US007294211B2

(12) United States Patent
Sturgill et al.

(10) Patent No.: US 7,294,211 B2
(45) **Date of Patent: *Nov. 13, 2007**

(54) NON-TOXIC CORROSION-PROTECTION CONVERSION COATS BASED ON COBALT

(75) Inventors: Jeffrey Allen Sturgill, Fairborn, OH (US); Andrew Wells Phelps, Kettering, OH (US); Joseph Thomas Swartzbaugh, Phillipsburg, OH (US)

(73) Assignee: University of Dayton, Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/038,274

(22) Filed: Jan. 4, 2002

(65) Prior Publication Data

US 2003/0234063 A1 Dec. 25, 2003

(51) Int. Cl.
*C22C 22/48* (2006.01)

(52) U.S. Cl. ..... 148/273; 148/243; 106/14.05; 106/14.21; 252/387; 252/387.1

(58) Field of Classification Search ..... 148/243, 148/273; 106/14.05, 14.21; 252/387, 389.1
See application file for complete search history.

(56) References Cited

U.S. PATENT DOCUMENTS

| | | | | |
|---|---|---|---|---|
| 1,078,788 | A | | 11/1913 | Kaplan |
| 1,216,451 | A | | 2/1917 | Holmes |
| 3,055,833 | A | | 9/1962 | Blatzer |
| 3,615,810 | A | | 10/1971 | Holznagel et al. |
| 3,879,523 | A | | 4/1975 | Miyata et al. |
| 4,012,195 | A | | 3/1977 | Noack |
| 4,024,036 | A | | 5/1977 | Nakamura et al. |
| 4,096,090 | A | | 6/1978 | Noack |
| 4,109,176 | A | | 8/1978 | Ernsthausen et al. |
| 4,469,521 | A | | 9/1984 | Salensky |
| 4,479,917 | A | | 10/1984 | Rothgery et al. |
| 4,564,511 | A | | 1/1986 | Desmond et al. |
| 4,673,445 | A | | 6/1987 | Tuttle, Jr. et al. |
| 5,188,993 | A | | 2/1993 | Takahashi et al. |
| 5,298,092 | A | | 3/1994 | Schriever |
| 5,322,560 | A | | 6/1994 | DePue et al. |
| 5,330,588 | A | | 7/1994 | Gulley |
| 5,344,504 | A | | 9/1994 | Deck et al. |
| 5,356,492 | A | | 10/1994 | Miller |
| 5,378,293 | A | | 1/1995 | Schriever |
| 5,399,210 | A | | 3/1995 | Miller |
| 5,411,606 | A | | 5/1995 | Schriever |
| 5,415,687 | A | | 5/1995 | Schriever |
| 5,419,790 | A | | 5/1995 | Miller |
| 5,427,632 | A | | 6/1995 | Dolan |
| 5,449,414 | A | | 9/1995 | Dolan |
| 5,449,415 | A | | 9/1995 | Dolan |
| 5,468,307 | A | | 11/1995 | Schriever |
| 5,472,524 | A | | 12/1995 | Schriever |
| 5,487,949 | A | | 1/1996 | Schriever |
| 5,505,792 | A | * | 4/1996 | Ouyang et al. ..... 148/241 |
| 5,551,994 | A | | 9/1996 | Schriever |
| 5,582,654 | A | | 12/1996 | Mansfeld et al. |
| 5,584,946 | A | | 12/1996 | Karmaschek et al. |
| 5,587,059 | A | | 12/1996 | Yamoto et al. |
| 5,604,040 | A | | 2/1997 | Sugama |
| 5,672,329 | A | | 9/1997 | Okada et al. |
| 5,683,816 | A | | 11/1997 | Goodreau |
| 5,743,971 | A | | 4/1998 | Inoue et al. |
| 5,756,218 | A | | 5/1998 | Buchheit et al. |
| 5,759,244 | A | | 6/1998 | Tomlinson |
| 5,873,952 | A | | 2/1999 | Hall et al. |
| 5,873,953 | A | | 2/1999 | Schriever |
| 6,068,709 | A | * | 5/2000 | Schapira et al. ..... 148/253 |
| 6,074,464 | A | | 6/2000 | Eddinger et al. |
| 6,117,251 | A | | 9/2000 | Rivera |
| 6,193,815 | B1 | | 2/2001 | Wada et al. |
| 6,200,672 | B1 | | 3/2001 | Tadokoro et al. |
| 6,291,018 | B1 | | 9/2001 | Dattilo |
| 6,432,225 | B1 | | 8/2002 | Schriever |
| 6,472,079 | B2 | | 10/2002 | Hayashi et al. |
| 6,500,276 | B1 | | 12/2002 | Minevski et al. |
| 6,582,814 | B2 | | 6/2003 | Swiler et al. |
| 2003/0221590 | A1 | | 12/2003 | Sturgill et al. |
| 2003/0230363 | A1 | | 12/2003 | Sturgill et al. |
| 2004/0011252 | A1 | | 1/2004 | Sturgill et al. |
| 2004/0016910 | A1 | | 1/2004 | Phelps et al. |
| 2004/0020568 | A1 | | 2/2004 | Phelps et al. |
| 2004/0104377 | A1 | | 6/2004 | Phelps et al. |
| 2004/0231754 | A1 | | 11/2004 | Phelps et al. |

FOREIGN PATENT DOCUMENTS

DE 33 09 194 A1 10/1983

(Continued)

OTHER PUBLICATIONS

Chemical Abstract Registry citation 100687-47-6, Mar. 1986.
Chemical Abstract Registry citation 256459-53-7, Feb. 2000.

*Primary Examiner*—John P. Sheehan
(74) *Attorney, Agent, or Firm*—Dinsmore & Shohl LLP

(57) ABSTRACT

Conversion coatings based on cobalt are described for substrate metals such as aluminum, zinc, magnesium, titanium, cadmium, silver, copper, tin, lead, cobalt, zirconium, beryllium, or indium, their alloys, or items coated with these metals. The conversion coating contains a trivalent or tetravalent cobalt/valence stabilizer complex. The coating bath may also contain a preparative agent or solubility control agent. The oxidized cobalt is present in the coating in a "sparingly soluble" form. The valence stabilizers can be either inorganic or organic in nature. Cobalt/valence stabilizer combinations are chosen based on the well-founded principles of cobalt coordination chemistry. A number of cobalt/valence stabilizer combinations that match the performance of conventional hexavalent chromium systems are presented.

71 Claims, No Drawings

FOREIGN PATENT DOCUMENTS

| | | | |
|---|---|---|---|
| DE | 197 54 108 A 1 | | 6/1999 |
| DE | 199 23 084 A 1 | | 11/2000 |
| DE | 199 23 084 | A1 | 11/2000 |
| EP | 0 368 470 | A1 | 5/1990 |
| EP | 0 405 340 | A1 | 1/1991 |
| EP | 0 458 020 | A1 | 11/1991 |
| EP | 0 486 778 | B1 | 5/1992 |
| EP | 0 488 430 | A2 | 6/1992 |
| EP | 0 523 288 | A1 | 1/1993 |
| EP | 0 634 460 | A2 | 1/1995 |
| EP | 0 675 173 | A2 | 10/1995 |
| EP | 0 872 543 | A2 | 10/1998 |
| EP | 0 872 543 | A3 | 10/1998 |
| EP | 0 523 288 | B1 | 11/1998 |
| EP | 0 905 279 | A1 | 3/1999 |
| EP | 0949353 | A1 | 10/1999 |
| GB | 2 138 796 | A | 10/1984 |
| GB | 2 139 206 | A | 11/1984 |
| JP | 03240971 | | 10/1991 |
| JP | 5-302179 | | 11/1993 |
| JP | 8-120460 | | 5/1996 |
| JP | 2000-234177 | | 8/2000 |
| WO | WO 91/11542 | | 8/1991 |
| WO | WO 93/05198 | | 3/1993 |
| WO | WO 93/15154 | | 8/1993 |
| WO | WO 93/15155 | | 8/1993 |
| WO | WO 94/00619 | | 1/1994 |
| WO | WO 94/26859 | | 11/1994 |
| WO | WO 95/04169 | | 2/1995 |
| WO | WO 95/31093 | | 11/1995 |
| WO | WO 96/05335 | | 2/1996 |
| WO | WO 96/21753 | | 7/1996 |
| WO | WO 96/27692 | | 9/1996 |
| WO | WO 96/27693 | | 9/1996 |
| WO | WO 96/29448 | | 9/1996 |
| WO | WO 98/47631 | | 10/1998 |
| WO | WO 98/51841 | | 11/1998 |
| WO | WO 98/56963 | | 12/1998 |
| WO | WO 99/35307 | | 7/1999 |
| WO | WO 00/36176 | | 6/2000 |
| WO | WO 01/32952 | A1 | 5/2001 |
| WO | WO 01/32954 | A2 | 5/2001 |

* cited by examiner

NON-TOXIC CORROSION-PROTECTION CONVERSION COATS BASED ON COBALT

CROSS-REFERENCE TO RELATED APPLICATIONS

This application is related to commonly assigned U.S. patent application Ser. No. 10/037,576, NON-TOXIC CORROSION-PROTECTION PIGMENTS BASED ON COBALT, filed Jan. 4, 2002 by Sturgill et al. and U.S. patent application Ser. No. 10/038,150, NON-TOXIC CORROSION-PROTECTION RINSES & SEALS BASED ON COBALT, filed Jan. 4, 2002 by Sturgill et al., the disclosures of which are incorporated herein by reference.

BACKGROUND OF THE INVENTION

This invention relates generally to compositions and methods for the formation of protective, corrosion-inhibiting coatings on metals, or other materials coated with metals, without the use of chromium in the hexavalent oxidation state. More particularly, this invention relates to non-toxic, corrosion-inhibiting conversion coatings based on trivalent and tetravalent cobalt and methods of making and using the same.

Metals like aluminum, zinc, magnesium, titanium, cadmium, silver, copper, tin, lead, cobalt, zirconium, beryllium, or indium, their alloys, or items coated with these metals, tend to corrode rapidly in the presence of water due to their low oxidation-reduction (redox) potentials or ease of oxide formation. Non-alloyed specimens of these metals typically form a natural oxide film that will protect them somewhat and reduce their overall rate of corrosion. However, alloys of these metals are particularly sensitive to corrosive attack. These materials also have a significant problem with paint adhesion. The as-formed metal surfaces are typically very smooth, and they tend to form weakly bound surface oxides. The native oxides do not normally provide a robust base on which subsequent paints can anchor themselves. These metal alloys have many uses ranging from architectural adornments to protective coatings on ferrous alloys to structural aerospace components.

The 2000 and 7000 series of aluminum alloys are used throughout military and civilian aircraft because of their high strength to weight ratio. However, these aluminum alloys are very sensitive to corrosive attack because their natural oxide layer offers only a limited degree of protection. Materials with greater redox potentials, such as steels or carbon fibers, in proximity to aluminum alloys will promote corrosive attack in water by the formation of a galvanic corrosion couple with the less-noble light metal alloy.

Inhibiting the initiation, growth, and extent of corrosion is a significant part of component and systems design for the successful long-term use of metal objects. Uniform physical performance and safety margins of a part, a component, or an entire system can be compromised by corrosion.

One method to enhance the corrosion resistance of these alloys is through the use of a conversion coating. A conversion coating is a self-healing, corrosion-inhibiting layer formed during intentional exposure to a chemically reactive solution. The conversion coating process forms an adherent surface containing an integral corrosion inhibitor with "throwing power" that can provide protection to coating breaches. The metal is exposed to a compound that chemically alters the surface and forms a coating that provides a high degree of corrosion resistance. A chemical conversion coating applied to the surface of a less-noble alloy can reduce the extent and severity of aqueous corrosion, provide long-term property stability, and extend the useful life of the object of manufacture.

Conversion coatings incorporate a portion of the base metal and form a mechanical, chemical, and electrostatic barrier to corrosive attack. A critical feature of effective conversion coatings is their ability to provide corrosion protection to the base metal in the presence of a coating breach.

Anodization of a metal surface followed by "sealing" or "rinsing" of the anodized metal does not constitute the formation of a conversion coating in our usage. Anodization, the formation of a porous oxide film on the metal, is achieved by the application of an electrical potential to the metal. This oxide film must then be "sealed", "washed", or "rinsed" in order to impart complete corrosion protection. Typically, the corrosion protection afforded by an anodized piece is due to the barrier oxide film. Conversion coatings, however, grow an oxide coating on the metal without an externally applied electrical potential. The protective film is produced by a chemical redox reaction between the metal surface and the conversion coating solution. The film is composed both of an oxide and integral corrosion inhibitor species formed during exposure to the conversion coating solution. A true conversion coating therefore affords corrosion protection from an oxide barrier film that has co-deposited oxidative corrosion inhibitor species.

A conversion-coated surface may be left bare or afforded further protection by the application of additional films or coatings. Conversion coatings need to adhere to the substrate and should result in a surface that will promote the formation of a strong bond with subsequently applied coatings. Bonding with subsequently applied coatings is a function of the morphology and chemical composition of the conversion coating. Adhesion promoting surface treatments may exhibit corrosion inhibiting characteristics. Depending on the intended application, a conversion coating, as described herein, may be considered to be an "adhesion promoter" and vice versa.

Conversion coatings are usually formed by the application of a conversion coating solution to a metal surface. The solution can be applied by immersion, spray, fogging, wiping, or other means.

Hexavalent chromium has traditionally been used in the formation of protective conversion coatings for aluminum, zinc, magnesium, titanium, cadmium, silver, copper, tin, lead, cobalt, zirconium, beryllium, indium, and their alloys. Compounds such as Alodine 1200™ (Henkel Co.) and Alumagold™ (Turco Co.) contain hexavalent chromium as their main corrosion-inhibiting compound.

Two generic types of hexavalent chromium coatings have been widely used. The newer "gold" coatings are named for the faint gold tint that the coatings have when they form on the surface of aluminum alloys. The compositions and application procedures of these "gold" hexavalent chromium conversion coating formulations are described in United States military process specifications, as well as other federal guidelines. Therefore, guidelines for the application of these solutions to aluminum (MIL C-5541; MIL C-81706; MIL STD-171; ASTM B-449), zinc (ASTM B-633; ASTM B-201; MIL C-17711; QQ Z-325a), magnesium (MIL M-3171), cadmium (ASTM A-165; ASTM B-201; QQ P-416b), silver (ASTM B-700; QQ S-365a), copper (ASTM B-281), and tin (ASTM A-599; QQ-T-425a) are available. The common components to these "gold" conversion coating baths are hexavalent chromium, complex fluorides, and ferricyanide. Older "green" conversion coatings containing hexavalent chromium have also been described, and the color formed on aluminum alloys through the application of these conversion coatings is a light green color. The "green" formulations all contain hexavalent chromium, a fluoride, and an acidic phosphate component. The major compositional difference between the two is that the current "gold" formulation contains ferricyanide and the older "green" formulations contain phosphate.

Corrosion-resistant compositions have also been described which contain hexavalent chromium, fluoride, and molybdic acid or molybdates, rather than ferricyanide or phosphate. Tungstates and vanadates have also been used in combination with hexavalent chromium and fluoride. Hexavalent chromium formulations which do not contain a fluoride source, and which contain borate ions instead of ferricyanide or phosphate or molybdate have also been described. Hexavalent chromium has also been used in combination with stannates, oxalates, and tellurates. Finally, corrosion protection of aluminum, magnesium, or zinc alloys has been achieved through the use of hexavalent chromium, fluoride, and rare earth compounds.

The variation in the type and amount of additional components such as ferricyanide, phosphate, molybdate, and borate, etc., in conversion coat formulations based on hexavalent chromium is significant in light of the chemistry developed and presented in the present invention. It is important to note that hexavalent chromium conversion coatings which have nearly identical formulations, except for one or more of the non-chromium components, result in obvious differences on the applied metal surface for a given alloy (such as "gold" and "green" coatings). It is also important to note that differences in the composition of aluminum alloys will influence the chemistry of the conversion coating formed when only one hexavalent chromium conversion coat composition is used.

Significant efforts have been made to replace chromium with other metals for corrosion-inhibiting applications due to toxicity, environmental, and regulatory concerns. Cobalt is one non-toxic, non-regulated metal which has been considered as a chromium replacement. Cobalt (like chromium) exhibits more than one oxidation state ($Co^{+2}$ and $Co^{+3}$). In addition, the oxidation-reduction potential of the $Co^{+3}$—$Co^{+2}$ couple is comparable to the $Cr^{+6}$—$Cr^{+3}$ couple. For example, in acid solution:

| | |
|---|---|
| $Co^{+3} + e \Rightarrow Co^{+2}$ | +1.92 V |
| $Cr^{+6} + 3e \Rightarrow Cr^{+3}$ | +1.36 V |

A number of processes have been reported in the literature which make use of cobalt in conversation coating bath solutions, as well as general corrosion protection or coloring of the alloys. However, the coatings formed by these processes provide only limited protection and do not approach the benefit derived from the use of hexavalent chromium.

The use of film-forming substances, such as polymers, silicates, sol-gel, etc., which have no inherent oxidizing character, in conversion coating solutions has been described in the literature. The film formers may enhance short-term corrosion resistance by functioning as a barrier layer. However, these films interfere with substrate oxidation during the conversion coating process and produce thin, incompletely anodized surfaces, resulting in poor mechanical adhesion to the solution-deposited polymer film and to later applied coatings. Restricting the formation of the oxide layer that acts as a reservoir for the active corrosion inhibitor yields a barrier film that is inhibitor starved. Barrier layers lacking an active corrosion inhibitor have been demonstrated to be capable of inhibiting corrosion only as long as the barrier is not breached, as by a scratch or other flaw. Film formers can actually enhance corrosion on a surface after failure due to the well known effects of crevice corrosion. The addition of polymer during conversion coating also produces a smooth coating which can reduce subsequent paint adhesion, resulting in reduced long-term corrosion protection.

The following references describe conversion coating processes based on cobalt: PCT International Application Nos. WO 96/29,448, WO 98/51,841, WO 96/21,753, WO 93/05,198, and S. African Patent No. ZA 93/01,234 to Dolan; PCT International Application Nos. WO 96/05,335, WO 94/00,619, and European Patent Application Nos. EP 523,288, EP 458,020, EP 488,430, and U.S. Pat. Nos. 5,873,953, 5,411,606, 5,378,293, 5,298,092, and 5,551,994 to Schriever. These specifications use additives that they term "bath stabilizers." These chemical species are claimed to form more stable coordination bonds with cobalt(III) cations than with cobalt(II) cations in the aqueous conversion coating solution. Specifically, carboxylates, hydroxyalkyl amines (aminoalcohols, such as triethanolamine), or nitrito complexes are described in these specifications as being added to the bath to retain trivalent cobalt in solution and to stabilize concentrations during the coating process. These bath stabilizers only treat and extend the service life of the cobalt(III) in the conversion coating solution itself.

"Bath stabilizers" used in the manner of these specifications reduce the formation and precipitation of $Co^{+3}$-containing solids during coating deposition. Bath stabilizers described in these patents behave similar to masking agents for chemical gravimetric analysis to keep unwanted compounds from precipitating. They actually serve to starve the deposited coating of $Co^{+3}$ by shifting the equilibrium away from the formation of a corrosion-inhibiting coating containing trivalent cobalt on a metal surface to the trivalent cobalt remaining dissolved in the coating bath. The compounds formed from the solutions described in these specifications have lower structural stability in the coating, as well as higher aqueous solubility, than if no bath stabilizer were used at all. The art described in the specification and examples herein shows that the solubilities of the formed compounds are still too high to afford long-term corrosion protection.

A post-treatment rinse with a vanadate or tungstate solution is used in PCT International Application Nos. WO 96/29,448 and WO 98/51,841 to Dolan, as well as PCT International Application No. WO 96/05,335 and U.S. Pat. No. 5,551,994 to Schriever. This rinse seals the coating deposited from the solution, as described in these specifications. $Co^{+3}$-vanadate/tungstate complexes form during these sealing treatments. These complexes are slightly soluble and serve to enhance the corrosion resistance of the deposited coating. However, the sealing step used in this art is not an efficient method to treat the coating thickness or to incorporate sparingly soluble $Co^{+3}$ compounds into the coating effectively. The effectiveness of the vanadate/tungstate sealing step is also reduced because the bath stabilizers carried over from the first solution increase the solubility of $Co^{+3}$-vanadate/tungstate complexes. Furthermore, the toxicity of the conversion coatings is not reduced if pentavalent vanadium is used in chrome-free compositions because the threshold limit value (TLV) of both $CrO_3$ and $V_2O_5$ is 0.05 $mg/m^3$, and the permissible exposure limit (PEL) of both is 0.5 $mg/m^3$.

These Schriever and Dolan coating processes also require the use of elevated temperatures, especially for the sealing process (40 to 75° C. being a typical range). Conversion coating processes that take place at elevated temperatures (above room temperature) can result in higher coating costs and increase the difficulty of the coating application.

Accordingly, a need exists for improved corrosion-protection conversion coatings composed of currently unregulated and/or non-toxic materials which have an effectiveness, ease of application, and performance comparable to coatings formed with hexavalent chromium, and for methods of making and using the same.

SUMMARY OF THE INVENTION

That need is met by the present invention which represents a significant improvement in the formulation of non-toxic conversion coatings through the use of trivalent cobalt. The conversion coatings of the present invention inhibit corrosion to a higher degree than any other known cobalt-based coatings. Moreover, the coatings inhibit corrosion to a degree comparable to commercial formulations based on hexavalent chromium. They do not require the use of elevated temperatures, exotic materials, or application methods.

The present invention utilizes 'valency stabilization' of the trivalent (or tetravalent) cobalt ion in the as-formed conversion coatings to achieve corrosion resistance that is comparable to hexavalent chromium. More specifically, in order to achieve a high degree of corrosion resistance, a conversion coating can exhibit the following characteristics:

1) The coating can contain an oxidizing species. Oxidizing species serve two important functions within the coating: a) they act to impede the flow of charged species through the coating, therefore helping reduce the transport of corrosion reactants, and b) if a scratch is formed in the coating, these oxidizing species act to "repair" the breach by oxidizing the underlying metal and quickly reforming an oxide barrier. The effectiveness of oxidizing species is a function of their individual oxidation-reduction potential, and the more highly oxidized species exhibit greater corrosion protection. An oxidation-reduction potential of approximately +0.80 V (at a pH of 0) appears to be the dividing line between inhibitors that offer some corrosion protection and those that do not. The trivalent cobalt ion, with an oxidation-reduction potential of +1.92 V (at a pH of 0), is an exceptionally good oxidizing species. The hydroxyl and oxygen liberated from water when trivalent cobalt is reduced will oxidize ("passivate") nearby bare metal.
2) A "valence stabilizer" for the trivalent cobalt can be employed to ensure that the ion will not be reduced quickly to the divalent state in solution or in the coating. The importance of stabilizing the cobalt ion in its trivalent state in a solid precipitate was not previously recognized as important to the formation of a conversion coating.
3) The trivalent cobalt species formed in the coating can be present as a "sparingly soluble" material. If the formed trivalent cobalt species is too soluble, then it will be washed away. If it is too insoluble, then insufficient trivalent cobalt is available to inhibit corrosion. A trivalent cobalt species that exhibits low solubility will not only fail to inhibit corrosion, but can promote localized crevice corrosion and result in enhanced corrosion rates. In order to form an effective conversion coating, the trivalent cobalt compounds formed in the coating must be in a "sparingly soluble" form. It is difficult to place specific solubility values to these optimum "sparingly soluble" coating materials because there appear to be several variables associated with what makes an optimum coating material. It appears that if the trivalent cobalt is incorporated in the coating in the form of a trivalent cobalt/valency stabilizer complex, which exhibits a solubility in water of between about $5\times10^{-5}$ and about $5\times10^{-2}$ moles per liter of trivalent cobalt, then appreciable corrosion inhibition will be observed. Coatings that incorporate stabilized trivalent cobalt compounds that fall outside of this particular solubility range may also exhibit some corrosion inhibition. For example, compositions with solubilities as high as $5\times10^{-1}$ moles per liter or as low as $1\times10^{-5}$ moles per liter of trivalent cobalt, at standard temperature and pressure, exhibited some corrosion resistance, although not as great as those compounds which fall within the optimum solubility range. The degree of effectiveness will depend on the particular compound itself. The solubility characteristics of the trivalent cobalt in the conversion coatings must be controlled through the use of stabilizer materials which form compounds that fall within a desired solubility range. In this way, a "controlled release" of trivalent cobalt can be achieved, much as a "timed release" of hexavalent chromium is achieved in the "state-of-the-art" systems.
4) The "valence stabilizer" helps establish an electrostatic barrier layer around the cation-stabilizer complex in aqueous solutions. The nature and character of the electrostatic double-layer surrounding the cation-stabilizer complex may be controlled and modified by careful selection of stabilizer species. Characteristics such as the electrical dipole moment and the shape/conformation (for steric effects) of the stabilizer were found to influence the performance of the conversion coating. In general, the electrostatic double layer formed acts to protect the cation from premature reaction with hydronium, hydroxide, and other ions in solution. The formation of electrostatic barrier layers also helps to impede the passage of corrosive ions through the conversion coatings to the metallic surface.

This phenomena is exhibited in the hexavalent chromium systems, wherein the highly charged hexavalent chromium is surrounded by very polar ferricyanide ions. The orientation of the dipoles of the ferricyanide ions with respect to the highly charged chromate ion serves to attract additional layers of ions in the aqueous solution. These ions form a protective shell around the cation-stabilizer complex.

5) The coating material may also exhibit ion exchange behavior towards alkali species. This optional consideration is important for the formation of conversion coatings which resist corrosion because alkali ions (especially sodium) are notoriously corrosive towards alloys which contain metals such as aluminum, magnesium, or zinc. The hexavalent chromium-ferricyanide complex formed in the conventional systems also exhibits this ion exchange phenomena.

The corrosion resistance of a number of aluminum alloys as tested using both ASTM B-117 and ASTM G-85 has been enhanced through the use of stabilized trivalent cobalt conversion coatings. Not only do these optimized coatings retard corrosion to a higher degree than other prior art trivalent cobalt baths, but their corrosion resistance is comparable to that of hexavalent chromium systems. Unlike the prior art, the trivalent cobalt conversion coatings of the present invention do not require elevated temperatures for their application, nor do they use materials which are as toxic as the hexavalent chromium they are attempting to replace.

The valence stabilizers can be inorganic or organic. A multitude of organic and inorganic stabilizer materials have been used.

In one aspect, the invention comprises a mechanistic and chemical approach to the production of corrosion-resistant conversion coatings using trivalent cobalt. This approach uses stabilizer materials which form compounds with trivalent cobalt that are sparingly soluble in aqueous solution, typically from about $5\times10^{-2}$ to about $5\times10^{-5}$ moles/liter of trivalent cobalt. This solubility range provides a release of trivalent cobalt at a rate sufficiently slow enough that protection will be provided for an extended period of time and fast enough to inhibit corrosion during conventional accelerated corrosion testing methods such as ASTM B-117 and ASTM G-85 for conversion coatings. Compounds that fall slightly outside of this solubility range (as high as $5\times10^{-1}$ to as low as $1\times10^{-5}$ moles/liter of trivalent cobalt at standard temperature and pressure) may also prove to be effective conversion coatings under certain conditions. However, compounds that exhibit aqueous solubilities far outside of the target range are unlikely to be effective corrosion inhibitors. The solubility of the formed trivalent cobalt compounds plays a significant role in the effectiveness of the formed coating. Solubility control can be achieved using organic or inorganic stabilizer materials.

In another aspect, the invention is the achievement of corrosion-resistant conversion coatings using trivalent cobalt. This approach also utilizes stabilizer materials, which form compounds that exhibit dipoles so as to form electrostatic barrier layers composed of ions, such as hydronium ($H_3O^+$) or hydroxide ($OH^-$). The formation of these barrier layers through the use of stabilizer materials can be achieved using organic or inorganic materials.

In an optional aspect, the invention is the achievement of corrosion-resistant conversion coatings using trivalent cobalt by the use of stabilizer materials, which form compounds that exhibit ion exchange behavior towards alkali ions. The formation of this ion exchange behavior can be achieved through the use of organic or inorganic materials.

In another optional aspect, the invention is the achievement of corrosion-resistant conversion coatings using preparative agents in conjunction with the cobalt to strip uncontrolled native oxide layers on the work piece surface, as well as to control the rate of coating deposition. Typical preparative agents for the formation of trivalent cobalt conversion coatings are fluorides and fluorine-containing chemicals. Acidic species or other halides such as chlorides, bromides, and iodides can be used, but are less effective than fluorides as preparative agents.

In another optional aspect, the invention is the achievement of superior corrosion-resistant conversion coatings by allowing the deposited trivalent cobalt-containing coating to reach a desired thickness and/or morphology in order to maximize adhesion to the work piece, as well as maximizing adhesion of subsequently-applied paint films to the conversion coating. Ideally, the thickness of the formed trivalent cobalt conversion coating should be approximately 200 nanometers. The minimum thickness allowable for a satisfactory pinhole-free trivalent cobalt conversion coating is approximately 25 nanometers, and the maximum allowable thickness is approximately 10,000 nanometers. The morphology of the formed conversion coating should be sufficient to allow for paint films to adhere to it. A "mud crack" or "honeycomb" morphology is typical.

Accordingly, it is an object of the present invention to provide non-toxic corrosion-protection conversion coating baths based on trivalent cobalt and methods of making and using the same. These and other objects and advantages of the present invention will become apparent from the following detailed description and claims.

DETAILED DESCRIPTION OF THE INVENTION

A) Starting Materials

Five general starting materials can be used for the conversion coating baths of the present invention. These include: a cobalt source; an oxidation source (optional); a preparation agent source (optional); a valence stabilizer source; and additional solubility control agents (optional). These materials may be included as neat compounds in the conversion coating bath, or may be added to the conversion coating bath as already-prepared solutions. Further enhancements to the formed coating may be imparted through the use of additional starting materials. Foremost among these are agents to improve the color-fastness of the coating.

1) Cobalt Source a) Trivalent Cobalt

The cobalt precursor compounds can be almost any cobalt compound in which the cobalt is in either the divalent or trivalent oxidation state. Water-soluble precursors are typically used. Examples of inorganic divalent cobalt precursor compounds include, but are not restricted to: cobalt nitrate, cobalt sulfate, cobalt perchlorate, cobalt chloride, cobalt fluoride, cobalt bromide, cobalt iodide, cobalt bromate, cobalt chlorate, and complex fluorides such as cobalt fluosilicate, cobalt fluotitanate, cobalt fluozirconate, cobalt fluoborate, and cobalt fluoaluminate. Examples of organometallic divalent cobalt precursor compounds include, but are not restricted to: cobalt formate, cobalt acetate, cobalt propionate, cobalt butyrate, cobalt benzoate, cobalt glycolate, cobalt lactate, cobalt tartronate, cobalt malate, cobalt tartrate, cobalt citrate, cobalt benzenesulfonate, cobalt thiocyanate, and cobalt acetylacetonate. Complex divalent cobalt precursor compounds include, but are not limited to, ammonium cobalt sulfate, ammonium cobalt nitrate, ammonium cobalt chloride, and ammonium cobalt bromide.

The cobalt precursor may also be a compound in which the cobalt is already in the trivalent oxidation state. Examples of these compounds include, but are not restricted to: hexaaminecobalt chloride, hexaaminecobalt bromide, hexaaminecobalt nitrate, pentaaminecobalt chloride, pentaaminecobalt bromide, pentaaminecobalt nitrate, lithium cobaltinitrite, sodium cobaltinitrite, tris(ethylenediamine) cobalt chloride, tris(ethylenediamine) cobalt nitrate, bipyridine complexes of trivalent cobalt, phenanthroline complexes of trivalent cobalt, cobalt (III) acetylacetonate, cobalticarbonates, cobalt (III) acetate, cobalt (III) chloride, and cobalt (III) sulfate.

While trivalent cobalt precursor compounds can be used, they are not recommended for the following reasons: 1) their cost is several orders of magnitude higher than divalent cobalt precursors; 2) in some instances (e.g., cobaltinitrite or cobalticarbonate compounds) they generate large quantities of gas ($NO_2$ or $CO_2$) when placed into acidic solutions; and 3) they lead to lower corrosion protection in the formed coatings because they are stabilized with additional materials to improve their solubility in water.

It may not be necessary to add a separate cobalt source for these conversion coating solutions if a cobalt-containing alloy is to be treated. The preparative agent contained within these conversion coating formulations can dissolve some of the cobalt in the substrate. This will result in divalent cobalt ions being present in the coating solution. A suitable oxidizer can then oxidize the divalent cobalt to the necessary trivalent oxidation state during or after coating deposition.

b) Tetravalent Cobalt

The tetravalent cobalt ion ($Co^{+4}$) is an even better oxidizing species than $Co^{+3}$. It has a radius of 0.053 nanometers, carries a charge of +4, and has a redox potential of over 2.0V. However, it has a correspondingly lower stability both in and out of solution. Therefore, valence stabilization of this ion is required in order to use it effectively in a conversion coating. Its very large redox potential makes it prone to rapid reduction, and few materials will effectively valence stabilize it in a sparingly soluble complex, which make its routine application problematic. Tetravalent cobalt can be made using chemical or electrolytic oxidation, as can trivalent cobalt.

The presence of both trivalent and tetravalent cobalt in these coatings can be determined by their magnetic behavior. A combination of $Co^{+3}$ and $Co^{+4}$ is reportedly paramagnetic. The difficulty of its formation or stabilization should not preclude the use of tetravalent cobalt in some conversion coatings. While it is not a typical species because of these difficulties, tetravalent cobalt can be incorporated either alone or in conjunction with trivalent cobalt by using tailored valence stabilizers.

2) Oxidation Source

Oxidizers serve two important functions within the coating: 1) they act in cooperation with the stabilizer to impede the flow of ionic species through the coating, therefore minimizing charge transport, and 2) if a scratch is formed in the coating, these oxidizing species act to repair the breach by oxidizing the metal in the presence of water, and quickly reforming an oxide barrier. The effectiveness of the oxidizing species is a function of its individual oxidation-reduction potential, with more highly oxidized species exhibiting greater corrosion protection.

In order to provide adequate oxidation potential in the conversion coating solution, especially if divalent cobalt compounds are utilized as precursors, an oxidizing species must also be included as a starting material. Additional amounts of oxidizer may be added to help control and maintain a desired amount of $Co^{+3}$ in the conversion coating solution by reoxidizing $Co^{+3}$ that has been reduced. Because of the high potential of the redox reaction required to oxidize divalent cobalt to trivalent (or tetravalent) cobalt, strong oxidizers must be utilized for this purpose. These oxidizers may be gaseous, liquid, or solid in form. Solid oxidizers are typically used for this application due to ease of handling and reagent measurement. Other starting materials (cobalt source, fluoride source, stabilizer source) will frequently also be solids. Liquid oxidizers may also be used, but handling and accurate process metering have proven difficult. Gaseous oxidizers may be the most cost effective and chemically efficient on a large scale, but are also the most problematic due to handling and venting concerns.

Examples of oxidizers suitable for the purpose of producing and maintaining the cobalt ion in the trivalent charge state include, but are not restricted to: peroxides and peroxo compounds (including superoxides, persulfates, perborates, pernitrates, perphosphates, percarbonates, persilicates, peraluminates, pertitanates, perzirconates, permolybdates, pertungstates, pervanadates, and organic peroxyacid derivatives), ozone, hypochlorites, chlorates, perchlorates, nitrates, nitrites, vanadates, iodates, hypobromites, chlorites, bromates, permanganates, periodates, and dissolved oxygen. Both inorganic and organic derivatives of these compounds may be used. Typical oxidizers are peroxides, persulfates, perbenzoates, periodates, bromates, hypochlorites, and gaseous dissolved oxygen, including the oxygen content of air. In general, any inorganic, organic, or combination species that has an oxidation potential of +1.5V or higher (at a pH of 1) will be capable of oxidizing divalent cobalt to the trivalent, or in some instances the tetravalent, oxidation state.

Oxidation of the cobalt to the trivalent state may also be achieved in the conversion coating solution through electrolytic means. In most instances, however, this approach may not be economically feasible due to the large energy costs associated with electrolytic oxidation. Chemical oxidation, such as that described above, currently offers the lowest-cost means to achieve oxidation of the cobalt to the trivalent state.

It is also possible to deposit divalent cobalt in a conversion coating, and then apply a second solution containing an oxidizer to oxidize divalent cobalt to trivalent cobalt. This, however, is less typical because the percentage of deposited cobalt that will be in the trivalent state will be less than if trivalent cobalt were deposited directly.

In the conversion coating solutions based on hexavalent chromium, oxidation sources are added to speed up the conversion coating process. Hence, they are termed "accelerators" in the hexavalent chromium formulations. Because the application of an acid (i.e., a conversion coating solution) to an electronegative metal will result in the formation of hydrogen gas, cathodic areas on the treated metal will be partially blocked from further coating formation. Oxidizers ("accelerators") act to eliminate hydrogen gas formation, thereby minimizing its barrier effect, and hence accelerating the overall deposition rate. It is for this reason that it is also desirable to have oxidizers in the initial conversion coating bath.

3) Preparative Agent Source

Uniform, adherent, low-defect film growth can be achieved if the conversion coat is deposited on a suitably prepared surface. Removing pre-existing "wild" native oxides is the first step to achieve the formation of high-quality conversion coatings. A preparative agent is any material that removes (dissolves and breaks up) preexisting surface oxides and provides a bare metal surface on which to deposit the conversion coating. The hexavalent chromium formulations term these materials "activators" or "surface etchants." The breakup and dissolution of the surface oxide in solution produces a bare unprotected metal suited for controlled oxidation, textures the surface, and encourages precipitation of the conversion coat compounds at the metal surface by locally raising the solution pH.

Fluoride acids and salts work especially well as preparative agents in conversion coating baths. The complex fluoride anions hexafluorozirconate ($ZrF_6^{-2}$) and hexafluorotitanate ($TiF_6^{-2}$) are superior fluoride sources for this application. Hexafluorosilicates ($SiF_6^{-2}$) can be used, but they result in a reduced level of subsequent corrosion protection. The potassium, lithium, sodium, and ammonium salts of these anions work especially well for this application, with potassium performing the best.

Other complex fluorides, including, but not restricted to, fluoroaluminates (e.g., $AlF_6^{-3}$ or $AlF_4^{-1}$), fluoroborates (e.g., $BF_4^{-1}$), fluorogallates (e.g., $GaF_4^{-1}$) fluoroindates (e.g., $InF_4^{-1}$), fluorogermanates (e.g., $GeF_6^{-2}$), fluorostannates (e.g., $SnF_6^{-2}$), fluorophosphates (e.g., $PF_6^{-1}$), fluoroarsenates (e.g., $AsF_6^{-1}$), fluoroantimonates (e.g., $SbF_6^{--1}$), fluorobismuthates (e.g., $BiF_6^{-1}$), fluorosulfates (e.g., $SF_6^{-2}$), fluoroselenates (e.g., $SeF_6^{-2}$), fluorotellurates (e.g., $TeF_6^{2}$ or $TeOF_5^{-1}$), fluorocuprates (e.g., $CuF_3^{-1}$ or $CuF_4^{-2}$), fluoroargentates (e.g., $AgF_3^{-1}$ or $AgF_4^{-2}$), fluorozincates (e.g., $ZnF_4^{-2}$), fluorohafnates (e.g., $HfF_6^{-2}$), fluorovanadates (e.g., $VF_7^{-2}$), fluoroniobates (e.g., $NbF_7^{-2}$), fluorotantalates (e.g., $TaF_7^{-2}$), fluoromolybdates (e.g., $MoF_6^{-3}$), fluorotungstates (e.g., $WF_6^{-1}$), fluoroyttrates (e.g., $YF_6^{-3}$), fluorolanthanates (e.g., $LaF_6^{3}$), fluorocerates (e.g., $CeF_6^{3}$ or $CeF_6^{-2}$), fluoromanganates (e.g., $MnF_6^{-2}$), fluoroferrates (e.g., $FeF_6^{-3}$), fluoronickelates (e.g., $NiF_6^{-2}$), and fluorocobaltates (e.g., $CoF_6^{-2}$) are also suitable fluoride sources, but these offer even less corrosion protection than hexafluorosilicates. Water-soluble potassium, sodium, lithium, or ammonium salts of these anions are typical.

Simple inorganic fluorides such as potassium fluoride (KF), potassium hydrogen fluoride ($KHF_2$), sodium fluoride (NaF), sodium hydrogen fluoride ($NaHF_2$), lithium fluoride (LiF), lithium hydrogen fluoride ($LiHF_2$), ammonium fluoride ($NH_4F$), ammonium hydrogen fluoride ($NH_4HF_2$), and even hydrofluoric acid solutions (HF) can also be used as a fluoride source. By analogy, organic compounds that provide a ready supply of aqueous fluoride ions will likewise serve as adequate fluoride sources.

Other halide species, such as chlorides ($Cl^-$), bromides ($Br^-$), and iodides ($I^-$) can also function as preparative agents, although their efficiency in stripping the surface oxide will not be as great as the fluorides. Inorganic or organic compounds that release chloride, bromide, or iodide anions can function as preparative agents, as can a number of complex chlorides and bromides that are similar to those described for the fluorides. By analogy, complex hexachlorozirconates ($ZrCl_6^{-2}$), hexachlorotitanates ($TiCl_6^{-2}$), and hexachlorosilicates ($SiCl_6^{-2}$) should function better than other chloride sources, and analogous complex bromide and iodide sources will function better than other bromides and iodides.

Acidic species, such as nitric acid, sulfuric acid, phosphoric acid, pyrophosphoric acid, hydrochloric acid, perchloric acid, hydrobromic acid, hydriodic acid, iodic acid, periodic acid, disulfuric acid, selenic acid, telluric acid, polyphosphoric acid, cyclophosphoric acid, boric acid, vanadic acid, molybdic acid, tungstic acid, carboxylic acids, phosphonic acids, and sulfonic acids can also function as preparative agents. Of these, nitric acid is the most useful as a preparative agent.

Although it is less desirable, hydroxides can also function as preparative agents. For example, under high pH conditions zinc and aluminum are known to dissolve in water, through the formation of zincate or aluminate anions. The use of hydroxides such as sodium, potassium, lithium, or ammonium derivatives will result in this pH rise.

Changes in the concentrations of the fluoride components also had significant effects upon the character of the deposited coating. It was found that the corrosion resistance of the formed coating was reduced if the fluoride concentration in solution came near or exceeded its solubility in water. Craters form in the coating, apparently caused by excess back etching of deposited oxides. The concentration of fluoride also appears to influence the thickness of the formed coating. The substrate metal remains bright and shiny at very low fluoride concentrations. These effects were found to begin when the ratio of fluoride ions to cobalt ions in the coating solution dropped below 0.05.

Fluoride species with different alkali metals appeared to have negligible effect upon the coating or its corrosion resistance. The use of lithium did not result in any improvement in corrosion resistance. Changes in the fluoride's associated alkali metals (e.g., $K_2ZrF_6$, $Na_2ZrF_6$) did alter the solubility of fluoride in solution and so control the amount of fluoride available to etch the metal surface.

If a preparative agent is not included in the conversion coating bath, then the "wild" native oxides must be removed by some other process prior to the application of the conversion coating.

4) Valence Stabilizers

Corrosion resistance comparable to that of hexavalent chromium can be achieved by the use of valence stabilized trivalent or tetravalent cobalt ions in the conversion coating solutions. Valence stabilization has not been recognized previously as an important consideration in the development of effective corrosion inhibiting conversion coats. A variety of inorganic and organic stabilizers are available that can control such properties as solubility, mobility, ion exchange, and binder compatibility. The stabilizer complex can also act as an ion-exchange host and/or trap for alkali or halide ions in solution.

Cobalt is effective as an oxidation corrosion inhibitor if it can be supplied in sufficient quantities in the trivalent or tetravalent charge state when brought into contact with unprotected bare metal. The characteristics of the $Co^{+3}$ ion which are relevant to its use in conversion coating applications include: 1) its valence is fairly stable in solution but is less stable on drying, 2) its compounds typically have large aqueous solubilities, 3) it is more stable in acidic or neutral pH aqueous solutions than in basic solutions, and 4) its radius of 0.061 nanometers is slightly larger than the 0.044 nanometers of the hexavalent chromium ion, and so it will have a correspondingly lower charge density (electrostatic field) per ion.

The need for "valence stabilization" of trivalent (or tetravalent) cobalt for corrosion inhibition has been indirectly noted in the general corrosion literature. Corrosion inhibition behavior of nitrogen-containing organics such as aniline or pyridine has been reported to be enhanced with the addition of cobalt. The exact nature of this "synergistic enhancement" has never been adequately explained. These "synergistic" mixtures of nitrogen-containing organics and cobalt have also been described as being "oxygen-scavengers", and the organics are frequently observed to "chemisorb" onto the substrate piece being protected.

This enhancement can be explained by our "valence stabilization" model of corrosion inhibition by trivalent (or tetravalent) cobalt. Nitrogen-containing organics and cobalt result in the formation of an organometallic complex where the central cobalt ion can be stabilized in a higher oxidation state. The observed "oxygen-scavenging" phenomenon associated with dissolved oxygen in aqueous solutions is easily explained by the oxidation of stabilized divalent cobalt to the trivalent state. "Sparingly soluble" $Co^{+3}$ complexes containing these organics are responsible for the corrosion-inhibiting activity, and these organics will appear to be "adsorbed" or "chemisorbed" from solution onto the metal piece being protected due to precipitation.

As noted in the Summary of the Invention, the valence stabilizer serves a number of important functions in the establishment of a successful conversion coating. First, the valence stabilizer, when used with trivalent cobalt, must result in a "sparingly soluble" $Co^{+3}$-valence stabilizer complex. Although the exact solubility of this complex can be slightly modified through the incorporation of different cations or anions (either through the dissolution of the coated metal, or the subsequent treatment by additional solubility control agents), appreciable corrosion inhibition will be observed if the trivalent cobalt is incorporated in the conversion coating as a $Co^{+3}$-stabilizer complex that exhibits a solubility in water of between about $5\times10^{-5}$ moles per liter and about $5\times10^{-2}$ moles per liter of available $Co^{+3}$. Therefore, any material (inorganic or organic) in the coating bath which complexes with trivalent cobalt and results in the formation of a $Co^{+3}$-containing complex which exhibits solubilities within or near this solubility range can serve as a valence stabilizer for trivalent cobalt.

Conversion coatings which incorporate stabilized trivalent cobalt compounds that fall outside this particular solubility range may exhibit some degree of corrosion inhibition and may be effective conversion coatings under certain circumstances. Although not as effective as those compounds within the optimum solubility range, compositions with solubilities as high as $5\times10^{-1}$ moles per liter or as low as $1\times10^{-5}$ moles per liter of trivalent cobalt, at standard temperature and pressure (about 25° C. and about 760 Torr), exhibited some corrosion resistance. For example, in situations where the substrate metal pieces are exposed to environments which require much more immediate corrosion exposure (e.g., sudden immersion in seawater), adequate corrosion protection can be achieved through the formation of a trivalent cobalt compound which exhibits a higher solubility in water (e.g., $5\times10^{-1}$ to $5\times10^{-3}$ moles/liter trivalent cobalt). In this way, a more "immediate" release of protective trivalent cobalt ions can be achieved, although the trivalent cobalt will be depleted faster from the coating. Trivalent cobalt solubilities that are lower than this optimum range (e.g., $1\times10^{-5}$ to $1\times10^{-3}$ moles/liter of trivalent cobalt) may be desirable for some situations (e.g., in nearly pure water with low aeration rates). However, compounds that exhibit solubilities far outside the target range are unlikely to be effective corrosion inhibitors.

The solubility characteristics of the trivalent cobalt in the conversion coatings must be controlled with stabilizer materials that form compounds within the desired solubility range. The exact solubility will be strongly dependent on the application of the conversion coating and net aqueous solubility of overlying paints and coatings. The formation of conversion coatings with the proper release rate of $Co^{+3}$ ions is problematic because of the instability of $Co^{+3}$ out of solution. Trivalent cobalt compounds, such as acetate, sulfate, acetylacetonate, and hexaamine chloride, are generally too soluble to serve as effective corrosion inhibitors if incorporated into a conversion coating. Oxides and hydroxides of $Co^{+3}$ are much too insoluble in water to serve effectively as corrosion inhibitors in a conversion coating.

The key to providing a useful source of trivalent cobalt at a metal surface is the creation of a sparingly soluble compound in which the $Co^{+3}$ ion is shielded from premature reduction during and after conversion coating formation. The assembly of a protective shell around the highly charged $Co^{+3}$ and its associated oxygen and hydroxyl species can help control the rate at which the cobalt is reduced and its oxygen is released. Proper selection of materials for forming the protective shell will allow solubility tailoring of the entire assembly to its intended application environment. Valence stabilizers are materials that, when assembled, modify the rate of reduction and the solubility of the $Co^{+3}$ ion.

The electrostatic character of the complex can also be considered in creating a $Co^{+3}$ stabilizer complex with optimal corrosion resistance. Valence stabilizers can also contribute to the development of a substantial electrostatic double layer. An electrostatic double layer of polar or charged species such as hydronium ($H_3O^+$) or hydroxide ($OH^-$) ions surrounding the stabilized cobalt complex will help control cobalt reduction and solubility and enhance the barrier properties of the conversion coating. Valence stabilizers which form sparingly soluble cobalt complexes with enhanced electrostatic double layers will maximize the corrosion-inhibiting character of the conversion coating.

The trivalent cobalt ion is slightly larger than the hexavalent chromium ion, with less charge density over the surface of the ion. Therefore, the valence stabilizers for $Co^{+3}$ must be more efficient in the establishment of dipole moments than the ferricyanide ion so that comparable corrosion resistance can be achieved in relation to the state of the art $Cr^{+6}$-ferricyanide compositions. Valence stabilizers which have a comparable dipole moment to ferricyanide, or which exhibit even less of a dipole moment than ferricyanide can also function as valence stabilizers, but the resultant corrosion resistance of the conversion coatings will, in all probability, be less than for the current commercial hexavalent chromium-based conversion coatings.

Large spheres of hydration around corrosion inhibitors can act as electrostatic and physical barriers to the passage of large corrosive ions such as $Cl^-$ and $SO_4^{-2}$ through the coating to the metal surface. The size of the electrostatic double layer is a function of the electrostatic potential at the complex surface and is inversely proportional to the ionic strength of the surrounding solution. Compounds that can carry a charge, have a natural electrostatic dipole, or can have a dipole induced, will likely form an electrostatic double layer in aqueous solution. However, these compounds do not normally act as corrosion inhibitors because they have not been optimized for that purpose.

Optionally, the incorporation of the valence stabilizer (inorganic or organic) should result in the formation of a $Co^{+3}$-valence stabilizer compound which exhibits ion exchange behavior towards alkali ions. As noted in the Summary of the Invention, this is not a requirement of the $Co^{+3}$-valence stabilizer complex, but it is a desirable characteristic for enhanced corrosion resistance. Some existing state of the art chromium systems exhibit this phenomena, but conversion coating compounds that do not exhibit this phenomena have been successfully demonstrated to inhibit corrosive attack.

Cobalt coordination chemistry, which has been the subject of numerous scientific studies for almost 100 years, identifies chemical binding preferences, structure stability, and physical properties of the resulting compounds. Producing effective $Co^{+3}$-valence stabilizer complexes requires understanding the electrostatic and structural influence of candidate species on the complex. Stabilizers can be designed that result in cobalt compounds with the necessary physical, electrical, and chemical properties to form corrosion inhibitors with this information. Property tailoring can also take place through selection of specific anions or cations bound to the $Co^{+3}$-valence stabilizer coordination complex.

The functional anatomy of inorganic stabilizers is simple because of the limited number of atoms and structural arrangements involved in their formation. The anatomy of organic stabilizers is not as simple. An organically stabilized cobalt complex may have one or more organic ligands that may have one or more bonding sites that can interact with the $Co^{+3}$ ion/oxide cluster. The bonding groups can be the same or different atoms or functional groups on an individual or a variety of ligands. An organic stabilizer ligand can be modified in an unlimited number of ways to tailor its physical behavior with respect to such properties as chemical reactivity, solubility, electrostatic and polar character, and functional behavior.

The stability of the $Co^{+3}$-valence stabilizer complex is strongly influenced by the charge, polarity sign, and degree of polarizability of specific binding sites. Factors influencing compound stability include: 1) ion-pair interactions for charged ligands and $Co^{+3}$, 2) ion-dipole and ion-induced dipole interactions for neutral ligands, 3) hydrogen bonding, and 4) the hard-soft acid-base (HSAB) rules convention of coordination chemistry. HSAB rules help identify functional groups on ligands that might be effective as binding sites. Optimum binding for organic valence stabilizers to $Co^{+3}$ will involve ligands with soft bonding species such as those that contain sulfur or phosphorus. Certain coordination complexes of the hard base nitrogen are also effective for binding with $Co^{+3}$. HSAB rules can also help identify groups that might provide a degree of polarization to the stabilizer because of their large dipole moments.

The nature of bonding between the $Co^{+3}$ ion/oxide cluster and the stabilizer ligand can be altered by using a substituent group to modify the stabilizer. Specific interactions between the ligand and $Co^{+3}$ can be tailored by substituent group selection, coupled with altering the size or geometry of the complexing ligand. For example, some substituent groups have large dipole moments associated with them, which will increase the electrostatic barrier layers associated with the cobalt/valence stabilizer complexes. These include: ketones (═C═O), thioketones (═C═S), amides (—C[═O]—$NR_2$), thioamides (—C[═S]—$NR_2$), nitriles or cyano groups, (—CN), isocyanides (—NC), nitroso groups (—N═O), thionitroso groups (—N═S), nitro groups (—$NO_2$), azido groups (—$N_3$), cyanamide or cyanonitrene groups (═N—CN), cyanate groups (—O—CN), isocyanate groups (—N═C═O), thiocyanate groups (—S—CN), isothiocyanate groups (—N═C═S), nitrosamine groups (═N—N═O), thionitrosamine groups (═N—N═S), nitramine groups (═N—$NO_2$), thionitramine groups (═N—$NS_2$), carbonylnitrene groups (—CO—N), thiocarbonylnitrene groups (—CS—N), sulfenyl halides (—S-X), sulfoxides (═S═O), sulfones (═S[═O]$_2$), sulfinyl groups (—N═S═O), thiosulfinyl groups (—N═S═S), sulfenyl thiocyanato groups (—S—S—CN), sulfenyl cyanato groups (—S—O—CN), sulfodiimine groups (═S[═NH]$_2$), sulfur dihaloimido groups (—N═$SX_2$), sulfur oxide dihaloimido groups (—N═S[═O]$X_2$), aminosulfur oxide trihalide groups (═N—S[═O]$X_3$), sulfonyl azide groups (—S[═O]$_2N_3$), sulfonyl thiocyanate groups (—S[═O]$_2$SCN), sulfonyl cyanate groups (—S[═O]$_2$OCN), sulfonyl cyanide groups (—S[═O]$_2$CN), halosulfonate groups (—S[═O]$_2$OX), phosphonyl thiocyanate groups (—P[═O]OHSCN), phosphonyl cyanate groups (—P[═O]OHOCN), and phosphonyl cyanide groups (—P[═O]OHCN). The polarization of the $Co^{+3}$-stabilizer can therefore be optimized via evaluation of the effect of ligand type and substituents. The influence of the $Co^{+3}$ ion on the aqueous solution outside of, or external to, the valence stabilizer shell (or hydration sphere) may play an important role in the complexation properties of a given ligand. It will also control the diameter of the hydration shell around the $Co^{+3}$-stabilizer complex.

The number of binding sites available on the complexing ligand is important to the resulting $Co^{+3}$-stabilizer's properties. Several ligands are required to stabilize $Co^{+3}$ effectively if the chosen ligand has only one binding site. Six $NH_3$ ligands are needed to octahedrally coordinate $Co^{+3}$ in a hexaaminecobalt(III) complex because $NH_3$ has only one binding site. Bulky ligands with only one binding site, like pyridine, can be sterically hindered from packing tightly around the ion, which will result in decreased complex stability. Conversely, macrocyclic organic and polymeric inorganic ligands may have many suitable binding sites. However, instability will result if a $Co^{+3}$ ion is not completely embraced by all of the multiple macromolecular bonding sites on the ligand. For example, if a macromolecule surrounding the $Co^{+3}$ ion has an insufficient number of binding sites available for charge balance, then the $Co^{+3}$-stabilizer complex will be much less stable than with a macromolecule that contains an adequate number of sites.

The physical geometry of the binding sites is important to the stability of the $Co^{+3}$-stabilizer complex. The influence of site geometry becomes evident when the solvation shell of a $Co^{+3}$ ion is replaced by the ligand donor atoms as when conversion coatings are formed. The number of available ligand binding sites should be at least equal to the standard coordination number of the $Co^{+3}$ ion. The balance between solvation of the ligand and $Co^{+3}$ and their complexation where $Co^{+3}$ is solvated by a specific ligand is critical in maintaining stability. $Co^{+3}$-ligand attraction increases with the number of available binding sites on the ligand. However, with an increasing number of binding sites, site-site repulsions will also increase, resulting in lower stability.

The $Co^{+3}$ ion generally favors complexation in the tetrahedral (coordination number 4) or octahedral (coordination number 6) arrangements. However, it will occasionally be found in a trigonal bipyramidal or square planar arrangement. Valence stabilizers (and stabilizer combinations) should be selected with the goal of achieving these coordinations.

Inorganic materials that tend to "polymerize" and form octahedra or tetrahedra (or a combination thereof) around ions such as $Co^{+3}$ are termed isopolyanions, and their resultant complexes with $Co^{+3}$ are termed heteropolyanions or heteropolymetallates. This polymerization of the inorganic valence stabilizer species results in stacks of octahedra or tetrahedra with central cavities which can accommodate at least one $Co^{+3}$ ion, thereby stabilizing it.

Valence stabilizers and combinations of stabilizers can be manipulated by the selection of "shaping groups" and heteroatoms positioned at the binding site. Inorganic valence stabilizers are typically oxygen-containing coordination compounds. Saturated organic chains can form flexible ligands that wrap around $Co^{+3}$ and can enhance its stability. Unsaturated organics typically have less freedom to bend and contort and are less likely to be able to wrap around the $Co^{+3}$ ion. The addition of substituents onto an organic ligand may further restrict its freedom to flex.

The actual size of the valence stabilizer complex situated around the $Co^{+3}$ ion has an important role in solubility control. Solubility of the complex scales roughly with the inverse of its physical diameter. $Co^{+3}$ and its layer of negatively charged hydroxyl ions is very small and results in its high degree of aqueous solubility. The field strength of the complex also scales with the inverse of its physical diameter. Large complexes with an optimal degree of solubility will not necessarily be ideal with respect to the size of the electrostatic double layer. The size of the ligand must, therefore, be balanced against the desired electrical properties.

The addition (or subtraction) of functional groups on organic valence stabilizers can be used to modify the solubility of the formed $Co^{+3}$/valence stabilizer species. For example, the addition of sulfonated groups (—$SO_3^-$) to organic valence stabilizers will significantly increase the solubility in water. Other substituent groups that will increase the solubility in water include: carboxyl groups (—$CO_2$—), hydroxyl groups (—OH), ester groups (—$CO_3^-$), carbonyl groups (═C═O), amine groups (—$NH_2$), nitrosamine groups (═N—N═O), carbonylnitrene groups (—CO—N), sulfoxide groups (═S═O), sulfone groups (═S[═O]2), sulfinyl groups (—N═S═O), sulfodiimines (═S[═NH]$_2$), sulfonyl halide groups (—S[═O]$_2$X), sulfonamide groups (—S[═O]$_2$NH$_2$), monohalosulfonamide groups (—S[═O]$_2$NHX), dihalosulfonamide groups (—S [═O]$_2$MX$_2$), halosulfonate groups (—S [═O]$_2$ OX), halosulfonate amide groups (═N—S[═O]$_2$X), aminosulfonate groups (═N—S[═O ]$_2$OH), iminodisulfonate groups (—N[$SO_3^-$]$_2$), phosphonate groups (—$PO_3^{-2}$), phosphonamide groups (—$PO_2NH_2$—), phosphondiamide groups (—PO[$NH_2$]$_2$), aminophosphonate groups (═N—$PO_3^{-2}$), and iminodiphosphonate groups (—N[$PO_3^{-2}$]$_2$). Conversely, the addition of nitro groups (—$NO_2$), perfluoroalkyl groups (—$C_xF_{2x+1}$), perchloroalkyl groups (—$C_xCl_{2+1}$), nitramine groups (═N—$NO_2$), thioketone groups (═C═S), sulfenyl halide groups (—S-X), or sulfur dihaloimide groups (—N═$SX_2$) to organic valence stabilizers will decrease the solubility in water. In this way, the solubility characteristics of valence stabilizers can be tailored to meet specific needs.

The physical, chemical, and electrostatic-requirements for the design of effective $Co^+$-stabilizer complexes results in lists of stabilizers that may be divided into wide band or narrow band stabilizer classes. The compounds listed here are general guides for the initial selection of a coordination compound and do not represent a complete or final list. New organic and inorganic compounds are continuously being developed, compound toxicity limits can change, and some currently available compounds may have been overlooked. Tailoring substituent groups and the selection of cations or anions for charge balance can influence whether a particular $Co^{+3}$-stabilizer complex will have a wide band or narrow band character.

Valence stabilizers for trivalent cobalt that embody the desirable characteristics of stabilizers as described above are typical when designing a conversion coating for maximum effectiveness. These "wide band" stabilizers result in the formation of compounds that provide significant corrosion resistance when used with trivalent cobalt. "Narrow band" valence stabilizers result in satisfactory conversion coatings only under limited applications. Wide band conversion coatings for general purpose applications and narrow band conversion coatings for specific uses have been identified and developed. In general, valence stabilizers that form cobalt complexes which exhibit the necessary physical properties of stability, solubility, and polarization may be achieved with both inorganic and organic valence stabilizers. Ion exchange behavior can also be achieved with both inorganic and organic coordination compounds.

4a) Wide Band Inorganic Valence Stabilizers

Wide band inorganic stabilizers are formed around the $Co^{+3}$ ion by polymerizing in the conversion coating solution near the metal surface being treated. Acidic coating solutions can become basic near the metal surface where precipitation of the cobalt-stabilizer complex occurs during the coating process. Inorganic wide band valence stabilizers for $Co^{+3}$ include, but are not limited to: molybdates ($Mo^{+6}$, $Mo^{+5}$, or $Mo^{+4}$, for example $[Co^{+3}Mo_6O_{18}(OH)_6]^{3-}$and $[Co^{+3}{}_2Mo_{10}O_{34}(OH)_4]^{6-}$), tungstates ($W^{+6}$, $W^{+5}$, or $W^{+4}$, for example $[Co^{+3}W_{12}O_{40}]^{5-}$), vanadates ($V^{+5}$ and $V^{+4}$, for example $[Co^{+3}V_{10}O_{28}]^{3-}$), niobates ($Nb^{+5}$ and $Nb^{+4}$, for example $[Co^{+3}Nb_4O_{12}(OH)_2]^{3-}$), tantalates ($Ta^{+5}$ and $Ta^{+4}$, for example $[Co^{+3}Ta_4O_{12}(OH)_2]^{3-}$), tellurates ($Te^{+6}$ and $Te^{+4}$), periodates ($I^{+7}$), iodates ($I^{+5}$, for example $[Co^{+3}(IO_3)_4]^{1-}$), carbonates ($C^{+4}$, for example $[Co^{+3}(CO_3)_3]^{3-}$), antimonates ($Sb^{+5}$ and $Sb^{+3}$), and stannates ($Sn^{+4}$). Many of these inorganics form octahedral and tetrahedral heteropolymetallate structures on precipitation from solution. For example, tellurate ions begin to polymerize in solution near pH 5 and will complex with $Co^{+3}$ ions near the metal substrate as solution pH increases. The exact chemical nature of these valence stabilizers (i.e., chemical formulation and valence state of the atom in the center of the tetrahedra or octahedra) is highly dependent upon the specific pH and redox conditions.

The stability of the heteropolymetallates is a function of composition and structure. The relatively unstable $Co^{+3}$ ion is protected and stabilized within the surrounding octahedral and tetrahedral groups, although specific configurations of the heteropolymetallate anions differ from stabilizer to stabilizer (i.e., from molybdate to periodate to carbonate).

The dimensions of the octahedra and tetrahedra are controlled by the size of the heteroatom (e.g., Mo, W, Te) around which they are assembled. A $Co^{+3}$ ion trapped by the precipitation of these heteropolymetallates and its resulting "ion within a cage" structure can exhibit an even greater apparent volume due to the development of a large electrostatic double layer. This will influence both the valence stabilization of the $Co^{+3}$ as well as the solubility of the assembled complex. These compounds are also reported to be excellent ion exchange agents for alkali ions.

This caging structure serves to lower the solubility of the $Co^{+3}$ because the chemical elements typically associated with these valence stabilizers (e.g., I, Te, Mo, W) are all inherently less soluble in water than $Co^{+3}$. These materials can also establish oriented dipoles with the interior $Co^{+3}$ ion, thereby forming the desired barrier layers (e.g., of hydronium ions), much as ferricyanide or molybdate probably contributes to the hexavalent chrome systems. Finally, the elements associated with these valence stabilizers themselves can contain high valence ions, such as $V^{+5}$, $Te^{+6}$, or $Mo^{+6}$, which will also serve somewhat in corrosion protection, although not to the degree of $Co^{+3}$, due to their lower redox potential.

Water-soluble precursors for the formation of these valence stabilizers are desirable in order to ensure that sufficient material is available for coating deposition from aqueous solutions. Identification of suitable water-soluble precursors may be difficult, since many of the elements associated with these valence stabilizers (e.g., Mo, W, Te, etc.) do not typically form water-soluble compounds (hence their beneficial use as a valence stabilizer). Representative examples of suitable precursors for "wide band" inorganic valence stabilizers are listed in Table 6.

The solubilities given in Table 6 are usually for the simplest salts of each compound. More complex, partially "polymerized" salts for each compound (e.g., para- or meta-polymorphs) can also be used as precursors, although these polymorphs typically exhibit slightly lower solubilities in water than the simple salts. Peroxo-salts of these compounds, especially percarbonates, permolybdates, pertungstates, pertitanates, and pervanadates can also be utilized as precursors. Formation of the chosen heteropolymetallates from precursors such as the fluorides, chlorides, bromides, nitrates, and perchlorates (e.g., $SnCl_4$ to form heterostannates, and $SbF_5$ to form heteroantimonates) proved to be difficult, but may be acceptable under certain circumstances.

$Co^{+3}$ stabilized with a heteropolymolybdate complex is an example of a wide band inorganically stabilized cobalt complex. This complex is very stable and provides significant corrosion protection when it is used as a conversion coating. The size of the cavity developed at the center of a ligand with three or more bonding sites is important. A cavity that is too large or too small will tend to be less stable and less effective in use as a corrosion inhibitor.

The valence stabilizer can be a cross between two or more of the wide-band inorganic valence stabilizers listed above. For example, in some instances it may be desirable to form a valence stabilizer out of a periodate and a molybdate. During the coating process, both of these materials will polymerize to form a mixed periodate/molybdate valence stabilizer out of the conversion coating solution.

4b) Wide Band Organic Valence Stabilizers

A variety of organic compounds meet the criteria to be typical valence stabilizers for $Co^{+3}$. These coordination ligands produce $Co^{+3}$ valence stabilized complexes which fulfill the general requirements of a $Co^{+3}$ conversion coating material. Organic compounds can be very effective cobalt stabilizers and provide the greatest degree of freedom in designing new stabilizer species with new functionalities. There are many more possible organic valence stabilizer species than inorganic valence stabilizers because of the large number of organic compounds and functionalities which exist. Some of the typical organic valence stabilizer species are listed in Table 1 below.

The number of wide band (and narrow band) organic compounds that are acceptable as valence stabilizers for trivalent cobalt is limited. Common organic compounds such as alcohols, aldehydes, ketones, esters, ethers, alkyl or aromatic halides, most carboxylic acids, anhydrides, phenols, sulfonic acids, phosphonic acids, carbohydrates, waxes, fats, sugars, and oils are not as effective as the structural types described in these Tables to stabilize the trivalent cobalt ion. At best, some of the organic types described in these Tables may presently be used for other industrial applications, but their incorporation into corrosion-inhibiting blends to stabilize trivalent cobalt has heretofore been unrecognized.

The choice of substituent functional groups on these general classes of valence stabilizers will affect the physicochemical properties of the $Co^{+3}$-containing complex and the corrosion resistance achieved using that complex. For example, the addition of $—NH_2$, or 0 substituents increases the net polarization of the overall $Co^{+3}$-valence stabilizer complex, but this will also increase its water solubility. Careful molecular design of $Co^{+3}$ complexes is necessary to achieve desired performance characteristics.

In general, the bonding atoms in typical organic valence stabilizers are nitrogen, phosphorus, or sulfur, with oxygen being acceptable in some circumstances. Oxygen is complexed with $Co^{+3}$ most frequently in association with at least one of the other three. Bonding atoms such as carbon, silicon, tin, arsenic, selenium, and antimony are much less desirable due to problems with valence stability, toxicity, or solubility. Other stable coordinations (like octahedral) are known, even though these particular agents are shown in tetrahedral coordination with $Co^{+3}$. These valence stabilizers all serve to stabilize the $Co^{+3}$ ion within a sparingly soluble complex that can exhibit a polar character in aqueous solution.

TABLE 1

Wide Band Organic Valence Stabilizers for the $Co^{+3}$ Ion

| General Structural Name (Type of Organic) | Structural Representation |
|---|---|
| N Valence Stabilizer #1: Monoamines (N Monodentates) | $NH_3$, $NH_2R$, $NHR_2$, and $NR_3$ where R represents H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #2: Diamines (N—N Bidentates) | R'—N—R—N—R", where R, R', and R" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #3: Triamines (either N—N Bidentates or N—N Tridentates) | R—N—R'—N—R"—N—R'", where R, R', R", and R'" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #4: Tetramines (N—N Bidentates, N—N Tridentates, or N—N Tetradentates) | R—N—R'—N—R"—N—R'"—N—R"", where R, R', R", R'", and R"" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 1-continued

Wide Band Organic Valence Stabilizers for the $Co^{+3}$ Ion

| General Structural Name (Type of Organic) | Structural Representation |
|---|---|
| N Valence Stabilizer #5: Pentamines (N—N Bidentates, N—N Tridentates, or N—N Tetradentates) | R—N—R'—N—R''—N—R'''—N—R''''—N—R'''', where R, R', R'', R''', R'''', and R''''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #6: Hexamines (N—N Bidentates, N—N Tridentates, N—N Tetradentates, or N—N Hexadentates) | R—N—R'—N—R''—N—R'''—N—R''''—N—R''''—N—R''''', where R, R', R'', R''', R'''', R''''', and R'''''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #7: Five-Membered Heterocyclic Rings containing One, Two, Three, or Four Nitrogen Atoms wherein at least one Nitrogen Atom is a Binding Site (N Monodentates or N—N Bidentates) | Five membered heterocyclic ring containing one, two, three, or four nitrogen atoms, all of which may or may not function as binding sites. Can include other ring systems bound to this heterocyclic ring, but they do not coordinate with the stabilized, high valence metal ion. Ring can also contain O, S, or P atoms. This 5-membered ring and/or attached, uncoordinating rings may or may not have halogen or polarizing or water-insolubilizing/solubilizing groups attached. |
| N Valence Stabilizer #8: Six-Membered Heterocyclic Rings containing One, Two, Three, or Four Nitrogen Atoms wherein at least one Nitrogen Atom is a Binding Site (N Monodentates or N—N Bidentates) | Six membered heterocyclic ring containing one, two, three, or four nitrogen atoms, all of which may or may not function as binding sites. Can include other ring systems bound to this heterocyclic ring, but they do not coordinate with the stabilized, high valence metal ion. Ring can also contain O, S, or P atoms. This 6-membered ring and/or attached, uncoordinating rings may or may not have halogen or polarizing or water-insolubilizing/solubilizing groups attached. |
| N Valence Stabilizer #9: Five-Membered Heterocyclic Rings containing One, Two, Three, or Four Nitrogen Atoms and having at least one additional Nitrogen Atom Binding Site not in a Ring (N Monodentates, N—N Bidentates, N Tridentates, N—N Tetradentates, or N—N Hexadentates) | Five membered heterocyclic ring(s) containing one, two, three, or four nitrogen atoms. In addition, ligand contains additional nitrogen-containing substituents (usually amines) that constitute N binding sites. Can include other ring systems bound to the heterocyclic ring or to the N-containing substiruent, but they do not coordinate with the stabilized, high valence metal ion. Ring(s) can also contain O, S, or P atoms. This 5-membered ring(s) and/or attached, uncoordinating rings and/or N-containing substituent(s) may or may not have halogen or polarizing or water-insolubilizing/solubilizing groups attached. |
| N Valence Stabilizer #10: Six-Membered Heterocyclic Rings containing One, Two, Three, or Four Nitrogen Atoms at least one additional Nitrogen Atom Binding Site not in a Ring (N Monodentates, N—N Bidentates, N—N Tridentates, N—N Tetradentates, or N—N Hexadentates) | Six membered heterocyclic ring(s) containing one, two, three, or four nitrogen atoms. In addition, ligand contains additional nitrogen-containing substituents (usually amines) that constitute N binding sites. Can include other ring systems bound to the heterocyclic ring or to the N-containing substituent, but they do not coordinate with the stabilized, high valence metal ion. Ring(s) can also contain O, S, or P atoms. This 6-membered ring(s) and/or attached, uncoordinating rings and/or N-containing substituent(s) may or may not have halogen or polarizing or water-insolubilizing/solubilizing groups attached. |
| N Valence Stabilizer #11: Five-Membered Heterocyclic Rings containing One, Two, Three, or Four Nitrogen Atoms at least one additional | Five membered heterocyclic ring(s) containing one, two, three, or four nitrogen atoms. In addition, ligand contains additional nitrogen-containing rings that constitute N binding sites. |

TABLE 1-continued

Wide Band Organic Valence Stabilizers for the $Co^{+3}$ Ion

| General Structural Name (Type of Organic) | Structural Representation |
|---|---|
| Nitrogen Atom Binding Site in a Separate Ring (N Monodentates, N—N Bidentates, N—N Tridentates, N—N Tetradentates) | Can include other ring systems bound to the N-containing heterocyclic rings, but they do not coordinate with the stabilized, high valence metal ion. Ring(s) can also contain O, S, or P atoms. This 5-membered ring(s) and/or additional N-containing ring(s) and/or attached, uncoordinating rings may or may not have halogen or polarizing or water-insolubilizing/solubilizing groups attached. |
| N Valence Stabilizer #12: Six-Membered Heterocyclic Rings containing One, Two, Three, or Four Nitrogen Atoms at least one additional Nitrogen Atom Binding Site in a Separate Ring (N Monodentates, N—N Bidentates, N—N Tridentates, N—N Tetradentates) | Six membered heterocyclic ring(s) containing one, two, three, or four nitrogen atoms. In addition, ligand contains additional nitrogen-containing rings that constitute N binding sites. Can include other ring systems bound to the N-containing heterocyclic rings, but they do not coordinate with the stabilized, high valence metal ion. Ring(s) can also contain O, S, or P atoms. This 6-membered ring(s) and/or additional N-containing ring(s) and/or attached, uncoordinating rings may or may not have halogen or polarizing or water-insolubilizing/solubilizing groups attached. |
| N Valence Stabilizer #13: Two-, Three-, Four-, Six-, Eight-, and Ten-Membered Macrocyclics, Macrobicyclics, and Macropolycyclics (including Catapinands, Cryptands, Cyclidenes, and Sepulchrates) wherein all Binding Sites are composed of Nitrogen (usually amine or imine groups) and are not contained in Component Heterocyclic Rings (N—N Bidentates, N—N Tridentates, N—N Tetradentates, and N—N Hexadentates) | Macrocyclic ligands containing two, three, four, six, eight, or ten nitrogen binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| N Valence Stabilizer #14: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen and are contained in Component 5-Membered Heterocyclic Rings (N—N Bidentates, N—N Tridentates, N—N Tetradentates, or N—N Hexadentates) | Macrocyclic ligands containing a total of four, six, eight, or ten five-membered heterocyclic rings containing nitrogen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #15: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen and are contained in a Combination of 5-Membered Heterocyclic Rings and Amine or Imine Groups (N—N Bidentates, N—N Tridentates, N—N Tetradentates, or N—N Hexadentates) | Macrocyclic ligands containing at least one 5-membered heterocyclic ring. These heterocyclic rings provide nitrogen binding sites to valence stabilize the central metal ion. Other amine or imine binding sites can also be included in the macrocyclic ligand, so long as the total number of binding sites is four, six, eight, or ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #16: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen and are contained in Component 6-Membered Heterocyclic Rings (N—N Bidentates, N—N Tridentates, N—N Tetradentates, or N—N Hexadentates) | Macrocyclic ligands containing a total of four, six, eight, or ten six-membered heterocyclic rings containing nitrogen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #17: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of | Macrocyclic ligands containing at least one 6-membered heterocyclic ring. These heterocyclic rings provide nitrogen binding sites to valence stabilize the central metal ion. Other amine or imine binding sites can also be included in the macrocyclic ligand, so long as |

TABLE 1-continued

Wide Band Organic Valence Stabilizers for the $Co^{+3}$ Ion

| General Structural Name (Type of Organic) | Structural Representation |
|---|---|
| Nitrogen and are contained in a Combination of 6-Membered Heterocyclic Rings and Amine or Imine Groups (N—N Bidentates, N—N Tridentates, N—N Tetradentates, or N—N Hexadentates) | the total number of binding sites is four, six, eight, or ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #18: Amidines and Diamidines (N—N Bidentates and N—N Tetradentates) | R'—NH—C(—R)═N—R", where R, R', and R" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #19: Biguanides (Imidodicarbonimidic Diamides or Dihydrazides), Biguanidines, Imidotricarbonimidic Diamides or Dihydrazides, Imidotetracarbonimidic Diamides or Dihydrazides, Dibiguanides, Bis(biguanidines), Polybiguanides, and Poly(biguanidines) (N—N Bidentates, N—N Tridentates, N—N Tetradentates, and N—N Hexadentates) | RR'—N—C(═NH)—NR"—C(═NH)—NR'"R"" for biguanides, RR'—N—C(═NH)—NR"—NH—C(═NH)—NR'"R"" for biguanidines, where R, R', R", R'", and R"" represent H, $NH_2$, or any organic functional group wherein the number of carbon atoms ranges from 0 to 40, halogen or polarizing or water-insolubilizing/solubilizing groups attached. Ligand can also contain nonbinding N, O, S, or P atoms. |
| N Valence Stabilizer #20: Diamidinomethanes, Bis(amidinomethanes), and Poly(amidinomethanes) (N—N Bidentates, N—N Tridentates, N—N Tetradentates, and N—N Hexadentates) | RR'—N—C(═NH)—CR"R'"—C(═NH)—NR""R"", where R, R', R", R'", R"", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #21: Imidoylguanidines, Amidinoguanidines, Bis(imidoylguanidines), Bis(amidinoguanidines), Poly(imidoylguanidines), and Poly(amidinoguanidines) (N—N Bidentates, N—N Tridentates, N—N Tetradentates) | RR'—N—C(═NH)—NR"—C(═NH)—R'" for imidoylguanidines, and RR'—N—C(═NH)—NR"—NH—C(═NH)—R'" for amidinoguanidines, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #22: Diformamidine oxides (Dicarbonimidic Diamides or Dihydrazides), Tricarbonimidic Diamides or Dihydrazides, Tetracarbonimidic Diamides or Dihydrazides, Bis(diformamidine oxides), and Poly(diformamidine oxides) (N—N Bidentates, N—N Tridentates, N—N Tetradentates) | RR'—N—C(═NH)—O—C(═NH)—NR"R'", where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #23: Diformamidine Sulfides (Thiodicarbonimidic Diamides or Dihydrazides), Thiotricarbonimidic Diamides or Dihydrazides, Thiotetracarbonimidic Diamides or Dihydrazides, Bis(diformamidine sulfides), and Poly(diformamidine sulfides) (N—N Bidentates, N—N Tridentates, N—N Tetradentates) | RR'—N—C(═NH)—S—C(═NH)—NR"R'", where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #24: Imidodicarbonimidic Acids, Diimidodicarbonimidic Acids, Imidotricarbonimidic Acids, Imidotetracarbonimidic Acids, and derivatives thereof (N—N Bidentates, N—N Tridentates, N—N Tetradentates, and N—N Hexadentates) | R—O—C(═NH)—NR'—C(═NH)—O—R" for imidodicarbomimidic acids, and R—O—C(═NH)—NR'—NH—C(═NH)—O—R" for diimidodicarbonimidic acids, where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 1-continued

Wide Band Organic Valence Stabilizers for the $Co^{+3}$ Ion

| General Structural Name (Type of Organic) | Structural Representation |
|---|---|
| N Valence Stabilizer #25: Thioimidodicarbonimidic Acids, Thiodiimidodicarbonimidic Acids, Thioimidotricarbonimidic Acids, Thioimidotetracarbonimidic Acids, and derivatives thereof (N—N Bidentates, N—N Tridentates, N—N Tetradentates, and N—N Hexadentates) | R—S—C(═NH)—NR'—C(═NH)—S—R" for thioimidodicarbonimidic acids, and R—S—C(═NH)—NR'—NH—C(═NH)—S—R" for thiodiimidodicarbonimidic acids, where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #26: Diimidoylimines, Diimidoylhydrazides, Bis(diimidoylimines), Bis(diimidoylhydrazides), Poly(diimidoylimines), and Poly(diimidoylhydrazides) (N—N Tridentates and N—N Hexadentates) | R—C(═NH)—NR'—C(═NH)—R" for diimidoylimines, and R—C(═NH)—NR'—NH—C(═NH)—R" for diimidoylhydrazides, where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #27: Imidosulfamides, Diimidosulfamides, Bis(imidosulfamides), Bis(diimidosulfamides), Poly(imidosulfamides), and Poly(diimidosulfamides) (N—N Bidentates, N—N Tridentates, N—N Tetradentates, and N—N Hexadentates) | RR'—N—S(═NH)(═O)—OR" or RR'—N—S(═NH)(═O)—N—R"R'" for imidosulfamides, and RR'—N—S(═NH)(═NH)—OR" or RR'—N—S(═NH)(═NH)—N—R"R'" for diimidosulfamides, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #28: Phosphoramidimidic Triamides, Bis(phosphoramidimidic triamides), and Poly(phosphoramidimidic triamides) and derivatives thereof (N—N Bidentates, N—N Tridentates, N—N Tetradentates, and N—N Hexadentates) | (NH═)P(—NRR')(—NR"R'")(—NR""R""'), where R, R', R", R'", R"", and R""' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #29: Phosphoramidimidic Acid, Phosphorodiamidimidic Acid, Bis(Phosphoramidimidic Acid), Bis(Phosphorodiamidimidic Acid), Poly(Phosphoramidimidic Acid), Poly(Phosphorodiamidimidic Acid), and derivatives thereof (N—N Bidentates, N—N Tridentates, N—N Tetradentates, and N—N Hexadentates) | (NH═)P(—NRR')$(OH)_2$ for phosphoramidimidic acid, and (NH═)P(—NRR')(—NR"R'")(OH) for phosphorodiamidimidic acid, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #30: Phosphoramidimidodithioic Acid, Phosphorodiamidimidothioic Acid, Bis(Phosphoramidimidodithioic Acid), Bis(Phosphorodiamidimidothioic Acid), Poly(Phosphoramidimidodithioic Acid), Poly(Phosphorodiamidimidothioic Acid), and derivatives thereof (N—N Bidentates, N—N Tridentates, N—N Tetradentates, and N—N Hexadentates) | (NH═)P(—NRR')$(SH)_2$ for phosphoramidimidodithioic acid, and (NH═)P(—NRR')(—NR"R'")(SH) for phosphorodiamidimidothioic acid, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #31: Azo compounds with amino, imino, oximo, diazeno, or hydrazido substitution at the ortho- (for aryl) or alpha- or beta- (for alkyl) positions, Bis[o-($H_2N$—) or alpha- or beta-($H_2N$—)azo compounds], or Poly[o-($H_2N$—) or alpha- or beta-($H_2N$—)azo compounds) (N—N Bidentates, N—N Tridentates, N—N Tetradentates, or N—N Hexadentates) | R—N═N—R', where R, and R' represent H or any organic functional group wherein the number of carbon atoms ranges from 0 to 40, optionally having halogen or polarizing or water-insolubilizing/solubilizing groups attached. (Must include ortho-amino, imino, oximo, diazeno, or hydrazido substituted aryl azo compounds, and alpha- or beta-amino, imino, oximo, diazeno, or hydrazido alkyl azo compounds.) Ligand can also contain nonbinding N, O, S, or P atoms. |
| N Valence Stabilizer #32: Diazeneformimidamides | R—N═N—C(═NH)—NR'R" for diazeneformimidamides, and R—N═N—CR'R"— |

TABLE 1-continued

Wide Band Organic Valence Stabilizers for the $Co^{+3}$ Ion

| General Structural Name (Type of Organic) | Structural Representation |
|---|---|
| (Diazeneamidines), Diazeneacetimidamides (Diazene-alpha-amidinoalkanes(alkenes)), Bis(diazeneformimidamides), Bis(diazeneacetimidamides), Poly(diazeneformimidamides), and Poly(diazeneacetimidamides) (N—N Bidentates, N—N Tetradentates, and N—N Hexadentates) | C(=NH)—NR'''R'''' for diazeneacetimidamides, where R, R', R'', R''', and R'''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #33: Diazeneformimidic Acid, Diazeneacetimidic Acid, Bis(diazeneformimidic acid), Bis(diazeneacetimidic acid), Poly(diazeneformimidic acid), Poly(diazeneacetimidic acid), and derivatives thereof (N—N Bidentates, N—N Tetradentates, and N—N Hexadentates) | R—N=N—C(=NH)—OR' for diazeneformimidic acid, and R—N=N—CR'R''—C(=NH)—OR''' for diazeneacetimidic acid, where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #34: Diazeneformimidothioic Acid, Diazeneacetimidothioic Acid, Bis(diazeneformimidothioic acid), Bis(diazeneacetimidothioic acid), Poly(diazeneformimidothioic acid), Poly(diazeneacetimidothioic acid), and derivatives thereof (N—N Bidentates, N—N Tetradentates, and N—N Hexadentates) | R—N=N—C(=NH)—SR' for diazeneformimidothioic acid, and R—N=N—CR'R''—C(=NH)—SR''' for diazeneacetimidothioic acid, where R, R', R'', and R''' represent H, $NH_2$, or any organic functional group wherein the number of carbon atoms ranges from 0 to 40, optionally having halogen or polarizing or water-insolubilizing/sohibilizing groups attached. Ligand can also contain nonbinding N, O, S, or P atoms. |
| N Valence Stabilizer #35: Imidoyldiazenes, Bis(imidoyldiazenes), and Poly(imidoyldiazenes), (N—N Bidentates, N—N Tetradentates and N—N Hexadentates) | R—N=N—C(=NH)—R' or R—N=N—CR'R''—C(=NH)—R''', where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #36: Diazenediformimidamides (1,2-Diazenediamidines), Diazenediacetimidamides (1,2-Diazene-di-alpha-amidinoalkanes(alkenes)), Bis(diazenediformimidamides), Bis(diazenediacetimidamides), Poly(diazenediformimidamides), and Poly(diazenediacetimidamides) (N—N Tridentates and N—N Hexadentates) | RR'—N—C(=NH)—N=N—C(=NH)—NR''R'''for diazenediformimidamides, and RR'—N—C(=NH)—CR''R'''—N=N—CR''''R'''''—C(=NH)—NR''''''R''''''' for diazenediacetimidamides, where R, R', R'', R''', R'''', R''''', R''''''', and R''''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #37: Diazenediformimidic Acid, Diazenediacetimidic Acid, Bis(diazenediformimidic acid), Bis(diazenediacetimidic acid), Poly(diazenediformimidic acid), and Poly(diazenediacetimidic acid), and derivatives thereof (N—N Tridentates and N—N Hexadentates) | RO—C(=NH)—N=N—C(=NH)—OR' for diazenediformimidic acid, and RO—C(=NH)—CR'R''—N=N—CR'''R''''—C(=NH)—OR''''' for diazenediacetimidic acid, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #38: Diazenediformimidothioic Acid, Diazenediacetimidothioic Acid, Bis(diazenediformimidothioic acid), Bis(diazenediacetimidothioicacid), Poly(diazenediformimidothioic acid), and Poly(diazenediacetimidothioic acid), and derivatives thereof (N—N Tridentates and N—N Hexadentates) | RS—C(=NH)—N=N—C(=NH)—SR' for diazenediformimidothioic acid, and RS—C(=NH)—CR'R''—N=N—CR'''R''''—C(=NH)—SR''''' for diazenediacetimidothioic acid, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 1-continued

Wide Band Organic Valence Stabilizers for the $Co^{+3}$ Ion

| General Structural Name (Type of Organic) | Structural Representation |
|---|---|
| N Valence Stabilizer #39: Diimidoyldiazenes, Bis(diimidoyldiazenes), and Poly(diimidoyldiazenes), (N—N Tridentates and N—N Hexadentates) | R—C(=NH)—N=N—C(=NH)—R'' or R—C(=NH)—CR'R''—N=N—CR'''R''''—C(=NH)—R''''', where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #40: Ortho-amino (or -hydrazido) Substituted Formazans, Bis(o-amino or -hydrazido substituted formazans), and Poly(o-amino or -hydrazido substituted formazans) (N—N Bidentates, N—N Tridentates, N—N Tetradentates, and N—N Hexadentates) | R—N=N—CR'=N—NR''R''', where R, R', R'', and R''' represent H, or any organic functional group wherein the number of carbon atoms ranges from 0 to 40, optionally having halogen or polarizing or water-insolubilizing/solubilizing groups attached. (Must include ortho-amine or hydrazide substituted aryl R derivatives, and beta-amine or hydrazide substituted alkyl R derivatives.) Ligand can also contain nonbinding N, O, S, or P atoms. |
| N Valence Stabilizer #41: Ortho-amino (or -hydrazido) Substituted Azines (including ketazines), Bis(o-amino or hydrazido substituted azines), and Poly(o-amino or hydrazido substituted azines) (N—N Bidentates, N—N Tridentates, N—N Tetradentates, and N—N Hexadentates) | RR'C=N—N=CR''R''' or RR'C=N—NR''R''' (for ketazines), where R, R', R'', and R''' represent H, or any organic functional group wherein the number of carbon atoms ranges from 0 to 40, optionally having halogen or polarizing or water-insolubilizing/solubilizing groups attached. (Must include ortho-amine or hydrazide substituted aryl R derivatives, and beta-amine or hydrazide substituted alkyl R derivatives.) Ligand can also contain nonbinding N, O, S, or P atoms. |
| N Valence Stabilizer #42: Schiff Bases with one Imine (C=N) Group and with ortho- or alpha- or beta-amino or imino or oximo or diazeno or hydrazido substitution (N—N Bidentates, N—N Tridentates, N—N Tetradentates, N—N Pentadentates, or N—N Hexadentates). Also includes hydrazones with ortho—N substitution. | RR'C=N—R'', where R, R', and R'' represent H, or any organic functional group wherein the number of carbon atoms ranges from 0 to 40, optionally having halogen or polarizing or water-insolubilizing/solubilizing groups attached. (Must contain ortho- or alpha- or beta-amino or imino or oximo or diazeno or hydrazido substitution.) Ligand can also contain nonbinding N, O, S, or P atoms. |
| N Valence Stabilizer #43: Schiff Bases with two Imine (C=N) Groups and without ortho- (for aryl constituents) or alpha- or beta- (for alkyl constituents) hydroxy, carboxy, carbonyl, thiol, mercapto, thiocarbonyl, amino, imino, oximo, diazeno, or hydrazido substitution (N—N Bidentates). Also includes dihydrazones. | RR'C=N—R''—N=CR'''R'''' or R—N=C—R'—C=N—R' or R<u>C=N—R'—N=C</u>R'', where R, R', R'', R''', and R'''' represent H, or any organic functional group wherein the number of carbon atoms ranges from 0 to 40, optionally having halogen or polarizing or water-insolubilizing/solubilizing groups attached. (Not including ortho-, alpha-, or beta-hydroxy, carboxy, carbonyl, thiol, mercapto, thiocarbonyl, amino, imino, oximo, diazeno, or hydrazido substitution.) Ligand can also contain nonbinding N, O, S, or P atoms. |
| N Valence Stabilizer #44: Schiff Bases with two Imine (C=N) Groups and with ortho- or alpha- or beta-amino or imino or oximo or diazeno or hydrazido substitution (N—N Tridentates, N—N Tetradentates, N—N Pentadentates, or N—N Hexadentates). Also includes hydrazones with ortho-N substitution. | RR'C=N—R''—N=CR'''R'''' or R—N=C—R'—C=N—R' or R<u>C=N—R'—N=C</u>R'', where R, R', R'', R''', and R'''' represent H, or any organic functional group wherein the number of carbon atoms ranges from 0 to 40, optionally having halogen or polarizing or water-insolubilizmg/solubilizing groups attached. (Must contain ortho- or alpha- or beta-amino or imino or oximo or diazeno or hydrazido substitution.) Ligand can also contain nonbinding N, O, S, or P atoms. |
| N Valence Stabilizer #45: Schiff Bases with three Imine (C=N) Groups and without ortho- (for aryl constituents) or alpha- or beta- (for alkyl constituents) hydroxy, carboxy, carbonyl, thiol, mercapto, thiocarbonyl, amino, imino, oximo, diazeno, or hydrazido substitution (N—N Tridentates). Also includes trihydrazones. | $N(—R—N=CR'R'')_3$, where R, R', and R'' represent H, or any organic functional group wherein the number of carbon atoms ranges from 0 to 40, optionally having halogen or polarizing or water-insolubilizing/solubilizing groups attached. (Not including ortho-, alpha-, or beta-hydroxy, carboxy, carbonyl, thiol, mercapto, thiocarbonyl, amino, imino, oximo, diazeno, or hydrazido substitution.) Ligand can also contain nonbinding N, O, S, or P atoms. |

TABLE 1-continued

Wide Band Organic Valence Stabilizers for the $Co^{+3}$ Ion

| General Structural Name (Type of Organic) | Structural Representation |
|---|---|
| N Valence Stabilizer #46: Schiff Bases with three Imine (C═N) Groups and with ortho- or alpha- or beta-amino or imino or oximo or diazeno or hydrazido substitution (N—N Tetradentates, N—N Pentadentates, or N—N Hexadentates) | $N(—R—N═CR'R'')_3$, where R, R', and R'' represent H, or any organic functional group wherein the number of carbon atoms ranges from 0 to 40, optionally having halogen or polarizing or water-insolubilizing/solubilizing groups attached. (Must contain ortho- or alpha- or beta-amino or imino or oximo or diazeno or hydrazido substitution.) Ligand can also contain nonbinding N, O, S, or P atoms. |
| S Valence Stabilizer #1: Macrocyclic, Macrobicyclic, and Macropolycyclic Oligothioketones (including Catapinands, Cryptands, Cyclidenes, and Sepulchrates) wherein all Binding Sites are composed of Thioketones (typically in the beta position) (S—S Bidentates, S—S Tetradentates, and S—S Hexadentates) | Macrocyclic ligands containing two, four, or six thioketone binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| S Valence Stabilizer #2: Macrocyclic, Macrobicyclic, and Macropolycyclic Dithiolenes (including Catapinands, Cryptands, Cyclidenes, and Sepulchrates) wherein all Binding Sites are composed of alpha, alpha dithiols (meaning two thiol groups on a single carbon atom in the ring) (S—S Bidentates, S—S Tetradentates, and S—S Hexadentates) | Macrocyclic ligands containing two, four, six, or eight 1,1-dithiolene binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| S Valence Stabilizer #3: Dithioimidodialdehydes, Dithiohydrazidodialdehydes (thioacyl thiohydrazides), Bis(dithioimidodialdehydes), Bis(dithiohydrazidodialdehydes), Poly(dithioimidodialdehydes), and Poly(dithiohydrazidodialdehydes) (S—S Bidentates, S—S Tridentates, S—S Tetradentates) | RC(═S)—NR'—C(═S)—R'' for dithioimidodialdehydes, and RC(═S)—NR'—NH—C(═S)—R'' for dithiohydrazidodialdehydes (thioacyl thiohydrazides), where R, R', and R'' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #4: Dithioimidodicarbonic acids, Dithiohydrazidodicarbonic acids, Bis(dithioimidodicarbonic acids), Bis(dithiohydrazidodicarbonic acids), Poly(dithioimidodicarbonic acids), Poly(dithiohydrazidodicarbonic acids) and derivatives thereof (S—S Bidentates, S—S Tridentates, S—S Tetradentates) | R—O—C(═S)—NR'—C(═S)—O—R'' or R—S—C(═S)—NR'—C(═S)—S—R'' for dithioimidodicarbonic acids, and R—O—C(═S)—NR'—NH—C(═S)—O—R'' or R—S—C(═S)—NR'—NH—C(═S)—S—R'' for dithiohydrazidodicarbonic acids, where R, R', and R'' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #5: 1,3-Dithioketones (Dithio-beta-ketonates), 1,3,5-Trithioketones, Bis(1,3-Dithioketones), and Poly(1,3-Dithioketones) (S—S Bidentates, S—S Tridentates, S—S Tetradentates) | R—C(═S)—CR'R''—C(═S)—R''' where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #6: 1,2-Dithioketones (Dithiolenes, Dithio-alpha-ketonates), 1,2,3-Trithioketones, Dithiotropolonates, ortho-Dithioquinones, Bis(1,2-Dithioketones), and Poly(1,2-Dithioketones) (S—S Bidentates, S—S Tridentates, S—S Tetradentates) | R—C(═S)—C(═S)—R' where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #7: Dithiomalonamides (Dithiomalonodiamides), Bis(dithiomalonamides), and | RR'—N—C(═S)—CR''R'''—C(═S)—N—R''''R''''' where R, R', R'', R''',R'''', and R''''' represent H, $NH_2$, or any organic functional group wherein the number of carbon atoms ranges from 0 to 40, |

TABLE 1-continued

Wide Band Organic Valence Stabilizers for the $Co^{+3}$ Ion

| General Structural Name (Type of Organic) | Structural Representation |
|---|---|
| Polydithiomalonamides (S—S Bidentates, S—S Tridentates, S—S Tetradentates) | optionally having halogen or polarizing or water-insolubilizing/solubilizing groups attached. Ligand can also contain nonbinding N, O, S, or P atoms. |
| S Valence Stabilizer #8: 2-Thioacylthioacetamides, Bis(2-thioacylthioacetamides), and Poly(2-thioacylthioacetamides) (S—S Bidentates, S—S Tridentates, S—S Tetradentates) | RR'—N—C(═S)—CR"R'"—C(═S)—R"" where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #9: Dithioacyl sulfides, Bis(dithioacyl sulfides), and Poly(dithioacyl sulfides) (S—S Bidentates, S—S Tridentates, S—S Tetradentates) | R—C(═S)—S—C(═S)—R' where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #10: Trithiodicarbonic Diamides, Bis(trithiodicarbonic diamides), and Poly(trithiodicarbonic diamides) (S—S Bidentates, S—S Tridentates, S—S Tetradentates) | RR'—N—C(═S)—S—C(═S)—N—R"R'" where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #11: Pentathio-, Tetrathio-, or Trithiodicarbonic Acids, Bis(pentathio-, tetrathio-, or trithiodicarbonic acids), Poly(pentathio-, tetrathio-, or trithiodicarbonic acids), and derivatives thereof (S—S Bidentates, S—S Tridentates, S—S Tetradentates) | R—S—C(═S)—S—C(═S)—S—R' for pentathiodicarbonic acids, R—O—C(═S)—S—C(═S)—S—R' for tetrathiodicarbonic acids, and R—O—C(═S)—S—C(═S)—O—R' for pentathiodicarbonic acids, where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #12: Dithiohypophosphoric Acids, Bis(dithiohypophosphoric acids), and Poly(dithiohypophosphoric acids), and derivatives thereof (S—S Bidentates, S—S Tridentates, S—S Tetradentates) | (R—O—)(R'—O—)P(═S)—P(═S)(—O—R")(—O—R'"); (R—O—)(R'—S—)P(═S)—P(═S)(—S—R")(—O—R'"); or (R—S—)(R'—S—)P(═S)—P(═S)(—S—R")(—S—R'"), where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. Note: these ligands are not to be confused with hypophosphorous acid derivatives (hypophosphites) (R—O—)R"R'"P(═O) which are very reducing and therefore unacceptable for stabilization of high valence states in metal ions. |
| S Valence Stabilizer #13: Dithiohypophosphoramides, Bis(dithiohypophosphoramides), and Poly(dithiohypophosphoramides) (S—S Bidentates, S—S Tridentates, S—S Tetradentates) | (RR'—N—)(R"R'"—N—)P(═S)—P(═S)(—N—R""R""")(—N—R"""R"""""), where R, R', R", R'", R"", R""", R""", and R""""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. Note: these ligands are not to be confused with hypophosphorous acid derivatives (hypophosphites) (R—O—)R"R'"P(═O) which are very reducing and therefore unacceptable for stabilization of high valence states in metal ions. |
| S Valence Stabilizer #14: Dithioimidodiphosphoric Acids, Dithiohydrazidodiphosphoric Acids, Bis(dithioimidodiphosphoric Acids), Bis(dithiohydrazidodiphosphoric Acids), Poly(dithioimidodiphosphoric Acids), Poly(dithiohydrazidodiphosphoric Acids), | (R—O—)(R'—O—)P(═S)—NH—P(═S)(—O—R")(—O—R'"); (R—O—)(R'—S—)P(═S)—NH—P(═S)(—S—R")(—O—R'"); or (R—S—)(R'—S—)P(═S)—NH—P(═S)(—S—R")(—S—R'") for dithioimidodiphosphoric acids, and —NH—NH— derivatives for dithiohydrazidodiphosphoric acids, where R, R', R", and R'" represent H, $NH_2$ or any organic |

TABLE 1-continued

Wide Band Organic Valence Stabilizers for the $Co^{+3}$ Ion

| General Structural Name (Type of Organic) | Structural Representation |
|---|---|
| and derivatives thereof (S—S Bidentates, S—S Tridentates, S—S Tetradentates) | functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #15: Dithioimidodiphosphoramides, Dithiohydrazidodiphosphoramides, Bis(dithioimidodiphosphoramides), Bis(dithiohydrazidodiphosphoramides), Poly(dithioimidodiphosphoramides), and Poly(dithiohydrazidodiphosphoramides) (S—S Bidentates, S—S Tridentates, S—S Tetradentates) | (RR'—N—)(R"R'"—N—)P(═S)—NH—P(═S)(—N—R""R""")(—N—R"""R""""") for dithioimidophosphoramides, and (RR'—N—)(R"R'"—N—)P(═S)—NH—NH—P(═S)(—N—R""R""")(—N—R"""R""""") for dithiohydrazidodiphosphoramides, where R, R', R", R'", R"", R""", R""", and R""""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #16: Dithiodiphosphoramides, Bis(dithioiphosphoramides), and Poly(dithiodiphosphoramides) (S—S Bidentates, S—S Tridentates, S—S Tetradentates) | (RR'—N—)(R"R'"—N—)P(═S)—S—P(═S)(—N—R""R""")(—N—R"""R""""), or (RR'—N—)(R"R'"—N—)P(═S)—O—P(═S)(—N—R""R""")(—N—R"""R""""), where R, R', R", R'", R"", R""", R""", and R""""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #17: Dithiodiphosphoric Acids, Bis(dithioiphosphoric Acids), Poly(dithiodiphosphoric Acids), and derivatives thereof (S—S Bidentates, S—S Tridentates, S—S Tetradentates) | (R—O—)(R'—O—)P(═S)—O—P(═S)(—O—R")(—O—R'"); (R—O—)(R'—O—)P(═S)—S—P(═S)(—O—R")(—O—R'"); (R—O—)(R'—S—)P(═S)—O—P(═S)(—S—R")(—O—R'"); (R—O—)(R'—S—)P(═S)—S—P(═S)(—S—R")(—O—R'"); or (R—S—)(R'—S—)P(═S)—S—P(═S)(—S—R")(—S—R'"), where R, R', R", R'", R"", R""", R""", and R""""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #18: Trithiophosphoric Acids (Phosphorotrithioic Acids), Bis(trithiophosphoric acids), Poly(trithiophosphoric acids), and derivatives thereof (S—S Bidentates, S—S Tridentates, S—S Tetradentates) | (O═)P(—S—R)(—S—R')(—S—R") or (S═)P(—S—R)(—S—R')(—O—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #19: Dithiophosphoric Acids (Phosphorodithioic Acids), Bis(dithiophosphoric acids), Poly(dithiophosphoric acids), and derivatives thereof (S—S Bidentates, S—S Tridentates, S—S Tetradentates) | (O═)P(—S—R)(—S—R')(—O—R") or (S═)P(—S—R)(—O—R')(—O—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #20: Tetrathiophosphoric Acids (Phosphorotetrathioic Acids), Bis(tetrathiophosphoric acids), Poly(tetrathiophosphoric acids), and derivatives thereof (S—S Bidentates, S—S Tridentates, S—S Tetradentates) | (S═)P(—S—R)(—S—R')(—S—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #21: Phosphoro(dithioperoxo)dithioic Acids, Bis[phosphoro(dithioperoxo)dithioic Acids], Poly[phosphoro(dithioperoxo)dithioic Acids], and derivatives thereof (S—S Bidentates, S—S Tridentates, S—S | (O)P(—S—S—R)(—S—R')(—S—R") or (S═)P(—S—S—R)(—S—R')(—O—R"), where R, R', and R" represent H, $NH_2$ or any organic functional group wherein the number of carbon atoms ranges from 0 to 40, optionally having halogen or polarizing or water-insolubilizing/solubilizing groups attached. |

TABLE 1-continued

Wide Band Organic Valence Stabilizers for the $Co^{+3}$ Ion

| General Structural Name (Type of Organic) | Structural Representation |
|---|---|
| Tetradentates) | Ligand can also contain nonbinding N, O, S, or P atoms. |
| S Valence Stabilizer #22: Phosphoro(dithioperoxo)thioic Acids, Bis[phosphoro(dithioperoxo)thioic Acids], Poly[phosphoro(dithioperoxo)thioic Acids], and derivatives thereof (S—S Bidentates, S—S Tridentates, S—S Tetradentates) | (O═)P(—S—S—R)(—S—R')(—O—R") or (S═)P(—S—S—R)(—O—R')(—O—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #23: Phosphoro(dithioperoxo)trithioic Acids, Bis[phosphoro(dithioperoxo)trithioic Acids], Poly[phosphoro(dithioperoxo)trithioic Acids], and derivatives thereof (S—S Bidentates, S—S Tridentates, S—S Tetradentates) | (S═)P(—S—S—R)(—S—R')(—S—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #24: Beta-Mercaptothioketones, Beta-Mercaptothioaldehydes, Bis(beta-mercaptothioketones), Bis(beta-mercaptothioaldehydes), Poly(beta-mercaptothioketones), and Poly(beta-mercaptothioaldehydes) (S—S Bidentates, S—S Tridentates, S—S Tetradentates) | R—CR'(—SH)—$CH_2$—C(═S)—R", where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #25: N—(Aminomethylthiol)thioureas [N—(Aminomercaptomethyl)thioureas], Bis[N—(aminomethylthiol)thioureas], and Poly[N—(aminomethylthiol)thioureas] (S—S Bidentates, S—S Tridentates, S—S Tetradentates) | RR'—N—CH(—SH)—NR"—C(═S)—NR'"R"", where R, R', R", R'", and R"" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #26: Dithiooxamides, Bis(dithiooxamides), and Poly(dithiooxamides) (S—S Bidentates, S—S Tridentates, S—S Tetradentates) | RR'—N—C(═S)—C(═S)—N—R"R'", where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #27: 1,1-Dithiolates, Bis(1,1-dithiolates), and Poly(1,1-dithiolates) (S—S Bidentates and S—S Tetradentates) | RR'—C═C(—$S^-$)(—$S^-$), where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #28: Dithiomonocarboxylic Acids, Tri- and Tetrathiodicarboxylic Acids, Bis(dithiomonocarboxylic Acids), Bis(tri- and tetrathiodicarboxylic acids), Poly(dithiomonocarboxylic acids), Poly(tri- and tetrathiodicarboxylic acids), and derivatives thereof (S—S Bidentates and S—S Tetradentates) | R—C(═S)(—S—R') for dithiomonocarboxylic acids, and (R—S—)(S═)C—R'—C(═S)(—S—R") for tri- and tetrathiodicarboxylic acids, where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #29: Perthiomonocarboxylic Acids, Perthiodicarboxylic Acids, Bis(perthiomonocarboxylic acids), Bis(perthiodicarboxylic acids), Poly(perthiomonocarboxylic acids), Poly(perthiodicarboxylic acids), and derivatives thereof (S—S Bidentates and S—S Tetradentates) | R—C(═S)(—S—S—R') for perthiomonocarboxylic acids, and (R—S—S—)(S═)C—R'—C(═S)(—S—S—R") for perthiodicarboxylic acids, where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #30: Dithiocarbonates, Trithiocarbonates, Perthiocarbonates, Bis(dithiocarbonates), Bis(trimiocarbonates), and | R—S—C(═S)—O—R' orR—S—C(═O)—S—R' for dithiocarbonates, R—S—C(═S)—S—R' for trithiocarbonates, and R—S—S—C(═S)—S—R' for perthiocarbonates, where R, and R' represent H, |

TABLE 1-continued

Wide Band Organic Valence Stabilizers for the $Co^{+3}$ Ion

| General Structural Name (Type of Organic) | Structural Representation |
|---|---|
| Bis(perthiocarbonates) (S—S Bidentates and S—S Tetradentates) | $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #31: Dithiocarbamates, Bis(dithiocarbamates), and Poly(dithiocarbamates) (including N—hydroxydithiocarbamates and N—mercaptodithiocarbamates) (S—S Bidentates, S—S Tridentates, and S—S Tetradentates) | $RR'N^{+}$=C(SH)(SH), where R and R' represent H, OH, SH, OR" (R" = $C_1$-$C_{30}$ alkyl or aryl), SR" (R" = $C_1$-$C_{30}$ alkyl or aryl), $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #32: Dithiocarbazates (Dithiocarbazides), Bis(dithiocarbazates), and Poly(dithiocarbazates) (S—S Bidentates, S—S Tridentates, and S—S Tetradentates; or possibly N—S Bidentates, N—S Tridentates, and N—S Tetradentates) | RR'N—NR"—C(=S)(SH), where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #1: Diformamidine Bisulfides (Thioperoxydicarbonimidic Diamides or Dihydrazides), Thioperoxytricarbonimidic Diamides or Dihydrazides, Thioperoxytetracarbonimidic Diamides or Dihydrazides, Bis(diformamidine disulfides), and Poly(diformamidine disulfides) (N—S Bidentates, N—S Tridentates, N—S Tetradentates) | RR'—N—C(=NH)—S—S—C(=NH)—NR"R'", where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #2: S—Amidinodithiocarbamates, Bis(S—amidinodithiocarbamates), and Poly(S—amidinodithiocarbamates) (N—S Bidentates and N—S Tetradentates) | RR'—N—C(=NH)—S—CS—NR"R'", where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #3: O-Amidinothiocarbamates, Bis(O-amidinothiocarbamates), and Poly(O-amidinothiocarbamates) (N—S Bidentates and N—S Tetradentates) | RR'—N—C(=NH)—O—CS—NR"R'", where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #4: S-Amidinoperoxymiocarbamates, Bis(S-amidinoperoxythiocarbamates), and Poly(S-amidinoperoxythiocarbamates) (N—S Bidentates and N—S Tetradentates) | RR'—N—C(=NH)—S—S—CS—NR"R'", where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #5: Phosphorimidothioic Acid; Phosphorimidodithioic Acid; Phosphorimidotrithioic Acid; Bis(Phosphorimidothioic Acid); Bis(Phosphorimidodithioic Acid); Bis(Phosphorimidotrithioic Acid); Poly(Phosphorimidothioic Acid); Poly(Phosphorimidodithioic Acid); Poly(Phosphorimidotrithioic Acid); and derivatives thereof (N—S Bidentates and N—S Tetradentates) | (NH=)P(—SR)(—OR')(—OR") for phosphorimidothioic acid, (NH=)P(—SR)(—SR')(—OR") for phosphorimidodithioic acid, (NH=)P(—SR)(—SR')(—SR") for phosphorimidotrithioic acid, where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #6: Phosphorothioic Triamides, Bis(phosphorothioic triamides), and | (S=)P(—NRR')(—NR"R'")(—NR""R""'), where R, R', R", R'", R"", and R""' represent H, $NH_2$ or any organic functional group wherein the |

TABLE 1-continued

Wide Band Organic Valence Stabilizers for the $Co^{+3}$ Ion

| General Structural Name (Type of Organic) | Structural Representation |
|---|---|
| Poly(phosphorothioic triamides) (N—S Bidentates and N—S Tetradentates) | number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #7: Phosphoramidotrithioic Acid, Phosphorodiamidodithioic Acid, Bis(phosphoramidotrithioic acid), Bis(phosphorodiamidodithioic acid), poly(phosphoramidotrithioic acid), poly(phosphorodiamidodithioic acid), and derivatives thereof (N—S Bidentates and N—S Tetradentates) | (S═)P(—NRR')(—SR")(—SR"') for phosphoramidotrithioic acid, and (S═)P(—NRR')(—NR"R"')(—SR"") for phosphorodiamidodithioic acid, where R, R', R", R"', and R"" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #8: Phosphoramidothioic Acid, Phosphoramidodithioic Acid, Phosphorodiamidothioic Acid, Bis(Phosphoramidothioic Acid), Bis(Phosphoramidodithioic Acid), Bis(Phosphorodiamidothioic Acid), Poly(Phosphoramidothioic Acid), Poly(Phosphoramidodithioic Acid), and Poly(Phosphorodiamidothioic Acid) (N—S Bidentates and N—S Tetradentates) | (O═)P(—NRR')(—SR")(—OR"') or (S═)P(—NRR')(—OR")(—OR"') for phosphoramidothioic acid; (O═)P(—NRR')(—SR")(—SR"') or (S═)P(—NRR')(—SR")(—OR"') for phosphoramidodithioic acid; (O═)P(—NRR')(—NR"R"')(—SR"") or (S═)P(—NRR')(—NR"R"')(—OR"") for phosphorodiamidothioic acid, where R, R', R", R"', and R"" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #9: N-Thioacyl 7-Aminobenzylidenimines (N—S Bidentates or N—S Tetradentates) | R'—C(═S)—N═C(—R)(—NHR"), where R is an aromatic derivative (i.e., $—C_6H_5$), and R' and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #10: Thiohydroxamates (Thiohydroxylamines), Bis(thiohydroxamates), and Poly(thiohydroxamates) (N—S Bidentates, N—S Tetradentates, and N—S Hexadentates) | R—C(═S)—NR'—OH or R—C(—SH)═N—OH, where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #11: Alpha- or ortho-Aminothiocarboxylic Acids, and alpha- or ortho-Aminothiodicarboxylic Acids, and derivatives thereof (N—S Bidentates, N—S Tridentates, and N—S Tetradentates) | R—CH(—NHR')—C(═S)(—OH) or R—CH(—NHR')—C(═S)(—SH) for aminothiocarboxylic acids, and (HO—)(S═)C—CH(—NHR)—R'—CH(—NHR")—C(═S)(—OH) or (HS—)(S═)C—CH(—NHR)—R'—CH(—NHR")—C(═S)(—SH) for aminothiodicarboxylic acids, where R, R', and R" represent any organic functional group wherein the number of carbon atoms ranges from 1 to 40, optionally having halogen or polarizing or water-insolubilizing/solubilizing groups attached. Ligand can also contain nonbinding N, O, S, or P atoms. |
| N—S Valence Stabilizer #12: Thiosemicarbazones, Bis(thiosemicarbazones), and Poly(thiosemicarbazones) (N—S Bidentates, N—S Tetradentates, and N—S Hexadentates) | RR'—N—C(═S)—NR"—N═CR"'R"", where R, R', R", R"', and R"" represent H, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #13: Thioacyl hydrazones, Bis(thioacyl hydrazones), and Poly(thioacyl hydrazones) | R—C(═S)—NR'—N═CR"R"', where R, R', R", and R"' represent H, or any organic functional group wherein the number of carbon atoms |

TABLE 1-continued

Wide Band Organic Valence Stabilizers for the $Co^{+3}$ Ion

| General Structural Name (Type of Organic) | Structural Representation |
|---|---|
| (N—S Bidentates, N—S Tetradentates, and N—S Hexadentates) | ranges from 0 to 40, optionally having halogen or polarizing or water-insolubilizing/solubilizing groups attached. Ligand can also contain nonbinding N, O, S, or P atoms. |
| N—S Valence Stabilizer #14: Thiocarbazones (Diazenecarbothioic hydrazides), Bis(thiocarbazones), and Poly(thiocarbazones) (N—S Bidentates, N—S Tetradentates, and N—S Hexadentates) | R—N=N—C(=S)—NR'—NR"R'", where R, R', R", and R'" represent H, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #15: Azo compounds with thiol or mercapto or thiocarbonyl substitution at the ortho- (for aryl) or alpha- or beta- (for alkyl) positions, Bis[o-(HS—) or alpha- or beta-(HS—)azo compounds], or Poly[o-(HS—) or alpha- or beta-(HS—)azo compounds) (N—S Bidentates, N—S Tridentates, N—S Tetradentates, or N—S Hexadentates) | R—N=N—R', where R, and R' represent H or any organic functional group wherein the number of carbon atoms ranges from 0 to 40, optionally having halogen or polarizing or water-insolubilizing/solubilizing groups attached. (Must include ortho-thio, mercapto, or thiocarbonyl substituted aryl azo compounds, and alpha- or beta-thio, mercapto, or thiocarbonyl alkyl azo compounds.) Ligand can also contain nonbinding N, O, S, or P atoms. |
| N—S Valence Stabilizer #16: Diazeneformothioamides, Diazeneacetothioamides, Bis(diazeneformothioamides), Bis(diazeneacetothioamides), Poly(diazeneformothioarnides), and Poly(diazeneacetothioamides) (N—S Bidentates, N—S Tetradentates, and N—S Hexadentates) | R—N=N—C(=S)—NR'R" for diazeneformothioamides, and R—N=N—CR'R"—C(=S)—NR'"R"" for diazeneacetothioamides, where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #17: Diazenecarbothioic acids, Diazenecarbodithioic acids, Bis(diazenecarbothioic acids), Bis(diazenecarbodithioic acids), Poly(diazenecarbothioic acids), Poly(diazenecarbodithioic acids) and derivatives thereof (N—S Bidentates, N—S Tetradentates, N—S Hexadentates) | R—N=N—C(=S)—O—R' or R—N=N—CR'R"—C(=S)—O—R'" for diazenecarbothioic acids, and R—N=N—C(=S)—S—R' or R—N=N—CR'R"—C(=S)—S—R'" for diazenecarbodithoic acids, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #18: Diazeneformothioaldehydes, Diazeneacetothioaldehydes, Bis(diazeneformothioaldehydes), Bis(diazeneacetothioaldehydes), Poly(diazeneformothioaldehydes), and Poly(diazeneacetothioaldehydes) (N—S Bidentates, N—S Tetradentates and N—S Hexadentates) | R—N=N—C(=S)—R' for diazeneformothioaldehydes, and R—N=N—CR'R"—C(=S)—R'" for diazeneacetothioaldehydes, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #19: Diazenediformothioamides, Diazenediacetothioamides, Bis(diazenediformothioamides), Bis(diazenediacetothioamides), Poly(diazenediformothioamides), and Poly(diazenediacetothioamides) (N—S Tridentates and N—S Hexadentates) | RR'—N—C(=S)—N=N—C(=S)—NR"R'" or RR'—N—C(=S)—N=N—C(=O)—NR"R'" for diazenediformothioamides, and RR'—N—C(=S)—CR"R'"—N=N—CR""R""—C(=S)—NR"""R""" or RR'—N—C(=S)—CR"R'"—N=N—CR""R""—C(=O)—NR"""R""" for diazenediacetothioamides, where R, R', R", R'", R"", R"", R""", and R""" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #20: Diazenedicarbothioic acids, Diazenedicarbodithioic acids, Bis(diazenedicarbothioic acids), Bis(diazenedicarbodithioic acids), | R—O—C(=S)—N=N—C(=S)—O—R', R—O—C(=S)—CR'R"—N=N—CR'"R""—C(=S)—O—R"", R—O—C(=S)—N=N—C(=O)—O—R', or R—O—C(—S)—CR'R"—N=N—CR'"R""—C(=O)—O—R"" for diazenedicarbothioic acids, and R—S—C(=S)— |

TABLE 1-continued

Wide Band Organic Valence Stabilizers for the $Co^{+3}$ Ion

| General Structural Name (Type of Organic) | Structural Representation |
|---|---|
| Poly(diazenedicarbothioic acids), Poly(diazenedicarbodithioic acids) and derivatives thereof (N—S Tridentates and N—S Hexadentates) | N═N—C(═S)—S—R' or R—S—C(═S)—CR'R''—N═N—CR'''R''''—C(═S)—S—R''''' for diazenedicarbodithioic acids, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #21: Diazenediformothioaldehydes, Diazenediacetothioaldehydes, Bis(diazenediformothioaldehydes), Bis(diazenediacetothioaldehydes), Poly(diazenediformothioaldehydes), and Poly(diazenediacetothioaldehydes) (N—S Tridentates and N—S Hexadentates) | RC(═S)—N═N—C(═S)—R' or RC(═S)—N═N—C(═O)—R' for diazenediformothioaldehydes, and RC(═S)—CR'R''—N═N—CR'''R''''—C(═S)—R''''' or RC(═S)—CR'R''—N═N—CR'''R''''—C(═O)—R''''' for diazenediacetothioaldehydes, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #22: Ortho-thio (or -mercapto) Substituted Formazans, Bis(o-thio or -mercapto substituted formazans), and Poly(o-thio or -mercapto substituted formazans) (N—S Bidentates, N—S Tridentates, N—S Tetradentates, and N—S Hexadentates) | R—N═N—CR'═N—NR''R''', where R, R', R'', and R''' represent H, or any organic functional group wherein the number of carbon atoms ranges from 0 to 40, optionally having halogen or polarizing or water-insolubilizing/solubilizing groups attached. (Must include ortho-thio or mercapto substituted aryl R derivatives, and beta-thio or mercapto substituted alkyl R derivatives.) Ligand can also contain nonbinding N, O, S, or P atoms. |
| N—S Valence Stabilizer #23: Ortho-thio (or -mercapto) Substituted Azines (including ketazines), Bis(o-thio or mercapto substituted azines), and Poly(o-thio or mercapto substituted azines) (N—S Bidentates, N—S Tridentates, N—S Tetradentates, and N—S Hexadentates) | RR'C═N—N═CR''R''' or RR'C═N—NR''R''' (for ketazines), where R, R', R'', and R''' represent H, or any organic functional group wherein the number of carbon atoms ranges from 0 to 40, optionally having halogen or polarizing or water-insolubilizing/solubilizing groups attached. (Must include ortho-thio or mercapto substituted aryl R derivatives, and beta-thio or mercapto substituted alkyl R derivatives.) Ligand can also contain nonbinding N, O, S, or P atoms. |
| N—S Valence Stabilizer #24: Schiff Bases with one Imine (C═N) Group and with ortho- or alpha- or beta-thio or mercapto or thiocarbonyl substitution (N—S Bidentates, N—S Tridentates, N—S Tetradentates, N—S Pentadentates, or N—S Hexadentates). Also includes Schiff Bases derived from the reaction of carbonyl compounds with dithiocarbazates, and hydrazones with ortho—S substitution. | RR'C═N—R'', where R, R', and R'' represent H, or any organic functional group wherein the number of carbon atoms ranges from 0 to 40, optionally having halogen or polarizing or water-insolubilizing/solubilizing groups attached. (Must contain ortho- or alpha- or beta-thio or mercapto or thiocarbonyl substitution.) Ligand can also contain nonbinding N, O, S, or P atoms. |
| N—S Valence Stabilizer #25: Schiff Bases with two Imine (C═N) Groups and with ortho- or alpha- or beta-thio or mercapto or thiocarbonyl substitution (N—S Tridentates, N—S Tetradentates, N—S Pentadentates, or N—S Hexadentates). Also includes Schiff Bases derived from the reaction of carbonyl compounds with dithiocarbazates, and hydrazones with ortho-S substitution. | RR'C═N—R''—N═CR'''R'''' or R—N═C—R'—C═N—R' or R<u>C═N—R'—N═C</u>R'', where R, R', R'', R''', and R'''' represent H, or any organic functional group wherein the number of carbon atoms ranges from 0 to 40, optionally having halogen or polarizing or water-insolubilizing/solubilizing groups attached. (Must contain ortho- or alpha- or beta-thio or mercapto or thiocarbonyl substitution.) Ligand can also contain nonbinding N, O, S, or P atoms. |
| N—S Valence Stabilizer #26: Schiff Bases with three Imine (C═N) Groups and with ortho- or alpha- or beta-thio or mercapto or thiocarbonyl substitution (N—S Tetradentates, N—S Pentadentates, or N—S Hexadentates). Also includes Schiff Bases derived from the | $N(—R—N═CR'R'')_3$, where R, R', and R'' represent H, or any organic functional group wherein the number of carbon atoms ranges from 0 to 40, optionally having halogen or polarizing or water-insolubilizing/solubilizing groups attached. (Must contain ortho- or alpha- or beta-thio or mercapto or thiocarbonyl |

TABLE 1-continued

Wide Band Organic Valence Stabilizers for the $Co^{+3}$ Ion

| General Structural Name (Type of Organic) | Structural Representation |
|---|---|
| reaction of carbonyl compounds with dithiocarbazates, and hydrazones with ortho-S substitution. | substitution.) Ligand can also contain nonbinding N, O, S, or P atoms. |
| N—S Valence Stabilizer #27: Thioalkyl Amines (Aminothiols or Aminodisulfides) and Thioalkyl Imines (Iminothiols or Iminodisulfides) (N—S Bidentates, N—S Tridentates, N—S Tetradentates, and N—S Hexadentates) | $[R—CR'(—NR''R''')]_x—R''''—[C(—SR'''')R'''''R''''''']_y$, $[R—CR'(—NR''R''')]_x—R''''—[C(—S—S—R'''')R'''''R''''''']_y$, or $[R—CR'(—NR''R''')]_x—R''''—[C(=S)R''''']_y$ for thioalkyl amines; and $[R—C(=NR')]_x—R''—[C(—SR''')R''''R''''']_y$, $[R—C(=NR')]_x—R''—[C(—S—SR''')R''''R''''']_y$, or $[R—C(=NR')]_x—R''—[C(=S)R''']_y$ for thioalkyl imines, where R, R', R'', R''', R'''', R''''', and R'''''' represent H, $NH_2$, or any organic functional group wherein the number of carbon atoms ranges from 0 to 40, optionally having halogen or polarizing or water-insolubilizing/solubilizing groups attached, and x and y = 1-6. Ligand can also contain nonbinding N, O, S, or P atoms. |
| N—S Valence Stabilizer #28: Thioaryl Amines and Thioaryl Imines (N—S Bidentates, N—S Tridentates, N—S Tetradentates, and N—S Hexadentates) | $[R(—NR'R'')(—SR''')]$, $[R(—NR'R'')(—S—S—R''')]$, $[R(—NR'R'')(—C(=S)R''')]$, $[R(—NR'R'')_x]_2S$, $[R(—NR'R'')_x]_{2-3}R'''(—SR'''')_y$, $[R(—SR')_x]_{2-3}R''(—NR'''R'''')_y$, $[R(—NR'R'')_x]_2S_2$, and $[R(—NR'R'')_x]_2R'''(C(=S))_yR''''$ for thioaryl amines; and $[R(—SR')_x]_2NH$ or $[R(—SR')_x]_2NHNH$ for thioaryl imines, where R, R', R'', R''', and R'''' represent H, $NH_2$, or any organic functional group wherein the number of carbon atoms ranges from 0 to 40, optionally having halogen or polarizing or water-insolubilizing/solubilizing groups attached, and x = 0-2 and y = 1-4. Ligand can also contain nonbinding N, O, S, or P atoms. |
| N—S Valence Stabilizer #29: Five-Membered Heterocyclic Rings containing One, Two, Three, or Four Nitrogen Atoms at least one additional Sulfur Atom Binding Site not in a Ring (N—S Bidentates, N—S Tridentates, N—S Tetradentates, or N—S Hexadentates) | Five membered heterocyclic ring(s) containing one, two, three, or four nitrogen atoms. In addition, ligand contains additional sulfur-containing substituents (usually thiols, mercaptans, disulfides, or thiocarbonyls) that constitute S binding sites. Can include other ring systems bound to the heterocyclic ring or to the S-containing substituent, but they do not coordinate with the stabilized, high valence metal ion. Ring(s) can also contain O, S, or P atoms. This 5-membered ring(s) and/or attached, uncoordinating rings and/or S-containing substituent(s) may or may not have halogen or polarizing or water-insolubilizing/solubilizing groups attached. |
| N—S Valence Stabilizer #30: Six-Membered Heterocyclic Rings containing One, Two, Three, or Four Nitrogen Atoms at least one additional Sulfur Atom Binding Site not in a Ring (N—S Bidentates, N—S Tridentates, N—S Tetradentates, or N—S Hexadentates) | Six membered heterocyclic ring(s) containing one, two, three, or four nitrogen atoms. In addition, ligand contains additional sulfur-containing substituents (usually thiols, mercaptans, disulfides, or thiocarbonyls) that constitute S binding sites. Can include other ring systems bound to the heterocyclic ring or to the S-containing substituent, but they do not coordinate with the stabilized, high valence metal ion. Ring(s) can also contain O, S, or P atoms. This 6-membered ring(s) and/or attached, uncoordinating rings and/or S-containing substituent(s) may or may not have halogen or polarizing or water-insolubilizing/solubilizing groups attached. |
| N—S Valence Stabilizer #31: Five-Membered Heterocyclic Rings containing One or Two Sulfur Atoms at least one additional Nitrogen Atom Binding Site not in a Ring (N—S Bidentates, N—S Tridentates, N—S Tetradentates, or N—S Hexadentates) | Five membered heterocyclic ring(s) containing one or two sulfur atoms. In addition, ligand contains additional nitrogen-containing substituents (usually amines, imines, or hydrazides) that constitute N binding sites. Can include other ring systems bound to the heterocyclic ring or to the N-containing substituent, but they do not coordinate with the stabilized, high valence metal ion. Ring(s) can also contain O, S, or P atoms. This 5-membered ring(s) and/or attached, uncoordinating rings and/or N-containing substituent(s) may or may |

TABLE 1-continued

Wide Band Organic Valence Stabilizers for the $Co^{+3}$ Ion

| General Structural Name (Type of Organic) | Structural Representation |
|---|---|
| | not have halogen or polarizing or water-insolubilizing/solubilizing groups attached. |
| N—S Valence Stabilizer #32: Six-Membered Heterocyclic Rings containing One or Two Sulfur Atoms at least one additional Nitrogen Atom Binding Site not in a Ring (N—S Bidentates, N—S Tridentates, N—S Tetradentates, or N—S Hexadentates) | Six membered heterocyclic ring(s) containing one or two sulfur atoms. In addition, ligand contains additional nitrogen-containing substituents (usually amines, imines, or hydrazides) that constitute N binding sites. Can include other ring systems bound to the heterocyclic ring or to the N-containing substituent, but they do not coordinate with the stabilized, high valence metal ion. Ring(s) can also contain O, S, or P atoms. This 6-membered ring(s) and/or attached, uncoordinating rings and/or N-containing substituent(s) may or may not have halogen or polarizing or water-insolubilizing/solubilizing groups attached. |
| N—S Valence Stabilizer #33: Five-Membered Heterocyclic Rings containing One, Two, Three, or Four Nitrogen Atoms at least one additional Sulfur Atom Binding Site in a Separate Ring (N—S Bidentates, N—S Tridentates, N—S Tetradentates) | Five membered heterocyclic ring(s) containing one, two, three, or four nitrogen atoms. In addition, ligand contains additional sulfur-containing rings that constitute S binding sites. Can include other ring systems bound to the N- or S-containing heterocyclic rings, but they do not coordinate with the stabilized, high valence metal ion. Ring(s) can also contain O, S, or P atoms. This 5-membered ring(s) and/or additional S-containing ring(s) and/or attached, uncoordinating rings may or may not have halogen or polarizing or water-insolubilizing/solubilizing groups attached. |
| N—S Valence Stabilizer #34: Six-Membered Heterocyclic Rings containing One, Two, Three, or Four Nitrogen Atoms at least one additional Sulfur Atom Binding Site in a Separate Ring (N—S Bidentates, N—S Tridentates, N—S Tetradentates) | Six membered heterocyclic ring(s) containing one, two, three, or four nitrogen atoms. In addition, ligand contains additional sulfur-containing rings that constitute S binding sites. Can include other ring systems bound to the N- or S-containing heterocyclic rings, but they do not coordinate with the stabilized, high valence metal ion. Ring(s) can also contain O, S, or P atoms. This 6-membered ring(s) and/or additional S-containing ring(s) and/or attached, uncoordinating rings may or may not have halogen or polarizing or water-insolubilizing/solubilizing groups attached. |
| N—S Valence Stabilizer #35: Two-, Three-, Four-, Six-, Eight-, and Ten-Membered Macrocyclics, Macrobicyclics, and Macropolycyclics (including Catapinands, Cryptands, Cyclidenes, and Sepulchrates) wherein all Binding Sites are composed of Nitrogen (usually amine or imine groups) or Sulfur (usually thiols, mercaptans, or thiocarbonyls) and are not contained in Component Heterocyclic Rings (N—S Bidentates, N—S Tridentates, N—S Tetradentates, and N—S Hexadentates) | Macrocyclic ligands containing two, three, four, six, eight, or ten binding sites composed of nitrogen and sulfur to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| N—S Valence Stabilizer #36: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen or Sulfur and are contained in Component Heterocyclic Rings (N—S Bidentates, N—S Tridentates, N—S Tetradentates, or N—S Hexadentates) | Macrocyclic ligands containing a total of four, six, eight, or ten heterocyclic rings containing nitrogen or sulfur binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N—S Valence Stabilizer #37: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen or Sulfur and are contained in a Combination of Heterocyclic Rings and Amine, Imine, Thiol, Mercapto, or Thiocarbonyl Groups (N—S Bidentates, N—S | Macrocyclic ligands containing at least one heterocyclic ring. These heterocyclic rings provide nitrogen or sulfur binding sites to valence stabilize the central metal ion. Other amine, imine, thiol, mercapto, or thiocarbonyl binding sites can also be included in the macrocyclic ligand, so long as the total number of binding sites is four, six, eight, or ten. Can include other hydrocarbon/ring systems bound to this macrocyclic ligand, but they do not |

TABLE 1-continued

Wide Band Organic Valence Stabilizers for the $Co^{+3}$ Ion

| General Structural Name (Type of Organic) | Structural Representation |
|---|---|
| Tridentates, N—S Tetradentates, or N—S Hexadentates) | coordinate with the stabilized, high valence metal ion. This ligand and/or attached, uncoordinating hydrocarbon/rings may or may not have halogen or polarizing or water-insolubilizing groups attached. |
| N—O Valence Stabilizer #1: N-Hydroxy(or N,N'-dihydroxy)amidines and N-Hydroxy(or N,N'-dihydroxy)diamidines (N—O Bidentates, N—O Tridentates, or N—O Tetradentates) | R'—N(—OH)—C(—R)═N—R", where R, R', and R" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #2: Guanylureas, Guanidinoureas, Bis(guanylureas), Bis(guanidinoureas), Poly(guanylureas), and Poly(guanidinoureas) (N—O Bidentates and N—O Tetradentates) | RR'—N—C(═NH)—NR"—CO—NR'"R"" for guanylureas, and RR'—N—C(═NH)—NR"—NH—CO—NR'"R"" for guanidinoureas, where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #3: Amidinoamides, Guanidinoamides, Bis(amidinoamides), Bis(guanidinoamides), Poly(amidinoamides), and Poly(guanidinoamides) (including both N—amidinoamides and 2-amidinoacetamides) (N—O Bidentates and N—O Tetradentates) | RR'—N—C(═NH)—NR"—CO—R'" for N—amidinoamides, or RR'—N—C(═NH)—CR"R'"—CO—N—R""R"" for 2-amidinoacetamides, and RR'—N—C(═NH)—NR"—NH—CO—R'" for guanidinoamides, where R, R', R", R'", R"", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #4: Imidoylamides, Bis(imidoylamides), and Poly(imidoylamides) (N—O Bidentates and N—O Tetradentates) | R—C(═NH)—NR'—CO—R", where R, R', and R", represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #5: O-Amidinocarbamates, Bis(O-amidinocarbamates), and Poly(O-amidinocarbamates) (N—O Bidentates and N—O Tetradentates) | RR'—N—C(═NH)—O—CO—NR"R'", where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #6: S-Amidinothiocarbamates, Bis(S-amidinothiocarbamates), and Poly(S-amidinothiocarbamates) (N—O Bidentates and N—O Tetradentates) | RR'—N—C(═NH)—S—CO—NR"R'", where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #7: Diimidosulfuric Acid, Bis(diimidosulfuric acid), and derivatives thereof (N—O Bidentates and N—O Tetradentates) | (NH═)(NH═)P(OR)(OR'), where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #8: Phosphorimidic Acid, Bis(phosphorimidic acid); and Poly(phosphorimidic acid), and derivatives thereof (N—O Bidentates) | (NH═)P(—OR)(—OR')(—OR"), where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 1-continued

Wide Band Organic Valence Stabilizers for the $Co^{+3}$ Ion

| General Structural Name (Type of Organic) | Structural Representation |
|---|---|
| N—O Valence Stabilizer #9: Phosphoric Triamides, Bis(phosphoric triamides), and Poly(phosphoric triamides) (N—O Bidentates and N—O Tetradentates) | (O═)P(—NRR')(—NR"R"')(—NR""R""'), where R, R', R", R"', R"", and R""' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #10: Phosphoramidic Acid, Phosphorodiamidic Acid, Bis(phosphoramidic acid), Bis(phosphorodiamidic acid), Poly(phosphoramidic acid), Poly(phosphorodiamidic acid), and derivatives thereof (N—O Bidentates and N—O Tetradentates) | (O═)P(—NRR')(—OR")(—OR"') for phosphoramidic acid and (O═)P(—NRR')(—NR"R"')(—OR"") for phosphorodiamidic acid, where R, R', R", R"', and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #11: N-Acyl 7-Aminobenzylidenimines (N—O Bidentates or N—O Tetradentates) | R'—C(═O)—N═C(—R)(—NHR"), where R is an aromatic derivative (i.e., —$C_6H_5$), and R' and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #12: Oximes, Dioximes, and Poly(oximes) (N—O Bidentates, N—O Tridentates, and N—O Tetradentates) | R—C(═NOH)—R' for oximes, and R—C(═NOH)—C(═NOH)—R' for dioximes, where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #13: Carbonyl oximes, Bis(carbonyl oximes), and Poly(carbonyl oximes) (N—O Bidentates, N—O Tridentates, and N—O Tetradentates) | R—C(═O)—C(═NOH)—R', where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #14: Imine oximes, Bis(imine oximes), and Poly(imine oximes) (including 2-Nitrogen heterocyclic oximes) (N—O Bidentates, N—O Tridentates, N—O Tetradentates, and N—O Hexadentates) | R—C(═N—R")—C(═NOH)—R', where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #15: Hydroxy oximes, Bis(hydroxy oximes), and Poly(hydroxy oximes) (including 2-Oxygen heterocyclic oximes) (N—O Bidentates, N—O Tridentates, N—O Tetradentates, and N—O Hexadentates) | R—CH(—OH)—C(═NOH)—R', where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #16: Amino oximes, Bis(amino oximes), and Poly(amino oximes) (N—O Bidentates, N—O Tridentates, N—O Tetradentates, and N—O Hexadentates) | RR'—C(—NH—R")—C(═NOH)—R"', where R, R', R", and R"' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #17: Amido oximes, Bis(amido oximes), and Poly(amido oximes) (N—O Bidentates, N—O | RR'—N—C(═NOH)—R", where R, R', and R" represent H, $NH_2$, or any organic functional group wherein the number of carbon atoms |

TABLE 1-continued

Wide Band Organic Valence Stabilizers for the $Co^{+3}$ Ion

| General Structural Name (Type of Organic) | Structural Representation |
|---|---|
| Tridentates, N—O Tetradentates, and N—O Hexadentates) | ranges from 0 to 40, optionally having halogen or polarizing or water-insolubilizing/solubilizing groups attached. Ligand can also contain nonbinding N, O, S, or P atoms. |
| N—O Valence Stabilizer #18: Azo oximes, Bis(azo oximes), and Poly(azo oximes) (N—O Bidentates, N—O Tridentates, N—O Tetradentates, and N—O Hexadentates). Also includes hydrazone oximes. | R—N═N—C(═NOH)—R' or RR'C═N—NR"—C(═NOH)—R'", where R, R', R", and R'" represent H, $NH_2$, or any organic functional group wherein the number of carbon atoms ranges from 0 to 40, optionally having halogen or polarizing or water-insolubilizing/solubilizing groups attached. (R is typically an aryl group.) Ligand can also contain nonbinding N, O, S, or P atoms. |
| N—O Valence Stabilizer #19: 2-Nitrosophenols (o-Quinone monoximes) (N—O Bidentates) | o-(ON—)(HO—)Ar, where Ar represents an aromatic group or heterocyclic wherein the number of carbon atoms ranges from 6 to 40, optionally having halogen or polarizing or water-insolubilizing/solubilizing groups attached. Ligand can also contain nonbinding N, O, S, or P atoms. |
| N—O Valence Stabilizer #20: 2-Nitrophenols (N—O Bidentates) | o-($O_2N$—)(HO—)Ar, where Ar represents an aromatic group or heterocyclic wherein the number of carbon atoms ranges from 6 to 40, optionally having halogen or polarizing or water-insolubilizing/solubilizing groups attached. Ligand can also contain nonbinding N, O, S, or P atoms. |
| N—O Valence Stabilizer #21: Hydroxamates (Hydroxylamines), Bis(hydroxamates), and Poly(hydroxamates) (N—O Bidentates, N—O Tetradentates, and N—O Hexadentates) | R—C(═O)—NR'—OH or R—C(—OH)═N—OH, where R and R' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #22: N-Nitrosohydroxylamines, Bis(N-nitrosohydroxylamines), and Poly(N-nitrosohydroxylamines) (N—O Bidentates, N—O Tetradentates, and N—O Hexadentates) | R—N(—NO)—OH, where R represents any organic functional group wherein the number of carbon atoms ranges from 1 to 40, optionally having halogen or polarizing or water-insolubilizing/solubilizing groups attached. (R is typically an aryl or heterocyclic group.) Ligand can also contain nonbinding N, O, S, or P atoms. |
| N—O Valence Stabilizer #23: Amino Acids and ortho-Aminocarboxylic Acids, Peptides, Polypeptides, and Proteins [N—O Bidentates, N—O Tridentates, and N—O Tetradentates; possibly S—O dentates for sulfur-contg. examples such as penicillamine and cystine] | R—CH(—NHR')—C(═O)(—OH) for amino acids and ortho-aminocarboxylic acids, and R—CH(—NHR')—C(═O)—(NR"—)CH(—R'")—C(═O)(—OH) for peptides, where R, R', R", and R'" represent any organic functional group wherein the number of carbon atoms ranges from 1 to 40, optionally having halogen or polarizing or water-insolubilizing/solubilizing groups attached. Ligand can also contain nonbinding N, O, S, or P atoms. |
| N—O Valence Stabilizer #24: Amides, Bis(amides), and Poly(amides), including lactams (N—O Bidentates, N—O Tridentates, and N—O Tetradentates) | RCONR'R", where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #25: Semicarbazones, Bis(semicarbazones), and Poly(semicarbazones) (N—O Bidentates, N—O Tetradentates, and N—O Hexadentates) | RR'—N—C(═O)—NR"—N═CR'"R"", where R, R', R", R'", and R"" represent H, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #26: Acyl hydrazones, Bis(acyl hydrazones), and Poly(acyl hydrazones) (N—O Bidentates, N—O Tetradentates, and N—O Hexadentates) | R—C(═O)—NR'—N═CR"R'", where R, R', R", and R'" represent H, or any organic functional group wherein the number of carbon atoms ranges from 0 to 40, optionally having halogen or polarizing or water- |

TABLE 1-continued

Wide Band Organic Valence Stabilizers for the $Co^{+3}$ Ion

| General Structural Name (Type of Organic) | Structural Representation |
|---|---|
| | insolubilizing/solubilizing groups attached. Ligand can also contain nonbinding N, O, S, or P atoms. |
| N—O Valence Stabilizer #27: Carbazones (Diazenecarboxylic hydrazides), Bis(carbazones), and Poly(carbazones) (N—O Bidentates, N—O Tetradentates, and N—O Hexadentates) | R—N=N—C(=O)—NR'—N—R"R'", where R, R', R", and R'" represent H, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #28: Azo compounds with hydroxyl or carboxy or carbonyl substitution at the ortho- (for aryl) or alpha- or beta- (for alkyl) positions, Bis[o-(HO—) or alpha- or beta-(HO—)azo compounds], or Poly[o-(HO—) or alpha- or beta-(HO—)azo compounds) (N—O Bidentates, N—O Tridentates, N—O Tetradentates, or N—O Hexadentates) | R—N=N—R', where R, and R' represent H or any organic functional group wherein the number of carbon atoms ranges from 0 to 40, optionally having halogen or polarizing or water-insolubilizing/solubilizing groups attached. (Must include ortho-hydroxy or carboxy or carbonyl substituted aryl azo compounds, and alpha- or beta-hydroxy or carboxy or carbonyl alkyl azo compounds.) Ligand can also contain nonbinding N, O, S, or P atoms. |
| N—O Valence Stabilizer #29: Diazeneformamides, Diazeneacetamides, Bis(diazeneformamides), Bis(diazeneacetamides), Poly(diazeneformamides), and Poly(diazeneacetamides) (N—O Bidentates, N—O Tetradentates, and N—O Hexadentates) | R—N=N—C(=O)—NR'R" for diazeneformamides, and R—N=N—CR'R"—C(=O)—NR'"R"" for diazeneacetamides, where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #30: Diazeneformic acids, Diazeneacetic acids, Bis(diazeneformic acids), Bis(diazeneacetic acids), Poly(diazeneformic acids), Poly(diazeneacetic acids), and derivatives thereof (N—O Bidentates, N—O Tetradentates, N—O Hexadentates) | R—N=N—C(=O)—O—R' for diazeneformic acid, and R—N=N—CR'R"—C(=O)—O—R'" for diazeneacetic acid, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #31: Diazeneformaldehydes, Diazeneacetaldehydes, Bis(diazeneformaldehydes), Bis(diazeneacetaldehydes), Poly(diazeneformaldehydes), and Poly(diazeneacetaldehydes) (N—O Bidentates, N—O Tetradentates and N—O Hexadentates) | R—N=N—C(=O)—R' for diazeneformaldehydes, and R—N=N—CR'R"—C(=O)—R'" for diazeneacetaldehydes, where R, R', R", and R'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #32: Diazenediformamides, Diazenediacetamides, Bis(diazenediformamides), Bis(diazenediacetamides), Poly(diazenediformamides), and Poly(diazenediacetamides) (N—O Tridentates and N—O Hexadentates) | RR'—N—C(=O)—N=N—C(=O)—NR"R'" for diazenediformamides, and RR'—N—C(=O)—CR"R'"—N=N—CR""R""—C(=O)—NR"""R"""" for diazenediacetamides, where R, R', R", R'", R"", R""", R"""", and R"""" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #33: Diazenediformic acids, Diazenediacetic acids, Bis(diazenediformic acids), Bis(diazenediacetic acids), Poly(diazenediformic acids), Poly(diazenediacetic acids) and derivatives thereof (N—O Tridentates and N—O Hexadentates) | R—O—C(=O)—N=N—C(=O)—O—R' for diazenediformic acid, and R—O—C(=O)—CR'R"—N=N—CR'"R""—C(=O)—O—R""' for diazenediacetic acid, where R, R', R", R'", R"", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 1-continued

Wide Band Organic Valence Stabilizers for the $Co^{+3}$ Ion

| General Structural Name (Type of Organic) | Structural Representation |
|---|---|
| N—O Valence Stabilizer #34: Diazenediformaldehydes, Diazenediacetaldehydes, Bis(diazenediformaldehydes), Bis(diazenediacetaldehydes), Poly(diazenediformaldehydes), and Poly(diazenediacetaldehydes) (N—O Tridentates and N—O Hexadentates) | RC(=O)—N=N—C(=O)—R' for diazenediformaldehydes, and RC(=O)—CR'R''—N=N—CR'''R''''—C(=O)—R''''' for diazenediacetaldehydes, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #35: Ortho-hydroxy (or -carboxy) Substituted Formazans, Bis(o-hydroxy or -carboxy substituted formazans), and Poly(o-hydroxy or -carboxy substituted formazans) (N—O Bidentates, N—O Tridentates, N—O Tetradentates, and N—O Hexadentates) | R—N=N—CR'=N—NR''R''', where R, R', R'', and R''' represent H, or any organic functional group wherein the number of carbon atoms ranges from 0 to 40, optionally having halogen or polarizing or water-insolubilizing/solubilizing groups attached. (Must include ortho-hydroxy or carboxy substituted aryl R derivatives, and beta-hydroxy or carboxy substituted alkyl R derivatives.) Ligand can also contain nonbinding N, O, S, or P atoms. |
| N—O Valence Stabilizer #36: Ortho-hydroxy (or -carboxy) Substituted Azines (including ketazines), Bis(o-hydroxy or carboxy substituted azines), and Poly(o-hydroxy or carboxy substituted azines) (N—O Bidentates, N—O Tridentates, N—O Tetradentates, and N—O Hexadentates) | RR'C=N—N=CR''R''' or RR'C=N—NR''R''' (for ketazines), where R, R', R'', and R''' represent H, or any organic functional group wherein the number of carbon atoms ranges from 0 to 40, optionally having halogen or polarizing or water-insolubilizing/solubilizing groups attached. (Must include ortho-hydroxy or carboxy substituted aryl R derivatives, and beta-hydroxy or carboxy substituted alkyl R derivatives.) Ligand can also contain nonbinding N, O, S, or P atoms. |
| N—O Valence Stabilizer #37: Schiff Bases with one Imine (C=N) Group and with ortho- or alpha- or beta-hydroxy or carboxy or carbonyl substitution (N—O Bidentates, N—O Tridentates, N—O Tetradentates, N—O Pentadentates, or N—O Hexadentates). Also includes hydrazones with ortho-O substitution. | RR'C=N—R'', where R, R', and R'' represent H, or any organic functional group wherein the number of carbon atoms ranges from 0 to 40, optionally having halogen or polarizing or water-insolubilizing/solubilizing groups attached. (Must contain ortho- or alpha- or beta-hydroxy or carboxy or carbonyl substitution.) Ligand can also contain nonbinding N, O, S, or P atoms. |
| N—O Valence Stabilizer #38: Schiff Bases with two Imine (C=N) Groups and with ortho- or alpha- or beta-hydroxy or carboxy or carbonyl substitution (N—O Tridentates, N—O Tetradentates, N—O Pentadentates, or N—O Hexadentates). Also includes hydrazones with ortho-O substitution. | RR'C=N—R''—N=CR'''R'''' or R—N=C—R'—C=N—R' or RC=N—R'—N=CR'', where R, R', R'', R''', and R'''' represent H, or any organic functional group wherein the number of carbon atoms ranges from 0 to 40, optionally having halogen or polarizing or water-insolubilizing/solubilizing groups attached. (Must contain ortho- or alpha- or beta-hydroxy or carboxy or carbonyl substitution.) Ligand can also contain nonbinding N, O, S, or P atoms. |
| N—O Valence Stabilizer #39: Schiff Bases with three Imine (C=N) Groups and with ortho- or alpha- or beta-hydroxy or carboxy or carbonyl substitution (N—O Tetradentates, N—O Pentadentates, or N—O Hexadentates). Also includes hydrazones with ortho-O substitution. | $N(—R—N=CR'R'')_3$, where R, R', and R'' represent H, or any organic functional group wherein the number of carbon atoms ranges from 0 to 40, optionally having halogen or polarizing or water-insolubilizing/solubilizing groups attached. (Must contain ortho- or alpha- or beta-hydroxy or carboxy or carbonyl substitution.) Ligand can also contain nonbinding N, O, S, or P atoms. |
| N—O Valence Stabilizer #40: Silylaminoalcohols (N—O Bidentates, N—O Tridentates, N—O Tetradentates, and N—O Hexadentates) | $[R—C(NR'R'')]_x—R''—[Si(—OR''')_zR''''_{3-z}]_y$ where R, R', R'', R''', and R'''' represent H, $NH_2$, or any organic functional group wherein the number of carbon atoms ranges from 0 to 40, optionally having halogen or polarizing or water-insolubilizing/solubilizing groups attached, and x and y = 1-6, z = 1-3. Ligand can also contain nonbinding N, O, S, or P atoms. |

TABLE 1-continued

Wide Band Organic Valence Stabilizers for the $Co^{+3}$ Ion

| General Structural Name (Type of Organic) | Structural Representation |
|---|---|
| N—O Valence Stabilizer #41: Hydroxyalkyl Imines (Imino Alcohols) (N—O Bidentates, N—O Tridentates, N—O Tetradentates, and N—O Hexadentates) | $[R—C(=NR')]_x—R''—[C(—OR''')R''''R''''']_y$ or $[R—C(=NR')]_x—R''—[C(=O)R''']_y$, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached, and x and y = 1-6. Ligand can also contain nonbinding N, O, S, or P atoms. |
| N—O Valence Stabilizer #42: Hydroxyaryl Amines and Hydroxyaryl Imines (N—O Bidentates, N—O Tridentates, N—O Tetradentates, and N—O Hexadentates) | $[R(—NR'R'')(—OR''')]$, $[R(—NR'R'')(—C(=O)R''']$, $[R(—NR'R'')_x]_2O$, $[R(—NR'R'')_x]_{2-3}R'''(—OR'''')_y$, $[R(—OR')_x]_{2-3}R''(—NR'''R'''')_y$, and $[R(—NR'R'')_x]_2R'''(C(=O))_yR''''$ for hydroxyaryl amines; and $[R(—OR')_x]_2NH$ or $[R(—OR')_x]_2NHNH$ for hydroxyaryl imines, where R, R', R'', R''', and R'''' represent H, $NH_2$, or any organic functional group wherein the number of carbon atoms ranges from 0 to 40, optionally having halogen or polarizing or water-insolubilizing/solubilizing groups attached, and x = 0-2 and y = 1-4. Ligand can also contain nonbinding N, O, S, or P atoms. |
| N—O Valence Stabilizer #43: Five-Membered Heterocyclic Rings containing One, Two, Three, or Four Nitrogen Atoms with at least one additional Oxygen Atom Binding Site not in a Ring (N—O Bidentates, N—O Tridentates, N—O Tetradentates, or N—O Hexadentates) | Five membered heterocyclic ring(s) containing one, two, three, or four nitrogen atoms. In addition, ligand contains additional oxygen-containing substituents (usually hydroxy, carboxy or carbonyl groups) that constitute O binding sites. Can include other ring systems bound to the heterocyclic ring or to the O-containing substituent, but they do not coordinate with the stabilized, high valence metal ion. Ring(s) can also contain O, S, or P atoms. This 5-membered ring(s) and/or attached, uncoordinating rings and/or O-containing substituent(s) may or may not have halogen or polarizing or water-insolubilizing/solubilizing groups attached. |
| N—O Valence Stabilizer #44: Six-Membered Heterocyclic Rings containing One, Two, Three, or Four Nitrogen Atoms with at least one additional Oxygen Atom Binding Site not in a Ring (N—O Bidentates, N—O Tridentates, N—O Tetradentates, or N—O Hexadentates) | Six membered heterocyclic ring(s) containing one, two, three, or four nitrogen atoms. In addition, ligand contains additional oxygen-containing substituents (usually hydroxy, carboxy, or carbonyl groups) that constitute O binding sites. Can include other ring systems bound to the heterocyclic ring or to the O-containing substituent, but they do not coordinate with the stabilized, high valence metal ion. Ring(s) can also contain O, S, or P atoms. This 6-membered ring(s) and/or attached, uncoordinating rings and/or O-containing substiruent(s) may or may not have halogen or polarizing or water-insolubilizing/solubilizing groups attached. |
| N—O Valence Stabilizer #45: Five-Membered Heterocyclic Rings containing One or Two Oxygen Atoms with at least one additional Nitrogen Atom Binding Site not in a Ring (N—O Bidentates, N—O Tridentates, N—O Tetradentates, or N—O Hexadentates) | Five membered heterocyclic ring(s) containing one or two oxygen atoms. In addition, ligand contains additional nitrogen-containing substituents (usually amines, imines, or hydrazides) that constitute N binding sites. Can include other ring systems bound to the heterocyclic ring or to the N-containing substituent, but they do not coordinate with the stabilized, high valence metal ion. Ring(s) can also contain O, S, or P atoms. This 5-membered ring(s) and/or attached, uncoordinating rings and/or N-containing substituent(s) may or may not have halogen or polarizing or water-insolubilizing/solubilizing groups attached. |
| N—O Valence Stabilizer #46: Six-Membered Heterocyclic Rings containing One or Two Oxygen Atoms with at least one additional Nitrogen Atom Binding Site not in a Ring (N—O Bidentates, N—O Tridentates, N—O Tetradentates, or N—O Hexadentates) | Six membered heterocyclic ring(s) containing one or two oxygen atoms. In addition, ligand contains additional nitrogen-containing substituents (usually amines, imines, or hydrazides) that constitute N binding sites. Can include other ring systems bound to the heterocyclic ring or to the N-containing substituent, but they do not coordinate with the |

TABLE 1-continued

Wide Band Organic Valence Stabilizers for the $Co^{+3}$ Ion

| General Structural Name (Type of Organic) | Structural Representation |
|---|---|
| | stabilized, high valence metal ion. Ring(s) can also contain O, S, or P atoms. This 6-membered ring(s) and/or attached, uncoordinating rings and/or N-containing substituent(s) may or may not have halogen or polarizing or water-insolubilizing/solubilizing groups attached. |
| N—O Valence Stabilizer #47: Five-Membered Heterocyclic Rings containing One, Two, Three, or Four Nitrogen Atoms with at least one additional Oxygen Atom Binding Site in a Separate Ring (N—O Bidentates, N—O Tridentates, N—O Tetradentates) | Five membered heterocyclic ring(s) containing one, two, three, or four nitrogen atoms. In addition, ligand contains additional oxygen-containing rings that constitute O binding sites. Can include other ring systems bound to the N- or O-containing heterocyclic rings, but they do not coordinate with the stabilized, high valence metal ion. Ring(s) can also contain O, S, or P atoms. This 5-membered ring(s) and/or additional O-containing ring(s) and/or attached, uncoordinating rings may or may not have halogen or polarizing or water-insolubilizing/solubilizing groups attached. |
| N—O Valence Stabilizer #48: Six-Membered Heterocyclic Rings containing One, Two, Three, or Four Nitrogen Atoms with at least one additional Oxygen Atom Binding Site in a Separate Ring (N—O Bidentates, N—O Tridentates, N—O Tetradentates) | Six membered heterocyclic ring(s) containing one, two, three, or four nitrogen atoms. In addition, ligand contains additional oxygen-containing rings that constitute O binding sites. Can include other ring systems bound to the N- or O-containing heterocyclic rings, but they do not coordinate with the stabilized, high valence metal ion. Ring(s) can also contain O, S, or P atoms. This 6-membered ring(s) and/or additional O-containing ring(s) and/or attached, uncoordinating rings may or may not have halogen or polarizing or water-insolubilizing/solubilizing groups attached. |
| N—O Valence Stabilizer #49: Two-, Three-, Four-, Six-, Eight-, and Ten-Membered Macrocyclics, Macrobicyclics, and Macropolycyclics (including Catapinands, Cryptands, Cyclidenes, and Sepulchrates) wherein all Binding Sites are composed of Nitrogen (usually amine or imine groups) or Oxygen (usually hydroxy, carboxy, or carbonyl groupss) and are not contained in Component Heterocyclic Rings (N—O Bidentates, N—O Tridentates, N—O Tetradentates, and N—O Hexadentates) | Macrocyclic ligands containing two, three, four, six, eight, or ten binding sites composed of nitrogen and oxygen to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| N—O Valence Stabilizer #50: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen or Oxygen and are contained in Component Heterocyclic Rings (N—O Bidentates, N—O Tridentates, N—O Tetradentates, or N—O Hexadentates) | Macrocyclic ligands containing a total of four, six, eight, or ten heterocyclic rings containing nitrogen or oxygen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N—O Valence Stabilizer #51: Four-, Six-, Eight-, or Ten-Membered Macrocyclics, Macrobicyclics, and Macropolycyclics (including Catapinands, Cryptands, Cyclidenes, and Sepulchrates) wherein all Binding Sites are composed of Nitrogen or Oxygen and are contained in a Combination of Heterocyclic Rings and Amine, Imine, Hydroxy, Carboxy, or Carbonyl Groups (N—O Bidentates, N—O Tridentates, N—O Tetradentates, or N—O Hexadentates) | Macrocyclic ligands containing at least one heterocyclic ring. These heterocyclic rings provide nitrogen or oxygen binding sites to valence stabilize the central metal ion. Other amine, imine, hydroxy, carboxy, or carbonyl binding sites can also be included in the macrocyclic ligand, so long as the total number of binding sites is four, six, eight, or ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S—O Valence Stabilizer #1: 1,3-Monothioketones (Monothio-beta-ketonates), 1,3,5-Monothioketones, 1,3,5-Dithioketones, Bis(1,3-Monothioketones), and Poly(1,3-Monothioketones) (S—O | R—C(=S)—CR'R''—C(=O)—R''' where R, R', R'', and R''' represent H, $NH_2$, or any organic functional group wherein the number of carbon atoms ranges from 0 to 40, optionally having halogen or polarizing or water- |

TABLE 1-continued

Wide Band Organic Valence Stabilizers for the $Co^{+3}$ Ion

| General Structural Name (Type of Organic) | Structural Representation |
|---|---|
| Bidentates, S—O Tridentates, S—O Tetradentates) | insolubilizing/solubilizing groups attached. Ligand can also contain nonbinding N, O, S, or P atoms. |
| S—O Valence Stabilizer #2: Thiomalonamides (Thiomalonodiamides), Bis(thiomalonamides), and Polythiomalonamides (S—O Bidentates, S—O Tridentates, S—O Tetradentates) | RR'—N—C(═S)—CR"R'"—C(═O)—N—R""R"""" where R, R', R", R'", R"", and R"""" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #3: 2-Thioacylacetamides, 2-Acylthioacetamides, Bis(2-thioacylacetamides), Bis(2acylthioacetamides), Poly(2-thioacylacetamides), and Poly(2-Acylthioacetamides) (S—O Bidentates, S—O Tridentates, S—O Tetradentates) | RR'—N—C(═O)—CR"R'"—C(═S)—R"" for 2-thioacylacetamides, and RR'—N—C(═S)—CR"R'"—C(═O)—R"" for 2-acylthioacetamides, where R, R', R", R'", and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #4: Dithiodicarbonic Diamides, Bis(dithiodicarbonic diamides), and Poly(dithiodicarbonic diamides) (S—O Bidentates, S—O Tridentates, S—O Tetradentates) | RR'—N—C(═S)—S—C(═O)—N—R"R'" where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #5: Monothiohypophosphoric Acids, Bis(monothiohypophosphoric acids), and Poly(monothiohypophosphoric acids), and derivatives thereof (S—O Bidentates, S—O Tridentates, S—O Tetradentates) | (R—O—)(R'—O—)P(═S)—P(═O)(—O—R")(—O—R'"); (R—O—)(R'—S—)P(═S)—P(O)(—S—R")(—O—R'"); or (R—S—)(R'—S—)P(═S)—P(═O)(—S—R")(—S—R'"), where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. Note: these ligands are not to be confused with hypophosphorous acid derivatives (hypophosphites) (R—O—)R"R'"P(═O) which are very reducing and therefore unacceptable for stabilization of high valence states in metal ions. |
| S—O Valence Stabilizer #6: Monothiohypophosphoramides, Bis(monothiohypophosphoramides), and Poly(monothiohypophosphoramides) (S—O Bidentates, S—O Tridentates, S—O Tetradentates) | (RR'—N—)(R"R'"—N—)P(═S)—P(═O)(—N—R""R""")(—N—R""""R"""""), where R, R', R", R'", R"", R""", R""", and R"""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. Note: these ligands are not to be confused with hypophosphorous acid derivatives (hypophosphites) (R—O—)R"R'"P(═O) which are very reducing and therefore unacceptable for stabilization of high valence states in metal ions. |
| S—O Valence Stabilizer #7: Monothioimidodiphosphoric Acids, Monothiohydrazidodiphosphoric Acids, Bis(monothioimidodiphosphoric Acids), Bis(monothiohydrazidodiphosphoric Acids), Poly(monothioimidodiphosphoric Acid), Poly(monothiohydrazidodiphosphoric Acids), and derivatives thereof (S—O Bidentates, S—O Tridentates, S—O Tetradentates) | (R—O—)(R'—O—)P(═S)—NH—P(═O)(—O—R")(—O—R'"); (R—O—)(R'—S—)P(═S)—NH—P(═O)(—S—R")(—O—R'"); or (R—S—)(R'—S—)P(═S)—NH—P(═O)(—S—R")(—S—R'") for monothioimidodiphosphoric acids, and —NH—NH— derivatives for monothiohydrazidodiphosphoric acids, where R, R', R", and R'" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #8: Monothioimidodiphosphoramides, Monothiohydrazidodiphosphoramides, | (RR'—N—)(R"R'"—N—)P(═S)—NH—P(═O)(—N—R""R""")(—N—R""""R"""""") for monothioimidodiphosphoramides, and —NH— |

TABLE 1-continued

Wide Band Organic Valence Stabilizers for the $Co^{+3}$ Ion

| General Structural Name (Type of Organic) | Structural Representation |
|---|---|
| Bis(monothioimidodiphosphoramides), Bis(monothiohydrazidodiphosphoramides), Poly(monothioimidodiphosphoramides), and Poly(monothiohydrazidodiphosphoramides) (S—O Bidentates, S—O Tridentates, S—O Tetradentates) | NH— derivatives for monothiohydrazidodiphosphoramides, where R, R', R'', R''', R'''', R''''', R'''''', and R''''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #9: Monothiodiphosphoramides, Bis(monothioiphosphoramides), and Poly(monothiodiphosphoramides) (S—O Bidentates, S—O Tridentates, S—O Tetradentates) | (RR'—N—)(R''R'''—N—)P(═S)—S—P(═O)(—N—R''''R'''''')(—N—R'''''R''''''), or (RR'—N—)(R''R'''—N—)P(═S)—O—P(═O)(—N—R''''R'''''')(—N—R'''''R''''''), where R, R', R'', R''', R'''', R''''', R'''''', and R''''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #10: Monothiodiphosphoric Acids, Bis(monothioiphosphoric Acids), Poly(monothiodiphosphoric Acids), and derivatives thereof (S—O Bidentates, S—O Tridentates, S—O Tetradentates) | (R—O—)(R'—O—)P(═S)—O—P(═O)(—O—R'')(—O—R'''); (R—O—)(R'—O—)P(═S)—S—P(═O)(—O—R'')(—O—R'''); (R—O—)(R'—S—)P(═S)—O—P(═O)(—S—R'')(—O—R'''); (R—O—)(R'—S—)P(═S)—S—P(═O)(—S—R'')(—O—R'''); or (R—S—)(R'—S—)P(═S)—S—P(═O)(—S—R'')(—S—R'''), where R, R', R'', R''', R'''', R''''', R'''''', and R''''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #11: Monothiocarbamates, Bis(monothiocarbamates), and Poly(monothiocarbamates) (including N-hydroxymonothiocarbamates and N-mercaptomonothiocarbamates) (S—O Bidentates, S—O Tridentates, and S—O Tetradentates) | $RR'N^{+}$═C(OH)(SH), where R and R' represent H, OH, SH, OR'' (R''═$C_1$-$C_{30}$ alkyl or aryl), SR'' (R''═$C_1$-$C_{30}$ alkyl or aryl), $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |

N Valence Stabilizer #1: Examples of monoamines (N monodentates) that meet the requirements for use as "wide band" valence stabilizers for $Co^{+3}$ include, but are not limited to: ammonia, ethylamine, n-dodecylamine, octylamine, phenylamine, cyclohexylamine, diethylamine, dioctylamine, diphenylamine, dicyclohexylamine, azetidine, hexamethylenetetramine, aziridine, azepine, pyrrolidine, benzopyrrolidine, dibenzopyrrolidine, naphthopyrrolidine, piperidine, benzopiperidine, dibenzopiperidine, naphthopiperidine, azacycloheptane (hexamethyleneimine (Urotropin)), aminonorbornane, adamantanamine, aniline, benzylamine, toluidine, phenethylamine, xylidine, cumidine, naphthylamine, polyalkylamines, polyanilines, and fluorenediamine.

N Valence Stabilizer #2: Examples of diamines (N—N bidentates) that meet the requirements for use as "wide band" valence stabilizers for $Co^{+3}$ include, but are not limited to: hydrazine, phenylhydrazine, 1,1-diphenylhydrazine, 1,2-diphenylhydrazine (hydrazobenzene), methanediamine, ethylenediamine (1,2-ethanediamine, en), trimethylenediamine (1,3-propanediamine), putrescine (1,4-butanediamine), cadaverine (1,5-pentanediamine), hexamethylenediamine (1,6-hexanediamine), 2,3-diaminobutane, stilbenediamine (1,2-diphenyl-1,2-ethanediamine), cyclohexane-1,2-diamine, cyclopentane-1,2-diamine, 1,3-diazacyclopentane, 1,3-diazacyclohexane, piperazine, benzopiperazine, dibenzopiperazine, naphthopiperazine, diazepine, thiadiazepine, oxodiazepine, sparteine (lupinidine), 2-(aminomethyl)azacyclohexane, 2-(aminomethyl)piperidine, 2-(aminomethyl)pyrrolidine, 2-(aminomethyl)azetidine, 2-(2-aminoethyl)aziridine, 1,2-diaminobenzene, benzidine, bis(2,2'-piperazino)-1,2-ethene, 1,4-diazabicyclo[2.2.2]octane, naphthylethylenediamine, and 1,2-dianilinoethane.

N Valence Stabilizer #3: Examples of triamines (N—N bidentates or N—N tridentates) that meet the requirements for use as "wide band" valence stabilizers for $Co^{+3}$ include, but are not limited to: N-(2-aminoethyl)-1,2-ethanediamine (dien, 2,2-tri); N-(2-aminoethyl)-1,3-propanediamine (2,3-tri); N-(3aminopropyl)-1,3-propanediamine (3,3-tri, dpt); N-(3-aminopropyl)-1,4-butanediamine (3,4-tri, spermidine); N-(2-aminoethyl)-1,4-butanediamine (2,4-tri); N-(6-hexyl)-1,6-hexanediamine (6,6-tri); 1,3,5-triaminocyclohexane (tach); 2-(aminomethyl)-1,3-propanediamine (tamm); 2-(aminomethyl)-2-methyl-1,3-propanediamine (tame); 2-(aminomethyl)-2-ethyl-1,3-propanediamine (lamp); 1,2,3-triaminopropane (tap); 2,3-(2-aminoethyl)aziridine; 2,4-(aminomethyl)azetidine; 2,5-(aminomethyl)pyrrolidine; 2,6-(aminomethyl)piperidine; di(2-aminobenzyl)amine; hexahydro-1,3,5-triazine; hexahydro-2,4,6-trimethyl-1,3,5-triazine; and 1,3,5-tris(aminomethyl)benzene.

N Valence Stabilizer #4: Examples of tetramines (N—N bidentates, N—N tridentates, or N—N tetradentates) that meet the requirements for use as "wide band" valence stabilizers for $Co^{+3}$ include, but are not limited to: N,N'-(2-aminoethyl)-1,2-ethanediamine (2,2,2-tet, trien (triethylenetetramine)); N,N'-(2-aminoethyl)-1,3-propanediamine (2,3,2-tet, entnen); N,N'-(3-aminopropyl)-1,2-ethanediamine (3,2,3-tet, tnentn); N-(2-aminoethyl)-N'-(3-aminopropyl)-1,2-ethanediamine (2,2,3-tet); N-(2-aminoethyl)-N'-(3-aminopropyl)-1,3-propanediamine (3,3,2-tet); N,N'-(3-aminopropyl)-1,3-propanediamine (3,3,3-tet); N,N'-(3-aminopropyl)-1,4-butanediamine (3,4,3-tet, spermine); tri(aminomethyl)amine (tren); tri(2-aminoethyl)amine (trtn); tri(3-aminopropyl)amine (trbn); 2,2-aminomethyl-1,3-propanediamine (tam); 1,2,3,4-tetraminobutane (tab); N,N'-(2-aminophenyl)-1,2-ethanediamine; and N,N'-(2-aminophenyl)-1,3-propanediamine.

N Valence Stabilizer #5: Examples of pentamines (N—N bidentates, N—N tridentates, or N—N tetradentates) that meet the requirements for use as "wide band" valence stabilizers for $Co^{+3}$ include, but are not limited to: N-[N-(2-aminoethyl)-2-aminoethyl]-N'-(2-aminoethyl)-1,2-ethanediamine (2,2,2,2-pent, tetren); N-[N-(3-aminopropyl)-2-aminoethyl]-N'-(3-aminopropyl)-1,2-ethanediamine (3,2,2,3-pent); N-[N-(3-aminopropyl)-3-aminopropyl]-N'-(3-aminopropyl)-1,3-propanediamine (3,3,3,3-pent, caldopentamine); N-[N-(2-aminobenzyl)-2-aminoethyl]-N'-(2-aminopropyl)-1,2-ethanediamine; N-[N-(2-aminoethyl)-2-aminoethyl]-N,N-(2-aminoethyl)amine (trenen); and N-[N-(2-aminopropyl)-2-aminoethyl]-N,N-(2-aminoethyl)amine (4-Me-trenen).

N Valence Stabilizer #6: Examples of hexamines (N—N bidentates, N—N tridentates, N—N tetradentates, or N—N—N—N—N—N hexadentates) that meet the requirements for use as "wide band" valence stabilizers for $Co^{+3}$ include, but are not limited to: N,N'-[N-(2-aminoethyl)-2-aminoethyl]-1,2-ethanediamine (2,2,2,2,2-hex, linpen); N,N'-[N-(2-aminoethyl)-3-aminopropyl]-1,2-ethanediamine (2,3,2,3,2-hex); N,N,N',N'-(2-aminoethyl)-1,2-ethanediamine (penten, ten); N,N,N',N '-(2-aminoethyl)-1-methyl-1,2-ethanediamine (tpn, R-5-Me-penten); N,N,N',N'-(2-aminoethyl)-1,3-propanediamine (ttn); N,N,N',N'-(2-aminoethyl)-1,4-butanediamine (tbn); N,N,N',N'-(2-aminoethyl)-1,3-dimethyl-1,3-propanediamine (R,R-tptn, R,S-tptn); N-(2-aminoethyl)-2,2-[N-(2-aminoethyl)aminomethyl-1-propaneamine (sen); and N-(3-aminopropyl)-2,2-[N-(3-aminopropyl)aminomethyl-1-propaneamine (stn).

N Valence Stabilizer #7a: Examples of 5-membered heterocyclic rings containing one nitrogen atom (N monodentates) that meet the requirements for use as "wide band" valence stabilizers for $Co^{+3}$ include, but are not limited to: 1-pyrroline, 2-pyrroline, 3-pyrroline, pyrrole, oxazole, isoxazole, thiazole, isothiazole, azaphosphole, benzopyrroline, benzopyrrole (indole), benzoxazole, benzisoxazole, benzothiazole, benzisothiazole, benzazaphosphole, dibenzopyrroline, dibenzopyrrole (carbazole), dibenzoxazole, dibenzisoxazole, dibenzothiazole, dibenzisothiazole, naphthopyrroline, naphthopyrrole, naphthoxazole, naphthisoxazole, naphthothiazole, naphthisothiazole, naphthazaphosphole, and polypyrroles.

N Valence Stabilizer #7b: Examples of 5-membered heterocyclic rings containing two nitrogen atoms (N monodentates or N—N bidentates) that meet the requirements for use as "wide band" valence stabilizers for $Co^{+3}$ include, but are not limited to: pyrazoline, imidazoline, imidazole (ia), pyrazole, oxadiazole, thiadiazole, diazaphosphole, benzopyrazoline, benzimidazoline, benzimidazole (azindole)(bia)(bz), benzopyrazole (indazole), benzothiadiazole (piazthiole), benzoxadiazole (benzofurazan), naphthopyrazoline, naphthimidazoline, naphthimidazole, naphthopyrazole, naphthoxadiazole, naphthothiadiazole, polybenzimidazole, and polyimidazoles (e.g. polyvinylimidazole (pvi)).

N Valence Stabilizer #7c: Examples of 5-membered heterocyclic rings containing three nitrogen atoms (N monodentates, N—N bidentates) that meet the requirements for use as "wide band" valence stabilizers for $Co^{+3}$ include, but are not limited to: triazole, oxatriazole, thiatriazole, benzotriazole (bta), tolyltriazole (tt), naphthotriazole, and triazolophthalazine.

N Valence Stabilizer #7d: Examples of 5-membered heterocyclic rings containing four nitrogen atoms (N monodentates or N—N bidentates) that meet the requirements for use as "wide band" valence stabilizers for $Co^{+3}$ include, but are not limited to: tetrazole.

N Valence Stabilizer #8a: Examples of 6-membered heterocyclic rings containing one nitrogen atom (N monodentates) that meet the requirements for use as "wide band" valence stabilizers for $Co^{+3}$ include, but are not limited to: pyridine, picoline, lutidine, γ-collidine, oxazine, thiazine, azaphosphorin, quinoline, isoquinoline, benzoxazine, benzothiazine, benzazaphosphorin, acridine, phenanthridine, phenothiazine (dibenzothiazine), dibenzoxazine, dibenzazaphosphorin, benzoquinoline (naphthopyridine), naphthoxazine, naphthothiazine, naphthazaphosphorin, and polypyridines.

N Valence Stabilizer #8b: Examples of 6-membered heterocyclic rings containing two nitrogen atoms (N monodentates or N—N bidentates) that meet the requirements for use as "wide band" valence stabilizers for $Co^{+3}$ include, but are not limited to: pyrazine, pyridazine, pyrimidine, oxadiazine, thiadiazine, diazaphosphorin, quinoxaline (benzopyrazine), cinnoline (benzo[c]pyridazine), quinazoline (benzopyrimidine), phthalazine (benzo[d]pyridazine), benzoxadiazine, benzothiadiazine, phenazine (dibenzopyrazine), dibenzopyridazine, naphthopyrazine, naphthopyridazine, naphthopyrimidine, naphthoxadiazine, naphthothiadiazine, and polyquinoxalines.

N Valence Stabilizer #8c: Examples of 6-membered heterocyclic rings containing three nitrogen atoms (N monodentates or N—N bidentates) that meet the requirements for use as "wide band" valence stabilizers for $Co^{+3}$ include, but are not limited to: 1,3,5-triazine, 1,2,3-triazine, benzo-1,2,3-triazine, naphtho-1,2,3-triazine, oxatriazine, thiatriazine, melamine, and cyanuric acid.

N Valence Stabilizer #8d: Examples of 6-membered heterocyclic rings containing four nitrogen atoms (N monodentates or N—N bidentates) that meet the requirements for use as "wide band" valence stabilizers for $Co^{+3}$ include, but are not limited to: tetrazine.

N Valence Stabilizer #9a: Examples of 5-membered heterocyclic rings containing one nitrogen atom and having at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 2-(aminomethyl)-3-pyrroline; 2,5-(aminomethyl)-3-pyrroline; 2-(aminomethyl) pyrrole; 2,5-(aminomethyl)pyrrole; 3-(aminomethyl)isoxazole; 2-(aminomethyl)thiazole; 3-(aminomethyl) isothiazole; 2-(aminomethyl)indole; 2-aminobenzoxazole; 2-aminobenzothiazole (abt); 1,8-diaminocarbazole; 2-amino-6-methyl-benzothiazole (amebt); 2-amino-6-methoxybenzothiazole (ameobt); and 1,3-diiminoisoindoline.

N Valence Stabilizer #9b: Examples of 5-membered heterocyclic rings containing two nitrogen atoms at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 2-aminoimidazoline; 1-(3-aminopropyl)imidazoline; 2-aminoimidazole; 1-(3-aminopropyl)imidazole; 4-(2-aminoethyl)imidazole [histamine]; 1-alkyl-4-(2-aminoethyl)imidazole; 3-(2-aminoethyl)pyrazole; 3,5-(2-aminoethyl)pyrazole; I-(aminomethyl) pyrazole; 2-aminobenzimidazole; 7-(2-aminoethyl) benzimidazole; 1-(3-aminopropyl)benzimidazole; 3-(2-aminoethyl)indazole; 3,7-(2-aminoethyl)indazole; I-(aminomethyl)indazole; 7-aminobenzothiadiazole; 4-(2-aminoethyl)benzothiadiazole; 7-aminobenzoxadiazole; 4-(2-aminoethyl)benzoxadiazole; ethylenediaminetetra(1-pyrazolylmethane) [edtp]; methylenenitrilotris(2-(1-methyl) benzimidazole) [mntb] [tris(1-methyl-2-benzimidazolylmethane)amine]; bis(alkyl-1-pyrazolylmethane)amine; bis (alkyl-2-(1-pyrazolyl)ethane)amine; bis(N,N-(2-benzimidazolyl)-2-aminoethane)(2-benzimidazolylmethane)amine; bis(1-(3,5-dimethyl) pyrazolylmethane)phenylamine; tris(2-(1-(3,5-dimethyl) pyrazolyl)ethane)amine; 5-(dimethylamino)pyrazole; 5-(dimethylaminomethyl)pyrazole; 2-amino-1,3,4-thiadiazole; and 1-(2-aminoethyl)imidazoline.

N Valence Stabilizer #9c: Examples of 5-membered heterocyclic rings containing three nitrogen atoms at least one additional nitrogen atom binding site not contained in a ring (N Monodentates, N—N Bidentates, N—N—N Tridentates, N—N—N—N Tetradentates, or N—N—N—N—N—N Hexadentates) that meet the requirements for use as "wide band" valence stabilizers for $Co^{+3}$ include, but are not limited to: 3-amino-1,2,4-triazole (ata); 3,5-diamino-1,2,4-triazole (dat); 5-amino-1,2,4-triazole; 3-(2-aminoethyl)-1,2,4-triazole; 5-(2-aminoethyl)-1,2,4-triazole; 3,5-(2-aminoethyl)-1,2,4-triazole; 1-(aminomethyl)-1,2,4-triazole; 3,5-(aminomethyl)-4-amino-1,2,4-triazole; 4-(2-aminoethyl)-1,2,3-triazole; 5-(2-aminoethyl)-1,2,3-triazole; 7-aminobenzotriazole; 1-(aminomethyl)-1,2,3-triazole; 1-(2-aminoethyl)-1,2,3-triazole; 4-(3-aminopropyl)benzotriazole; N-(benzotriazolylalkyl)amine; dibenzotriazole-1-ylalkylamine; bis(5-amino-1,2,4-triazol-3-yl); bis(5-amino-1,2,4-triazol-3-yl)alkanes; and 1-(aminomethyl) benzotriazole.

N Valence Stabilizer #9d: Examples of 5-membered heterocyclic rings containing four nitrogen atoms at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 5-(2-aminoethyl)-1H-tetrazole; 1-(aminomethyl)-1H-tetrazole; and 1-(2-aminoethyl)-1H-tetrazole.

N Valence Stabilizer #10a: Examples of 6-membered heterocyclic rings containing one nitrogen atom and having at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 2-aminopyridine; 2,6-diaminopyridine; 2-(aminomethyl)pyridine; 2,6-(aminomethyl)pyridine; 2,6-(aminoethyl)pyridine; 2-amino-4-picoline; 2,6-diamino-4-picoline; 2-amino-3,5-lutidine; 2-aminoquinoline; 8-aminoquinoline; 2-aminoisoquinoline; acriflavine; 4-aminophenanthridine; 4,5-(aminomethyl)phenothiazine; 4,5-(aminomethyl)dibenzoxazine; 10-amino-7,8-benzoquinoline; bis(2-pyridylmethane) amine; tris(2-pyridyl)amine; bis(4-(2-pyridyl)-3-azabutane) amine; bis(N,N-(2-(2-pyridyl)ethane)aminomethane)amine; 4-(N,N-dialkylaminomethyl)morpholine; 6-aminonicotinic acid; 8-aminoacridine; and 2-hydrazinopyridine.

N Valence Stabilizer #10b: Examples of 6-membered heterocyclic rings containing two nitrogen atoms at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 2-aminopyrazine; 2,6-diaminopyrazine; 2-(aminomethyl)pyrazine; 2,6-(aminomethyl)pyrazine; 3-(aminomethyl)pyridazine; 3,6-(aminomethyl)pyridazine; 3,6-(2-aminoethyl)pyridazine; 1-aminopyridazine; 1-(aminomethyl)pyridazine; 2-aminopyrimidine; 1-(2-aminoethyl)pyrimidine; 2-aminoquinoxaline; 2,3-diaminoquinoxaline; 2-aminocinnoline; 3-aminocinnoline; 3-(2-aminoethyl)cinnoline; 3,8-(2-aminoethyl)cinnoline; 2-aminoquinazoline; 1-(2-aminoethyl) quinazoline; 1-aminophthalazine; 1,4-(2-aminoethyl)phthalazine; 1,8-(aminomethyl)phenazine; 2-amino-4,6-dimethylpyrimidine (admp); dihydralazine; and hydralazine.

N Valence Stabilizer #10c: Examples of 6-membered heterocyclic rings containing three nitrogen atoms at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 2-amino-1,3,5-triazine; 2-(aminomethyl)-1,3,5-triazine; 2,6-(aminomethyl)-1,3,5-triazine; 1-(3-aminopropyl)-1,3,5-triazine; 1,5-(3-aminopropyl)-1,3,5-triazine; polymelamines; melamine; and altretamine.

N Valence Stabilizer #10d: Examples of 6-membered heterocyclic rings containing four nitrogen atoms at least one additional nitrogen atom binding site not contained in a ring (N Monodentates, N—N Bidentates, N—N Tridentates, N—N Tetradentates, or N—N Hexadentates) that meet the requirements for use as "wide band" valence stabilizers for $Co^{+3}$ include, but are not limited to: 3,6-(2-aminoethyl)-1,2,4,5-tetrazine; 3,6-(1,3-diamino-2-propyl)-1,2,4,5-tetrazine; and 4,6-(aminomethyl)-1,2,3,5-tetrazine.

N Valence Stabilizer #11a: Examples of 5-membered heterocyclic rings containing one nitrogen atom and having at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 2,2'-bi-3-pyrroline; 2,2'-bi-2-pyrroline; 2,2'-bi-1-pyrroline; 2,2'-bipyrrole; 2,2',2"-tripyrrole; 3,3'-biisoxazole; 2,2'-bioxazole; 3,3'-biisothiazole; 2,2'-bithiazole;

2,2'-biindole; 2,2'-bibenzoxazole; 2,2'-bibenzothiazole; bilirubin; biliverdine; and 7-azaindole.

N Valence Stabilizer #11b: Examples of 5-membered heterocyclic rings containing two nitrogen atoms at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 2,2'-bi-2-imidazoline [2,2'-bi-2-imidazolinyl][bimd]; 2,2'-biimidazole [2,2'-biimidazolyl][biim$H_2$]; 5,5'-bipyrazole; 3,3'-bipyrazole; 4,4'-bipyrazole [4,4'-bipyrazolyl][bpz]; 2,2'-bioxadiazole; 2,2'-bithiadiazole; 2,2'-bibenzimidazole; 7,7'-biindazole; 5,5'-bibenzofurazan; 5,5'-bibenzothiadiazole; bis-1,2-(2-benzimidazole)ethane; bis(2-benzimidazole)methane; 1,2-(2-imidazolyl)benzene; 2-(2-thiazolyl)benzimidazole; 2-(2-imidazolyl)benzimidazole; benzimidazotriazine; 4-azabenzimidazole; and 2,6-bis(2-benzimidazolyl)pyridine.

N Valence Stabilizer #11c: Examples of 5-membered heterocyclic rings containing three nitrogen atoms at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 5,5'-bi-1,2,4-triazole [btrz]; 3,3'-bi-1,2,4-triazole; 1,1'-bi-1,2,4-triazole; 1,1'-bi-1,2,3-triazole; 5,5'-bi-1,2,3-triazole; 7,7'-bibenzotriazole; 1,1'-bibenzotriazole; bis(pyridyl)aminotriazole (pat); and 8-azaadenine.

N Valence Stabilizer #11d: Examples of 5-membered heterocyclic rings containing four nitrogen atoms at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 5,5'-bi-1H-tetrazole; and 1,1'-bi-1H-tetrazole.

N Valence Stabilizer #12a: Examples of 6-membered heterocyclic rings containing one nitrogen atom and having at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 2,2'-bipyridine [bipy]; 2,2',2"-tripyridine [terpyridine] [terpy]; 2,2',2",2'"-tetrapyridine [tetrapy]; 6,6'-bi-2-picoline; 6,6'-bi-3-picoline; 6,6'-bi-4-picoline; 6,6'-bi-2,3-lutidine; 6,6'-bi-2,4-lutidine; 6,6'-bi-3,4-lutidine; 6,6'-bi-2,3,4-collidine; 2,2'-biquinoline; 2,2'-biisoquinoline; 3,3'-bibenzoxazine; 3,3'-bibenzothiazine; 1,10-phenanthroline [phen]; 1,8-naphthyridine; bis-1,2-(6-(2,2'-bipyridyl)) ethane; bis-1,3-(6-(2,2'-bipyridyl))propane; 3,5-bis(3-pyridyl)pyrazole; 3,5-bis(2-pyridyl)triazole; 1,3-bis(2-pyridyl)-1,3,5-triazine; 1,3-bis(2-pyridyl)-5-(3-pyridyl)-1,3,5-triazine; 2,7-(N,N'-di-2-pyridyl)diaminobenzopyrroline; 2,7-(N,N'-di-2-pyridyl)diaminophthalazine; 2,6-di-(2-benzothiazolyl)pyridine; triazolopyrimidine; 2-(2-pyridyl)imidazoline; 7-azaindole; 1-(2-pyridyl)pyrazole; (1-imidazolyl)(2-pyridyl)methane; 4,5-bis(N,N'-(2-(2-pyridyl)ethyl) iminomethyl)imidazole; bathophenanthroline; 4-(2-benzimidazolyl)quinoline; 1,2-bis(2-pyridyl)ethane; 4,4'-diphenyl-2,2'-dipyridyl; neocuproine; nicotine; and nornicotine.

N Valence Stabilizer #12b: Examples of 6-membered heterocyclic rings containing two nitrogen atoms at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 2,2'-bipyrazine; 2,2',2"-tripyrazine; 6,6'-bipyridazine; bis(3-pyridazinyl)methane-1,2-bis(3-pyridazinyl) ethane; 2,2'-bipyrimidine; 2,2'-biquinoxaline; 8,8'-biquinoxaline; bis(3-cinnolinyl)methane; bis(3-cinnolinyl) etbane; 8,8'-bicinnoline; 2,2'-biquinazoline; 4,4'-biquinazoline; 8,8'-biquinazoline; 2,2'-biphthalazine; 1,1'-biphthalazine; 2-(2-pyridyl)benzimidazole; 8-azapurine; purine; adenine; guanine; hypoxanthine; 2,6-bis(N,N'-(2-(4-imidazolyl)ethyl)iminomethyl)pyridine; 2-(N-(2-(4-imidazolyl)ethyl)iminomethyl)pyridine; adenine (aminopurine); purine; and 2,3-bis(2-pyridyl)pyrazine.

N Valence Stabilizer #12c: Examples of 6-membered heterocyclic rings containing three nitrogen atoms at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 2,2'-bi-1,3,5-triazine; 2,2',2"-tri-1,3,5-triazine; 4,4'-bi-1,2,3-triazine; and 4,4'-bibenzo-1,2,3-triazine; 2,4,6-tris(2-pyridyl)-1,3,5-triazine; and benzimidazotriazines.

N Valence Stabilizer #12d: Examples of 6-membered heterocyclic rings containing four nitrogen atoms at least one additional nitrogen atom binding site contained in a ring (N Monodentates, N—N Bidentates, N—N Tridentates, N—N Tetradentates) that meet the requirements for use as "wide band" valence stabilizers for $Co^{+3}$ include, but are not limited to: 3,3'-bi-1,2,4,5-tetrazine; and 4,4'-bi-1,2,3,5-tetrazine.

N Valence Stabilizer #13a: Examples of two-membered macrocyclics, macrobicyclics, and macropolycyclics (including catapinands, cryptands, cyclidenes, and sepulchrates) wherein both binding sites are composed of nitrogen (usually amine or imine groups) and are not contained in component heterocyclic rings (N—N Bidentates) that meet the requirements for use as "wide band" valence stabilizers for $Co^{+3}$ include, but are not limited to: diazacyclobutane ([4]ane$N_2$); diazacyclopentane ([5]ane$N_2$); diazacyclohexane ([6]ane$N_2$); diazacycloheptane ([7]ane$N_2$); diazacyclooctane ([8]ane$N_2$); piperazine; benzopiperazine; diazacyclobutene ([4]ene$N_2$); diazacyclopentene ([5]ene$N_2$); diazacyclohexene ([6]ene$N_2$); diazacycloheptene ([7]ene$N_2$); diazacyclooctene ([8]ene$N_2$); diazacyclobutadiene ([4]diene$N_2$); diazacyclopentadiene ([5]diene$N_2$); diazacyclohexadiene ([6]diene$N_2$); diazacycloheptadiene ([7]diene$N_2$); and diazacyclooctadiene ([8]diene$N_2$).

N Valence Stabilizer #13b: Examples of three-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates) that meet the requirements for use as "wide band" valence stabilizers for $Co^{+3}$ include, but are not limited to: triazacyclohexane (including hexahydro-1,3,5-triazine)([6]ane$N_3$); triazacycloheptane ([7]ane$N_3$); triazacyclooctane ([8]ane$N_3$); triazacyclononane ([9]ane$N_3$); triazacyclodecane ([10]ane$N_3$); triazacycloundecane ([11]ane$N_3$); triazacyclododecane ([12]ane$N_3$); triazacyclohexene ([6]ene$N_3$); triazacycloheptene ([7]ene$N_3$); triazacyclooctene ([8]ene$N_3$); triazacyclononene ([9]ene$N_3$); triazacyclodecene ([10]ene$N_3$); triazacycloundecene ([11]ene$N_3$); triazacyclododecene ([12]ene$N_3$); triazacyclohexatriene ([6]triene$N_3$); triazacycloheptatriene ([7]triene$N_3$); triazacyclooctatriene ([8]triene$N_3$); triazacyclononatriene ([9]trieneN$_3$); triazacyclodecatriene ([10]trieneN$_3$); triazacycloundecatriene ([11]trieneN$_3$); and triazacyclododecatriene ([12]trieneN$_3$).

N Valence Stabilizer #13c: Examples of four-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tetradentates) that meet the requirements for use as "wide band" valence stabilizers for $Co^{+3}$ include, but are not limited to: tetraazacyclooctane ([8]aneN$_4$); tetraazacyclononane ([9]aneN$_4$); tetraazacyclodecane ([10]aneN$_4$); tetraazacycloundecane ([11]aneN$_4$); tetraazacyclododecane ([12]aneN$_4$); tetraazacyclotridecane ([13]aneN$_4$); tetraazacyclotetradecane ([14]aneN$_4$); tetraazacyclopentadecane ([15]aneN$_4$); tetraazacyclohexadecane ([16]aneN$_4$); tetraazacycloheptadecane ([17]aneN$_4$); tetraazacyclooctadecane ([18]aneN$_4$); tetraazacyclononadecane ([19]aneN$_4$); tetraazacycloeicosane ([20]aneN$_4$); tetraazacyclooctadiene ([8]dieneN$_4$); tetraazacyclononadiene ([9]dieneN$_4$); tetraazacyclodecadiene ([10]dieneN$_4$); tetraazacycloundecadiene ([11]dieneN$_4$); tetraazacyclododecadiene ([12]dieneN$_4$); tetraazacyclotridecadiene ([13]dieneN$_4$); tetraazacyclotetradecadiene ([14]dieneN$_4$); tetraazacyclopentadecadiene ([15]dieneN$_4$); tetraazacyclohexadecadiene ([16]dieneN$_4$); tetraazacycloheptadecadiene ([17]dieneN$_4$); tetraazacyclooctadecadiene ([18]dieneN$_4$); tetraazacyclononadecadiene ([19]dieneN$_4$); tetraazacycloeicosadiene ([20]dieneN$_4$); tetraazacyclooctatetradiene ([8]tetradieneN$_4$); tetraazacyclononatetradiene ([9]tetradieneN$_4$); tetraazacyclodecatetradiene ([10]tetradieneN$_4$); tetraazacycloundecatetradiene ([11]tetradieneN$_4$); tetraazacyclododecatetradiene ([12]tetradieneN$_4$); tetraazacyclotridecatetradiene ([13]tetradieneN$_4$); tetraazacyclotetradecatetradiene ([14]tetradieneN$_4$); tetraazacyclopentadecatetradiene ([15]tetradieneN$_4$); tetraazacyclohexadecatetradiene ([16]tetradieneN$_4$); tetraazacycloheptadecatetradiene ([17]tetradieneN$_4$); tetraazacyclooctadecatetradiene ([18]tetradieneN$_4$); tetraazacyclononadecatetradiene ([19]tetradieneN$_4$); and tetraazacycloeicosatetradiene ([20]tetradieneN$_4$).

N Valence Stabilizer #13d: Examples of six-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates, N—N Tetradentates, or N—N Hexadentates) that meet the requirements for use as "wide band" valence stabilizers for $Co^{+3}$ include, but are not limited to: hexaazacyclododecane ([12]aneN$_6$); hexaazacyclotridecane ([13]aneN$_6$); hexaazacyclotetradecane ([14]aneN$_6$); hexaazacyclopentadecane ([15]aneN$_6$); hexaazacyclohexadecane ([16]aneN$_6$); hexaazacycloheptadecane ([17]aneN$_6$); hexaazacyclooctadecane ([18]aneN$_6$); hexaazacyclononadecane ([19]aneN$_6$); hexaazacycloeicosane ([20]aneN$_6$); hexaazacycloheneicosane ([21]aneN$_6$); hexaazacyclodocosane ([22]aneN$_6$); hexaazacyclotricosane ([23]aneN$_6$); hexaazacyclotetracosane ([24]aneN$_6$); hexaazacyclododecatriene ([12]trieneN$_6$); hexaazacyclotridecatriene ([13]trieneN$_6$); hexaazacyclotetradecatriene ([14]trieneN$_6$); hexaazacyclopentadecatriene ([15]trieneN$_6$); hexaazacyclohexadecatriene ([16]trieneN$_6$); hexaazacycloheptadecatriene ([17]trieneN$_6$); hexaazacyclooctadecatriene ([18]trieneN$_6$); hexaazacyclononadecatriene ([19]trieneN$_6$); hexaazacycloeicosatriene ([20]trieneN$_6$); hexaazacycloheneicosatriene ([21]trieneN$_6$); hexaazacyclodocosatriene ([22]trieneN$_6$); hexaazacyclotricosatriene ([23]trieneN$_6$); and hexaazacyclotetracosatriene ([24]trieneN$_6$).

N Valence Stabilizer #13e: Examples of eight-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates, N—N Tetradentates, or N—N Hexadentates) that meet the requirements for use as "wide band" valence stabilizers for $Co^{+3}$ include, but are not limited to: octaazacyclohexadecane ([16]aneN$_8$); octaazacycloheptadecane ([17]aneN$_8$); octaazacyclooctadecane ([18]aneN$_8$); octaazacyclononadecane ([19]aneN$_8$); octaazacycloeicosane ([20]aneN$_8$); octaazacycloheneicosane ([21]aneN$_8$); octaazacyclodocosane ([22]aneN$_8$); octaazacyclotricosane ([23]aneN$_8$); octaazacyclotetracosane ([24]aneN$_8$); octaazacyclohexadecatetradiene ([16]tetradieneN$_8$); octaazacycloheptadecatetradiene ([17]tetradieneN$_8$); octaazacyclooctadecatetradiene ([18]tetradieneN$_8$); octaazacyclononadecatetradiene ([19]tetradieneN$_8$); octaazacycloeicosatetradiene ([20]tetradieneN$_8$); octaazacycloheneicosatetradiene ([21]tetradieneN$_8$); octaazacyclodocosatetradiene ([22]tetradieneN$_8$); octaazacyclotricosatetradiene ([23]tetradieneN$_8$); and octaazacyclotetracosatetradiene ([24]tetradieneN$_8$).

N Valence Stabilizer #13f: Examples of ten-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates, N—N Tetradentates, or N—N Hexadentates) that meet the requirements for use as "wide band" valence stabilizers for $Co^{+3}$ include, but are not limited to: decaazacycloeicosane ([20]aneN$_{10}$); decaazacycloheneicosane ([21]aneN$_{10}$); decaazacyclodocosane ([22]aneN$_{10}$); decaazacyclotricosane ([23]aneN$_{10}$); decaazacyclotetracosane ([24]aneN$_{10}$); decaazacyclopentacosane ([25]aneN$_{10}$); decaazacyclohexacosane ([26]aneN$_{10}$); decaazacycloheptacosane ([27]aneN$_{10}$); decaazacyclooctacosane ([28]aneN$_{10}$); decaazacyclononacosane ([29]aneN$_{10}$); decaazacyclotriacontane ([30]aneN$_{10}$); decaazacycloeicosapentadiene ([20]pentadieneN$_{10}$); decaazacycloheneicosapentadiene ([21]pentadieneN$_{10}$); decaazacyclodocosapentadiene ([22]pentadieneN$_{10}$); decaazacyclotricosapentadiene ([23]pentadieneN$_{10}$); decaazacyclotetracosapentadiene ([24]pentadieneN$_{10}$); decaazacyclopentacosapentadiene ([25]pentadieneN$_{10}$); decaazacyclohexacosapentadiene ([26]pentadieneN$_{10}$); decaazacycloheptacosapentadiene ([27]pentadieneN$_{10}$); decaazacyclooctacosapentadiene ([28]pentadieneN$_{10}$); decaazacyclononacosapentadiene ([29]pentadieneN$_{10}$); and decaazacyclotriacontapentadiene ([30]pentadieneN$_{10}$).

N Valence Stabilizer #14a: Examples of four-membered macrocyclics, macrobicyclics, and macropolycyclics (including catapinands, cryptands, cyclidenes, and sepulchrates) wherein all four binding sites are composed of nitrogen and are contained in component 5-membered heterocyclic rings (N—N Tetradentates) that meet the requirements for use as "wide band" valence stabilizers for $Co^{+3}$ include, but are not limited to: porphyrins (including tetraphenylporphine (tpp); "picket fence" porphyrins, "picket tail" porphyrins, "bispocket" porphyrins, "capped" porphyrins, cyclophane porphyrins, "pagoda" porphyrins, "pocket" porphyrins, "pocket tail" porphyrins, cofacial diporphyrins, "strapped" porphyrins, "hanging base" porphyrins, bridged porphyrins, chelated mesoporphyrins, homoporphyrins, chlorophylls, and pheophytins); porphodimethanes; porphyrinogens; chlorins; bacteriochlorins; isobacteriochlorins; corroles; corrins and corrinoids; didehydrocorrins; tetradehydrocorrins; hexadehydrocorrins; octadehydrocorrins; tetraoxazoles; tetraisooxazoles; tetrathiazoles; tetraisothiazoles; tetraazaphospholes; tetraimidazoles; tetrapyrazoles; tetraoxadiazoles; tetrathiadiazoles; tetradiazaphospholes; tetratriazoles; tetraoxatriazoles; tetrathiatriazoles; coproporphyrin; etioporphyrin; and hematoporphyrin.

N Valence Stabilizer #14b: Examples of six-membered macrocyclics, macrobicyclics, and macropolycyclics (including catapinands, cryptands, cyclidenes, and sepulchrates) wherein all six binding sites are composed of nitrogen and are contained in component 5-membered heterocyclic rings (N—N Tridentates, N—N Tetradentates, or N—N Hexadentates) that meet the requirements for use as "wide band" valence stabilizers for $Co^{+3}$ include, but are not limited to: hexaphyrins (hexapyrroles); hexaoxazoles; hexaisooxazoles; hexathiazoles; hexaisothiazoles; hexaazaphospholes; hexaimidazoles; hexapyrazoles; hexaoxadiazoles; hexathiadiazoles; hexadiazaphospholes; hexatriazoles; hexaoxatriazoles; and hexathiatriazoles.

N Valence Stabilizer #14c: Examples of eight-membered macrocyclics, macrobicyclics, and macropolycyclics (including catapinands, cryptands, cyclidenes, and sepulchrates) wherein all eight binding sites are composed of nitrogen and are contained in component 5-membered heterocyclic rings (N—N Tridentates, N—N Tetradentates, or N—N Hexadentates) that meet the requirements for use as "wide band" valence stabilizers for $Co^{+3}$ include, but are not limited to: octaphyrins (octapyrroles); octaoxazoles; octaisooxazoles; octathiazoles; octaisothiazoles; octaazaphospholes; octaimidazoles; octapyrazoles; octaoxadiazoles; octathiadiazoles; octadiazaphospholes; octatriazoles; octaoxatriazoles; and octathiatriazoles.

N Valence Stabilizer #14d: Examples of ten-membered macrocyclics, macrobicyclics, and macropolycyclics (including catapinands, cryptands, cyclidenes, and sepulchrates) wherein all ten binding sites are composed of nitrogen and are contained in component 5-membered heterocyclic rings (N—N Tridentates, N—N Tetradentates, or N—N Hexadentates) that meet the requirements for use as "wide band" valence stabilizers for $Co^{+3}$ include, but are not limited to: decaphyrins (decapyrroles); decaoxazoles; decaisooxazoles; decathiazoles; decaisothiazoles; decaazaphospholes; decaimidazoles; decapyrazoles; decaoxadiazoles; decathiadiazoles; decadiazaphospholes; decatriazoles; decaoxatriazoles; and decathiatriazoles.

N Valence Stabilizer #15a: Examples of four-membered macrocyclics, macrobicyclics, and macropolycyclics (including catapinands, cryptands, cyclidenes, and sepulchrates) wherein all four binding sites are composed of nitrogen and are contained in a combination of 5-membered heterocyclic rings and amine or imine groups (N—N Tetradentates) that meet the requirements for use as "wide band" valence stabilizers for $Co^{+3}$ include, but are not limited to: porphyrazines; octahydrodiazaporphyrins; phthalocyanines; naphthalocyanines; anthracocyanines; and tetraazaporphyrins N Valence Stabilizer #15b: Examples of six-membered macrocyclics, macrobicyclics, and macropolycyclics (including catapinands, cryptands, cyclidenes, and sepulchrates) wherein all six binding sites are composed of nitrogen and are contained in a combination of 5-membered heterocyclic rings and amine or imine groups (N—N Tridentates, N—N Tetradentates, or N—N Hexadentates) that meet the requirements for use as "wide band" valence stabilizers for $Co^{+3}$ include, but are not limited to: diazahexaphyrins; tetraazahexaphyrins; hexaazahexaphyrins; diazahexapyrazoles; tetraazahexapyrazoles; hexaazahexapyrazoles; diazahexaimidazoles; tetraazahexaimidazoles; and hexaazahexaimidazoles.

N Valence Stabilizer #15c: Examples of eight-membered macrocyclics, macrobicyclics, and macropolycyclics (including catapinands, cryptands, cyclidenes, and sepulchrates) wherein all eight binding sites are composed of nitrogen and are contained in a combination of 5-membered heterocyclic rings and amine or imine groups (N—N Tridentates, N—N Tetradentates, or N—N Hexadentates) that meet the requirements for use as "wide band" valence stabilizers for $Co^{+3}$ include, but are not limited to: diazaoctaphyrins; tetraazaoctaphyrins; hexaazaoctaphyrins; octaazaoctaphyrins; diazaoctapyrazoles; tetraazaoctapyrazoles; hexaazaoctapyrazoles; octaazaoctapyrazoles; diazaoctaimidazoles; tetraazaoctaimidazoles; hexaazaoctaimidazoles; and octaazaoctaimidazoles.

N Valence Stabilizer #15d: Examples of ten-membered macrocyclics, macrobicyclics, and macropolycyclics (including catapinands, cryptands, cyclidenes, and sepulchrates) wherein all ten binding sites are composed of nitrogen and are contained in a combination of 5-membered heterocyclic rings and amine or imine groups (N—N Tridentates, N—N Tetradentates, or N—N Hexadentates) that meet the requirements for use as "wide band" valence stabilizers for $Co^{+3}$ include, but are not limited to: diazadecaphyrins; tetraazadecaphyrins; hexaazadecaphyrins; octaazadecaphyrins; decaazadecaphyrins; diazadecapyrazoles; tetraazadecapyrazoles; hexaazadecapyrazoles; octaazadecapyrazoles; decaazadecapyrazoles; diazadecaimidazoles; tetraazadecaimidazoles; hexaazadecaimidazoles; octaazadecaimidazoles; and decaazadecaimidazoles.

N Valence Stabilizer #16a: Examples of four-membered macrocyclics, macrobicyclics, and macropolycyclics (including catapinands, cryptands, cyclidenes, and sepulchrates) wherein all four binding sites are composed of nitrogen and are contained in component 6-membered heterocyclic rings (N—N Tetradentates) that meet the requirements for use as "wide band" valence stabilizers for $Co^{+3}$ include, but are not limited to: cyclotetrapyridines; cyclotetraoxazines; cyclotetrathiazines; cyclotetraphosphorins; cyclotetraquinolines; cyclotetrapyrazines; cyclotetrapyridazines; cyclotetrapyrimidines; cyclotetraoxadiazines; cyclotetrathiadiazines; cyclotetradiazaphosphorins; cyclotetraquinoxalines; cyclotetratriazines; cyclotetrathiatriazines; and cyclotetraoxatriazines.

N Valence Stabilizer #16b: Examples of six-membered macrocyclics, macrobicyclics, and macropolycyclics (including catapinands, cryptands, cyclidenes, and sepulchrates) wherein all six binding sites are composed of nitrogen and are contained in component 6-membered heterocyclic rings (N—N Tridentates, N—N Tetradentates, or N—N Hexadentates) that meet the requirements for use as "wide band" valence stabilizers for $Co^{+3}$ include, but are not limited to: cyclosexipyridines; cyclosexioxazines; cyclosexithiazines; cyclosexiphosphorins; cyclosexiquinolines; cyclosexipyrazines; cyclosexipyridazines; cyclosexipyrimidines; cyclosexioxadiazines; cyclosexithiadiazines; cyclosexidiazaphosphorins cyclosexiquinoxalines; cyclosexitriazines; cyclosexithiatriazines; and cyclosexioxatriazines.

N Valence Stabilizer #16c: Examples of eight-membered macrocyclics, macrobicyclics, and macropolycyclics (including catapinands, cryptands, cyclidenes, and sepulchrates) wherein all six binding sites are composed of nitrogen and are contained in component 6-membered heterocyclic rings (N—N Tridentates, N—N Tetradentates, or N—N Hexadentates) that meet the requirements for use as "wide band" valence stabilizers for $Co^{+3}$ include, but are not limited to: cyclooctapyridines; cyclooctaoxazines; cyclooctathiazines; cyclooctaphosphorins; cyclooctaquinolines; cyclooctapyrazines; cyclooctapyridazines; cyclooctapyrimidines; cyclooctaoxadiazines; cyclooctathiadiazines; cyclooctadiazaphosphorins; cyclooctaquinoxalines; cyclooctatriazines; cyclooctathiatriazines; and cyclooctaoxatriazines.

N Valence Stabilizer #16d: Examples of ten-membered macrocyclics, macrobicyclics, and macropolycyclics (including catapinands, cryptands, cyclidenes, and sepulchrates) wherein all six binding sites are composed of nitrogen and are contained in component 6-membered heterocyclic rings (N—N Tridentates, N—N Tetradentates, or N—N Hexadentates) that meet the requirements for use as "wide band" valence stabilizers for $Co^{+3}$ include, but are not limited to: cyclodecapyridines; cyclodecaoxazines; cyclodecathiazines; cyclodecaphosphorins; cyclodecaquinolines; cyclodecapyrazines; cyclodecapyridazines; cyclodecapyrimidines; cyclodecaoxadiazines; cyclodecathiadiazines; cyclodecadiazaphosphorins; cyclodecaquinoxalines; cyclodecatriazines; cyclodecathiatriazines; and cyclodecaoxatriazines.

N Valence Stabilizer #17a: Examples of four-membered macrocyclics, macrobicyclics, and macropolycyclics (including catapinands, cryptands, cyclidenes, and sepulchrates) wherein all four binding sites are composed of nitrogen and are contained in a combination of 6-membered heterocyclic rings and amine or imine groups (N—N Tetradentates) that meet the requirements for use as "wide band" valence stabilizers for $Co^{+3}$ include, but are not limited to: diazacyclotetrapyridines; tetraazacyclotetrapyridines; diazacyclotetraquinolines; tetraazacyclotetraquinolines; diazacyclotetrapyrazines; tetraazacyclotetrapyrazines; diazacyclotetrapyridazines; tetraazacyclotetrapyridazines; diazacyclotetrapyrimidines; tetraazacyclotetrapyrimidines; diazacyclotetratriazines; and tetraazacyclotetratriazines.

N Valence Stabilizer #17b: Examples of six-membered macrocyclics, macrobicyclics, and macropolycyclics (including catapinands, cryptands, cyclidenes, and sepulchrates) wherein all six binding sites are composed of nitrogen and are contained in a combination of 6-membered heterocyclic rings and amine or imine groups (N—N Tridentates, N—N Tetradentates, or N—N Hexadentates) that meet the requirements for use as "wide band" valence stabilizers for $Co^{+3}$ include, but are not limited to: diazacyclosexipyridines; triazacyclosexipyridines; diazacyclosexiquinolines; triazacyclosexiquinolines; diazacyclosexipyrazines; triazacyclosexipyrazines; diazacyclosexipyridazines; triazacyclosexipyridazines; diazacyclosexipyrimidines; triazacyclosexipyrimidines; diazacyclosexitriazines; and triazacyclosexitriazines.

N Valence Stabilizer #17c: Examples of eight-membered macrocyclics, macrobicyclics, and macropolycyclics (including catapinands, cryptands, cyclidenes, and sepulchrates) wherein all eight binding sites are composed of nitrogen and are contained in a combination of 6-membered heterocyclic rings and amine or imine groups (N—N Tridentates, N—N Tetradentates, or N—N Hexadentates) that meet the requirements for use as "wide band" valence stabilizers for $Co^{+3}$ include, but are not limited to: diazacyclooctapyridines; tetraazacyclooctapyridines; diazacyclooctaquinolines; tetraazacyclooctaquinolines; diazacyclooctapyrazines; tetraazacyclooctapyrazines; diazacyclooctapyridazines; tetraazacyclooctapyridazines; diazacyclooctapyrimidines; tetraazacyclooctapyrimidines; diazacyclooctatriazines; and tetraazacyclooctatriazines.

N Valence Stabilizer #17d: Examples of ten-membered macrocyclics, macrobicyclics, and macropolycyclics (including catapinands, cryptands, cyclidenes, and sepulchrates) wherein all ten binding sites are composed of nitrogen and are contained in a combination of 6-membered heterocyclic rings and amine or imine groups (N—N Tridentates, N—N Tetradentates, or N—N Hexadentates) that meet the requirements for use as "wide band" valence stabilizers for $Co^{+3}$ include, but are not limited to: diazacyclodecapyridines; pentaazacyclodecapyridines; diazacyclodecaquinolines; pentaazacyclodecaquinolines; diazacyclodecapyrazines; pentaazacyclodecapyrazines; diazacyclodecapyridazines; pentaazacyclodecapyridazines; diazacyclodecapyrimidines; pentaazacyclodecapyrimidines; diazacyclodecatriazines; and pentaazacyclodecatriazines.

N Valence Stabilizer #18: Examples of amidines and diamidines (N—N bidentates or N—N Tetradentates) that meet the requirements for use as "wide band" valence stabilizers for $Co^{+3}$ include, but are not limited to: N,N'-dimethylformamidine; N,N'-diethylformamidine; N,N'-diisopropylformamidine; N,N'-dibutylformamidine; N,N'-diphenylformamidine; N,N'-dibenzylformamidine; N,N'-dinaphthylformamidine; N,N'-dicyclohexylformamidine; N,N'-dinorbornylformamidine; N,N'-diadamantylformamidine; N,N'-dianthraquinonylformamidine; N,N'-dimethylacetamidine; N,N'-diethylacetamidine; N,N'-diisopropylacetamidine; N,N'-dibutylacetamidine; N,N'-diphenylacetamidine; N,N'-dibenzylacetamidine; N,N'-dinaphthylacetamidine; N,N'-dicyclohexylacetamidine; N,N'-dinorbornylacetamidine; N,N'-diadamantylacetamidine; N,N'-dimethylbenzamidine; N,N'-diethylbenzamidine; N,N'-diisopropylbenzamidine; N,N'-dibutylbenzamidine; N,N'-diphenylbenzamidine; N,N'-dibenzylbenzamidine; N,N'-dinaphthylbenzamidine; N,N'-dicyclohexylbenzamidine; N,N'-dinorbornylbenzamidine; N,N'-diadamantylbenzamidine; N,N'-dimethyltoluamidine; N,N'-diethyltoluamidine; N,N'-diisopropyltoluamidine; N,N'-dibutyltoluamidine; N,N'-diphenyltoluamidine; N,N'-dibenzyltoluamidine; N,N'-dinaphthyltoluamidine; N,N'-dicyclohexyltoluamidine; N,N'-dinorbornyltoluamidine; N,N'-diadamantyltoluamidine; oxalic diamidine; malonic diamidine; succinic diamidine; glutaric diamidine; adipic diamidine; pimelic diamidine; suberic diamidine; phthalic diamidine; terephthalic diamidine; isophthalic diamidine; piperazine diamidine; 2-iminopyrrolidine; 2-iminopiperidine; amidinobenzamide; benzamidine; chloroazodin; and debrisoquin.

N Valence Stabilizer #19: Examples ofbiguamides (imidodicarbonimidic diamides), biguanidines, imidotricarbonimidic diamides, imidotetracarbonimidic diamides, dibiguamides, bis(biguanidines), polybiguamides, and poly(biguanidines) (N—N bidentates, N—N tridentates, N—N tetradentates, and N—N hexadentates) that meet the requirements for use as "wide band" valence stabilizers for $Co^{+3}$ include, but are not limited to: biguamide (bigH); biguanidine, methylbiguamide; ethylbiguamide; isopropylbiguamide; butylbiguamide; benzylbiguamide; phenylbiguamide; tolylbiguamide; naphthylbiguamide; cyclohexylbiguamide; norbornylbiguamide; adamantylbiguamide; dimethylbiguamide; diethylbiguamide; diisopropylbiguamide; dibutylbiguamide; dibenzylbiguamide; diphenylbiguamide; ditolylbiguamide; dinaphthylbiguamide; dicyclohexylbiguamide; dinorbornylbiguamide; diadamantylbiguamide; ethylenedibiguamide; propylenedibiguamide; tetramethylenedibiguamide; pentamethylenedibiguamide; hexamethylenedibiguamide; heptamethylenedibiguamide; octamethylenedibiguamide; phenylenedibiguamide; piperazinedibiguamide; oxalyldibiguamide; malonyldibiguamide; succinyldibiguamide; glutaryldibiguamide; adipyldibiguamide; pimelyldibiguamide; suberyldibiguamide; phthalyldibiguamide; paludrine; polyhexamethylene biguamide; 2-guanidinothiazole; 2-guanidinooxazole; 2-guanidinoimidazole; 3-guanidinopyrazole; 3-guanidino-1,2,4-triazole; 5-guanidinotetrazole; alexidine; buformin; and moroxydine.

N Valence Stabilizer #20: Examples of diamidinomethanes, bis(diamidinomethanes), and poly(diamidinomethanes) (N—N bidentates, N—N tridentates, N—N tetradentates, and N—N hexadentates) that meet the requirements for use as "wide band" valence stabilizers for $Co^{+3}$ include, but are not limited to: diamidinomethane; N-methyldiamidinomethane; N-ethyldiamidinomethane; N-isopropyldiamidinomethane; N-butyldiamidinomethane; N-benzyldiamidinomethane; N-phenyldiamidinomethane; N-tolyldiamidinomethane; N-naphthyldiamidinomethane; N-cyclohexyldiamidinomethane; N-norbornyldiamidinomethane; N-adamantyldiamidinomethane; dimethyldiamidinomethane; diethyldiamidinomethane; diisopropyldiamidinomethane; dibutyldiamidinomethane; dibenzyldiamidinomethane; diphenyldiamidinomethane; ditolyldiamidinomethane; dinaphthyldiamidinomethane; dicyclohexyldiamidinomethane; dinorbornyldiamidinomethane; diadamantyldiamidinomethane; ethylenebisdiamidinomethane; propylenebisdiamidinomethane; tetramethylenebisdiamidinomethane; pentamethylenebisdiamidinomethane; hexamethylenebisdiamidinomethane; heptamethylenebisdiamidinomethane; octamethylenebisdiamidinomethane; phenylenebisdiamidinomethane; piperazinebisdiamidinomethane; oxalylbisdiamidinomethane; malonylbisdiamidinomethane; succinylbisdiamidinomethane; glutarylbisdiamidinomethane; phthalylbisdiamidinomethane; 2-amidinomethylthiazole; 2-amidinomethyloxazole; 2-amidinomethylimidazole; 3-amidinomethylpyrazole; 3-amidinomethyl-1,2,4-triazole; and 5-amidinomethyltetrazole.

N Valence Stabilizer #21: Examples of imidoylguanidines, amidinoguanidines, bis(imidoylguanidines), bis(amidinoguanidines), poly(imidoylguanidines), and poly(amidinoguanidines) (N—N bidentates, N—N tridentates, N—N tetradentates, and N—N hexadentates) that meet the requirements for use as "wide band" valence stabilizers for $Co^{+3}$ include, but are not limited to: acetimidoylguanidine; amidinoguanidine, benzimidoylguanidine; cyclohexylimidoylguanidine; pentafluorobenzimidoylguanidine; 2-N-imidoylaminothiazole; 2-N-imidoylaminooxazole; 2-N-imidoylaminoimidazole; 3-N-imidoylaminopyrazole; 3-N-imidoylamino-1,2,4-triazole; and 5-N-imidoylaminotetrazole.

N Valence Stabilizer #22: Examples of diformamidine oxides (dicarbonimidic diamides), tricarbonimidic diamides, tetracarbonimidic diamides, bis(diformamidine oxides), and poly(diformamidine oxides) (N—N bidentates, N—N tridentates, or N—N tetradentates) that meet the requirements for use as "wide band" valence stabilizers for $Co^{+3}$ include, but are not limited to: diformamidine oxide; methyldiformamidine oxide; ethyldiformamidine oxide; isopropyldiformamidine oxide; butyldiformamidine oxide; benzyldiformamidine oxide; phenyldiformamidine oxide; tolyldiformamidine oxide; naphthyldiformamidine oxide; cyclohexyldiformamidine oxide; norbornyldiformamidine oxide; adamantyldiformamidine oxide; dimethyldiformamidine oxide; diethyldiformamidine oxide; diisopropyldiformamidine oxide; dibutyldiformamidine oxide; dibenzyldiformamidine oxide; diphenyldiformamidine oxide; ditolyldiformamidine oxide; dinaphthyldiformamidine oxide; dicyclohexyldiformamidine oxide; dinorbornyldiformamidine oxide; diadamantyldiformamidine oxide; 2-O-amidinohydroxythiazole; 2-O-amidinohydroxyoxazole; 2-O-amidinohydroxyimidazole; 3-O-amidinohydroxypyrazole; 3-O-amidinohydroxy-1,2,4-triazole; and 5-O-amidinohydroxytetrazole.

N Valence Stabilizer #23: Examples of diformamidine sulfides (thiodicarbonimidic diamides), thiotricarbonimidic diamides, thiotetracarbonimidic diamides, bis(diformamidine sulfides), and poly(diformamidine sulfides) (N—N bidentates, N—N tridentates, or N—N tetradentates) that meet the requirements for use as "wide band" valence stabilizers for $Co^{+3}$ include, but are not limited to: diformamidine sulfide; methyldiformamidine sulfide; ethyldiformamidine sulfide; isopropyldiformamidine sulfide; butyldiformamidine sulfide; benzyldiformamidine sulfide; phenyldiformamidine sulfide; tolyldiformamidine sulfide; naphthyldiformamidine sulfide; cyclohexyldiformamidine sulfide; norbornyldiformamidine sulfide; adamantyldiformamidine sulfide; dimethyldiformamidine sulfide; diethyldiformamidine sulfide; diisopropyldiformamidine sulfide; dibutyldiformamidine sulfide; dibenzyldiformamidine sulfide; diphenyldiformamidine sulfide; ditolyldiformamidine sulfide; dinaphthyldiformamidine sulfide; dicyclohexyldiformamidine sulfide; dinorbornyldiformamidine sulfide; diadamantyldiformamidine sulfide; phenylthiobisformamidine; 2-S-amidinomercaptothiazole; 2-S-amidinomercaptooxazole; 2-S-amidinomercaptoimidazole; 3-S-amidinomercaptopyrazole; 3-S-amidinomercapto-1,2,4-triazole; and 5-S-amidinomercaptotetrazole.

N Valence Stabilizer #24: Examples of imidodicarbonimidic acids, diimidodicarbonimidic acids, imidotricarbonimidic acids, imidotetracarbonimidic acids, and derivatives thereof (N—N Bidentates, N—N Tridentates, N—N Tetradentates, and N—N Hexadentates) that meet the requirements for use as "wide band" valence stabilizers for $Co^{+3}$ include, but are not limited to: imidodicarbonimidic acid, diimidodicarbonimidic acid, imidotricarbonimidic acid, imidotetracarbonimidic acid; O-methylimidodicarbonimidic acid; O-ethylimidodicarbonimidic acid; O-isopropylimidodicarbonimidic acid; O-phenylimidodicarbonimidic acid; O-benzylimidodicarbonimidic acid; O-cyclohexylimidodicarbonimidic acid; O-naphthylimidodicarbonimidic acid; O-norbornylimidodicarbonimidic acid; O-adamantylimidodicarbonimidic acid; O,O'-dimethylimidodicarbonimidic acid; O,O'-diethylimidodicarbonimidic acid; O,O'-diisopropylimidodicarbonimidic acid; O,O'-diphenylimidodicarbonimidic acid; O,O'-dibenzylimidodicarbonimidic acid; O,O'-dicyclohexylimidodicarbonimidic acid; O,O'-dinaphthylimidodicarbonimidic acid; O,O'-dinorbornylimidodicarbonimidic acid; and O,O'-diadamantylimidodicarbonimidic acid.

N Valence Stabilizer #25: Examples ofthioimidodicarbonimidic acids, thiodiimidodicarbonimidic acids, thioimidotricarbonimidic acids, thioimidotetracarbonimidic acids, and derivatives thereof (N—N Bidentates, N—N Tridentates, N—N Tetradentates, and N—N Hexadentates) that meet the requirements for use as "wide band" valence stabilizers for $Co^{+3}$ include, but are not limited to: thioimidodicarbonimidic acid, thiodiimidodicarbonimidic acid, thioimidotricarbonimidic acid, thioimidotetracarbonimidic acid; O-methylthioimidodicarbonimidic acid; O-ethylthioimidodicarbonimidic acid; O-isopropylthioimidodicarbonimidic acid; O-phenylthioimidodicarbonimidic acid; O-benzylthioimidodicarbonimidic acid; O-cyclohexylthioimidodicarbonimidic acid; O-naphthylthioimidodicarbonimidic acid; O-norbornylthioimidodicarbonimidic acid; O-adamantylthioimidodicarbonimidic acid; O,O'-dimethylthioimidodicarbonimidic acid; O,O'-diethylthioimidodicarbonimidic acid; O,O'-diisopropylthioimidodicarbonimidic acid; O,O'-diphenylthioimidodicarbonimidic acid; O,O'-dibenzylthioimidodicarbonimidic acid; O,O'-dicyclohexylthioimidodicarbonimidic acid; O,O'-dinaphthylthioimidodicarbonimidic acid; O,O'-dinorbornylthioimidodicarbonimidic acid; and O,O'-diadamantylthioimidodicarbonimidic acid.

N Valence Stabilizer #26: Examples of diumidoylimines, diimidoylhydrazides, bis(diimidoylimines), bis(diimidoylhydrazides), poly(diimidoylimines), and poly(diimidoylhydrazides) (N—N Tridentates and N—N Hexadentates) that meet the requirements for use as "wide band" valence stabilizers for $Co^{+3}$ include, but are not limited to: diacetimidoylimine; dibenzimidoylimine; and dicyclohexylimidoylimine.

N Valence Stabilizer #27: Examples ofimidosulfamides, diimidosulfamides, bis(imidosulfamides), bis(diimidosulfamides), poly(imidosulfamides), and poly(diimidosulfamides) (N—N Bidentates, N—N Tridentates, N—N Tetradentates, and N—N Hexadentates) that meet the requirements for use as "wide band" valence stabilizers for $Co^{+3}$ include, but are not limited to: imidosulfamidic acid, duimidosulfamidic acid; O-phenylimidosulfamide; O-benzylimidosulfamide; N-phenylimidosulfamide; N-benzylimidosulfamide; O-phenyldiimidosulfamide; O-benzyldiimidosulfamide; N-phenyldiimidosulfamide; and N-benzyldiimidosulfamide.

N Valence Stabilizer #28: Examples of phosphoramidimidic triamides, bis(phosphoramidimidic triamides), and poly (phosphoramidimidic triamides) and derivatives thereof (N—N Bidentates, N—N Tridentates, N—N Tetradentates, and N—N Hexadentates) that meet the requirements for use as "wide band" valence stabilizers for $Co^{+3}$ include, but are not limited to: phosphoramidimidic triamide; N-phenylphosphoramidimidic triamide; N-benzylphosphoramidimidic triamide; N-naphthylphosphoramidimidic triamide; N-cyclohexylphosphoramidimidic triamide; N-norbornylphosphoramidimidic triamide; N,N'-diphenylphosphoramidimidic triamide; N,N'-dibenzylphosphoramidimidic triamide; N,N'-dinaphthylphosphoramidimidic triamide; N,N'-dicyclohexylphosphoramidimidic triamide; and N,N'-dinorbornylphosphoramidimidic triamide.

N Valence Stabilizer #29: Examples of phosphoramidimidic acid, phosphorodiamidimidic acid, bis(phosphoramidimidic acid), bis(phosphorodiamidimidic acid), poly(phosphoramidimidic acid), poly(phosphorodiamidimidic acid), and derivatives thereof (N—N Bidentates, N—N Tridentates, N—N Tetradentates, and N—N Hexadentates) that meet the requirements for use as "wide band" valence stabilizers for $Co^{+3}$ include, but are not limited to: phosphoramidimidic acid, phosphorodiamidimidic acid, O-phenylphosphoramidimidic acid; O-benzylphosphoramidimidic acid; O-naphthylphosphoramidimidic acid; O-cyclohexylphosphoramidimidic acid; O-norbornylphosphoramidimidic acid; O,O'-diphenylphosphoramidimidic acid; O,O'-dibenzylphosphoramidimidic acid; O,O'-dinaphthylphosphoramidimidic acid; O,O'-dicyclohexylphosphoramidimidic acid; and O,O'-dinorbornylphosphoramidimidic acid.

N Valence Stabilizer #30: Examples of phosphoramidimidodithioic acid, phosphorodiamidimidothioic acid, bis(phosphoramidimidodithioic acid), bis(phosphorodiamidimidothioic acid), poly(phosphoramidimidodithioic acid), poly (phosphorodiamidimidothioic acid), and derivatives thereof (N—N Bidentates, N—N Tridentates, N—N Tetradentates, and N—N Hexadentates) that meet the requirements for use as "wide band" valence stabilizers for $Co^{+3}$ include, but are not limited to: phosphoramidimidodithioic acid, phosphorodiamidimidothioic acid, S-phenylphosphoramidimidodithioic acid; S-benzylphosphoramidimidodithoic acid; S-naphthylphosphoramidimidodithioic acid; S-cyclohexylphosphoramidimidodithioic acid; S-norbornylphosphoramidimidodithioic acid; S,S'-diphenylphosphoramidimidodithioic acid; S,S'-dibenzylphosphoramidimidodithioic acid; S,S'-dinaphthylphosphoramidimidodithioic acid; S,S'-dicyclohexylphosphoramidimidodithioic acid; and S,S'-dinorbornylphosphoramidimidodithioic acid.

N Valence Stabilizer #31: Examples of azo compounds with amino, imino, oximo, diazeno, or hydrazido substitution at the ortho- (for aryl) or alpha- or beta- (for alkyl) positions, bis[o-($H_2N$—) or alpha- or beta-($H_2N$—)azo compounds], or poly[o-($H_2N$—) or alpha- or beta-($H_2N$—)azo compounds) (N—N Bidentates, N—N Tridentates, N—N Tetradentates, or N—N Hexadentates) that meet the requirements for use as "wide band" valence stabilizers for $Co^{+3}$ include, but are not limited to: o-aminoazobenzene; o,o'-diaminoazobenzene; (2-pyridine)azobenzene; 1-phenylazo-2-naphthylamine; pyridineazo-2-naphthol (PAN); pyridineazoresorcinol (PAR); o-hydroxy-o'-(beta-aminoethylamino) azobenzene; Benzopurpurin 4B; Congo Red; Fat Brown RR; benzopurpurin; Congo Red; Direct Red 75; Mordant Brown 48; Nitro Red; 2-imidazolylazobenzene; 2-benzimidazolylazobenzene; 3-pyrazolylazobenzene; 3-(1,2,4-triazolyl) azobenzene; 2-pyridylazobenzene; 2-pyrazinylazobenzene; and 2-pyrimidinylazobenzene.

N Valence Stabilizer #32: Examples of diazeneformimidamides (diazeneamidines), diazeneacetimidamides (diazene-alpha-amidinoalkanes(alkenes)), bis(diazeneformimidamides), bis(diazeneacetimidamides), poly (diazeneformimidamides), and poly (diazeneacetimidamides) (N—N Bidentates, N—N Tetradentates, and N—N Hexadentates) that meet the requirements for use as "wide band" valence stabilizers for $Co^{+3}$ include, but are not limited to: diazeneformimidamide (diazeneamidine); diazeneacetimidamide (diazene-alpha-amidinomethane); phenyldiazeneformimidamide; triphenyldiazeneformimidamide; phenyldiazeneacetimidamide; and triphenyldiazeneacetimidamide.

N Valence Stabilizer #33: Examples of diazeneformimidic acid, diazeneacetimidic acid, bis(diazeneformimidic acid), bis(diazeneacetimidic acid), poly(diazeneformimidic acid), poly(diazeneacetimidic acid), and derivatives thereof(N—N Bidentates, N—N Tetradentates, and N—N Hexadentates) that meet the requirements for use as "wide band" valence stabilizers for $Co^{+3}$ include, but are not limited to: diazeneformimidic acid, diazeneacetimidic acid, phenyldiazeneformimidic acid, diphenyldiazeneformimidic acid, phenyldiazeneacetimidic acid, and diphenyldiazeneacetimidic acid.

N Valence Stabilizer #34: Examples of diazeneformimidothioic acid, diazeneacetimidothioic acid, bis(diazeneformimidothioic acid), bis(diazeneacetimidothioic acid), poly(diazeneformimidothioic acid), poly(diazeneacetimidothioic acid), and derivatives thereof (N—N Bidentates, N—N Tetradentates, and N—N Hexadentates) that meet the requirements for use as "wide band" valence stabilizers for $Co^{+3}$ include, but are not limited to: diazeneformimidothioic acid, diazeneacetimidothioic acid, phenyldiazeneformimidothioic acid, diphenyldiazeneformimidoihioic acid, phenyldiazeneacetimidothioic acid, and diphenyldiazeneacetimidothioic acid.

N Valence Stabilizer #35: Examples of imidoyldiazenes, bis(imidoyldiazenes), and poly(imidoyldiazenes), (N—N Tridentates and N—N Hexadentates) that meet the requirements for use as "wide band" valence stabilizers for $Co^{3}$ include, but are not limited to: acetimidoyldiazene; benzimidoyldiazene; and cyclohexylimidoyldiazene.

N Valence Stabilizer #36: Examples of diazenediformimidamides (1,2-diazenediamidines), diazenediacetimidamides (1,2-diazene-di-alpha-amidinoalkanes(alkenes)), bis(diazenediformimidamides), bis(diazenediacetimidamides), poly (diazenediformimidamides), and poly(diazenediacetimidamides) (N—N Tridentates and N—N Hexadentates) that meet the requirements for use as "wide band" valence stabilizers for $Co^{+3}$ include, but are not limited to: diazenediformimidamide (1,2-diazenediamidine), diazenediacetimidamide (1,2-diazene-di-alpha-amidinomethane); diphenyldiazenediformimidamide; tetraphenyldiazenediformimidamide; diphenyldiazenediacetimidamide; and tetraphenyldiazenediacetimidamide.

N Valence Stabilizer #37: Examples of diazenediformimidic acid, diazenediacetimidic acid, bis(diazenediformimidic acid), bis(diazenediacetimidic acid), poly(diazenediformimidic acid), and poly(diazenediacetimidic acid), and derivatives thereof (N—N Tridentates and N—N Hexadentates) that meet the requirements for use as "wide band" valence stabilizers for $Co^{+3}$ include, but are not limited to: diazenediformimidic acid, diazenediacetimidic acid, diphenyldiazenediformimidic acid, and diphenyldiazenediacetimidic acid.

N Valence Stabilizer #38: Examples of diazenediformimidothioic acid, diazenediacetimidothioic acid, bis(diazenediformimidothioic acid), bis(diazenediacetimidothioic acid), poly(diazenediformimidothioic acid), and poly(diazenediacetimidothioic acid), and derivatives thereof(N—N Tridentates and N—N Hexadentates) that meet the requirements for use as "wide band" valence stabilizers for $Co^{+3}$ include, but are not limited to: diazenediformimidothioic acid, diazenediacetimidothioic acid, diphenyldiazenediformimidothioic acid, and diphenyldiazenediacetimidothioic acid.

N Valence Stabilizer #39: Examples of diimidoyldiazenes, bis(diimidoyldiazenes), and poly(diimidoyldiazenes), (N—N Tridentates and N—N Hexadentates) that meet the requirements for use as "wide band" valence stabilizers for $Co^{+3}$ include, but are not limited to: diacetimidoyldiazene; dibenzimidoyldiazene; and dicyclohexylimidoyldiazene.

N Valence Stabilizer #40: Examples of ortho-amino (or -hydrazido) substituted formazans, bis(o-amino or -hydrazido substituted formazans), and poly(o-amino or -hydrazido substituted formazans) (N—N Bidentates, N—N Tridentates, N—N Tetradentates, and N—N Hexadentates) that meet the requirements for use as "wide band" valence stabilizers for $Co^{+3}$ include, but are not limited to: 1-(2-aminophenyl)-3,5-diphenylformazan; and 1,5-bis(2-aminophenyl)-3-phenylformazan.

N Valence Stabilizer #41: Examples of ortho-amino (or -hydrazido) substituted azines (including ketazines), bis(o-amino or hydrazido substituted azines), and poly(o-amino or hydrazido substituted azines) (N—N Bidentates, N—N Tridentates, N—N Tetradentates, and N—N Hexadentates) that meet the requirements for use as "wide band" valence stabilizers for $Co^{+3}$ include, but are not limited to: 2-amino-1-benzalazine; 2-amino-1-naphthalazine; and 2-amino-1-cyclohexanonazine.

N Valence Stabilizer #42: Examples of Schiff Bases with one Imine (C═N) Group and with ortho- or alpha- or beta-amino or imino or oximo or diazeno or hydrazido substitution (N—N Bidentates, N—N Tridentates, N—N Tetradentates, N—N Pentadentates, or N—N Hexadentates) that meet the requirements for use as "wide band" valence stabilizers for $Co^{+3}$ include, but are not limited to: N-(2-Aminobenzaldehydo)isopropylamine; N-(2-Pyridinecarboxaldehydo)isopropylamine; N-(2-Pyrrolecarboxaldehydo)isopropylamine; N-(2-Acetylpyridino) isopropylamine; N-(2-Acetylpyrrolo)isopropylamine; N-(2-Aminoacetophenono)isopropylamine; N-(2-Aminobenzaldehydo)cyclohexylamine; N-(2-Pyridinecarboxaldehydo)cyclohexylamine; N-(2-Pyrrolecarboxaldehydo)cyclohexylamine; N-(2-Acetylpyridino)cyclohexylamine; N-(2-Acetylpyrrolo) cyclohexylamine; N-(2-Aminoacetophenono) cyclohexylamine; N-(2-Aminobenzaldehydo)aniline; N-(2-Pyridinecarboxaldehydo)aniline; N-(2-Pyrrolecarboxaldehydo)aniline; N-(2-Acetylpyridino) aniline; N-(2-Acetylpyrrolo)aniline; N-(2-Aminoacetophenono)aniline; N-(2-Aminobenzaldehydo) aminonorbornane; N-(2-Pyridinecarboxaldehydo) aminonorbornane; N-(2-Pyrrolecarboxaldehydo) aminonorbornane; N-(2-Acetylpyridino)aminonorbornane; N-(2-Acetylpyrrolo)aminonorbornane; N-(2-Aminoacetophenono)aminonorbornane; 2-pyrrolecarboxaldehyde phenylhydrazone; 2-pyrrolecarboxaldehyde 2-pyridyl hydrazone; 2-aminobenzaldehyde phenylhydrazone (nitrin); and 2-aminobenzaldehyde 2-pyridyl hydrazone. Also includes hydrazones with ortho-N substitution.

N Valence Stabilizer #43: Examples of Schiff Bases with two Imine (C═N) Groups and without ortho- (for aryl constituents) or alpha- or beta- (for alkyl constituents) hydroxy, carboxy, carbonyl, thiol, mercapto, thiocarbonyl, amino, imino, oximo, diazeno, or hydrazido substitution (N—N Bidentates) that meet the requirements for use as "wide band" valence stabilizers for $Co^{+3}$ include, but are not limited to: N,N'-(Glyoxalo)diisopropylamine; N,N'-(Glyoxalo)dicyclohexylamine; N,N'-(Glyoxalo)dianiline; N,N'-(Glyoxalo)di-aminonorbornane; N,N'-(Malondialdehydo) diisopropylamine; N,N'-(Malondialdehydo) dicyclohexylamine; N,N'-(Malondialdehydo)dianiline; N,N'-(Malondialdehydo)di-aminonorbornane; N,N'-(Phthalicdialdehydo)diisopropylamine; N,N'-(Phthalicdialdehydo) dicyclohexylamine; N,N'-(Phthalicdialdehydo)dianiline; N,N'-(Phthalicdialdehydo)di-aminonorbornane; N,N'-(Formylcamphoro)diisopropylamine; N,N'-(Formylcamphoro)dicyclohexylamine; N,N'-(Formylcamphoro)dianiline; N,N'-(Formylcamphoro)di-aminonorbornane; N,N'-(Acetylacetonato)diisopropylamine; N,N'-(Acetylacetonato)dicyclohexylamine; N,N'-(Acetylacetonato)dianiline; N,N'-(Acetylacetonato)di-aminonorbornane; N,N'-(Diacetylbenzeno) diisopropylamine; N,N'-(Diacetylbenzeno) dicyclohexylamine; N,N'-(Diacetylbenzeno)dianiline; N,N'-(Diacetylbenzeno)di-aminonorbornane; N,N'-(1,2-Cyclohexanono)diisopropylamine; N,N'-(1,2-Cyclohexanono)dicyclohexylamine; N,N'-(1,2-Cyclohexanono)dianiline; N,N'-(1,2-Cyclohexanono)di-aminonorbornane; N,N'-(Camphorquinono) diisopropylamine; N,N'-(Camphorquinono) dicyclohexylamine; N,N'-(Camphorquinono)dianiline; N,N'-(Camphorquinono)di-aminonorbornane; N,N'-(Benzaldehydo)ethylenediamine; N,N'-(Naphthaldehydo)ethylenediamine; N,N'-(Acetophenono)ethylenediamine; N,N'-(Benzaldehydo)trimethylenediamine; N,N'-(Naphthaldehydo)trimethylenediamine; N,N'-(Acetophenono)trimethylenediamine; N,N'-(Benzaldehydo) cyclohexane-1,2-diamine; N,N'-(Naphthaldehydo) cyclohexane-1,2-diamine; N,N'-(Acetophenono) cyclohexane-1,2-diamine; N,N'-(Benzaldehydo)-1,2-diaminobenzene; N,N'-(Naphthaldehydo)-1,2-diaminobenzene; N,N'-(Acetophenono)-1,2-diaminobenzene; N,N'-(Acetylacetonato)ethylenediamine; N,N'-(Acetylacetonato)-1,2-cyclohexylenediamine; N,N'-(Acetylacetonato)-1,2-propylenediamine; N,N'-(Glyoxalo)-o-phenylenediamine; and N,N'-(Glyoxalo)ethylenediamine. Also includes dihydrazones.

N Valence Stabilizer #44: Examples of SchiffBases with two Imine (C═N) Groups and with ortho- or alpha- or beta-amino or imino or oximo or diazeno or hydrazido substitution (N—N Bidentates, N—N Tridentates, N—N Tetradentates, N—N Pentadentates, or N—N Hexadentates) that meet the requirements for use as "wide band" valence stabilizers for $Co^{+3}$ include, but are not limited to: N,N'-(2,6-Pyridinedicarboxaldehydo)diisopropylamine; N,N'-(2,6-Pyridinedicarboxaldehydo)dicyclohexylamine; N,N'-(2,6-Pyridinedicarboxaldehydo)dianiline; N,N'-(2,6-Pyridinedicarboxaldehydo)di-aminonorbornane; N,N'-(2,5-Pyrroledicarboxaldehydo)diisopropylamine; N,N'-(2,5-Pyrroledicarboxaldehydo)dicyclohexylamine; N,N'-(2,5-Pyrroledicarboxaldehydo)dianiline; N,N'-(2,5-Pyrroledicarboxaldehydo)di-aminonorbornane; N,N'-(o-Aminophthalicdialdehydo) diisopropyl amine; N,N'-(o-Aminophthalicdialdehydo)dicyclohexylamine; N,N'-(o-Aminophthalicdialdehydo)dianiline; N,N'-(o-Aminophthalicdialdehydo)di-aminonorbornane; N,N'-(o-Aminoformylcamphoro)diisopropylamine; N,N'-(o-Aminoformylcamphoro)dicyclohexylamine; N,N'-(o-Aminoformylcamphoro)dianiline; N,N'-(o-Aminoformylcamphoro)di-aminonorbornane; N,N'-(2,6-Diacetylpyridino)diisopropylamine; N,N'-(2,6-Diacetylpyridino)dicyclohexylamine; N,N'-(2,6-Diacetylpyridino)di aniline; N,N'-(2,6-Diacetylpyridino)di-aminonorbornane; N,N'-(o -Aminodiacetylbenzeno) diisopropylamine; N,N'-(o-Aminodiacetylbenzeno) dicyclohexylamine; N,N'-(o-Aminodiacetylbenzeno) dianiline; N,N'-(o-Aminodiacetylbenzeno)di-aminonorbornane; N,N'-(3,6-Diamino-1,2-cyclohexanono) diisopropylamine; N,N'-(3,6-Diamino-1,2-cyclohexanono) dicyclohexylamine; N,N'-(3,6-Diamino-1,2-cyclohexanono)dianiline; N,N'-(3,6-Diamino-1,2-cyclohexanono)di-aminonorbornane; N,N'-(2,5-Diacetylpyrrolo)diisopropylamine; N,N'-(2,5-Diacetylpyrrolo)dicyclohexylamine; N,N'-(2,5-Diacetylpyrrolo)dianiline; N,N'-(2,5-Diacetylpyrrolo)di-aminonorbornane; N,N'-(o-Aminobenzaldehydo) ethylenediamine; N,N'-(o-Aminonaphthaldehydo) ethylenediamine; N,N'-(o-Aminoacetophenono) ethylenediamine; N,N'-(o-Aminobenzaldehydo) trimethylenediamine; N,N'-(o-Aminonaphthaldehydo) trimethylenediamine; N,N'-(o-Aminoacetophenono) trimethylenediamine; N,N'-(o-Aminobenzaldehydo) cyclohexane-1,2-diamine; N,N'-(o-Aminonaphthaldehydo) cyclohexane-1,2-diamine; N,N'-(o-Aminoacetophenono) cyclohexane-1,2-diamine; N,N '-(o-Aminobenzaldehydo)-1,2-diaminobenzene; N,N'-(o-Aminonaphthaldehydo)-1,2-diaminobenzene; and N,N'-(o-Aminoacetophenono)-1,2-diaminobenzene. Also includes hydrazones with ortho-N substitution.

N Valence Stabilizer #45: Examples of SchiffBases with three Imine (C═N) Groups and without ortho- (for aryl constituents) or alpha- or beta- (for alkyl constituents) hydroxy, carboxy, carbonyl, thiol, mercapto, thiocarbonyl, amino, imino, oximo, diazeno, or hydrazido substitution (N—N Tridentates) that meet the requirements for use as "wide band" valence stabilizers for $Co^{+3}$ include, but are not limited to: N,N',N"-(Benzaldehydo)tris(2-aminoethyl) amine; N,N',N"-(Naphthaldehydo)tris(2-aminoethyl)amine; and N,N',N"-(Acetophenono)tris(2-aminoethyl)amine. Also includes trihydrazones.

N Valence Stabilizer #46: Examples of SchiffBases with three Imine (C═N) Groups and with ortho- or alpha- or beta-amino or imino or oximo or diazeno or hydrazido substitution (N—N Tridentates, N—N Tetradentates, N—N Pentadentates, or N—N Hexadentates) that meet the requirements for use as "wide band" valence stabilizers for $Co^{+3}$ include, but are not limited to: N,N',N"-(o-Aminobenzaldehydo)tris(2-aminoethyl)amine; N,N',N"-(o-Aminonaphthaldehydo)tris(2-aminoethyl)amine; and N,N',N"-(o-Aminoacetophenono)tris(2-aminoethyl)amine.

S Valence Stabilizer #1: Examples of macrocyclic, macrobicyclic, and macropolycyclic oligothioketones (including catapinands, cryptands, cyclidenes, and sepulchrates) wherein all binding sites are composed of thioketones (especially in the beta position) (S—S Bidentates, S—S Tetradentates, and S—S Hexadentates) that meet the requirements for use as "wide band" valence stabilizers for $Co^{+3}$ include, but are not limited to: hexathioketocyclotetracosane ([24]ane(═S)$_6$); hexathioketocycloheneicosane ([21]ane(═S)$_6$); hexathioketocyclooctadecane ([18]ane(═S)$_6$); hexathioketocyclopentadecane ([15]ane(═S)$_6$); tetrathioketocycloeicosane ([20]ane(═S)$_4$); tetrathioketocyclooctadecane ([18]ane(═S)$_4$); tetrathioketocyclohexadecane ([16]ane(═S)$_4$); tetrathioketocyclotetradecane ([14]ane(═S)$_4$); tetrathioketocyclododecane ([12]ane(═S)$_4$); dithioketocyclohexadecane ([16]ane(═S)$_2$); dithioketocyclotetraadecane ([14]ane (=S)$_2$); dithioketocyclododecane ([12]ane(=S)$_2$); dithioketocyclodecane ([10]ane(=S)$_2$); and dithioketocyclooctane ([8]ane(=S)$_2$).

S Valence Stabilizer #2: Examples of macrocyclic, macrobicyclic, and macropolycyclic dithiolenes (including catapinands, cryptands, cyclidenes, and sepulchrates) wherein all binding sites are composed of alpha-, alpha-dithiolenes (meaning two thiol groups on a single carbon atom in the ring) (S—S Bidentates, S—S Tetradentates, and S—S Hexadentates) that meet the requirements for use as "wide band" valence stabilizers for $Co^{+3}$ include, but are not limited to: hexathiolocyclotetracosane ([24]ane(—SH)$_6$); hexathiolocycloheneicosane ([21]ane(—SH)$_6$); hexathiolocyclooctadecane ([18]ane(—SH)$_6$); hexathiolocyclopentadecane ([15]ane(—SH)$_6$); tetrathiolocycloeicosane ([20]ane(—SH)$_4$); tetrathiolocyclooctadecane ([18]ane(—SH)$_4$); tetrathiolocyclohexadecane ([16]ane(—SH)$_4$); tetrathiolocyclotetradecane ([14]ane(—SH)$_4$); tetrathiolocyclododecane ([12]ane(—SH)$_4$); dithiolocyclohexadecane ([16]ane(—SH)$_2$); dithiolocyclotetraadecane ([14]ane(—SH)$_2$); dithiolocyclododecane ([12]ane(—SH)$_2$); dithiolocyclodecane ([10]ane(—SH)$_2$); and dithiolocyclooctane ([8]ane(—SH)$_2$).

S Valence Stabilizer #3: Examples of dithioimidodialdehydes, dithiohydrazidodialdehydes (thioacyl thiohydrazides), bis(dithioimidodialdehydes), bis(dithiohydrazidodialdehydes), poly(dithioimidodialdehydes), and poly(dithiohydrazidodialdehydes) (S—S Bidentates, S—S Tridentates, S—S Tetradentates) that meet the requirements for use as "wide band" valence stabilizers for $Co^{+3}$ include, but are not limited to: dithiodiacetamide, dithiodipropanamide, dithiodibutanamide, dithiodibenzamide, and dithiodicyclohexamide.

S Valence Stabilizer #4: Examples of dithioimidodicarbonic acids, dithiohydrazidodicarbonic acids, bis(dithioimidodicarbonic acids), bis(dithiohydrazidodicarbonic acids), poly(dithioimidodicarbonic acids), poly(dithiohydrazidodicarbonic acids) and derivatives thereof (S—S Bidentates, S—S Tridentates, S—S Tetradentates) that meet the requirements for use as "wide band" valence stabilizers for $Co^{+3}$ include, but are not limited to: dithioimidodicarbonic acid, dithiohydrazidodicarbonic acid, O-phenyldithioimidodicarbonic acid, O-benzyldithioimidodicarbonic acid, O-cyclohexyldithioimidodicarbonic acid, O-norbornyldithioimidodicarbonic acid, O,O'-diphenyldithioimidodicarbonic acid, O,O'-dibenzyldithioimidodicarbonic acid, O,O'-dicyclohexyldithioimidodicarbonic acid, and O,O'-norbornyldithioimidodicarbonic acid.

S Valence Stabilizer #5: Examples of 1,3-dithioketones (dithio-beta-ketonates), 1,3,5-trithioketones, bis(1,3-dithioketones), and poly(1,3-dithioketones) (S—S Bidentates, S—S Tridentates, S—S Tetradentates) that meet the requirements for use as "wide band" valence stabilizers for $Co^{+3}$ include, but are not limited to: hexafluoropentanedithione; 1,3-diphenyl-1,3-propanedithione; thiobenzoylthiopinacolone; dithiocyclohexoylmethane; diphenylpentanetrithionate; tetramethylnonanetrithionate; hexafluoroheptanetrithionate; trifluoroheptanetrithionate; 1-(2-thienyl)-1,3-butanedithione, 1-(2-naphthyl)-1,3-butanedithione, trifluorothioacetylthiocamphor; and 1,3-indandithione.

S Valence Stabilizer #6: Examples of 1,2-dithioketones (dithiolenes, dithio-alpha-ketonates), 1,2,3-trithioketones, dithiotropolonates, o-dithioquinones, bis(1,2-dithioketones), and poly(1,2-dithioketones) (S—S Bidentates, S—S Tridentates, S—S Tetradentates) that meet the requirements for use as "wide band" valence stabilizers for $Co^{+3}$ include, but are not limited to: dithiotropolone; 1,2-dithiobenzoquinone (o-dithioquinone)(o-benzenedithiolate)(bdt); di-tert-butyl-1,2-dithiobenzoquinone; hexafluoro-1,2-dithiobenzoquinone; 1,2-dithionaphthoquinone; 9,10-dithiophenanthroquinone; ethylenedithiolene (edt); maleonitriledithiolene (mnt); trifluoromethyldithiolene (tfd); carbomethoxydithiolene (cmt); trithionedithiolene (dmit); toluenedithiolate (tdt); dithiomanaldehyde (propenethionethiolate)(ptt); dithioacetylacetonate (SacSac); dijulolidinedithiolene; 2,3-piperazinedithiolate; di(4-aminophenyl)dithiolene; dimercaptoisotrithione (dmit); (4-octylphenyl)dithiolene; benzenetetrathiol; tetrathiosquaric acid; trithiodeltic acid; pentathiocroconic acid; dithiocroconic acid; hexathiorhodizonic acid; dithiorhodizonic acid; ethylenetetrathiol; trans-butadienetetrathiolate; tetrathiooxalic acid; 1,2-indandithione; naphthothioquinone; acenapthenethioquinone; aceanthrenethioquinone; and indole-2,3-dithione (thioisatin).

S Valence Stabilizer #7: Examples of dithiomalonamides (dithiomalonodiamides), bis(dithiomalonamides), and polydithiomalonamides (S—S Bidentates, S—S Tridentates, S—S Tetradentates) that meet the requirements for use as "wide band" valence stabilizers for $Co^{+3}$ include, but are not limited to: dithiomalonamide, N-phenyldithiomalonamide, N-benzyldithiomalonamide, N-pentafluorophenyldithiomalonamide, N-cyclohexyldithiomalonamide, N-norbornyldithiomalonamide, N,N'-diphenyldithiomalonamide, N,N'-dibenzyldithiomalonamide, N,N'-dipentafluorophenyldithiomalonamide, N,N'-dicyclohexyldithiomalonamide, and N,N'-norbornyldithiomalonamide.

S Valence Stabilizer #8: Examples of2-thioacylthioacetamides, bis(2-thioacylthioacetamides), and poly(2-thioacylthioacetamides) (S—S Bidentates, S—S Tridentates, S—S Tetradentates) that meet the requirements for use as "wide band" valence stabilizers for $Co^{+3}$ include, but are not limited to: 2-thioacetothioacetamide, N-phenyl-2-thioacetothioacetamide, N-pentafluorophenyl-2-thioacetothioacetamide, N-benzyl-2-thioacetothioacetamide, N-cyclohexyl-2-thioacetothioacetamide, N-norbornyl-2-thioacetothioacetamide, N-phenyl-2-thiobenzothioacetamide, N-pentafluorophenyl-2-pentafluorothiobenzothioacetamide, and N-cyclohexyl-2-thiocyclohexothioacetamide.

S Valence Stabilizer #9: Examples of dithioacyl sulfides, bis(dithioacyl sulfides), and poly(dithioacyl sulfides), (S—S Bidentates, S—S Tridentates, S—S Tetradentates) that meet the requirements for use as "wide band" valence stabilizers for $Co^{+3}$ include, but are not limited to: dithioacetyl sulfide; dithiopropanoyl sulfide; dithiobenzoyl sulfide; and dithiopentafluorobenzoyl sulfide.

S Valence Stabilizer #10: Examples of trithiodicarbonic diamides, bis(trithiodicarbonic diamides), and poly(trithiodicarbonic diamides) (S—S Bidentates, S—S Tridentates, S—S Tetradentates) that meet the requirements for use as "wide band" valence stabilizers for $Co^{+3}$ include, but are not limited to: trithiodicarbonic diamide; N-phenyltrithiodicarbonic diamide; N-pentafluorophenyltrithiodicarbonic diamide; N-benzyltrithiodicarbonic diamide; N-cyclohexyltrithiodicarbonic diamide; N-norbornyltrithiodicarbonic diamide; N,N'-diphenyltrithiodicarbonic diamide; N,N'-dipentafluorophenyltrithiodicarbonic diamide; N,N'-dibenzyl-trithiodicarbonic diamide; N,N'-dicyclohexyltrithiodicarbonic diamide; and N,N'-dinorbornyltrithiodicarbonic diamide.

S Valence Stabilizer #11: Examples of pentathio-, tetrathio-, or trithiodicarbonic acids, bis(pentathio-, tetrathio-, or trithiodicarbonic acids), poly(pentathio-, tetrathio-, or trithiodicarbonic acids), and derivatives thereof (S—S Bidentates, S—S Tridentates, S—S Tetradentates) that meet the requirements for use as "wide band" valence stabilizers for $Co^{+3}$ include, but are not limited to: pentathiodicarbonic acid, tetrathiodicarbonic acid, trithiodicarbonic acid, O-phenyltrithiodicarbonic acid, O-benzyltrithiodicarbonic acid, O-cyclohexyltrithiodicarbonic acid, O-norbornyltrithiodicarbonic acid, O,O'-diphenyltrithiodicarbonic acid, O,O'-dibenzyltrithiodicarbonic acid, O,O'-dicyclohexyltrithiodicarbonic acid, and O,O'-dinorbornyltrithiodicarbonic acid.

S Valence Stabilizer #12: Examples of dithiohypophosphoric acids, bis(dithiohypophosphoric acids), poly(dithiohypophosphoric acids), and derivatives thereof (S—S Bidentates, S—S Tridentates, S—S Tetradentates) that meet the requirements for use as "wide band" valence stabilizers for $Co^{+3}$ include, but are not limited to: dithiohypophosphoric acid, methyldithiohypophosphoric acid, isopropyldithiohypophosphoric acid, tert-butyldithiohypophosphoric acid, phenyldithiohypophosphoric acid, pentafluorophenyldithiohypophosphoric acid, benzyldithiohypophosphoric acid, cyclohexyldithiohypophosphoric acid, norbornyldithiohypophosphoric acid, dimethyldithiohypophosphoric acid, diisopropyldiothiohypophosphoric acid, di-tert-butyldithiohypophosphoric acid, diphenyldithiohypophosphoric acid, di-pentafluorophenyldithiohypophosphoric acid, dibenzyldithiohypophosphoric acid, dicyclohexyldithiohypophosphoric acid, and dinorbornyldithiohypophosphoric acid.

S Valence Stabilizer #13: Examples of dithiohypophosphoramides, bis(dithiohypophosphoramides), and poly (dithiohypophosphoramides) (S—S Bidentates, S—S Tridentates, S—S Tetradentates) that meet the requirements for use as "wide band" valence stabilizers for $Co^{+3}$ include, but are not limited to: dithiohypophosphoramide, N-methyldithiohypophosphoramide, N-isopropyldithiohypophosphoramide, N-tert-butyldithiohypophosphoramide, N-phenyldithiohypophosphoramide, N-pentafluorophenyldithiohypophosphoramide, N-benzyldithiohypophosphoramide, N-cyclohexyldithiohypophosphoramide, N-norbornyldithiohypophosphoramide, N,N'''-dimethyldithiohypophosphoramide, N,N'''-diisopropyldithiohypophosphoramide, N,N'''-di-tert-butyldithiohypophosphoramide, N,N'''-diphenyldithiohypophosphoramide, N,N'''-di-pentafluorophenyldithiohypophosphoramide, N,N'''-dibenzyldithiohypophosphoramide, N,N'''-dicyclohexyldithiohypophosphoramide, and N,N'''-dinorbornyldithiohypophosphoramide.

S Valence Stabilizer #14: Examples of dithioimidodiphosphoric acids, dithiohydrazidodiphosphoric acids, bis(dithioimidodiphosphoric acids), bis(dithiohydrazidodiphosphoric acids), poly(dithioimidodiphosphoric acids), poly(dithiohydrazidodiphosphoric acids), and derivatives thereof(S—S Bidentates, S—S Tridentates, S—S Tetradentates) that meet the requirements for use as "wide band" valence stabilizers for $Co^{+3}$ include, but are not limited to: dithioimidodiphosphoric acid, methyldithioimidodiphosphoric acid, isopropyldithioimidodiphosphoric acid, tert-butyldithioimidodiphosphoric acid, phenyldithioimidodiphosphoric acid, pentafluorophenyldithioimidodiphosphoric acid, benzyldithioimidodiphosphoric acid, cyclohexyldithioimidodiphosphoric acid, norbornyldithioimidodiphosphoric acid, dimethyldithioimidodiphosphoric acid, diisopropyldiothioimidodiphosphoric acid, di-tert-butyldithioimidodiphosphoric acid, diphenyldithioimidodiphosphoric acid, di-pentafluorophenyldithioimidodiphosphoric acid, dibenzyldithioimidodiphosphoric acid, dicyclohexyldithioimidodiphosphoric acid, and dinorbornyldithioimidodiphosphoric acid.

S Valence Stabilizer #15: Examples of dithioimidodiphosphoramides, dithiohydrazidodiphosphoramides, bis(dithioimidodiphosphoramides), bis(dithiohydrazidodiphosphoramides), poly(dithioimidodiphosphoramides), and poly (dithiohydrazidodiphosphoramides) (S—S Bidentates, S—S Tridentates, S—S Tetradentates) that meet the requirements for use as "wide band" valence stabilizers for $Co^{+3}$ include, but are not limited to: dithioimidodiphosphoramide, N-methyldithioimidodiphosphoramide, N-isopropyldithioimidodiphosphoramide, N-tert-butyldithioimidodiphosphoramide, N-phenyldithioimidodiphosphoramide, N-pentafluorophenyldithioimidodiphosphoramide, N-benzyldithioimidodiphosphoramide, N-cyclohexyldithioimidodiphosphoramide, N-norbornyldithioimidodiphosphoramide, N,N'''-dimethyldithioimidodiphosphoramide, N,N'''-diisopropyldithioimidodiphosphoramide, N,N'''-di-tert-butyldithioimidodiphosphoramide, N,N'''-diphenyldithioimidodiphosphoramide, N,N'''-di-pentafluorophenyldithioimidodiphosphoramide, N,N'''-dibenzyldithioimidodiphosphoramide, N,N'''-dicyclohexyldithioimidodiphosphoramide, and N,N'''-dinorbornyldithioimidodiphosphoramide.

S Valence Stabilizer #16: Examples of dithiodiphosphoramides, bis(dithiodiphosphoramides), and poly(dithiodiphosphoramides) (S—S Bidentates, S—S Tridentates, S—S Tetradentates) that meet the requirements for use as "wide band" valence stabilizers for $Co^{+3}$ include, but are not limited to: dithiodiphosphoramide, N-methyldithiodiphosphoramide, N-isopropyldithiodiphosphoramide, N-tert-butyldithiodiphosphoramide, N-phenyldithiodiphosphoramide, N-pentafluorophenyldithiodiphosphoramide, N-benzyldithiodiphosphoramide, N-cyclohexyldithiodiphosphoramide, N-norbornyldithiodiphosphoramide, N,N'''-dimethyldithiodiphosphoramide, N,N'''-diisopropyldithiodiphosphoramide, N,N'''-di-tert-butyldithiodiphosphoramide, N,N'''-diphenyldithiodiphosphoramide, N,N'''-di-pentafluorophenyldithiodiphosphoramide, N,N'''-dibenzyldithiodiphosphoramide, N,N'''-dicyclohexyldithiodiphosphoramide, and N,N'''-dinorbornyldithiodiphosphoramide.

S Valence Stabilizer #17: Examples of dithiodiphosphoric acids, bis(dithiodiphosphoric acids), poly(dithiodiphosphoric acids), and derivatives thereof (S—S Bidentates, S—S Tridentates, S—S Tetradentates) that meet the requirements for use as "wide band" valence stabilizers for $Co^{+3}$ include, but are not limited to: dithiodiphosphoric acid, methyldithiodiphosphoric acid, isopropyldithiodiphosphoric acid, tert-butyldithiodiphosphoric acid, phenyldithiodiphosphoric acid, pentafluorophenyldithiodiphosphoric acid, benzyldithiodiphosphoric acid, cyclohexyldithiodiphosphoric acid, norbornyldithiodiphosphoric acid, dimethyldithiodiphosphoric acid, diisopropyldiothiodiphosphoric acid, di-tert-butyldithiodiphosphoric acid, diphenyldithiodiphosphoric acid, di-pentafluorophenyldithiodiphosphoric acid, dibenzyldithiodiphosphoric acid, dicyclohexyldithiodiphosphoric acid, and dinorbornyldithiodipbosphoric acid.

S Valence Stabilizer #18: Examples of tritbiophosphoric acids (phosphorotrithioic acids), bis(trithiopbosphoric acids), poly(trithiophosphoric acids), and derivatives thereof (S—S Bidentates, S—S Tridentates, S—S Tetradentates) that meet the requirements for use as "wide band" valence stabilizers for $Co^{+3}$ include, but are not limited to: trithiophosphoric acid, O-phenyltrithiophosphoric acid, O-benzyltrithiophosphoric acid, O-cyclohexyltrithiophosphoric acid, O-norbornyltrithiophosphoric acid, O,S-diphenyltrithiophosphoric acid, O,S-dibenzyltrithiophosphoric acid, O,S-dicyclohexyltrithiophosphoric acid, and O,S-dinorbornyltrithiophosphoric acid.

S Valence Stabilizer #19: Examples of dithiophosphoric acids (phosphorodithioic acids), bis(dithiophosphonic acids), poly(dithiophosphoric acids), and derivatives thereof (S—S Bidentates, S—S Tridentates, S—S Tetradentates) that meet the requirements for use as "wide band" valence stabilizers for $Co^{+3}$ include, but are not limited to: dithiophosphoric acid, O-phenyldithiophosphoric acid, O-benzyldithiophosphoric acid, O-cyclohexyldithiophosphoric acid, O-norbornyldithiophosphoric acid, O,O-diphenyldithiophosphoric acid, O,O-dibenzyldithiophosphoric acid, O,O-dicyclohexyldithiophosphoric acid, and O,O-dinorbornyldithiophosphoric acid.

S Valence Stabilizer #20: Examples of tetrathiophosphoric acids (phosphorotetrathioic acids), bis(tetrathiophosphoric acids), poly(tetrathiophosphoric acids), and derivatives thereof (S—S Bidentates, S—S Tridentates, S—S Tetradentates) that meet the requirements for use as "wide band" valence stabilizers for $Co^{+3}$ include, but are not limited to: tetrathiophosphoric acid, S-phenyltetrathiophosphoric acid, S-benzyltetrathiophosphoric acid, S-cyclohexyltetrathiophosphoric acid, S-norbornyltetrathiophosphoric acid, S,S-diphenyltetrathiophosphoric acid, S,S-dibenzyltetrathiophosphoric acid, S,S-dicyclohexyltetrathiophosphoric acid, and S,S-dinorbornyltetrathiophosphoric acid.

S Valence Stabilizer #21: Examples of phosphoro(dithioperoxo)dithioic acids, bis[phosphoro(dithioperoxo)dithioic acids], poly[phosphoro(dithioperoxo)dithioic acids], and derivatives thereof(S—S Bidentates, S—S Tridentates, S—S Tetradentates) that meet the requirements for use as "wide band" valence stabilizers for $Co^{+3}$ include, but are not limited to: phosphoro(dithioperoxo)dithioic acid, O-phenylphosphoro(dithioperoxo)dithioic acid, O-benzylphosphoro(dithioperoxo)dithioic acid, O-cyclohexylphosphoro(dithioperoxo)dithioic acid, O-norbornylphosphoro(dithioperoxo)dithioic acid, O,S-diphenylphosphoro(dithioperoxo)dithioic acid, O,S-dibenzylphosphoro(dithioperoxo)dithioic acid, O,S-dicyclohexylphosphoro(dithioperoxo)dithioic acid, and O,S-dinorbornylphosphoro(dithioperoxo)dithioic acid.

S Valence Stabilizer #22: Examples of phosphoro(dithioperoxo)thioic acids, bis[phosphoro(dithioperoxo)thioic acids], poly[phosphoro(dithioperoxo)thioic acids], and derivatives thereof (S—S Bidentates, S—S Tridentates, S—S Tetradentates) that meet the requirements for use as "wide band" valence stabilizers for $Co^{+3}$ include, but are not limited to: phosphoro(dithioperoxo)thioic acid, O-phenylphosphoro(dithioperoxo)thioic acid, O-benzylphosphoro(dithioperoxo)thioic acid, O-cyclohexylphosphoro(dithioperoxo)thioic acid, O-norbornylphosphoro(dithioperoxo)thioic acid, O,S-diphenylphosphoro(dithioperoxo)thioic acid, O,S-dibenzylphosphoro(dithioperoxo)thioic acid, O,S-dicyclohexylphosphoro(dithioperoxo)thioic acid, and O,S-dinorbornylphosphoro(dithioperoxo)thioic acid.

S Valence Stabilizer #23: Examples of phosphoro(dithioperoxo)trithioic acids, bis[phosphoro(dithioperoxo)trithioic acids], poly[phosphoro(dithioperoxo)trithioic acids], and derivatives thereof (S—S Bidentates, S—S Tridentates, S—S Tetradentates) that meet the requirements for use as "wide band" valence stabilizers for $Co^{+3}$ include, but are not limited to: phosphoro(dithioperoxo)trithioic acid, O-phenylphosphoro(dithioperoxo)trithioic acid, O-benzylphosphoro(dithioperoxo)trithioic acid, O-cyclohexylphosphoro(dithioperoxo)trithioic acid, O-norbornylphosphoro(dithioperoxo)trithioic acid, O,S-diphenylphosphoro(dithioperoxo)trithioic acid, O,S-dibenzylphosphoro(dithioperoxo)trithioic acid, O,S-dicyclohexylphosphoro(dithioperoxo)trithioic acid, and O,S-dinorbornylphosphoro(dithioperoxo)trithioic acid.

S Valence Stabilizer #24: Examples of beta-mercaptothioketones, beta-mercaptothioaldehydes, bis(beta-mercaptothioketones), bis(beta-mercaptothioaldehydes), poly(beta-mercaptothioketones), and poly(beta-mercaptothioaldehydes) (S—S Bidentates, S—S Tridentates, S—S Tetradentates) that meet the requirements for use as "wide band" valence stabilizers for $Co^{+3}$ include, but are not limited to: 4-mercaptopentan-2-thione; 1,3-diphenyl-3-mercaptopropanethioaldehyde; 1,3-dibenzyl-3-mercaptopropanethioaldehyde; 1,3-dicyclohexyl-3-mercaptopropanethioaldehyde; 1,3-dinorbornyl-3-mercaptopropanethioaldehyde; 1,3-di(2-thienyl)-3-mercaptopropanethioaldehyde; 1,3-di(2-furyl)-3-mercaptopropanethioaldehyde; o-mercaptothioacetophenone; 5-mercapto-1,4-dithionaphthoquinone; 1-mercaptothioacridone; 1-mercaptodithioanthraquinone; 1,8-dimercaptodithioanthraquinone; and beta-mercaptothiobenzophenone.

S Valence Stabilizer #25: Examples of N-(aminomethylthiol)thioureas [N-(aminomercaptomethyl)thioureas], bis[N-(aminomethylthiol)thioureas], and poly[N-(aminomethylthiol)thioureas] (S—S Bidentates, S—S Tridentates, S—S Tetradentates) that meet the requirements for use as "wide band" valence stabilizers for $Co^{+3}$ include, but are not limited to: N'-(aminomercaptomethyl)thiourea; N,N"-dimethyl-N'-(aminomercaptomethyl)thiourea; N,N'-diethyl-N'-(aminomercaptomethyl)thiourea; N,N"-isopropyl-N'-(aminomercaptomethyl)thiourea; N,N"-diphenyl-N'-(aminomercaptomethyl)thiourea; N,N"-dibenzyl-N'-(aminonercaptomethyl)thiourea; N,N"-dicyclohexyl-N'-(aminomercaptomethyl)thiourea; and N,N"-dinorbornyl-N'-(aminomercaptomethyl)thiourea.

S Valence Stabilizer #26: Examples of dithiooxamides, bis(dithiooxamides), and poly(dithiooxamides) (S—S Bidentates, S—S Tridentates, S—S Tetradentates) that meet the requirements for use as "wide band" valence stabilizers for $Co^{+3}$ include, but are not limited to: dithiooxamide (rubeanic acid), N-methyldithiooxamide; N-ethyldithiooxamide; N-isopropyldithiooxamide; N-phenyldithiooxamide; N-benzyldithiooxamide; N-cyclohexyldithiooxamide; N-norbornyldithiooxamide; N,N'-dimethyldithiooxamide; N,N'-diethyldithiooxamide; N,N'-diisopropyldithiooxamide; N,N'-diphenyldithiooxamide; N,N'-dibenzyldithiooxamide; N,N'-dicyclohexyldithiooxamide; and N,N'-dinorbornyldithiooxamide.

S Valence Stabilizer #27: Examples of 1,1-dithiolates, bis(1,1-dithiolates), and poly(1,1-dithiolates) (S—S Bidentates and S—S Tetradentates) that meet the requirements for use as "wide band" valence stabilizers for $Co^{+3}$ include, but are not limited to: 1,1-dicyano-2,2-ethylene dithiolate (i-mnt); 1,1-dicarboalkoxy-2,2-ethylenedithiolate(DED); 1,1-di(trifluoromethyl)-2,2-ethylenedithiolate; 1,1-di(pentafluorophenyl)-2,2-ethylene dithiolate; 1-pentamethylene-2,2-ethylene dithiolate; and 1-nitroethylene dithiolate.

S Valence Stabilizer #28: Examples of dithiomonocarboxylic acids, tri- and tetrathiodicarboxylic Acids, bis(dithiomonocarboxylic acids), bis(tri- and tetrathiodicarboxylic acids), poly(dithiomonocarboxylic acids), poly(tri- and tetrathiodicarboxylic acids), and derivatives thereof (S—S Bidentates and S—S Tetradentates) that meet the requirements for use as "wide band" valence stabilizers for $Co^{+3}$ include, but are not limited to: dithioacetic acid; dithiopropionic acid; dithiobenzoic acid (dtb); dithiophenylacetic acid (dtpa); dithiocyclohexanoic acid; dithiofuroic acid; dithionaphthoic acid; phenyl dithioacetate; phenyl dithiopropionate; phenyl dithiobenzoate; phenyl dithiocyclohexanoate; phenyl dithiofuroate; phenyl dithionaphthoate; tetrathiooxalic acid; tetrathiomalonic acid; tetrathiosuccinic acid; trithiooxalic acid; trithiomalonic acid; trithiosuccinic acid; diphenyl tetrathiooxalate; diphenyl tetrathiomalonate; diphenyl tetrathiosuccinate; diphenyl trithiooxalate; diphenyl trithiomalonate; diphenyl trithiosuccinate; pyridine dithiocarboxylic acid; pyrrole dithiocarboxylic acid; thiophene dithiocarboxylic acid; dithionaphthoic acid; and tetrathiocamphonic acid.

S Valence Stabilizer #29: Examples of perthiomonocarboxylic acids, perthiodicarboxylic acids, bis(perthiomonocarboxylic acids), bis(perthiodicarboxylic acids), poly(perthiomonocarboxylic acids), poly(perthiodicarboxylic acids), and derivatives thereof (S—S Bidentates and S—S Tetradentates) that meet the requirements for use as "wide band" valence stabilizers for $Co^{+3}$ include, but are not limited to: perthioacetic acid; perthiopropionic acid; perthiobenzoic acid; perthiophenylacetic acid; perthiocyclohexanoic acid; perthiofuroic acid; perthionaphthoic acid; phenyl perthioacetate; phenyl perthiopropionate; phenyl perthiobenzoate; phenyl perthiocyclohexanoate; phenyl perthiofuroate; phenyl perthionaphthoate; perthiooxalic acid; perthiomalonic acid; perthiosuccinic acid; diphenyl perthiooxalate; diphenyl perthiomalonate; diphenyl perthiosuccinate; dithiole-3-thione (dithione-3-thione); and benzodithiole-3-thione (benzodithione-3-thione).

S Valence Stabilizer #30: Examples of dithiocarbonates, trithiocarbonates, perthiocarbonates, bis(dithiocarbonates), bis(trithiocarbonates), and bis(perthiocarbonates) (S—S Bidentates and S—S Tetradentates) that meet the requirements for use as "wide band" valence stabilizers for $Co^{+3}$ include, but are not limited to: S,S-diethyldithiocarbonate; S,S-diisopropyldithiocarbonate; S,S-diphenyldithiocarbonate; S,S-dibenzyldithiocarbonate; S,S-dicyclohexyldithiocarbonate; S,S-dinorbornyldithiocarbonate; diethyltrithiocarbonate; diisopropyltrithiocarbonate; diphenyltrithiocarbonate; dibenzyltrithiocarbonate; dicyclohexyltrithiocarbonate; and dinorbornyltrithiocarbonate.

S Valence Stabilizer #31: Examples of dithiocarbamates, bis(dithiocarbamates), and poly(dithiocarbamates) (including N-hydroxydithiocarbamates and N-mercaptodithiocarbamates) (S—S Bidentates, S—S Tridentates, and S—S Tetradentates) that meet the requirements for use as "wide band" valence stabilizers for $Co^{+3}$ include, but are not limited to: dimethyldithiocarbamate (dmdtc); di(trifluorodimethyl)dithiocarbamate; diethyldithiocarbamate (dedtc); dipropyldithiocarbamate; diisopropyldithiocarbamate; dibutyldithiocarbamate; ditertbutyldithiocarbamate; dicyanamidodithiocarbamate; azidothioformates; diphenyldithiocarbamate; di(pentafluorophenyl)dithiocarbamate; dibenzyldithiocarbamate; dinaphthyldithiocarbamate; dicyclohexyldithiocarbamate; dinorbornyldithiocarbamate; diadamantyldithiocarbamate; pyrrolidinodithiocarbamate (pyrdtc); piperidinodithiocarbamate (pipdtc); morpholinodithiocarbamate (mordtc); thiamorpholinodithiocarbamate; 3-pyrrolinodithiocarbamate; pyrrolodithiocarbamate; oxazolodithiocarbamate; isoxazolodithiocarbamate; thiazolodithiocarbamate; isothiazolodithiocarbamate; indolodithiocarbamate; carbazolodithiocarbamate; pyrazolinodithiocarbamate; imidazolinodithiocarbamate; pyrazolodithiocarbamate; imidazolodithiocarbamate; indazolodithiocarbamate; and triazolodithiocarbamate.

S Valence Stabilizer #32: Examples of dithiocarbazates (dithiocarbazides), bis(dithiocarbazates), and poly(dithiocarbazates) (S—S Bidentates, S—S Tridentates, and S—S Tetradentates; or possibly N—S Bidentates, N—S Tridentates, and N—S Tetradentates) that meet the requirements for use as "wide band" valence stabilizers for $Co^{+3}$ include, but are not limited to: N,N'-dimethyldithiocarbazate; N,N'-di(trifluoromethyl)dithiocarbazate; N,N'-diethyldithiocarbazate; N,N'-diphenyldithiocarbazate; N,N'-dibenzyldithiocarbazate; N,N'-di(pentafluorophenyl)dithiocarbazate; N,N'-dicyclohexyldithiocarbazate; and N,N'-dinorbornyldithiocarbazate.

N—S Valence Stabilizer #1: Examples of diformamidine disulfides (thioperoxydicarbonimidic diamides), thioperoxytricarbonimidic diamides, thioperoxytetracarbonimidic diamides, bis(diformamidine disulfides), and poly(diformamidine disulfides) (N—S bidentates, N—N—S tridentates, or N—S tetradentates) that meet the requirements for use as "wide band" valence stabilizers for $Co^{+3}$ include, but are not limited to: diformamidine disulfide; methyldiformamidine disulfide; ethyldiformamidine disulfide; isopropyldiformamidine disulfide; butyldiformamidine disulfide; benzyldiformamidine disulfide; phenyldiformamidine disulfide; tolyldiformamidine disulfide; naphthyldiformamidine disulfide; cyclohexyldiformamidine disulfide; norbornyldiformamidine disulfide; adamantyldiformamidine disulfide; dimethyldiformamidine disulfide; diethyldiformamidine disulfide; diisopropyldiformamidine disulfide; dibutyldiformamidine disulfide; dibenzyldiformamidine disulfide; diphenyldiformamidine disulfide; ditolyldiformamidine disulfide; dinaphthyldiformamidine disulfide; dicyclohexyldiformamidine disulfide; dinorbornyldiformamidine disulfide; diadamantyldiformamidine disulfide; 2-S-amidinodisulfidothiazole; 2-S-amidinodisulfidooxazole; 2-S-amidinodisulfidoimidazole; 3-S-amidinodisulfidopyrazole; 3-S-amidinodisulfido-1,2,4-triazole; and 5-S-amidinodisulfidotetrazole.

N—S Valence Stabilizer #2: Examples of S-amidinodithiocarbamates, bis(S-amidinodithiocarbamates), and poly(S-amidinodithiocarbamates) (N—S Bidentates and N—S Tetradentates) that meet the requirements for use as "wide band" valence stabilizers for $Co^{+3}$ include, but are not limited to: S-amidinodithiocarbamate; N-methyl-S-amidinodithiocarbamate; N-ethyl-S-amidinodithiocarbamate; N-isopropyl-S-amidinodithiocarbamate; N-butyl-S-amidinodithiocarbamate; N-benzyl-S-amidinodithiocarbamate; N-phenyl-S-amidinodithiocarbamate; N-tolyl-S-amidinodithiocarbamate; N-naphthyl-S-amidinodithiocarbamate;

N-cyclohexyl-S-amidinodithiocarbamate; N-norbornyl-S-amidinodithiocarbamate; N-adamantyl-S-amidinodithiocarbamate; N,N'-dimethyl-S-amidinodithiocarbamate; N,N'-diethyl-S-amidinodithiocarbamate; N,N'-diisopropyl-S-amidinodithiocarbamate; N,N'-dibutyl-S-amidinodithiocarbamate; N,N'-dibenzyl-S-amidinodithiocarbamate; N,N'-diphenyl-S-amidinodithiocarbamate; N,N'-ditolyl-S-amidinodithiocarbamate; N,N'-dinaphthyl-S-amidinodithiocarbamate; N,N'-dicyclohexyl-S-amidinodithiocarbamate; N,N'-dinorbornyl-S-amidinodithiocarbamate; N,N'-diadamantyl-S-amidinodithiocarbamate; ethylenebis(S-amidinodithiocarbamate); propylenebis(S-amidinodithiocarbamate); phenylenebis(S-amidinodithiocarbamate); piperazinebis(S-amidinodithiocarbamate); oxalylbis(S-amidinodithiocarbamate); malonylbis(S-amidinodithiocarbamate); succinylbis(S-amidinodithiocarbamate); phthalylbis(S-amidinodithiocarbamate); 2-S-dithiocarbamatothiazole; 2-S-dithiocarbamatooxazole; 2-S-dithiocarbamatoimidazole; 3-S-dithiocarbamatopyrazole; 3-S-dithiocarbamato-1,2,4-triazole; and 5-S-dithiocarbamatotetrazole.

N—S Valence Stabilizer #3: Examples of O-amidinothiocarbamates, bis(O-amidinothiocarbamates), and poly(O-amidinothiocarbamates) (N—S Bidentates and N—S Tetradentates) that meet the requirements for use as "wide band" valence stabilizers for $Co^{+3}$ include, but are not limited to: O-amidinothiocarbamate; N-methyl-O-amidinothiocarbamate; N-ethyl-O-amidinothiocarbamate; N-isopropyl-O-amidinothiocarbamate; N-butyl-O-amidinothiocarbamate; N-benzyl-O-amidinothiocarbamate; N-phenyl-O-amidinothiocarbamate; N-tolyl-O-amidinothiocarbamate; N-naphthyl-O-amidinothiocarbamate; N-cyclohexyl-O-amidinothiocarbamate; N-norbornyl-O-amidinothiocarbamate; N-adamantyl-O-amidinothiocarbamate; N,N'-dimethyl-O-amidinothiocarbamate; N,N'-diethyl-O-amidinothiocarbamate; N,N'-diisopropyl-O-amidinothiocarbamate; N,N'-dibutyl-O-amidinothiocarbamate; N,N'-dibenzyl-O-amidinothiocarbamate; N,N'-diphenyl-O-amidinothiocarbamate; N,N'-ditolyl-O-amidinothiocarbamate; N,N'-dinaphthyl-O-amidinothiocarbamate; N,N'-dicyclohexyl-O-amidinothiocarbamate; N,N'-dinorbornyl-O-amidinothiocarbamate; N,N'-diadamantyl-O-amidinothiocarbamate; ethylenebis(O-amidinothiocarbamate); propylenebis(O-amidinothiocarbamate); phenylenebis(O-amidinothiocarbamate); piperazinebis(O-amidinothiocarbamate); oxalylbis(O-amidinothiocarbamate); malonylbis(O-amidinothiocarbamate); succinylbis(O-amidinothiocarbamate); phthalylbis(O-amidinothiocarbamate); 2-O-monothiocarbamatothiazole; 2-O-monothiocarbamatooxazole; 2-O-monothiocarbamatoimidazole; 3-O-monothiocarbamatopyrazole; 3-O-monothiocarbamato-1,2,4-triazole; and 5-O-monothiocarbamatotetrazole.

N—S Valence Stabilizer #4: Examples of S-amidinoperoxythiocarbamates, bis(S-amidinoperoxythiocarbamates), and poly(S-amidinoperoxythiocarbamates) (N—S Bidentates and N—S Tetradentates) that meet the requirements for use as "wide band" valence stabilizers for $Co^{+3}$ include, but are not limited to: S-amidinoperoxythiocarbamate; N-methyl-S-amidinoperoxythiocarbamate; N-ethyl-S-amidinoperoxythiocarbamate; N-isopropyl-S-amidinoperoxythiocarbamate; N-butyl-S-amidinoperoxythiocarbamate; N-benzyl-S-amidinoperoxythiocarbamate; N-phenyl-S-amidinoperoxythiocarbamate; N-tolyl-S-amidinoperoxythiocarbamate; N-naphthyl-S-amidinoperoxythiocarbamate; N-cyclohexyl-S-amidinoperoxythiocarbamate; N-norbornyl-S-amidinoperoxythiocarbamate; N-adamantyl-S-amidinoperoxythiocarbamate; N,N'-dimethyl-S-amidinoperoxythiocarbamate; N,N'-diethyl-S-amidinoperoxythiocarbamate; N,N'-diisopropyl-S-amidinoperoxythiocarbamate; N,N'-dibutyl-S-amidinoperoxythiocarbamate; N,N'-dibenzyl-S-amidinoperoxythiocarbamate; N,N'-diphenyl-S-amidinoperoxythiocarbamate; N,N'-ditolyl-S-amidinoperoxythiocarbamate; N,N'-dinaphthyl-S-amidinoperoxythiocarbamate; N,N'-dicyclohexyl-S-amidinoperoxythiocarbamate; N,N'-dinorbornyl-S-amidinoperoxythiocarbamate; N,N'-diadamantyl-S-amidinoperoxythiocarbamate; ethylenebis(S-amidinoperoxythiocarbamate); propylenebis(S-amidinoperoxythiocarbamate); phenylenebis(S-amidinoperoxythiocarbamate); piperazinebis(S-amidinoperoxythiocarbamate); oxalylbis(S-amidinoperoxythiocarbamate); malonylbis(S-amidinoperoxythiocarbamate); succinylbis(S-amidinoperoxythiocarbamate); and phthalylbis(S-amidinoperoxythiocarbamate).

N—S Valence Stabilizer #5: Examples of phosphorimidothioic acid; phosphorimidodithioic acid; phosphorimidotrithioic acid; bis(phosphorimidothioic acid); bis(phosphorimidodithioic acid); bis(phosphorimidotrithioic acid); poly(phosphorimidothioic acid); poly(phosphorimidodithioic acid); poly(phosphorimidotrithioic acid); and derivatives thereof (N—S Bidentates and N—S Tetradentates) that meet the requirements for use as "wide band" valence stabilizers for $Co^{+3}$ include, but are not limited to: phosphorimidothioic acid; phosphorimidodithioic acid; phosphorimidotrithioic acid; O-phenylphosphorimidothioic acid; O-benzylphosphorimidothioic acid; O-cyclohexylphosphorimidothioic acid; O-norbornylphosphorimidothioic acid; O,O'-diphenylphosphorimidothioic acid; O,O'-dibenzylphosphorimidothioic acid; O,O'-dicyclohexylphosphorimidothioic acid; and O,O'-dinorbornylphosphorimidothioic acid.

N—S Valence Stabilizer #6: Examples of phosphorothioic triamides, bis(phosphorothioic triamides), and poly(phosphorothioic triamides) (N—S Bidentates and N—S Tetradentates) that meet the requirements for use as "wide band" valence stabilizers for $Co^{+3}$ include, but are not limited to: phosphorothioic triamide; phosphorothioic trihydrazide; phosphoramidothioic dihydrazide; N-phenylphosphorothioic triamide;N-benzylphosphorothioic triamide; N-cyclohexylphosphorothioic triamide; N-norbornylphosphorothioic triamide; N,N'-diphenylphosphorothioic triamide; N,N'-dibenzylphosphorothioic triamide; N,N'-dicyclohexylphosphorothioic triamide; and N,N'-dinorbornylphosphorothioic triamide.

N—S Valence Stabilizer #7: Examples of phosphoramidotrithioic acid, phosphorodiamidodithioic acid, bis(phosphoramidotrithioic acid), bis(phosphorodiamidodithioic acid), poly(phosphoramidotrithioic acid), poly(phosphorodiamidodithioic acid), and derivatives thereof (N—S Bidentates and N—S Tetradentates) that meet the requirements for use as "wide band" valence stabilizers for $Co^{+3}$ include, but are not limited to: phosphoramidotrithioic acid, phosphorodiamidodithioic acid, S-phenylphosphoramidotrithioic acid, S-benzylphosphoramidotrithioic acid, S-cyclohexylphosphoramidotrithioic acid, S-norbornylphosphoramidotrithioic acid, S,S'-diphenylphosphoramidotrithioic acid, S,S'-dibenzylphosphoramidotrithioic acid, S,S'-dicyclohexylphosphoramidotrithioic acid, and S,S'-dinorbornylphosphoramidotrithioic acid.

N—S Valence Stabilizer #8: Examples of phosphoramidothioic acid, phosphoramidodithioic acid, phosphorodiamidothioic acid, bis(phosphoramidothioic acid), bis(phosphoramidodithioic acid), bis(phosphorodiamidothioic acid), poly(phosphoramidothioic acid), poly(phosphoramidodithioic acid), and poly(phosphorodiamidothioic acid) (N—S Bidentates and N—S Tetradentates) that meet the requirements for use as "wide band" valence stabilizers for $Co^{+3}$ include, but are not limited to: phosphoramidothioic acid, phosphoramidodithioic acid, phosphorodiamidothioic acid, phosphorohydrazidothioic acid, phosphorohydrazidodithioic acid, phosphorodihydrazidothioic acid, phosphoramidohydrazidothioic acid, O-phenylphosphoramidothioic acid, O-benzylphosphoramidothioic acid, O-cyclohexylphosphoramidothioic acid, O-norbornylphosphoramidothioic acid, S-phenylphosphoramidodithioic acid, S-benzylphosphoramidodithioic acid, S-cyclohexylphosphoramidodithioic acid, and S-norbornylphosphoramidodithioic acid.

N—S Valence Stabilizer #9: Examples of N-thioacyl 7-aminobenzylidenimines (N—S Bidentates or N—S Tetradentates) that meet the requirements for use as "wide band" valence stabilizers for $Co^{+3}$ include, but are not limited to: N-thioacetyl 7-methylaminobenzylidenimine; N-thioacetyl 7-phenylaminobenzylidenimine; N-thiobenzoyl 7-methylaminobenzylidenimine; and N-thiobenzoyl 7-phenylaminobenzylidenimine.

N—S Valence Stabilizer #10: Examples of thiohydroxamates (thiohydroxylamines), bis(thiohydroxamates), and poly (thiohydroxamates) (N—S Bidentates, N—S Tetradentates, and N—S Hexadentates) that meet the requirements for use as "wide band" valence stabilizers for $Co^{+3}$ include, but are not limited to: acetothiohydroxamic acid; propianothiohydroxamic acid; butyrothiohydroxamic acid; crotonothiohydroxamic acid; sorbothiohydroxamic acid; benzothiohydroxamic acid; toluicthiohydroxamic acid; salicylthiohydroxamic acid; phenylacetothiohydroxamic acid; anthranilthiohydroxamic acid; nicotinethiohydroxamic acid; picolinethiohydroxamic acid; cyclohexanethiohydroxamic acid; quinoline 8-thiohydroxamic acid; cinnamylthiohydroxamic acid; oxaldithiohydroxamic acid; succinylbis-N-phenylthiohydroxamic acid; adipylbis-N-phenylthiohydroxamic acid; glyoxalthiohydroxamic acid; 2-thiophenethiocarbohydroxamic acid; thenoylthiohydroxamic acid; N-phenylbenzothiohydroxamic acid; N-tolylbenzothiohydroxamic acid; N-phenylacetothiohydroxamic acid; N-phenyl-2-thenoylthiohydroxainic acid; and N-tolyl-2-thenoylthiohydroxamic acid.

N—S Valence Stabilizer #11: Examples of alpha- or ortho-aminothiocarboxylic acids, and alpha- or ortho-aminothiodicarboxylic acids, and derivatives thereof (N—S Bidentates, N—S Tridentates, and N—S Tetradentates) that meet the requirements for use as "wide band" valence stabilizers for $Co^{+3}$ include, but are not limited to: 2-pyridinethiocarboxylic acid (thiopicolinic acid); 2-pyrazinethiocarboxylic acid; o-aminothiobenzoic acid; o-aminothionaphthoic acid; and 3,6-diaminothiophthalic acid.

N—S Valence Stabilizer #12: Examples of thiosemicarbazones, bis(thiosemicarbazones), and poly(thiosemicarbazones) (N—S Bidentates, N—S Tetradentates, and N—S Hexadentates) that meet the requirements for use as "wide band" valence stabilizers for $Co^{+3}$ include, but are not limited to: acetaldehyde thiosemicarbazone; acetone thiosemicarbazone; pinacolone thiosemicarbazone; benzaldehyde thiosemicarbazone; naphthaldehyde thiosemicarbazone; norbornanone thiosemicarbazone; camphor thiosemicarbazone; nopinone thiosemicarbazone; 2-pyridinaldehyde thiosemicarbazone; salicylaldehyde thiosemicarbazone; quinolinaldehyde thiosemicarbazone; isatin dithiosemicarbazone; camphorquinone dithiosemicarbazone; camphorquinone dithiosemicarbazone; picolinaldehyde thiosemicarbazone; dipyridyl glyoxal dithiosemicarbazone; di-2-pyridyl ketone thiosemicarbazone; methyl-2-pyridyl ketone thiosemicarbazone; glyoxal dithiosemicarbazone; acetophenone thiosemicarbazone; biacetyl monoxime thiosemicarbazone; acetamidobenzaldehyde thiosemicarbazone; thymolaldothiosemicarbazone; thiophene-2-aldehyde thiosemicarbazone; phthalaldehyde dithiosemicarbazone; phthalimide dithiosemicarbazone; furaldehyde thiosemicarbazone; naphthoquinone thiosemicarbazone; phenanthrequinone thiosemicarbazone; cyclohexanedione dithiosemicarbazone; ionone thiosemicarbazone; bisthiosemicarbazone of diethyl-3,4-dioxadioate; pyridoxal alkylthiosemicarbazones; benzylidene phenylthiosemicarbazones; lawsone thiosemicarbazone; and 1-benzoin-4-phenylthiosemicarbazone (bps).

N—S Valence Stabilizer #13: Examples of thioacyl hydrazones, bis(thioacyl hydrazones), and poly(thioacyl hydrazones) (N—S Bidentates, N—S Tetradentates, and N—S Hexadentates) that meet the requirements for use as "wide band" valence stabilizers for $Co^{+3}$ include, but are not limited to: acetaldehyde N-thioformylhydrazone; acetaldehyde N-thiobenzoylhydrazone; acetone N-thioformylhydrazone; acetone N-thiobenzoylhydrazone; pinacolone N-thioformylhydrazone; pinacolone N-thiobenzoylhydrazone; benzaldehyde N-thioformylhydrazone; benzaldehyde N-thiobenzoylhydrazone; naphthaldehyde N-thioformylhydrazone; naphthaldehyde N-thiobenzoylhydrazone; norbornanone N-thioformylhydrazone; norbornanone N-thiobenzoylhydrazone; camphor N-thioformylhydrazone; camphor N-thiobenzoylhydrazone; nopinone N-thioformylhydrazone; nopinone N-thiobenzoylhydrazone; 2-pyridinaldehyde N-thioformylhydrazone; 2-pyridinaldehyde N-thiobenzoylhydrazone; salicylaldehyde N-thioformylhydrazone; salicylaldehyde N-thiobenzoylhydrazone; quinolinaldehyde N-thioformylhydrazone; quinolinaldehyde N-thiobenzoylhydrazone; thiophene-2-aldehyde N-thioformylhydrazone; thiophene-2-aldehyde N-thiobenzoylhydrazone; naphthoquinone N-thioformylhydrazone; naphthoquinone N-thiobenzoylhydrazone; ionone N-thioformylhydrazone; ionone N-thiobenzoylhydrazone; benzaldehyde benzothiazolehydrazone; lawsone N-thioformylhydrazone; and lawsone N-thiobenzoylhydrazone.

N—S Valence Stabilizer #14: Examples of thiocarbazones (diazenecarbothioic hydrazides), bis(thiocarbazones), and poly(thiocarbazones) (N—S Bidentates, N—S Tetradentates, and N—S Hexadentates) that meet the requirements for use as "wide band" valence stabilizers for $Co^{+3}$ include, but are not limited to: diphenylthiocarbazone (dithizone); 2-phenylthiocarbazone; dinaphthylthiocarbazone; 2-naphthylthiocarbazone; and ambazone.

N—S Valence Stabilizer #15: Examples of azo compounds with thiol or mercapto or thiocarbonyl substitution at the ortho- (for aryl) or alpha- or beta- (for alkyl) positions, Bis[o-(HS—) or alpha- or beta-(HS—)azo compounds], or Poly[o-(HS—) or alpha- or beta-(HS—)azo compounds) (N—S Bidentates, N—S Tridentates, N—S Tetradentates, or N—S Hexadentates) that meet the requirements for use as "wide band" valence stabilizers for $Co^{+3}$ include, but are not limited to: 2-thiolazobenzene [1-(phenylazo)-2-thiophenol]; 2,2'-dithioazobenzene; (2-thiophene)azobenzene; 1-(4-nitrophenylazo)-2-thionaphthol; 2-thiazolylazobenzene; and 2-benzothiazolylazobenzene.

N—S Valence Stabilizer #16: Examples of diazeneformothioamides, diazeneacetothioamides, bis(diazeneformothioamides), bis(diazeneacetothioamides), poly(diazeneformothioamides), and poly(diazeneacetothioamides) (N—S Bidentates, N—S Tetradentates, and N—S Hexadentates) that meet the requirements for use as "wide band" valence stabilizers for $Co^{+3}$ include, but are not limited to: diazeneformothioamide, diazeneacetothioamide, phenyldiazeneformothioamide, diphenyldiazeneformothioamide, phenyldiazeneacetothioamide, and diphenyldiazeneacetothioamide.

N—S Valence Stabilizer #17: Examples of diazenecarbothioic acids, diazenecarbodithioic acids, bis(diazenecarbothioic acids), bis(diazenecarbodithioic acids), poly(diazenecarbothioic acids), poly(diazenecarbodithioic acids) and derivatives thereof (N—S Bidentates, N—S Tetradentates, N—S Hexadentates) that meet the requirements for use as "wide band" valence stabilizers for $Co^{+3}$ include, but are not limited to: diazeneformothioic acid, diazeneacetothioic acid, phenyldiazeneformothioic acid, diphenyldiazeneformothioic acid, phenyldiazeneacetothioic acid, and diphenyldiazeneacetothioic acid.

N—S Valence Stabilizer #18: Examples of diazeneformothioaldehydes, diazeneacetothioaldehydes, bis(diazeneformothioaldehydes), bis(diazeneacetothioaldehydes), poly (diazeneformothioaldehydes), and poly (diazeneacetothioaldehydes) (N—S Bidentates, N—S Tetradentates and N—S Hexadentates) that meet the requirements for use as "wide band" valence stabilizers for $Co^{+3}$ include, but are not limited to: diazeneformotbioaldehyde, diazeneacetothioaldehyde, phenyldiazeneformothioaldehyde, diphenyldiazeneformothioaldehyde, phenyldiazeneacetothioaldehyde, and diphenyldiazeneacetothioaldehyde.

N—S Valence Stabilizer #19: Examples of diazenediformothioamides, diazenediacetothioamides, bis(diazenediformothioamides), bis(diazenediacetothioamides), poly(diazenediformothioamides), and poly (diazenediacetothioamides) (N—S Tridentates and N—S Hexadentates) that meet the requirements for use as "wide band" valence stabilizers for $Co^{+3}$ include, but are not limited to: diazenediformodithioamide, diazenediacetodithioamide, diphenydiazenediformodithioamide, tetraphenyldiazenediformodithioamide, diphenyldiazenediacetodithioamide, and tetraphenyldiazenediacetodithioamide.

N—S Valence Stabilizer #20: Examples ofdiazenedicarbothioic acids, diazenedicarbodithioic acids, bis(diazenedicarbothioic acids), bis(diazenedicarbodithioic acids), poly(diazenedicarbothioic acids), poly(diazenedicarbodithioic acids) and derivatives thereof (N—S Tridentates and N—S Hexadentates) that meet the requirements for use as "wide band" valence stabilizers for $Co^{+3}$ include, but are not limited to: diazenediformothioic acid, diazenediacetodithioic acid, phenyldiazenediformothioic acid, diphenyldiazenediformothioic acid, phenyldiazenediacetodithioic acid, and diphenyldiazenediacetodithioic acid.

N—S Valence Stabilizer #21: Examples of diazenediformothioaldehydes, diazenediacetothioaldehydes, bis(diazenediformothioaldehydes), bis(diazenediacetothioaldehydes), poly(diazenediformothioaldehydes), and poly(diazenediacetothioaldehydes) (N—S Tridentates and N—S Hexadentates) that meet the requirements for use as "wide band" valence stabilizers for $Co^{+3}$ include, but are not limited to: diazenediformothioaldehyde, diazenediacetothioaldehyde, diphenyldiazenediformothioaldehyde, and diphenyldiazenediacetothioaldehyde.

N—S Valence Stabilizer #22: Examples of ortho-thio (or -mercapto) substituted formazans, bis(o-thio or -mercapto substituted formazans), and poly(o-thio or -mercapto substituted formazans) (N—S Bidentates, N—S Tridentates, N—S Tetradentates, and N—S Hexadentates) that meet the requirements for use as "wide band" valence stabilizers for $Co^{+3}$ include, but are not limited to: 1-(2-thiophenyl)-3,5-diphenylformazan; 1-(2-methylmercaptophenyl)-3,5-diphenylformazan; 1,5-bis(2-thiophenyl)-3-phenylform azan; and 5-bis(2-methylmercaptophenyl)-3-phenylformazan.

N—S Valence Stabilizer #23: Examples of ortho-thio (or -mercapto) substituted azines (including ketazines), bis(o-thio or mercapto substituted azines), and poly(o-thio or mercapto substituted azines) (N—S Bidentates, N—S Tridentates, N—S Tetradentates, and N—S Hexadentates) that meet the requirements for use as "wide band" valence stabilizers for $Co^{+}3$ include, but are not limited to: 2-mercapto-1-benzalazine; 2-mercapto-1-naphthalazine; and 2-mercapto-1-cyclohexanonazine.

N—S Valence Stabilizer #24: Examples of Schiff Bases with one Imine (C═N) Group and with ortho- or alpha- or beta-thio or mercapto or thiocarbonyl substitution (N—S Bidentates, N—S Tridentates, N—S Tetradentates, N—S Pentadentates, or N—S Hexadentates) that meet the requirements for use as "wide band" valence stabilizers for $Co^{+3}$ include, but are not limited to: N -(Thiosalicylaldehydo) isopropylamine; N-(2-thiophenecarboxaldehydo)isopropylamine; N-(2-Acetylthiopheno)isopropylamine; N-(2-Thioacetophenono)isopropylamine; N-(Thiosalicylaldehydo) cyclohexylamine; N-(2-Thiophenecarboxaldehydo) cyclohexylamine; N-(2-Acetylthiopheno)cyclohexylamine; N-(2-Thioacetophenono)cyclohexylamine; N-(Thiosalicylaldehydo)aniline; N-(2-Thiophenecarboxaldehydo)aniline; N-(2-Acetylthiopheno)aniline; N-(2-Thioacetophenono) aniline; N-(Thiosalicylaldehydo)aminonorbornane; N-(2-Thiocarboxaldehydo)aminonorbornane; N-(2-Acetylthiopheno)aminonorbornane; N-(2-Thioacetophenono) aminonorbornane; 4-aminobenzylidene-3-propyl-5-mercapto-1,2,4-triazole; 4-aminocinnamalidene-3-propyl-5-mercapto-1,2,4-triazole (acpmt); 4-aminosalicylidene-3-propyl-5-mercapto-1,2,4-triazole (aspmt); 4-aminovanillidene-3-propyl-5-mercapto-1,2,4-triazole; 4-aminodimethylaminobenzylidene-3-propyl-5-mercapto-1,2,4-triazole (adpmt); cinnamylideneaminophenylthiazole; N-(2-mercaptophenyl)salicylidenimine; 2-thiophenecarboxaldehyde phenylhydrazone; 2-thiophenecarboxaldehyde 2-pyridyl hydrazone; 2-mercaptobenzaldehyde phenylhydrazone; and 2-mercaptobenzaldehyde 2-pyridyl hydrazone. Also includes SchiffBases derived from the reaction of carbonyl compounds with dithiocarbazates, and hydrazones with ortho-S substitution.

N—S Valence Stabilizer #25: Examples of Schiff Bases with two Imine (C═N) Groups and with ortho- or alpha- or beta-thio or mercapto or thiocarbonyl substitution (N—S Tridentates, N—S Tetradentates, N—S Pentadentates, or N—S Hexadentates) that meet the requirements for use as "wide band" valence stabilizers for $Co^{+3}$ include, but are not limited to: N,N'-(2,5-Thiophenedicarboxalehydo) diisopropylamine; N,N'-(2,5-Thiophenedicarboxaldehydo)dicyclohexylamine; N,N'-(2,5-Thiophenedicarboxaldehydo)dianiline; N,N'-(2,5-Thiophenedicarboxaldehydo)diaminonorbornane; N,N'-(o-Thiophthalicdialdehydo) diisopropylamine; N,N'-(o-Thiophthalicdialdehydo) dicyclohexylamine; N,N'-(o-Thiophthalicdialdehydo) dianiline; N,N'-(o-Thiophthalicdialdehydo)diaminonorbornane; N,N'-(o-Thioformylcamphoro) diisopropylamine; N,N'-(o-Thioformylcamphoro) dicyclohexylamine; N,N'-(o-Thioformylcamphoro) dianiline; N,N'-(o-Thioformylcamphoro)diaminonorbornane; N,N'-(o-Thiodiacetylbenzeno) diisopropylamine; N,N'-(o-Thiodiacetylbenzeno) dicyclohexylamine; N,N'-(o-Thiodiacetylbenzeno)dianiline; N,N'-(o-Thiodiacetylbenzeno)di-aminonorbornane; N,N'-(3,6-Dithio-1,2-cyclohexanono)diisopropylamine; N,N'-(3,6-Dithio-1,2-cyclohexanono)dicyclohexylamine; N,N'-(3,6-Dithio-1,2-cyclohexanono)dianiline; N,N'-(3,6-Dithio-1,2-cyclohexanono)di-aminonorbornane; N,N'-(2,5-Diacetylthiopheno)diisopropylamine; N,N'-(2,5-Diacetylthiopheno)dicyclohexylamine; N,N'-(2,5-Diacetylthiopheno)dianiline; N,N'-(2,5-Diacetylthiopheno) di-aminonorbornane; N,N'-(Thiosalicylaldehydo) ethylenediamine;N,N'-(o-Thionaphthaldehydo) ethylenediamine; N,N'-(o-Thioacetophenono) ethylenediamine; N,N'-(Thiosalicylaldehydo) trimethylenediamine; N,N'-(o-Thionaphthaldehydo) trimethylenediamine; N,N'-(o-Thioacetophenono) trimethylenediamine; N,N'-(Thiosalicylaldehydo) cyclohexane-1,2-diamine; N,N'-(o-Thionaphthaldehydo) cyclohexane-1,2-diamine; N,N'-(o-Thioacetophenono) cyclohexane-1,2-diamine; N,N'-(Thiosalicylaldehydo)-1,2-diaminobenzene; N,N'-(o-Thionaphthaldehydo)-1,2-diaminobenzene; and N,N'-(o-Thioacetophenono)-1,2-diaminobenzene. Also includes SchiffBases derived from the reaction of carbonyl compounds with dithiocarbazates, and hydrazones with ortho-S substitution.

N—S Valence Stabilizer #26: Examples of Schiff Bases with three Imine (C═N) Groups and with ortho- or alpha- or beta-thio or mercapto or thiocarbonyl substitution (N—S Tetradentates, N—S Pentadentates, or N—S Hexadentates) that meet the requirements for use as "wide band" valence stabilizers for $Co^{+3}$ include, but are not limited to: N,N',N"-(Thiosalicylaldehydo)tris(2-aminoethyl)amine; N,N',N"-(o-Thionaphthaldehydo)tris(2-aminoethyl)amine; and N,N',N"-(o-Thioacetophenono)tris(2-aminoethyl)amine. Also includes Schiff Bases derived from the reaction of carbonyl compounds with dithiocarbazates, and hydrazones with ortho-S substitution.

N—S Valence Stabilizer #27: Examples of thioalkyl amines (aminothiols or aminodisulfides) and thioalkyl imines (iminothiols or iminodisulfides) (N—S Bidentates, N—S Tridentates, N—S Tetradentates, and N—S Hexadentates) that meet the requirements for use as "wide band" valence stabilizers for $Co^{+3}$ include, but are not limited to: 2-mercapto-1-aminoethane; 2-methylmercapto-1-aminoethane; 3-mercapto-1-aminopropane; 1-mercapto-2-amino-2-methylpropane; 2-mercaptocyclohexylamine; 3-mercapto-2-aminonorbornane; 1,3-dimercapto-2-aminopropane; 1,5-dimercapto-3-aminopentane; 2,2'-diaminodiethyl sulfide; 3,3'-diaminodipropyl sulfide; 2,2'-diaminodicyclohexyl sulfide; 1,6-dimercapto-3,4-diaminohexane; 1,7-dimercapto-3,5-diaminoheptane; 1,6-diamino-3,4-dimercaptohexane; 1,7-diamino-3,5-dimercaptoheptane; tri(mercaptomethyl)amine; tri(2-mercaptoethyl)amine; dithiooxamide (rubeanic acid); 2,2'-diaminodiethyl disulfide; 3,3'-diaminodipropyl disulfide; 2,2'-diaminodicyclohexyl disulfide; 3-amino-1,5-pentanedithiodialdehyde; 3,4-diamino-1,6-hexanedithiodialdehyde; 3,5-diamino-1,7-heptanedithiodialdehyde; iminobisacetic acid; iminobispropionic acid; and bis(hydroxyethyl)aminoalkyl sulfide.

N—S Valence Stabilizer #28: Examples of thioaryl amines and thioaryl imines (N—S Bidentates, N—S Tridentates, N—S Tetradentates, and N—S Hexadentates) that meet the requirements for use as "wide band" valence stabilizers for $Co^{+3}$ include, but are not limited to: 2-aminothiophenol (2-aminobenzenethiol); 2-aminothiobenzoic acid (thioanthranilic acid); 2-aminothioanisole; 2-(methanamine)benzyl mercaptan [(2-aminomethyl)-alpha-toluenethiol] [(2-mercaptomethyl)-alpha-aminotoluene]; 1-amino-2-naphthalenethiol; 2-amino-1-naphthalenethiol; 2-amino-1-(methyldisulfido)benzene; 2,2'-di(aminomethyl)diphenylthioketone; di(2-amino)phenyl sulfide; di(2-amino)phenyl disulfide (di-ortho-aminophenyl disulfide (doapd); 1,3-di(2-amino)phenyl-2-mercaptopropane; 1,3-di(3-amino)phenyl-2-mercaptopropane; 1,3-di(2-mercapto)phenyl-2-aminopropane; 1,3-di(3-mercapto)phenyl-2-aminopropane; 2,2'-dimercaptoiminodibenzyl; 2,2'-iminodibenzothioic acid; 2,2'-dimercaptoiminostilbene; and poly(o-aminothiophenol).

N—S Valence Stabilizer #29: Examples of five-membered heterocyclic rings containing one, two, three, or four nitrogen atoms at least one additional sulfur atom binding site not in a ring (N—S Bidentates, N—S Tridentates, N—S Tetradentates, or N—S Hexadentates) that meet the requirements for use as "wide band" valence stabilizers for $Co^{+3}$ include, but are not limited to: 2-mercaptopyrrole; 2-(methylthio)methylpyrrole; 2,5-(thiomethyl)pyrrole; 2,5-(methylthiomethyl)pyrrole; 2,6-(methyldisulfidomethyl)pyrrole; imidazoline-2-thione (2-mercaptoimidazole); 2-mercaptothiazoline; 2-mercaptobenzimidazole; 2-mercaptobenzothiazole; 2-mercaptobenzoxazole; 2-thiohydantoin; di-2-pyridylthioglyoxal (2,2'-thiopyridil); bis((1-pyrazolyl) methane)sulfide; bis((1-pyrazolyl)methane)disulfide; bis(2-(1-pyrazolyl)ethane)sulfide; bis(2-(1-pyrazolyl)ethane) disulfide; bis(benzimidazolylmethane)sulfide; bis (benzimidazolylethane)sulfide; bis(benzimidazolylmethane) disulfide; bis(benzimidazolylethane)disulfide; tris (imidazolyl)methanethiol; tris(imidazolylmethane) methanethiol; N-thiomethyl-N,N-(benzimidazolylmethane) amine; N-(2-thioethyl)-N,N-(benzimidazolylmethane) amine; N,N'-di(benzimidazolylmethane)-1,3-diamino-2-mercaptopropane; N,N,N',N'-tetrakis (benzimidazolylmethane)-1,3-diamino-2-mercaptopropane; bis(N,N-((4-imidazolyl)methane)2-aminoethane)sulfide; bis (N,N-((4-imidazolyl)methane)2-aminoethane)disulfide; 2-aminobenzothiazole (abt); 2-phenylaminothiazole; thiohydantoin; thioxohydropyrazole; 2-mercaptobenzothiazole (mbt); 2-mercapto-1,3,4-thiadiazole; 2,5-dimercapto-1,3,4-thiadiazole (bismuthiol); 2,5-bis(alkylthio)-1,3,4-thiadiazole; 2-amino-5-mercapto-1,3,4-thiadiazole (amt); 5-mercaptotetrazole; 1-phenyl-5-mercaptotetrazole (pmt)(5-mptt); 5-mercaptotriazole; 3-mercaptotriazole; (2-benzothiazolyl) thioacetic acid; (2-benzothiazolyl)thiopropionic acid; (alkylthio)benzotriazoles; (arylthio)benzotriazoles; 2-mercapto-pyrimidine; bis(5-mercapto-1,2,4-triazol-3-yl); bis(5-mercapto-1,2,4-triazol-3-yl)alkanes; 2-aminothiazolidine; thiazolidine-2-thione; 2-mercaptothiazolidine; 1-(2-mercaptoethyl)imidazoline; imidazolidine-2-thione; 4,5-dihydroxyimidazolidine-2-thione; 4-amino-5-mercapto-1,2,4-triazole; (2-benzimidazolylthio)carboxylic acids; (2-benzoxazolylthio)carboxylic acids; (2-benzothiazolylthio)carboxylic acids; (2-benzimidazolylthio)hydroxyalkyl(aryl)s; (2-benzoxazolylthio)hydroxyalkyl(aryl)s; (2-benzothiazolylthio)hydroxyalkyl(aryl)s; 2-(phenylmethylthio)benzothiazole; 2,5-bis(hydrocarbyldithio)-1,3,4-thiadiazoles; 2-(hydrocarbyldithio)-5-mercapto-1,3,4-thiadiazoles; bis(dithiobisthiadiazole); benzothiazolethione; 3-hydrazino-5-thio-1,2,4-triazole; imidazolidine-2,4-dithione; dimercaptobenzothiazole; 2-aminothiazole (atz); thiadiazole-2-thione; 5-mercaptothiadiazole-2-thione; 1,1-thiocarbonyldiimidazole; phosphosphonomethylenethio-1,3-benzothiazole (pmtbt); 4,5-dihydroxyimidazolidine-2-thione; imidazolidine-2-thione; 1,1'-thiocarbonyldiimidazole; 2,2'-dithiobis(benzothiazole); and 5,5'-dithiobis(tetrazole).

N—S Valence Stabilizer #30: Examples of six-membered heterocyclic rings containing one, two, three, or four nitrogen atoms at least one additional sulfur atom binding site not in a ring (N—S Bidentates, N—S Tridentates, N—S Tetradentates, or N—S Hexadentates) that meet the requirements for use as "wide band" valence stabilizers for $Co^{+3}$ include, but are not limited to: 4-aminomethyl-3-pyridinemethanethiol (including thiopyridoxamine); 2-mercaptopyridine; 2-(methylthio)methylpyridine; 2-(2-(methylthio)ethyl)pyridine; 2,6-(thiomethyl)pyridine; 2,6-(methylthiomethyl)pyridine; 2,6-(methyldisulfidomethyl)pyridine; 2-mercaptopyrimidine; 2-dithiomethylpyrimidine; 2-mercaptoquinoline; 8-mercaptoquinoline (thioxine); 8-methylthioquinoline; 2-mercaptoquinazoline; thioorotic acid (1,2,3,6-tetrahydro-2,6-dithiono-4-pyrimidinecarboxylic acid) (6-thiouracilcarboxylic acid); 1-methylpyrimidine-2-thione; 2-thiouracil; 2,4-dithiouracil; 6-mercaptopurine; bis(N,N,N',N'-tetra(2-(2-pyridyl)ethane)aminomethane)sulfide; bis(N,N,N',N'-tetra(2-(2-pyridyl)ethane)aminomethane)disulfide; bis(N,N,N',N'-tetra(2-(2-pyridyl)ethane)aminoethane)sulfide; bis(N,N,N',N'-tetra(2-(2-pyridyl)ethane)aminoethane)disulfide; 1,3,5-triazine-6-thione; 2-benzylmercapto-1,3,5-triazine; triazine dithiols [i.e., 6-(phenylamino)-1,3,5-triazine-2,4-dithiol (ptd); 6-aniline-1,3,5-triazine-2,4-dithiol (atd); and 2-(N,N-dialkylamino)-1,3,5-triazine-4,6-dithiol]; 2-thioquinazoline; 2-thioquinazolin-4-one; thiomorpholin-3-thione; [2-(aminomethyl)thio]pyridine; 6-mercaptopurine; dithiouracil; and 2,2'-dithiodipyridine (2,2'-dipyridyl disulfide).

N—S Valence Stabilizer #31: Examples of five-membered heterocyclic rings containing one or two sulfur atoms at least one additional nitrogen atom binding site not in a ring (N—S Bidentates, N—S Tridentates, N—S Tetradentates, or N—S Hexadentates) that meet the requirements for use as "wide band" valence stabilizers for $Co^{+3}$ include, but are not limited to: 2-aminothiophene; 2,5-diaminothiophene; 2-aminomethylthiophene; 2,5-di(aminomethyl)thiophene; 2-aminobenzothiophene; and 2-iminothiolane.

N—S Valence Stabilizer #32: Examples of six-membered heterocyclic rings containing one or two sulfur atoms at least one additional nitrogen atom binding site not in a ring (N—S Bidentates, N—S Tridentates, N—S Tetradentates, or N—S Hexadentates) that meet the requirements for use as "wide band" valence stabilizers for $Co^{+3}$ include, but are not limited to: 2-aminothiopyran; 2,6-diaminothiopyran; 2-aminomethylthiopyran; 2,6-di(aminomethyl)thiopyran; and 2-aminobenzothiopyran.

N—S Valence Stabilizer #33: Examples of five-membered heterocyclic rings containing one, two, three, or four nitrogen atoms at least one additional sulfur atom binding site in a separate ring (N—S Bidentates, N—S Tridentates, N—S Tetradentates) that meet the requirements for use as "wide band" valence stabilizers for $Co^{+3}$ include, but are not limited to: 2-(2-thiophene)pyrrole; 2,5-di(2-thiophene)pyrrole; 2-(2-thiopyran)pyrrole; 2,5-di(2-thiopyran)pyrrole; 2,5-di(2-pyrrole)thiophene; 2,6-di(2-pyrrole)thiopyran; and 3,5-bis(2-thienyl)-4-amino-1,2,4-triazole (2-tat).

N—S Valence Stabilizer #34: Examples of six-membered heterocyclic rings containing one, two, three, or four nitrogen atoms at least one additional sulfur atom binding site in a separate ring (N—S Bidentates, N—S Tridentates, N—S Tetradentates) that meet the requirements for use as "wide band" valence stabilizers for $Co^{+3}$ include, but are not limited to: 2-(2-thiadiazolyl)benzimidazole; 2-(2-thiophene)pyridine; 2,6-di(2-thiophene)pyridine; 2-(2-thiopyran)pyridine; 2,6-di(2-thiopyran)pyridine; 2,5-di(2-pyridyl)thiophene; 2,6-di(2-pyridyl)thiopyran; and 2-(4-thiazolyl)benzimidazole.

N—S Valence Stabilizer #35: Examples of two-, three-, four-, six-, eight-, and ten-membered macrocyclics, macrobicyclics, and macropolycyclics (including catapinands, cryptands, cyclidenes, and sepulchrates) wherein all binding sites are composed of nitrogen (usually amine or imine groups) or sulfur (usually thiols, mercaptans, or thiocarbonyls) and are not contained in component heterocyclic rings (N—S Bidentates, N—S Tridentates, N—S Tetradentates, and N—S Hexadentates) that meet the requirements for use as "wide band" valence stabilizers for $Co^{+3}$ include, but are not limited to: azathiacyclobutane ([4]aneNS); azathiacyclopentane ([5]aneNS); azathiacyclohexane ([6]aneNS); azathiacycloheptane ([7]aneNS); azathiacyclooctane ([8]aneNS); azathiacyclobutene ([4]eneNS); azathiacyclopentene ([5]eneNS); azathiacyclohexene ([6]eneNS); azathiacycloheptene ([7]eneNS); azathiacyclooctene ([8]eneNS); azathiacyclobutadiene ([4]dieneNS); azathiacyclopentadiene ([5]dieneNS); azathiacyclohexadiene ([6]dieneNS); azathiacycloheptadiene ([7]dieneNS); azathiacyclooctadiene ([8]dieneNS); diazathiacyclohexane ([6]aneSN$_2$); diazathiacycloheptane ([7]aneSN$_2$); diazathiacyclooctane ([8]aneSN$_2$); diazathiacyclononane ([9]aneSN$_2$); diazathiacyclodecane ([10]aneSN$_2$); diazathiacycloundecane ([11]aneSN$_2$); diazathiacyclododecane ([12]aneSN$_2$); diazathiacyclohexene ([6]eneSN$_2$); diazathiacycloheptene ([7]eneSN$_2$); diazathiacyclooctene ([8]eneSN$_2$); diazathiacyclononene ([9]eneSN$_2$); diazathiacyclodecene ([10]eneSN$_2$); diazathiacycloundecene ([11]eneSN$_2$); diazathiacyclododecene ([12]eneSN$_2$); diazadithiacyclooctane ([8]aneS$_2$N$_2$); diazadithiacyclononane ([9]aneS$_2$N$_2$); diazadithiacyclodecane ([10]aneS$_2$N$_2$); diazadithiacycloundecane ([11]aneS$_2$N$_2$); diazadithiacyclododecane ([12]aneS$_2$N$_2$); diazadithiacyclotridecane ([13]aneS$_2$N$_2$); diazadithiacyclotetradecane ([14]aneS$_2$N$_2$); diazadithiacyclopentadecane ([15]aneS$_2$N$_2$); diazadithiacyclohexadecane ([16]aneS$_2$N$_2$); diazadithiacycloheptadecane ([17]aneS$_2$N$_2$); diazadithiacyclooctadecane ([18]aneS$_2$N$_2$); diazadithiacyclononadecane ([19]aneS$_2$N$_2$); diazadithiacycloeicosane ([20]aneS$_2$N$_2$); diazadithiacyclooctadiene ([8]dieneS$_2$N$_2$); diazadithiacyclononadiene ([9]dieneS$_2$N$_2$); diazadithiacyclodecadiene ([10]dieneS$_2$N$_2$); diazadithiacycloundecadiene ([11]dieneS$_2$N$_2$);

diazadithiacyclododecadiene ([12]diene$S_2N_2$); diazadithiacyclotridecadiene ([13]diene$S_2N_2$); diazadithiacyclotetradecadiene ([14]diene$S_2N_2$); diazadithiacyclopentadecadiene ([15]diene$S_2N_2$); diazadithiacyclohexadecadiene ([16]diene$S_2N_2$); diazadithiacycloheptadecadiene ([17]diene$S_2N_2$); diazadithiacyclooctadecadiene ([18]diene$S_2N_2$); diazadithiacyclononadecadiene ([19]diene$S_2N_2$); diazadithiacycloeicosadiene ([20]diene$S_2N_2$); and tetramethyldithiahexaazacyclobidecanehexaene (mtab).

N—S Valence Stabilizer #36: Examples of four-, six-, eight-, or ten-membered macrocyclics, macrobicyclics, and macropolycyclics (including catapinands, cryptands, cyclidenes, and sepulchrates) wherein all binding sites are composed of nitrogen or sulfur and are contained in component heterocyclic rings (N—S Bidentates, N—S Tridentates, N—S Tetradentates, or N—S Hexadentates) that meet the requirements for use as "wide band" valence stabilizers for $Co^{+3}$ include, but are not limited to: dithiopyrandipyridines; dithiophenedipyrroles; trithiopyrantripyridines; trithiophenetripyrroles; tetrathiopyrantetrapyridines; and tetrathiophenetetrapyrroles.

N—S Valence Stabilizer #37: Examples of four-, six-, eight-, or ten-membered macrocyclics, macrobicyclics, and macropolycyclics (including catapinands, cryptands, cyclidenes, and sepulchrates) wherein all binding sites are composed of nitrogen or sulfur and are contained in a combination of heterocyclic rings and amine, imine, thiol, mercapto, or thiocarbonyl groups (N—S Bidentates, N—S Tridentates, N—S Tetradentates, or N—S Hexadentates) that meet the requirements for use as "wide band" valence stabilizers for $Co^{+3}$ include, but are not limited to: azathiatetraphyrins; diazadithiatetraphyrins; azathiahexaphyrins; diazadithiahexaphyrins; and triazatrithiahexaphyrins.

N—O Valence Stabilizer #1: Examples of N-hydroxy(or N,N'-dihydroxy)amidines and N-hydroxy(or N,N'-dihydroxy)diamidines (N—O bidentates, N—O tridentates, or N—O tetradentates) that meet the requirements for use as "wide band" valence stabilizers for $Co^{+3}$ include, but are not limited to: N-hydroxy-N,N'-dimethylformamidine; N-hydroxy-N,N'-diethylformamidine; N-hydroxy-N,N'-diisopropylformamidine;N-hydroxy-N,N'-dibutylformamidine; N-hydroxy-N,N'-diphenylformamidine; N-hydroxy-N,N'-dibenzylformamidine; N-hydroxy-N,N'-dinaphthylformamidine; N-hydroxy-N,N'-dicyclohexylformamidine; N-hydroxy-N,N'-dinorbornylformamidine; N-hydroxy-N,N'-diadamantylformamidine; N-hydroxy-N,N'-dianthraquinonylformamidine; N-hydroxy-N,N'-dimethylacetamidine; N-hydroxy-N,N'-diethylacetamidine; N-hydroxy-N,N'-diisopropylacetamidine; N-hydroxy-N,N'-dibutylacetamidine; N-hydroxy-N,N'-diphenylacetamidine; N-hydroxy-N,N'-dibenzylacetamidine; N-hydroxy-N,N'-dinaphthylacetamidine; N-hydroxy-N,N'-dicyclohexylacetamidine; N-hydroxy-N,N'-dinorbornylacetamidine; N-hydroxy-N,N'-diadamantylacetamidine; N-hydroxy-N,N'-dimethylbenzamidine; N-hydroxy-N,N'-diethylbenzamidine; N-hydroxy-N,N'-diisopropylbenzamidine; N-hydroxy-N,N'-dibutylbenzamidine; N-hydroxy-N,N'-diphenylbenzamidine; N-hydroxy-N,N'-dibenzylbenzamidine; N-hydroxy-N,N'-dinaphthylbenzamidine; N-hydroxy-N,N'-dicyclohexylbenzamidine; N-hydroxy-N,N'-dinorbornylbenzamidine; N-hydroxy-N,N'-diadamantylbenzamidine; N-hydroxy-N,N'-dimethyltoluamidine; N-hydroxy-N,N'-diethyltoluamidine; N-hydroxy-N,N'-diisopropyltoluamidine; N-hydroxy-N,N'-dibutyltoluamidine; N-hydroxy-N,N'-diphenyltoluamidine; N-hydroxy-N,N'-dibenzyltoluamidine; N-hydroxy-N,N'-dinaphthyltoluamidine; N-hydroxy-N,N'-dicyclohexyltoluamidine; N-hydroxy-N,N'-dinorbornyltoluamidine; N-hydroxy-N,N'-diadamantyltoluamidine; N,N-dihydroxyoxalic diamidine; N,N'-dihydroxymalonic diamidine; N,N'-dihydroxysuccinic diamidine; N,N'-dihydroxyglutaric diamidine; N,N'-dihydroxyadipic diamidine; N,N'-dihydroxypimelic diamidine; N,N'-dihydroxysuberic diamidine; N,N'-dihydroxyphthalic diamidine; N,N'-dihydroxyterephthalic diamidine; N,N'-dihydroxyisophthalic diamidine; N,N'-dihydroxypiperazine diamidine.

N—O Valence Stabilizer #2: Examples of guanylureas, guanidinoureas, bis(guanylureas), bis(guanidinoureas), poly(guanylureas), and poly(guanidinoureas) (N—O Bidentates and N—O Tetradentates) that meet the requirements for use as "wide band" valence stabilizers for $Co^{+3}$ include, but are not limited to: guanylurea (amidinourea)(dicyandiamidine); guanidinourea; methylguanylurea; ethylguanylurea; isopropylguanylurea; butylguanylurea; benzylguanylurea; phenylguanylurea; tolylguanylurea; naphthylguanylurea; cyclohexylguanylurea; norbornylguanylurea; adamantylguanylurea; dimethylguanylurea; diethylguanylurea; diisopropylguanylurea; dibutylguanylurea; dibenzylguanylurea; diphenylguanylurea; ditolylguanylurea; dinaphthylguanylurea; dicyclohexylguanylurea; dinorbornylguanylurea; diadamantylguanylurea; ethylenebis(guanylurea); propylenebis(guanylurea); phenylenebis(guanylurea); piperazinebis(guanylurea); oxalylbis(guanylurea); malonylbis(guanylurea); succinylbis(guanylurea); phthalylbis(guanylurea); 2-ureidothiazole; 2-ureidooxazole; 2-ureidoimidazole; 3-ureidopyrazole; 3-ureido-1,2,4-triazole; and 5-ureidotetrazole.

N—O Valence Stabilizer #3: Examples of amidinoamides, guanidinoamides, bis(amidinoamides), bis(guanidinoamides), poly(amidinoamides), and poly(guanidinoamides) (including both N-amidinoamides and 2-amidinoacetamides) (N—O Bidentates, N—O Tridentates, and N—O Tetradentates) that meet the requirements for use as "wide band" valence stabilizers for $Co^{+3}$ include, but are not limited to: amidinoacetamide (1-acetylguanidine); guanidinoacetamide; amidinopropanamide; amidinobutanamide; amidinobenzamide; amidinotoluamide; amidinocyclohexamide; N-methylamidinoacetamide; N-ethylamidinopropanamide; N-propylamidinobutanamide; N-phenylamidinobenzamide; N-tolylamidinotoluamide; N-cyclohexylamidinocyclohexamide; bis(amidinooxamide); bis(amidinomalonamide); bis(amidinosuccinamide); bis(amidinophthalamide); 2-amidinoacetamide (malonamamidine); N-methyl-2-amidinoacetamide; N-ethyl-2-amidinoacetamide; N-phenyl-2-amidinoacetamide; N-benzyl-2-amidinoacetamide; N-cyclohexyl-2-amidinoacetamide; N,N'-dimethyl-2-amidinoacetamide; N,N'-diethyl-2-amidinoacetamide; N,N'-diphenyl-2-amidinoacetamide; N,N'-dibenzyl-2-amidinoacetamide; N,N'-dicyclohexyl-2-amidinoacetamide; 2-N-acylaminothiazole; 2-N-acylaminooxazole; 2-N-acylaminoimidazole; 3-N-acylaminopyrazole; 3-N-acylamino-1,2,4-triazole; and 5-N-acylaminotetrazole.

N—O Valence Stabilizer #4: Examples of imidoylamides, bis(imidoylamides), and poly(imidoylamides) (N—O Bidentates, N—O Tridentates, and N—O Tetradentates) that meet the requirements for use as "wide band" valence stabilizers for $Co^{+3}$ include, but are not limited to: acetimidoylacetamide; acetimidoylpropanamide; acetimidoylbutanamide; acetimidoylbenzamide; acetimidolytoluamide; acetimidoylcyclohexamide; propimidoylpropanamide; butimidoylbutanamide; benzimidoylbenzamide; ethylenebis(acetimidoylacetamide); propylenebis(acetimidoylacetamide); and phenylenebis(acetimidoylacetamide).

N—O Valence Stabilizer #5: Examples of O-amidinocarbamates, bis(O-amidinocarbamates), and poly(O-amidinocarbamates) (N—O Bidentates and N—O Tetradentates) that meet the requirements for use as "wide band" valence stabilizers for $Co^{+3}$ include, but are not limited to: O-amidinocarbamate; N-methyl-O-amidinocarbamate; N-ethyl-O-amidinocarbamate; N-isopropyl-O-amidinocarbamate; N-butyl-O-amidinocarbamate; N-benzyl-O-amidinocarbamate; N-phenyl-O-amidinocarbamate; N-tolyl-O-amidinocarbamate; N-naphthyl-O-amidinocarbamate; N-cyclohexyl-O-amidinocarbamate; N-norbornyl-O-amidinocarbamate; N-adamantyl-O-amidinocarbamate; N,N'-dimethyl-O-amidinocarbamate; N,N'-diethyl-O-amidinocarbamate; N,N'-diisopropyl-O-amidinocarbamate; N,N'-dibutyl-O-amidinocarbamate; N,N'-dibenzyl-O-amidinocarbamate; N,N'-diphenyl-O-amidinocarbamate; N,N'-ditolyl-O-amidinocarbamate; N,N'-dinaphthyl-O-amidinocarbamate; N,N'-dicyclohexyl-O-amidinocarbamate; N,N'-dinorbornyl-O-amidinocarbamate; N,N'-diadamantyl-O-amidinocarbamate; ethylenebis(O-amidinocarbamate); propylenebis(O-amidinocarbamate); phenylenebis(O-amidinocarbamate); piperazinebis(O-amidinocarbamate); oxalylbis(O-amidinocarbamate); malonylbis(O-amidinocarbamate); succinylbis(O-amidinocarbamate); phthalylbis(O-amidinocarbamate); 2-O-carbamatothiazole; 2-O-carbamatooxazole; 2-O-carbamatoimidazole; 3-O-carbamatopyrazole; 3-O-carbamato-1,2,4-triazole; and 5-carbamatotetrazole.

N—O Valence Stabilizer #6: Examples of S-amidinothiocarbamates, bis(S-amidinothiocarbamates), and poly(S-amidinothiocarbamates) (N-O Bidentates and N-O Tetradentates) that meet the requirements for use as "wide band" valence stabilizers for $Co^{+3}$ include, but are not limited to: S-amidinothiocarbamate; N-methyl-S-amidinothiocarbamate; N-ethyl-S-amidinothiocarbamate; N-isopropyl-S-amidinothiocarbamate; N-butyl-S-amidinothiocarbamate; N-benzyl-S-amidinothiocarbamate; N-phenyl-S-amidinothiocarbamate; N-tolyl-S-amidinothiocarbamate; N-naphthyl-S-amidinothiocarbamate; N-cyclohexyl-S-amidinothiocarbamate; N-norbornyl-S-amidinothiocarbamate; N-adamantyl-S-amidinothiocarbamate; N,N'-dimethyl-S-amidinothiocarbamate; N,N'-diethyl-S-amidinothiocarbamate; N,N'-diisopropyl-S-amidinothiocarbamate; N,N'-dibutyl-S-amidinothiocarbamate; N,N'-dibenzyl-S-amidinothiocarbamate; N,N'-diphenyl-S-amidinothiocarbamate; N,N'-ditolyl-S-amidinothiocarbamate; N,N'-dinaphthyl-S-amidinothiocarbamate; N,N'-dicyclohexyl-S-amidinothiocarbamate; N,N'-dinorbornyl-S-amidinothiocarbamate; N,N'-diadamantyl-S-amidinothiocarbamate; ethylenebis(S-amidinothiocarbamate); propylenebis(S-amidinothiocarbamate); phenylenebis(S-amidinothiocarbamate); piperazinebis(S-amidinothiocarbamate); oxalylbis(S-amidinothiocarbamate); malonylbis(S-amidinothiocarbamate); succinylbis(S-amidinothiocarbamate); phthalylbis(S-amidinothiocarbamate); 2-O-monothiocarbamatothiazole; 2-O-monothiocarbamatooxazole; 2-O-monothiocarbamatoimidazole; 3-O-monothiocarbamatopyrazole; 3-O-monothiocarbamato-1,2,4-triazole; and 5-O-monothiocarbamatotetrazole.

N—O Valence Stabilizer #7: Examples of diimidosulfuric acid, bis(diimidosulfuric acid), and derivatives thereof (N—O Bidentates and N—O Tetradentates) that meet the requirements for use as "wide band" valence stabilizers for $Co^{+3}$ include, but are not limited to: diimidosulfuric acid; O-phenyldiimidosulfuric acid; O-benzyldiimidosulfuric acid, O-cyclohexyldiimidosulfuric acid, O-norbornyldiimidosulfuric acid, O,O'-diphenyldiimidosulfuric acid; O,O'-dibenzyldiimidosulfuric acid, O,O'-dicyclohexyldiimidosulfuric acid, and O,O'-dinorbornyldiimidosulfuric acid.

N—O Valence Stabilizer #8: Examples of phosphorimidic acid, bis(phosphorimidic acid); and poly(phosphorimidic acid), and derivatives thereof (N—O Bidentates, N—O Tetradentates) that meet the requirements for use as "wide band" valence stabilizers for Co#$^{3}$ include, but are not limited to: phosphorimidic acid; O-phenylphosphorimidic acid; O-benzylphosphorimidic acid; O-cyclohexylphosphorimidic acid; O-norbornylphosphorimidic acid; O,O'-diphenylphosphorimidic acid; O,O'-dibenzylphosphorimidic acid; O,O'-dicyclohexylphosphorimidic acid; and O,O'-dinorbornylphosphorimidic acid.

N—O Valence Stabilizer #9: Examples of phosphoric triamides, bis(phosphoric triamides), and poly(phosphoric triamides) (N—O Bidentates and N—O Tetradentates) that meet the requirements for use as "wide band" valence stabilizers for $Co^{+3}$ include, but are not limited to: phosphoric triamide; phosphoramidic dihydrazide; N-phenylphosphoric triamide, N-benzylphosphoric triamide; N-cyclohexylphosphoric triamide; N-norbornylphosphoric triamide; N,N'-diphenylphosphoric triamide, N,N'-dibenzylphosphoric triamide; N,N'-dicyclohexylphosphoric triamide; and N,N'-dinorbornylphosphoric triamide.

N—O Valence Stabilizer #10: Examples of phosphoramidic acid, phosphorodiamidic acid, bis(phosphoramidic acid), bis(phosphorodiamidic acid), poly(phosphoramidic acid), poly(phosphorodiamidic acid), and derivatives thereof (N—O Bidentates and N—O Tetradentates) that meet the requirements for use as "wide band" valence stabilizers for $Co^{+3}$ include, but are not limited to: phosphoramidic acid, phosphorodiamidic acid, phosphoramidohydrazidic acid; phosphorohydrazidic acid; phosphorodihydrazidic acid; O-phenylphosphoramidic acid; O-benzylphosphoramidic acid; O-cyclohexylphosphoramidic acid; O-norbornylphosphoramidic acid; O,O'-diphenylphosphoramidic acid; O,O'-dibenzylphosphoramidic acid; O,O'-dicyclohexylphosphoramidic acid; and O,O'-dinorbornylphosphoramidic acid.

N—O Valence Stabilizer #11: Examples of N-acyl 7-aminobenzylidenimines (N—O Bidentates or N—O Tetradentates) that meet the requirements for use as "wide band" valence stabilizers for $Co^{+3}$ include, but are not limited to: N-acetyl 7-methylaminobenzylidenimine; N-acetyl 7-phenylaminobenzylidenimine; N-benzoyl 7-methylaminobenzylidenimine; and N-benzoyl 7-phenylaminobenzylidenimine.

N—O Valence Stabilizer #12: Examples of oximes, dioximes, and poly(oximes) (N—O Bidentates, N—O Tridentates, and N—O Tetradentates) that meet the requirements for use as "wide band" valence stabilizers for $Co^{+3}$ include, but are not limited to: acetaldoxime (Hado); acetoxime (acetone oxime)(Hato); butanone oxime; pentanone oxime; hexanone oxime; pinacolone oxime; heptanone oxime; octanone oxime; cyclopentanone oxime; cyclohexanone oxime; cycloheptanone oxime; cyclooctanone oxime; cyclopentanedione dioxime; cyclohexanedione dioxime; cycloheptanedione dioxime; cyclooctanedione dioxime; isatin dioxime; benzaldehyde oxime; naphthaldehyde oxime; norbornanone oxime; camphor oxime; dimethylglyoxime ($H_2DMG$); diethylglyoxime; diisopropylglyoxime; ditertbutylglyoxime; dicyanoglyoxime; dicyanamidoglyoxime; diphenylglyoxime (Hdfg); dibenzylglyoxime; dicyclohexylglyoxime; dinorbornylglyoxime; camphorquinone dioxime (Hcqd); nopinoquinone dioxime (Hnqd); butyraldoxime; propionaldoxime; furildioxime; and thienyldioxime.

N—O Valence Stabilizer #13: Examples of carbonyl oximes, bis(carbonyl oximes), and poly(carbonyl oximes) (N—O Bidentates, N—O Tridentates, and N—O Tetradentates) that meet the requirements for use as "wide band" valence stabilizers for $Co^{+3}$ include, but are not limited to: diacetyl monoxime (2,3-butanedione monoxime); benzil monoxime (1,2-diphenylethanedione monoxime); 1,2-dicyclohexylethanedionemonoxime; 1,2-(trifluoromethyl) ethanedionemonoxime; 1,2-dinorbornylethanedione monoxime; cyclopentanedione monoxime; cyclohexanedione monoxime; cycloheptanedione monoxime; cyclooctanedione monoxime; camphorquinone oxime; 3-hydroxyiminopentane-2,4-dione; and 4-isonitrosopyralozone.

N—O Valence Stabilizer #14: Examples of imine oximes, bis(imine oximes), and poly(imine oximes) (including 2-nitrogen heterocyclic oximes) (N—O Bidentates, N—O Tridentates, N—O Tetradentates, and N—O Hexadentates) that meet the requirements for use as "wide band" valence stabilizers for $Co^{+3}$ include, but are not limited to: 3-(methylimino)butan-2-one oxime; 4-(methylimino)hexan-3-one oxime; 1,2-diphenyl-2-(methylimino)ethan-1-one oxime; 1,2-diphenyl-2-(phenylimino)ethan-1-one oxime; 1,2-dicyclohexyl-2-(methylimino)ethan-1-one oxime; 1,2-dicyclohexyl-2-(cyclohexylimino)ethan-1-one oxime; 1,2-dinorbornyl-2-(methylimino)ethan-1-one oxime; N,N'-methylenebis-(3-iminobutan-2-one oxime); N,N'-methylenebis-(4-iminohexan-3-one oxime); N,N'-methylenebis-(1,2-diphenyl-2-iminoethan-1-one oxime); N,N'-methylenebis-(1,2-dicyclohexyl-2-iminoethan-1-one oxime); N,N'-methylenebis-(1,2-dinorbornyl-2-iminoethan-1-one oxime); N,N'-ethylenebis-(3-iminobutan-2-one oxime); N,N'-ethylenebis-(4-iminohexan-3-one oxime); N,N'-ethylenebis-(1,2-diphenyl-2-iminoethan-1-one oxime); N,N'-ethylenebis-(1,2-dicyclohexyl-2-iminoethan-1-one oxime); N,N'-ethylenebis-(1,2-dinorbornyl-2-iminoethan-1-one oxime); N,N'-propylenebis-(3-iminobutan-2-one oxime); N,N'-propylenebis-(4-iminohexan-3-one oxime); N,N'-propylenebis-(1,2-diphenyl-2-iminoethan-1-one oxime); N,N'-propylenebis-(1,2-dicyclohexyl-2-iminoethan-1-one oxime); N,N'-propylenebis-(1,2-dinorbornyl-2-iminoethan-1-one oxime); diacetylazine oxime (Hazio); 2-pyridinaldoxime (Hpao); methyl 2-pyridyl ketone oxime; ethyl 2-pyridyl ketoxime; phenyl 2-pyridyl ketone oxime (Hppk); benzyl 2-pyridyl ketoxime; di(2-pyridyl) ketone oxime; methyl 2-pyrrolyl ketone oxime; ethyl 2-pyrrolyl ketone oxime; phenyl 2-pyrrolyl ketone oxime; di(2-pyrrolyl) ketone oxime; and tris(2-aldoximo-6-pyridyl)phosphine.

N—O Valence Stabilizer #15: Examples of hydroxy oximes, bis(hydroxy oximes), and poly(hydroxy oximes) (including 2-oxygen heterocyclic oximes) (N—O Bidentates, N—O Tridentates, N—O Tetradentates, and N—O Hexadentates) that meet the requirements for use as "wide band" valence stabilizers for $Co^{+3}$ include, but are not limited to: 3-hydroxybutan-2-one oxime; 4-hydroxyhexan-3-one oxime; benzoin oxime (bo)(1,2-diphenyl-2-hydroxyethanone oxime); 1,2-di(trifluoromethyl)-2-hydroxyethanone oxime; 1,2-dicyclohexyl-2-hydroxyethanone oxime; 1,2-dinorbornyl-2-hydroxyethanone oxime; salicylaldoxime (so)(saldox); 2-hydroxy-1-naphthaldehyde oxime; 2-furanaldoxime; furildioxime; methyl 2-furanyl ketone oxime; ethyl 2-furanyl ketoxime; phenyl 2-furanyl ketone oxime; benzyl 2-furanyl ketoxime; di(2-furanyl) ketone oxime; and 2,5-(oximinomethyl)phenol.

N—O Valence Stabilizer #16: Examples of amino oximes, bis(amino oximes), and poly(amino oximes) (N—O Bidentates, N—O Tridentates, N—O Tetradentates, and N—O Hexadentates) that meet the requirements for use as "wide band" valence stabilizers for $Co^{+3}$ include, but are not limited to: 3-(methylamino)butan-2-one oxime (HMeabo); 4-(methylamino)hexan-3-one oxime (HEtabo); 1,2-diphenyl-2-(methylamino)ethanone oxime (HPhabo); 1,2-diphenyl-2-(phenylamino)ethanone oxime; 1,2-dicyclohexyl-2-(methylamino)ethanone oxime (HcyHxabo); 1,2-dicyclohexyl-2-(cyclohexylamino)ethanoneoxime; 1,2-di(trifluoromethyl)-2-(methylamino)ethanoneoxime; 1,2-dinorbornyl-2-(methylamino)ethanone oxime (HNorbabo); N,N'-ethylenebis-(3-aminobutan-2-one oxime)(Haboen); N,N'-ethylenebis-(4-aminohexan-3-one oxime); N,N'-ethylenebis-(1,2-diphenyl-2-aminoethanone oxime); N,N'-ethylenebis-(1,2-dicyclohexyl-2-aminoethanone oxime); N,N'-ethylenebis-(1,2-di(trifluoromethyl)-2-aminoethanone oxime); N,N'-ethylenebis-(1,2-dinorbornyl-2-aminoethanone oxime); N,N'-propylenebis-(3-aminobutan-2-one oxime)(Habopn); N,N'-propylenebis-(4-aminohexan-3-one oxime); N,N'-propylenebis-(1,2-diphenyl-2-aminoethanone oxime); N,N'-propylenebis-(1,2-dicyclohexyl-2-aminoethanone oxime); N,N'-propylenebis-(1,2-di(trifluoromethyl)-2-aminoethanone oxime); N,N'-propylenebis-(1,2-dinorbornyl-2-aminoethanone oxime); 2,2'-iminobis(acetamidoxime); 1-diethylamino-3-butanoxime; and di-2-pyridyl ketone oxime.

N—O Valence Stabilizer #17: Examples of amido oximes, bis(amido oximes), and poly(amido oximes) (N—O Bidentates, N—O Tridentates, N—O Tetradentates, and N—O Hexadentates) that meet the requirements for use as "wide band" valence stabilizers for $Co^{+3}$ include, but are not limited to: formamide oxime; acetamide oxime; propanamide oxime; butanamide oxime; benzamide oxime (Hbamox); naphthamide oxime; diformamide dioxime; salicylamide oxime; and 4-imidazolamide oxime.

N—O Valence Stabilizer #18: Examples of azo oximes, bis(azo oximes), and poly(azo oximes) (N—O Bidentates, N—O Tridentates, N—O Tetradentates, and N—O Hexadentates) that meet the requirements for use as "wide band" valence stabilizers for $Co^{+3}$ include, but are not limited to: acetaldehyde phenylhydrazone oxime; propionaldehyde phenylhydrazone oxime; and benzaldehyde phenylhydrazone oxime. Also includes hydrazone oximes.

N—O Valence Stabilizer #19: Examples of 2-nitrosophenols (o-quinone monoximes) (N—O Bidentates) that meet the requirements for use as "wide band" valence stabilizers for $Co^{+3}$ include, but are not limited to: 2-nitrosophenol; 1-nitroso-2-naphthol (Honn); 2-nitroso-1-naphthol (Htnn); 3-nitrosopyrocatechol; 3,6-dinitrosopyrocatechol; 2-nitrosoresorcinol; 2,4-dinitrosoresorcinol; 2,4,6-trinitrosoresorcinol;

2-nitrosohydroquinone; 2,6-dinitrosohydroquinone; 2,3,5,6-tetranitrosohydroquinone; 4-nitrosopyrogallol; 4,6-dinitrosopyrogallol; 2-nitrosophloroglucinol; 2,4,6-trinitrosophloroglucinol; 7-nitroso-6-hydroxyindazole; Pigment Green 12 (C.I. 10020); Naphthol Green; and nitroso-R-salt.

N—O Valence Stabilizer #20: Examples of 2-nitrophenols (N—O Bidentates) that meet the requirements for use as "wide band" valence stabilizers for $Co^{+3}$ include, but are not limited to: 2-nitrophenol; 2,3-dinitrophenol; 2,4-dinitrophenol; 2,5-dinitrophenol; 2,6-dinitrophenol; 2,4,6-trinitrophenol (picric acid); 2-amino-4,6-dinitrophenol (picramic acid); 1-nitro-2-naphthol; 2-nitro-1-naphthol; 3-nitropyrocatechol; 3,6-dinitropyrocatechol; 2-nitroresorcinol; 2,4-dinitroresorcinol; 2,4,6-trinitroresorcinol (styphnic acid); 2-nitrohydroquinone; 2,6-dinitrohydroquinone; 2,3,5,6-tetranitrohydroquinone; 4-nitropyrogallol; 4,6-dinitropyrogallol; 2-nitrophloroglucinol; 2,4,6-trinitrophloroglucinol; dinitrocresol; 7-nitro-6-hydroxyindazole; Dinoseb; Eosin; Naphthol Yellow; and Martius Yellow.

N—O Valence Stabilizer #21: Examples ofbydroxamates (hydroxylamines), bis(hydroxamates), and poly(hydroxamates) (N—O Bidentates, N—O Tetradentates, and N—O Hexadentates) that meet the requirements for use as "wide band" valence stabilizers for $Co^{+3}$ include, but are not limited to: acetohydroxamic acid; propianohydroxamic acid; butyrohydroxamic acid; crotonohydroxamic acid; sorbohydroxamic acid; benzohydroxamic acid ($BH_2$); toluichydroxamic acid; salicylhydroxamic acid ($SH_2$); phenylacetohydroxamic acid ($PhH_2$); anthranilhydroxamic acid ($AnH_2$); nicotinehydroxamic acid ($NiCH_2$); picolinehydroxamic acid; cyclohexanehydroxamic acid ($CH_2$); quinoline 8-hydroxamic acid ($QH_2$); cinnamylhydroxamic acid ($CnH_2$); oxaldihydroxamic acid ($OxalH_2$); succinylbis-N-phenylhydroxamic acid ($SuH_2$); adipylbis-N-phenylhydroxamic acid ($AdH_2$); glyoxalhydroxamic acid ($GH_2$); 2-thiophenecarbohydroxamic acid; thenoylhydroxamic acid; N-phenylbenzohydroxamic acid; N-tolylbenzohydroxamic acid; N-phenylacetohydroxamic acid; N-phenyl-2-thenoylhydroxamic acid; N-tolyl-2-tbenoylhydroxamic acid; and polyhydroxamic acids.

N—O Valence Stabilizer #22: Examples of N-nitrosohydroxylamines, bis(N-nitrosohydroxylamines), and poly(N-nitrosohydroxylamines) (N—O Bidentates, N—O Tetradentates, and N—O Hexadentates) that meet the requirements for use as "wide band" valence stabilizers for $Co^{+3}$ include, but are not limited to: N-nitrosophenylhydroxylamine (cupferron); N-nitrosonaphthylhydroxylamine (neocupferron); N-nitrosoanthracylhydroxylamine; N-nitroso(2-pyridyl)hydroxylamine; and N-nitroso(2-thiophenyl)hydroxylamine.

N—O Valence Stabilizer #23: Examples of amino acids, ortho-aminocarboxylic acids, peptides, polypeptides, and proteins [N—O Bidentates, N—O Tridentates, and N—O Tetradentates; possibly S—O dentates for sulfur-contg. examples such as penicillamine and cystine] that meet the requirements for use as "wide band" valence stabilizers for $Co^{+3}$ include, but are not limited to: alanine (Ala); arginine (Arg); asparagine (Asn); aspartic acid (Asp); cysteine (Cys); cystine (Cys or Cys.Cys); dihydroxyphenylalanine (Dopa); glutamic acid (Glu); glutamine (Gin); glycine (Gly); histidine (His); isoleucine (Ile); leucine (Leu); lysine (Lys); methionine (Met); penicillamine (Pen); phenylalanine (Phe); tolylalanine (tala); proline (Pro); sarcosine; serine (Ser); threonine (Thr); tryptophan (Trp); tyrosine (Tyr); and valine (Val) as amino acid examples; 2-pyridinecarboxylic acid (picolinic acid), 2-pyrazinecarboxylic acid, 2,3-dicarboxypyrazine, and anthranilic acid as ortho-aminocarboxylic acid examples; Gly-GluO; Hgly-Gly; Gly-MetO; Met-GlyO; Gly-TyrO; Ala-H is O; Gly-His-GlyO; Gly-Gly-His; Gly-Leu-TyrO; penta-GlyO; His-His; triaminoisobutyrate; tetra-GlyO; Pro-Gly; and Gly-Met as peptide examples; and azurin, carbonic anhydrase C; carboxypeptidase; concanavalin A; cytochrome b; cytochrome c; erythrocruorin; ferredoxin; haemerythrin; haemoglobin; myoglobin; parvalbumin; albumin; plastocyanin; rubredoxin; superoxide dismutase; thermolysin; and trysin as protein examples; N-acylamino acids; aminocaproic acid; and 3,5-diiodotyrosine.

N—O Valence Stabilizer #24: Examples of amides, bis(amides), and poly(amides), including lactams (N—O bidentates, N—O tridentates, and N—O tetradentates) that meet the requirements for use as "narrow band" valence stabilizers for $Co^{+3}$ include, but are not limited to: acetamide; propionamide; butanamide; benzamide (benzoylamide)(1-phenylformamide); 1-naphthylformamide; toluamide; 1-cyclohexylformamide); 1-norbornylformamide; 1-adamantylformamide; N,N-dimethylformamide (DMF) (DMFA); N,N-dimethylacetamide (DMAC); N,N-dimethylbenzamide; N,N-diethylformamide; N,N-diethylacetamide; decanamide; dodecanamide; tetradecanamide; hexadecanamide; octadecanamide; lactobionic acid amide; (hydroxyalkylthio)succinamides; (mercaptoalkoxy)succinamides; polycaproamides; glycinamide; aminoalkylanilides; amidopolyamines (apa); bis(1-phenylethylamide); oxalic semiamide; malonic semiamide; succinic semiamide; bis(1,1'-benzotriazolyl)dicarboxamide; nicotinamide; acetanilide (N-phenylacetamide); formanilide (N-phenylformamide); benzanilide (N-phenylbenzamide); N-methylformanilide; acetanilide; nicotinanilide; 4'-hydroxyacetanilide (acetaminophen); 2-pyrrolidone; methyl-2-pyrrolidone (NMP); 2-piperidone (valerolactam); caprolactam; polymethylenepolyamine dipropionamide; polyacrylamides; polypyrrolidones [including polyvinylpyrrolidone (povidone)(PVP)]; pyrazolidinones; pyrazolones; diazepinones; N-alkylazaalkene lactams; and N-(2-hydroxyalkyl)azaalkene lactams.

N—O Valence Stabilizer #25: Examples of semicarbazones, bis(semicarbazones), and poly(semicarbazones) (N—O Bidentates, N—O Tetradentates, and N—O Hexadentates) that meet the requirements for use as "wide band" valence stabilizers for $Co^{+3}$ include, but are not limited to: acetaldehyde semicarbazone; acetone semicarbazone; pinacolone semicarbazone; benzaldehyde semicarbazone; naphthaldehyde semicarbazone; norbornanone semicarbazone; camphor semicarbazone; nopinone semicarbazone; 2-pyridinaldehyde semicarbazone; salicylaldehyde semicarbazone; quinolinaldehyde semicarbazone; isatin disemicarbazone; camphorquinone disemicarbazone; camphorquinone disemicarbazone; picolinaldehyde semicarbazone; dipyridyl glyoxal disemicarbazone; di-2-pyridyl ketone semicarbazone; methyl-2-pyridyl ketone semicarbazone; glyoxal disemicarbazone; acetophenone semicarbazone; biacetyl monoxime semicarbazone; acetamidobenzaldehyde semicarbazone; thymolaldosemicarbazone; thiophene-2-aldehyde semicarbazone; phthalaldehyde disemicarbazone; phthalimide disemicarbazone; furaldehyde semicarbazone; naphthoquinone semicarbazone; phenanthrequinone semi carbazone; cyclohexanedione disemicarbazone; ionone semicarbazone; bissemicarbazone of diethyl-3,4-dioxadioate; and lawsone semicarbazone.

N—O Valence Stabilizer #26: Examples of acyl hydrazones, bis(acyl hydrazones), and poly(acyl hydrazones) (N—O Bidentates, N—O Tetradentates, and N—O Hexadentates) that meet the requirements for use as "wide band" valence stabilizers for $Co^{+3}$ include, but are not limited to: acetaldehyde N-formylhydrazone; acetaldehyde N-benzoylhydrazone; acetone N-formylhydrazone; acetone N-benzoylhydrazone; pinacolone N-formylhydrazone; pinacolone N-benzoylhydrazone; benzaldehyde N-formylhydrazone; benzaldehyde N-benzoylhydrazone; naphthaldehyde N-formylhydrazone; naphthaldehyde N-benzoylhydrazone; norbornanone N-formylhydrazone; norbornanone N-benzoylhydrazone; camphor N-formylhydrazone; camphor N-benzoylhydrazone; nopinone N-formylhydrazone; nopinone N-benzoylhydrazone; 2-pyridinaldehyde N-formylhydrazone; 2-pyridinaldehyde N-benzoylhydrazone; salicylaldehyde N-formylhydrazone; salicylaldehyde N-benzoylhydrazone; quinolinaldehyde N-formylhydrazone; quinolinaldehyde N-benzoylhydrazone; furan-2-aldehyde N-formylhydrazone; furan-2-aldehyde N-benzoylhydrazone; naphthoquinone N-formylhydrazone; naphthoquinone N-benzoylhydrazone; ionone N-formylhydrazone; ionone N-benzoylhydrazone; lawsone N-formylhydrazone; and lawsone N-benzoylhydrazone.

N—O Valence Stabilizer #27: Examples of carbazones (diazenecarboxylic hydrazides), bis(carbazones), and poly (carbazones) (N—O Bidentates, N—O Tetradentates, and N—O Hexadentates) that meet the requirements for use as "wide band" valence stabilizers for $Co^{+3}$ include, but are not limited to: diphenylcarbazone; 2-phenylcarbazone; dinaphthylcarbazone; and 2-naphthylcarbazone.

N—O Valence Stabilizer #28: Examples of azo compounds with hydroxyl or carboxy or carbonyl substitution at the ortho- (for aryl) or alpha- or beta- (for alkyl) positions, Bis[o-(HO—) or alpha- or beta-(HO—)azo compounds], or Poly[o-(HO—) or alpha- or beta-(HO—)azo compounds) (N—O Bidentates, N—O Tridentates, N—O Tetradentates, or N—O Hexadentates) that meet the requirements for use as "wide band" valence stabilizers for $Co^{+3}$ include, but are not limited to: 2-hydroxyazobenzene [1-(phenylazo)-2-phenol]; 2,2'-dihydroxyazobenzene (o,o'-dihydroxyazobenzene); (2-furan)azobenzene; Direct Blue 2B; 1-(4-nitrophenylazo)-2-naphthol; 1-(2-hydroxyphenylazo)-2-naphthol; 1-(2-methoxyphenylazo)-2-naphthol; pyridineazo-2-naphthol (PAN); pyridineazoresorcinol (PAR); 1-phenyl-4-(2-hydroxyphenylazo)-5-pyrazolone; 1-phenyl-4-(2-methoxyphenylazo)-5-pyrazolone; o-hydroxy-o'-(beta-aminoethylamino)azobenzene; 2-hydroxy-2'-methoxymethyleneoxyazobenzene; methyl red; turquoise blue (reactive blue); sunset yellow; amaranth; tartrazine; Eriochrome Black T; tropeolins; Allura Red; amaranth; Acid Alizarin Violet N; Acid Blue 29; Acid Orange 8, 63, and 74; Acid Red 1, 4, 8, 37, 88, 97, 114, 151, and 183; Acid Violet 7; Acid Yellow 25, 29, 34, 42, 76, and 99; Brilliant Black BN; Brilliant Crocein; Bordeaux R; Calcion; Chicago Sky Blue; Chromotrope; Cibacron Brilliant Red; Cibacron Brilliant Yellow; Crocein Orange; Crystal Scarlet; Calmagite; Direct Blue 71; Direct Red 23, 80, and 81; Direct Violet 51; Direct Yellow 8 and 27; Fast Black; Flavazin; Mordant Blue 9; Mordant Brown 1 and 33; Napthol Blue Black; New Coccine; Nitrazine Yellow; Nitrosulfonazo III; Orange II; Orange G, OT, and B; Ponceau 3R and SX; Polar Yellow; 2-oxazolylazobenzene; and 2-benzoxazolylazobenzene.

N—O Valence Stabilizer #29: Examples of diazeneformamides, diazeneacetamides, bis(diazeneformamides), bis(diazeneacetamides), poly(diazeneformamides), and poly(diazeneacetamides) (N—O Bidentates, N—O Tetradentates, and N—O Hexadentates) that meet the requirements for use as "wide band" valence stabilizers for $Co^{+3}$ include, but are not limited to: diazeneformamide, diazeneacetamide, phenyldiazeneformamide, diphenyldiazeneformamide, phenyldiazeneacetamide, and diphenyldiazeneacetamide.

N—O Valence Stabilizer #30: Examples of diazeneformic acids, diazeneacetic acids, bis(diazeneformic acids), bis (diazeneacetic acids), poly(diazeneformic acids), poly(diazeneacetic acids) and derivatives thereof (N—O Bidentates, N—O Tetradentates, N—O Hexadentates) that meet the requirements for use as "wide band" valence stabilizers for $Co^{+3}$ include, but are not limited to: diazeneformic acid, diazeneacetic acid, phenyldiazeneformic acid, diphenyldiazeneformic acid, phenyldiazeneacetic acid, and diphenyldiazeneacetic acid.

N—O Valence Stabilizer #31: Examples of diazeneformaldehydes, diazeneacetaldehydes, bis(diazeneformaldehydes), bis(diazeneacetaldehydes), poly(diazeneformaldehydes), and poly(diazeneacetaldehydes) (N—O Bidentates, N—O Tetradentates and N—O Hexadentates) that meet the requirements for use as "wide band" valence stabilizers for $Co^{+3}$ include, but are not limited to: diazeneformaldehyde, diazeneacetaldehyde, phenyldiazeneformaldehyde, diphenyldiazeneformaldehyde, phenyldiazeneacetaldehyde, and diphenyldiazeneacetaldehyde.

N—O Valence Stabilizer #32: Examples of diazenediformamides, diazenediacetamides, bis(diazenediformamides), bis (diazenediacetamides), poly(diazenediformamides), and poly(diazenediacetamides) (N—O Tridentates and N—O Hexadentates) that meet the requirements for use as "wide band" valence stabilizers for $Co^{+3}$ include, but are not limited to: diazenediformamide, diazenediacetamide, diphenydiazenediformamide, tetraphenyldiazenediformamide, diphenyldiazenediacetamide, and tetraphenyldiazenediacetamide.

N—O Valence Stabilizer #33: Examples of diazenediformic acids, diazenediacetic acids, bis(diazenediformic acids), bis (diazenediacetic acids), poly(diazenediformic acids), poly (diazenediacetic acids) and derivatives thereof (N—O Tridentates and N—O Hexadentates) that meet the requirements for use as "wide band" valence stabilizers for $Co^{+3}$ include, but are not limited to: diazenediformic acid, diazenediacetic acid, phenyldiazenediformic acid, diphenyldiazenediformic acid, phenyldiazenediacetic acid, and diphenyldiazenediacetic acid.

N—O Valence Stabilizer #34: Examples of diazenediformaldehydes, diazenediacetaldehydes, bis(diazenediformaldehydes), bis(diazenediacetaldehydes), poly(diazenediformaldehydes), and poly(diazenediacetaldehydes) (N—O Tridentates and N—O Hexadentates) that meet the requirements for use as "wide band" valence stabilizers for $Co^{+3}$ include, but are not limited to: diazenediformaldehyde, diazenediacetaldehyde, diphenyldiazenediformaldehyde, and diphenyldiazenediacetaldebyde.

N—O Valence Stabilizer #35: Examples of ortho-hydroxy (or -carboxy) substituted formazans, bis(o-hydroxy or -carboxy substituted formazans), and poly(o-hydroxy or -carboxy substituted formazans) (N—O Bidentates, N—O Tridentates, N—O Tetradentates, and N—O Hexadentates) that meet the requirements for use as "wide band" valence stabilizers for $Co^{+3}$ include, but are not limited to: 1-(2-hydroxyphenyl)-3,5-diphenylformazan; 1-(2-methoxyphenyl)-3,5-diphenylformazan; 1,5-bis(2-hydroxyphenyl)-3-phenylformazan; and 5-bis(2-methoxyphenyl)-3-phenylformazan.

N—O Valence Stabilizer #36: Examples of ortho-hydroxy (or -carboxy) substituted azines (including ketazines), bis (o-hydroxy or carboxy substituted azines), and poly(o-hydroxy or carboxy substituted azines) (N—O Bidentates, N—O Tridentates, N—O Tetradentates, and N—O Hexadentates) that meet the requirements for use as "wide band" valence stabilizers for $Co^{+3}$ include, but are not limited to: 2-hydroxy-1-benzalazine; 2-hydroxy-1-naphthalazine; and 2-hydroxy-1-cyclohexanonazine.

N—O Valence Stabilizer #37: Examples of Schiff Bases with one Imine (C═N) Group and with ortho- or alpha- or beta-hydroxy or carboxy or carbonyl substitution (N—O Bidentates, N—O Tridentates, N—O Tetradentates, N—O Pentadentates, or N—O Hexadentates) that meet the requirements for use as "wide band" valence stabilizers for $Co^{+3}$ include, but are not limited to: N -(Salicylaldehydo)isopropylamine; N-(2-Furfuralo)isopropylamine; N-(2-Acetylfurano)isopropylamine; N-(2-Hydroxyacetophenono)isopropylamine; N-(Pyridoxalo)isopropylamine; N-(Salicylaldehydo)cyclohexylamine; N-(2-Furfuralo)cyclohexylamine; N-(2-Acetylfurano)cyclohexylamine; N-(2-Hydroxyacetophenono)cyclohexylamine; N-(Pyridoxalo) cyclohexylamine; N-(Salicylaldehydo)aniline; N-(2-Furfuralo)aniline (Stenhauz salt); N-(2-Acetylfurano) aniline; N-(2-Hydroxyacetophenono)aniline; N-(Pyridoxalo)aniline; N-(Salicylaldehydo)aminonorbornane; N-(2-Furfuralo)aminonorbornane; N-(2-Acetylfurano)aminonorbornane; N-(2-Hydroxyacetophenono)aminonorbornane; N-(Pyridoxalo)aminonorbornane; (Salicylaldehydo)anisidine; 2-salicylideneiminobenzothiazole; (Salicylaldehydo)sulfamethazine; N'-histidine-3-methoxysalicylidenimine (V-his); N-(o-carboxybenzaldehydo)-2-aminophenol; N-(salicylaldehydo)isatin; N-(2-furfuralo) isatin; N-(2-acetylfurano)isatin; N-(pyridoxalo)isatin; N-(2-hydroxyacetophenono)isatin; hydrofuramide; 2-furancarboxaldehyde phenylhydrazone; 2-furancarboxaldehyde 2-pyridyl hydrazone; salicylaldehyde phenylhydrazone; and salicylaldehyde 2-pyridyl hydrazone. Also includes hydrazones with ortho-O substitution.

N—O Valence Stabilizer #38: Examples of Schiff Bases with two Imine (C═N) Groups and with ortho- or alpha- or beta-hydroxy or carboxy or carbonyl substitution (N—O Tridentates, N—O Tetradentates, N—O Pentadentates, or N—O Hexadentates) that meet the requirements for use as "wide band" valence stabilizers for $Co^{+3}$ include, but are not limited to: N,N'-(2,5-Furandicarboxaldehydo)diisopropylamine; N,N'-(2,5-Furandicarboxaldehydo)dicyclohexylamine; N,N'-(2,5-Furandicarboxaldehydo)dianiline; N,N'-(2,5-Furandicarboxaldehydo)di-aminonorbornane; N,N'-(o-Hydroxyphthalicdialdehydo)diisopropylamine; N,N'-(o-Hydroxyphthalicdialdehydo)dicyclohexylamine; N,N'-(o-Hydroxyphthalicdialdehydo)dianiline; N,N'-(o-Hydroxyphthalicdialdehydo)di-aminonorbornane; N,N'-(o-Hydroxyformylcamphoro)diisopropylamine; N,N'-(o-Hydroxyformylcamphoro)dicyclohexylamine; N,N'-(o-Hydroxyformylcamphoro)dianiline; N,N'-(o-Hydroxyformylcamphoro)di-aminonorbornane; N,N'-(o-Hydroxydiacetylbenzeno)diisopropylamine; N,N'-(o-Hydroxydiacetylbenzeno)dicyclohexylamine; N,N'-(o-Hydroxydiacetylbenzeno)dianiline; N,N'-(o-Hydroxydiacetylbenzeno)di-aminonorbornane; N,N'-(3,6-Dihydroxy-1,2-cyclohexanono)diisopropylamine; N,N'-(3,6-Dihydroxy-1,2-cyclohexanono)dicyclohexylamine; N,N'-(3,6-Dihydroxy-1,2-cyclohexanono)dianiline; N,N'-(3,6-Dihydroxy-1,2-cyclohexanono)di-aminonorbornane; N,N'-(2,5-Diacetylfurano)diisopropylamine; N,N'-(2,5-Diacetylfurano)dicyclohexylamine; N,N'-(2,5-Diacetylfurano)dianiline; N,N'-(2,5-Diacetylfurano)di-aminonorbornane; N,N'-(Salicylaldehydo)ethylenediamine; N,N'-(o-Hydroxynaphthaldehydo)ethylenediamine; N,N'-(o-Hydroxyacetophenono)ethylenediamine; N,N'-(Salicylaldehydo)trimethylenediamine; N,N'-(o-Hydroxynaphthaldehydo)trimethylenediamine; N,N'-(o-Hydroxyacetophenono) trimethylenediamine; N,N'-(Salicylaldehydo)cyclohexane-1,2-diamine; N,N'-(o-Hydroxynaphthaldehydo) cyclohexane-1,2-diamine; N,N'-(o-Hydroxyacetophenono) cyclohexane-1,2-diamine; N,N'-(Salicylaldehydo)-1,2-diaminobenzene; N,N'-(o-Hydroxynaphthaldehydo)-1,2-diaminobenzene; N,N'-(o-Hydroxyacetophenono)-1,2-diaminobenzene; N,N'-bis(salicylaldehydo)-1,12-diaminododecane (Saldn); N,N'-bis(3-methoxysalicylaldehydo)-o-phenyldiamine;N,N'-bis(3,4-difluorobenzaldehydo)-4,4'-benzidine; and N,N'-phenylenebis(3-methoxysalicylidenimine) (V-ph-V). Also includes hydrazones with ortho-O substitution.

N—O Valence Stabilizer #39: Examples of Schiff Bases with three Imine (C═N) Groups and with ortho- or alpha- or beta-hydroxy or carboxy or carbonyl substitution (N—O Tetradentates, N—O Pentadentates, or N—O Hexadentates) that meet the requirements for use as "wide band" valence stabilizers for $Co^{+3}$ include, but are not limited to: N,N',N"-(Salicylaldehydo)tris(2-aminoethyl)amine; N,N',N"-(o-Hydroxynaphthaldehydo)tris(2-aminoethyl)amine; and N,N',N"-(o-Hydroxyacetophenono)tris(2-aminoethyl)amine. Also includes hydrazones with ortho-O substitution.

N—O Valence Stabilizer #40: Examples of silylaminoalcohols (N—O Bidentates, N—O Tridentates, N—O Tetradentates, and N—O Hexadentates) that meet the requirements for use as "wide band" valence stabilizers for $Co^{+3}$ include, but are not limited to: silatranes.

N—O Valence Stabilizer #41: Examples of hydroxyalkyl imines (imino alcohols) (N—O Bidentates, N—O Tridentates, N—O Tetradentates, and N—O Hexadentates) that meet the requirements for use as "wide band" valence stabilizers for $Co^{+3}$ include, but are not limited to: 2-hydroxycyclohexylimine; 3-hydroxy-2-iminonorbornane; 2,2'-diiminodicyclohexyl ether; oxamide; 3-imino-1,5-pentanedialdehyde; iminodiacetic acid; and iminodipropionic acid.

N—O Valence Stabilizer #42: Examples of hydroxyaryl amines and hydroxyaryl imines (N—O Bidentates, N—O Tridentates, N—O Tetradentates, and N—O Hexadentates) that meet the requirements for use as "wide band" valence stabilizers for $Co^{+3}$ include, but are not limited to: 2-aminophenol; 2-aminobenzoic acid (anthranilic acid); 2-aminoanisole; o-phenetidine; o-anisidine; 2-hydroxymethyl)-alpha-aminotoluene; 1-amino-2-naphthol; 2-amino-1-naphthol; 2,2'-di(aminomethyl)diphenylketone; isophoronediamine; tris-2,4,6-dimethylaminomethyl phenol; di(2-amino)phenyl ether; 1,3-di(2-amino)phenyl-2-hydroxypropane; 1,3-di(3-amino)phenyl-2-hydroxypropane; 1,3-di(2-hydroxy)phenyl-2-aminopropane; 1,3-di(3-hydroxy)phenyl-2-aminopropane; 2,2'-dihydroxyiminodibenzyl; 2,2'-iminodibenzoic acid; 2,2'-dihydroxyiminostilbene; poly(o-phenetidine); poly(o-aminophenol); poly(o-anisidine); and 3-(anilino)propionamide.

N—O Valence Stabilizer #43: Examples of five-membered heterocyclic rings containing one, two, three, or four nitrogen atoms at least one additional oxygen atom binding site not in a ring (N—O Bidentates, N—O Tridentates, N—O Tetradentates, or N—O Hexadentates) that meet the requirements for use as "wide band" valence stabilizers for $Co^{+3}$ include, but are not limited to: 2-hydroxypyrrole; 2-(methylhydroxy)methylpyrrole; 2,5-(hydroxymethyl)pyrrole; 2,5-(methylhydroxymethyl)pyrrole; imidazoline-2-one (2-hydroxyimidazole); 2-hydroxythiazoline; 2-hydroxybenzimidazole; 2-hydroxybenzothiazole; 2-hydroxybenzoxazole; 2-hydantoin; di-2-pyridylglyoxal (2,2'-pyridil); bis((1-pyrazolyl)methane)ether; bis(2-(1-pyrazolyl)ethane)ether; bis(benzimidazolylmethane)ether; bis(benzimidazolylethane)ether; tris(imidazolyl)methanol; tris(imidazolylmethane)methanol; N-hydroxymethyl-N,N-(benzimidazolylmethane)amine; N-(2-hydroxyethyl)-N,N-(benzimidazolylmethane)amine; N,N'-di(benzimidazolylmethane)-1,3-di amino-2-hydroxypropane; N,N,N',N'-tetrakis(benzimidazolylmethane)-1,3-diamino-2-hydroxypropane; bis(N,N-((4-imidazolyl)methane)2-aminoethane)ether; 4-carboxybenzotriazole; antipyrine; 4-aminoantipyrine (aap); hydantoin; aminoalkylhydantoins; 2,5-oxazolidinedione; benzyldibenzoyltriazole (bdbt); 5-hydroxymethylimidazole; dicarboxyalkylbenzotriazoles; bis(hydroxyphenyl)aminotriazoles; pyrrole-2-carboxaldehyde; (oxopyrrolidinylalkyl)triazoles; alkoxybenzotriazoles; aryloxybenzotriazoles; 3-salicylamido-4,5-dihydro-1,2,4-triazole; 5-(alkoxy)benzotriazole; (polyoxyalkylene)oxazolidines; 1-(dialkylaminomethyl)-5-carboxyalkylbenzotriazole; 1-(2-hydroxyethyl)imidazoline; 1-acetoxyimidazole; 1-acetylimidazole; benzotriazolecarboxylic acid; poly(oxyalkylated)pyrazoles; poly(oxyalkylated)thiadiazoles; 1,2,4-triazole-3-carboxylic acid; 5-hydroxypyrazole; 3-phenyl-1,2,4-triazol-5-one (ptr); 1-acetylbenzimidazole; 1-[(acetoxy)ethyl]benzimidazole; creatinine; indole-2-carboxylic acid; pyrrole-2-carboxylic acid; imidazole-2-carboxylic acid; pyrazole-2-carboxylic acid; and 1,1'-oxalyldimdazole.

N—O Valence Stabilizer #44: Examples of six-membered heterocyclic rings containing one, two, three, or four nitrogen atoms at least one additional oxygen atom binding site not in a ring (N—O Bidentates, N—O Tridentates, N—O Tetradentates, or N—O Hexadentates) that meet the requirements for use as "wide band" valence stabilizers for $Co^{+3}$ include, but are not limited to: 4-aminomethyl-3-pyridinemethanol (including pyridoxamine); 2-hydroxypyridine; 2-(methylhydroxy)methylpyridine; 2-(2-(methylhydroxy)ethyl)pyridine; 2,6-(hydroxymethyl)pyridine; 2,6-(methylhydroxymethyl)pyridine; 2-hydroxypyrimidine; 2-dihydroxymethylpyrimidine; 2-hydroxyquinoline; 8-hydroxyquinoline (oxine); 8-methylhydroxyquinoline; 2-hydroxyquinazoline; orotic acid (1,2,3,6-tetrahydro-2,6-dioxo-4-pyrimidinecarboxylic acid) (6-uracilcarboxylic acid); 1-methylpyrimidine-2-one; uracil; 6-hydroxypurine; bis(N,N,N',N'-tetra(2-(2-pyridyl)ethane)aminomethane)ether; bis(N,N,N',N'-tetra(2-(2-pyridyl)ethane)aminoethane)ether; quinazol-4-one; quinazol-2-one; 5-azathymine; 2-hydroxybenzimidazole (2-hbz); guanine; 1,3,5-triazin-6-one; 6-hydroxy-1,3,5-triazine; 4,6-dibydroxy-1,3,5-triazine; triazine carboxylic acids; 2,3-dihydroxypyridine; thiomorpholin-3-one; hydroxytetrahydropyrimidines; 2-piperazinones; 2-piperidinones; dilituric acid; actinoquinol; caffeine; citrazinic acid; picolinic acid; 2-quinolol; 2,6-dimethoxypyridine; quinoxaline-2-carboxylic acid; flucytosine; hypoxanthine; hexamethylolmelamine; hydroorotic acid; isoorotic acid; xanthine; leucopterin; nitroorotic acid; 8-azaguanine; and cyanuric acid.

N—O Valence Stabilizer #45: Examples of five-membered heterocyclic rings containing one or two oxygen atoms at least one additional nitrogen atom binding site not in a ring (N—O Bidentates, N—O Tridentates, N—O Tetradentates, or N—O Hexadentates) that meet the requirements for use as "wide band" valence stabilizers for $Co^{+3}$ include, but are not limited to: 2-aminofuran; 2,5-diaminofuran; 2-aminomethylfuran; 2,5-di(aminomethyl)furan; 2-aminobenzofuran; and 2-amino-1,3-dioxolane.

N—O Valence Stabilizer #46: Examples of six-membered heterocyclic rings containing one or two oxygen atoms at least one additional nitrogen atom binding site not in a ring (N—O Bidentates, N—O Tridentates, N—O Tetradentates, or N—O Hexadentates) that meet the requirements for use as "wide band" valence stabilizers for $Co^{+3}$ include, but are not limited to: 2-aminopyran; 2,6-diaminopyran; 2-aminomethylpyran; 2,6-di(aminomethyl)pyran; and 2-aminobenzopyran.

N—O Valence Stabilizer #47: Examples of five-membered heterocyclic rings containing one, two, three, or four nitrogen atoms at least one additional oxygen atom binding site in a separate ring (N—O Bidentates, N—O Tridentates, N—O Tetradentates) that meet the requirements for use as "wide band" valence stabilizers for $Co^{+3}$ include, but are not limited to: 2-(2-furan)pyrrole; 2,5-di(2-furan)pyrrole; 2-(2-pyran)pyrrole; 2,5-di(2-pyran)pyrrole; 2,5-di(2-pyrrole)furan; and 2,6-di(2-pyrrole)pyran.

N—O Valence Stabilizer #48: Examples of six-membered heterocyclic rings containing one, two, three, or four nitrogen atoms at least one additional oxygen atom binding site in a separate ring (N—O Bidentates, N—O Tridentates, N—O Tetradentates) that meet the requirements for use as "wide band" valence stabilizers for $Co^{+3}$ include, but are not limited to: 2-(2-furan)pyridine; 2,6-di(2-furan)pyridine; 2-(2-pyran)pyridine; 2,6-di(2-pyran)pyridine; 2,5-di(2-pyridyl)furan; 2,6-di(2-pyridyl)pyran; and drometrizole.

N—O Valence Stabilizer #49: Examples of two-, three-, four-, six-, eight-, and ten-membered macrocyclics, macrobicyclics, and macropolycyclics (including catapinands, cryptands, cyclidenes, and sepulchrates) wherein all binding sites are composed of nitrogen (usually amine or imine groups) or oxygen (usually hydroxy, carboxy, or carbonyl groups) and are not contained in component heterocyclic rings (N—O Bidentates, N-OTridentates, N—O Tetradentates, and N—O Hexadentates) that meet the requirements for use as "wide band" valence stabilizers for $Co^{+3}$ include, but are not limited to: azaoxacyclobutane ([4]aneNO); azaoxacyclopentane ([5]aneNO); azaoxacyclohexane ([6]aneNO); azaoxacycloheptane ([7]aneNO); azaoxacyclooctane ([8]aneNO); azaoxacyclobutene ([4]eneNO); azaoxacyclopentene ([5]eneNO); azaoxacyclohexene ([6]eneNO); azaoxacycloheptene ([7]eneNO); azaoxacyclooctene ([8]eneNO); azaoxacyclobutadiene ([4]dieneNO); azaoxacyclopentadiene ([5]dieneNO); azaoxacyclohexadiene ([6]dieneNO); azaoxacycloheptadiene ([7]dieneNO); azaoxacyclooctadiene ([8]dieneNO); diazaoxacyclohexane ([6]aneON$_2$); diazaoxacycloheptane ([7]aneON$_2$); diazaoxacyclooctane ([8]aneON$_2$); diazaoxacyclononane ([9]aneON$_2$); diazaoxacyclodecane ([10]aneON$_2$); diazaoxacycloundecane ([11]aneON$_2$); diazaoxacyclododecane ([12]aneON$_2$); diazaoxacyclohexene ([6]eneON$_2$);

diazaoxacycloheptene ([7]eneON$_2$); diazaoxacyclooctene ([8]eneON$_2$); diazaoxacyclononene ([9]eneON$_2$); diazaoxacyclodecene ([10]eneON$_2$); diazaoxacycloundecene ([11]eneON$_2$); diazaoxacyclododecene ([12]eneON$_2$); diazadioxacyclooctane ([8]aneO$_2$N$_2$); diazadioxacyclononane ([9]aneO$_2$N$_2$); diazadioxacyclodecane ([10]aneO$_2$N$_2$); diazadioxacycloundecane ([11]aneO$_2$N$_2$); diazadioxacyclododecane ([12]aneO$_2$N$_2$); diazadioxacyclotridecane ([13]aneO$_2$N$_2$); diazadioxacyclotetradecane ([14]aneO$_2$N$_2$); diazadioxacyclopentadecane ([15]aneO$_2$N$_2$); diazadioxacyclohexadecane ([16]aneO$_2$N$_2$); diazadioxacycloheptadecane ([17]aneO$_2$N$_2$); diazadioxacyclooctadecane ([18]aneO$_2$N$_2$); diazadioxacyclononadecane ([19]aneO$_2$N$_2$); diazadioxacyclocicosane ([20]aneO$_2$N$_2$); diazadioxacyclooctadiene ([8]dieneo$_2$N$_2$); diazadioxacyclononadiene ([9]dieneo$_2$N$_2$); diazadioxacyclodecadiene ([10]dieneo$_2$N$_2$); diazadioxacycloundecadiene ([11]dieneo$_2$N$_2$); diazadioxacyclododecadiene ([12]dieneo$_2$N$_2$); diazadioxacyclotridecadiene ([13]dieneo$_2$N$_2$); diazadioxacyclotetradecadiene ([14]dieneO$_2$N$_2$); diazadioxacyclopentadecadiene ([15]dieneo$_2$N$_2$); diazadioxacyclohexadecadiene ([16]dieneO$_2$N$_2$); diazadioxacycloheptadecadiene ([17]dieneO$_2$N$_2$); diazadioxacyclooctadecadiene ([18]dieneo$_2$N$_2$); diazadioxacyclononadecadiene ([19]dieneo$_2$N$_2$); and diazadioxacycloeicosadiene ([20]dieneO$_2$N$_2$).

N—O Valence Stabilizer #50: Examples of four-, six-, eight-, or ten-membered macrocyclics, macrobicyclics, and macropolycyclics (including catapinands, cryptands, cyclidenes, and sepulchrates) wherein all binding sites are composed of nitrogen or oxygen and are contained in component heterocyclic rings (N—O Bidentates, N—O Tridentates, N—O Tetradentates, or N—O Hexadentates) that meet the requirements for use as "wide band" valence stabilizers for $Co^{+3}$ include, but are not limited to: dipyrandipyridines; difurandipyrroles; tripyrantripyridines; trifurantripyrroles; tetrapyrantetrapyridines; and tetrafurantetrapyrroles.

N—O Valence Stabilizer #51: Examples of four-, six-, eight-, or ten-membered macrocyclics, macrobicyclics, and macropolycyclics (including catapinands, cryptands, cyclidenes, and sepulchrates) wherein all binding sites are composed of nitrogen or oxygen and are contained in a combination of heterocyclic rings and amine, imine, hydroxy, carboxy, or carbonyl groups (N—O Bidentates, N—O Tridentates, N—O Tetradentates, or N—O Hexadentates) that meet the requirements for use as "wide band" valence stabilizers for $Co^{+3}$ include, but are not limited to: azaoxatetraphyrins; diazadioxatetraphyrins; azaoxahexaphyrins; diazadioxahexaphyrins; and triazatrioxahexaphyrins.

S—O Valence Stabilizer #1: Examples of 1,3-monothioketones (monothio-beta-ketonates), 1,3,5-monothioketones, 1,3,5-dithioketones, bis(1,3-monothioketones), and poly(1,3-monothioketones) (S—O Bidentates, S—O Tridentates, S—O Tetradentates) that meet the requirements for use as "wide band" valence stabilizers for $Co^{+3}$ include, but are not limited to: hexafluoropenta-2-thione-4-ketone; 1,3-diphenyl-1,3-propana-1-thione-3-ketone; benzoylthiopinacolone; cyclohexoylthiocyclohexoylmethane; diphenylpentanedithionate; tetramethylnonanedithionate; hexafluoroheptanedithionate; trifluoroheptanedithionate; 1-(2-thienyl)-butan-1-thione-3-ketone, 1-(2-naphthyl)-butan-1-thione-3-ketone, and trifluoroacetylthiocamphor.

S—O Valence Stabilizer #2: Examples of thiomalonamides (thiomalonodiamides), bis(thiomalonamides), and polythiomalonamides (S—O Bidentates, S—O Tridentates, S—O Tetradentates) that meet the requirements for use as "wide band" valence stabilizers for $Co^{+3}$ include, but are not limited to: thiomalonamide, N-phenylthiomalonamide, N-benzylthiomalonamide, N-pentafluorophenylthiomalonamide, N-cyclohexylthiomalonamide, N-norbornylthiomalonamide, N,N'-diphenylthiomalonamide, N,N'-dibenzylthiomalonamide, N,N'-dipentafluorophenylthiomalonamide, N,N'-dicyclohexylthiomalonamide, and N,N'-norbornylthiomalonamide.

S—O Valence Stabilizer #3: Examples of 2-thioacylacetamides, 2-acylthioacetamides, bis(2-thioacylacetamides), bis(2acylthioacetamides), poly(2-thioacylacetamides), and poly(2-Acylthioacetamides) (S—O Bidentates, S—O Tridentates, S—O Tetradentates) that meet the requirements for use as "wide band" valence stabilizers for $Co^{+3}$ include, but are not limited to: 2-acetothioacetamide, 2-thioacetoacetamide, N-phenyl-2-acetothioacetamide, N-pentafluorophenyl-2-acetothioacetamide, N-benzyl-2-acetothioacetamide, N-cyclohexyl-2-acetothioacetamide, N-norbornyl-2-acetothioacetamide, N-phenyl-2-benzothioacetamide, N-pentafluorophenyl-2-pentafluorobenzothioacetamide, and N-cyclohexyl-2-cyclohexothioacetamide.

S—O Valence Stabilizer#4: Examples of dithiodicarbonic diamides, bis(dithiodicarbonic diamides), and poly(dithiodicarbonic diamides) (S—O Bidentates, S—O Tridentates, S—O Tetradentates) that meet the requirements for use as "wide band" valence stabilizers for $Co^{+3}$ include, but are not limited to: dithiodicarbonic diamide; N-phenyldithiodicarbonic diamide; N-pentafluorophenyldithiodicarbonic diamide; N-benzyldithiodicarbonic diamide; N-cyclohexyldithiodicarbonic diamide; N-norbornyldithiodicarbonic diamide; N,N'-diphenyldithiodicarbonic diamide; N,N'-dipentafluorophenyldithiodicarbonic diamide; N,N'-dibenzyldithiodicarbonic diamide; N,N'-dicyclohexyldithiodicarbonic diamide; and N,N'-dinorbornyldithiodicarbonic diamide.

S—O Valence Stabilizer #5: Examples of monothiohypophosphoric acids, bis(monothiohypophosphoric acids), poly(monothiohypophosphoric acids), and derivatives thereof (S—O Bidentates, S—O Tridentates, S—O Tetradentates) that meet the requirements for use as "wide band" valence stabilizers for $Co^{+3}$ include, but are not limited to: monothiohypophosphoric acid, methylmonothiohypophosphoric acid, isopropylmonothiohypophosphoric acid, tert-butylmonothiohypophosphoric acid, phenylmonothiohypophosphoric acid, pentafluorophenylmonothiohypophosphoric acid, benzylmonothiohypophosphoric acid, cyclohexylmonothiohypophosphoric acid, norbornylmonothiohypophosphoric acid, dimethylmonothiohypophosphoric acid, diisopropylmonothiohypophosphoric acid, di-tert-butylmonothiohypophosphoric acid, diphenylmonothiohypophosphoric acid, di-pentafluorophenylmonothiohypophosphoric acid, dibenzylmonothiohypophosphoric acid, dicyclohexylmonothiohypophosphoric acid, and dinorbornylmonothiohypophosphoric acid.

S—O Valence Stabilizer #6: Examples of monothiohypophosphoramides, bis(monothiohypophosphoramides), and poly(monothiohypophosphoramides) (S—O Bidentates, S—O Tridentates, S—O Tetradentates) that meet the requirements for use as "wide band" valence slabilizers for $Co^{3}$ include, but are not limited to: monothiohypophosphoramide, N-methylmonothiohypophosphoramide, N-isopropylmonothiohypophosphoramide, N-tert-butylmonothiobypophosphoramide,
N-phenylmonothiohypophosphoramide, N-pentafluorophenylmonothiohypophosphoramide, N-benzylmonothiohypophosphoramide, N-cyclohexylmonothiohypophosphoramide, N-norbornylmonothiohypophosphoramide, N,N'''-dimethylmonothiohypophosphoramide, N,N'''-diisopropylmonothiohypophosphoramide, N,N'''-di-tert-butylmonothiohypophosphoramide, N,N'''-diphenylmonothiohypophosphoramide, N,N'''-di-pentafluorophenylmonothiohypophosphoramide, N,N'''-dibenzylmonothiohypophosphoramide, N,N'''-dicyclohexylmonothiohypophosphoramide, and N,N'''-dinorbornylmonothiohypophosphoramide.

S—O Valence Stabilizer #7: Examples of monothioimidodiphosphoric acids, monothiohydrazidodiphosphoric acids, bis(monothioimidodiphosphoric acids), bis(monothiohydrazidodiphosphoric acids), poly(monothioimidodiphosphoric acids), poly(monothiohydrazidodiphosphoric acids), and derivatives thereof (S—O Bidentates, S—O Tridentates, S—O Tetradentates) that meet the requirements for use as "wide band" valence stabilizers for $Co^{+3}$ include, but are not limited to: monothioimidodiphosphoric acid, methylmonothioimidodiphosphoric acid, isopropylmonothioimidodiphosphoric acid, tert-butylmonothioimidodiphosphoric acid, phenylmonothioimidodiphosphoric acid, pentafluorophenylmonothioimidodiphosphoric acid, benzylmonothioimidodiphosphoric acid, cyclohexylmonothioimidodiphosphoric acid, norbornylmonothioimidodiphosphoric acid, dimethylmonothioimidodiphosphoric acid, diisopropylmonothioimidodiphosphoric acid, di-tert-butylmonothioimidodiphosphoric acid, diphenylmonothioimidodiphosphoric acid, di-pentafluorophenylmonothioimidodipbosphoric acid, dibenzylmonothioimidodiphosphoric acid, dicyclohexylmonothioimidodiphosphoric acid, and dinorbornylmonothioimidodiphosphoric acid.

S—O Valence Stabilizer #8: Examples of monothioimidodiphosphoramides, monothiohydrazidodiphosphoramides, bis(monothioimidodiphosphoramides), bis(monothiohydrazidodiphosphoramides), poly(monothioimidodiphosphoramides), and poly(monothiohydrazidodiphosphoramides) (S—O Bidentates, S—O Tridentates, S—O Tetradentates) that meet the requirements for use as "wide band" valence stabilizers for $Co^{+3}$ include, but are not limited to: monothioimidodiphosphoramide, N-methylmonothioimidodiphosphoramide, N-isopropylmonothioimidodiphosphoramide, N-tert-butylmonothioimidodiphosphoramide, N-phenylmonothioimidodiphosphoramide, N-pentafluorophenylmonothioimidodiphosphoramide, N-benzylmonothioimidodiphosphoramide, N-cyclohexylmonothioimidodiphosphoramide, N-norbornylmonothioimidodiphosphoramide, N,N'''-dimethylmonothioimidodiphosphoramide, N,N'''-diisopropylmonothioimidodiphosphoramide, N,N'''-di-tert-butylmonothioimidodiphosphoramide, N,N'''-diphenylmonothioimidodiphosphoramide, N,N'''-di-pentafluorophenylmonothioimidodiphosphoramide, N,N'''-dibenzylmonothioimidodiphosphoramide, N,N'''-dicyclohexylmonothioimidodiphosphoramide, and N,N'''-dinorbornylmonothioimidodiphosphoramide.

S—O Valence Stabilizer #9: Examples of monothiodiphosphoramides, bis(monothiodiphosphoramides), and poly (monothiodiphosphoramides) (S—O Bidentates, S—O Tridentates, S—O Tetradentates) that meet the requirements for use as "wide band" valence stabilizers for $Co^{+3}$ include, but are not limited to: monothiodiphosphoramide, N-methylmonothiodiphosphoramide, N-isopropylmonothiodiphosphoramide, N-tert-butylmonothiodiphosphoramide, N-phenylmonothiodiphosphoramide, N-pentafluorophenylmonothiodiphosphoramide, N-benzylmonothiodiphosphoramide, N-cyclohexylmonothiodiphosphoramide, N-norbornylmonothiodiphosphoramide, N,N'''-dimethylmonothiodiphosphoramide, N,N'''-diisopropylmonothiodiphosphoramide, N,N'''-di-tert-butylmonothiodiphosphoramide, N,N'''-diphenylmonothiodiphosphoramide, N,N'''-di-pentafluorophenylmonothiodiphosphoramide, N,N'''-dibenzylmonothiodiphosphoramide, N,N'''-dicyclohexylmonothiodiphosphoramide, and N,N'''-dinorbornylmonothiodiphosphoramide.

S—O Valence Stabilizer#10: Examples of monothiodiphosphoric acids, bis(monothiodiphosphoric acids), poly(monothiodiphosphoric acids), and derivatives thereof (S—O Bidentates, S—O Tridentates, S—O Tetradentates) that meet the requirements for use as "wide band" valence stabilizers for $Co^{+3}$ include, but are not limited to: monothiodiphosphoric acid, methylmonothiodiphosphoric acid, isopropylmonothiodiphosphoric acid, tert-butylmonothiodiphosphoric acid, phenylmonothiodiphosphoric acid, pentafluorophenylmonothiodiphosphoric acid, benzylmonothiodiphosphoric acid, cyclohexylmonothiodiphosphoric acid, norbornylmonothiodiphosphoric acid, dimethylmonothiodiphosphoric acid, diisopropylmonothiodiphosphoric acid, di-tert-butylmonothiodiphosphoric acid, diphenylmonotbiodiphosphoric acid, di-pentafluorophenylmonothiodiphosphoric acid, dibenzylmonothiodiphosphoric acid, dicyclohexylmonothiodiphosphoric acid, and dinorbornylmonothiodiphosphoric acid.

S—O Valence Stabilizer #11: Examples of monothiocarbamates, bis(monothiocarbamates), and poly(monothiocarbamates) (including N-hydroxymonothiocarbamates and N-mercaptomonothiocarbamates) (S—O Bidentates, S—O Tridentates, and S—O Tetradentates) that meet the requirements for use as "wide band" valence stabilizers for $Co^{3}$ include, but are not limited to: dimethylmonothiocarbamate (dmmtc); di(trifluorodimethyl)monothiocarbamate; diethylmonothiocarbamate (demtc); dipropylmonothiocarbamate; diisopropylmonothiocarbamate; dibutylmonothiocarbamate; ditertbutylmonothiocarbamate; dicyanamidomonothiocarbamate; diphenylmonothiocarbamate; di(pentafluorophenyl)monothiocarbamate; dibenzylmonothiocarbamate; dinaphthylmonothiocarbamate; dicyclohexylmonothiocarbamate; dinorbornylmonothiocarbamate; diadamantylmonothiocarbamate; pyrrolidinomonothiocarbamate (pyrmtc); piperidinomonothiocarbamate (pipmtc); morpholinomonothiocarbamate (mormtc); thiamorpholinomonothiocarbamate; 3-pyrrolinomonothiocarbamate; pyrrolomonothiocarbamate; oxazolomonothiocarbamate; isoxazolomonothiocarbamate; thiazolomonothiocarbamate; isothiazolomonothiocarbamate; indolomonothiocarbamate; carbazolomonothiocarbamate; pyrazolinomonothiocarbamate; imidazolinomonothiocarbamate; pyrazolomonothiocarbamate; imidazolomonothiocarbamate; indazolomonothiocarbamate; and triazolomonothiocarbamate.

Water-soluble precursors for the organic valence stabilizers are typically used to ensure that sufficient material is available for coating deposition from aqueous solutions. Identification of suitable water soluble precursors can be difficult because many of these organics do not form a wide range of water-soluble compounds.

As with the inorganic valence stabilizers, crosses between two or more organic valence stabilizers can be used to stabilize $Co^{+3}$ for corrosion protection. For example, in some instances it may be desirable to form a valence stabilizer out of a nitrogen-containing heterocyclic and an amine ligand. Both of these materials can complex to form a mixed nitrogen heterocyclic/amine valence stabilizer out of the conversion coating solution during the coating process.

4c) Narrow Band Inorganic Valence Stabilizers

Narrow band valence stabilizers can be used to stabilize $Co^{+3}$ for corrosion protection, but they are less typical. Narrow band valence stabilizers exhibit some limitation in their use when compared to wide band stabilizers. They may be toxic or may complex $Co^{+3}$ only with difficulty. These narrow band stabilizers include, but are not limited to, bismuthates, germanates, arsenates, litanates, zirconates, and hafnates. For example, valence stabilizers using arsenate are less desirable because their inherent toxicity is very large (greater than hexavalent chromium), although they may be very effective at inhibiting corrosion when used with $Co^{+3}$. Arsenates can be used as valence stabilizers for $Co^{+3}$ when the toxicity of the coating solution is not a factor in its use.

Other narrow band stabilizers may result in $Co^{+3}$-stabilizer complexes with limited stability, an undesirable solubility range, or limited electrostatic characteristics, and they would be useful only in limited applications. Formation of a protective shell of octahedra or tetrahedra with phosphates ($P^{+5}$), borates ($B^{+3}$), aluminates ($Al^{+3}$), and silicates ($Si^{+4}$) around the $Co^{+3}$ ion is difficult but possible. These compounds are known to form octahedra or tetrahedra, but tend to polymerize in chain-like structures when precipitated from aqueous solution under ambient conditions. These and other narrow band stabilizers can provide some degree of corrosion protection when complexed with $Co^{+3}$, but will not necessarily perform with the same efficiency as the wide band stabilizers by themselves. Combinations of these materials, such as phosphosilicates, aluminosilicates, or borosilicates may also function as narrow band inorganic valence stabilizers.

Narrow band inorganic stabilizers used in combination with wide band inorganic stabilizers described above can be used to provide significant corrosion protection. Conversely, modifications of wide band inorganic valence stabilizers can result in a complex with reduced corrosion inhibition. For example, heteropolymetallates can contain ions in addition to the desired $Co^{+3}$ ion.

The central cavity of the heteropolymetallates can contain ions in addition to the desired $Co^{+3}$ ion. For example, the use of silicomolybdates, phosphomolybdates, silicotungstates, and phosphotungstates is possible. In these $Co^{+3}$-valence stabilizer complexes, $Si^{+4}$ or $p^{+5}$ ions also occupy the central cavity of the complex with the $Co^{+3}$ ion. The inclusion of additional ions in the central cavity reduces the stability of the complex, and thereby leads to lower corrosion protection. Nonetheless, these complexes also demonstrated some corrosion inhibiting activity.

The additional ions that can be included within the central cavity of the heteropolymetallates described above depend upon the size of the central cavity, which in turn depends upon the specific chemistry exhibited by an inorganic valence stabilizer (e.g., molybdate, tungstate, periodate, carbonate, etc.). In general, these additional ions must also be small so as to ensure the stability of the formed $Co^{+3}$-valence stabilized complex. Examples of small additional ions include, but are not limited to: $B^{+3}$, $Al^{+3}$, $Si^{+4}$, $p^{+5}$, $Ti^{+4}$, $V^{+5}$, $V^{+4}$, $Cr^{+6}$, $Cr^{+4}$, $Cr^{+3}$, $Mn^{+4}$, $Mn^{+3}$, $Mn^{+2}$, $Fe^{+3}$, $Fe^{+2}$, $Co^{+2}$ $Ni^{+2}$ $Ni^{+4}$, $Cu^{+2}$, $Cu^{+3}$, $Zn^{+2}$, $Ga^{+3}$, $Ge^{+4}$, As, $As^{+3}$, Zr, and $Ce^{+4}$.

Water-soluble precursors for these materials are desirable. Typically, the free acids (e.g., silicomolybdic acid, phosphotungstic acid, borotungstic acid, etc.) offer the most water-soluble precursors for these materials.

4d) Narrow Band Organic Valence Stabilizers

Narrow band organic valence stabilizers include those general classes of chemical compounds that result in $Co^{+3}$-valence stabilizer complexes that are either less stable, more soluble in water, or more toxic than the wide band organic stabilizers.

TABLE 2

Narrow Band Organic Valence Stabilizers for the $Co^{+3}$ Ion

| General Structural Name (Type of Organic) | Structural Representation |
|---|---|
| N Valence Stabilizer #1: Five-, Seven-, or Nine-Membered Macrocyclics, Macrobicyclics, and Macropolycyclics (including Catapinands, Cryptands, Cyclidenes, and Sepulchrates) wherein all Binding Sites are composed of Nitrogen (usually amine or imine groups) and are not contained in Component Heterocyclic Rings (N—N Tridentates, N—N Tetradentates, and N—N Hexadentates) | Macrocyclic ligands containing five, seven, or nine nitrogen binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| N Valence Stabilizer #2: Five-, or Seven-Membered Macrocyclics, Macrobicyclics, and Macropolycyclics (including Catapinands, Cryptands, Cyclidenes, and Sepulchrates) wherein all Binding Sites are composed of Nitrogen and are contained in Component 5-Membered Heterocyclic Rings (N—N Tridentates, N—N Tetradentates, or N—N Hexadentates) | Macrocyclic ligands containing a total of five or seven five-membered heterocyclic rings containing nitrogen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |

TABLE 2-continued

Narrow Band Organic Valence Stabilizers for the $Co^{+3}$ Ion

| General Structural Name (Type of Organic) | Structural Representation |
|---|---|
| N Valence Stabilizer #3: Five-, Seven-, or Nine-Membered Macrocyclics, Macrobicyclics, and Macropolycyclics (including Catapinands, Cryptands, Cyclidenes, and Sepulchrates) wherein all Binding Sites are composed of Nitrogen and are contained in a Combination of 5-Membered Heterocyclic Rings and Amine or Imine Groups (N—N Tridentates, N—N Tetradentates, or N—N Hexadentates) | Macrocyclic ligands containing at least one 5-membered heterocyclic ring. These heterocyclic rings provide nitrogen binding sites to valence stabilize the central metal ion. Other amine or imine binding sites can also be included in the macrocyclic ligand, so long as the total number of binding sites is five, seven, or nine. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #4: Five- or Seven-Membered Macrocyclics, Macrobicyclics, and Macropolycyclics (including Catapinands, Cryptands, Cyclidenes, and Sepulchrates) wherein all Binding Sites are composed of Nitrogen and are contained in Component 6-Membered Heterocyclic Rings (N—N Tridentates, N—N Tetradentates, or N—N Hexadentates) | Macrocyclic ligands containing a total of five or seven six-membered heterocyclic rings containing nitrogen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #5: Five-, Seven-, or Nine-Membered Macrocyclics, Macrobicyclics, Macropolycyclics (including Catapinands, Cryptands, Cyclidenes, and Sepulchrates) wherein all Binding Sites are composed of Nitrogen and are contained in a Combination of 6-Membered Heterocyclic Rings and Amine or Imine Groups (N—N Tridentates, N—N Tetradentates, or N—N Hexadentates) | Macrocyclic ligands containing at least one 6-membered heterocyclic ring. These and heterocyclic rings provide nitrogen binding sites to valence stabilize the central metal ion. Other amine or imine binding sites can also be included in the macrocyclic ligand, so long as the total number of binding sites is five, seven, or nine. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N Valence Stabilizer #6: Silylamines and Silazanes, including Macrocyclic Derivatives, wherein at least one Nitrogen Atom is a Binding Site (N Monodentates, N—N Bidentates, N—N Tridentates, N—N Tetradentates, and N—N Hexadentates) | $N(SiR_3)_3$, $R'N(SiR_3)_2$, or $R'R''N(SiR_3)$ for silylamines; and $[RR''Si—NR']_x$ (x = 1-10) for silazanes where R, R', and R'' represents H or any organic functional group wherein the number of carbon atoms ranges from 0 to 35, optionally having halogen or polarizing or water-insolubilizing/solubilizing groups attached. Ligand can also contain nonbinding N, P, As, O, S, or Se atoms. |
| N Valence Stabilizer #7: Guanidines, Diguanidines, and Polyguanidines (N—N Bidentates, N—N Tridentates, N—N Tetradentates, and N—N Hexadentates) | RR'—N—C(═NH)NR''R''', where R, R', R'', and R''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #8: Phosphonitrile Amides, and Bis(phosphonitrile amides) (N—N Bidentates, N—N Tetradentates) | RR'—N—P(═N)—N—R''R''', where R, R', R'', and R''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #9: Phosphonimidic Diamides, Bis(Phosphonimidic Diamides), and Poly(Phosphonimidic Diamides) (N—N Bidentates, N—N Tetradentates) | (NH═)PR'''(—NRR')(—NR''R''''), where R, R', R'', R''', and R'''' represent H or any organic functional group wherein the number of carbon atoms ranges from 0 to 40, optionally having halogen or polarizing or water-insolubilizing/solubilizing groups attached. |

TABLE 2-continued

Narrow Band Organic Valence Stabilizers for the $Co^{+3}$ Ion

| General Structural Name (Type of Organic) | Structural Representation |
|---|---|
| | Ligand can also contain nonbinding N, O, S, or P atoms. |
| N Valence Stabilizer #10: | (NH═)PR'''(—NRR')(—OR'') for |
| Phosphonamidimidic Acid, Phosphonamidimidothioic Acid, Bis(Phosphonamidimidic Acid), Bis(Phosphonamidimidothioic Acid), Poly(Phosphonamidimidic Acid), Poly(Phosphonamidimidothioic Acid), and derivatives thereof (N—N Bidentates, and N—N Tetradentates) | phosphonamidimidic acid and (NH═)PR''' (—NRR')(—SR'') for phosphonamidimidothioic acid, where R, R', R'', and R''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #11: | $C_5H_5N$—CR—NR', where $C_5H_5N$ is a pyridine |
| Pyridinaldimines, Bis(pyridinaldimines), and Poly(pyridinaldimines) (N—N Bidentates, N—N Tridentates, and N—N Tetradentates) | derivative, R is typically an aromatic constituent (i.e. —$C_6H_5$), and R' represents H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N Valence Stabilizer #12: | R—NH—N═R', where R and R' represent H or |
| Hydrazones, Bis(hydrazones), and Poly(hydrazones) (N Monodentates, N—N Bidentates, N—N Tridentates, and N—N Tetradentates) | any organic functional group wherein the number of carbon atoms ranges from 0 to 40, optionally having halogen or polarizing or water-insolubilizing/solubilizing groups attached. (Either R or R' is typically an aryl group.) Ligand can also contain nonbinding N, O, S, or P atoms. |
| N Valence Stabilizer #13: | R—N═N—R' for azo compounds, R—N═N—NH—R' |
| Azo compounds including triazenes without chelate substitution at the ortho- (for aryl) or alpha- or beta- (for alkyl) positions, Bis(azo compounds), or Poly(azo compounds) (N Monodentates, N—N Bidentates, or N—N—N Tridentates) | for triazenes, where R, and R' represent H or any organic functional group wherein the number of carbon atoms ranges from 0 to 40, optionally having halogen or polarizing or water-insolubilizing/solubilizing groups attached. (Not including ortho- chelate substituted aryl azo compounds, and alpha- or beta-substituted alkyl azo compounds.) Ligand can also contain nonbinding N, O, S, or P atoms. |
| N Valence Stabilizer #14: | R—N═N—CR'N—NR''R''', where R, R', R'', and |
| Formazans, Bis(formazans), and Poly(formazans) without ortho- hydroxy, carboxy, thiol, mercapto, amino, or hydrazido substitution (N—N Bidentates, N—N Tetradentates, and N—N Hexadentates) | R''' represent H, or any organic functional group wherein the number of carbon atoms ranges from 0 to 40, optionally having halogen or polarizing or water-insolubilizing/solubilizing groups attached. (Not including ortho- hydroxy, carboxy, thiol, mercapto, amino, or hydrazido substitution.) Ligand can also contain nonbinding N, O, S, or P atoms. |
| N Valence Stabilizer #15: | R—CH═N—CHR'—N═CHR'', where R, R', and R'' |
| Hydramides (N—N Bidentates) | represent H, or any organic functional group wherein the number of carbon atoms ranges from 0 to 40, optionally having halogen or polarizing or water-insolubilizing/solubilizing groups attached. (R, R', and R'' are typically aryl derivatives.) Ligand can also contain nonbinding N, O, S, or P atoms. |
| N Valence Stabilizer #16: | RR'C═N—N═CR''R''' or RR'C═N—NR''R''' (for |
| Azines (including ketazines), Bis(azines), and Poly(azines) without ortho- hydroxy, carboxy, thiol, mercapto, amino, or hydrazido substitution (N—N Bidentates, N—N Tetradentates, and N—N Hexadentates) | ketazines), where R, R', R'', and R''' represent H, or any organic functional group wherein the number of carbon atoms ranges from 0 to 40, optionally having halogen or polarizing or water-insolubilizing/solubilizing groups attached. (Not including ortho- hydroxy, carboxy, thiol, mercapto, amino, or hydrazido |

TABLE 2-continued

Narrow Band Organic Valence Stabilizers for the $Co^{+3}$ Ion

| General Structural Name (Type of Organic) | Structural Representation |
|---|---|
| | substitution.) Ligand can also contain nonbinding N, O, S, or P atoms. |
| N Valence Stabilizer #17: | RR'C═N—R", where R, R', and R" represent H, |
| Schiff Bases with one Imine (C═N) Group and without ortho- (for aryl constituents) or alpha- or beta- (for alkyl constituents) hydroxy, carboxy, carbonyl, thiol, mercapto, thiocarbonyl, amino, imino, oximo, diazeno, or hydrazido substitution (N Monodentates) | or any organic functional group wherein the number of carbon atoms ranges from 0 to 40, optionally having halogen or polarizing or water-insolubilizing/solubilizing groups attached. (Not including ortho-, alpha-, or beta-hydroxy, carboxy, carbonyl, thiol, mercapto, thiocarbonyl, amino, imino, oximo, diazeno, or hydrazido substitution.) Ligand can also contain nonbinding N, O, S, or P atoms. |
| N Valence Stabilizer #18: | Isocyanides, cyanamides, and related ligands |
| Isocyanide and Cyanamide and related ligands (N Monodentates) | where the nitrogen atom is directly complexed to the high valence metal ion. |
| N Valence Stabilizer #19: | Nitrosyl, nitrite, and related ligands where the |
| Nitrosyl and Nitrite and related ligands (N Monodentates) | nitrogen atom is bound directly to the high valence metal ion. |
| N Valence Stabilizer #20: | R—CN, R—$(CN)_2$, R—$(CN)_x$, etc. where R |
| Nitriles, Dinitriles, and Polynitriles (N Monodentates, N—N Bidentates, and N—N—N Tridentates) | represents H or any organic functional group wherein the number of carbon atoms ranges from 0 to 40, optionally having halogen or polarizing or water-insolubilizing/solubilizing groups attached. |
| N Valence Stabilizer #21: | Azide (—$N_3$) ligands bound directly to the high |
| Azide ligands (N Monodentates, or N—N Bidentates) | valence metal ion. Also includes organoazide derivatives (R—$N_3$), triazenido compounds (R—$N_3$—R'), phosphonyl azides (R—$PO_2H$—$N_3$), phosphoryl azides (O—$PO_2H$—$N_3$), and sulfonyl azides (R—$SO_2$—$N_3$) where R and R' represent H or any organic functional group wherein the number of carbon atoms ranges from 0 to 35, optionally having halogen or polarizing or water-insolubilizing/solubilizing groups attached |
| S Valence Stabilizer #1: | $SH_2$, SHR, $SR_2$, where R represents H or any |
| Monothioethers (S Monodentates) wherein at least one Sulfur Atom is a Binding Site | organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| S Valence Stabilizer #2: | R—S—S—R', where R and R' represents H or any |
| Disulfides (S Monodentates) wherein at least one Sulfur Atom is a Binding Site | organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| S Valence Stabilizer #3: | R—S—R'—S—R", where R, R', and R" represents H |
| Dithioethers (S—S Bidentates) wherein at least one Sulfur Atom is a Binding Site | or any organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| S Valence Stabilizer #4: | R—S—R'—S—R"—S—R"', where R, R', R", and R"' |
| Trithioethers (S—S Bidentates or S—S Tridentates) wherein at least one Sulfur Atom is a Binding Site | represents H or any organic functional group wherein the number of carbon atoms ranges from 0 to 35, optionally having halogen or polarizing or water-insolubilizing/solubilizing groups attached. Ligand can also contain nonbinding N, P, O, S, or Se atoms. |

TABLE 2-continued

Narrow Band Organic Valence Stabilizers for the $Co^{+3}$ Ion

| General Structural Name (Type of Organic) | Structural Representation |
|---|---|
| S Valence Stabilizer #5: | R—S—R'—S—R''—S—R'''—S—R'''', where R, R', R'', |
| Tetrathioethers (S—S Bidentates, S—S Tridentates, or S—S Bidentates) wherein at least one Sulfur Atom is a Binding Site | R''', and R'''' represents H or any organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| S Valence Stabilizer #6: | R—S—R'—S—R''—S—R'''—S—R''''—S—R'''''—S—R''''', |
| Hexathioethers (S—S Bidentates, S—S Tridentates, S—S Tetradentates, or S—S Hexadentates) wherein at least one Sulfur Atom is a Binding Site | where R, R', R'', R''', R'''', R''''', and R''''' represents H or any organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| S Valence Stabilizer #7: | Five membered heterocyclic ring containing |
| Five-Membered Heterocyclic Rings containing One or Two Sulfur Atoms wherein at least one Sulfur Atom is a Binding Site (S Monodentates or S—S Bidentates) | one or two sulfur atoms, both of which may function as binding sites. Can include other ring systems bound to this heterocyclic ring, but they do not coordinate with the stabilized, high valence metal ion. Ring can also contain O, N, P, As, or Se atoms. This 5-membered ring and/or attached, uncoordinating rings may or may not have halogen or polarizing or water insolubilizing/solubilizing groups attached. |
| S Valence Stabilizer #8: | Six membered heterocyclic ring containing just |
| Six-Membered Heterocyclic Rings containing One or Two Sulfur Atoms wherein at least one Sulfur Atom is a Binding Site (S Monodentates or S—S Bidentates) | one or two sulfur atoms, both of which may function as binding sites. Can include other ring systems bound to this heterocyclic ring, but they do not coordinate with the stabilized, high valence metal ion. Ring can also contain O, N, P, As, or Se atoms. This 5-membered ring and/or attached, uncoordinating rings may or may not have halogen or polarizing or water-insolubilizing/solubilizing groups attached. |
| S Valence Stabilizer #9: | Five membered heterocyclic ring(s) containing |
| Five-Membered Heterocyclic Rings containing One or Two Sulfur Atoms at least one additional Sulfur Atom Binding Site not in a Ring (S Monodentates, S—S Bidentates, S—S Tridentates, S—S Tetradentates, or S—S Hexadentates) | one or two sulfur atoms. In addition, ligand contains additional sulfur-containing substituents (usually thiols or thioethers) that constitute S binding sites. Can include other ring systems bound to the heterocyclic ring or to the S-containing substituent, but they do not coordinate with the stabilized, high valence metal ion. Ring(s) can also contain O, N, P, As or Se atoms. This 5-membered ring(s) and/or attached, uncoordinating rings and/or S-containing substituent(s) may or may not have halogen or polarizing or water-insolubilizing/solubilizing groups attached. |
| S Valence Stabilizer #10: | Six membered heterocyclic ring(s) containing |
| Six-Membered Heterocyclic Rings containing One or Two Sulfur Atoms at least one additional Sulfur Atom Binding Site not in a Ring (S Monodentates, S—S Bidentates, S—S Tridentates, S—S Tetradentates, or S—S Hexadentates) | one or two sulfur atoms. In addition, ligand contains additional sulfur-containing substituents (usually thiols or thioethers) that constitute S binding sites. Can include other ring systems bound to the heterocyclic ring or to the S-containing substituent, but they do not coordinate with the stabilized, high valence metal ion. Ring(s) can also contain O, N, P, As or Se atoms. This 6-membered ring(s) and/or attached, uncoordinating rings and/or S-containing substituent(s) may or may not have halogen or polarizing or water-insolubilizing/solubilizing groups attached. |
| S Valence Stabilizer #11: | Five membered heterocyclic ring(s) containing |
| Five-Membered Heterocyclic Rings containing One or Two Sulfur Atoms at | one or two sulfur atoms. In addition, ligand contains additional sulfur-containing rings that |

TABLE 2-continued

Narrow Band Organic Valence Stabilizers for the $Co^{+3}$ Ion

| General Structural Name (Type of Organic) | Structural Representation |
|---|---|
| least one additional Sulfur Atom Binding Site in a separate Ring (S Monodentates, S—S Bidentates, S—S Tridentates, S—S Tetradentates, or S—S Hexadentates) | constitute S binding sites. Can include other ring systems bound to the S-containing heterocyclic rings, but they do not coordinate with the stabilized, high valence metal ion. Ring(s) can also contain O, N, P, As, or Se atoms. This 5-membered ring(s) and/or additional S-containing ring(s) and/or attached, uncoordinating rings may or may not have halogen or polarizing or water-insolubilizing/solubilizing groups attached. |
| S Valence Stabilizer #12: | Six membered heterocyclic ring(s) containing |
| Six-Membered Heterocyclic Rings containing One or Two Sulfur Atoms at least one additional Sulfur Atom Binding Site in a separate Ring (S Monodentates, S—S Bidentates, S—S Tridentates, S—S Tetradentates, or S—S Hexadentates) | one or two sulfur atoms. In addition, ligand contains additional sulfur-containing rings that constitute S binding sites. Can include other ring systems bound to the S-containing heterocyclic rings, but they do not coordinate with the stabilized, high valence metal ion. Ring(s) can also contain O, N, P, As, or Se atoms. This 6-membered ring(s) and/or additional S-containing ring(s) and/or attached, uncoordinating rings may or may not have halogen or polarizing or water-insolubilizing/solubilizing groups attached. |
| S Valence Stabilizer #13: | Macrocyclic ligands containing two to ten |
| Two-, Three-, Four-, Five-, Six-, Seven-, Eight-, Nine-, and Ten-Membered Macrocyclics, Macrobicyclics, and Macropolycyclics (including Catapinands, Cryptands, Cyclidenes, and Sepulchrates) wherein all Binding Sites are composed of Sulfur (usually thiol or thioether groups) and are not contained in Component Heterocyclic Rings (S—S Bidentates, S—S Tridentates, S—S Tetradentates, and S—S Hexadentates) | sulfur binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| S Valence Stabilizer #14: | Macrocyclic ligands containing a total of four to |
| Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur and are contained in Component 5-Membered Heterocyclic Rings (S—S Tridentates, S—S Tetradentates or S—S Hexadentates) | ten five-membered heterocyclic rings containing sulfur binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S Valence Stabilizer #15: | Macrocyclic ligands containing at least one 5- |
| Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur and are contained in a Combination of 5-Membered Heterocyclic Rings and Thiol, Thioether, or Thioketo Groups (S—S Tridentates, S—S Tetradentates, or S—S Hexadentates) | membered heterocyclic ring. These heterocyclic rings provide sulfur binding sites to valence stabilize the central metal ion. Other thiol, thioether, or thioketo binding sites can also be included in the macrocyclic ligand, so long as the total number of binding sites is four to ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S Valence Stabilizer #16: | Macrocyclic ligands containing a total of four to |
| Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur and are contained in Component 6-Membered Heterocyclic Rings (S—S Tridentates, S—S Tetradentates, or S—S Hexadentates) | ten six-membered heterocyclic rings containing sulfur binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |

TABLE 2-continued

Narrow Band Organic Valence Stabilizers for the $Co^{+3}$ Ion

| General Structural Name (Type of Organic) | Structural Representation |
|---|---|
| S Valence Stabilizer #17: Four-, Five-, Six-, Seven-, Eight-, Nine-, or Ten-Membered Macrocyclics, Macrobicyclics, and Macropolycyclics (including Catapinands, Cryptands, Cyclidenes, and Sepulebrates) wherein all Binding Sites are composed of Sulfur and are contained in a Combination of 6-Membered Heterocyclic Rings and Thiol, Thioether, or Thioketo Groups (S—S Tridentates, S—S Tetradentates, or S—S Hexadentates) | Macrocyclic ligands containing at least one 6-membered heterocyclic ring. These heterocyclic rings provide sulfur binding sites to valence stabilize the central metal ion. Other thiol, thioether, or thioketo binding sites can also be included in the macrocyclic ligand, so long as the total number of binding sites is four to ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S Valence Stabilizer #18: Dithiobiurets (Dithioimidodicarbonic Diamides), Dithioisobiurets, Dithiobiureas, Trithiotriurets, Trithiotriureas, Bis(dithiobiurets), Bis(dithioisobiurets), Bis(dithiobiureas), Poly(dithiobiurets), Poly(dithioisobiurets), and Poly(dithiobiureas) (S—S Bidentates, S—S Tridentates, S—S Tetradentates) | RR'—N—C(=S)—NR''—C(=S)—NR'''R'''' for dithiobiurets, and RR'—N—C(=S)—NR''—NH—C(=S)—NR'''R'''' for dithiobiureas, where R, R', R'', R''', and R'''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #19: Thioacylthioureas, Thioaroylthioureas, Bis(thioacylthioureas), Bis(thioaroylthioureas), Poly(thioacylthioureas), and Poly(thioaroylthioureas) (S—S Bidentates, S—S Tridentates, S—S Tetradentates) | RR'—N—C(=S)—NR''—C(=S)—R''' where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #20: Dithioacyl disulfides, Bis(dithioacyl disulfides), and Poly(dithioacyl disulfides) (S—S Bidentates, S—S Tridentates, S—S Tetradentates) | R—C(=S)—S—S—C(=S)—R' where R, and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #21: Tetrathioperoxydicarbonic Diamides, Bis(tetrathioperoxydicarbonic diamides), and poly(tetrathioperoxydicarbonic diamides) (S—S Bidentates, S—S Tridentates, S—S Tetradentates) | RR'—N—C(=S)—S—S—C(=S)—N—R''R''' where R, R', R'', R''' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #22: Hexathio-, Pentathio-, and Tetrathioperoxydicarbonic Acids, Bis(hexathio-, pentathio-, and acids, tetrathioperoxydicarbonic acids), poly(hexathio-, pentathio-, and tetrathioperoxydicarbonic acids), and derivatives thereof (S—S Bidentates, S—S Tridentates, S—S Tetradentates) | R—S—C(=S)—S—S—C(=S)=S=R' for hexathioperoxydicarbonic acids, R—O—C(=S)—S—S—C(=S)—S—R' for pentathioperoxydicarbonic and R—O—C(=S)—S—S—C(=S)—O—R' for tetrathioperoxydicarbonic acids, where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #23: Dithioperoxydiphosphoramide, Bis(dithioperoxyphosphoramide), and Poly(dithioperoxydiphosphoramide) (S—S Bidentates, S—S Tridentates, S—S Tetradentates) | (RR'—N—)(R''R'''—N—)P(=S)—S—S—P(=S)(—N—R''''R''''')(—N—R'''''R''''''), where R, R', R'', R''', R'''', R''''', R''''', and R''''''' represent H, $NH_2$ or any organic functional group wherein the number of carbon atoms ranges from 0 to 40, optionally having halogen or polarizing or water-insolubilizing/solubilizing groups |

TABLE 2-continued

Narrow Band Organic Valence Stabilizers for the $Co^{+3}$ Ion

| General Structural Name (Type of Organic) | Structural Representation |
|---|---|
| | attached. Ligan can also contain nonbinding N, O, S, or P atoms. |
| S Valence Stabilizer #24: | (R—O—)(R'—O—)P(═S)—S—S—P(═S)(—O—R'')(—O— |
| Dithioperoxydiphosphoric Acids, Bis(dithioperoxyphosphoric Acids), Poly(dithioperoxydiphosphoric Acids), and derivatives thereof (S—S Bidentates, S—S Tridentates, S—S Tetradentates) | R'''); (R—O—)(R'—S—)P(═S)—S—S—P(═S)(—S—R'')(—O—R'''); or (R—S—)(R'—S—)P(═S)—S—S—P(═S)(—S—R')(—S—R''), where R, R', R'', R''', R'''', R''''', R'''''', and R'''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #25: | (R—O—)(R'—)P(═S)—NH—P(═S)(—R'')(—O—R'''); |
| Dithioimidodiphosphonic Acids, Dithiohydrazidodiphosphonic Acids, Bis(dithioimidodiphosphonic acids), Bis(dithiohydrazidodiphosphonic acids), derivatives for dithiohydrazidodiphosphonic Poly(dithioimidodiphosphonic acids), Poly(dithiohydrazidodiphosphonic acids), and derivatives thereof (S—S Bidentates, S—S Tridentates, and S—S Tetradentates) | (R—S—)(R'—)P(═S)—NH—P(═S)(—R'')(—O—R'''); or (R—S—)(R'—)P(═S)—NH—P(═S)(—R'')(—S—R''') for dithioimidodiphosphonic acids, and NH—NH— acids, where R, R', R'', and R''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #26: | (RR'—N—)(R''—)P(═S)—NH—P(═S)(—R''')—N— |
| Dithiolmidodiphosphonamides, Dithiohydrazidodiphosphonarnides, Bis(dithioirnidodiphosphonamides), R''''R'''') for Bis(dithiohydrazidodiphosphonamides), Poly(dithioimidodiphosphonamides), Poly(dithiohydrazidodiphosphonamides) (S—S Bidentates, S—S Tridentates, S—S Tetradentates) | R''''R'''') for dithioimidophosphonamides, and (RR'—N—)(R''—)P(═S)—NH—NH—P(═S)(—R''')(—N— dithiohydrazidodiphosphonamides, where R, and R', R'', R''', R'''', and R''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #27: | (RR'—N—)(R''—)P(═S)-S-P(═S)(—R''')(—N— |
| Dithiodiphosphonamides, Bis(dithiophosphonarnides), and Poly(dithiodiphosphonamides) (S—S Bidentates, S—S Tridentates, S—S Tetradentates) | R''''R'''''), or (RR'—N—)(R''—)P(═S)—O—P(═S)(—R''')(N—R''''R'''''), where R, R', R'', R''', R'''', and R''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #28: | (R—O—)(R'—)P(═S)—O—P(═S)(—R'')(—O—R'''); (R—O—) |
| Dithiodiphosphonic Acids, Bis(dithioiphosphonic Acids), Poly(dithiodiphosphonic Acids), and derivatives thereof (S—S Bidentates, S—S Tridentates, S—S Tetradentates) | (R'—)P(═S)—S—P(═S)(—R'')(—O—R'''); (R—S—)(R'—)P(═S)—O—P(═S)(—R'')(—S—R'''); or (R—S—)(R'—)P(═S)—S—P(═S)(—R'')(—S—R'''); where R, R', R'', and R''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #29: | (RR'—N—)(R''—)P(═S)—S—S—P(═S)(—R''')(—N— |
| Dithioperoxydiphosphonamide, Bis(dithioperoxyphosphonamide), and Poly(dithioperoxydiphosphonamide) (S—S Bidentates, S—S Tridentates, S—S Tetradentates) | R''''R'''''), where R, R', R'', R''', R'''', and R''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 2-continued

Narrow Band Organic Valence Stabilizers for the $Co^{+3}$ Ion

| General Structural Name (Type of Organic) | Structural Representation |
|---|---|
| S Valence Stabilizer #30: | (R—O—)(R'—)P(═S)—S—S—P(═S)(—R'')(—O—R'''); or |
| Dithioperoxydiphosphonic Acids, Bis(dithioperoxyphosphonic Acids), Poly(dithioperoxydiphosphonic Acids), and derivatives thereof (S—S Bidentates, S—S Tridentates, S—S Tetradentates) | (R—S—)(R'—)P(═S)—S—S—P(═S)(—R'')(—S—R'''), where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #31: | (O═)PR(—S—R')(—S—R'') or (S═)PR(—S—R')(—O— |
| Dithiophosphonic Acids (Phosphonodithioic Acids), Bis(dithiophosphonic Acids), Poly(dithiophosphonic Acids), and derivatives thereof (S—S Bidentates, S—S Tridentates, S—S Tetradentates) | R''), where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #32: | (S═)PR(—S—R')(—S—R''), where R, R', and R'' |
| Trithiophosphonic Acids (Phosphonotrithioic Acids), Bis(trithiophosphonic Acids), Poly(trithiophosphonic Acids), and derivatives thereof (S—S Bidentates, S—S Tridentates, S—S Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #33: | (O═)PR(—S—S—R')(—S—R'') or (S═)PR(—S—S—R') |
| Phosphono(dithioperoxo)thioic Acids), Bis[phosphono(dithioperoxo)thioic Acids], Poly[phosphono(dithioperoxo)thioic Acids], and derivatives thereof (S—S Bidentates, S—S Tridentates, S—S Tetradentates) | (—O—R''), where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #34: | (S═)PR(—S—S—R')(—S—R''), where R, R', and R'' |
| Phosphono(dithioperoxo)dithioic Acids), Bis[phosphono(dithioperoxo)dithioic Acids], Polyl[phosphono(dithioperoxo)dithioic Acids], and derivatives thereof (S—S Bidentates, S—S Tridentates, S—S Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #35: | R—S—R'CSOH or R—S—R'CSSH for S- |
| S-(Alkylthio)thiocarboxylic Acids, S-(Arylthio)thiocarboxylic Acids, and S,S-thiobisthiocarboxylic Acids (S—S Bidentates and S—S Tridentates) | (alkylthio)thiocarboxylic and S-(arylthio)thiocarboxylic acids, and HSOCR—S—R'COSH or HSSCR—S—R'CSSH for S,S-thiobisthiocarboxylic acids, where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #36: | R—S—S—R'CSOH or R—S—S—R'CSSH for S— |
| S-(Alkyldisulfido)thiocarboxylic Acids, S-(Aryldisulfido)thiocarboxylic Acids, and S,S'—Disulfidobisthiocarboxylic Acids (S—S Bidentates and S—S Tridentates) | (alkyldi sulfido)thiocarboxylic and S—(aryldisulfido)thiocarboxylic acids, and HSOCR—S—S—R'COSH or HSSCR—S—S—R'CSSH for S,S'—disulfidobisthiocarboxylic acids, where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #37: | R—CH(—SR'')—CH(—SR''')—R', and R—C(— |
| 1,2-Dithiolates, Bis(1,2-dithiolates), and | SR'')═C(—SR''')—R', where R, R', R'', and R''' |

TABLE 2-continued

Narrow Band Organic Valence Stabilizers for the $Co^{+3}$ Ion

| General Structural Name (Type of Organic) | Structural Representation |
|---|---|
| Poly(1,2-dithiolates) (S—S Bidentates, S—S Tridentates, S—S Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #38: | RN—C(═O)—CHR'—S—C(═S) for rhodanines, and |
| Rhodanines and Bis(rhodanines) (S—S Bidentates and S—S Tetradentates) | R—[N—C(═O)—CHR'—S—C(═S)]$_2$ for bis(rhodanines), where R and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #39: | RN—C(SH)(SH), where R represents H, $NH_2$ or |
| Dithiocarbimates, Bis(dithiocarbimates), and Poly(dithiocarbimates) (S—S Bidentates, S—S Tridentates, and S—S Tetradentates) | any organic functional group wherein the number of carbon atoms ranges from 0 to 40, optionally having halogen or polarizing or water-insolubilizing/solubilizing groups N, O, S, or P atoms. |
| S Valence Stabilizer #40: | $RS^+$═C(SH)(SH) or RS—C(═S)(SH), where R |
| Thioxanthates, Bis(thioxanthates), and Poly(thioxanthates) (S—S Bidentates and S—S Tetradentates) | represents H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #41: | $RO^+$═C(SH)(SH) or RO—C(═S)(SH), where R |
| Xanthates, Bis(xanthates), and Poly(xanthates) (S—S Bidentates and S—S Tetradentates) | represents H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #42: | Typically RR'R"P═C(SH)(SH) [pentavalent P], |
| Phosphinodithioformates (S—S Bidentates) | although RR'P—C(═S)(SH) [trivalent P] may be acceptable in some situations, where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #43: | R—S—C(—S—R")—O—R' for dithioborates, R—S—C |
| Alkyl- and Aryl- Dithioborates, Trithioborates, Perthioborates, Bis(dithioborates), Bis(trithioborates), and Bis(perthioborates) (S—S Bidentates and S—S Tetradentates) | (—S—R")—S—R' for trithioborates, and R—S—S—C(S—R")—S—R' for perthioborates, where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #44: | R—C(—S—R")—S—R', where R, R', and R" |
| Alkyl- and Aryl- Dithioboronates, and Bis(dithioboronates) (S—S Bidentates and S—S Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 2-continued

Narrow Band Organic Valence Stabilizers for the $Co^{+3}$ Ion

| General Structural Name (Type of Organic) | Structural Representation |
|---|---|
| S Valence Stabilizer #45: | (O═)As(—S—R)(—S—R')(—S—R'') or (S═)As(—S—R) |
| Trithioarsonic Acids (Arsonotrithioic Acids), Dithioarsonic Acids (Arsonodithioic Acids), Tetrathioarsonic Acids (Arsonotetrathioic Acids), and derivatives thereof (S—S Bidentates, S—S Tridentates, S—S Tetradentates) | (—S—R')(—O—R'') for trithioarsonic acid; (O═)As(—O—R)(—S—R')(—S—R'') or (S═)As(—S—R)(—O—R')(—O—R'') for dithioarsonic acid, or (S═)As(—S—R)(—S—R')(—S—R'') for tetrathioarsonic acid, where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #46: | (O═)Sb(—S—R)(—S—R')(—S—R'') or (S═)Sb(—S—R) |
| Trithioantimonic Acids (Stibonotrithioic Acids), Dithioantimonic Acids (Stibonodithioic Acids), Tetrathioantimonic Acids (Stibonotetrathioic Acids), and derivatives thereof (S—S Bidentates, S—S Tridentates, S—S Tetradentates) | (—S—R')(—O—R'') for trithioantimonic acid; (O═)Sb(—O—R)(—S—R')(—S—R'') or (S═)Sb(—S—R)(—O—R')(—O—R'') for dithioantimonic acid, or (S═)Sb(—S—R)(—S—R')(—S—R'') for tetrathioantimonic acid, where R, R', and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S Valence Stabilizer #47: | RR'R''P═S for phosphine P-sulfides, and |
| Phosphine P-sulfides and Amino-substituted Phosphine sulfides (S Monodentates) | (RR'N)(R''R'''N)(R''''R'''''N)P═S for amino-substituted phosphine sulfides, where R, R', R'', R''', R'''', and R''''' represent H, Cl, Br, $NH_2$ or any organic functional group wherein the number of carbon atoms ranges from 0 to 40, optionally having halogen or polarizing or water-insolubilizing/solubilizing groups attached. (Rs are typically aromatic or heterocyclic for phosphine P-sulfides.) Ligand can also contain nonbinding N, O, S, or P atoms. |
| S Valence Stabilizer #48: | RR'R''As═S for arsine As-sulfides, and |
| Arsine As-sulfides and Amino-substituted Arsine sulfides (S Monodentates) | (RR'N)(R''R'''N)(R''''R'''''N)As═S for amino-substituted arsine sulfides, where R, R', R'', R''', R'''', and R''''' represent H, Cl, Br, $NH_2$ or any organic functional group wherein the number of carbon atoms ranges from 0 to 40, optionally having halogen or polarizing or water-insolubilizing/solubilizing groups attached. (Rs are typically aromatic or heterocyclic for arsine As-sulfides.) Ligand can also contain nonbinding N, O, S, or P atoms. |
| S Valence Stabilizer #49: | Thiocyanates bound directly to the high valence |
| Thiocyanate ligands (S Monodentates) | metal ion. |
| S Valence Stabilizer #50: | Thiols (HS—R, HS—R—SH, etc.), where R and R' |
| Thiolates (S Monodentates) | represent H or any organic functional group wherein the number of carbon atoms ranges from 0 to 35, optionally having halogen or polarizing or water-insolubilizing/solubilizing groups attached. |
| S Valence Stabilizer #51: | Sulfide ($—S^{2-}$) ligands bound directly to the high |
| Sulfide ligands (S Monodentates) | valence metal ion. |
| P Valence Stabilizer #1: | $PH_3$, $PH_2R$, $PHR_2$, and $PR_3$ where R represents |
| Monophosphines (P Monodentates) wherein at least one Phosphorus Atom is a Binding Site | H or any organic functional group wherein the number of carbon atoms ranges from 0 to 35, optionally having halogen or polarizing or water-insolubilizing/solubilizing groups attached. Ligand can also contain nonbinding N, P, As, O, S, or Se atoms. |

TABLE 2-continued

Narrow Band Organic Valence Stabilizers for the $Co^{+3}$ Ion

| General Structural Name (Type of Organic) | Structural Representation |
|---|---|
| P Valence Stabilizer #2: | R'—P—R—P—R", where R, R', and R" represent H |
| Diphosphines (a P—P Bidentate) wherein at least one Phosphorus Atom is a Binding Site | or any organic functional group wherein the number of carbon atoms ranges from 0 to 35, optionally having halogen or polarizing or water-insolubilizing/solubilizing groups N, P, As, O, S, or Se atoms. |
| P Valence Stabilizer #3: | R—P—R'—P—R"—P—R"', where R, R', R", and R"' |
| Triphosphines (either P—P Bidentates or P—P—P Tridentates) wherein at least one Phosphorus Atom is a Binding Site | represent H or any organic functional group wherein the number of carbon atoms ranges from 0 to 35, optionally having halogen or polarizing or water-insolubilizing/solubilizing groups attached. Ligand can also contain nonbinding N, P, As, O, S, or Se atoms. |
| P Valence Stabilizer #4: | R—P—R'—P—R"—P—R"'—P—R"", where R, R', R", |
| Tetraphosphines (P—P Bidentates, P—P Tridentates, or P—P Tetradentates) wherein at least one Phosphorus Atom is a Binding Site | R"', and R"" represent H or any organic functional group wherein the number of carbon atoms ranges from 0 to 35, optionally having halogen or polarizing or water-insolubilizing/solubilizing groups attached. Ligand can also contain nonbinding N, P, As, O, S, or Se atoms. |
| P Valence Stabilizer #5: | R—P—R'—P—R"—P—R"'—P—R""—P—R"", where R, |
| Pentaphosphines (P—P Bidentates, P—P Tridentates, or P—P Tetradentates) wherein at least one Phosphorus Atom is a Binding Site | R', R", R"', R"", and R"" represent H or any organic functional group wherein the number of carbon atoms ranges from 0 to 35, optionally having halogen or polarizing or water-insolubilizing/solubilizing groups attached. Ligand can also contain nonbinding N, P, As, O, S, or Se atoms. |
| P Valence Stabilizer #6: | |
| Hexaphosphines (P—P Bidentates, P—P Tridentates, P—P Tetradentates, or P—P Hexadentates) wherein at least one Phosphorus Atom is a Binding Site | where R, R', R", R"', R"", R"", and R"" represent H or any organic functional group wherein the number of carbon atoms ranges from 0 to 35, optionally having halogen or polarizing or water-insolubilizing/solubilizing groups attached. Ligand can also contain nonbinding N, P, As, O, S, or Se atoms. |
| P Valence Stabilizer #7: | Five membered heterocyclic ring containing |
| Five-Membered Heterocyclic Rings containing One, Two, or Three Phosphorus Atoms wherein at least one Phosphorus Atom is a Binding Site (P Monodentates or P—P Bidentates) | one, two, or three phosphorus atoms, all of which may or may not function as binding sites. Can include other ring systems bound to this heterocyclic ring, but they do not coordinate with the stabilized, high valence metal ion. Ring can also contain O, S, N, As, or Se atoms. This 5-membered ring and/or attached, uncoordinating rings may or may not have halogen or polarizing or water-insolubilizing/solubilizing groups attached. |
| P Valence Stabilizer #8: | Six membered heterocyclic ring containing one, |
| Six-Membered Heterocyclic Rings containing One, Two, or Three Phosphorus Atoms wherein at least one Phosphorus Atom is a Binding Site (P Monodentates or P—P Bidentates) | two, or three phosphorus atoms, all of which may or may not function as binding sites. Can include other ring systems bound to this heterocyclic ring, but they do not coordinate with the stabilized, high valence metal ion. Ring can also contain O, S, N, As, or Se atoms. This 6-membered ring and/or attached, uncoordinating rings may or may not have halogen or polarizing or water-insolubilizing/solubilizing groups attached. |
| P Valence Stabilizer #9: | Five membered heterocyclic ring(s) containing |
| Five-Membered Heterocyclic Rings containing One, Two, or Three Phosphorus Atoms at least one additional Phosphorus Atom Binding Site not in a Ring (P Monodentates, P—P Bidentates, P—P | one, two, or three phosphorus atoms. In addition, ligand contains additional phosphorus-containing substituents (usually phosphines) that constitute P binding sites. Can include other ring systems bound to the |

TABLE 2-continued

Narrow Band Organic Valence Stabilizers for the $Co^{+3}$ Ion

| General Structural Name (Type of Organic) | Structural Representation |
|---|---|
| Tridentates, P—P Tetradentates, or P—P Hexadentates) | heterocyclic ring or to the P-containing substituent, but they do not coordinate with the stabilized, high valence metal ion. Ring(s) can also contain O, N, S, As or Se atoms. This 5-membered ring(s) and/or attached, uncoordinating rings and/or P-containing substituent(s) may or may not have halogen or polarizing or water-insolubilizing/solubilizing groups attached. |
| P Valence Stabilizer #10: | Six membered heterocyclic ring(s) containing |
| Six-Membered Heterocyclic Rings containing One, Two, or Three Phosphorus Atoms at least one additional Phosphorus Atom Binding Site not in a Ring (P Monodentates, P—P Bidentates, P—P Tridentates, P—P Tetradentates, or P—P Hexadentates) | one, two, or three phosphorus atoms. In addition, ligand contains additional phosphorus-containing substituents (usually phosphines) that constitute P binding sites. Can include other ring systems bound to the heterocyclic ring or to the P-containing substituent, but they do not coordinate with the stabilized, high valence metal ion. Ring(s) can also contain O, N, S, As or Se atoms. This 6-membered ring(s) and/or attached, uncoordinating rings and/or P-containing substituent(s) may or may not have halogen or polarizing or water-insolubilizing/solubilizing groups attached. |
| P Valence Stabilizer #11: | Five membered heterocyclic ring(s) containing |
| Five-Membered Heterocyclic Rings containing One, Two, or Three Phosphorus Atoms at least one additional Phosphorus Atom Binding Site in a separate Ring (P Monodentates, P—P Bidentates, P—P Tridentates, P—P Tetradentates, or P—P Hexadentates) | one, two, or three phosphorus atoms. In addition, ligand contains additional phosphorus-containing rings that constitute P binding sites. Can include other ring systems bound to the P-containing heterocyclic rings, but they do not coordinate with the stabilized, high valence metal ion. Ring(s) can also contain O, N, S, As, or Se atoms. This 5-membered ring(s) and/or additional P-containing ring(s) and/or attached, uncoordinating rings may or may not have halogen or polarizing or water-insolubilizing/solubilizing groups attached. |
| P Valence Stabilizer #12: | Six membered heterocyclic ring(s) containing |
| Six-Membered Heterocyclic Rings containing One, Two, or Three Phosphorus Atoms at least one additional Phosphorus Atom Binding Site in a separate Ring (P Monodentates, P—P Bidentates, P—P Tridentates, P—P Tetradentates, or P—P Hexadentates) | one, two, or three phosphorus atoms. In addition, ligand contains additional phosphorus-containing rings that constitute P binding sites. Can include other ring systems bound to the P-containing heterocyclic rings, but they do not coordinate with the stabilized, high valence metal ion. Ring(s) can also contain O, N, S, As, or Se atoms. This 6-membered ring(s) and/or additional P-containing ring(s) and/or attached, uncoordinating rings may or may not have halogen or polarizing or water-insolubilizing/solubilizing groups attached. |
| P Valence Stabilizer #13: | Macrocyclic ligands containing two, three, four, |
| Two-, Three-, Four-, Five-, Six-, and Eight-Membered Macrocyclics, Macrobicyclics, and Macropolycyclics (including Catapinands, Cryptands, Cyclidenes, and Sepulchrates) wherein all Binding Sites are composed of Phosphorus and are not contained in Component Heterocyclic Rings (P—P Bidentates, P—P Tridentates, P—P Tetradentates, and P—P Hexadentates) | five, six, or eight phosphorus binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| P Valence Stabilizer #14: | Macrocyclic ligands containing a total of four, |
| Four-, Six-, or Eight-Membered Macrocyclics, Macrobicyclics, and Macropolycyclics (including Catapinands, Cryptands, Cyclidenes, and Sepulchrates) wherein all Binding Sites are composed of Phosphorus and are contained in | six, or eight five-membered heterocyclic rings containing phosphorus binding sites. Can include other hydrocarbon/ring systems bound to this macrocyclic ligand, but they do not coordinate with the stabilized, high valence metal ion. This ligand and/or attached, |

TABLE 2-continued

Narrow Band Organic Valence Stabilizers for the $Co^{+3}$ Ion

| General Structural Name (Type of Organic) | Structural Representation |
|---|---|
| Component 5-Membered Heterocyclic Rings (P—P Tridentates, P—P Tetradentates, or P—P Hexadentates) | uncoordinating hydrocarbon/rings may or may not have halogen or polarizing or water-insolubilizing groups attached. |
| P Valence Stabilizer #15: | Macrocyclic ligands containing at least one 5- |
| Four-, Six-, or Eight-Membered Macrocyclics, Macrobicyclics, and Macropolycyclics (including Catapinands, Cryptands, Cyclidenes, and Sepulchrates) wherein all Binding Sites are composed of Phosphorus and are contained in a Combination of 5-Membered Heterocyclic Rings and Phosphine Groups (P—P Tridentates, P—P Tetradentates, or P—P Hexadentates) | membered heterocyclic ring. These heterocyclic rings provide phosphorus binding sites to valence stabilize the central metal ion. Other phosphine binding sites can also be included in the macrocyclic ligand, so long as the total number of binding sites is four, six, or eight. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| P Valence Stabilizer #16: | Macrocyclic ligands containing a total of four, |
| Four-, Six-, or Eight-Membered Macrocyclics, Macrobicyclics, and Macropolycyclics (including Catapinands, Cryptands, Cyclidenes, and Sepulchrates) wherein all Binding Sites are composed of Phosphorus and are contained in Component 6-Membered Heterocyclic Rings (P—P Tridentates, P—P Tetradentates, or P—P Hexadentates) | six, or eight six-membered heterocyclic rings containing phosphorus binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| P Valence Stabilizer #17: | Macrocyclic ligands containing at least one 6- |
| Four-, Six-, or Eight-Membered Macrocyclics, Macrobicyclics, and Macropolycyclics (including Catapinands, Cryptands, Cyclidenes, and Sepulchrates) wherein all Binding Sites are composed of Phosphorus and are contained in a Combination of 6-Membered Heterocyclic Rings and Phosphine Groups (P—P Tridentates, P—P Tetradentates, or P—P Hexadentates) | membered heterocyclic ring. These heterocyclic rings provide phosphorus binding sites to valence stabilize the central metal ion. Other phosphine binding sites can also be included in the macrocyclic ligand, so long as the total number of binding sites is four, six, or eight. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| O Valence Stabilizer #1: | RR'—N—C(═O)—NR''—C(═O)—NR'''R'''' for |
| Biurets (Imidodicarbonic Diamides), Isobiurets, Biureas, Triurets, Triureas, Bis(biurets), Bis(isobiurets), Bis(biureas), Poly(biurets), Poly(isobiurets), and Poly(biureas) (O—O Bidentates, O—O Tridentates, O—O Tetradentates) | biurets, and RR'—N—C(O)—NR''—NH—C(O)—NR'''R'''' for biureas, where R, R', R'', R''', and R'''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #2: | RR'—N—C(═O)—NR''—C(═O)—R''' where R, R', |
| Acylureas, Aroylureas, Bis(acylureas), Bis(aroylureas), Poly(acylureas), and Poly(aroylureas) (O—O Bidentates, O—O Tridentates, O—O Tetradentates) | R'', and R''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #3: | RC(═O)—NR'—C(O)—R'' for imidodialdehydes, |
| Imidodialdehydes, Hydrazidodialdehydes (Acyl hydrazides), Bis(imidodialdehydes), Bis(hydrazidodialdehydes), Poly(imidodialdehydes), and Poly(hydrazidodialdehydes) (O—O | and RC(═O)—NR'—NH—C(═0)—R'' for hydrazidodialdehydes (acyl hydrazides), where R, R', and R'' represent H, $NH_2$, or any organic functional group wherein the number of carbon atoms ranges from 0 to 40, optionally having |

TABLE 2-continued

Narrow Band Organic Valence Stabilizers for the $Co^{+3}$ Ion

| General Structural Name (Type of Organic) | Structural Representation |
|---|---|
| Bidentates, O—O Tridentates, O—O Tetradentates) | halogen or polarizing or water-insolubilizing/solubilizing groups attached. Ligand can also contain nonbinding N, O, S, or P atoms. |
| O Valence Stabilizer #4: | R—O—C(═O)—NR'—C(O)—O—R" for |
| Imidodicarbonic acids, Hydrazidodicarbonic acids, Bis(imidodicarbonic acids), Bis(hydrazidodicarbonic acids), Poly(imidodicarbonic acids), Poly(hydrazidodicarbonic acids) and derivatives thereof (O—O Bidentates, O—O Tridentates, O—O Tetradentates) | imidodicarbonic acids, and R—O—C(═O)—NR'—NH—C(═O)—O—R" for hydrazidodicarbonic acids, where R, R', and R" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #5: | RR'—N—S(═O)(═O)—NR"—S(═O)(═O)—NR"'R"" |
| Imidodisulfamic Acid, Imidodisulfuric Acid, Bis(Imidodisulfamic Acid), Bis(Imidodisulfuric Acid), Poly(Imidodisulfamic Acid), and Poly(Imidodisulfuric Acid) and thereof (O—O Bidentates, O—O Tridentates, O—O Tetradentates) | for imidodisulfamic acid, and R—O—S(═O)(═O)—NR'—S(═O)(═O)—OR" for imidosulfuric acid, where R, R', and R" represent H, $NH_2$, or any organic functional group wherein the number of derivatives carbon atoms ranges from 0 to 40, optionally having halogen or polarizing or water-insolubilizing/solubilizing groups attached. Ligand can also contain nonbinding N, O, S, or P atoms. |
| O Valence Stabilizer #6: | R—C(═O)—CR'R"—C(═O)—R"' where R, R', R", |
| 1,3-Diketones (Beta-Diketonates), 1,3,5-Triketones, Bis(1,3-Diketones), and Poly(1,3-Diketones), all with a Molecular Weight Greater than 125 (O—O Bidentates, O—O Tridentates, O—O Tetradentates) | and R"' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. If these ligands exhibit a molecular weight less than or equal to 125, the solubility of the resultant $Co^{+3}$-diketonate complex will be too high. |
| O Valence Stabilizer #7: | R—C(═O)—C(═O)—R' where R and R' represent |
| 1,2-Diketones (Alpha-Diketonates), 1,2,3-Triketones, Tropolonates, ortho-Quinones, Bis(1,2-Diketones), and Poly(1,2-Diketones), all with a Molecular Weight Greater than 100 (O—O Bidentates, O—O Tridentates, O—O Tetradentates) | H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. If these ligands exhibit a molecular weight less than or equal to 100, the solubility of the resultant $Co^{+3}$-diketonate complex will be too high. |
| O Valence Stabilizer #8: | RR'—N—C(═O)—CR"R"'—C(═O)—N—R""R""' |
| Malonamides (Malonodiamides), Bis(malonamides), and Polymalonamides (O—O Bidentates, O—O Tridentates, O—O Tetradentates) | where R, R', R", R"', R"", and R"'" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #9: | RR'—N—C(═O)—CR"R"'—C(═O)—R"" where R, |
| 2-Acylacetamides, Bis(2-acylacetamides), and Poly(2-acylacetamides) (O—O Bidentates, O—O Tridentates, O—O Tetradentates) | R', R", R"', and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #10: | RR'—N—C(═O)—S—C(═O)—N—R"R"' where R, R', |
| Monothiodicarbonic Diamides, Bis(monothiodicarbonic diamides), and Poly(monothiodicarbonic diamides) (O—O Bidentates, O—O Tridentates, O—O Tetradentates) | R", and R"' represent H, $NH_2$ or any organic functional group wherein the number of carbon atoms ranges from 0 to 40, optionally having halogen or polarizing or water-insolubilizing/solubilizing groups attached. |

TABLE 2-continued

Narrow Band Organic Valence Stabilizers for the $Co^{+3}$ Ion

| General Structural Name (Type of Organic) | Structural Representation |
|---|---|
| | Ligand can also contain nonbinding N, O, S, or P atoms. |
| O Valence Stabilizer #11: | R—O—C(═O)—S—C(═O)—O—R', where R and R' |
| Monothiodicarbonic Acids, Bis(monothiodicarbonic acids), Poly(monothiodicarbonic acids), and derivatives thereof (O—O Bidentates, O—O Tridentates, O—O Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #12: | R—O—C(═O)—S—S—C(═O)—O—R', where R and R' |
| Dithioperoxydicarbonic Acids, Bis(dithioperoxydicarbonic acids), poly(dithioperoxydicarbonic acids), and derivatives thereof (O—O Bidentates, O—O Tridentates, O—O Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #13: | R—O—S(═O)(═O)—S—S(═O)(═O)—O—R', where R |
| Trithionic acid, Bis(trithionic acid), Poly(trithionic acid), and derivatives thereof (O—O Bidentates, O—O Tridentates, O—O Tetradentates) | and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #14: | (R—O—)(R'—O—)P(═O)—P(═O)(—O—R'')(—O—R'''), |
| Hypophosphoric Acids, Bis(hypophosphoric acids), and Poly(hypophosphoric acids), and derivatives thereof (O—O Bidentates, O—O Tridentates, O—O Tetradentates) | where R, R', R'', and R''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. Note: these ligands are not to be confused with hypophosphorous acid derivatives (hypophosphites) (R—O—) R''R'''P(═O) which are very reducing and therefore unacceptable for stabilization of high valence states in metal ions. |
| O Valence Stabilizer #15: | (RR'—N—)(R''R'''—N—)P(═O)—P(═O)(—N— |
| Hypophosphoramides, Bis(hypophosphoramides), and Poly(hypophosphoramides) (O—O Bidentates, O—O Tridentates, O—O Tetradentates) | R''''R''''')(—N—R'''''R''''''), where R, R', R'', R''', R'''', R''''', R''''', and R''''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. Note: these ligands are not to be confused with hypophosphorous acid derivatives (hypophosphites) (R—O—) R''R'''P(═O) which are very reducing and therefore unacceptable for stabilization of high valence states in metal ions. |
| O Valence Stabilizer #16: | (R—O—)(R'—O—)P(═O)—NH—P(═O)(—O—R'')(—O— |
| Imidodiphosphoric Acids, Hydrazidodiphosphoric Acids, Bis(imidodiphosphoric Acids), Bis(hydrazidodiphosphoric Acids), Poly(imidodiphosphoric Acids), Poly(hydrazidodiphosphoric Acids), and derivatives thereof (O—O Bidentates, O—O Tridentates, O—O Tetradentates) | R''') for imidodiphosphoric acids, and (R—O—) (R'—O—)P(═O)—NH—NH—P(═O)(—O—R'')(—O—R''') for hydrazidodiphosphoric acids; where R, R', R'', and R''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #17: | (RR'—N—)(R''R'''—N—)P(═O)—NH—P(═O)(—N— |
| Imidodiphosphoramides, Hydrazidodiphosphoramides, | R''''R''''')(—N—R'''''R''''''') for imidodiphosphoramides, and —NH—NH— |

TABLE 2-continued

Narrow Band Organic Valence Stabilizers for the $Co^{+3}$ Ion

| General Structural Name (Type of Organic) | Structural Representation |
|---|---|
| Bis(imidodiphosphoramides), Bis(hydrazidodiphosphoramides), Poly(imidodiphosphoramides), and Poly(hydrazidodiphosphoramides) (O—O Bidentates, O—O Tridentates, O—O Tetradentates) | derivatives for hydrazidodiphosphoramides, where R, R', R'', R''', R'''', R''''', and R'''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #18: | (RR'—N—)(R''R'''—N—)P(=O)—O—P(=O)(—N— |
| Diphosphoramides, Bis(diphosphoramides), and Poly(diphosphoramides) (O—O Bidentates, O—O Tridentates, O—O Tetradentates) | R''''R'''')(—N—R'''''R''''''), where R, R', R'', R''', R'''', R''''', and R'''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #19: | (R—O—)(R'—)P(=O)—NH—P(=O)(—R'')(—O—R''') for |
| Imidodiphosphonic Acids, Hydrazidodiphosphonic Acids, Bis(imidodiphosphonic Acids), Bis(hydrazidodiphosphonic Acids), Poly(imidodiphosphonic Acids), Poly(hydrazidodiphosphonic Acids), derivatives thereof (O—O Bidentates, O—O Tridentates, O—O Tetradentates) | imidodiphosphonic acids, and (R—O—)(R'—) P(=O)—NH—NH—P(=O)(—R'')(—O—R''') for hydrazidodiphosphonic acids; where R, R', R'', and R''' represent H, $NH_2$ or any organic functional group wherein the number of carbon and atoms ranges from 0 to 40, optionally having halogen or polarizing or water-insolubilizing/solubilizing groups attached. Ligand can also contain nonbinding N, O, S, or P atoms. |
| O Valence Stabilizer #20: | (RR'—N—)(R''—)P(=O)—NH—P(=O)(—R''')(—N— |
| Imidodiphosphonamides, Hydrazidodiphosphonamides, Bis(imidodiphosphonamides), Bis(hydrazidodiphosphonamides), Poly(imidodiphosphonamides), and Poly(hydrazidodiphosphonamides) (O—O Bidentates, O—O Tridentates, O—O Tetradentates) | R''''R'''') for imidodiphosphonamides, and —NH—NH— derivatives for hydrazidodiphosphonamides, where R, R', R'', R''', R'''', and R''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #21: | (RR'—N—)(R''—)P(=O)—O—P(=O)(—R''')(—N— |
| Diphosphonamides, Bis(diphosphonamides), and Poly(diphosphonamides) (O—O Bidentates, O—O Tridentates, O—O Tetradentates) | R''''R'''')), where R, R', R'', R''', R'''', and R''''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #22: | R—CR'(—OH)—$CH_2$—C(=O)—R'', where R, R', and |
| Beta-Hydroxyketones, Beta-Hydroxyaldehydes, Bis(beta-hydroxyketones), Bis(beta-hydroxyaldehydes), Poly(beta-hydroxyketones), and Poly(beta-hydroxyaldehydes) (O—O Bidentates, O—O Tridentates, O—O Tetradentates) | R'' represent H, NH—, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #23: | RR'—N—CH(—OH)—NR''—C(=O)—NR'''R'''', where |
| N-(Aminomethylol)ureas [N-(Aminohydroxymethyl)ureas], Bis[N-(aminomethylol)ureas], and Poly[N-(aminomethylol)ureas] (O—O Bidentates, O—O Tridentates, O—O Tetradentates) | R, R', R'', R''', and R'''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #24: | RR'—N—C(=O)—C(=O)—N—R''R''', where R, R', |
| Oxamides, Bis(oxamides), and | R'', and R''' represent H, $NH_2$ or any organic |

TABLE 2-continued

Narrow Band Organic Valence Stabilizers for the $Co^{+3}$ Ion

| General Structural Name (Type of Organic) | Structural Representation |
|---|---|
| Poly(oxamides) (O—O Bidentates, O—O Tridentates, O—O Tetradentates) | functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #25: | —C(—OH)═C(—OH)—, where the two carbon atoms |
| Squaric Acids and derivatives thereof (O—O Bidentates) | supporting the hydroxy groups are included within a cyclic hydrocarbon moiety, optionally having halogen or polarizing or water-insolubilizing/solubilizing groups attached. Ligand can also contain nonbinding N, O, S, or P atoms. |
| O Valence Stabilizer #26: | (R—O—)(O═)C—R'—C(═O)(—O—R''), where R, R', |
| Dicarboxylic Acids, Bis(dicarboxylic acids), Poly(dicarboxylic acids), and derivatives thereof (O—O Bidentates and O—O Tetradentates) | and R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #27: | R—O—C(═O)—O—R', where R, and R' represent H, |
| Carbonates and Bis(carbonates) (O—O Bidentates and O—O Tetradentates) | $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #28: | $RR'N^{+}$═C(OH)(OH), where R and R' represent |
| Carbamates, Bis(carbamates), and Poly(carbamates) (including N-hydroxycarbamates and N-mercaptocarbamates) (O—O Bidentates, O—O Tridentates, and O—O Tetradentates) | H, OH, SH, OR'' (R'' = $C_1$-$C_{30}$ alkyl or aryl), SR'' (R'' = $C_1$-$C_{30}$ alkyl or aryl), $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #29: | RR'N—NR''—C(═O)(OH), where R and R' |
| Carbazates (carbazides), Bis(carbazates), and Poly(carbazates) (O—O Bidentates, O—O Tridentates, and O—O Tetradentates; or possibly N—O Bidentates, N—O Tridentates, and N—O Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #30: | RN═C(OH)(OH), where R represents H, $NH_2$ or |
| Carbimates, Bis(carbimates), and Poly(carbimates) (O—O Bidentates, O—O Tridentates, and O—O Tetradentates) | any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #31: | (O═)As(—O—R)(—O—R')(—O—R''), where R, R', and |
| Arsonic Acids, Bis(arsonic acids), Poly(arsonic acids), and derivatives thereof (O—O Bidentates, O—O Tridentates, O—O Tetradentates) | R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #32: | R—O—C(—O—R'')—O—R', where R, R', and R'' |
| Alkyl- and Aryl- Borates and Bis(borates) (O—O Bidentates and O—O Tetradentates) | represent H, $NH_2$ or any organic functional group wherein the number of carbon atoms ranges from 0 to 40, optionally having halogen or polarizing or water-insolubilizing/solubilizing groups attached. |

TABLE 2-continued

Narrow Band Organic Valence Stabilizers for the $Co^{+3}$ Ion

| General Structural Name (Type of Organic) | Structural Representation |
|---|---|
| | Ligand can also contain nonbinding N, O, S, or P atoms. |
| O Valence Stabilizer #33: | R—C(—O—R")—O—R', where R, R', and R" |
| Alkyl- and Aryl- Boronates and Bis(boronates) (O—O Bidentates and O—O Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| O Valence Stabilizer #34: | RR'R"P═O for phosphine P-oxides, and |
| Phosphine P-oxides and Amino-substituted Phosphine oxides (0 Monodentates) | (RR'N)(R"'R"N)(R""R"""N)P═O for amino-substituted phosphine oxides, where R, R', R", R"', R"", and R""' represent H, Cl, Br, $NH_2$ or any organic functional group wherein the number of carbon atoms ranges from 0 to 40, optionally having halogen or polarizing or water-insolubilizing/solubilizing groups attached. (Rs are typically aromatic or heterocyclic for phosphine P-oxides.) Ligand can also contain nonbinding N, O, S, or P atoms. |
| O Valence Stabilizer #35: | RR'R"As═O for arsine As-oxides, and |
| Arsine As-oxides and Amino-substituted Arsine oxides (O Monodentates) | (RR'N)(R"'R"N)(R""R"""N)As═O for amino-substituted arsine oxides, where R, R', R", R"', R"", and R""' represent H, Cl, Br, $NH_2$ or any organic functional group wherein the number of carbon atoms ranges from 0 to 40, optionally having halogen or polarizing or water-insolubilizing/solubilizing groups attached. (Rs are typically aromatic or heterocyclic for arsine As-oxides.) Ligand can also contain nonbinding N, O, S, or P atoms. |
| O Valence Stabilizer #36: | Cyanates bound directly to the high valence |
| Cyanate ligands (O Monodentates) | metal ion. |
| N—S Valence Stabilizer #1: | RC(═NH)SR', where R and R' represent H or |
| Thioimidates, Dithioimidates, Polythioimidates, and Derivatives of Thioimidic Acid (N—S Bidentates and N—S Tetradentates) | any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #2: | RR'—N—C(═NH)—NR"—CS—NR"'R"" for |
| Thioguanylureas, Guanidinothioureas, Bis(thioguanylureas), Bis(guanidinothioureas), Poly(thioguanylureas), and Poly(guanidinothioureas) (N—S Bidentates and N—S Tetradentates) | thioguanylureas, and RR'—N—C(═NH)—NR"—NH—CS—NR"'R"" for guanidinothioureas, where R, R', R", R"', and R"" represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #3: | RR'—N—C(═NH)—NR"—CS—R"' for N- |
| Amidinothioamides, Guanidinothioamides, Bis(amidinothioamides), Bis(guanidinothioamides), Poly(amidinothioamides), and Poly(guanidinothioamides) (including both N-amidinothioamides and 2-amidinothioacetamides) (N—S Bidentates and N—S Tetradentates) | amidinothioamides, or RR'—N—C(═NH)—CR"R"'—CS—N—R""R""' for 2-amidinothioacetamides, and RR'—N—C(═NH)—NR"—NH—CS—R"' for guanidinothioamides, where R, R', R", R"', R"", and R""' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #4: | R—C(═NH)—NR'—CS—R", where R, R', and R", |
| Imidoylthioamides, | represent H or any organic functional group |

TABLE 2-continued

Narrow Band Organic Valence Stabilizers for the $Co^{+3}$ Ion

| General Structural Name (Type of Organic) | Structural Representation |
|---|---|
| Bis(imidoylthioamides), and Poly(imidoylthioamides) (N—S Bidentates and N—S Tetradentates) | wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #5: | RR'NCSNR"R'", where R, R', R", and R'" |
| Thioureas, Bis(thioureas), and Poly(thioureas), including Thiourylene Complexes (N—S Bidentates, N—S Tridentates, and N—S Tetradentates) | represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #6: | RCSNR'R", where R, R', and R" represent H, |
| Thiocarboxamides, Bis(thiocarboxamides), and Poly(thiocarboxamides) (N—S Bidentates, N—S Tridentates, and N—S Tetradentates) | $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #7: | RR'—N—S(=NH)—N—R"R'", where R, R', R", and |
| Imidosulfurous Diamides and Bis(imidosulfurous diamides) Bidentates, N—S Tridentates, and N—S Tetradentates) | R'" represent H or any organic functional group (N—S wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #8: | R—N=S=N—R', where R and R' represent H or |
| Sulfurdiimines, Bis(sulfurdiimines), and Poly(sulfurdiimines) (N—S Bidentates, N—S Tridentates, and N—S Tetradentates) | any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #9: | (NH=)PR(OR')(SR") for phosphonimidothioic |
| Phosphonimidothioic Acid, Phosphonimidodithioic Acid, Bis(Phosphonimidothioic acid); Bis(Phosphonimidodithioic acid), and derivatives thereof (N—S Bidentates, N—S Tetradentates) | acid and (NH=)PR(SR')(SR") for phosphonimidodithioic acid, where R, R', and R" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #10: | (S=)PR(—NR'R")(—NR'"R""), where R, R', R", |
| Phosphonothioic Diamides, Bis(phosphonothioic diamides), and Poly(phosphonothioic diamides) (N—S Bidentates and N—S Tetradentates) | R'", and R"" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #11: | (S=)PR(—NR'R")(—OR'") or (O=)PR(—NR'R") |
| Phosphonamidothioic Acid, Phosphonamidimidodithioic Acid, Bis(phosphonamidothioic acid), Bis(phosphonamidimidodithioic acid), poly(phosphonamidothioic acid), and poly(phosphonamidimidodithioic acid), and derivatives thereof (N—S Bidentates and N—S Tetradentates) | (—SR'") for phosphonamidothioic acid, (S=)PR (—NR'R")(—SR'") for phosphonamidimidodithioic acid, where R, R', R", and R'" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #12: | R—C(=S)—CR'=CR"—NHR'", where R, R', R", |
| Beta-Aminothiones (N-Substituted 3-amino-2-propenethioaldehydes), Bis(beta-aminothiones), and Poly(beta-aminothiones) (N—S Bidentates and N—S | and R'" represent H, or any organic functional group wherein the number of carbon atoms ranges from 0 to 40, optionally having halogen or polarizing or water- |

TABLE 2-continued

Narrow Band Organic Valence Stabilizers for the $Co^{+3}$ Ion

| General Structural Name (Type of Organic) | Structural Representation |
|---|---|
| Tetradentates) | insolubilizing/solubilizing groups attached. Ligand can also contain nonbinding N, O, S, or P atoms. |
| N—S Valence Stabilizer #13: | RR'—N—C(═S)—CR═C(—NHR''')R'''' for 3- |
| 3-Aminothioacrylamides (3-Amino-2-thiopropenamides), 3,3-Diaminothioacrylamides, Bis(3-aminothioacrylamides), Bis(3,3-diaminoacrylamides), Poly(3-aminothioacrylamides), and Poly(3,3-diaminothioacrylamides) (N—S Bidentates and N—S Tetradentates) | aminothioacrylamides, and RR'—N—C(═S)—CR''═C(—NHR''')(—NR''''R''''') for 3,3-diaminothioacrylamides, where R, R', R'', R''', R'''', R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #14: | R—O—C(═S)—CR'═C(—NHR'')R''' or R—S—C(═S)— |
| 3-Aminothioacrylic Acids (3-Amino-2-thiopropenoic acids),3-Mercapto-3-aminothioacrylic acids, Bis(3-aminothioacrylic acids), Bis(3-Hydroxy-3-aminothioacrylic acids), Poly(3-aminothioacrylic acids), and Poly(3-Hydroxy-3-aminothioacrylic acids), and derivatives thereof (N—S Bidentates and N—S Tetradentates) | CR'═C(—NHR'')R''' for 3-aminothioacrylic acids, and R—O—C(═S)—CR'═C(—NHR'')(—S—R''') or R—S—C(═S)—CR'═C(—NHR'')(—S—R''') for 3-mercapto-3-aminothioacrylic acids, where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #15: | R—C(═S)—N═CHR', where R' represents an |
| N-Thioacyl Benzylidenimines, Bis(N-thioacyl benzylidenirnines), and Poly(N-thioacyl benzylidenimines) (N—S and N—S Tetradentates) | aromatic derivative (i.e. —$C_6H_5$), and R represent H, $NH_2$, or any organic functional group Bidentates wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #16: | R—C(═S)—C(═NOH)—R', where R and R' |
| Thiocarbonyl oximes, Bis(thiocarbonyl oximes), and Poly(thiocarbonyl oximes) (N—S Bidentates, N—S Tridentates, and N—S Tetradentates) | represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #17: | R—CH(—SH)C(═NOH)—R', where R, R', and R'' |
| Mercapto oximes, Bis(mercapto oximes), and Poly(mercapto oximes) (including 2-sulfur heterocyclic oximes) (N—S Bidentates, N—S Tridentates, N—S Tetradentates, and N—S Hexadentates) | represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #18: | o-($O_2N$—)(HS—)Ar, where Ar represents an |
| 2-Nitrothiophenols (2-nitrobenzenethiols) (N—S Bidentates) | aromatic group or heterocyclic wherein the number of carbon atoms ranges from 6 to 40, optionally having halogen or polarizing or water-insolubilizing/solubilizing groups attached. Ligand can also contain nonbinding N, O, S, or P atoms. |
| N—S Valence Stabilizer #19: | o-(NC—$(CH_2)_{0-1}$)(HS—)Ar, where Ar represents |
| 2—Nitrilothiophenols (N—S Bidentates) | an aromatic group or heterocyclic wherein the number of carbon atoms ranges from 6 to 40, optionally having halogen or polarizing or water-insolubilizing/solubilizing groups attached. Ligand can also contain nonbinding N, O, S, or P atoms. |
| N—S Valence Stabilizer #20: | R—C(═S)—NHNR'R'', where R, R', and R'' |
| Thiohydrazides, Bis(thiohydrazides), and | represent H or any organic functional group |

TABLE 2-continued

Narrow Band Organic Valence Stabilizers for the $Co^{+3}$ Ion

| General Structural Name (Type of Organic) | Structural Representation |
|---|---|
| Poly(thiohydrazides) (N—S Bidentates and N—S Tetradentates) | wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #21: | RR'—N—C(=S)—NHNR"R'", where R, R', and R" |
| Thiosemicarbazides, Bis(thiosemicarbazides), and Poly(thiosemicarbazides) (N—S Bidentates, N—S Tetradentates, and N—S Hexadentates) | represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—S Valence Stabilizer #22: | Macrocyclic ligands containing five, seven, or |
| Five-, Seven-, or Nine-Membered Macrocyclics, Macrobicyclics, and Macropolycyclics (including Catapinands, Cryptands, Cyclidenes, and Sepulchrates) wherein all Binding Sites are composed of Nitrogen (usually amine or irmine groups) or Sulfur (usually thiols, mercaptans, or thiocarbonyls) and are not contained in Component Heterocyclic Rings (N—S Tridentates, N—S Tetradentates, and N—S Hexadentates) | nine binding sites composed of nitrogen and sulfur to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| N—S Valence Stabilizer #23: | Macrocyclic ligands containing a total of five or |
| Five-, or Seven-Membered Macrocyclics, Macrobicyclics, and Macropolycyclics (including Catapinands, Cryptands, Cyclidenes, and Sepulchrates) wherein all Binding Sites are composed of Nitrogen or Sulfur and are contained in Component Heterocyclic Rings (N—S Tridentates, N—S Tetradentates, or N—S Hexadentates) | seven heterocyclic rings containing nitrogen or sulfur binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N—S Valence Stabilizer #24: | Macrocyclic ligands containing at least one |
| Five-, Seven-, or Nine-Membered Macrocyclics, Macrobicyclics, and Macropolycyclics (including Catapinands, Cryptands, Cyclidenes, and Sepulchrates) wherein all Binding Sites are composed of Nitrogen or Sulfur and are contained in a Combination of Heterocyclic Rings and Amine, Imine, Thiol, Mercapto, or Thiocarbonyl Groups (N—S Tridentates, N—S Tetradentates, or N—S Hexadentates) | heterocyclic ring. These heterocyclic rings provide nitrogen or sulfur binding sites to valence stabilize the central metal ion. Other amine, imine, thiol, mercapto, or thiocarbonyl binding sites can also be included in the macrocyclic ligand, so long as the total number of binding sites is five, seven, or nine. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N—O Valence Stabilizer #1: | RC(=NH)OR', where R and R' represent H or |
| Imidates, Diimidates, Polyimidates, and Derivatives of Imidic Acid (N—O Bidentates and N—O Tetradentates) | any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #2: | RR'NC(=NH)OR", where R, R', and R" |
| Pseudoureas, bis(pseudoureas), and poly(pseudoureas) (N—O Bidentates and N—O Tetradentates) | represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #3: | RR'NC(=NH)CR"R'"(CO)OR"", where R, R', |
| 2-Amidinoacetates, Bis(2-amidinoacetates), and Poly(2-amidinoacetates) (N—O | R", R'", and R"" represent H, $NH_2$, or any organic functional group wherein the number of |

TABLE 2-continued

Narrow Band Organic Valence Stabilizers for the $Co^{+3}$ Ion

| General Structural Name (Type of Organic) | Structural Representation |
|---|---|
| Bidentates and N—O Tetradentates) | carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #4: | RR'NCONR''R''', where R, R', R'', and R''' |
| Ureas, Bis(ureas), and Poly(ureas), including Urylene Complexes (N—O Bidentates, N—O Tridentates, and N—O Tetradentates) | represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #5: | (NH═)PR(OR')(OR''), where R, R', and R'' |
| Phosphonimidic Acid, Bis(phosphonimidic acid), Poly(phosphonimidic acid), derivatives thereof (N—O Bidentates and N—O Tetradentates) | represent H, $NH_2$, or any organic functional and group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #6: | (O═)PR(—NR'R'')(—OR''') for phosphonamidic |
| Phosphonamidic Acid, Phosphonic Diamide, Bis(Phosphonamidic Acid), Bis(Phosphonic Diamide), Poly(phosphonamidic acid), poly(phosphonic diamide), and derivatives thereof (N—O Bidentates and N—O Tetradentates) | acid and (O═)PR(—NR'R'')(—NR'''R'''') for phosphonic diamide, where R, R', R'', R''', and R'''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #7: | R—C(═O)—CR'═C(—NHR'')R''', where R, R', R'', |
| Beta-Ketoamines (N-Substituted 3-amino-2-propenals), Bis(beta-ketoamines), and Poly(beta-ketoamines) (N—O Bidentates N—O Tetradentates) | and R''' represent H, or any organic functional group wherein the number of carbon atoms and ranges from 0 to 40, optionally having halogen or polarizing or water-insolubilizing/solubilizing groups attached. Ligand can also contain nonbinding N, O, S, or P atoms. |
| N—O Valence Stabilizer #8: | RR'—N—C(═O)—CR''═C(—NHR''')R'''' for 3- |
| 3-Aminoacrylamides (3-Amino-2-propenamides), 3,3-Diaminoacrylamides, Bis(3-aminoacrylamides), Bis(3,3-diaminoacrylamides), Poly(3-aminoacrylamides), and Poly(3,3-diaminoacrylamides) (N—O Bidentates and N—O Tetradentates) | aminoacrylamides, and RR'—N—C(═O)—CR''═C(—NHR''')(—NR''''R''''') for 3,3-diaminoacrylamides, where R, R', R'', R''', R'''', and R''''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #9: | R—O—C(═O)—CR'═C(—NHR'')R''' for 3- |
| 3-Aminoacrylic Acids (3-Amino-2-propenoic acids), 3-Hydroxy-3-arninoacrylic acids, Bis(3-aminoacrylic acids), Bis(3-Hydroxy-3-aminoacrylic acids), Poly(3-aminoacrylic acids), and Poly(3-Hydroxy-3-aminoacrylic acids), and derivatives thereof (N—O Bidentates and N—O Tetradentates) | aminoacrylic acids, and R—O—C(═O)—CR'C(—NHR'')(—O—R''') for 3-hydroxy-3-aminoacrylic acids, where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #10: | R—C(═O)—N═CHR', where R' represents an |
| N-Acyl Benzylidenimines, Bis(N-acyl benzylidenimines), and Poly(N-acyl benzylidenimines) (N—O Bidentates and N—O Tetradentates) | aromatic derivative (i.e. —$C_6H_5$), and R represent H, $NH_2$, or any organic functional group wherein the number of carbon atoms ranges from 0 to 40, optionally having halogen or polarizing or water-insolubilizing/solubilizing |

TABLE 2-continued

Narrow Band Organic Valence Stabilizers for the $Co^{+3}$ Ion

| General Structural Name (Type of Organic) | Structural Representation |
|---|---|
| | groups attached. Ligand can also contain nonbinding N, O, S, or P atoms. |
| N—O Valence Stabilizer #11: | o-($O_2N$—)(RR'N—)Ar, where Ar represents an |
| 2-Nitroanilines (N—O Bidentates) | aromatic group or heterocyclic wherein the number of carbon atoms ranges from 6 to 40, and R and R' represent H, $NH_2$, or alkyl or aryl hydrocarbon groups wherein the number of carbon atoms range from 0 to 25, optionally having halogen or polarizing or water-insolubilizing/solubilizing groups attached. Ligand can also contain nonbinding N, O, S, or P atoms. |
| N—O Valence Stabilizer #12: | o-(NC—$(CH_2)_{0-1}$)(HO—)Ar, where Ar represents |
| 2-Nitrilophenols (N—O Bidentates). Also includes acylcyanamides. | an aromatic group or heterocyclic wherein the number of carbon atoms ranges from 6 to 40, optionally having halogen or polarizing or water-insolubilizing/solubilizing groups attached. Ligand can also contain nonbinding N, O, S, or P atoms. |
| N—O Valence Stabilizer #13: | $HetN^+$—$O^-$ for amine N-oxides, and R—N═$N^+$ |
| Amine N-Oxides and Diazine N-Oxides (Azoxy componds) (N—O Bidentates, N—O Tridentates, and N—O Tetradentates) | (—$O^-$)—R' for diazine N-oxides (azoxy compounds), where Het represents a nitrogen-containing heterocyclic derivative wherein the number of carbon atoms ranges from 4 to 40, and R and R' represent separate or the same aromatic functionalities, both Het and R,R' optionally having halogen or polarizing or water-insolubilizing/solubilizing groups attached. Ligand can also contain nonbinding N, O, S, or P atoms. |
| N—O Valence Stabilizer #14: | R—C(═O)—NHNR'R", where R, R', and R" |
| Hydrazides, Bis(hydrazides), and Poly(hydrazides) (N—O Bidentates and N—O Tetradentates) | represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #15: | RR'—N—C(═O)—NHNR"R'", where R, R', and |
| Semicarbazides, Bis(semicarbazides), and Poly(semicarbazides) (N—O Bidentates, N—O Tetradentates, and N—O Hexadentates) | R" represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| N—O Valence Stabilizer #16: | Macrocyclic ligands containing five, seven, or |
| Five-, Seven-, or Nine-Membered Macrocyclics, Macrobicyclics, and Macropolycyclics (including Catapinands, Cryptands, Cyclidenes, and Sepulchrates) wherein all Binding Sites are composed of Nitrogen (usually amine or imine groups) or Oxygen (usually hydroxy, carboxy, or carbonyl groups) and are not contained in Component Heterocyclic Rings (N—O Tridentates, N—O Tetradentates, and N—O Hexadentates) | nine binding sites composed of nitrogen and oxygen to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| N—O Valence Stabilizer #17: | Macrocyclic ligands containing a total of five or |
| Five-, or Seven-Membered Macrocyclics, Macrobicyclics, and Macropolycyclics (including Catapinands, Cryptands, Cyclidenes, and Sepulchrates) wherein all Binding Sites are composed of Nitrogen or Oxygen and are contained in Component Heterocyclic Rings (N—O Tridentates, N—O Tetradentates, or N—O Hexadentates) | seven heterocyclic rings containing nitrogen or oxygen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |

TABLE 2-continued

Narrow Band Organic Valence Stabilizers for the $Co^{+3}$ Ion

| General Structural Name (Type of Organic) | Structural Representation |
|---|---|
| N—O Valence Stabilizer #18: | Macrocyclic ligands containing at least one |
| Five-, Seven-, or Nine-Membered Macrocyclics, Macrobicyclics, and Macropolycyclics (including Catapinands, Cryptands, Cyclidenes, and Scpulchrates) wherein all Binding Sites are composed of Nitrogen or Oxygen and are contained in a Combination of Heterocyclic Rings and Amine, Imine, Hydroxy, Carboxy, or Carbonyl Groups (N—O Tridentates, N—O Tetradentates, or N—O Hexadentates) | heterocyclic ring. These heterocyclic rings provide nitrogen or oxygen binding sites to valence stabilize the central metal ion. Other amine, imine, hydroxy, carboxy, or carbonyl binding sites can also be included in the macrocyclic ligand, so long as the total number of binding sites is five, seven, or nine. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S—O Valence Stabilizer #1: | RR'—N—C(═S)—NR''—C(═O)—NR'''R'''' for |
| Thiobiurets (Thioimidodicarbonic Diamides), Thioisobiurets, Thiobiureas, Thiotriurets, Thiotriureas, Bis(thiobiurets), Bis(thioisobiurets), Bis(thiobiureas), Poly(thiobiurets), Poly(thioisobiurets), Poly(thiobiureas) (S—O Bidentates, S—O Tridentates, S—O Tetradentates), and 3-formamidino thiocarbamides | thiobiurets, and RR'—N—C(═S)—NR''—NH—C(═O)—NR'''R'''' for thiobiureas, where R, R', R'', R''', and R'''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #2: | RR'—N—C(═S)—NR''—C(═O)—R''' for acyl- and |
| Acylthioureas, Aroylthioureas, Thioacylureas, Thioaroylureas, Bis(acylthioureas), Bis(aroylthioureas), Bis(thioacylureas), Bis(thioaroylureas), Poly(thioacylthioureas), Poly(thioaroylthioureas), Poly(thioacylureas), and Poly(thioaroylureas) (S—O Bidentates, S—O Tridentates, S—O Tetradentates) | aroylthioureas, and RR'—N—C(═O)—NR''—C(═S)—R''' for thioacyl- and thioaroylureas, where R, R', R'', and R''' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #3: | RC(═S)—NR'—(═O)—R'' for |
| Thioimidodialdehydes, Thiohydrazidodialdehydes (thioacyl hydrazides), Bis(thioimidodialdehydes), Bis(thiohydrazidodialdehydes), Poly(thioimidodialdehydes), and Poly(thiohydrazidodialdehydes) (S—O Bidentates, S—O Tridentates, S—O Tetradentates) | thioimidodialdehydes, and RC(═S)—NR'—NH—C(═O)—R'' for thiohydrazidodialdehydes (thioacyl hydrazides), where R, R', and R'' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #4: | R—O—C(═S)—NR'—C(═O)—O—R'' or R—S—C(═S)— |
| Thioimidodicarbonic acids, Thiohydrazidodicarbonic acids, Bis(thioimidodicarbonic acids), Bis(thiohydrazidodicarbonic acids), Poly(thioimidodicarbonic acids), Poly(thiohydrazidodicarbonic acids) and derivatives thereof (S—O Bidentates, S—O Tridentates, S—O Tetradentates) | NR'—C(═O)—S—R'' for thioimidodicarbonic acids, and R—O—C(═S)—NR'—NH—C(═O)—O—R'' or R—S—C(═S)—NR'—NH—C(═O)—S—R'' for thiohydrazidodicarbonic acids, where R, R', and R'' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #5: | R—C(═S)—C(═O)—R' where R and R' represent |
| 1,2-Monothioketones (Monothiolenes, Monothio-alpha-ketonates), 1,2,3-Monothioketones, 1,2,3-Dithioketones, Monothiotropolonates, ortho-Monothioquinones, Bis(1,2-Monothioketones), and Poly(1,2-Monothioketones) (S—O Bidentates, S—O Tridentates, S—O Tetradentates) | H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 2-continued

Narrow Band Organic Valence Stabilizers for the $Co^{+3}$ Ion

| General Structural Name (Type of Organic) | Structural Representation |
|---|---|
| S—O Valence Stabilizer #6: | RR'—N—C(═S)—S—S—C(═O)—N—R"R"' for |
| Trithioperoxydicarbonic Diamides, Dithioperoxydicarbonic Diamides, Bis(trithioperoxydicarbonic diamides), Bis(dithioperoxydicarbonic diamides), poly(trithioperoxydicarbonic diamides) and poly(dithioperoxydicarbonic diamides) S—O Bidentates, S—O Tridentates, S—O Tetradentates) | trithioperoxydicarbonic diamides, and RR'—N—C(═O)—S—S—C(═O)—N—R"R"' for dithioperoxydicarbonic diamides, where R, R', R", R"' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #7: | R—O—C(═S)—S—C(═O)—O—R', where R and R' |
| Diithiodicarbonic Acids, Bis(dithiodicarbonic acids), Poly(dithiodicarbonic acids), and derivatives thereof (S—O Bidentates, S—O Tridentates, S—O Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #8: | R—O—C(═S)—S—S—C(═O)—O—R', where R and R' |
| Trithioperoxydicarbonic Acids, Bis(trithioperoxydicarbonic acids), poly(trithioperoxydicarbonic acids), and derivatives thereof (S—O Bidentates, S—O Tridentates, S—O Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #9: | (RR'—N—)(R"R"'—N—)P(═S)—S—S—P(═O)(—N— |
| Monothioperoxydiphosphoramide, Bis(monothioperoxyphosphoramide), and Poly(monothioperoxydiphosphoramide) S—O Bidentates, S—O Tridentates, S—O Tetradentates) | R""R""')(—N—R"""R"""'), where R, R', R", R"', R"", R"""', R"""", and R"""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #10: | (R—O—)(R'—O—)P(═S)—S—S—P(═O)(—O—R")(—O— |
| Monothioperoxydiphosphoric Acids, Bis(monothioperoxyphosphoric Acids), Poly(monothioperoxydiphosphoric Acids), and derivatives thereof (S—O Bidentates, S—O Tridentates, S—O Tetradentates) | R"'); (R—O—)(R'—S—)P(═S)—S—S—P(═O)(—S—R")(—O—R"'); or (R—S—)(R'—S—)P(═S)—S—S—P(═O)(—S—R")(—S—R"'), where R, R', R", R"', R"", R"""', R"""", and R"""" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #11: | (R—O—)(R'—)P(═S)—NH—P(═O)(—R")(—O—R"'); |
| Monothioimidodiphosphonic Acids, Monothiohydrazidodiphosphonic Acids, Bis(monothioimidodiphosphonic Acids), Bis(monothiohydrazidodiphosphonic Acids), Poly(monothioimidodiphosphonic Acid), Poly(monothiohydrazidodiphosphonic Acids), and derivatives thereof (S—O Bidentates, S—O Tridentates, S—O Tetradentates) | (R—S—)(R'—)P(═S)—NH—P(═O)(—R")(—O—R"'); or (R—S—)(R'—)P(═S)—NH—P(═O)(—R")(—S—R"') for monothioimidodiphosphonic acids, and —NH—NH— derivatives for monothiohydrazidodiphosphonic acids, where R, R', R", and R"' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #12: | (RR'—N—)(R"—)(═S)—NH—P(═O)(—R"')(—N— |
| Monothioimidodiphosphonamides, Monothiohydrazidodiphosphonamides, Bis(monothioimidodiphosphonamides), Bis(monothiohydrazidodiphosphonamides) Poly(monothioimidodiphosphonamides), and | R""R""') for monothiolmidodiphosphonamides, and —NH—NH— derivatives for monothiohydrazidodiphosphonamides, where R, R', R", R"', R"", and R"""', represent H, $NH_2$ or any organic functional group wherein the |

TABLE 2-continued

Narrow Band Organic Valence Stabilizers for the $Co^{+3}$ Ion

| General Structural Name (Type of Organic) | Structural Representation |
|---|---|
| Poly(monothiohydrazidodiphosphonamides) (S—O Bidentates, S—O Tridentates, S—O Tetradentates) | number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #13: | (RR'—N—)(R"—)P(═S)—S—P(═O)(—R"')(—N— |
| Monothiodiphosphonamides, Bis(monothioiphosphonamides), and Poly(monothiodiphosphonamides) (S—O Bidentates, S—O Tridentates, S—O Tetradentates) | R""R""'), or (RR'—N—)(R"—)P(═S)—O—P(═O)(—R"')(—N—R""R""'), where R, R', R", R"', R"", and R"""' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #14: | (R—O—)(R'—)P(═S)—O—P(═O)(—R")(—O—R"'); |
| Monothiodiphosphonic Acids, Bis(monothioiphosphonic Acids), Poly(monothiodiphosphonic Acids), and derivatives thereof (S—O Bidentates, S—O Tridentates, S—O Tetradentates) | (R—O—)(R'—)P(═S)—S—P(═O)(—R")(—O—R"'); (R—S—)(R'—)P(═S)—O—P(═O)(—R")(—S—R"'); or (R—S—)(R'—)P(═S)—S—P(═O)(—R")(—S—R"'), where R, R', R", and R"' represent H, $NH_2$ or any organic functional group wherein the number of carbon atoms ranges from 0 to 40, optionally having halogen or polarizing or water-insolubilizing/solubilizing groups attached. Ligand can also contain nonbinding N, 0, S, or P atoms. |
| S—O Valence Stabilizer #15: | (RR'—N—)(R"—)P(═S)—S—S—P(═O)(—R'41 )(—N— |
| Monothioperoxydiphosphonamide, Bis(monothioperoxyphosphonamide), and Poly(monothioperoxydiphosphonamide) (S—O Bidentates, S—O Tridentates, S—O Tetradentates) | R""R""'), where R, R', R", R"', R"", and R"""' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #16: | (R—O—)(R'—)P(═S)—S—S—P(═O)(—R")(—O—R"'); or |
| Monothioperoxydiphosphonic Acids, Bis(monothioperoxyphosphonic Acids), Poly(monothioperoxydiphosphonic Acids), and derivatives thereof (S—O Bidentates, S—O Tridentates, S—O Tetradentates) | (R—S—)(R'—)P(═S)—S—S—P(═O)(—R")(—S—R"'), where R, R', R", and R"' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #17: | (O═)P(—S—R)(—O—R')(—O—R") or (S═)P(—O—R) |
| Monothiophosphoric Acids (Phosphorothioic Acids), Bis(monothiophosphoric acids), Poly(monothiophosphoric acids), and derivatives thereof (S—O Bidentates, S—O Tridentates, S—O Tetradentates) | (—O—R')(—O—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #18: | (O═)P(—S—S—R)(—O—R')(—O—R"), where R, R', |
| Phosphoro(dithioperoxoic) Acids, Bis[phosphoro(dithioperoxoic) acids], Poly[phosphoro(dithioperoxoic) acids], and derivatives thereof (S—O Bidentates, S—O Tridentates, S—O Tetradentates) | and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #19: | (O═)PR(—S—R')(—O—R") or (S═)PR(—O—R')(—O— |
| Monothiophosphonic Acids (Phosphonothioic Acids), Bis(monothiophosphonic Acids), Poly(monothiophosphonic Acids), | R"), where R, R', and R" represent H, $NH_2$ or any organic functional group wherein the number of carbon atoms ranges from 0 to 40, and optionally having halogen or polarizing or |

TABLE 2-continued

Narrow Band Organic Valence Stabilizers for the $Co^{+3}$ Ion

| General Structural Name (Type of Organic) | Structural Representation |
|---|---|
| derivatives thereof (S—O Bidentates, S—O Tridentates, S—O Tetradentates) | water-insolubilizing/solubilizing groups attached. Ligand can also contain nonbinding N, O, S, or P atoms. |
| S—O Valence Stabilizer #20: | (O═)PR(—S—S—R')(—O—R''), where R, R', and R'' |
| Phosphono(dithioperoxoic) Acids, Bis[phosphono(dithioperoxoic) Acids], Poly[phosphono(dithioperoxoic) Acids], and derivatives thereof (S—O Bidentates, S—O Tridentates, S—O Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #21: | R—CR'(—OH)—$CH_2$—C(═S)—R'', where R, R', and |
| Beta-Hydroxythioketones, Beta-Hydroxythioaldehydes, Bis(beta-hydroxythioketones), Bis(beta-hydroxythioaldehydes), Poly(beta-hydroxythioketones), and Poly(beta-hydroxythioaldehydes) (S—O Bidentates, S—O Tridentates, S—O Tetradentates) | R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #22: | R—CR'(—SH)—$CH_2$—C(═O)—R'', where R, R', and |
| Beta-Mercaptoketones, Beta-Mercaptoaldehydes, Bis(beta-mercaptoketones), Bis(beta-mercaptoaldehydes), Poly(beta-mercaptoketones), and Poly(beta-mercaptoaldehydes) (S—O Bidentates, S—O Tridentates, S—O Tetradentates) | R'' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #23: | RR'—N—CH(—OH)—NR''—C(═S)—NR'''R'''', where |
| N-(Aminomethylol)thioureas [N-(Aminohydroxymethyl)thioureas], Bis[N-(aminomethylol)thioureas], and Poly[N-(aminomethylol)thioureas] (S—O Bidentates, S—O Tridentates, S—O Tetradentates) | R, R', R'', R''', and R'''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #24: | RR'—N—CH(—SH)—NR''—C(═O)—NR'''R'''', where |
| N-(Aminomethylthiol)ureas [N-(Aminomercaptomethyl)ureas], Bis[N-(aminomethylthiol)ureas], and Poly[N-(aminomethylthiol)ureas] (S—O Bidentates, S—O Tridentates, S—O Tetradentates) | R, R', R'', R''', and R'''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #25: | RR'—N—C(═S)—C(═O)—N—R''R''', where R, R', |
| Monothiooxamides, Bis(monothiooxamides), and Poly(monothiooxamides) (S—O Bidentates, S—O Tridentates, S—O Tetradentates) | R'', and R''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #26: | R—CR'(—SH)—CR''R'''—C(═O)(—O—R''''), where R, |
| Beta-Mercapto Carboxylic Acids, Bis(Beta-Mercapto Carboxylic Acids), Poly(Beta-Mercapto Carboxylic Acids), and derivatives thereof (S—O Bidentates, S—O Tridentates, S—O Tetradentates) | R', R'', R''', and R'''' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #27: | R—CR'(—SH)—CR''R'''—C(═O)(—S—R''''), where R, |
| Beta-Mercapto Thiocarboxylic Acids, Bis(Beta-Mercapto Thiocarboxylic Acids), Poly(Beta-Mercapto Thiocarboxylic Acids), and derivatives thereof (S—O | R', R'', R''', and R'''' represent H, $NH_2$ or any organic functional group wherein the number of carbon atoms ranges from 0 to 40, optionally having halogen or polarizing or water- |

TABLE 2-continued

Narrow Band Organic Valence Stabilizers for the $Co^{+3}$ Ion

| General Structural Name (Type of Organic) | Structural Representation |
|---|---|
| Bidentates, S—O Tridentates, S—O Tetradentates) | insolubilizing/solubilizing groups attached. Ligand can also contain nonbinding N, O, S, or P atoms. |
| S—O Valence Stabilizer #28: | R—CR'(—OH)—CR"R'"—C(=O)(—S—R""), where R, |
| Beta-Hydroxy Thiocarboxylic Acids, Bis(Beta-Hydroxy Thiocarboxylic Acids), Poly(Beta-Hydroxy Thiocarboxylic Acids), and derivatives thereof (S—O Bidentates, S—O Tridentates, S—O Tetradentates) | R', R", R'", and R"" represent H, $NH_2$ or any organic functional group wherein the number of carbon atoms ranges from 0 to 40, optionally having halogen or polarizing or water insolubilizing/solubilizing groups attached. Ligand can also contain nonbinding N, O, S, or P atoms. |
| S—O Valence Stabilizer #29: | R—CR' (—SH)—CR"R'"—C(=O)(—NH—R""), where |
| Beta-Mercapto Carboxamides, Bis(Beta-Mercapto Carboxamides), Poly(Beta-Mercapto Carboxamides), and derivatives thereof (S—O Bidentates, S—O Tridentates, S—O Tetradentates) | R, R', R", R'", and R"" represent H, NH or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #30: | R—S—R'COOH for S-alkylthiocarboxylic and |
| S-Alkylthiocarboxylic Acids, S-Arylthiocarboxylic Acids, and S,S-thiobiscarboxylic Acids (S—O Bidentates and S—O Tridentates) | S-arylthiocarboxylic acids, and HOOCR—S—R'COOH for S,S-thiobiscarboxylic acids, where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #31: | R—S—S—R'COOH for S-alkyldisulfidocarboxylic |
| S-Alkyldisulfidocarboxylic Acids, S-Aryldisulfidocarboxylic Acids, and S,S'-Disulfidobiscarboxylic Acids (S—O Bidentates and S—O Tridentates) | and S-aryldisulfidocarboxylic acids, and HOOCR—S—S—R'COOH for S,S'-disulfidobiscarboxylic acids, where R and R' represent H or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #32: | R—C(=O)(—S—R') for monothiomonocarboxylic |
| Monothiomonocarboxylic Acids, Dithiodicarboxylic Acids, Bis(monothiomonocarboxylic Acids), Bis(dithiodicarboxylic acids), Poly(monothiomonocarboxylic acids), Poly(dithiodicarboxylic acids), and derivatives thereof (S—O Bidentates and S—O Tetradentates) | acids, and (R—S—)(O=)C—R'—C(=O)(—S—R") or (R—S—)(O=)C—R'—C(=O)(—O—R") for dithiodicarboxylic acids, where R, R', and R" represent H, $NH_2$ or any organic functional group wherein the number of carbon atoms ranges from 0 to 40, optionally having halogen or polarizing or water insolubilizing/solubilizing groups attached. Ligand can also contain nonbinding N, O, S, or P atoms. |
| S—O Valence Stabilizer #33: | R—O—C(=S)—O—R', where R, and R' represent H, |
| Monothiocarbonates and Bis(monothiocarbonates) (S—O Bidentates and S—O Tetradentates) | $NH_2$ or any organic functional group wherein the number of carbon atoms ranges from 0 to 40, optionally having halogen or polarizing or water-insolubilizing/solubilizing groups attached. Ligand can also contain nonbinding N O, S, or P atoms. |
| S—O Valence Stabilizer #34: | RR'N—NR"—C(=O)(SH), where R and R' |
| Monothiocarbazates (Monothiocarbazides), Bis(monothiocarbazatcs), and Poly(monothiocarbazates) (S—O Bidentates, S—O Tridentates, and S—O Tetradentates; or possibly N—S Bidentates, N—S Tridentates, and N—S Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 2-continued

Narrow Band Organic Valence Stabilizers for the $Co^{+3}$ Ion

| General Structural Name (Type of Organic) | Structural Representation |
|---|---|
| S—O Valence Stabilizer #35: | R—CH(—SH)—CH(—OH)—R' for alpha-mercapto |
| Mercapto Alcohols and Silylmercaptoalcohols, Bis(mercapto alcohols and silylmercaptoalcohols), and Poly(mercapto alcohols and silylmercaptoalcohols) (S—O Bidentates, S—O Tridentates, S—O Tetradentates) | alcohols, R—CH(—SH)—Si(—OR')$_x$—R''$_{3-x}$ for alpha-silylmercaptoalcohols, R—CH(—SH)—R'—CH(—OH)—R'' for beta-mercapto alcohols, and R—CH(—SH)—R'—Si(—OR'')$_x$—R'''$_{3x}$ for beta-silylmercaptoalcohols, etc., where R, R', R'', and R''' represent H, $NH_2$ or any organic functional group wherein the number of carbon atoms ranges from 0 to 40, optionally having halogen or polarizing or water-insolubilizing/solubilizing groups attached. x = 1-3. Ligand can also contain nonbinding N, O, S, or P atoms. |
| S—O Valence Stabilizer #36: | RN═C(OH)(SH), where R represents H, $NH_2$ or |
| Monothiocarbimates, Bis(monothiocarbimates), and Poly(monothiocarbimates) (S—O Bidentates, S—O Tridentates, and S—O Tetradentates) | any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #37: | R—O—C(—S—R'')—O—R', where R, R', and R'' |
| Alkyl- and Aryl- Monothioborates and Bis(monothioborates) (S—O Bidentates and S—O Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #38: | R—C(—S—R'')—O—R', where R, R', and R'' |
| Alkyl- and Aryl- Monothioboronates and Bis(monothioboronates) (S—O Bidentates and S—O Tetradentates) | represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| S—O Valence Stabilizer #39: | (O═)As(—S—R)(—O—R')(—O—R'') or (S═)As(—O— |
| Monothioarsonic Acids (Arsonothioic Acids), Bis(monothioarsonic acids), Poly(monothioarsonic acids), and derivatives thereof (S—O Bidentates, Tridentates, S—O Tetradentates) | R)(—O—R')(—O—R''), where R, R', and R'' represent H, $NH_2$ or any organic functional group wherein the number of carbon atoms S—O ranges from 0 to 40, optionally having halogen or polarizing or water-insolubilizing/solubilizing groups attached. Ligand can also contain nonbinding N, O, S, or P atoms. |
| S—O Valence Stabilizer #40: | Heterocyclic ring(s) containing one or two |
| Heterocyclic Rings containing One or Two Sulfur Atoms at least one additional Oxygen Atom Binding Site not in a Ring (S—O Bidentates, S—O Tridentates, S—O Tetradentates, or S—O Hexadentates) | sulfur atoms. In addition, ligand contains additional oxygen-containing substituents (usually hydroxy, carboxy, or carbonyl groups) that constitute O binding sites. Can include other ring systems bound to the heterocyclic ring or to the O-containing substituent, but they do not coordinate with the stabilized, high valence metal ion. Ring(s) can also contain O, N, P, As or Se atoms. This 5-membered ring(s) and/or attached, uncoordinating rings and/or O-containing substituent(s) may or may not have halogen or polarizing or water-insolubilizing/solubilizing groups attached. |
| S—O Valence Stabilizer #41: | Heterocyclic ring(s) containing one or two |
| Heterocyclic Rings containing One or Two Oxygen Atoms at least one additional Sulfur Atom Binding Site not in a Ring S—O Bidentates, S—O Tridentates, S—O Tetradentates, or S—O Hexadentates) | oxygen atoms. In addition, ligand contains additional sulfur-containing substituents (usually thio, mercapto, or thiocarbonyl groups) that constitute S binding sites. Can include other ring systems bound to the heterocyclic ring or to the S-containing substituent, but they do not coordinate with the stabilized, high |

TABLE 2-continued

Narrow Band Organic Valence Stabilizers for the $Co^{+3}$ Ion

| General Structural Name (Type of Organic) | Structural Representation |
|---|---|
| | valence metal ion. Ring(s) can also contain O, N, P, As or Se atoms. This 5-membered ring(s) and/or attached, uncoordinating rings and/or 5-containing substituent(s) may or may not have halogen or polarizing or water-insolubilizing/solubilizing groups attached. |
| S—O Valence Stabilizer #42: | Heterocyclic ring(s) containing one or two |
| Heterocyclic Rings containing One or Two Sulfur Atoms at least one additional Oxygen Atom Binding Site in a separate Ring (S—O Bidentates, S—O Tridentates, S—O Tetradentates, or S—O Hexadentates) | sulfur atoms. In addition, ligand contains additional oxygen-containing rings that constitute O binding sites. Can include other ring systems bound to the O-containing heterocyclic rings, but they do not coordinate with the stabilized, high valence metal ion. Ring(s) can also contain O, N, P, As, or Se atoms. This 5-membered ring(s) and/or additional O-containing ring(s) and/or attached, uncoordinating rings may or may not have halogen or polarizing or water-insolubilizing/solubilizing groups attached. |
| S—O Valence Stabilizer #43: | Macrocyclic ligands containing two to ten |
| Two-, Three-, Four-, Five-, Six-, Seven-, Eight-, Nine-, and Ten-Membered Macrocyclics, Macrobicyclics, and Macropolycyclics (including Catapinands, Cryptands, Cyclidenes, and Sepulchrates) wherein all Binding Sites are composed of Sulfur (usually thiol, mercapto, or thiocarbonyl groups) or Oxygen (hydroxy, carboxy, or carbonyl groups) and are not contained in Component Heterocyclic Rings (S—O Bidentates, S—O Tridentates, S—O Tetradentates, and S—O Hexadentates) | sulfur or oxygen binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| S—O Valence Stabilizer #44: | Macrocyclic ligands containing a total of four to |
| Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur or Oxygen and are contained in Component 5-Membered Heterocyclic Rings (S—O Tridentates, S—O Tetradentates or S—O Hexadentates) | ten five-membered heterocyclic rings containing sulfur or oxygen binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S—O Valence Stabilizer #45: | Macrocyclic ligands containing at least one |
| Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur or Oxygen and are contained in a Combination of Heterocyclic Rings and Thiol, Mercapto, Thiocarbonyl, Hydroxy, Carboxy, and Carbonyl Groups (S—O Tridentates, S—O Tetradentates, or S—O Hexadentates) | heterocyclic ring. These heterocyclic rings provide sulfur or oxygen binding sites to valence stabilize the central metal ion. Other thiol, mercapto, thiocarbonyl, hydroxy, carboxy, or carbonyl binding sites can also be included in the macrocyclic ligand, so long as the total number of binding sites is four to ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S—O Valence Stabilizer #46: | Sulfoxides (R—SO—R'), where R and R' |
| Sulfoxides (S—O Bidentates) | represent H or any organic functional group wherein the number of carbon atoms ranges from 0 to 35, optionally having halogen or polarizing or water-insolubilizing/solubilizing groups attached. |
| S—O Valence Stabilizer #47: | Sulfones ($R—SO_2—R'$), where R and R' represent |
| Sulfones (S—O Bidentates) | H or any organic functional group wherein the number of carbon atoms ranges from 0 to 35, optionally having halogen or polarizing or |

TABLE 2-continued

Narrow Band Organic Valence Stabilizers for the $Co^{+3}$ Ion

| General Structural Name (Type of Organic) | Structural Representation |
|---|---|
| | water-insolubilizing/solubilizing groups attached. |
| S—O Valence Stabilizer #48: | Sulfur dioxide ligands (—$SO_2$) bound directly to |
| Sulfur dioxide ($SO_2$) ligands (S—O Bidentates) | the high valence metal ion. |
| N—P Valence Stabilizer #1: | [R(—NR'R'')(—PR'''R'''')], [R(—NR'R'')$_x$]$_{1-3}$P, [R |
| Aminoaryl Phosphines and Iminoaryl Phosphines (N—P Bidentates, N—P Tridentates, and N—P Tetradentates) | —NR'R'')$_x$]$_{1-3}$PX, or [R(—PR'R'')$_x$]$_{1-3}$N, where X = O or S and R, R', R'', R''', and R'''' represents H, $NH_9$ or any organic functional group wherein the number of carbon atoms ranges from 0 to 35, optionally having halogen or polarizing or water-insolubilizing/solubilizing groups attached. Ligand can also contain nonbinding N, P, O, S, or Se atoms. |
| N—P Valence Stabilizer #2: | Five inembered heterocyclic ring(s) containing |
| Heterocyclic Rings containing One, Two, Three, or Four Nitrogen Atoms at least one additional Phosphorus Atom Binding Site not in a Ring (N—P Bidentates, N—P Tridentates, N—P Tetradentates, or N—P Hexadentates) | one, two, three, or four nitrogen atoms. In addition, ligand contains additional phosphorus-containing substituents that constitute P binding sites. Can include other ring systems bound to the heterocyclic ring or to the P-containing substituent, but they do not coordinate with the stabilized, high valence metal ion. Ring(s) can also contain O, S, or P atoms. This ring(s) and/or attached, uncoordinating rings and/or P-containing substituent(s) may or may not have halogen or polarizing or water-insolubilizing/solubilizing groups attached. |
| N—P Valence Stabilizer #3: | Five membered heterocyclic ring(s) containing |
| Heterocyclic Rings containing One, Two, or Three Phosphorus Atoms at least one additional Nitrogen Atom Binding Site not in a Ring (N—P Bidentates, N—P Tridentates, N—P Tetradentates, or N—P Hexadentates) | one, two, or three phosphorus atoms. In addition, ligand contains additional nitrogen-containing substituents (usually amines, imines, or hydrazides) that constitute N binding sites. Can include other ring systems bound to the heterocyclic ring or to the N-containing substituent, but they do not coordinate with the stabilized, high valence metal ion. Ring(s) can also contain O, S, or P atoms. This ring(s) and/or attached, uncoordinating rings and/or N-containing substituent(s) may or may not have halogen or polarizing or water-insolubilizing/solubilizing groups attached. |
| N—P Valence Stabilizer #4: | Heterocyclic ring(s) containing one, two, three, |
| Heterocyclic Rings containing One, Two, Three, or Four Nitrogen Atoms at least one additional Phosphorus Atom Binding Site in a Separate Ring (N—P Bidentates, N—P Tridentates, N—P Tetradentates) | or four nitrogen atoms. In addition, ligand contains additional phosphorus-containing rings that constitute P binding sites. Can include other ring systems bound to the N- or P-containing heterocyclic rings, but they do not coordinate with the stabilized, high valence metal ion. Ring(s) can also contain O, S, or P atoms. This ring(s) and/or additional P-containing ring(s) and/or attached, uncoordinating rings may or may not have halogen or polarizing or water-insolubilizing/solubilizing groups attached. |
| N—P Valence Stabilizer #5: | Macrocyclic ligands containing two, three, four, |
| Two-, Three-, Four-, Five-, Six-, Seven-, Eight-, Nine-, and Ten-Membered Macrocyclics, Macrobicyclics, and Macropolycyclics (including Catapinands, Cryptands, Cyclidenes, and Sepulchrates) wherein all Binding Sites are composed of Nitrogen (usually amine or imine groups) or Phosphorus and are not contained in Component Heterocyclic Rings (N—P Bidentates, N—P Tridentates, N—P Tetradentates, and N—P Hexadentates) | five, six, seven, eight, nine, or ten binding sites composed of nitrogen and phosphorus to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |

TABLE 2-continued

Narrow Band Organic Valence Stabilizers for the $Co^{+3}$ Ion

| General Structural Name (Type of Organic) | Structural Representation |
|---|---|
| N—P Valence Stabilizer #6: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Nitrogen or Phosphorus and are contained in Component Heterocyclic Rings (N—P Bidentates, N—P Tridentates, N—P Tetradentates, or N—P Hexadentates) | Macrocyclic ligands containing a total of four, five, six, seven, eight, nine, or ten heterocyclic rings containing nitrogen or phosphorus binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| N—P Valence Stabilizer #7: Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Nitrogen or Phosphorus and are contained in a Combination of Heterocyclic Rings and Amine, Imine, and Phosphine Groups (N—P Bidentates, N—P Tridentates, N—P Tetradentates, or N—P Hexadentates) | Macrocyclic ligands containing at least one heterocyclic ring. These heterocyclic rings provide nitrogen or phosphorus binding sites to valence stabilize the central metal ion. Other amine, imine, or phosphine binding sites can also be included in the macrocyclic ligand, so long as the total number of binding sites is four, five, six, seven, eight, nine, or ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S—P Valence Stabilizer #1: Thioaryl Phosphines (S—P Bidentates, S—P Tridentates, and S—P Tetradentates) | $[R(—SR')_x]_{1-3}P$, $[R(—SR')_x]_{1-3}PX$, $[R(—PR'R'')(—SR''')]$, $[R(—PR'R'')(—S—S—R''')]$, $[R(—PR—R'')(—C(=S)R''')]$, $[R(—PR'R'')_x]_x]_2S$, $[R(—PR'R'')_x]_{2-3}R'''(—SR'''')_y$, $]R—SR')_{x2-3}R''(—PR'''R'''')_y$, $[R(—PR'R'')_x]_2S_2$, and $[R(—PR'R'')_{x]2}R'''(C(=S))_yR''''$, where X = O or S, and R, R', R'', R''', and R'''' represent H, $NH_2$, or any organic functional group wherein the number of carbon atoms ranges from 0 to 40, optionally having halogen or polarizing or water-insolubilizing/solubilizing groups attached, and x = 1-2 and y = 1-4. Ligand can also contain nonbinding N, O, S, or P atoms. |
| S—P Valence Stabilizer #2: Heterocyclic Rings containing One or Two Sulfur Atoms at least one additional Phosphorus Atom Binding Site not in a Ring (P—S Bidentates, P—S Tridentates, P—S Tetradentates, or P-S Hexadentates) | Heterocyclic ring(s) containing one or two sulfur atoms. In addition, ligand contains additional phosphorus-containing substituents that constitute P binding sites. Can include other ring systems bound to the heterocyclic ring or to the P-containing substituent, but they do not coordinate with the stabilized, high valence metal ion. Ring(s) can also contain O, S, or P atoms. This ring(s) and/or attached, uncoordinating rings and/or P-containing substituent(s) may or may not have halogen or polarizing or water-insolubilizing/solubilizing groups attached. |
| S—P Valence Stabilizer #3: Heterocyclic Rings containing One, Two, or Three Phosphorus Atoms at least one additional Sulfur Atom Binding Site not in a Ring (S—P Bidentates, S—P Tridentates, S—P Tetradentates, or S—P Hexadentates) | Heterocyclic ring(s) containing one, two, or three phosphorus atoms. In addition, ligand contains additional sulfur-containing substituents (usually thiol, mercapto, or thiocarbonyl groups) that constitute S binding sites. Can include other ring systems bound to the heterocyclic ring or to the S-containing substituent, but they do not coordinate with the stabilized, high valence metal ion. Ring(s) can also contain O, S, or P atoms. This ring(s) and/or attached, uncoordinating rings and/or S-containing substituent(s) may or may not have halogen or polarizing or water-insolubilizing/solubilizing groups attached. |
| S—P Valence Stabilizer #4: Heterocyclic Rings containing One or Two | Heterocyclic ring(s) containing one or two sulfur atoms. In addition, ligand contains |

TABLE 2-continued

Narrow Band Organic Valence Stabilizers for the $Co^{+3}$ Ion

| General Structural Name (Type of Organic) | Structural Representation |
|---|---|
| Sulfur Atoms at least one additional Phosphorus Atom Binding Site in a Separate Ring (S—P Bidentates, S—P Tridentates, S—P Tetradentates) | additional phosphorus-containing rings that constitute P binding sites. Can include other ring systems bound to the S- or P-containing heterocyclic rings, but they do not coordinate with the stabilized, high valence metal ion. Ring(s) can also contain O, S, or P atoms. This ring(s) and/or additional P-containing ring(s) and/or attached, uncoordinating rings may or may not have halogen or polarizing or water-insolubilizing/solubilizing groups attached. |
| S—P Valence Stabilizer #5: | Macrocyclic ligands containing two, three, four, |
| Two-, Three-, Four-, Five-, Six-, Seven-, Eight-, Nine-, and Ten-Membered Macrocyclics, Macrobicyclics, and Macropolycyclics (including Catapinands, Cryptands, Cyclidenes, and Sepulchrates) wherein all Binding Sites are composed of Sulfur (usually thiol, mercapto, or thiocarbonyl groups) or Phosphorus and are not contained in Component Heterocyclic Rings (S—P Bidentates, S—P Tridentates, S—P Tetradentates, and S—P Hexadentates) | five, six, seven, eight, nine, or ten binding sites composed of sulfur and phosphorus to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| S—P Valence Stabilizer #6: | Macrocyclic ligands containing a total of four, |
| Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur or Phosphorus and are contained in Component Heterocyclic Rings (S—P Bidentates, S—P Tridentates, S—P Tetradentates, or S—P Hexadentates) | five, six, seven, eight, nine, or ten heterocyclic rings containing sulfur or phosphorus binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| S—P Valence Stabilizer #7: | Macrocyclic ligands containing at least one |
| Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Sulfur or Phosphorus and are contained in a Combination of Heterocyclic Rings and Thiol, Mercapto, Thiocarbonyl or Phosphine Groups (S—P Bidentates, S—P Tridentates, S—P Tetradentates, or S—P Hexadentates) | heterocyclic ring. These heterocyclic rings provide sulfur or phosphorus binding sites to valence stabilize the central metal ion. Other thiol, mercapto, or thiocarbonyl, or phosphine binding sites can also be included in the macrocyclic ligand, so long as the total number of binding sites is four, five, six, seven, eight, nine, or ten. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| P—O Valence Stabilizer #1: | $[R(—OR')_x]_{1-3}P$, $[R(—OR')_x]_{1-3}PX$, $[R(—PR'R'')$ |
| Hydroxyaryl Phosphines (P—O Bidentates, P—O Tridentates, and P—O Tetradentates) | $(—OR''')]$, $[R(—PR'R'')(—C(=O)R''')]$, $[R(—RPR'R'')_x]_2O$, $[R(—PR'R'')_x]_{2-3}R'''(—OR'''')_y$, $[R(—OR')_x]_{2-3}R''(—PR'''R'''')_y$, and $[R(—PR'R'')_x]_2R'''(C(=O))$,R'''', where X = O or S, and R, R', R'', R''', and R'''' represent H, $NH_2$, or any organic functional group wherein the number of carbon atoms ranges from 0 to 40, optionally having halogen or polarizing or water-insolubilizing/solubilizing groups attached, and x = 1-2 and y = 1-4. Ligand can also contain nonbinding N, O, S, or P atoms. |
| P—O Valence Stabilizer #2: | Heterocyclic ring(s) containing one or two |
| Heterocyclic Rings containing One or Two Oxygen Atoms at least one additional Phosphorus Atom Binding Site not in a Ring (P—O Bidentates, P—O Tridentates, P—O Tetradentates, or P—O Hexadentates) | oxygen atoms. In addition, ligand contains additional phosphorus-containing substituents that constitute P binding sites. Can include other ring systems bound to the heterocyclic ring or to the P-containing substituent, but they do not coordinate with the stabilized, high valence metal ion. Ring(s) can also contain O, |

TABLE 2-continued

Narrow Band Organic Valence Stabilizers for the $Co^{+3}$ Ion

| General Structural Name (Type of Organic) | Structural Representation |
|---|---|
| | S, or P atoms. This ring(s) and/or attached, uncoordinating rings and/or P-containing substituent(s) may or may not have halogen or polarizing or water-insolubilizing/solubilizing groups attached. |
| P—O Valence Stabilizer #3: | Heterocyclic ring(s) containing one, two, or |
| Heterocyclic Rings containing One, Two, or Three Phosphorus Atoms at least one additional Oxygen Atom Binding Site not in a Ring (P—O Bidentates, P—O Tridentates, P—O Tetradentates, or P—O Hexadentates) | three phosphorus atoms. In addition, ligand contains additional oxygen-containing substituents (usually hydroxy, carboxy, or carbonyl groups) that constitute 0 binding sites. Can include other ring systems bound to the heterocyclic ring or to the O-containing substituent, hut they do not coordinate with the stabilized, high valence metal ion. Ring(s) can also contain O, S, or P atoms. This ring(s) and/or attached, uncoordinating rings and/or O-containing substituent(s) may or may not have halogen or polarizing or water-insolubilizing/solubilizing groups attached. |
| P—O Valence Stabilizer #4: | Heterocyclic ring(s) containing one or two |
| Heterocyclic Rings containing One or Two Oxygen Atoms at least one additional Phosphorus Atom Binding Site in a Separate Ring (P—O Bidentates, P—O Tridentates, P—O Tetradentates) | oxygen atoms. In addition, ligand contains additional phosphorus-containing rings that constitute P binding sites. Can include other ring systems bound to the O- or P-containing heterocyclic rings, but they do not coordinate with the stabilized, high valence metal ion. Ring(s) can also contain O, S, or P atoms. This ring(s) and/or additional P-containing ring(s) and/or attached, uncoordinating rings may or may not have halogen or polarizing or water-insolubilizing/solubilizing groups attached. |
| P—O Valence Stabilizer #5: | Macrocyclic ligands containing two, three, four, |
| Two-, Three-, Four-, Five-, Six-, Seven-, Eight-, Nine-, and Ten-Membered Macrocyclics, Macrobicyclics, and Macropolycyclics (including Catapinands, Cryptands, Cyclidenes, and Sepulchrates) wherein all Binding Sites are composed of Oxygen (usually hydroxy, carboxy, or carbonyl groups) or Phosphorus and are not contained in Component Heterocyclic Rings (P—O Bidentates, P—O Tridentates, 0 Tetradentates, and P—O Hexadentates) | five, six, seven, eight, nine, or ten binding sites composed of oxygen and phosphorus to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| P—O Valence Stabilizer #6: | Macrocyclic ligands containing a total of four, |
| Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Oxygen or Phosphorus and are contained in Component Heterocyclic Rings (P—O Bidentates, P—O Tridentates, P—O P—O Tetradentates, or P—O Hexadentates) | five, six, seven, eight, nine, or ten heterocyclic rings containing oxygen or phosphorus binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| P—O Valence Stabilizer #7: | Macrocyclic ligands containing at least one |
| Four-, Five-, Six-, Seven-, Eight-, Nine-, or Ten-Membered Macrocyclics, Macrobicyclics, and Macropolycyclics (including Catapinands, Cryptands, Cyclidenes, and Sepulchrates) wherein all Binding Sites are composed of Oxygen or Phosphorus and are contained in a Combination of Heterocyclic Rings and Hydroxy, Carboxy, Carbonyl or Phosphine Groups (P—O Bidentates, P—O Tridentates, P—O Tetradentates, or P—O Hexadentates) | heterocyclic ring. These heterocyclic rings provide oxygen or phosphorus binding sites to valence stabilize the central metal ion. Other hydroxy, carboxy, carbonyl, or phosphine binding sites can also be included in the macrocyclic ligand, so long as the total number of binding sites is four, five, six, seven, eight, nine, or ten. Can include other hydrocarbon/ring systems bound to this macrocyclic ligand, but they do not coordinate with the stabilized, high valence metal ion. This ligand and/or attached, uncoordinating hydrocarbon/rings may or may not have |

TABLE 2-continued

Narrow Band Organic Valence Stabilizers for the $Co^{+3}$ Ion

| General Structural Name (Type of Organic) | Structural Representation |
|---|---|
| | halogen or polarizing or water-insolubilizing groups attached. |
| As Valence Stabilizer #1: | $AsH_3$, $AsH_2R$, $AsHR_2$, where R represents H or |
| Monoarsines (As Monodentates) wherein at least one Arsenic Atom is a Binding Site | any organic functional group wherein the number of carbon atoms ranges from 0 to 25, optionally having halogen or polarizing or water-insolubilizing/solubilizing groups attached. Ligand can also contain nonbinding N, P, As, O, S, or Se atoms. |
| As Valence Stabilizer #2: | R'—As—R—As—R", where R, R', and R" represent |
| Diarsines (an As—As Bidentate) wherein at least one Arsenic Atom is a Binding Site | H or any organic functional group wherein the number of carbon atoms ranges from 0 to 25, optionally having halogen or polarizing or water-insolubilizing/solubilizing groups attached. Ligand can also contain nonbinding N, P, As, O, S, or Se atoms. |
| As Valence Stabilizer #3: | R—As—R'—As—R"—As—R"', where R, R', R", and |
| Triarsines (either As—As Bidentates or As—As Tridentates) wherein at least one Arsenic Atom is a Binding Site | R"' represent H or any organic functional group wherein the number of carbon atoms ranges from 0 to 25, optionally having halogen or polarizing or water-insolubilizing/solubilizing groups attached. Ligand can also contain nonbinding N, P, As, O, S, or Se atoms. |
| As Valence Stabilizer #4: | R—As—R'—As—R"—As—R"'—As—R"", where R, R', |
| Tetraarsines (As—As Bidentates, As—As Tridentates, or As—As Tetradentates) wherein at least one Arsenic Atom is a Binding Site | R", R"', and R"" represent H or any organic functional group wherein the number of carbon atoms ranges from 0 to 25, optionally having halogen or polarizing or water-insolubilizing/solubilizing groups attached. Ligand can also contain nonbinding N, P, As, O, S, or Se atoms. |
| As Valence Stabilizer #5: | R—As—R'—As—R"—As—R"' |
| Pentaarsines (As—As Bidentates, As—As Tridentates, or As—As Tetradentates) wherein at least one Arsenic Atom is a Binding Site | where R, R', R", R"', R"", and R""' represent H or any organic functional group wherein the number of carbon atoms ranges from 0 to 25, optionally having halogen or polarizing or water-insolubilizing/solubilizing groups attached. Ligand can also contain nonbinding N, P, As, O, S, or Se atoms. |
| As Valence Stabilizer #6: | R—As—R'—As—R"—As—R"'—As—R""—As—R""'—As— |
| Hexaarsines (As—As Bidentates, As—As Tridentates, As—As Tetradentates, or As—As Hexadentates) wherein at least one Arsenic Atom is a Binding Site | R""', where R, R', R", R"', R"", R""', and R""' represent H or any organic functional group wherein the number of carbon atoms ranges from 0 to 25, optionally having halogen or polarizing or water-insolubilizing/solubilizing groups attached. Ligand can also contain nonbinding N, P, As, O, S, or Se atoms. |
| As Valence Stabilizer #7: | Five membered heterocyclic ring containing |
| Five-Membered Heterocyclic Rings containing One Arsenic Atom wherein the Arsenic Atom is the Binding Site (As Monodentates) | just one arsenic binding site. Can include other ring systems bound to this heterocyclic ring, but they do not coordinate with the stabilized, high valence metal ion. Ring can also contain O, S, N, P, or Se atoms. This 5-membered ring and/or attached, uncoordinating rings may or may not have halogen or polarizing or water-insolubilizing/solubilizing groups attached. |
| As Valence Stabilizer #8: | Six membered heterocyclic nng containing just |
| Six-Membered Heterocyclic Rings containing One Arsenic Atom wherein the Arsenic Atom is the Binding Site (As Monodentates) | one arsenic binding site. Can include other ring systems bound to this heterocyclic ring, but they do not coordinate with the stabilized, high valence metal ion. Ring can also contain O, S, N, P, or Se atoms. This 6-membered ring and/or attached, uncoordinating rings may or may not have halogen or polarizing or water-insolubilizing/solubilizing groups attached. |

TABLE 2-continued

Narrow Band Organic Valence Stabilizers for the $Co^{+3}$ Ion

| General Structural Name (Type of Organic) | Structural Representation |
|---|---|
| As Valence Stabilizer #9: | Five membered heterocyclic ring(s) containing |
| Five-Membered Heterocyclic Rings containing One Arsenic Atom and having at least one additional Arsenic Atom Binding Site not in a Ring (As Monodentates, As—As Bidentates, As—As Tridentates, As—As Tetradentates, or As—As Hexadentates) | one arsenic atom. In addition, ligand contains additional arsenic-containing substituents (usually arsines) that constitute As binding sites. Can include other ring systems bound to the heterocyclic ring or to the As-containing substituent, but they do not coordinate with the stabilized, high valence metal ion. Ring(s) can also contain O, N, S, P or Se atoms. This 5-membered ring(s) and/or attached, uncoordinating rings and/or As-containing substituent(s) may or may not have halogen or polarizing or water-insolubilizing/solubilizing groups attached. |
| As Valence Stabilizer #10: | Six membered heterocyclic ring(s) containing |
| Six-Membered Heterocyclic Rings containing One Arsenic Atom at least one additional Arsenic Atom Binding Site not in a Ring (As Monodentates, As—As Bidentates, As—As Tridentates, As—As Tetradentates, or As—As Hexadentates) | one arsenic atom. In addition, ligand contains and having additional arsenic-containing substituents (usually arsines) that constitute As binding sites. Can include other ring systems bound to the heterocyclic ring or to the As-containing substituent, but they do not coordinate with the stabilized, high valence metal ion. Ring(s) can also contain O, N, S, P or Se atoms. This 6-membered ring(s) and/or attached, uncoordinating rings and/or As-containing substituent(s) may or may not have halogen or polarizing or water-insolubilizing/solubilizing groups attached. |
| As Valence Stabilizer #11: | Five membered heterocyclic ring(s) containing |
| Five-Membered Heterocyclic Rings containing One Arsenic Atom and having at least one additional Arsenic Atom Binding Site in a separate Ring (As Monodentates, As—As Bidentates, As—As Tridentates, As—As Tetradentates, or As—As Hexadentates) | one arsenic atom. In addition, ligand contains additional arsenic-containing rings that constitute As binding sites. Can include other ring systems bound to the As-containing heterocyclic rings, but they do not coordinate with the stabilized, high valence metal ion. Ring(s) can also contain O, N, S, P, or Se atoms. This 5-membered ring(s) and/or additional As-containing ring(s) and/or attached, uncoordinating rings may or may not have halogen or polarizing or water-insolubilizing/solubilizing groups attached. |
| As Valence Stabilizer #12: | Six membered heterocyclic ring(s) containing |
| Six-Membered Heterocyclic Rings containing One Arsenic Atom and having at least one additional Arsenic Atom Binding Site in a separate Ring (As Monodentates, As—As Bidentates, As—As Tridentates, As—As Tetradentates, or As—As Hexadentates) Ring(s) | one arsenic atom. In addition, ligand contains additional arsenic-containing rings that constitute As binding sites. Can include other ring systems bound to the As-containing heterocyclic rings, but they do not coordinate with the stabilized, high valence metal ion. can also contain O, N, S, P, or Se atoms. This 6-membered ring(s) and/or additional As-containing ring(s) and/or attached, uncoordinating rings may or may not have halogen or polarizing or water-insolubilizing/solubilizing groups attached. |
| As Valence Stabilizer #13: | Macrocyclic ligands containing two, three, four, |
| Two-, Three-, Four-, and Six-Membered Macrocyclics, Macrobicyclics, and Macropolycyclics (including Catapinands, Cryptands, Cyclidenes, and Sepulchrates) wherein all Binding Sites are composed of Arsenic and are not contained in Component Heterocyclic Rings (As—As Bidentates, As—As Tridentates, As—As Tetradentates, and As—As Hexadentates) | or six arsenic binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| As Valence Stabilizer #14: | Macrocyclic ligands containing a total of four |
| Four-, or Six-Membered Macrocyclics, Macrobicyclics, and Macropolycyclics (including Catapinands, Cryptands, | or six five-membered heterocyclic rings containing arsenic binding sites. Can include other hydrocarbon/ring systems bound to this |

TABLE 2-continued

Narrow Band Organic Valence Stabilizers for the $Co^{+3}$ Ion

| General Structural Name (Type of Organic) | Structural Representation |
|---|---|
| Cyclidenes, and Sepulchrates) wherein all Binding Sites are composed of Arsenic and are contained in Component 5-Membered Heterocyclic Rings (As—As Tridentates, As—As Tetradentates, or As—As Hexadentates) | macrocyclic ligand, but they do not coordinate with the stabilized, high valence metal ion. This ligand and/or attached, uncoordinating hydrocarbon/rings may or may not have halogen or polarizing or water-insolubilizing groups attached. |
| As Valence Stabilizer #15: | Macrocyclic ligands containing at least one 5- |
| Four-, or Six-Membered Macrocyclics, Macrobicyclics, and Macropolycyclics (including Catapinands, Cryptands, Cyclidenes, and Sepulchrates) wherein all Binding Sites are composed of Arsenic and are contained in a Combination of 5-Membered Heterocyclic Rings and Arsine Groups (As—As Tridentates, As—As Tetradentates, or As—As Hexadentates) | membered heterocyclic ring. These heterocyclic rings provide arsenic binding sites to valence stabilize the central metal ion. Other arsine binding sites can also be included in the macrocyclic ligand, so long as the total number of binding sites is four or eight. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| As Valence Stabilizer #16: | Macrocyclic ligands containing a total of four |
| Four-, or Six-Membered Macrocyclics, Macrobicyclics, and Macropolycyclics (including Catapinands, Cryptands, Cyclidenes, and Sepulchrates) wherein all Binding Sites are composed of Arsenic and are contained in Component 6-Membered Heterocyclic Rings (As—As Tridentates, As—As Tetradentates, or As—As Hexadentates) | or six six-membered heterocyclic rings containing arsenic binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| As Valence Stabilizer #17: | Macrocyclic ligands containing at least one 6- |
| Four-, or Six-Membered Macrocyclics, Macrobicyclics, and Macropolycyclics (including Catapinands, Cryptands, Cyclidenes, and Sepulchrates) wherein all Binding Sites are composed of Arsenic and are contained in a Combination of 6-Membered Heterocyclic Rings and Arsine Groups (As—As Tridentates, As—As Tetradentates, or As—As Hexadentates) | membered heterocyclic ring. These heterocyclic rings provide arsenic binding sites to valence stabilize the central metal ion. Other arsine binding sites can also be included in the macrocyclic ligand, so long as the total number of binding sites is four or six. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| Se Valence Stabilizer #1: | $SeH_2$, SeHR, $SeR_2$, where R represents H or any |
| Monoselenoethers (Se Monodentates) wherein at least one Selenium Atom is a Binding Site | organic functional group wherein the number of carbon atoms ranges from 0 to 25, optionally having halogen or polarizing or water-insolubilizing/solubilizing groups attached. Ligand can also contain nonbinding N, P, O, S, or Se atoms. |
| Se Valence Stabilizer #2: | R—Se—R'—Se—R", where R, R', and R" represents |
| Diselenoethers (Se—Se Bidentates) at least one Selenium Atom is a Binding Site | wherein H or any organic functional group wherein the number of carbon atoms ranges from 0 to 25, optionally having halogen or polarizing or water-insolubilizing/solubilizing groups attached. Ligand can also contain nonbinding N, P, O, S, or Se atoms. |
| Se Valence Stabilizer #3: | R—Se—R'—Se—R"—Se—R"', where R, R', R", and |
| Triselenoethers (Se—Se Bidentates or Se—Se Tridentates) wherein at least one Selenium Atom is a Binding Site | R"' represents H or any organic functional group wherein the number of carbon atoms ranges from 0 to 25, optionally having halogen or polarizing or water-insolubilizing/solubilizing groups attached. Ligand can also contain nonbinding N, P, O, S, or Se atoms. |

TABLE 2-continued

Narrow Band Organic Valence Stabilizers for the $Co^{+3}$ Ion

| General Structural Name (Type of Organic) | Structural Representation |
|---|---|
| Se Valence Stabilizer #4: | R—Se—R'—Se—R"—Se—R'"—Se—R"", where R, R', |
| Tetraselenoethers (Se—Se Bidentates, Se—Se Tridentates, or Se—Se Tetradentates) wherein at least one Selenium Atom is a Binding Site | R", R'", and R"" represents H or any organic functional group wherein the number of carbon atoms ranges from 0 to 25, optionally having halogen or polarizing or water-insolubilizing/solubilizing groups attached. Ligand can also contain nonbinding N, P, O, S, or Se atoms. |
| Se Valence Stabilizer #5: | Five membered heterocyclic ring containing |
| Five-Membered Heterocyclic Rings containing One or Two Selenium Atoms wherein at least one Selenium Atom is a Binding Site (Se Monodentates or Se—Se Bidentates) | one or two selenium atoms, both of which may function as binding sites. Can include other ring systems bound to this heterocyclic ring, but they do not coordinate with the stabilized, high valence metal ion. Ring can also contain O, N, P, As, or S atoms. This 5-membered ring and/or attached, uncoordinating rings may or may not have halogen or polarizing or water-insolubilizing/solubilizing groups attached. |
| Se Valence Stabilizer #6: | Six membered heterocyclic ring containing one |
| Six-Membered Heterocyclic Rings containing One or Two Selenium Atoms wherein at least one Selenium Atom is a Binding Site (Se Monodentates or Se—Se Bidentates) | or two selenium atoms, both of which may function as binding sites. Can include other ring systems bound to this heterocyclic ring, but they do not coordinate with the stabilized, high valence metal ion. Ring can also contain O, N, P, As, or S atoms. This 5-membered ring and/or attached, uncoordinating rings may or may not have halogen or polarizing or water-insolubilizing/solubilizing groups attached. |
| Se Valence Stabilizer #7: | Five membered heterocyclic ring(s) containing |
| Five-Membered Heterocyclic Rings containing One Selenium Atom and having at least one additional Selenium Atom Binding Site not in a Ring (Se Monodentates, Se—Se Bidentates, Se—Se Tridentates, Se—Se Tetradentates, or Se—Se Hexadentates) | one selenium atom. In addition, ligand contains additional selenium-containing substituents (usually selenols or selenoethers) that constitute Se binding sites. Can include other ring systems bound to the heterocyclic ring or to the Se-containing substituent, but they do not coordinate with the stabilized, high valence metal ion. Ring(s) can also contain O, N, P, As or S atoms. This 5-membered ring(s) and/or attached, uncoordinating rings and/or Se-containing substituent(s) may or may not have halogen or polarizing or water-insolubilizing/solubilizing groups attached. |
| Se Valence Stabilizer #8: | Six membered heterocyclic ring(s) containing |
| Six-Membered Heterocyclic Rings containing One Selenium Atom and having at least one additional Selenium Atom Binding Site not in a Ring (Se Monodentates, Se—Se Bidentates, Se—Se Tridentates, Se—Se Tetradentates, or Se—Se Hexadentates) | one selenium atom. In addition, ligand contains additional selenium-containing substituents (usually selenols or selenoethers) that constitute Se binding sites. Can include other ring systems bound to the heterocyclic ring or to the Se-containing substituent, but they do not coordinate with the stabilized, high valence metal ion. Ring(s) can also contain O, N, P, As or S atoms. This 6-membered ring(s) and/or attached, uncoordinating rings and/or Se-containing substituent(s) may or may not have halogen or polarizing or water-insolubilizing/solubilizing groups attached. |
| Se Valence Stabilizer #9: | Five membered heterocyclic ring(s) containing |
| Five-Membered Heterocyclic Rings containing One Selenium Atom and having at least one additional Selenium Atom Binding Site in a separate Ring (Se Monodentates, Se—Se Bidentates, Se—Se Tridentates, Se—Se Tetradentates, or Se—Se Hexadentates) | one selenium atom. In addition, ligand contains additional selenium-containing rings that constitute Se binding sites. Can include other ring systems bound to the Se-containing heterocyclic rings, but they do not coordinate with the stabilized, high valence metal ion. Ring(s) can also contain O, N, P, As, or S atoms. This 5-membered ring(s) and/or additional Se-containing ring(s) and/or attached, uncoordinating rings may or may not |

TABLE 2-continued

Narrow Band Organic Valence Stabilizers for the $Co^{+3}$ Ion

| General Structural Name (Type of Organic) | Structural Representation |
|---|---|
| | have halogen or polarizing or water-insolubilizing/solubilizing groups attached. |
| Se Valence Stabilizer #10: | Six membered heterocyclic ring(s) containing |
| Six-Membered Heterocyclic Rings containing One Selenium Atom and having at least one additional Selenium Atom Binding Site in a separate Ring (Se Monodentates, Se—Se Bidentates, Se—Se Tridentates, Se—Se Tetradentates, or Se—Se Hexadentates) | one selenium atom. In addition, ligand contains additional selenium-containing rings that constitute Se binding sites. Can include other ring systems bound to the Se-containing heterocyclic rings, but they do not coordinate with the stabilized, high valence metal ion. Ring(s) can also contain O, N, P, As, or S atoms. This 6-membered ring(s) and/or additional Se-containing ring(s) and/or attached, uncoordinating rings may or may not have halogen or polarizing or water-insolubilizing/solubilizing groups attached. |
| Se Valence Stabilizer #11: | Macrocyclic ligands containing two, three, four, |
| Two-, Three-, Four-, or Six-Membered Macrocyclics, Macrobicyclics, and Macropolycyclics (including Catapinands, Cryptands, Cyclidenes, and Sepulchrates) wherein all Binding Sites are composed of Selenium (usually selenol or selenoether groups) and are not contained in Component Heterocyclic Rings (Se—Se Bidentates, Se—Se Tridentates, Se—Se Tetradentates, or Se—Se Hexadentates) | or six selenium binding sites to valence stabilize the central metal ion. Can include other hydrocarbon or ring systems bound to this macrocyclic ligand, but they do not coordinate with the stabilized, high valence metal ion. This ligand and/or attached, uncoordinating hydrocarbons/rings may or may not have halogen or polarizing or water-insolubilizing/solubilizing groups attached. |
| Se Valence Stabilizer #12: | Macrocyclic ligands containing a total of four |
| Four-, or Six-Membered Macrocyclics, Macrobicyclics, and Macropolycyclics (including Catapinands, Cryptands, Cyclidenes, and Sepulchrates) wherein all Binding Sites are composed of Selenium and are contained in Component 5-Membered Heterocyclic Rings (Se—Se Tridentates, Se—Se Tetradentates or Se—Se Hexadentates) | or six five-membered heterocyclic rings containing selenium binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| Se Valence Stabilizer #13: | Macrocyclic ligands containing at least one 5- |
| Four-, or Six-Membered Macrocyclics, Macrobicyclics, and Macropolycyclics (including Catapinands, Cryptands, Cyclidenes, and Sepulchrates) wherein all Binding Sites are composed of Selenium and are contained in a Combination of 5-Membered Heterocyclic Rings and Selenol or Selenoether Groups (Se—Se Tridentates, Se—Se Tetradentates, or Se—Se Hexadentates) | membered heterocyclic ring. These heterocyclic rings provide selenium binding sites to valence stabilize the central metal ion. Other selenol or selenoether binding sites can also be included in the macrocyclic ligand, so long as the total number of binding sites is four or six. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water insolubilizing groups attached. |
| Se Valence Stabilizer #14: | Macrocyclic ligands containing a total of four |
| Four-, or Six-Membered Macrocyclics, Macrobicyclics, and Macropolycyclics (including Catapinands, Cryptands, Cyclidenes, and Sepulchrates) wherein all Binding Sites are composed of Selenium and are contained in Component 6-Membered Heterocyclic Rings (Se—Se Tridentates, Se—Se Tetradentates, or Se—Se Hexadentates) | or six six-membered heterocyclic rings containing selenium binding sites. Can include other hydrocarbon/ring systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| Se Valence Stabilizer #15: | Macrocyclic ligands containing at least one 6- |
| Four-, or Six-Membered Macrocyclics, Macrobicyclics, and Macropolycyclics (including Catapinands, Cryptands, Cyclidenes, and Sepulchrates) wherein all Binding Sites are composed of Selenium and are contained in a Combination of 6-Membered Heterocyclic Rings and Selenol | membered heterocyclic ring. These heterocyclic rings provide selenium binding sites to valence stabilize the central metal ion. Other selenol or selenoether binding sites can also be included in the macrocyclic ligand, so long as the total number of binding sites is four or six. Can include other hydrocarbon/ring |

TABLE 2-continued

Narrow Band Organic Valence Stabilizers for the $Co^{+3}$ Ion

| General Structural Name (Type of Organic) | Structural Representation |
|---|---|
| or Selenoether Groups (Se—Se Tridentates, Se—Se Tetradentates, or Se—Se Hexadentates) | systems bound to this macrocyclic ligand, but they do not coordinate with the stabilized, high valence metal ion. This ligand and/or attached, uncoordinating hydrocarbon/rings may or may not have halogen or polarizing or water-insolubilizing groups attached. |
| Se Valence Stabilizer #16: | R—C(═Se)—CR'R"—C(═Se)—R"' where R, R', R", |
| 1,3-Diselenoketones (Diseleno-beta-ketonates), 1,3,5-Triselenoketones, Bis(1,3-Diselenoketones), and Poly(1,3-Diselenoketones) (S—S Bidentates, S—S Tridentates, S—S Tetradentates) | and R"' represent H, $NH_2$, or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| Se Valence Stabilizer #17: | RR'—C═C(—Se)(—Se), where R and R' represent |
| 1,1-Diselenolates, Bis(1,1-diselenolates), and Poly(1,1-diselenolates) (Se—Se Bidentates and Se—Se Tetradentates) | H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| Se Valence Stabilizer #18: | $RR'N^+$═C(SeH)(SeH), where R and R' |
| Diselenocarbamates, Bis(diselenocarbamates), and Poly(diselenocarbamates) (including N-hydroxydiselenocarbamates and N-mercaptodiselenocarbamates) (Se—Se Bidentates, Se—Se Tridentates, and Se—Se Tetradentates) | represent H, OH, SH, OR" (R" = $C_1$-$C_{30}$ alkyl or aryl), SR" (R" = $C_1$-$C_{30}$ alkyl or aryl), $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| Se Valence Stabilizer #19: | (O═)P(—Se—R)(—Se—R')(—Se—R") or (Se═)P(—Se— |
| Triselenophosphoric Acids (Phosphorotriselenoic Acids), Bis(triselenophosphoric acids), Poly(triselenophosphoric acids), and derivatives thereof (Se—Se Bidentates, Se—Se Tridentates, Se—Se Tetradentates) | R)(—Se—R')(—O—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| Se Valence Stabilizer #20: | (O═)P(—Se—R)(—Se—R')(—O—R") or (Se═)P(—Se— |
| Diselenophosphoric Acids (Phosphorodiselenoic Acids), Bis(diselenophosphoric acids), Poly(diselenophosphoric acids), and derivatives thereof (Se—Se Bidentates, Se—Se Tridentates, Se—Se Tetradentates) | R)(—O—R')(—O—R"), where R, R', and R" represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |
| Se Valence Stabilizer #21: | (Se═)P(—Se—R)(—Se—R')(—Se—R"), where R, R', |
| Tetraselenophosphoric Acids (Phosphorotetraselenoic Acids), Bis(tetraselenophosphoric acids), Poly(tetraselenophosphoric acids), derivatives thereof (Se—Se Bidentates, Se—Se Tridentates, Se—Se Tetradentates) | and R" represent H, $NH_2$ or any organic functional group wherein the number of carbon atoms ranges from 0 to 40, optionally having and halogen or polarizing or water-insolubilizing/solubilizing groups attached. Ligand can also contain nonbinding N, O, S, or P atoms. |
| Se Valence Stabilizer #22: | R—Se—C(═Se)—O—R' or R—Se—C(═O)—Se—R' for |
| Diselenocarbonates, Triselenocarbonates, Bis(diselenocarbonates), and Bis(triselenocarbonates), (Se—Se Bidentates and Se—Se Tetradentates) | diselenocarbonates, and R—Se—C(═Se)—Se—R' for triselenocarbonates, where R, and R' represent H, $NH_2$ or any organic functional group wherein the number of carbon atoms ranges from 0 to 40, optionally having halogen or polarizing or water-insolubilizing/solubilizing groups attached. Ligand can also contain nonbinding N, O, S, or P atoms. |

TABLE 2-continued

Narrow Band Organic Valence Stabilizers for the $Co^{+3}$ Ion

| General Structural Name (Type of Organic) | Structural Representation |
|---|---|
| Se Valence Stabilizer #23: | Selenocyanates bound directly to the high |
| Selenocyanates (Se Monodentates) | valence metal ion. |
| Se Valence Stabilizer #24: | Selenolates (HSe—R, HSe—R—SeH, etc.), where R |
| Selenolates (Se Monodentates) | and R' represent H or any organic functional group wherein the number of carbon atoms ranges from 0 to 35, optionally having halogen or polarizing or water-insolubilizing/solubilizing groups attached. |
| Miscellaneous Valence Stabilizer #1: | Dialkenes or bicyclic or tricyclic hydrocarbons |
| Diene or bicyclic or tricyclic hydrocarbon ligands | bound directly to the high valence metal ion. |
| Miscellaneous Valence Stabilizer #2: | Cyanide and cyanate and related ligands bound |
| Cyanide and related ligands | directly to the high valence metal ion. |
| Miscellaneous Valence Stabilizer #3: | Carbonyl (—CO) ligands bound directly to the |
| Carbonyl ligands | high valence metal ion. |
| Miscellaneous Valence Stabilizer #4: | Halogen (X) atoms bound directly to the high |
| Halogen ligands | valence metal ion. |
| Miscellaneous Valence Stabilizer #5: | Hydroxo and oxo ligands bound directly to the |
| Hydroxo and Oxo Ligands | high valence metal ion. |

N Valence Stabilizer #1a: Examples of five-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates or N—N Tetradentates) that meet the requirements for use as "narrow band" valence stabilizers for $Co^{+3}$ include, but are not limited to: pentaazacyclodecane ([10]ane$N_5$); pentaazacycloundecane ([11]ane$N_5$); pentaazacyclododecane ([12]ane$N_5$); pentaazacyclotridecane ([13]ane$N_5$); pentazaacyclotetradecane ([14]ane$N_5$); pentaazacyclopentadecane ([15]ane$N_5$); pentaazacyclodecatriene ([10]triene$N_5$); pentaazacycloundecatriene ([11]triene$N_5$); pentaazacyclododecatriene ([12]triene$N_5$); pentaazacyclotridecatriene ([13]triene$N_5$); pentazaacyclotetradecatriene ([14]triene$N_5$); and pentaazacyclopentadecatriene ([15]triene$N_5$).

N Valence Stabilizer #1b: Examples of seven-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates, N—N Tetradentates, or N—N Hexadentates) that meet the requirements for use as "narrow band" valence stabilizers for $Co^{+3}$ include, but are not limited to: heptaazacyclotetradecane ([14]ane$N_7$); heptaazacyclopentadecane ([15]ane$N_7$); heptaazacyclohexadecane ([16]ane$N_7$); heptaazacycloheptadecane ([17]ane$N_7$); heptaazacyclooctadecane ([18]ane$N_7$); heptaazacyclononadecane ([19]ane$N_7$); heptaazacycloeicosane ([20]ane$N_7$); heptaazacycloheneicosane ([21]ane$N_7$); heptaazacyclotetradecatriene ([14]triene$N_7$); heptaazacyclopentadecatriene ([15]triene$N_7$); heptaazacyclohexadecatriene ([16]triene$N_7$); heptaazacycloheptadecatriene ([17]triene$N_7$); heptaazacyclooctadecatriene ([18]triene$N_7$); heptaazacyclononadecatriene ([19]triene$N_7$); heptaazacycloeicosatriene ([20]triene$N_7$); and heptaazacycloheneicosatriene ([21]triene$N_7$).

N Valence Stabilizer #1c: Examples of nine-membered macrocyclics, macrobicyclics, and macropolycyclics (including catapinands, cryptands, cyclidenes, and sepulchrates) wherein all binding sites are composed of nitrogen (usually amine or imine groups) and are not contained in component heterocyclic rings (N—N Tridentates, N—N Tetradentates, or N—N Hexadentates) that meet the requirements for use as "narrow band" valence stabilizers for $Co^{+3}$ include, but are not limited to: nonaazacyclooctadecane ([18]ane$N_9$); nonaazacyclononadecane ([19]ane$N_9$); nonaazacycloeicosane ([20]ane$N_9$); nonaazacycloheneicosane ([21]ane$N_9$); nonaazacyclodocosane ([22]ane$N_9$); nonaazacyclotricosane ([23]ane$N_9$); nonaazacyclotetracosane ([24]ane$N_9$); nonaazacyclopentacosane ([25]ane$N_9$); nonaazacyclohexacosane ([26]ane$N_9$); nonaazacycloheptacosane ([27]ane$N_9$); nonaazacyclooctadecatetradiene ([18]tetradiene$N_9$); nonaazacyclononadecatetradiene ([19]tetradiene$N_9$); nonaazacycloeicosatetradiene ([20]tetradiene$N_9$); nonaazacycloheneicosatetradiene ([21]tetradiene$N_9$); nonaazacyclodocosatetradiene ([22]tetradiene$N_9$); nonaazacyclotricosatetradiene ([23]tetradiene$N_9$); nonaazacyclotetracosatetradiene ([24]tetradiene$N_9$); nonaazacyclopentacosatetradiene ([25]tetradiene$N_9$); nonaazacyclohexacosatetradiene ([26]tetradiene$N_9$); and nonaazacycloheptacosatetradiene ([27]tetradiene$N_9$).

N Valence Stabilizer #2a: Examples of five-membered macrocyclics, macrobicyclics, and macropolycyclics (including catapinands, cryptands, cyclidenes, and sepulchrates) wherein all five binding sites are composed of nitrogen and are contained in component 5-membered heterocyclic rings (N—N Tetradentates) that meet the requirements for use as "narrow band" valence stabilizers for $Co^{+3}$ include, but are not limited to: pentaphyrins (pentapyrroles); sapphyrins;

smaragdyrins; pentaoxazoles; pentaisooxazoles; pentathiazoles; pentaisothiazoles; pentaazaphospholes; pentaimidazoles; pentapyrazoles; pentaoxadiazoles; pentathiadiazoles; pentadiazaphospholes; pentatriazoles; pentaoxatriazoles; and pentathiatriazoles.

N Valence Stabilizer #2b: Examples of seven-membered macrocyclics, macrobicyclics, and macropolycyclics (including catapinands, cryptands, cyclidenes, and sepulchrates) wherein all seven binding sites are composed of nitrogen and are contained in component 5-membered heterocyclic rings (N—N Tetradentates) that meet the requirements for use as "narrow band" valence stabilizers for $Co^{+3}$ include, but are not limited to: heptaphyrins (heptapyrroles); heptaoxazoles; heptaisooxazoles; heptathiazoles; heptaisothiazoles; heptaazaphospholes; heptaimidazoles; heptapyrazoles; heptaoxadiazoles; heptathiadiazoles; heptadiazaphospholes; heptatriazoles; heptaoxatriazoles; and heptathiatriazoles.

N Valence Stabilizer #3a: Examples of five-membered macrocyclics, macrobicyclics, and macropolycyclics (including catapinands, cryptands, cyclidenes, and sepulchrates) wherein all five binding sites are composed of nitrogen and are contained in a combination of 5-membered heterocyclic rings and amine or imine groups (N—N Tridentates or N—N Tetradentates) that meet the requirements for use as "narrow band" valence stabilizers for $Co^{+3}$ include, but are not limited to: superphthalocyanine; supernaphthalocyanine; diazapentaphyrins; tetraazapentaphyrins; pentaazapentaphyrins; diazapentapyrazoles; tetraazapentapyrazoles; pentaazapentapyrazoles; diazapentaimidazoles; tetraazapentaimidazoles; and pentaazapentaimidazoles.

N Valence Stabilizer #3b: Examples of seven-membered macrocyclics, macrobicyclics, and macropolycyclics (including catapinands, cryptands, cyclidenes, and sepulchrates) wherein all seven binding sites are composed of nitrogen and are contained in a combination of 5-membered heterocyclic rings and amine or imine groups (N—N Tridentates, N—N Tetradentates, or N—N Hexadentates) that meet the requirements for use as "narrow band" valence stabilizers for $Co^{+3}$ include, but are not limited to: diazaheptaphyrins; tetraazaheptaphyrins; hexaazaheptaphyrins; diazaheptapyrazoles; tetraazaheptapyrazoles; hexaazaheptapyrazoles; diazaheptaimidazoles; tetraazaheptaimidazoles; and hexaazaheptaimidazoles.

N Valence Stabilizer #3c: Examples of nine-membered macrocyclics, macrobicyclics, and macropolycyclics (including catapinands, cryptands, cyclidenes, and sepulchrates) wherein all nine binding sites are composed of nitrogen and are contained in a combination of 5-membered heterocyclic rings and amine or imine groups (N—N Tridentates, N—N Tetradentates, or N—N Hexadentates) that meet the requirements for use as "narrow band" valence stabilizers for $Co^{+3}$ include, but are not limited to: diazanonaphyrins; tetraazanonaphyrins; hexaazanonaphyrins; diazanonapyrazoles; tetraazanonapyrazoles; hexaazanonapyrazoles; diazanonaimidazoles; tetraazanonaimidazoles; and hexaazanonaimidazoles.

N Valence Stabilizer #4a: Examples of five-membered macrocyclics, macrobicyclics, and macropolycyclics (including catapinands, cryptands, cyclidenes, and sepulchrates) wherein all five binding sites are composed of nitrogen and are contained in component 6-membered heterocyclic rings (N—N Tetradentates) that meet the requirements for use as "narrow band" valence stabilizers for $Co^{+3}$ include, but are not limited to: cyclopentapyridines; cyclopentaoxazines; cyclopentathiazines; cyclopentaphosphorins; cyclopentaquinolines; cyclopentapyrazines; cyclopentapyridazines; cyclopentapyrimidines; cyclopentaoxadiazines; cyclopentathiadiazines; cyclopentadiazaphosphorins cyclopentaquinoxalines; cyclopentatriazines; cyclopentathiatriazines; and cyclopentaoxatriazines.

N Valence Stabilizer #4b: Examples of seven-membered macrocyclics, macrobicyclics, and macropolycyclics (including catapinands, cryptands, cyclidenes, and sepulchrates) wherein all seven binding sites are composed of nitrogen and are contained in component 6-membered heterocyclic rings (N—N Tetradentates) that meet the requirements for use as "narrow band" valence stabilizers for $Co^{+3}$ include, but are not limited to: cycloheptapyridines; cycloheptaoxazines; cycloheptathiazines; cycloheptaphosphorins; cycloheptaquinolines; cycloheptapyrazines; cycloheptapyridazines; cycloheptapyrimidines; cycloheptaoxadiazines; cycloheptathiadiazines; cycloheptadiazaphosphorins cycloheptaquinoxalines; cycloheptatriazines; cycloheptathiatriazines; and cycloheptaoxatriazines.

N Valence Stabilizer #5a: Examples of five-membered macrocyclics, macrobicyclics, and macropolycyclics (including catapinands, cryptands, cyclidenes, and sepulchrates) wherein all five binding sites are composed of nitrogen and are contained in a combination of 6-membered heterocyclic rings and amine or imine groups (N—N Tridentates or N—N Tetradentates) that meet the requirements for use as "narrow band" valence stabilizers for $Co^{+3}$ include, but are not limited to: diazacyclopentapyridines; tetraazacyclopentapyridines; diazacyclopentaquinolines; tetraazacyclopentaquinolines; diazacyclopentapyrazines; tetraazacyclopentapyrazines; diazacyclopentapyridazines; tetraazacyclopentapyridazines; diazacyclopentapyrimidines; tctraazacyclopentapyrimidines; diazacyclopentatriazines; and tetraazacyclopentatriazines.

N Valence Stabilizer #5b: Examples of seven-membered macrocyclics, macrobicyclics, and macropolycyclics (including catapinands, cryptands, cyclidenes, and sepulchrates) wherein all seven binding sites are composed of nitrogen and are contained in a combination of 6-membered heterocyclic rings and amine or imine groups (N—N Tridentates, N—N Tetradentates, or N—N Hexadentates) that meet the requirements for use as "narrow band" valence stabilizers for $Co^{+3}$ include, but are not limited to: diazacycloheptapyridines; tetraazacycloheptapyridines; diazacycloheptaquinolines; tetraazacycloheptaquinolines; diazacycloheptapyrazines; tetraazacycloheptapyrazines; diazacycloheptapyridazines; tetraazacycloheptapyridazines; diazacycloheptapyrimidines; tetraazacycloheptapyrimidines; diazacycloheptatriazines; and tetraazacycloheptatriazines.

N Valence Stabilizer #5c: Examples of nine-membered macrocyclics, macrobicyclics, and macropolycyclics (including catapinands, cryptands, cyclidenes, and sepulchrates) wherein all nine binding sites are composed of nitrogen and are contained in a combination of 6-membered heterocyclic rings and amine or imine groups (N—N Tridentates, N—N Tetradentates, or N—N Hexadentates) that meet the requirements for use as "narrow band" valence stabilizers for $Co^{+3}$ include, but are not limited to: diazacyclononapyridines; tetraazacyclononapyridines; diazacyclononaquinolines; tetraazacyclononaquinolines; diazacyclononapyrazines; tctraazacyclononapyrazines; diazacyclononapyridazines; tetraazacyclononapyridazines;

diazacyclononapyrimidines; tetraazacyclononapyrimidines; diazacyclononatriazines; and tetraazacyclononatriazines.

N Valence Stabilizer #6: Examples ofsilylamines and silazanes (N Monodentates, N—N Bidentates, N—N Tridentates, N—N Tetradentates, and N—N Hexadentates) that meet the requirements for use as "narrow band" valence stabilizers for $Co^{+3}$ include, but are not limited to: trisilylamine; N-methyldisilazane (disilylmethylamine); N,N-dimethylsilylamine; (silyldimethylamine); tris(trimethylsilyl)amine; triethylsilylamine (triethylaminosilane) (triethylsilazane); N-ethyltriethylsilylamine (triethyl-N-ethylaminosilane); di-tert-butylsilanediamine (di-tert-butyldiaminosilane); bis(methylamino)diethylsilane; tris(dimethylamino)ethylsilane; hexamethyldisilazane; N-methylhexaphenyldisilazane; hexamethylcyclotrisilazane; and octaphenylcyclotetrasilazane. [Note: Silylamines and silazanes are notably weaker ligands than their carbonaceous derivatives, although replacement of one or two $SiR_3$ groups with $CR_3$ will enhance the donor power of the ligand. Thus, $N(CR_3)_2(SiR_3)$ is a better ligand than $N(CR_3)(SiR_3)_2$, etc.]

N Valence Stabilizer #7: Examples of guanidines, diguanidines, and polyguanidines (N—N bidentates, N—N tridentates, N—N tetradentates, and N—N hexadentates) that meet the requirements for use as "narrow band" valence stabilizers for $Co^{+3}$ include, but are not limited to: guanidine; methylguanidine; ethylguanidine; isopropylguanidine; butylguanidine; benzylguanidine; phenylguanidine; tolylguanidine; naphthylguanidine; cyclohexylguanidine; norbornylguanidine; adamantylguanidine; dimethylguanidine; diethylguanidine; diisopropylguanidine; dibutylguanidine; dibenzylguanidine; diphenylguanidine; ditolylguanidine; dinaphthylguanidine; dicyclohexylguanidine; dinorbornylguanidine; diadamantylguanidine; ethylenediguanidine; propylenediguanidine; tetramethylenediguanidine; pentamethylenediguanidine; hexamethylenediguanidine; heptamethylenediguanidine; octamethylenediguanidine; phenylenediguanidine; piperazinediguanidine; oxalyldiguanidine; malonyldiguanidine; succinyldiguanidine; glutaryldiguanidine; adipyldiguanidine; pimelyldiguanidine; suberyldiguanidine; phthalyldiguanidine; benzimidazoleguanidine; aminoguanidine; nitroaminoguanidine; dicyandiamide (cyanoguanidine); dodecylguanidine; and nitrovin.

N Valence Stabilizer #8: Examples of phosphonitrile amides and bis(phosphonitrile amides) (N—N Bidentates and N—N Tetradentates) that meet the requirements for use as "narrow band" valence stabilizers for $Co^{+3}$ include, but are not limited to: phosphononitrile amide; N-phenylphosphonitrile amide; N-benzylphosphonitrile amide; N-cyclohexylphosphonitrile amide; N-norbornylphosphonitrile amide; N,N'-diphenylphosphonitrile amide; N,N'-dibenzylphosphonitrile amide; N,N'-dicyclohexylphosphonitrile amide; and N,N'-dinorbornylphosphonitrile amide. [Note: The phosphite ($P^{+3}$) valence of the phosphorus atom makes stabilization of high valence metal ions much more difficult, though still possible.]

N Valence Stabilizer #9: Examples of phosphonimidic diamides, bis(phosphonimidic diamides), and poly(phosphonimidic diamides) (N—N bidentates and N—N tetradentates) that meet the requirements for use as "narrow band" valence stabilizers for $Co^{+3}$ include, but are not limited to: phosphonimidic diamide; N-benzylphosphonimidic diamide; N-phenylphosphonimidic diamide; N-cyclohexylphosphonimidic diamide; N-norbornylphosphonimidic diamide; N,N-dibenzylphosphonimidic diamide; N,N-diphenylphosphonimidic diamide; N,N-dicyclohexylphosphonimidic diamide; and N,N-dinorbornylphosphonimidic diamide. [Note: The phosphite ($P^{+3}$) valence of the phosphorus atom makes stabilization of high valence metal ions much more difficult, though still possible.]

N Valence Stabilizer#10: Examples ofphosphonamidimidic acid, phosphonamidimidothioic acid, bis(phosphonamidimidic acid), bis(phosphonamidimidothioic acid), poly(phosphonamidimidic acid), poly(phosphonamidimidothioic acid), and derivatives thereof (N—N Bidentates, and N—N Tetradentates) that meet the requirements for use as "narrow band" valence stabilizers for $Co^{+3}$ include, but are not limited to: phosphonamidimidic acid, phosphonamidimidothioic acid; O-phenylphosphonamidimidic acid; O-benzylphosphonamidimidic acid; O-cyclohexylphosphonamidimidic acid; O-norbornylphosphonamidimidic acid; S-phenylphosphonamidimidothioic acid; S-benzylphosphonamidimidothioic acid; S-cyclohexylphosphonamidimidothioic acid; and S-norbornylphosphonamidimidothioic acid. [Note: The phosphite ($P^{+3}$) valence of the phosphorus atom makes stabilization of high valence metal ions much more difficult, though still possible.]

N Valence Stabilizer #11: Examples of pyridinaldimines, bis(pyridinaldimines), and poly(pyridinaldimines) (N—N Bidentates, N—N Tridentates, and N—N Tetradentates) that meet the requirements for use as "narrow band" valence stabilizers for $Co^{+3}$ include, but are not limited to: pyridylideneaniline [N-(pyridylmethylene)benzenamine]; and (2-pyridyl)benzylideneaniline.

N Valence Stabilizer #12: Examples of hydrazones, bis(hydrazones), and poly(hydrazones) (N Monodentates, N—N Bidentates, N—N Tridentates, and N—N Tetradentates) that meet the requirements for use as "narrow band" valence stabilizers for $Co^{+3}$ include, but are not limited to: acetaldehyde hydrazone; acetaldehyde phenylhydrazone; acetone hydrazone; acetone phenylhydrazone; pinacolone hydrazone; pinacolone phenylhydrazone; benzaldehyde hydrazone; benzaldehyde phenylhydrazone; naphthaldehyde hydrazone; naphthaldehyde phenylhydrazone; norbornanone hydrazone; norbornanone phenylhydrazone; camphor hydrazone; camphor phenylhydrazone; nopinone hydrazone; nopinone phenylhydrazine; 2-pyridinaldehyde hydrazone; 2-pyridinealdehyde phenylhydrazone; salicylaldehyde hydrazone; salicylaldehyde phenylhydrazone; quinolinaldehyde hydrazone; quinolinaldehyde phenylhydrazone; isatin dihydrazone; isatin di(phenylhydrazone); camphorquinone dihydrazone; camphorquinone di(phenylhydrazone); and 2-hydrazinobenzimidazole hydrazone.

N Valence Stabilizer #13: Examples of azo compounds without chelate substitution at the ortho- (for aryl) or alpha- or beta- (for alkyl) positions, bis(azo compounds), or poly(azo compounds) (N Monodentates, N—N Bidentates, or N—N Tridentates) that meet the requirements for use as "narrow band" valence stabilizers for $Co^{+3}$ include, but are not limited to: azobenzene (diphenyldiazene); p-diaminoazobenzene; p-dimethylaminoazobenzene (butter yellow); methyl orange; Fast Garnet GBC (4'-amino-2,3'-dimethylazobenzene)[Note: non-bonding methyl group in the o-position.]; and Alizarin Yellow R. [Note: Azo compounds without chelate substitution at the ortho- (for aryl) or beta- (for alkyl) positions tend to stabilize lower oxidation states in metal ions.]

N Valence Stabilizer #14: Examples of formazans, bis (formazans), and poly(fonmazans) without ortho-hydroxy, carboxy, thiol, mercapto, amino, or hydrazido substitution (N—N Bidentates, N—N Tetradentates, and N—N Hexadentates) that meet the requirements for use as "narrow band" valence stabilizers for $Co^{+3}$ include, but are not limited to: 1,3,5-triphenylformazan; and 1,3,5-naphthylformazan.

N Valence Stabilizer #15: Examples of hydramides (N—N Bidentates) that meet the requirements for use as "narrow band" valence stabilizers for $Co^{+3}$ include, but are not limited to: hydrobenzamide; hydronaphthamide; and hydrosalicylamide.

N Valence Stabilizer #16: Examples of azines (including ketazines), bis(azines), and poly(azines) without ortho-hydroxy, carboxy, thiol, mercapto, amino, or hydrazido substitution (N—N Bidentates, N—N Tetradentates, and N—N Hexadentates) that meet the requirements for use as "narrow band" valence stabilizers for $Co^{+3}$ include, but are not limited to: benzalazine; naphthalazine; cyclohexanonazine; and norbomonazine.

N Valence Stabilizer #17: Examples of Schiff Bases with one Imine (C═N) Group and without ortho- (for aryl constituents) or alpha- or beta- (for alkyl constituents) hydroxy, carboxy, carbonyl, thiol, mercapto, thiocarbonyl, amino, imino, oximo, diazeno, or hydrazido substitution (N Monodentates) that meet the requirements for use as "narrow band" valence stabilizers for $Co^{+3}$ include, but are not limited to: N-(Benzaldehydo)isopropylamine; N-(Naphthaldehydo)isopropylamine; N-(Acetophenono)isopropylamine; N-(Propiophenono)isopropylamine; N-(Benzaldehydo)cyclohexylamine; N-(Naphthaldehydo) cyclohexylamine; N-(Acetophenono)cyclohexylamine; N-(Propiophenono)cyclohexylamine; N-(Benzaldehydo) aniline (BAAN); N-(Naphthaldehydo)aniline; N-(Acetophenono)aniline; N-(Propiophenono)aniline; N-(Benzaldehydo) aminonorbornane; N-(Naphthaldehydo)aminonorbornane; N-(Acetophenono)aminonorbornane; N-(Propiophenono) aminonorbornane; (Vanillino)anisidine; (Cinnamaldehydo) anisidine; N-(o-carboxycinnamaldehydo)aniline; N-(cinnamaldehydo)aniline; N-(cinnamaldehydo)m- or p-anisidine; and N-(o-carboxycinnamaldehydo)m- or p-anisidine.

N Valence Stabilizer #18: Examples of isocyanide and cyanamide and related ligands (N Monodentates) that meet the requirements for use as "narrow band" valence stabilizers for $Co^{+3}$ include, but are not limited to: isocyanate (—NCO); isothiocyanate (—NCS); isoselenocyanate (—NCSe); and cyanamide (—NCN). [Note: the nitrogen atom is directly complexed to the high valence metal ion.]

N Valence Stabilizer #19: Examples of nitrosyls and nitrites and related ligands (N Monodentates) that meet the requirements for use as "narrow band" valence stabilizers for $Co^{+3}$ include, but are not limited to: nitrosyl (—NO); thionitrosyl (—NS); nitrite (—$NO_2$); thionitrite (sulfinylamide)(thiazate)(—NSO); nitrosamine (═NN═O); thionitrosamine (═NN═S); nitramine (═$NNO_2$); and thionitramine (═$NNS_2$) ligands.

N Valence Stabilizer #20: Examples of nitrites, dinitriles, and polynitriles (N Monodentates, N—N Bidentates, N—N Tridentates) that meet the requirements for use as "narrow band" valence stabilizers for $Co^{+3}$ include, but are not limited to: benzonitrile; naphthonitrile; cyanonaphthalene; cyclohexyl nitrile; cyanopyridine; cyanopurine; cyanophenol; cyanothiophenol; adamantane nitrite; norbornyl nitrile; cinnamonitrile; dicyanobenzene; dicyanobutene; dicyanoimidazole; dicyanopyridine; cyanotolunitrile; tetracyanoethylene (TCNE); tetracyanoquinodimethane (TCNQ); diethylaminopropionitrile (deapn), and polyacrylonitriles.

N Valence Stabilizer #21: Examples of azide ligands (N monodentates) that meet the requirements for use as "narrow band" valence stabilizers for $Co^{+3}$ include, but are not limited to: azide (—$N_3$) ions; methyl azide; ethyl azide; phenyl azide; diphenyltriazene; and phenyl sulfonyl azide.

S Valence Stabilizer #1: Examples of monothioethers (S monodentates) that meet the requirements for use as "narrow band" valence stabilizers for $Co^{+3}$ include, but are not limited to: hydrogen sulfide, dimethyl sulfide, diethyl sulfide, dioctyl sulfide, diphenyl sulfide, dicyclohexyl sulfide, tetramethylene sulfide (tetrahydrothiophene, tht), trimethylene sulfide, dimethylene sulfide (ethylene sulfide), pentamethylene sulfide, 1,4-thioxane, oxathiolane, cyclohexene sulfide, cyclooctene sulfide, benzotetrahydrothiophene, dibenzothiophene, naphthotetrahydrothiophene, and thiabicycloheptane.

S Valence Stabilizer #2: Examples of disulfides (S monodentates) that meet the requirements for use as "narrow band" valence stabilizers for $Co^{+3}$ include, but are not limited to: methyl disulfide, ethyl disulfide, phenyl disulfide, nitrophenide, and 1,2-dithiacyclohexane.

S Valence Stabilizer #3: Examples of dithioethers (S monodentates or S—S bidentates) that meet the requirements for use as "narrow band" valence stabilizers for $Co^{+3}$ include, but are not limited to: 1,3-dithiane, 1,4-dithiane, benzodithiane, dibenzodithiane, naphthodithiane, 2,5-dithiahexane (dth); 3,6-dithiaoctane (dto); 2,5-dimethyl-3,6-dithiaoctane; 3,7-dithianonane; 2,6-dithiaheptane; 1,6-diphenyl-2,5-dithiahexane; 1,4-diphenyl-1,4-dithiabutane; 1,3-dithiolane; 1,4-dithiane (1,4-dithiacyclohexane); 1,4-dithiacycloheptane (dtch); 1,5-dithiacyclooctane (dtco); o-phenylenebis(2-thiapropane); o-phenylenebis(2-thiabutane); 2,2'-(thiamethyl)biphenyl, and 2,2'-(thiaethyl)biphenyl.

S Valence Stabilizer #4: Examples of trithioethers (S monodentates, S—S bidentates, or S—S tridentates) that meet the requirements for use as "narrow band" valence stabilizers for $Co^{+3}$ include, but are not limited to: 1,3,5-trithiane; 1,3,5-tris(methylthia)cyclohexane; 1,3,5-tris(ethyltbia)cyclohexane; 1,3,5-tris(phenylthia)cyclohexane; 2,5,8-tritbianonane; 3,6,9-trithiaundecane; and 2,6,10-trithiaundecane.

S Valence Stabilizer #5: Examples of tetrathioethers (S monodentates, S—S bidentates, S—S tridentates, or S—S tetradentates) that meet the requirements for use as "narrow band" valence stabilizers for $Co^{+3}$ include, but are not limited to: 1,4,10,13-tetrathiatridecane; 2,6,10,14-tetrathiapentadecane; 2,5,8,11-tetrathiadodecane; 2,5,9,12-ttetrathiatridecane; 2,6,9,13-tetrathiatetradecane; 1,4-(o-thiomethyl) phenyl-1,4-dithiabutane; 1,5-(o-thiomethyl)phenyl-1,5-dithiapentane; 1,6-(o-thiomethyl)phenyl-1,6-dithiahexane; 1,4-(o-thiomethyl)phenyl-1,4-dithiabut-2-ene; and polythioethers.

S Valence Stabilizer #6: Examples of hexathioethers (S monodentates, S—S bidentates, S—S tridentates, S—S tetradentates, or S—S hexadentates) that meet the requirements for use as "narrow band" valence stabilizers for $Co^{+3}$ include, but are not limited to: tri(2-((o-thiomethyl)phenyl) ethyl)amine; and tri((o-thiomethyl)phenyl)methylamine.

S Valence Stabilizer #7a: Examples of 5-membered heterocyclic rings containing one sulfur atom (S monodentates)

that meet the requirements for use as "narrow band" valence stabilizers for $Co^{+3}$ include, but are not limited to: dihydrothiophene, thiophene, thiazole, thiapyrroline, thiaphospholene, thiaphosphole, oxathiole, thiadiazole, thiatriazole, benzodihydrothiophene, benzothiophene, benzothiazole, benzothiaphosphole, dibenzothiophene, and naphthothiophene.

S Valence Stabilizer #7b: Examples of 5-membered heterocyclic rings containing two sulfur atoms (S monodentates or S—S bidentates) that meet the requirements for use as "narrow band" valence stabilizers for $Co^{+3}$ include, but are not limited to: dithiole, benzodithiole, and naphthodithiole.

S Valence Stabilizer #8a: Examples of 6-membered heterocyclic rings containing one sulfur atom (S monodentates) that meet the requirements for use as "narrow band" valence stabilizers for $Co^{+3}$ include, but are not limited to: dihydrothiopyran, thiopyran, thiazine, thiadiazine, thiaphosphorin, thiadiphosphorin, oxathiin, benzothiopyran, dibenzothiopyran, and naphthothiopyran.

S Valence Stabilizer #8b: Examples of 6-membered hetero cyclic rings containing two sulfur atoms (S monodentates or S—S bidentates) that meet the requirements for use as "narrow band" valence stabilizers for $Co^{+3}$ include, but are not limited to: dihydrodithlim, dithuin, benzodithimn, dibenzodithiin (thianthrene), and naphthodithiin.

S Valence Stabilizer #9a: Examples of 5-membered heterocyclic rings containing one sulfur atom and having at least one additional sulfur atom binding site not contained in a ring (S Monodentates, S—S Bidentates, S—S Tridentates, S—S Tetradentates, or S—S Hexadentates) that meet the requirements for use as "narrow band" valence stabilizers for $Co^{+3}$ include, but are not limited to: 2,5-dimercapto-2,5-dihydrothiophene; 2,5-bis(thiomethyl)-2,5-dihydrothiophene; 2,5-bis(2-thiophenyl)-2,5-dihydrothiophene; 2,5-dimercaptothiophene; 2,5-bis(thiomethyl)thiophene; 2,5-bis(2-thiophenyl)thiophene; 2,5-dimercatothiazoic; 2,5-bis(thiomethyl)thiazole; 2,5-bis(2-thiophenyl)thiazole; 2,5-dimercapto-1,3,4-thiadiazole [bismuththiol]; 2-mercaptothianaphthene; 7-(thiomethyl)thianaphthene; 1,8-dimercaptodibenzothiophene; 2-mercaptobenzothiazole; 2-mercapro-1,3,4-thiadiazole; 2-amino-5-mercapto-1,3,4-thiadiazole; 2,5-bis(alkylthio)-1,3,4-thiadiazole; and 7-(thiomethyl)benzothiazole.

S Valence Stabilizer #9b: Examples of 5-membered heterocyclic rings containing two sulfur atoms and having at least one additional sulfur atom binding site not contained in a ring (S Monodentates, S—S Bidentates, S—S Tridentates, S—S Tetradentates, or S—S Hexadentates) that meet the requirements for use as "narrow band" valence stabilizers for $Co^{+3}$ include, but are not limited to: 2-mercapto-1,3-dithiole; 2-(dimercaptomethyl)-1,3-dithiole; 4,5-dimercapto-1,3-dithiole; 4,5-bis(2-thiophenyl)-1,3-dithiole; 2-mercaptobenzodithiole; and 7-mercaptob enzodithiole.

S Valence Stabilizer #10a: Examples of 6-membered heterocyclic rings containing one sulfur atom and having at least one additional sulfur atom binding site not contained in a ring (S Monodentates, S—S Bidentates, S—S Tridentates, S—S Tetradentates, or S—S Hexadentates) that meet the requirements for use as "narrow band" valence stabilizers for $Co^{+3}$ include, but are not limited to: 2,6-dimercapto-2,5-dihydrothiopyran; 2,6-bis(thiomethyl)-2,5-dihydrothiopyran; 2,6-bis(2-thiophenyl)-2,5-dihydrothiopyran; 2,6-dimercaptothiopyran; 2,6-bis(thiomethyl)thiopyran; 2,6-bis(2-thiophenyl)thiopyran; 2,6-dimercaptothiazine; 2,6-bis(thiomethyl)thiazine; 2,6-bis(2-thiophenyl)thiazine; 2,6-dimercapto-1,3,5-thiadiazine; 2-mercapto-1-benzothiopyran; 8-mercapto-1-benzothiopyran; and 1,9-dimercaptodibenzothiopyran.

S Valence Stabilizer #10b: Examples of 6-membered heterocyclic rings containing two sulfur atoms and having at least one additional sulfur atom binding site not contained in a ring (S Monodentates, S—S Bidentates, S—S Tridentates, S—S Tetradentates, or S—S Hexadentates) that meet the requirements for use as "narrow band" valence stabilizers for $Co^{+3}$ include, but are not limited to: 2-mercapto-1,4-dithiin; 2,6-dimercapto-1,4-dithiin; 2,6-bis(2-thiophenyl)-1,4-dithiin; 2,3-dimercapto-1,4-benzodithiin; 5,8-dimercapto-1,4-benzodithiin; 1,8-dimercaptothianthrene; and 1,4,5,8-tetramercaptothianthrene.

S Valence Stabilizer #11a: Examples of 5-membered heterocyclic rings containing one sulfur atom and having at least one additional sulfur atom binding site contained in a ring (S Monodentates, S—S Bidentates, S—S Tridentates, S—S Tetradentates) that meet the requirements for use as "narrow band" valence stabilizers for $Co^{+3}$ include, but are not limited to: 2,2'-bi-2,5-dihydrothiophene; 2,2',2"-tri-2,5-dihydrothiophene; 2,2'-bithiophene; 2,2',2"-trithiophene; 2,2'-bithiazole; 5,5'-bithiazole; 2,2'-bioxathiole; 2,2'-bi-1,3,4-thiadiazole; 2,2'-bithianaphthene; 2,2'-bibenzothiazole; 1,1'-bis(dibenzothiophene); and polythiophenes.

S Valence Stabilizer #11b: Examples of 5-membered heterocyclic rings containing two sulfur atoms and having at least one additional sulfur atom binding site contained in a ring (S Monodentates, S—S Bidentates, S—S Tridentates, S—S Tetradentates) that meet the requirements for use as "narrow band" valence stabilizers for $Co^{+3}$ include, but are not limited to: 2,2'-bi-1,3-dithiole; 4,4'-bi-1,3-dithiole; 7,7'-bi-1,2-benzodithiole; 3,3'-bi-1,2-benzodithiole; and tetrathiofulvalene.

S Valence Stabilizer #12a: Examples of6-membered heterocyclic rings containing one sulfur atom and having at least one additional sulfur atom binding site contained in a ring (S Monodentates, S—S Bidentates, S—S Tridentates, S—S Tetradentates) that meet the requirements for use as "narrow band" valence stabilizers for $Co^{+3}$ include, but are not limited to: 2,2'-bi-2,5-dihydrothiopyran; 2,2',2"-tri-2,5-dihydrothiopyran; 2,2'-bithiopyran; 2,2',2"-trithiopyran; 2,2'-bi-1,4-thiazine; 2,2'-bi-1,3,5-thiadiazine; 2,2'-bi-1-benzothiopyran; and 1,1'-bis(dibenzothiopyran)

S Valence Stabilizer #12b: Examples of 6-membered heterocyclic rings containing two sulfur atoms and having at least one additional sulfur atom binding site contained in a ring (S Monodentates, S—S Bidentates, S—S Tridentates, S—S Tetradentates) that meet the requirements for use as "narrow band" valence stabilizers for $Co^{+3}$ include, but are not limited to: 2,2'-bi-1,4-dithiin; 2,2'-bi-1,3-dithiin; 5,5'-bi-1,4-benzodithiin; 2,2'-bi-1,3-benzodithiin; and 1,1'-bithianthrene.

S Valence Stabilizer #13a: Examples of two-membered macrocyclics, macrobicyclics, and macropolycyclics (including catapinands, cryptands, cyclidenes, and sepulchrates) wherein both binding sites are composed of sulfur (usually thiol or thioether groups) and are not contained in component heterocyclic rings (S—S Bidentates) that meet the requirements for use as "narrow band" valence stabilizers for $Co^{+3}$ include, but are not limited to: dithiacyclobutane ([4]ane$S_2$); dithiacyclopentane ([5]ane$S_2$); dithiacyclohexane ([6]ane$S_2$); dithiacycloheptane ([7]ane$S_2$);

dithiacyclooctane ([8]aneS$_2$); dithiacyclobutene ([4]eneS$_2$); dithiacyclopentene ([5]eneS$_2$); dithiacyclohexene ([6]eneS$_2$); dithiacycloheptene ([7]eneS$_2$); dithiacyclooctene ([8]eneS$_2$); dithiacyclobutadiene ([4]dieneS$_2$); dithiacyclopentadiene ([5]dieneS$_2$); dithiacyclohexadiene ([6]dieneS$_2$); dithiacycloheptadiene ([7]dieneS$_2$); and dithiacyclooctadiene ([8]dieneS$_2$).

S Valence Stabilizer #13b: Examples of three-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates) that meet the requirements for use as "narrow band" valence stabilizers for $Co^{+3}$ include, but are not limited to: trithiacyclohexane ([6]aneS$_3$); trithiacycloheptane ([7]aneS$_3$); trithiacyclooctane ([8]aneS$_3$); trithiacyclononane ([9]aneS$_3$) trithiacyclodecane ([10]aneS$_3$); trithiacycloundecane ([11]aneS$_3$); trithiacyclododecane ([12]aneS$_3$); trithiacyclohexene ([6]eneS$_3$); trithiacycloheptene ([7]eneS$_3$); trithiacyclooctene ([8]eneS$_3$) trithiacyclononene ([9]eneS$_3$); trithiacyclodecene ([10]eneS$_3$); trithiacycloundecene ([11]eneS$_3$); trithiacyclododecene ([12]eneS$_3$); trithiacyclohexatriene ([6]trieneS$_3$); trithiacycloheptatriene ([7]trieneS$_3$); trithiacyclooctatriene ([8]trieneS$_3$); trithiacyclononatriene ([9]trieneS$_3$); trithiacyclodecatriene ([10]trieneS$_3$); trithiacycloundecatriene ([11]trieneS$_3$); and trithiacyclododecatriene ([12]trieneS$_3$).

S Valence Stabilizer #13c: Examples of four-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tetradentates) that meet the requirements for use as "narrow band" valence stabilizers for $Co^{+3}$ include, but are not limited to: tetrathiacyclooctane ([8]aneS$_4$); tetrathiacyclononane ([9]aneS$_4$); tetrathiacyclodecane ([10]aneS$_4$); tetrathiacycloundecane ([11]aneS$_4$); tetrathiacyclododecane ([12]aneS$_4$); tetrathiacyclotridecane ([13]aneS$_4$); tetrathiacyclotetradecane ([14]aneS$_4$); tetrathiacyclopentadecane ([15]aneS$_4$); tetrathiacyclohexadecane ([16]aneS$_4$); tetrathiacycloheptadecane ([17]aneS$_4$); tetrathiacyclooctadecane ([18]aneS$_4$); tetrathiacyclononadecane ([19]aneS$_4$); tetrathiacycloeicosane ([20]aneS$_4$); tetrathiacyclooctadiene ([8]dieneS$_4$); tetrathiacyclononadiene ([9]dieneS$_4$); tetrathiacyclodecadiene ([10]dieneS$_4$); tetrathiacycloundecadiene ([11]dieneS$_4$); tetrathiacyclododecadiene ([12]dieneS$_4$); tetrathiacyclotridecadiene ([13]dieneS$_4$); tetrathiacyclotetradecadiene ([14]dieneS$_4$); tetrathiacyclopentadecadiene ([15]dieneS$_4$); tetrathiacyclohexadecadiene ([16]dieneS$_4$); tetrathiacycloheptadecadiene ([17]dieneS$_4$); tetrathiacyclooctadecadiene ([18]dieneS$_4$); tetrathiacyclononadecadiene ([19]dieneS$_4$); tetrathiacycloeicosadiene ([20]dieneS$_4$); tetrathiacyclooctatetradiene ([8]tetradieneS$_4$); tetrathiacyclononatetradiene ([9]tetradieneS$_4$); tetrathiacyclodecatetradiene ([10]tetradieneS$_4$); tetrathiacycloundecatetradiene ([11]tetradieneS$_4$); tetrathiacyclododecatetradiene ([12]tetradieneS$_4$); tetrathiacyclotridecatetradi ene ([13]tetradieneS$_4$); tetrathiacyclotetradecatetradiene ([14]tetradieneS$_4$); tetrathiacyclopentadecatetradiene ([15]tetradieneS$_4$); tetrathiacyclohexadecatetradiene ([16]tetradieneS$_4$); tetrathiacycloheptadecatetradiene ([17]tetradieneS$_4$); tetrathiacyclooctadecatetradiene ([18]tetradieneS$_4$); tetrathiacyclononadecatetradiene ([19]tetradieneS$_4$); and tetrathiacycloeicosatetradiene ([20]tetradieneS$_4$).

S Valence Stabilizer #13d: Examples of five-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates or S—S Tetradentates) that meet the requirements for use as "narrow band" valence stabilizers for $Co^{+3}$ include, but are not limited to: pentathiacyclodecane ([10]aneS$_5$); pentathiacycloundecane ([11]aneS$_5$); pentathiacyclododecane ([12]aneS$_5$); pentathiacyclotridecane ([13]anes$_5$); pentathiacyclotetradecane ([14]aneS$_5$); pentathiacyclopentadecane ([15]aneS$_5$); pentathiacyclodecatriene ([10]trieneS$_5$); pentathiacycloundecatriene ([11]trieneS$_5$); pentathiacyclododecatriene ([12]trieneS$_5$); pentathiacyclotridecatriene ([13]trieneS$_5$); pentathiacyclotetradecatriene ([14]trieneS$_5$); and pentathiacyclopentadecatriene ([15]trieneS$_5$).

S Valence Stabilizer #13e: Examples of six-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates, S—S Tetradentates, or S—S Hexadentates) that meet the requirements for use as "narrow band" valence stabilizers for $Co^{+3}$ include, but are not limited to: hexathiacyclododecane ([12]aneS$_6$); hexathiacyclotridecane ([13]aneS$_6$); hexathiacyclotetradecane ([14]aneS$_6$); hexathiacyclopentadecane ([15]aneS$_6$); hexathiacyclohexadecane ([16]aneS$_6$); hexathiacycloheptadecane ([17]aneS$_6$); hexathiacyclooctadecane ([18]aneS$_6$); hexathiacyclononadecane ([19]aneS$_6$); hexathiacycloeicosane ([20]aneS$_6$); hexathiacycloheneicosane ([21]aneS$_6$); hexathiacyclodocosane ([22]aneS$_6$); hexathiacyclotricosane ([23]aneS$_6$); hexathiacyclotetracosane ([24]aneS$_6$); hexathiacyclododecatriene ([12]trieneS$_6$); hexathiacyclotridecatriene ([13]trieneS$_6$); hexathiacyclotetradecatriene ([14]trieneS$_6$); hexathiacyclopentadecatriene ([15]trieneS$_6$); hexathiacyclohexadecatriene ([16]trieneS$_6$); hexathiacycloheptadecatriene ([17]trieneS$_6$); hexathiacyclooctadecatriene ([18]trieneS$_6$); hexathiacyclononadecatriene ([19]trieneS$_6$); hexathiacycloeicosatriene ([20]trieneS$_6$); hexathiacycloheneicosatriene ([21]trieneS$_6$); hexathiacyclodocosatriene ([22]trieneS$_6$); hexathiacyclotricosatriene ([23]trieneS$_6$); and hexathiacyclotetracosatriene ([24]trieneS$_6$).

S Valence Stabilizer #13f: Examples of seven-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates, S—S Tetradentates, or S—S Hexadentates) that meet the requirements for use as "narrow band" valence stabilizers for $Co^{+3}$ include, but are not limited to: heptathiacyclotetradecane ([14]aneS$_7$); heptathiacyclopentadecane ([15]aneS$_7$); heptathiacyclohexadecane ([16]aneS$_7$); heptathiacycloheptadecane ([17]aneS$_7$); heptathiacyclooctadecane ([18]aneS$_7$); heptathiacyclononadecane ([19]aneS$_7$); heptathiacycloeicosane ([20]aneS$_7$); heptathiacycloheneicosane ([21]aneS$_7$); heptathiacyclotetradecatriene ([14]trieneS$_7$); heptathiacyclopentadecatriene ([15]trieneS$_7$); heptathiacyclohexadecatriene ([16]trieneS$_7$); heptathiacycloheptadecatriene ([17]trieneS$_7$); heptathiacyclooctadecatriene ([18]trieneS$_7$); heptathiacyclononadecatriene ([19]trieneS$_7$); heptathiacycloeicosatriene ([20]trieneS$_7$); and heptathiacycloheneicosatriene ([21]trieneS$_7$).

S Valence Stabilizer #13g: Examples of eight-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates, S—S Tetradentates, or S—S Hexadentates) that meet the requirements for use as "narrow band" valence stabilizers for $Co^{+3}$ include, but are not limited to: octathiacyclohexadecane ([16]ane$S_8$); octathiacycloheptadecane ([17]ane$S_8$); octathiacyclooctadecane ([18]ane$S_8$); octathiacyclononadecane ([19]ane$S_8$); octathiacycloeicosane ([20]ane$S_8$); octathiacycloheneicosane ([21]ane$S_8$); octathiacyclodocosane ([22]ane$S_8$); octathiacyclotricosane ([23]ane$S_8$); octathiacyclotetracosane ([24]ane$S_8$); octathiacyclohexadecatetradiene ([16]tetradiene$S_8$); octathiacycloheptadecatetradiene ([17]tetradiene$S_8$); octathiacyclooctadecatetradiene ([18]tetradiene$S_8$); octathiacyclononadecatetradiene ([19]tetradiene$S_8$); octathiacycloeicosatetradiene ([20]tetradiene$S_8$); o ctathiacycl ohenei co satetradi ene ([21]tetradiene$S_8$); octathiacyclodocosatetradiene ([22]tetradiene$S_8$); octathiacyclotricosatetradiene ([23]tetradiene$S_8$); and octathiacyclotetracosatetradiene ([24]tetradiene$S_8$).

S Valence Stabilizer #13h: Examples of nine-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates, S—S Tetradentates, or S—S Hexadentates) that meet the requirements for use as "narrow band" valence stabilizers for $Co^{+3}$ include, but are not limited to: nonathiacyclooctadecane ([18]ane$S_9$); nonathiacyclononadecane ([19]ane$S_9$); nonathiacycloeicosane ([20]ane$S_9$); nonathiacycloheneicosane ([21]ane$S_9$); nonathiacyclodocosane ([22]ane$S_9$); nonathiacyclotricosane ([23]ane$S_9$); nonathiacyclotetracosane ([24]ane$S_9$); nonathiacyclopentacosane ([25]ane$S_9$); nonathiacyclohexacosane ([26]ane$S_9$); nonathiacycloheptacosane ([27]ane$S_9$); nonathiacyclooctadecatetradiene ([18]tetradiene$S_9$); nonathiacyclononadecatetradiene ([19]tetradiene$S_9$); nonathiacycloeicosatetradiene ([20]tetradiene$S_9$); nonathiacycloheneicosatetradiene ([21]tetradiene$S_9$); nonathiacyclodocosatetradiene ([22]tetradiene$S_9$); nonathiacyclotricosatetradiene ([23]tetradiene$S_9$); nonathiacyclotetracosatetradiene ([24]tetradiene$S_9$); nonathiacyclopentacosatetradiene ([25]tetradiene$S_9$); nonathiacyclohexacosatetradiene ([26]tetradiene$S_9$); and nonathiacycloheptacosatetradiene ([27]tetradiene$S_9$).

S Valence Stabilizer #13i: Examples of ten-membered macrocyclics, macrobicyclics, and macropolycyclics (including catapinands, cryptands, cyclidenes, and sepulchrates) wherein all binding sites are composed of sulfur (usually thiol or thioether groups) and are not contained in component heterocyclic rings (S—S Tridentates, S—S Tetradentates, or S—S Hexadentates) that meet the requirements for use as "narrow band" valence stabilizers for $Co^{+3}$ include, but are not limited to: decathiacycloeicosane ([20]ane$S_{10}$); decathiacycloheneicosane ([21]ane$S_{10}$); decathiacyclodocosane ([22]ane$S_{10}$); decathiacyclotricosane ([23]ane$S_{10}$); decathiacyclotetracosane ([24]ane$S_{10}$); decathiacyclopentacosane ([25]ane$S_{10}$); decathiacyclohexacosane ([26]ane$S^{10}$); decathiacycloheptacosane ([27]ane$S_{10}$); decathiacyclooctacosane ([28]ane$S_{10}$); decathiacyclononacosane ([29]ane$S_{10}$); decathiacyclotriacontane ([30]ane$S_{10}$); decathiacyclocicosapentadiene ([20]pentadiene$S_{10}$); decathiacycloheneicosapentadiene ([21]pentadiene$S_{10}$); decathiacyclodocosapentadiene ([22]pentadiene$S_{10}$); decathi acyclotricosapentadiene ([23]pentadiene$S_{10}$); decathiacyclotetracosapentadiene ([24]pentadiene$S_{10}$); decathiacyclopentacosapentadiene ([25]pentadiene$S_{10}$); decathiacyclohexacosapentadiene ([26]pentadiene$S_{10}$); decathiacycloheptacosapentadiene ([27]pentadiene$S_{10}$); decathiacyclooctacosapentadiene ([28]pentadiene$S_{10}$); decathiacyclononacosapentadiene ([29]pentadiene$S_{10}$); and decathiacyclotriacontapentadiene ([30]pentadiene$S_{10}$).

S Valence Stabilizer #14a: Examples of four-membered macrocyclics, macrobicyclics, and macropolycyclics (including catapinands, cryptands, cyclidenes, and sepulchrates) wherein all four binding sites are composed of sulfur and are contained in component 5-membered heterocyclic rings (S—S Tetradentates) that meet the requirements for use as "narrow band" valence stabilizers for $Co^{+3}$ include, but are not limited to: tetrathiophenes; tetrathiazoles; tetrathiaphospholes; tetraoxathioles; tetrathiadiazoles; tetrathiatriazoles; and tetradithioles.

S Valence Stabilizer #14b: Examples of five-membered macrocyclics, macrobicyclics, and macropolycyclics (including catapinands, cryptands, cyclidenes, and sepulchrates) wherein all five binding sites are composed of sulfur and are contained in component 5-membered heterocyclic rings (S—S Tridentates or S—S Tetradentates) that meet the requirements for use as "narrow band" valence stabilizers for $Co^{+3}$ include, but are not limited to: pentathiophenes; pentathiazoles; pentathiaphospholes; pentaoxathioles; pentathiadiazoles; pentathiatriazoles; and pentadithioles.

S Valence Stabilizer #14c: Examples of six-membered macrocyclics, macrobicyclics, and macropolycyclics (including catapinands, cryptands, cyclidenes, and sepulchrates) wherein all six binding sites are composed of sulfur and are contained in component 5-membered heterocyclic rings (S—S Tridentates, S—S Tetradentates, or S—S Hexadentates) that meet the requirements for use as "narrow band" valence stabilizers for $Co^{+3}$ include, but are not limited to: hexathiophenes; hexathiazoles; hexathiaphospholes; hexaoxathioles; hexathiadiazoles; hexathiatriazoles; and hexadithioles.

S Valence Stabilizer #14d: Examples of seven-membered macrocyclics, macrobicyclics, and macropolycyclics (including catapinands, cryptands, cyclidenes, and sepulchrates) wherein all seven binding sites are composed of sulfur and are contained in component 5-membered heterocyclic rings (S—S Tridentates, S—S Tetradentates, or S—S Hexadentates) that meet the requirements for use as "narrow band" valence stabilizers for $Co^{+3}$ include, but are not limited to: heptathiophenes; heptathiazoles; heptathiaphospholes; heptaoxathioles; heptathiadiazoles; heptathiatriazoles; and heptadithioles.

S Valence Stabilizer #14e: Examples of eight-membered macrocyclics, macrobicyclics, and macropolycyclics(including catapinands, cryptands, cyclidenes, and sepulchrates) wherein all eight binding sites are composed of sulfur and are contained in component 5-membered heterocyclic rings (S—S Tridentates, S—S Tetradentates, or S—S Hexadentates) that meet the requirements for use as "narrow band" valence stabilizers for $Co^{+3}$ include, but are not limited to: octathiophenes; octathiazoles; octathiaphospholes; octaoxathioles; octathiadiazoles; octathiatriazoles; and octadithioles.

S Valence Stabilizer #14f: Examples of nine-membered macrocyclics, macrobicyclics, and macropolycyclics (including catapinands, cryptands, cyclidenes, and sepulchrates) wherein all nine binding sites are composed of sulfur and are contained in component 5-membered heterocyclic rings (S—S Tridentates, S—S Tetradentates, or S—S Hexadentates) that meet the requirements for use as "narrow band" valence stabilizers for $Co^{+3}$ include, but are not limited to: nonathiophenes; nonathiazoles; nonathiaphospholes; nonaoxathioles; nonathiadiazoles; nonathiatriazoles; and nonadithioles.

S Valence Stabilizer #14g: Examples of ten-membered macrocyclics, macrobicyclics, and macropolycyclics (including catapinands, cryptands, cyclidenes, and sepulchrates) wherein all ten binding sites are composed of sulfur and are contained in component 5-membered heterocyclic rings (S—S Tridentates, S—S Tetradentates, or S—S Hexadentates) that meet the requirements for use as "narrow band" valence stabilizers for $Co^{+3}$ include, but are not limited to: decathiophenes; decathiazoles; decathiaphospholes; decaoxathioles; decathiadiazoles; decathiatriazoles; and decadithioles.

S Valence Stabilizer #15a: Examples of four-membered macrocyclics, macrobicyclics, and macropolycyclics (including catapinands, cryptands, cyclidenes, and sepulchrates) wherein all four binding sites are composed of sulfur and are contained in a combination of 5-membered heterocyclic rings and thiol, thioether, or thioketo groups (S—S Tetradentates) that meet the requirements for use as "narrow band" valence stabilizers for $Co^{+3}$ include, but are not limited to: dithiatetrathiophenes; tetrathiatetrathiophenes; dithiatetradithioles; and tetrathiatetradithioles.

S Valence Stabilizer #15b: Examples of five-membered macrocyclics, macrobicyclics, and macropolycyclics (including catapinands, cryptands, cyclidenes, and sepulchrates) wherein all five binding sites are composed of sulfur and are contained in a combination of 5-membered heterocyclic rings and thiol, thioether, or thioketo groups (S—S Tridentates or S—S Tetradentates) that meet the requirements for use as "narrow band" valence stabilizers for $Co^{+3}$ include, but are not limited to: dithiapentathiophenes; tetrathiapentathiophenes; dithiapentadithioles; and tetrathiapentadithioles.

S Valence Stabilizer #15c: Examples of six-membered macrocyclics, macrobicyclics, and macropolycyclics (including catapinands, cryptands, cyclidenes, and sepulchrates) wherein all six binding sites are composed of sulfur and are contained in a combination of 5-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiahexaathiophenes; trithiahexathiophenes; dithiahexadithioles; and trithiahexadithioles.

S Valence Stabilizer #15d: Examples of seven-membered macrocyclics, macrobicyclics, and macropolycyclics (including catapinands, cryptands, cyclidenes, and sepulchrates) wherein all seven binding sites are composed of sulfur and are contained in a combination of 5-membered heterocyclic rings and thiol, thioether, or thioketo groups (S—S Tridentates, S—S Tetradentates, or S—S Hexadentates) that meet the requirements for use as "wide band" valence stabilizers for $Co^{+3}$ include, but are not limited to: dithiaheptathiophenes; tetrathiaheptathiophenes; dithiaheptadithioles; and tetrathiaheptadithioles.

S Valence Stabilizer #15e: Examples of eight-membered macrocyclics, macrobicyclics, and macropolycyclics (including catapinands, cryptands, cyclidenes, and sepulchrates) wherein all eight binding sites are composed of sulfur and are contained in a combination of 5-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiaoctathiophenes; tetrathiaoctathiophenes; dithiaoctadithioles; and tetrathiaoctadithioles.

S Valence Stabilizer #15f: Examples of nine-membered macrocyclics, macrobicyclics, and macropolycyclics (including catapinands, cryptands, cyclidenes, and sepulchrates) wherein all nine binding sites are composed of sulfur and are contained in a combination of 5-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: trithianonathiophenes; hexathianonathiophenes; trithianonadithioles; and hexathianonadithioles.

S Valence Stabilizer #15g: Examples of ten-membered macrocyclics, macrobicyclics, and macropolycyclics (including catapinands, cryptands, cyclidenes, and sepulchrates) wherein all ten binding sites are composed of sulfur and are contained in a combination of 5-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiadecathiophenes; pentathiadecathiophenes; dithiadecadithioles; and pentathiadecadithioles.

S Valence Stabilizer #16a: Examples of four-membered macrocyclics, macrobicyclics, and macropolycyclics (including catapinands, cryptands, cyclidenes, and sepulchrates) wherein all four binding sites are composed of sulfur and are contained in component 6-membered heterocyclic rings (S—S Tetradentates) that meet the requirements for use as "narrow band" valence stabilizers for $Co^{+3}$ include, but are not limited to: tetrathiopyrans; tetrathiazines; tetrathiaphosphorins; tetrathiadiphosphorins; tetraoxathiins; and tetradithiins.

S Valence Stabilizer #16b: Examples of five-membered macrocyclics, macrobicyclics, and macropolycyclics (including catapinands, cryptands, cyclidenes, and sepulchrates) wherein all five binding sites are composed of sulfur and are contained in component 6-membered heterocyclic rings (S—S Tridentates or S—S Tetradentates) that meet the requirements for use as "narrow band" valence stabilizers for $Co^{+3}$ include, but are not limited to: pentathiopyrans; pentathiazines; pentathiaphosphorins; pentathiadiphosphorins; pentaoxathiins; and pentadithiins.

S Valence Stabilizer #16c: Examples of six-membered macrocyclics, macrobicyclics, and macropolycyclics (including catapinands, cryptands, cyclidenes, and sepulchrates) wherein all six binding sites are composed of sulfur and are contained in component 6-membered heterocyclic rings (S—S Tridentates, S—S Tetradentates, or S—S Hexadentates) that meet the requirements for use as "narrow band" valence stabilizers for $Co^{+3}$ include, but are not limited to:

hexathiopyrans; hexathiazines; hexathiaphosphorins; hexathiadiphosphorins; hexaoxathiins; and hexadithiins.

S Valence Stabilizer #16d: Examples of seven-membered macrocyclics, macrobicyclics, and macropolycyclics (including catapinands, cryptands, cyclidenes, and sepulchrates) wherein all seven binding sites are composed of sulfur and are contained in component 6-membered heterocyclic rings (S—S Tridentates, S—S Tetradentates, or S—S Hexadentates) that meet the requirements for use as "narrow band" valence stabilizers for $Co^{+3}$ include, but are not limited to: heptathiopyrans; heptathiazines; heptathiaphosphorins; heptathiadiphosphorins; heptaoxathiins; and heptadithiins.

S Valence Stabilizer #16e: Examples of eight-membered macrocyclics, macrobicyclics, and macropolycyclics (including catapinands, cryptands, cyclidenes, and sepulchrates) wherein all eight binding sites are composed of sulfur and are contained in component 6-membered heterocyclic rings (S—S Tridentates, S—S Tetradentates, or S—S Hexadentates) that meet the requirements for use as "narrow band" valence stabilizers for $Co^{+3}$ include, but are not limited to: octathiopyrans; octathiazines; octathiaphosphorins; octathiadiphosphorins; octaoxathiins; and octadithiins.

S Valence Stabilizer #16f: Examples of nine-membered macrocyclics, macrobicyclics, and macropolycyclics (including catapinands, cryptands, cyclidenes, and sepulchrates) wherein all nine binding sites are composed of sulfur and are contained in component 6-membered heterocyclic rings (S—S Tridentates, S—S Tetradentates, or S—S Hexadentates) that meet the requirements for use as "narrow band" valence stabilizers for $Co^{+3}$ include, but are not limited to: nonathiopyrans; nonathiazines; nonathiaphosphorins; nonathiadiphosphorins; nonaoxathiins; and nonadithiins.

S Valence Stabilizer #16g: Examples of ten-membered macrocyclics, macrobicyclics, and macropolycyclics (including catapinands, cryptands, cyclidenes, and sepulchrates) wherein all ten binding sites are composed of sulfur and are contained in component 6-membered heterocyclic rings (S—S Tridentates, S—S Tetradentates, or S—S Hexadentates) that meet the requirements for use as "narrow band" valence stabilizers for $Co^{+3}$ include, but are not limited to: decathiopyrans; decathiazines; decathiaphosphorins; decathiadiphosphorins; decaoxathiins; and decadithiins.

S Valence Stabilizer #17a: Examples of four-membered macrocyclics, macrobicyclics, and macropolycyclics (including catapinands, cryptands, cyclidenes, and sepulchrates) wherein all four binding sites are composed of sulfur and are contained in a combination of 6-membered heterocyclic rings and thiol, thioether, or thioketo groups (S—S Tetradentates) that meet the requirements for use as "narrow band" valence stabilizers for $Co^{+3}$ include, but are not limited to: dithiatetrathiopyrans; tetrathiatetrathiopyrans; dithiatetrathiazines; tetrathiatetrathiazines; dithiatetrathiaphosphorins; tetrathiatetrathiaphosphorins; dithiatetraoxathiins; tetrathiatetraoxathiins; dithiatetradithiins; and tetrathiatetradithiins.

S Valence Stabilizer #17b: Examples of five-membered macrocyclics, macrobicyclics, and macropolycyclics (including catapinands, cryptands, cyclidenes, and sepulchrates) wherein all five binding sites are composed of sulfur and are contained in a combination of 6-membered heterocyclic rings and thiol, thioether, or thioketo groups (S—S Tridentates or S—S Tetradentates) that meet the requirements for use as "narrow band" valence stabilizers for $Co^{+3}$ include, but are not limited to: dithiapentathiopyrans; tetrathiapentathiopyrans; dithiapentathiazines; tetrathiapentathiazines; dithiapentathiaphosphorins; tetrathiapentathiaphosphorins; dithiapentaoxathiins; tetrathiapentaoxathiins; dithiapentadithiins; and tetrathiapentadithiins.

S Valence Stabilizer #17c: Examples of six-membered macrocyclics, macrobicyclics, and macropolycyclics (including catapinands, cryptands, cyclidenes, and sepulchrates) wherein all six binding sites are composed of sulfur and are contained in a combination of 6-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiahexathiopyrans; trithiahexathiopyrans; dithiahexathiazines; trithiahexathiazines; dithiahexathiaphosphorins; trithiahexathiaphosphorins; dithiahexaoxathiins; trithiahexaoxathiins; dithiahexadithiins; and trithiahexadithiins.

S Valence Stabilizer #17d: Examples of seven-membered macrocyclics, macrobicyclics, and macropolycyclics (including catapinands, cryptands, cyclidenes, and sepulchrates) wherein all seven binding sites are composed of sulfur and are contained in a combination of 6-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiaheptathiopyrans; tetrathiaheptathiopyrans; dithiaheptathiazines; tetrathiaheptathiazines; dithiaheptathiaphosphorins; tetrathiaheptathiaphosphorins; dithiaheptaoxathiins; tetrathiaheptaoxathiins; dithiaheptadithiins; and tetrathiaheptadithiins.

S Valence Stabilizer #17e: Examples of eight-membered macrocyclics, macrobicyclics, and macropolycyclics (including catapinands, cryptands, cyclidenes, and sepulchrates) wherein all eight binding sites are composed of sulfur and are contained in a combination of 6-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiaoctathiopyrans; tetrathiaoctathiopyrans; dithiaoctathiazines; tetrathiaoctathiazines; dithiaoctathiaphosphorins; tetrathiaoctathiaphosphorins; dithiaoctaoxathiins; tetrathiaoctaoxathiins; dithiaoctadithiins; and tetrathiaoctadithiins.

S Valence Stabilizer #17f: Examples of nine-membered macrocyclics, macrobicyclics, and macropolycyclics (including catapinands, cryptands, cyclidenes, and sepulchrates) wherein all nine binding sites are composed of sulfur and are contained in a combination of 6-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: trithianonathiopyrans; hexathianonathiopyrans; trithianonathiazines; hexathianonathiazines; trithianonathiaphosphorins; hexathianonathiaphosphorins; trithianonaoxathiins; hexathianonaoxathiins; trithianonadithiins; and hexathianonadithiins.

S Valence Stabilizer #17g: Examples of ten-membered macrocyclics, macrobicyclics, and macropolycyclics (including catapinands, cryptands, cyclidenes, and sepulchrates) wherein all ten binding sites are composed of sulfur and are contained in a combination of 6-membered heterocyclic rings and thiol, thioether, or thioketo groups (S—S Tridentates, S—S Tetradentates, or S—S Hexadentates) that meet the requirements for use as "narrow band" valence stabilizers for $Co^{+3}$ include, but are not limited to: dithiadecathiopyrans; pentathiadecathiopyrans; dithiadecathiazines; pentathiadecathiazines; dithiadecathiaphosphorins; pentathiadecathiaphosphorins; dithiadecaoxathiins; pentathiadecaoxathiins; dithiadecadithiins; and pentathiadecadithiins.

S Valence Stabilizer #18: Examples of dithiobiurets (dithioimidodicarbonic diamides), dithioisobiurets, dithiobiureas, trithiotriurets, trithiotriureas, bis(dithiobiurets), bis(dithioisobiurets), bis(dithiobiureas), poly(dithiobiurets), poly (dithioisobiurets), and poly(dithiobiureas) (S—S Bidentates, S—S Tridentates, S—S Tetradentates) that meet the requirements for use as "narrow band" valence stabilizers for $Co^{+3}$ include, but are not limited to: dithiobiuret, dithioisobiuret, dithiobiurea, trithiotriuret, trithiotriurea, nitrodithiobiuret, dinitrodithiobiuret, aminodithiobiuret, diaminodithiobiuret, oxydithiobiuret, dioxydithiobiuret, cyanodithiobiuret, methyldithiobiuret, ethyldithiobiuret, isopropyldithiobiuret, phenyldithiobiuret, benzyldithiobiuret, cyclohexyldithiobiuret, norbornyldithiobiuret, adamantyldithiobiuret, dimethyldithiobiuret, diethyldithiobiuret, diisopropyldithiobiuret, diphenyldithiobiuret, dibenzyldithiobiuret, dicyclohexyldithiobiuret, dinorbornyldithiobiuret, and diadamantyldithiobiuret.

S Valence Stabilizer #19: Examples ofthioacylthioureas, thioaroylthioureas, bis(thioacylthioureas), bis(thioaroylthioureas), poly(thioacylthioureas), and poly(thioaroylthioureas) (S—S Bidentates, S—S Tridentates, S—S Tetradentates) that meet the requirements for use as "narrow band" valence stabilizers for $Co^{+3}$ include, but are not limited to: thioformylthiourea, thioacetylthiourea, thiobenzoylthiourea, thiocyclohexoylthiourea, pentafluorothiobenzoylthiourea, N-methylthioacetylthiourea, N-phenylthiobenzoylthiourea, and N-cyclohexylthiocyclohexoylthiourea.

S Valence Stabilizer #20: Examples of dithioacyl disulfides, bis(dithioacyl disulfides), and poly(dithioacyl disulfides), (S—S Bidentates, S—S Tridentates, S—S Tetradentates) that meet the requirements for use as "narrow band" valence stabilizers for $Co^{+3}$ include, but are not limited to: dithioacetyl disulfide; dithiopropanoyl disulfide; dithiobenzoyl disulfide; and dithiopentafluorobenzoyl disulfide.

S Valence Stabilizer #21: Examples of tetrathioperoxydicarbonic diamides, bis(tetrathioperoxydicarbonic diamides), and poly(tetrathioperoxydicarbonic diamides) (S—S Bidentates, S—S Tridentates, S—S Tetradentates) that meet the requirements for use as "narrow band" valence stabilizers for $Co^{+3}$ include, but are not limited to: tetrathioperoxydicarbonic diamide; N-phenyltetrathioperoxydicarbonic diamide; N-benzyltetrathioperoxydicarbonic diamide; N-cyclohexyltetrathioperoxydicarbonic diamide; N-norbornyltetrathioperoxydicarbonic diamide; N,N'-diphenyltetrathioperoxydicarbonic diamide; N,N'-dibenzyltetrathioperoxydicarbonic diamide; N,N'-dicyclohexyltetrathioperoxydicarbonic diamide; and N,N'-dinorbornyltetrathioperoxydicarbonic diamide.

S Valence Stabilizer #22: Examples of hexathio-, pentathio-, and tetrathioperoxydicarbonic acids, bis(hexathio-, pentathio-, and tetrathioperoxydicarbonic acids), poly (hexathio-, pentathio-, and tetrathioperoxydicarbonic acids), and derivatives thereof (S—S Bidentates, S—S Tridentates, S—S Tetradentates) that meet the requirements for use as "narrow band" valence stabilizers for $Co^{+3}$ include, but are not limited to: hexathioperoxydicarbonic acid, pentathioperoxydicarbonic acid, tetrathioperoxydicarbonic acid, S-phenylhexathioperoxydicarbonic acid; S-benzylhexathioperoxydicarbonic acid; S-cyclohexylhexathioperoxydicarbonic acid; S-norbornylhexathioperoxydicarbonic acid; S,S'-diphenylhexathioperoxydicarbonic acid; S,S'-dibenzylhexathioperoxydicarbonic acid; S,S'-dicyclohexylhexathioperoxydicarbonic acid; and S,S'-dinorbornylhexathioperoxydicarbonic acid.

S Valence Stabilizer #23: Examples of dithioperoxydiphosphoramides, bis(dithioperoxydiphosphoramides), and poly (dithioperoxydiphosphoramides) (S—S Bidentates, S—S Tridentates, S—S Tetradentates) that meet the requirements for use as "narrow band" valence stabilizers for $Co^{+3}$ include, but are not limited to: dithioperoxydiphosphoramide, N-methyldithioperoxydiphosphoramide, N-isopropyldithioperoxydiphosphoramide, N-tert-butyldithioperoxydiphosphoramide, N-phenyldithioperoxydiphosphoramide, N-pentafluorophenyldithioperoxydiphosphoramide, N-benzyldithioperoxydiphosphoramide, N-cyclohexyldithioperoxydiphosphoramide, N-norbornyldithioperoxydiphosphoramide, N,N'''-dimethyldithioperoxydiphosphoramide, N,N'''-diisopropyldithioperoxydiphosphoramide, N,N'''-di-tert-butyldithioperoxydiphosphoramide, N,N'''-diphenyldithioperoxydiphosphoramide, N,N'''-di-pentafluorophenyldithioperoxydiphosphoramide, N,N'''-dibenzyldithioperoxydiphosphoramide, N,N'''-di cyclohexyldithioperoxydiphosphoramide, and N,N'''-dinorbornyldithioperoxydiphosphoramide.

S Valence Stabilizer #24: Examples of dithioperoxydiphosphoric acids, bis(dithioperoxydiphosphoric acids), poly (dithioperoxydiphosphoric acids), and derivatives thereof (S—S Bidentates, S—S Tridentates, S—S Tetradentates) that meet the requirements for use as "narrow band" valence stabilizers for $Co^{+3}$ include, but are not limited to: dithioperoxydiphosphoric acid, methyldithioperoxydiphosphoric acid, isopropyldithioperoxydiphosphoric acid, tert-butyldithioperoxydiphosphoric acid, phenyldithioperoxydiphosphoric acid, pentafluorophenyldithioperoxydiphosphoric acid, benzyldithioperoxydiphosphoric acid, cyclohexyldithioperoxydiphosphoric acid, norbornyldithioperoxydiphosphoric acid, dimethyldithioperoxydiphosphoric acid, diisopropyldithioperoxydiphosphoric acid, di-tert-butyldithioperoxydiphosphoric acid, diphenyldithioperoxydiphosphoric acid, di-pentafluorophenyldithioperoxydiphosphoric acid, dibenzyldithioperoxydiphosphoric acid, dicyclohexyldithioperoxydiphosphoric acid, and dinorbornyldithioperoxydiphosphoric acid.

S Valence Stabilizer #25: Examples of dithioimidodiphosphonic acids, dithiohydrazidodiphosphonic acids, bis (dithioimidodiphosphonic acids), bis(dithiohydrazidodiphosphonic acids), poly(dithioimidodiphosphonic acids), poly(dithiohydrazidodiphosphonic acids), and derivatives thereof(S—S Bidentates, S—S Tridentates, S—S Tetradentates) that meet the requirements for use as "narrow band" valence stabilizers for $Co^{+3}$ include, but are not limited to: dithioimidodiphosphonic acid, methyldithioimidodiphosphonic acid, isopropyldithioimidodiphosphonic acid, tert-butyldithioimidodiphosphonic acid, phenyldithioimidodiphosphonic acid, pentafluorophenyldithioimidodiphosphonic acid, benzyldithioimidodiphosphonic acid, cyclohexyldithioimidodiphosphonic acid, norbornyldithioimidodiphosphonic acid, dimethyldithioimidodiphosphonic acid, diisopropyldiothioimidodiphosphonic acid, di-tert-butyldithioimidodiphosphonic acid, diphenyldithioimidodiphosphonic acid, di-pentafluorophenyldithioimidodiphosphonic acid, dibenzyldithioimidodiphosphonic acid, dicyclohexyldithioimidodiphosphonic acid, and dinorbornyldithioimidodiphosphonic acid. [Note: The phosphite ($p^{+3}$) valence of the phosphorus atom makes stabilization of high valence metal ions much more difficult, though still possible.]

S Valence Stabilizer #26: Examples of dithioimidodiphosphonamides, dithiohydrazidodiphosphonamides, bis(dithioimidodiphosphonamides), bis(dithiohydrazidodiphosphonamides), poly(dithioimidodiphosphonamides), and poly(dithiohydrazidodiphosphonamides) (S—S Bidentates, S—S Tridentates, S—S Tetradentates) that meet the requirements for use as "narrow band" valence stabilizers for $Co^{+3}$ include, but are not limited to: dithioimidodiphosphonamide, N-methyldithioimidodiphosphonamide, N-isopropyldithioimidodiphosphonamide, N-tert-butyldithioimidodiphosphonamide, N-phenyldithioimidodiphosphonamide, N-pentafluorophenyldithioimidodiphosphonamide, N-benzyldithioimidodiphosphonamide, N-cyclohexyldithioimidodiphosphonamide, N-norbornyldithioimidodiphosphonamide, N,N'''-dimethyldithioimidodiphosphonamide, N,N'''-diisopropyldithioimidodiphosphonamide, N,N'''-di-tert-butyldithioimidodiphosphonamide, N,N'''-diphenyldithioimidodiphosphonamide, N,N'''-di-pentafluorophenyldithioimidodiphosphonamide, N,N'''-dibenzyldithioimidodiphosphonamide, N,N'''-dicyclohexyldithioimidodiphosphonamide, and N,N'''-dinorbornyldithioimidodiphosphonamide. [Note: The phosphite ($P^{+3}$) valence of the phosphorus atom makes stabilization of high valence metal ions much more difficult, though still possible.]

S Valence Stabilizer #27: Examples ofdithiodiphosphonamides, bis(dithiodiphosphonamides), and poly(dithiodiphosphonamides) (S—S Bidentates, S—S Tridentates, S—S Tetradentates) that meet the requirements for use as "narrow band" valence stabilizers for $Co^{+3}$ include, but are not limited to: dithiodiphosphonamide, N-methyldithiodiphosphonamide, N-isopropyldithiodiphosphonamide, N-tert-butyldithiodiphosphonamide, N-phenyldithiodiphosphonamide, N-pentafluorophenyldithiodiphosphonamide, N-benzyldithiodiphosphonamide, N-cyclohexyldithiodiphosphonamide, N-norbornyldithiodiphosphonamide, N,N'''-dimethyldithiodiphosphonamide, N,N'''-diisopropyldithiodiphosphonamide, N,N'''-di-tert-butyldithiodiphosphonamide, N,N'''-diphenyldithiodiphosphonamide, N,N'''-di-pentafluorophenyldithiodiphosphonamide, N,N'''-dibenzyldithiodiphosphonamide, N,N'''-dicyclohexyldithiodiphosphonamide, and N,N'''-dinorbornyldithiodiphosphonamide. [Note: The phosphite ($P^{+3}$) valence of the phosphorus atom makes stabilization of high valence metal ions much more difficult, though still possible.]

S Valence Stabilizer #28: Examples of dithiodiphosphonic acids, bis(dithiodiphosphonic acids), poly(dithiodiphosphonic acids), and derivatives thereof (S—S Bidentates, S—S Tridentates, S—S Tetradentates) that meet the requirements for use as "narrow band" valence stabilizers for $Co^{+3}$ include, but are not limited to: dithiodiphosphonic acid, methyldithiodiphosphonic acid, isopropyldithiodiphosphonic acid, tert-butyldithiodiphosphonic acid, phenyldithiodiphosphonic acid, pentafluorophenyldithiodiphosphonic acid, benzyldithiodiphosphonic acid, cyclohexyldithiodiphosphonic acid, norbornyldithiodiphosphonic acid, dimethyldithiodiphosphonic acid, diisopropyldiothiodiphosphonic acid, di-tert-butyldithiodiphosphonic acid, diphenyldithiodiphosphonic acid, di-pentafluorophenyldithiodiphosphonic acid, dibenzyldithiodiphosphonic acid, dicyclohexyldithiodiphosphonic acid, and dinorbornyldithiodiphosphonic acid. [Note: The phosphite ($P^{+3}$) valence of the phosphorus atom makes stabilization of high valence metal ions much more difficult, though still possible.]

S Valence Stabilizer #29: Examples of dithioperoxydiphosphonamides, bis(dithioperoxydiphosphonamides), and poly(dithioperoxydiphosphonamides) (S—S Bidentates, S—S Tridentates, S—S Tetradentates) that meet the requirements for use as "narrow band" valence stabilizers for $Co^{+3}$ include, but are not limited to: dithioperoxydiphosphonamide, N-methyldithioperoxydiphosphonamide, N-isopropyldithioperoxydiphosphonamide, N-tert-butyldithioperoxydiphosphonamide, N-phenyldithioperoxydiphosphonamide, N-pentafluorophenyldithioperoxydiphosphonamide, N-benzyldithioperoxydiphosphonamide, N-cyclohexyldithioperoxydiphosphonamide, N-norbornyldithioperoxydiphosphonamide, N,N'''-dimethyldithioperoxydiphosphonamide, N,N'''-diisopropyldithioperoxydiphosphonamide, N,N'''-di-tert-butyldithioperoxydiphosphonamide, N,N'''-diphenyldithioperoxydiphosphonamide, N,N'''-di-pentafluorophenyldithioperoxydiphosphonamide, N,N'''-dibenzyldithioperoxydiphosphonamide, N,N'''-dicyclohexyldithioperoxydiphosphonamide, and N,N'''-dinorbornyldithioperoxydiphosphonamide. [Note: The phosphite ($P^{+3}$) valence of the phosphorus atom makes stabilization of high valence metal ions much more difficult, though still possible.]

S Valence Stabilizer #30: Examples of dithioperoxydiphosphonic acids, bis(dithioperoxydiphosphonic acids), poly(dithioperoxydiphosphonic acids), and derivatives thereof (S—S Bidentates, S—S Tridentates, S—S Tetradentates) that meet the requirements for use as "narrow band" valence stabilizers for $Co^{+3}$ include, but are not limited to: dithioperoxydiphosphonic acid, methyldithioperoxydiphosphonic acid, isopropyldithioperoxydiphosphonic acid, tert-butyldithioperoxydiphosphonic acid, phenyldithioperoxydiphosphonic acid, pentafluorophenyldithioperoxydiphosphonic acid, benzyldithioperoxydiphosphonic acid, cyclohexyldithioperoxydiphosphonic acid, norbornyldithioperoxydiphosphonic acid, dimethyldithioperoxydiphosphonic acid, diisopropyldithioperoxydiphosphonic acid, di-tert-butyldithioperoxydiphosphonic acid, diphenyldithioperoxydiphosphonic acid, di-pentafluorophenyldithioperoxydiphosphonic acid, dibenzyldithioperoxydiphosphonic acid, dicyclohexyldithioperoxydiphosphonic acid, and dinorbornyldithioperoxydiphosphonic acid. [Note: The phosphite ($P^{+3}$) valence of the phosphorus atom makes stabilization of high valence metal ions much more difficult, though still possible.]

S Valence Stabilizer #31: Examples of dithiophosphonic acids (phosphonodithioic acids), bis(dithiophosphonic acids), poly(dithiophosphonic acids), and derivatives thereof (S—S Bidentates, S—S Tridentates, S—S Tetradentates) that meet the requirements for use as "narrow band" valence stabilizers for $Co^{+3}$ include, but are not limited to: dithiophosphonic acid, O-phenyldithiophosphonic acid, O-benzyldithiophosphonic acid, O-cyclohexyldithiophosphonic acid, O-norbornyldithiophosphonic acid, O,P-diphenyldithiophosphonic acid, O,P-dibenzyldithiophosphonic acid, O,P-dicyclohexyldithiophosphonic acid, and O,P-dinorbornyldithiophosphonic acid. [Note: The phosphite ($P^{+3}$) valence of the phosphorus atom makes stabilization of high valence metal ions much more difficult, though still possible.]

S Valence Stabilizer #32: Examples of trithiophosphonic acids (phosphonotrithioic acids), bis(trithiophosphonic acids), poly(trithiophosphonic acids), and derivatives thereof(S—S Bidentates, S—S Tridentates, S—S Tetradentates) that meet the requirements for use as "narrow band" valence stabilizers for $Co^{+3}$ include, but are not limited to: trithiophosphonic acid, S-phenyltrithiophosphonic acid, S-benzyltrithiophosphonic acid, S-cyclohexyltrithiophosphonic acid, S-norbornyltrithiophosphonic acid, S,P-diphenyltrithiophosphonic acid, S,P-dibenzyltrithiophosphonic acid, S,P-dicyclohexyltrithiophosphonic acid, and S,P-dinorbornyltrithiophosphonic acid. [Note: The phosphite ($P^{+3}$) valence of the phosphorus atom makes stabilization of high valence metal ions much more difficult, though still possible.]

S Valence Stabilizer #33: Examples of phosphono(dithioperoxo)thioic acids, bis[phosphono(dithioperoxo)thioic acids], poly[phosphono(dithioperoxo)thioic acids], and derivatives thereof (S—S Bidentates, S—S Tridentates, S—S Tetradentates) that meet the requirements for use as "narrow band" valence stabilizers for $Co^{+3}$ include, but are not limited to: phosphono(dithioperoxo)thioic acid, O-phenylphosphono(dithioperoxo)thioic acid, O-benzylphosphono(dithioperoxo)thioic acid, O-cyclohexylphosphono(dithioperoxo)thioic acid, O-norbornylphosphono(dithioperoxo)thioic acid, O,P-diphenylphosphono(dithioperoxo)thioic acid, O,P-dibenzylphosphono(dithioperoxo)thioic acid, O,P-dicyclohexylphosphono(dithioperoxo)thioic acid, and O,P-dinorbornylphosphono(dithioperoxo)thioic acid. [Note: The phosphite ($P^{+3}$) valence of the phosphorus atom makes stabilization of high valence metal ions much more difficult, though still possible.]

S Valence Stabilizer #34: Examples of phosphono(dithioperoxo)dithioic acids, bis[phosphono(dithioperoxo)dithioic acids], poly[phosphono(dithioperoxo)dithioic acids], and derivatives thereof(S—S Bidentates, S—S Tridentates, S—S Tetradentates) that meet the requirements for use as "narrow band" valence stabilizers for $Co^{+3}$ include, but are not limited to: phosphono(dithioperoxo)dithioic acid, S-phenylphosphono(dithioperoxo)dithioic acid, S-benzylphosphono(dithioperoxo)dithioic acid, S-cyclohexylphosphono(dithioperoxo)dithioic acid, S-norbornylphosphono(dithioperoxo)dithioic acid, S,P-diphenylphosphono(dithioperoxo)dithioic acid, S,P-dibenzylphosphono(dithioperoxo)dithioic acid, S,P-dicyclohexylphosphono(dithioperoxo)dithioic acid, and S,P-dinorbornylphosphono(dithioperoxo)dithioic acid. [Note: The phosphite ($P^{+3}$) valence of the phosphorus atom makes stabilization of high valence metal ions much more difficult, though still possible.]

S Valence Stabilizer #35: Examples of S-(alkylthio)thiocarboxylic acids, S-(arylthio)thiocarboxylic acids, and S,S-thiobisthiocarboxylic Acids (S—S Bidentates and S—S Tridentates) that meet the requirements for use as "narrow band" valence stabilizers for $Co^{+3}$ include, but are not limited to: (methylthio)thioacetic acid; (methylthio)thiobenzoic acid; (methylthio)thionicotinic acid; (methylthio)thionapthoic acid; (phenylthio)thioacetic acid; (phenylthio)thiobenzoic acid; (phenylthio)thionaphthoic acid; (norbornylthio)thioacetic acid; (norbornylthio)thiobenzoic acid; (norbornylthio)thionapthoic acid; thiobisthioacetic acid; thiobisthiobenzoic acid; and thiobisthionapthoic acid.

S Valence Stabilizer #36: Examples of S-(alkyldisulfido) thiocarboxylic acids, S-(aryldisulfido)thiocarboxylic acids, and S,S'-disulfidobisthiocarboxylic acids (S—S Bidentates and S—S Tridentates) that meet the requirements for use as "narrow band" valence stabilizers for $Co^{+3}$ include, but are not limited to: (methyldisulfido)thioacetic acid; (methyldisulfido)thiobenzoic acid; (methyldisulfido)thionicotinic acid; (methyldisulfido)thionapthoic acid; (phenyldisulfido)thioacetic acid; (phenyldisulfido)thiobenzoic acid; (phenyldisulfido)thionaphthoic acid; (norbornyldisulfido)thioacetic acid; (norbornyldisulfido)thiobenzoic acid; (norbornyldisulfido)thionapthoic acid; S,S'-disulfidobisthioacetic acid; S,S'-disulfidobisthiobenzoic acid; and S,S'-disulfidobisthionapthoic acid.

S Valence Stabilizer #37: Examples of 1,2-dithiolates, bis (1,2-dithiolates), and poly(1,2-dithiolates) (S—S Bidentates, S—S Tridentates, S—S Tetradentates) that meet the requirements for use as "narrow band" valence stabilizers for $Co^{+3}$ include, but are not limited to: 2,3-butanedithiol; 1,2-diphenyl-1,2-ethanedithiol; 1,2-di(pentafluorophenyl)-1,2-ethanedithio; 1,2-dicyclohexyl-1,2-ethanedithiol; 1,2-dinorbornyl-1,2-ethanedithiol; 2,3-dimercaptopropanol; 2,3-dimercaptosuccinic acid; poly[bis(arylthio)acetylene]s; and poly[bis(alkylylthio)acetylene]s.

S Valence Stabilizer #38: Examples of rhodanines and bis(rhodanines) (S—S Bidentates and S—S Tetradentates) that meet the requirements for use as "narrow band" valence stabilizers for $Co^{+3}$ include, but are not limited to: 3-methylrhodanine; 3-ethylrhodanine; 3-isopropylrhodanine; 3-phenylrhodanine; 3-benzylrhodanine; 3-cyclohexylrhodanine; 3-norbornylrhodanine; 5-methylrhodanine; 5-ethylrhodanine; 5-isopropylrhodanine; 5-phenylrhodanine; 5-benzylrhodanine; 5-cyclohexylrhodanine; 5-norbornylrhodanine; 3,3'-ethylenebisrhodanine; 3,3'-propylenerhodanine; 3,3'-butylenerhodanine; 5,5'-ethylenebisrhodanine; 5,5'-propylenerhodanine; and 5,5'-butylenerhodanine. [Note: rhodanines and bis(rhodanines) tend to stabilize lower oxidation states in metal ions.]

S Valence Stabilizer #39: Examples of dithiocarbimates, bis(dithiocarbimates), and poly(dithiocarbimates) (S—S Bidentates, S—S Tridentates, and S—S Tetradentates) that meet the requirements for use as "narrow band" valence stabilizers for $Co^{+3}$ include, but are not limited to: methyldithiocarbimate; trifluoromethyldithiocarbimate; ethyldithiocarbimate; propyldithiocarbimate; isopropyldithiocarbimate; butyldithiocarbimate; tertbutyldithiocarbimate; cyanodithiocarbimate (CDC); cyanamidodithiocarbimate; azidodithiocarbimate; phenyldithiocarbimate; pentafluorophenyldithiocarbimate; benzyldithiocarbimate; naphthyldithiocarbimate; cyclohexyldithiocarbimate; norbornyldithiocarbimate; and adamantyldithiocarbimate. [Note: Carbimates tend to stabilize lower oxidation states in metal ions.]

S Valence Stabilizer #40: Examples of thioxanthates, bis (thioxanthates), and poly(thioxanthates) (S—S Bidentates and S—S Tetradentates) that meet the requirements for use as "narrow band" valence stabilizers for $Co^{+3}$ include, but are not limited to: methyl thioxanthate (MeSxan); ethyl thioxanthate (EtSxan); isopropyl thioxanthate (iPrSxan); trifluoromethyl thioxanthate ($CF_3$Sxan); cyanothioxanthate;

cyanamidothioxanthate; phenyl thioxanthate (PhSxan); benzyl thioxanthate (BzSxan); pentafluorophenyl thioxanthate; cyclohexyl thioxanthate (cHxSxan); and norbornyl thioxanthate. [Note: Thioxanthates tend to stabilize lower oxidation states in metal ions.]

S Valence Stabilizer #41: Examples of xanthates, bis(xanthates), and poly(xanthates) (S—S Bidentates and S—S Tetradentates) that meet the requirements for use as "narrow band" valence stabilizers for $Co^{+3}$ include, but are not limited to: methyl xanthate (Mexan); ethyl xanthate (Etxan); isopropyl xanthate (iPrxan); trifluoromethyl xanthate ($CF_3$xan); cyanoxanthate; cyanamidoxanthate; phenyl xanthate (Phxan); benzyl xanthate (Bzxan); pentafluorophenyl xanthate; cyclohexyl xanthate (cHxxan); and norbornyl xanthate. [Note: Xanthates tend to stabilize lower oxidation states in metal ions.]

S Valence Stabilizer #42: Examples of phosphinodithioformates (S—S Bidentates) that meet the requirements for use as "narrow band" valence stabilizers for $Co^{+3}$ include, but are not limited to: trimethylphosphinodithioformate; triethylphosphinodithioformate; triphenylphosphinodithioformate; tricyclohexylphosphinodithioformate; dimethylphosphinodithioformate; diethylphosphinodithioformate; diphenylphosphinodithioformate; and dicyclohexylphosphinodithioformate.

S Valence Stabilizer #43: Examples of alkyl- and aryldithioborates, trithioborates, perthioborates, bis(dithioborates), bis(trithioborates), and bis(perthioborates) (S—S Bidentates and S—S Tetradentates) that meet the requirements for use as "narrow band" valence stabilizers for $Co^{+3}$ include, but are not limited to: S,O-diethyl dithioborate; S,O-diisopropyl dithioborate; S,O-diphenyl dithioborate; S,O-dibenzyl dithioborate; S,O-dicyclohexyl dithioborate; S,O-dinorbornyl dithioborate; diethyl trithioborate; diisopropyl trithioborate; diphenyl trithioborate; dibenzyl trithioborate; dicyclohexyl trithioborate; and dinorbornyl trithioborate.

S Valence Stabilizer #44: Examples of alkyl- and aryldithioboronates and bis(dithioboronates) (S—S Bidentates and S—S Tetradentates) that meet the requirements for use as "narrow band" valence stabilizers for $Co^{+3}$ include, but are not limited to: diethyl dithioboronate; diisopropyl dithioboronate; diphenyl dithioboronate; dibenzyl dithioboronate; dicyclohexyl dithioboronate; and dinorbornyl dithioboronate. [Note: boronates tend to stabilize lower oxidation states in metal ions.]

S Valence Stabilizer #45: Examples of trithioarsonic acids (arsonotrithioic acids), dithioarsonic acids (arsonodithioic acids), tetrathioarsonic acids (arsonotetrathioic acids), and derivatives thereof (S—S Bidentates, S—S Tridentates, S—S Tetradentates) that meet the requirements for use as "narrow band" valence stabilizers for $Co^{+3}$ include, but are not limited to: trithioarsonic acid, O-phenyltrithioarsonic acid, O-benzyltrithioarsonic acid, O-cyclohexyltrithioarsonic acid, O-norbornyltrithioarsonic acid, O,S-diphenyltrithioarsonic acid, O,S-dibenzyltrithioarsonic acid, O,S-dicyclohexyltrithioarsonic acid, O,S-dinorbornyltrithioarsonic acid; dithioarsonic acid, O-phenyldithioarsonic acid, O-benzyldithioarsonic acid, O-cyclohexyldithioarsonic acid, O-norbornyldithioarsonic acid, O,O-diphenyldithioarsonic acid, O,O-dibenzyldithioarsonic acid, O,O-dicyclohexyldithioarsonic acid, and O,O-dinorbornyldithioarsonic acid.

S Valence Stabilizer #46: Examples of trithioantimonic acids (stibonotrithioic acids), dithioantimonic acids (stibonodithioic acids), tetrathioantimonic acids (stibonotetrathioic acids), and derivatives thereof (S—S Bidentates, S—S Tridentates, S—S Tetradentates) that meet the requirements for use as "narrow band" valence stabilizers for $Co^{+3}$ include, but are not limited to: trimethyltrithioantimonate; triethyltrithioantimonate; and triphenyltrithioantimonate.

S Valence Stabilizer #47: Examples of phosphine P-sulfides and amino-substituted phosphine sulfides (S Monodentates) that meet the requirements for use as "narrow band" valence stabilizers for $Co^{+3}$ include, but are not limited to: trimethylphosphine sulfide (TMPS); triethylphosphine sulfide (TEPS); triphenylphosphine sulfide (TPhPS); tribenzylphosphine sulfide (TBzPS); tricyclohexylphosphine sulfide (TcHxPS); and trinorbornylphosphine sulfide for phosphine P-sulfides; and tris(dimethylamino)phosphine sulfide; trimorpholinophosphine sulfide; tripiperidinophosphine sulfide; tripyrrolidinophosphine sulfide; and tri(cyclohexylamino)phosphine sulfide for amino-substituted phosphine sulfides.

S Valence Stabilizer #48: Examples of arsine As-sulfides and amino-substituted arsine sulfides (S Monodentates) that meet the requirements for use as "narrow band" valence stabilizers for $Co^{+3}$ include, but are not limited to: trimethylarsine sulfide; triethylarsine sulfide; triphenylarsine sulfide; tribenzylarsine sulfide; tricyclohexylarsine sulfide; and trinorbornylarsine sulfide for arsine As-sulfides; and tris (dimethylamino)arsine sulfide; trimorpholinoarsine sulfide; tripiperidinoarsine sulfide; tripyrrolidinoarsine sulfide; and tri(cyclohexylamino)arsine sulfide for amino-substituted arsine sulfides.

S Valence Stabilizer #49: Examples of thiocyanate ligands (S monodentates) that meet the requirements for use as "narrow band" valence stabilizers for $Co^{+3}$ include, but are not limited to: selenocyanate (—SCN).

S Valence Stabilizer #50: Examples of thiolates that meet the requirements for use as "narrow band" valence stabilizers for $Co^{+3}$ include, but are not limited to: thiophenol; naphthalenethiol; 1-dodecanethion; hexadecyl mercaptan; benzenethiol (bt); polybenzenethiols; and polythioarylenes.

S Valence Stabilizer #51: Examples of sulfide that meet the requirements for use as "narrow band" valence stabilizers for $Co^{+3}$ include, but are not limited to: sulfides ($—S^{2-}$); disulfides ($—S_2^{2-}$); and polysulfides ($—S_x^{2-}$).

P Valence Stabilizer #1: Examples of monophosphines (P monodentates) that meet the requirements for use as "narrow band" valence stabilizers for $Co^{+3}$ include, but are not limited to: phosphine, phenylphosphine, diphenylphosphine, triphenylphosphine, tricyclohexylphosphine, phenyldimethylphosphine, phenyldiethylphosphine, methyldiphenylphosphine, ethyldiphenylphosphine, phosphirane, phosphetane, phospholane, phosphorinane, benzophospholane, benzophosphorinane, dibenzophospholane, dibenzophosphorinane, naphthophospholane, naphthophosphorinane, phosphinonorbornane, and phosphinoadamantane.

P Valence Stabilizer #2: Examples of diphosphines (P monodentates or P—P bidentates) that meet the requirements for use as "narrow band" valence stabilizers for $Co^{+3}$ include, but are not limited to: diphospholane, benzodiphospholane, naphthodiphospholane, diphosphorinane, benzodiphosphorinane, dibenzodiphosphorinane, naphthodiphosphorinane, bis(diphenylphosphino)methane, bis(diphenylphosphino)ethane, bis(diphenylphosphino)propane, bis(diphenylphosphino)butane, bis(diphenylphosphino)pentane, 1,2-bis(diphenylphosphino)ethylene, and o-phenylenebis(diphenylphosphine). (Note: the aryl derivatives are air-stable, whereas the alkyl derivatives are air-sensitive and therefore unsuitable for these applications.)

P Valence Stabilizer #3: Examples of triphosphines (P monodentates, P—P bidentates, or P—P tridentates) that meet the requirements for use as "narrow band" valence stabilizers for $Co^{+3}$ include, but are not limited to: triphosphorinane, P,P'-tetraphenyl-2-methyl-2-(P-diphenyl)phosphinomethyl-1,3-propanediphosphine; P,P-[2-(P-diphenyl)phosphinoethyl]diethyl-P-phenylphosphine; P,P-[2-(P-diphenyl)phosphino]diphenyl-P-phenylphosphine; and hexahydro-2,4,6-trimethyl-1,3,5-triphosphazine. (Note: the aryl derivatives are air-stable, whereas the alkyl derivatives are air-sensitive and therefore unsuitable for these applications.)

P Valence Stabilizer #4: Examples of tetraphosphines (P monodentates, P—P bidentates, P—P tridentates, and P—P tetradentates) that meet the requirements for use as "narrow band" valence stabilizers for $Co^{+3}$ include, but are not limited to: P,P'-tetraphenyl-2,2-[(P-diphenyl)phosphinomethyl]-1,3-propanediphosphine; tri[o-(P-diphenyl)phosphinophenyl]phosphine; and 1,1,4,7,10,10-hexaphenyl-1,4,7,10-tetraphosphadecane. (Note: the aryl derivatives are air-stable, whereas the alkyl derivatives are air-sensitive and therefore unsuitable for these applications.)

P Valence Stabilizer #5: Examples of pentaphosphines (P monodentates, P—P bidentates, P—P tridentates, and P—P tetradentates) that meet the requirements for use as "narrow band" valence stabilizers for $Co^{+3}$ include, but are not limited to: 4-[2-(P-diphenyl)phosphinoethyl]-1,1,7,10,10-pentaphenyl-1,4,7,10-tetraphosphadecane. (Note: the aryl derivatives are air-stable, whereas the alkyl derivatives are air-sensitive and therefore unsuitable for these applications.)

P Valence Stabilizer #6: Examples of hexaphosphines (P—P bidentates, P—P tridentates, P—P tetradentates, and P—P hexadentates) that meet the requirements for use as "narrow band" valence stabilizers for $Co^{+3}$ include, but are not limited to: 1,1,10,10-tetraphenyl-4,7-[2-(P,P-diphenyl)phosphinoethyl]-1,4,7,10-tetraphosphadecane. (Note: the aryl derivatives are air-stable, whereas the alkyl derivatives are air-sensitive and therefore unsuitable for these applications.)

P Valence Stabilizer #7a: Examples of 5-membered heterocyclic rings containing one phosphorus atom (P monodentates) that meet the requirements for use as "narrow band" valence stabilizers for $Co^{+3}$ include, but are not limited to: 1-phospholene, 2-phospholene, 3-phospholene, phosphole, oxaphosphole, thiaphosphole, benzophospholene, benzophosphole, benzoxaphosphole, benzothiaphosphole, dibenzophospholene, dibenzophosphole, naphthophospholene, naphthophosphole, naphthoxaphosphole, naphthothiaphosphole.

P Valence Stabilizer #7b: Examples of 5-membered heterocyclic rings containing two phosphorus atoms (P monodentates or P—P bidentates) that meet the requirements for use as "narrow band" valence stabilizers for $Co^{+3}$ include, but are not limited to: diphospholene, diphosphole, oxadiphospholene, thiadiphospholene, benzodiphospholene, benzodiphosphole, naphthodiphospholene, and naphthodiphosphole.

P Valence Stabilizer #7c: Examples of 5-membered heterocyclic rings containing three phosphorus atoms (P monodentates or P—P bidentates) that meet the requirements for use as "narrow band" valence stabilizers for $Co^{+3}$ include, but are not limited to: triphosphole.

P Valence Stabilizer #8a: Examples of 6-membered heterocyclic rings containing one phosphorus atom (P monodentates) that meet the requirements for use as "narrow band" valence stabilizers for $Co^{+3}$ include, but are not limited to: phosphorin, oxaphosphorin, thiaphosphorin, benzophosphorin, benzoxaphosphorin, benzothiaphosphorin, acridophosphine, phosphanthridine, dibenzoxaphosphorin, dibenzothiaphosphorin, naphthophosphorin, naphthoxaphosphorin, and naphthothiaphosphorin.

P Valence Stabilizer #8b: Examples of 6-membered heterocyclic rings containing two phosphorus atoms (P monodentates or P—P bidentates) that meet the requirements for use as "narrow band" valence stabilizers for $Co^{+3}$ include, but are not limited to: o-diphosphorin, m-diphosphorin, p-diphosphorin, oxadiphosphorin, thiadiphosphorin, benzodiphosphorin, benzoxadiphosphorin, benzothiadiphosphorin, dibenzodiphosphorin, dibenzoxadiphosphorin, dibenzothiadiphosphorin, naphthodiphosphorin, naphthoxadiphosphorin, and naphthothiadiphosphorin.

P Valence Stabilizer #8c: Examples of 6-membered heterocyclic rings containing three phosphorus atoms (P monodentates or P—P bidentates) that meet the requirements for use as "narrow band" valence stabilizers for $Co^{+3}$ include, but are not limited to: 1,3,5-triphosphorin, 1,2,3-triphosphorin, benzo-1,2,3-triphosphorin, and naphtho-1,2,3-triphosphorin.

P Valence Stabilizer #9a: Examples of 5-membered heterocyclic rings containing one phosphorus atom and having at least one additional phosphorus atom binding site not contained in a ring (P Monodentates, P—P Bidentates, P—P Tridentates, P—P Tetradentates, or P—P Hexadentates) that meet the requirements for use as "narrow band" valence stabilizers for $Co^{+3}$ include, but are not limited to: 2-(P-phenylphosphino)-1-phospholene; 2,5-(P-phenylphosphino)-1-phospholene; 2-(P-phenylphosphino)-3-phospholene; 2,5-(P-phenylphosphino)-3-phospholene; 2-(P-phenylphosphino)phosphole; 2,5-(P-phenylphosphino)phosphole; 2-(P-phenylphosphino)benzophosphole; 7-(P-phenylphosphino)benzophosphole; and 1,8-(P-phenylphosphino)dibenzophosphole.

P Valence Stabilizer #9b: Examples of 5-membered heterocyclic rings containing two phosphorus atoms and having at least one additional phosphorus atom binding site not contained in a ring (P Monodentates, P—P Bidentates, P—P Tridentates, P—P Tetradentates, or P—P Hexadentates) that meet the requirements for use as "narrow band" valence stabilizers for $Co^{+3}$ include, but are not limited to: 2-(P-phenylphospbino)-1,3-diphospholene; 2,5-(P-phenylphosphino)-1,3-diphospholene; 2-(P-phenylphosphino)-1,3-diphosphole; 2,5-(P-phenylphosphino)-1,3-diphosphole; 2-(P-phenylphosphino)benzodiphosphole; and 7-(P-phenylphosphino)benzodiphosphole.

P Valence Stabilizer #9c: Examples of 5-membered heterocyclic rings containing three phosphorus atoms and having at least one additional phosphorus atom binding site not contained in a ring (P Monodentates, P—P Bidentates, P—P Tridentates, P—P Tetradentates, or P—P Hexadentates) that meet the requirements for use as "narrow band" valence stabilizers for $Co^{+3}$ include, but are not limited to: 2-(P-phenylphosphino)-1,3,4-triphosphole; and 2,5-(P-phenylphosphino)-1,3,4-triphosphole.

P Valence Stabilizer #10a: Examples of 6-membered heterocyclic rings containing one phosphorus atom and having at least one additional phosphorus atom binding site not contained in a ring (P Monodentates, P—P Bidentates, P—P Tridentates, P—P Tetradentates, or P—P Hexadentates) that meet the requirements for use as "narrow band" valence stabilizers for $Co^{+3}$ include, but are not limited to: 2-(P-phenylphosphino)phosphorin; 2,5-(P-phenylphosphino) phosphorin; 2-(P-phenylphosphino)benzophosphorin; 7-(P-phenylphosphino)benzophosphorin; and 1,9-(P-phenylphosphino)acridophosphine.

P Valence Stabilizer #10b: Examples of 6-membered heterocyclic rings containing two phosphorus atoms and having at least one additional phosphorus atom binding site not contained in a ring (P Monodentates, P—P Bidentates, P—P Trident ates, P—P Tetradentates, or P—P Hexadentates) that meet the requirements for use as "narrow band" valence stabilizers for $Co^{+3}$ include, but are not limited to: 2-(P-phenylphosphino)-4-diphosphorin; 2,6-(P-phenylphosphino)-4-diphosphorin; 2,3,5,6-(P-phenylphosphino)-4-diphosphorin; 2-(P-phenylphosphino)benzo-1,4-diphosphorin; 2,3-(P-phenylphosphino)benzo-1,4-diphosphorin; 2,8-(P-phenylphosphino)benzo-1,4-diphosphorin; 2,3,5,8-(P-phenylphosphino)benzo-1,4-diphosphorin; 1,9-(P-phenylphosphino) dibenzodiphosphorin; and 1,4,6,9-(P-phenylphosphino) dibenzodiphosphorin.

P Valence Stabilizer #10c: Examples of 6-membered heterocyclic rings containing three phosphorus atoms and having at least one additional phosphorus atom binding site not contained in a ring (P Monodentates, P—P Bidentates, P—P Tridentates, P—P Tetradentates, or P—P Hexadentates) that meet the requirements for use as "narrow band" valence stabilizers for $Co^{+3}$ include, but are not limited to: 2-(P-phenylphosphino)-1,3,5-triphosphorin; 2,6-(P-phenylphosphino)-1,3,5-triphosphorin; 4-(P-phenylphosphino)-1,2,3-triphosphorin; and 8-(P-phenylphosphino)benzo-1,2,3-triphosphorin.

P Valence Stabilizer#11a: Examples of 5-membered heterocyclic rings containing one phosphorus atom and having at least one additional phosphorus atom binding site contained in a ring (P Monodentates, P—P Bidentates, P—P Tridentates, P—P Tetradentates) that meet the requirements for use as "narrow band" valence stabilizers for $Co^{+3}$ include, but are not limited to: 2,2'-bi-1-phospholene; 2,2',2"-tri-1-phospholene; 2,2'-bi-3-phospholene; 2,2', 2"-tri-3-phospholene; 2,2'-biphosphole; 2,2',2"-triphosphole; and 2,2'-bibenzophosphole.

P Valence Stabilizer#11b: Examples of 5-memberedheterocyclicrings containingtwo phosphorus atoms and having at least one additional phosphorus atom binding site contained in a ring (P Monodentates, P—P Bidentates, P—P Tridentates, P—P Tetradentates) that meet the requirements for use as "narrow band" valence stabilizers for $Co^{+3}$ include, but are not limited to: 2,2'-bi-1,3-diphospholene; 2,2'-bi-1,3-diphosphole; and 2,2'-bibenzo-1,3-diphosphole.

P Valence Stabilizer #11c: Examples of 5-membered heterocyclic rings containing three phosphorus atoms and having at least one additional phosphorus atom binding site contained in a ring (P Monodentates, P—P Bidentates, P—P Tridentates, P—P Tetradentates) that meet the requirements for use as "narrow band" valence stabilizers for $Co^{+3}$ include, but are not limited to:2,2'-bi-1,3,4-triphosphole; and 2,2',2"-tri-1,3,4-triphosphole.

P Valence Stabilizer #12a: Examples of 6-membered heterocyclic rings containing one phosphorus atom and having at least one additional phosphorus atom binding site contained in a ring (P Monodentates, P—P Bidentates, P—P Tridentates, P—P Tetradentates) that meet the requirements for use as "narrow band" valence stabilizers for $Co^{+3}$ include, but are not limited to: 2,2'-biphosphorin; 2,2',2"-triphosphorin; 2,2',2",2'"-tetraphosphorin; 2,2'-bibenzophosphorin; and 8,8'-bibenzophosphorin.

P Valence Stabilizer #12b: Examples of 6-membered heterocyclic rings containing two phosphorus atoms and having at least one additional phosphorus atom binding site contained in a ring (P Monodentates, P—P Bidentates, P—P Tridentates, P—P Tetradentates) that meet the requirements for use as "narrow band" valence stabilizers for $Co^{+3}$ include, but are not limited to: 3,3'-bi-1,2-diphosphorin; 3,3',3"-tri-1,2-diphosphorin; 2,2'-bi-1,4-diphosphorin; 2,2', 2"-tri-1,4-diphosphorin; 3,3'-bibenzo-1,2-diphosphorin; 8,8'-bibenzo-1,2-diphosphorin; 2,2'-bibenzo-1,4-diphosphorin; and 8,8'-bibenzo-1,4-diphosphorin.

P Valence Stabilizer #12c: Examples of 6-membered heterocyclic rings containing three phosphorus atoms and having at least one additional phosphorus atom binding site contained in a ring (P Monodentates, P—P Bidentates, P—P Tridentates, P—P Tetradentates) that meet the requirements for use as "narrow band" valence stabilizers for $Co^{+3}$ include, but are not limited to: 2,2'-bi-1,3,5-triphosphorin; 2,2',2"-tri-1,3,5-triphosphorin; 4,4'-bi-1,2,3-triphosphorin; 4,4'-bibenzo-1,2,3-triphosphorin; and 8,8'-bibenzo-1,2,3-triphosphorin.

P Valence Stabilizer #13a: Examples of two-membered macrocyclics, macrobicyclics, and macropolycyclics (including catapinands, cryptands, cyclidenes, and sepulchrates) wherein both binding sites are composed of phosphorus and are not contained in component heterocyclic rings (P—P Bidentates) that meet the requirements for use as "narrow band" valence stabilizers for $Co^{+3}$ include, but are not limited to: P,P-diphenyldiphosphacyclobutane ([4]ane$P_2$); P,P-diphenyldiphosphacyclopentane ([5]ane$P_2$); P,P-diphenyldiphosphacyclohexane ([6]ane$P_2$); P,P-diphenyldiphosphacycloheptane ([7]ane$P_2$); P,P-diphenyldiphosphacyclooctane ([8]ane$P_2$); P,P-diphenyldiphosphacyclobutene ([4]ene$P_2$); P,P-diphenyldiphosphacyclopentene ([5]ene$P_2$); P,P-diphenyldiphosphacyclohexene ([6]ene$P_2$); P,P-diphenyldiphosphacycloheptene ([7]ene$P_2$); and P,P-diphenyldiphosphacyclooctene ([8]ene$P_2$).

P Valence Stabilizer #13b: Examples of three-membered macrocyclics, macrobicyclics, and macropolycyclics (including catapinands, cryptands, cyclidenes, and sepulchrates) wherein all binding sites are composed of phosphorus and are not contained in component heterocyclic rings (P—P Tridentates) that meet the requirements for use as "narrow band" valence stabilizers for $Co^{+3}$ include, but are not limited to: P,P,P-triphenyltriphosphacyclohexane ([6]ane$P_3$); P,P,P-triphenyltriphosphacycloheptane ([7]ane$P_3$); P,P,P-triphenyltriphosphacyclooctane ([8]ane$P_3$); P,P,P-triphenyltriphosphacyclononane ([9]ane$P_3$); P,P,P-triphenyltriphosphacyclodecane ([10]ane$P_3$); P,P,P-triphenyltriphosphacycloundecane ([11]ane$P_3$); P,P,P-triphenyltriphosphacyclododecane ([12]ane$P_3$); P,P,P-triphenyltriphosphacyclohexatriene ([6]triene$P_3$); P,P,P-triphenyltriphosphacycloheptatriene ([7]triene$P_3$); P,P,P-triphenyltriphosphacyclooctatriene ([8]triene$P_3$); P,P,P-triphenyltriphosphacyclononatriene ([9]triene$P_3$); P,P,P-triphenyltriphosphacyclodecatriene ([10]triene$P_3$); P,P,P-triphenyltriphosphacycloundecatriene ([11]trienePₙ); and P,P,P-triphenyltriphosphacyclododecatriene ([12]trienePₙ).

P Valence Stabilizer #13c: Examples of four-membered macrocyclics, macrobicyclics, and macropolycyclics (including catapinands, cryptands, cyclidenes, and sepulchrates) wherein all binding sites are composed of phosphorus and are not contained in component heterocyclic rings (P—P Tetradentates) that meet the requirements foruse as "narrow band" valence stabilizers for $Co^{+3}$ include, but are not limited to: P,P,P,P-tetraphenyltetraphosphacyclooctane ([8]aneP$_4$); P,P,P,P-tetraphenyltetraphosphacyclononane ([9]aneP$_4$); P,P,P,P-tetrapbenyltetraphosphacyclodecane ([10]aneP$_4$); P,P,P,P-tetraphenyltetraphosphacycloundecane ([11]aneP$_4$); P,P,P,P-tetraphenyltetraphosphacyclododecane ([12]aneP$_4$); P,P,P,P-tetraphenyltetrapbosphacyclotridecane ([13]aneP$_4$); P,P,P,P-tetraphenyltetraphosphacyclotetradecane ([14]aneP$_4$); P,P,P,P-tetraphenyltetraphosphacyclopentadecane ([15]aneP$_4$); P,P,P,P-tetraphenyltetraphosphacyclohexadecane ([16]aneP$_4$); P,P,P,P-tetraphenyltetraphosphacycloheptadecane ([17]aneP$_4$); P,P,P,P-tetraphenyltetraphosphacyclooctadecane ([18]aneP$_4$); P,P,P,P-tetraphenyltetraphosphacyclononadecane ([19]aneP$_4$); and P,P,P,P-tetraphenyltetraphosphacycloeicosane ([20]aneP$_4$).

P Valence Stabilizer #13d: Examples of five-membered macrocyclics, macrobicyclics, and macropolycyclics (including catapinands, cryptands, cyclidenes, and sepulchrates) wherein all binding sites are composed of phosphorus and are not contained in component heterocyclic rings (P—P Tridentates, or P—P Tetradentates) that meet the requirements for use as "narrow band" valence stabilizers for $Co^{+3}$ include, but are not limited to: P,P,P,P,P-pentaphenylpentaphosphacyclodecane ([10]aneP$_5$); P,P,P,P,P-pentaphenylpentaphosphacycloundecane ([11]aneP$_5$); P,P,P,P,P-pentaphenylpentaphosphacyclododecane ([12]aneP$_5$); P,P,P,P,P-pentaphenylpentaphosphacyclotridecane ([13]aneP$_5$); P,P,P,P,P-pentaphenylpentaphosphacyclotetradecane ([14]aneP$_5$); and P,P,P,P,P-pentaphenylpentaphosphacyclopentadecane ([15]aneP$_5$).

P Valence Stabilizer #13e: Examples of six-membered macrocyclics, macrobicyclics, and macropolycyclics (including catapinands, cryptands, cyclidenes, and sepulchrates) wherein all binding sites are composed of phosphorus and are not contained in component heterocyclic rings (P—P—P Tridentates, P—P—P—P Tetradentates, or P—P—P—P—P—P Hexadentates) that meet the requirements for use as "narrow band" valence stabilizers for $Co^{+3}$ include, but are not limited to: P,P,P,P,P,P-hexaphenylhexaphosphacyclododecane ([12]aneP$_6$); P,P,P,P,P,P-hexaphenylhexaphosphacyclotridecane ([13]aneP$_6$); P,P,P,P,P,P-hexaphenylhexaphosphacyclotetradecane ([14]aneP$_6$); P,P,P,P,P,P-hexaphenylhexaphosphacyclopentadecane ([15]aneP$_6$); P,P,P,P,P,P-hexaphenylhexaphosphacyclohexadecane ([16]aneP$_6$); P,P,P,P,P,P-hexaphenylhexaphosphacycloheptadecane ([17]aneP$_6$); P,P,P,P,P,P-hexaphenylhexaphosphacyclooctadecane ([18]aneP$_6$); P,P,P,P,P,P-hexaphenylhexaphosphacyclononadecane ([19]aneP$_6$); P,P,P,P,P,P-hexaphenylhexaphosphacycloeicosane ([20]aneP$_6$); P,P,P,P,P,P-hexaphenylhexaphosphacycloheneicosane ([21]aneP$_6$); P,P,P,P,P,P-hexaphenylhexaphosphacyclodocosane ([22]aneP$_6$); P,P,P,P,P,P-hexaphenylhexaphosphacyclotricosane ([23]aneP$_6$); P,P,P,P,P,P-hexaphenylhexaphosphacyclotetracosane ([24]aneP$_6$).

P Valence Stabilizer #13f: Examples of eight-membered macrocyclics, macrobicyclics, and macropolycyclics (including catapinands, cryptands, cyclidenes, and sepulchrates) wherein all binding sites are composed of phosphorus and are not contained in component heterocyclic rings (P—P Tridentates, P—P Tetradentates, or P—P Hexadentates) that meet the requirements for use as "narrow band" valence stabilizers for $Co^{+3}$ include, but are not limited to: P,P,P,P,P,P,P,P-octaphenyloctaphosphacyclohexadecane ([16]aneP$_8$); P,P,P,P,P,P,P,P-octaphenyloctaphosphacycloheptadecane ([17]aneP$_8$); P,P,P,P,P,P,P,P-octaphenyloctaphosphacyclooctadecane ([18]aneP$_8$); P,P,P,P,P,P,P,P-octaphenyloctaphosphacyclononadecane ([19]aneP$_8$); P,P,P,P,P,P,P,P-octaphenyloctaphosphacycloeicosane ([20]aneP$_8$); P,P,P,P,P,P,P,P-octaphenyloctaphosphacycloheneicosane ([21]aneP$_8$); P,P,P,P,P,P,P,P-octaphenyloctaphosphacyclodocosane ([22]aneP$_8$); P,P,P,P,P,P,P,P-octaphenyloctaphosphacyclotricosane ([23]aneP$_8$); and P,P,P,P,P,P,P,P-octaphenyloctaphosphacyclotetracosane ([24]aneP$_8$).

P Valence Stabilizer #14a: Examples of four-membered macrocyclics, macrobicyclics, and macropolycyclics (including catapinands, cryptands, cyclidenes, and sepulchrates) wherein all four binding sites are composed of phosphorus and are contained in component 5-membered heterocyclic rings (P—P Tetradentates) that meet the requirements for use as "narrow band" valence stabilizers for $Co^{+3}$ include, but are not limited to: tetraphospholenes; tetraphospholes; tetraoxaphospholes; tetradiphospholenes; tetradiphospholes; and tetraoxadiphospholes.

P Valence Stabilizer #14b: Examples of six-membered macrocyclics, macrobicyclics, and macropolycyclics (including catapinands, cryptands, cyclidenes, and sepulchrates) wherein all six binding sites are composed of phosphorus and are contained in component 5-membered heterocyclic rings (P—P Tetradentates and P—P Hexadentates) that meet the requirements for use as "narrow band" valence stabilizers for $Co^{+3}$ include, but are not limited to: hexaphospholenes; hexaphospholes; hexaoxaphospholes; hexadiphospholenes; hexadiphospholes; and hexaoxadiphospholes.

P Valence Stabilizer #14c: Examples of eight-membered macrocyclics, macrobicyclics, and macropolycyclics (including catapinands, cryptands, cyclidenes, and sepulchrates) wherein all eight binding sites are composed of phosphorus and are contained in component 5-membered heterocyclic rings (P—P Tridentates; P—P Tetradentates; or P—P Hexadentates) that meet the requirements for use as "narrow band" valence stabilizers for $Co^{+3}$ include, but are not limited to: octaphospholenes; octaphospholes; octaoxaphospholes; octadiphospholenes; octadiphospholes; and octaoxadiphospholes.

P Valence Stabilizer #15a: Examples of four-membered macrocyclics, macrobicyclics, and macropolycyclics (including catapinands, cryptands, cyclidenes, and sepulchrates) wherein all four binding sites are composed of phosphorus and are contained in a combination of 5-membered heterocyclic rings and phosphine groups (P—P Tridentates, P—P Tetradentates) that meet the requirements for use as "narrow band" valence stabilizers for $Co^{+3}$ include, but are not limited to: diphosphatetraphospholenes; tetraphosphatetraphospholenes; diphosphatetraphospholes; tetraphosphatetraphospboles; diphoshatetradiphospholes; and tetraphosphatetradiphospholes.

P Valence Stabilizer #15b: Examples of six-membered macrocyclics, macrobicyclics, and macropolycyclics (including catapinands, cryptands, cyclidenes, and sepulchrates) wherein all six binding sites are composed of phosphorus and are contained in a combination of 5-membered heterocyclic rings and phosphine groups (P—P Tridentates, P—P Tetradentates, and P—P Hexadentates) that meet the requirements for use as "narrow band" valence stabilizers for $Co^{+3}$ include, but are not limited to: diphosphahexaphospholenes; triaphosphahexaphospholenes; diphosphahexaphospholes; triphosphahexaphospholes; diphoshahexadiphospholes; and triphosphahexadiphospholes.

P Valence Stabilizer #15c: Examples of eight-membered macrocyclics, macrobicyclics, and macropolycyclics (including catapinands, cryptands, cyclidenes, and sepulchrates) wherein all eight binding sites are composed of phosphorus and are contained in a combination of 5-membered heterocyclic rings and phosphine groups (P—P Tridentates, P—P Tetradentates, and P—P Hexadentates) that meet the requirements for use as "narrow band" valence stabilizers for $Co^{+3}$ include, but are not limited to: diphosphaoctaphospholenes; tetraphosphaoctaphospholenes; diphosphaoctaphospholes; tetraphosphaoctaphospholes; diphoshaoctadiphospholes; and tetraphosphaoctadiphospholes.

P Valence Stabilizer #16a: Examples of four-membered macrocyclics, macrobicyclics, and macropolycyclics (including catapinands, cryptands, cyclidenes, and sepulchrates) wherein all four binding sites are composed of phosphorus and are contained in component 6-membered heterocyclic rings (P—P Tetradentates) that meet the requirements for use as "narrow band" valence stabilizers for $Co^{+3}$ include, but are not limited to: cyclotetraphosphorins; cyclotetraaoxaphosphorins; cyclotetradiphosphorins; and cyclotetraoxadiphosphorins.

P Valence Stabilizer #16b: Examples of six-membered macrocyclics, macrobicyclics, and macropolycyclics (including catapinands, cryptands, cyclidenes, and sepulchrates) wherein all six binding sites are composed of phosphorus and are contained in component 6-membered heterocyclic rings (P—P Tridentates, P—P Tetradentates, and P—P Hexadentates) that meet the requirements for use as "narrow band" valence stabilizers for $Co^{+3}$ include, but are not limited to: cyclohexaphosphorins; cyclohexaoxaphosphorins; cyclohexadiphosphorins; and cyclohexaoxadiphosphorins.

P Valence Stabilizer #16c: Examples of eight-membered macrocyclics, macrobicyclics, and macropolycyclics (including catapinands, cryptands, cyclidenes, and sepulchrates) wherein all eight binding sites are composed of phosphorus and are contained in component 6-membered heterocyclic rings (P—P Tridentates, P—P Tetradentates, and P—P Hexadentates) that meet the requirements for use as "narrow band" valence stabilizers for $Co^{+3}$ include, but are not limited to: cyclooctaphosphorins; cyclooctaoxaphosphorins; cyclooctadiphosphorins; and cyclooctaoxadiphosphorins.

P Valence Stabilizer #17a: Examples of four-membered macrocyclics, macrobicyclics, and macropolycyclics (including catapinands, cryptands, cyclidenes, and sepulchrates) wherein all four binding sites are composed of phosphorus and are contained in a combination of 6-membered hetero cyclic rings and phosphine groups (P—P Tridentates, P—P Tetradentates, or P—P Hexadentates) that meet the requirements for use as "narrow band" valence stabilizers for $Co^{+3}$ include, but are not limited to: diphosphacyclotetraphosphorins; tetraphosphacyclotetraphosphorins; diphosphacyclotetraoxaphosphorins; tetraphosphacyclotetraoxaphosphorins; diphosphacyclotetradiphosphorins; tetraphosphacyclotetradiphosphorins; diphosphacyclotetraoxadiphosphorins; and tetraphosphacyclotetraoxadiphosphorins.

P Valence Stabilizer #17b: Examples of six-membered macrocyclics, macrobicyclics, and macropolycyclics (including catapinands, cryptands, cyclidenes, and sepulchrates) wherein all six binding sites are composed of phosphorus and are contained in a combination of 6-membered heterocyclic rings and phosphine groups (P—P Tridentates, P—P Tetradentates, or P—P Hex adentates) that meet the requirements for use as "narrow band" valence stabilizers for $Co^{+3}$ include, but are not limited to: diphosphacyclohexaphosphorins; triphosphacyclohexaphosphorins; diphosphacyclohexaoxaphosphorins; triphosphacyclohexaoxaphosphorins; diphosphacyclohexadiphosphorins; triphosphacyclohexadiphosphorins; diphosphacyclohexaoxadiphosphorins; and triphosphacyclohexaoxadiphosphorins.

P Valence Stabilizer #17c: Examples of eight-membered macrocyclics, macrobicyclics, and macropolycyclics (including catapinands, cryptands, cyclidenes, and sepulchrates) wherein all eight binding sites are composed of phosphorus and are contained in a combination of 6-membered heterocyclic rings and phosphine groups (P—P Tridentates, P—P Tetradentates, or P—P Hexadentates) that meet the requirements for use as "narrow band" valence stabilizers for $Co^{+3}$ include, but are not limited to: diphosphacyclooctaphosphorins; tetraphosphacyclooctaphosphorins; diphosphacyclooctaoxaphosphorins; tetraphosphacyclooctaoxaphosphorins; diphosphacyclooctadiphosphorins; tetraphosphacyclooctadiphosphorins; diphosphacyclooctaoxadiphosphorins; and tetraphosphacyclooctaoxadiphosphorins.

O Valence Stabilizer #1: Examples of biurets (imidodicarbonic diamides), isobiurets, biureas, triurets, triureas, bis(biurets), bis(isobiurets), bis(biureas), poly(biurets), poly(isobiurets), and poly(biureas) (O—O Bidentates, O—O Tridentates, O—O Tetradentates) that meet the requirements for use as "narrow band" valence stabilizers for $Co^{+3}$ include, but are not limited to: biuret, isobiuret, biurea, triuret, triurea, nitrobiuret, dinitrobiuret, aminobiuret, diaminobiuret, oxybiuret, dioxybiuret, cyanobiuret, methylbiuret, ethylbiuret, isopropylbiuret, phenylbiuret, benzylbiuret, cyclohexylbiuret, norbornylbiuret, adamantylbiuret, dimethylbiuret, diethylbiuret, diisopropylbiuret, diphenylbiuret, dibenzylbiuret, dicyclohexylbiuret, dinorbornylbiuret, and diadamantylbiuret.

O Valence Stabilizer #2: Examples of acylureas, aroylureas, bis(acylureas), bis(aroylureas), poly(acylureas), and poly(aroylureas) (O—O Bidentates, O—O Tridentates, O—O Tetradentates) that meet the requirements for use as "narrow band" valence stabilizers for $Co^{+3}$ include, but are not limited to: formylurea, acetylurea, benzoylurea, cyclohexoylurea, pentafluorobenzoylurea, N-methylacetylurea, N-phenylbenzoylurea, and N-cyclohexylcyclohexoylurea.

O Valence Stabilizer #3: Examples of imidodialdehydes, hydrazidodialdehydes (acyl hydrazides), bis(imidodialdehydes), bis(hydrazidodialdehydes), poly(imidodialdehydes), and poly(hydrazidodialdehydes) (O—O Bidentates, O—O Tridentates, O—O Tetradentates) that meet the requirements for use as "narrow band" valence stabilizers for $Co^{+3}$ include, but are not limited to: diacetamide, dipropanamide, dibutanamide, dibenzamide, and dicyclohexamide.

O Valence Stabilizer #4: Examples of imidodicarbonic acids, hydrazidodicarbonic acids, bis(imidodicarbonic acids), bis(hydrazidodicarbonic acids), poly(imidodicarbonic acids), poly(hydrazidodicarbonic acids) and derivatives thereof (O—O Bidentates, O—O Tridentates, O—O Tetradentates) that meet the requirements for use as "narrow band" valence stabilizers for $Co^{+3}$ include, but are not limited to: imidodicarbonic acid, hydrazidodicarbonic acid, O-phenylimidodicarbonic acid, O-benzylimidodicarbonic acid, O-cyclohexylimidodicarbonic acid, O-norbornylimidodicarbonic acid, O,O'-diphenylimidodicarbonic acid, O,O'-dibenzylimidodicarbonic acid, O,O'-dicyclohexylimidodicarbonic acid, and O,O'-dinorbornylimidodicarbonic acid.

O Valence Stabilizer #5: Examples of imidodisulfamic acid, imidodisulfuric acid, bis(imidodisulfamic acid), bis(imidodisulfuric acid), poly(imidodisulfamic acid), and poly(imidodisulfuric acid) and derivatives thereof (O—O Bidentates, O—O Tridentates, O—O Tetradentates) that meet the requirements for use as "narrow band" valence stabilizers for $Co^{+3}$ include, but are not limited to: imidodisulfamic acid, imidodisulfuric acid, N-phenylimidodisulfamic acid, N-benzylimidodisulfamic acid, N-cyclohexylimidodisulfamic acid, N-norbornylimidodisulfamic acid, N,N'-diphenylimidodisulfamic acid, N,N'-dibenzylimidodisulfamic acid, N,N'-dicyclohexylimidodisulfamic acid, and N,N'-norbornylimidodisulfamic acid.

O Valence Stabilizer #6: Examples of 1,3-diketones (beta-diketonates), 1,3,5-triketones, bis(1,3-diketones), and poly(1,3-diketones), all with a molecular weight greater than 125 (O—O Bidentates, O—O Tridentates, O—O Tetradentates) that meet the requirements for use as "narrow band" valence stabilizers for $Co^{+3}$ include, but are not limited to: hexafluoropentanedione; dibenzoylmethane (1,3-diphenyl-1,3-propanedione); benzoylpinacolone; dicyclohexoylmethane; diphenylpentanetrionate; dibenzoylacetone; benzoylacetylacetone; dibenzoylacetylacetone; tetramethylnonanetrionate; hexafluoroheptanetrionate; trifluoroheptanetrionate; trifluoroacetylcamphor (facam); and 1,3-indandione.

O Valence Stabilizer #7: Examples of 1,2-diketones (alpha-diketonates), 1,2,3-triketones, tropolonates, o-quinones, bis(1,2-diketones), and poly(1,2-diketones), all with a molecular weight greater than 100 (O—O Bidentates, O—O Tridentates, O—O Tetradentates) that meet the requirements for use as "narrow band" valence stabilizers for $Co^{+3}$ include, but are not limited to: tropolone; 1,2-benzoquinone (o-quinone); di-tert-butyl-1,2-benzoquinone; hexafluoro-1,2-benzoquinone; 1,2-naphthoquinone; 9,10-phenanthroquinone; and 1,2-indandione.

O Valence Stabilizer #8: Examples of malonamides (malonodiamides), bis(malonamides), and polymalonamides (O—O Bidentates, O—O Tridentates, O—O Tetradentates) that meet the requirements for use as "narrow band" valence stabilizers for $Co^{+3}$ include, but are not limited to: malonamide, N-phenylmalonamide, N-benzylmalonamide, N-pentafluorophenylmalonamide, N-cyclohexylmalonamide, N-norbornylmalonamide, N,N'-diphenylmalonamide, N,N'-dibenzylmalonamide, N,N'-dipentafluorophenylmalonamide, N,N'-dicyclohexylmalonamide, and N,N'-norbornylmalonamide.

O Valence Stabilizer #9: Examples of 2-acylacetamides, bis(2-acylacetamides), and poly(2-acylacetamides) (O—O Bidentates, O—O Tridentates, O—O Tetradentates) that meet the requirements for use as "narrow band" valence stabilizers for $Co^{+3}$ include, but are not limited to: 2-acetoacetamide, N-phenyl-2-acetoacetamide, N-pentafluorophenyl-2-acetoacetamide, N-benzyl-2-acetoacetamide, N-cyclohexyl-2-acetoacetamide, N-norbornyl-2-acetoacetamide, N-phenyl-2-benzoacetamide, N-pentafluorophenyl-2-pentafluorobenzoacetamide, and N-cyclohexyl-2-cyclohexoacetamide.

O Valence Stabilizer #10: Examples of monothiodicarbonic diamides, bis(monothiodicarbonic diamides), and poly(monothiodicarbonic diamides) (O—O Bidentates, O—O Tridentates, O—O Tetradentates) that meet the requirements for use as "narrow band" valence stabilizers for $Co^{+3}$ include, but are not limited to: monothiodicarbonic diamide; N-phenylmonothiodicarbonic diamide; N-pentafluorophenylmonothiodicarbonic diamide; N-benzylmonothiodicarbonic diamide; N-cyclohexylmonothiodicarbonic diamide; N-norbornylmonothiodicarbonic diamide; N,N'-diphenylmonothiodicarbonic diamide; N,N'-dipentafluorophenylmonothiodicarbonic diamide; N,N'-dibenzylmonothiodicarbonic diamide; N,N'-dicyclohexylmonothiodicarbonic diamide; and N,N'-dinorbornylmonothiodicarbonic diamide.

O Valence Stabilizer #11: Examples ofmonothiodicarbonic acids, bis(monothiodicarbonic acids), poly(monothiodicarbonic acids), and derivatives thereof (O—O Bidentates, O—O Tridentates, O—O Tetradentates) that meet the requirements for use as "narrow band" valence stabilizers for $Co^{+3}$ include, but are not limited to: monothiodicarbonic acid, O-phenylmonothiodicarbonic acid, O-benzylmonothiodicarbonic acid, O-cyclohexylmonothiodicarbonic acid, O-norbornylmonothiodicarbonic acid, O,O'-diphenylmonothiodicarbonic acid, O,O'-dibenzylmonothiodicarbonic acid, O,O'-dicyclohexylmonothiodicarbonic acid, and O,O'-dinorbornylmonothiodicarbonic acid.

O Valence Stabilizer #12: Examples of dithioperoxydicarbonic acids, bis(dithioperoxydicarbonic acids), poly(dithioperoxydicarbonic acids), and derivatives thereof (O—O Bidentates, O—O Tridentates, O—O Tetradentates) that meet the requirements for use as "narrow band" valence stabilizers for $Co^{+3}$ include, but are not limited to: dithioperoxydicarbonic acid, O-phenyldithioperoxydicarbonic acid; O-benzyldithioperoxydicarbonic acid; O-cyclohexyldithioperoxydicarbonic acid; O-norbornyldithioperoxydicarbonic acid; O,O'-diphenyldithioperoxydicarbonic acid; O,O'-dibenzyldithioperoxydicarbonic acid; O,O'-dicyclohexyldithioperoxydicarbonic acid; and O,O'-dinorbornyldithioperoxydicarbonic acid.

O Valence Stabilizer #13: Examples oftrithionic acid, bis(trithionic acid), poly(trithionic acid), and derivatives thereof (O—O Bidentates, O—O Tridentates, O—O Tetradentates) that meet the requirements for use as "narrow band" valence stabilizers for $Co^{+3}$ include, but are not limited to: diphenyl trithionate, dipentafluorodiphenyl trithionate, dicyclohexyl trithionate, and dinorbornyl trithionate.

O Valence Stabilizer #14: Examples of hypophosphoric acids, bis(hypophosphoric acids), and poly(hypophosphoric acids), and derivatives thereof (O—O Bidentates, O—O Tridentates, O—O Tetradentates) that meet the requirements for use as "narrow band" valence stabilizers for $Co^{+3}$ include, but are not limited to: hypophosphoric acid, O-methylhypophosphoric acid, O-isopropylhypophosphoric acid, O-tert-butylhypophosphoric acid, O-phenylhypophosphoric acid, O-pentafluorophenylhypophosphoric acid, O-benzylhypophosphoric acid, O-cyclohexylhypophosphoric acid, O-norbornylhypophosphoric acid, O,O"-dimethylhypophosphoric acid, O,O"-diisopropylhypophosphoric acid, O,O"-di-tert-butylhypophosphoric acid, O,O"-diphenylhypophosphoric acid, O,O"-di-pentafluorophenylhypophosphoric acid, O,O"-dibenzylhypophosphoric acid, O,O"-dicyclohexylhypophosphoric acid, and O,O"-dinorbornylhypophosphoric acid.

O Valence Stabilizer #15: Examples of hypophosphoramides, bis(hypophosphoramides), and poly(hypophosphoramides) (O—O Bidentates, O—O Tridentates, O—O Tetradentates) that meet the requirements for use as "narrow band" valence stabilizers for $Co^{+3}$ include, but are not limited to: hypophosphoramide, N-methylhypophosphoramide, N-isopropylhypophosphoramide, N-tert-butylhypophosphoramide, N-phenylhypophosphoramide, N-pentafluorophenylhypophosphoramide, N-benzylhypophosphoramide, N-cyclohexylhypophosphoramide, N-norbornylhypophosphoramide, N,N'''-dimethylhypophosphoramide, N,N'''-diisopropylhypophosphoramide, N,N'''-di-tert-butylhypophosphoramide, N,N'''-diphenylhypophosphoramide, N,N'''-di-pentafluorophenylhypophosphoramide, N,N'''-dibenzylhypophosphoramide, N,N'''-dicyclohexylhypophosphoramide, and N,N'''-dinorbornylhypophosphoramide.

O Valence Stabilizer #16: Examples of imidodiphosphoric acids, hydrazidodiphosphoric acids, bis(imidodiphosphoric acids), bis(hydrazidodiphosphoric acids), poly(imidodiphosphoric acids), poly(hydrazidodiphosphoric acids), and derivatives thereof(O—O Bidentates, O—O Tridentates, O—O Tetradentates) that meet the requirements for use as "narrow band" valence stabilizers for $Co^{+3}$ include, but are not limited to: imidodiphosphoric acid, methylimidodiphosphoric acid, isopropylimidodiphosphoric acid, tert-butylimidodiphosphoric acid, phenylimidodiphosphoric acid, pentafluorophenylimidodiphosphoric acid, benzylimidodiphosphoric acid, cyclohexylimidodiphosphoric acid, norbornylimidodiphosphoric acid, dimethylimidodiphosphoric acid, diisopropylimidodiphosphoric acid, di-tert-butylimidodiphosphoric acid, diphenylimidodiphosphoric acid, di-pentafluorophenylimidodiphosphoric acid, dibenzylimidodiphosphoric acid, dicyclohexylimidodiphosphoric acid, and dinorbornylimidodiphosphoric acid.

O Valence Stabilizer #17: Examples of imidodiphosphoramides, hydrazidodiphosphoramides, bis(imidodiphosphoramides), bis(hydrazidodiphosphoramides), poly(imidodiphosphoramides), and poly(hydrazidodiphosphoramides) (O—O Bidentates, O—O Tridentates, O—O Tetradentates) that meet the requirements for use as "narrow band" valence stabilizers for $Co^{+3}$ include, but are not limited to: imidodiphosphoramide, N-methylimidodiphosphoramide, N-isopropylimidodiphosphoramide, N-tert-butylimidodiphosphoramide, N-phenylimidodiphosphoramide, N-pentafluorophenylimidodiphosphoramide, N-benzylimidodiphosphoramide, N-cyclohexylimidodiphosphoramide, N-norbornylimidodiphosphoramide, N,N'''-dimethylimidodiphosphoramide, N,N'''-diisopropylimidodiphosphoramide, N,N'''-di-tert-butylimidodiphosphoramide, N,N'''-diphenylimidodiphosphoramide, N,N'''-di-pentafluorophenylimidodiphosphoramide, N,N'''-dibenzylimidodiphosphoramide, N,N'''-dicyclohexylimidodiphosphoramide, and N,N'''-dinorbornylimidodiphosphoramide.

O Valence Stabilizer #18: Examples of diphosphoramides, bis(diphosphoramides), and poly(diphospboramides) (O—O Bidentates, O—O Tridentates, O—O Tetradentates) that meet the requirements for use as "narrow band" valence stabilizers for $Co^{+3}$ include, but are not limited to: diphosphoramide, N-methyldiphosphoramide, N-isopropyldiphosphoramide, N-tert-butyldiphosphoramide, N-phenyldiphosphoramide, N-pentafluorophenyldiphosphoramide, N-benzyldiphosphoramide, N-cyclohexyldiphosphoramide, N-norbornyldiphosphoramide, N,N'''-dimethyldiphosphoramide, N,N'''-diisopropyldiphosphoramide, N,N'''-di-tert-butyldiphosphoramide, N,N'''-diphenyldiphosphoramide, N,N'''-di-pentafluorophenyldiphosphoramide, N,N'''-dibenzyldiphosphoramide, N,N'''-dicyclohexyldiphosphoramide, and N,N'''-dinorbornyldiphosphoramide.

O Valence Stabilizer #19: Examples of imidodiphosphonic acids, hydrazidodiphosphonic acids, bis(imidodiphospbonic acids), bis(hydrazidodiphospbonic acids), poly(imidodiphosphonic acids), poly(hydrazidodiphosphonic acids), and derivatives thereof (O—O Bidentates, O—O Tridentates, O—O Tetradentates) that meet the requirements for use as "narrow band" valence stabilizers for $Co^{+3}$ include, but are not limited to: imidodiphosphonic acid, methylimidodiphosphonic acid, isopropylimidodiphosphonic acid, tert-butylimidodiphosphonic acid, phenylimidodiphosphonic acid, pentafluorophenylimidodiphosphonic acid, benzylimidodiphosphonic acid, cyclohexylimidodiphosphonic acid, norbornylimidodiphosphonic acid, dimethylimidodiphosphonic acid, diisopropylimidodiphosphonic acid, di-tert-butylimidodiphosphonic acid, diphenylimidodiphosphonic acid, di-pentafluorophenylimidodiphosphonic acid, dibenzylimidodiphosphonic acid, dicyclohexylimidodiphosphonic acid, and dinorbornylimidodiphosphonic acid. [Note: The phosphite ($P^{+3}$) valence of the phosphorus atom makes stabilization of high valence metal ions much more difficult, though still possible.]

O Valence Stabilizer #20: Examples of imidodiphosphonamides, hydrazidodiphosphonamides, bis(imidodiphosphonamides), bis(hydrazidodiphosphonamides), poly(imidodiphosphonamides), and poly(hydrazidodiphosphonamides) (O—O Bidentates, O—O Tridentates, O—O Tetradentates) that meet the requirements for use as "narrow band" valence stabilizers for $Co^{+3}$ include, but are not limited to: imidodiphosphonamide, N-methylimidodiphosphonamide, N-isopropylimidodiphosphonamide, N-tert-butylimidodiphosphonamide, N-phenylimidodiphosphonamide, N-pentafluorophenylimidodiphosphonamide, N-benzylimidodiphosphonamide, N-cyclohexylimidodiphosphonamide, N-norbornylimidodiphosphonamide, N,N'''-dimethylimidodiphosphonamide, N,N'''-diisopropylimidodiphosphonamide, N,N'''-di-tert-butylimidodiphosphonamide, N,N'''-diphenylimidodiphosphonamide, N,N'''-di-pentafluorophenylimidodiphosphonamide, N,N'''-dibenzylimidodiphosphonamide, N,N'''-dicyclohexylimidodiphosphonamide, and N,N'''-dinorbornylimidodiphosphonamide. [Note: The phosphite ($P^{+3}$) valence of the phosphorus atom makes stabilization of high valence metal ions much more difficult, though still possible.]

O Valence Stabilizer #21: Examples of diphosphonamides, bis(diphosphonamides), and poly(diphosphonamides) (O—O Bidentates, O—O Tridentates, O—O Tetradentates) that meet the requirements for use as "narrow band" valence stabilizers for $Co^{+3}$ include, but are not limited to: diphosphonamide, N-methyldiphosphonamide, N-isopropyl-diphosphonamide, N-tert-butyldiphosphonamide, N-phenyldiphosphonamide, N-pentafluorophenyldiphosphonamide, N-benzyldiphosphonamide, N-cyclohexyldiphosphonamide, N-norbornyldiphosphonamide, N,N'''-dimethyldiphosphonamide, N,N'''-diisopropyldiphosphonamide, N,N'''-di-tert-butyldiphosphonamide, N,N'''-diphenyldiphosphonamide, N,N'''-di-pentafluorophenyldiphosphonamide, N,N'''-dibenzyldiphosphonamide, N,N'''-dicyclohexyldiphosphonamide, and N,N'''-dinorbornyldiphosphonamide. [Note: The phosphite ($P^{+3}$) valence of the phosphorus atom makes stabilization of high valence metal ions much more difficult, though still possible.]

O Valence Stabilizer #22: Examples of beta-hydroxyketones, beta-hydroxyaldehydes, bis(beta-hydroxyketones), bis(beta-hydroxyaldehydes), poly(beta-hydroxyketones), and poly(beta-hydroxyaldehydes) (O—O Bidentates, O—O Tridentates, O—O Tetradentates) that meet the requirements for use as "narrow band" valence stabilizers for $Co^{+3}$ include, but are not limited to: 4-hydroxypentan-2-one; 1,3-diphenyl-3-hydroxypropanal; 1,3-dibenzyl-3-hydroxypropanal; 1,3-dicyclohexyl-3-hydroxypropanal; 1,3-dinorbornyl-3-hydroxypropanal; 1,3-di(2-thienyl)-3-hydroxypropanal; 1,3-di(2-furyl)-3-hydroxypropanal; o-hydroxyacetophenone; juglone; alizarin; 1-hydroxyanthraquinone; 1,8-hydroxyanthraquinone; 1-hydroxyacridone; and beta-hydroxybenzophenone.

O Valence Stabilizer #23: Examples of N-(aminomethylol) ureas [N-(aminohydroxymethyl)ureas], bis[N-(aminomethylol)ureas], and poly[N-(aminomethylol)ureas] (O—O Bidentates, O—O Tridentates, O—O Tetradentates) that meet the requirements for use as "narrow band" valence stabilizers for $Co^{+3}$ include, but are not limited to: N'-(aminohydroxymethyl)urea; N,N''-dimethyl-N'-(aminohydroxymethyl)urea;N,N'-diethyl-N'-(aminohydroxymethyl) urea; N,N''-isopropyl-N'-(aminohydroxymethyl)urea; N,N''-diphenyl-N'-(aminohydroxymethyl)urea; N,N''-dibenzyl-N'-(aminohydroxymethyl)urea; N,N''-dicyclohexyl-N'-(aminohydroxymethyl)urea; and N,N''-dinorbornyl-N'-(aminohydroxymethyl)urea.

O Valence Stabilizer #24: Examples of oxamides, bis(oxamides), and poly(oxamides) (O—O Bidentates, O—O Tridentates, O—O Tetradentates) that meet the requirements for use as "narrow band" valence stabilizers for $Co^{+3}$ include, but are not limited to: oxamide, N-methyloxamide; N-ethyloxamide; N-isopropyloxamide; N-phenyloxamide; N-benzyloxamide; N-cyclohexyloxamide; N-norbornyloxamide; N,N'-dimethyloxamide; N,N'-diethyloxamide; N,N'-diisopropyloxamide; N,N'-diphenyloxamide; N,N'-dibenzyloxamide; N,N'-dicyclohexyloxamide; and N,N'-dinorbornyloxamide.

O Valence Stabilizer #25: Examples of squaric acids and derivatives thereof (O—O Bidentates) that meet the requirements for use as "narrow band" valence stabilizers for $Co^{+3}$ include, but are not limited to: deltic acid; squaric acid; croconic acid; and rhodizonic acid.

O Valence Stabilizer #26: Examples of dicarboxylic acids, bis(dicarboxylic acids), poly(dicarboxylic acids), and derivatives thereof (O—O Bidentates and O—O Tetradentates) that meet the requirements for use as "narrow band" valence stabilizers for $Co^{+3}$ include, but are not limited to: oxalic acid; malonic acid; succinic acid; diphenyl oxalate; diphenyl malonate; and diphenyl succinate.

O Valence Stabilizer #27: Examples of carbonates and bis(carbonates) (O—O Bidentates and O—O Tetradentates) that meet the requirements for use as "narrow band" valence stabilizers for $Co^{+3}$ include, but are not limited to: carbonate; bicarbonate; O,O-diethylcarbonate; diisopropylcarbonate; diphenylcarbonate; dibenzylcarbonate; dicyclohexylcarbonate; and dinorbornylcarbonate.

O Valence Stabilizer #28: Examples of carbamates, bis(carbamates), and poly(carbamates) (including N-hydroxycarbamates and N-mercaptocarbamates) (O—O Bidentates, O—O Tridentates, and O—O Tetradentates) that meet the requirements for use as "narrow band" valence stabilizers for $Co^{+3}$ include, but are not limited to: dimethylcarbamate (dmc); di(trifluorodimethyl)carbamate; ethyl carbamate; diethylcarbamate (dec); dipropylcarbamate; diisopropylcarbamate; dibutylcarbamate; ditertbutylcarbamate; dicyanamidocarbamate; diphenylcarbamate; di(pentafluorophenyl) carbamate; dibenzylcarbamate; dinaphthylcarbamate; dicyclohexylcarbamate; dinorbornylcarbamate; diadamantylcarbamate; pyrrolidinocarbamate (pyrc); piperidinocarbamate (pipc); morpholinocarbamate (more); thiamorpholinocarbamate; 3-pyrrolinocarbamate; pyrrolocarbamate; oxazolocarbamate; isoxazolocarbamate; thiazolocarbamate; isothiazolocarbamate; indolocarbamate; carbazolocarbamate; pyrazolinocarbamate; imidazolinocarbamate; pyrazolocarbamate; imidazolocarbamate; indazolocarbamate; and triazolocarbamate.

O Valence Stabilizer #29: Examples of carbazates (carbazides), bis(carbazates), and poly(carbazates) (O—O Bidentates, O—O Tridentates, and O—O Tetradentates; or possibly N—O Bidentates, N—O Tridentates, and N—O Tetradentates) that meet the requirements for use as "narrow band" valence stabilizers for $Co^{+3}$ include, but are not limited to: N,N'-dimethylcarbazate; N,N'-di(trifluoromethyl)carbazate; N,N'-diethylcarbazate; N,N'-diphenylcarbazate; N,N'-dibenzylcarbazate; N,N'-di(pentafluorophenyl) carbazate; N,N'-dicyclohexylcarbazate; and N,N'-dinorbornylcarbazate.

O Valence Stabilizer #30: Examples of carbimates, bis(carbimates), and poly(carbimates) (O—O Bidentates, O—O Tridentates, and O—O Tetradentates) that meet the requirements for use as "narrow band" valence stabilizers for $Co^{+3}$ include, but are not limited to: methylcarbimate; trifluoromethylcarbimate; etbylcarbimate; propylcarbimate; isopropylcarbimate; butylcarbimate; tertbutylcarbimate; cyanocarbimate; cyanamidocarbimate; azidocarbimate; phenylcarbimate; pentafluorophenylcarbimate; benzylcarbimate; naphthylcarbimate; cyclohexylcarbimate; norbornylcarbimate; and adamantylcarbimate. [Note: Carbimates tend to stabilize lower oxidation states in metal ions.]

O Valence Stabilizer #31: Examples of arsonic acids, bis(arsonic acids), poly(arsonic acids), and derivatives thereof (O—O Bidentates, O—O Tridentates, O—O Tetradentates) that meet the requirements for use as "narrow band" valence stabilizers for $Co^{+3}$ include, but are not limited to: arsonic acid, O-phenylarsonic acid, O-benzylarsonic acid, O-cyclohexylarsonic acid, O-norbornylarsonic acid, O,O-diphenylarsonic acid, O,O-dibenzylarsonic acid, O,O-dicyclohexylarsonic acid, O,O-dinorbornylarsonic acid; and aminophenylarsonic acids.

O Valence Stabilizer #32: Examples of alkyl- and arylborates and bis(borates) (O—O Bidentates and O—O Tetradentates) that meet the requirements for use as "narrow band" valence stabilizers for $Co^{+3}$ include, but are not limited to: triethyl borate; diisopropyl borate; diphenyl borate; dibenzyl borate; dicyclohexyl borate; and dinorbornyl borate.

O Valence Stabilizer #33: Examples of alkyl- and arylboronates and bis(boronates) (O—O Bidentates and O—O Tetradentates) that meet the requirements for use as "narrow band" valence stabilizers for $Co^{+3}$ include, but are not limited to: diethyl boronate; diisopropyl boronate; diphenyl boronate; dibenzyl boronate; dicyclohexyl boronate; and dinorbornyl boronate. [Note: boronates tend to stabilize lower oxidation states in metal ions.]

O Valence Stabilizer #34: Examples of phosphine P-oxides and amino-substituted phosphine oxides (O Monodentates) that meet the requirements for use as "narrow band" valence stabilizers for $Co^{+3}$ include, but are not limited to: trimethylphosphine oxide (TMPO); triethylphosphine oxide (TEPO); triphenylphosphine oxide (TPhPO); tribenzylphosphine oxide (TBzPO); tricyclohexylphosphine oxide (TcHxPO); and trinorbornylphosphine oxide for phosphine P-oxides; and hexamethylphosphoramide (HMPA); trimorpholinophosphine oxide (TMrPO); tripiperidinophosphine oxide; tripyrrolidinophosphine oxide; and tri(cyclohexylamino)phosphine oxide for amino-substituted phosphine oxides.

O Valence Stabilizer #35: Examples of arsine As-oxides and amino-substituted arsine oxides (O Monodentates) that meet the requirements for use as "narrow band" valence stabilizers for $Co^{+3}$ include, but are not limited to: trimethylarsine oxide (TMAsO); triethylarsine oxide (TEAsO); triphenylarsine oxide (TPhAsO); tribenzylarsine oxide (TBzAsO); tricyclohexylarsine oxide (TcHxAsO); and trinorbornylarsine oxide for arsine As-oxides; and hexamethylarsonamide; trimorpholinoarsine oxide; tripiperidinoarsine oxide; tripyrrolidinoarsine oxide; and tri(cyclohexylamino)arsine oxide for amino-substituted arsine oxides.

O Valence Stabilizer #36: Examples of cyanate ligands (O monodentates) that meet the requirements for use as "narrow band" valence stabilizers for $Co^{+3}$ include, but are not limited to: cyanate (—OCN).

N—S Valence Stabilizer #1: Examples of thioimidates, dithioimidates, polythioimidates, and derivatives of thioimidic acid (N—S bidentates and N—S tetradentates) that meet the requirements for use as "narrow band" valence stabilizers for $Co^{+3}$ include, but are not limited to: S-methyl formathioimidate; S-ethyl formathioimidate; S-methyl acetathioimidate; S-ethyl acetathioimidate; S-methyl benzthioimidate; S-ethyl benzthioimidate; S-methyl cyclohexylthioimidate; S-ethyl cyclohexylthioimidate; S-methyl pentafluorobenzthioimidate; S-ethyl pentafluorobenzthioimidate; S-methyl 2-pyridylthioimidate; S-ethyl 2-pyridylthioimidate; S,S'-dimethyl benzdithioimidate; S,S'-dimethyl tetrafluorobenzdithioimidate; 2-iminothiolane; and 2-iminotetrahydrothiopyran. [Note: Many thioimidate complexes are decomposed by water, but their stability can be enhanced through the use of fluorinated solubility control anions (e.g. $PF_{6-}$).]

N—S Valence Stabilizer #2: Examples ofthioguanylureas, guanidinothioureas, bis(thioguanylureas), bis(guanidinothioureas, poly(thioguanylureas), and poly(guanidinothioureas) (N—S Bidentates and N—S Tetradentates) that meet the requirements for use as "narrow band" valence stabilizers for $Co^{+3}$ include, but are not limited to: thioguanylurea (amidinothiourea); guanidinothiourea; methylthioguanylurea; ethylthioguanylurea; isopropylthioguanylurea; butylthioguanylurea; benzylthioguanylurea; phenylthioguanylurea; tolylthioguanylurea; naphthylthioguanylurea; cyclohexylthioguanylurea; norbornylthioguanylurea; adamantylthioguanylurea; dimethylthioguanylurea; diethylthioguanylurea; diisopropylthioguanylurea; dibutylthioguanylurea; dibenzylthioguanylurea; diphenylthioguanylurea; ditolylthioguanylurea; dinaphthylthioguanylurea; dicyclohexylthioguanylurea; dinorbornylthioguanylurea; diadamantylthioguanylurea; ethylenebis(thioguanylurea); propylenebis(thioguanylurea); phenylenebis(thioguanylurea); piperazinebis(thioguanylurea); oxalylbis(thioguanylurea); malonylbis(thioguanylurea); succinylbis(thioguanylurea); and phthalylbis (thioguanylurea). [Note: thioguanylureas generally tend to favor lower oxidation states in complexed metals.]

N—S Valence Stabilizer #3: Examples of amidinothioamides, guanidinothioamides, bis(amidinothioamides), bis (guanidinothioamides), poly(amidinothioamides), and poly (guanidinothioamides) (including both N-amidinothioamides and 2-amidinothioacetamides) (N—S Bidentates, N—S Tridentates, and N—S Tetradentates) that meet the requirements for use as "narrow band" valence stabilizers for $Co^{+3}$ include, but are not limited to: amidinothioacetamide; guanidinothioamide, amidinothiopropanamide; amidinothiobutanamide; amidinothiobenzamide; amidinothiotoluamide; amidinothiocyclohexamide; N-methylamidinothioacetamide; N-ethylamidinothiopropanamide; N-propylamidinothiobutanamide; N-phenylamidinothiobenzamide; N-tolylamidinothiotoluamide; N-cyclohexylamidinothiocyclohexamide; bis(amidinothiooxamide); bis(amidinothiomalonamide); bis(amidinothiosuccinamide); bis(amidinothiophthalamide); 2-amidinothioacetamide (thiomalonamamidine); N-methyl-2-amidinothioacetamide; N-ethyl-2-amidinothioacetamide; N-phenyl-2-amidinothioacetamide; N-benzyl-2-amidinothioacetamide; N-cyclohexyl-2-amidinothioacetamide; N,N'-dimethyl-2-amidinothioacetamide; N,N'-diethyl-2-amidinothioacetamide; N,N'-diphenyl-2-amidinothioacetamide; N,N'-dibenzyl-2-amidinothioacetamide; and N,N'-dicyclohexyl-2-amidinothioacetamide. [Note: amidinothioamides generally tend to favor lower oxidation states in complexed metals.]

N—S Valence Stabilizer #4: Examples of imidoylthioamides, bis(imidoylthioamides), and poly(imidoylthioamides) (N—S Bidentates, N—S Tridentates, and N—S Tetradentates) that meet the requirements for use as "narrow band" valence stabilizers for $Co^{+3}$ include, but are not limited to: acetimidoylthioacetamide; acetimidoylthiopropanamide; acetimidoylthiobutanamide; acetimidoylthiobenzamide; acetimidolylthiotoluamide; acetimidoylthiocyclohexamide; propimidoylthiopropanamide; butimidoylthiobutanamide; benzimidoylthiobenzamide; ethylenebis(acetimidoylthioacetamide); propylenebis(acetimidoylthioacetamide); and phenylenebis(acetimidoylthioacetamide). [Note: imidoylthioamides generally tend to favor lower oxidation states in complexed metals.]

N—S Valence Stabilizer #5: Examples of thioureas, bis (thioureas), and poly(thioureas), including thiourylene complexes (N—S bidentates and N—S tetradentates) that meet the requirements for use as "narrow band" valence stabilizers for $Co^{+3}$ include, but are not limited to: thiourea; methylthiourea; ethylthiourea; isopropylthiourea; benzylthiourea; phenylthiourea; cyclohexylthiourea; naphthylthiourea (ntu); biphenylthiourea; norbornylthiourea; adamantylthiourea; N,N'-dimethylthiourea; N,N'-diethylthiourea; N,N'-diisopropylthiourea; N,N'-dibenzylthiourea; N,N'-dicyclohexylthiourea; N,N'dinapthylthiourea; N,N'-dibiphenylthiourea; N,N'-dinorbornylthiourea; N,N'-diadamantylthiourea; tetramethylthiourea; ethylenethiourea (2-imidazolidinethione)(etu); 4,5-dihydroxy-2-imidazolinethione (dhetu); propylenethiourea; N-(thiazol-2-yl)thiourea; diphenylphosphinothioyl thioureas; allylthiourea; N-allyl-N'-pyridylthiourea; N-allyl-N'-anisylthiourea; N-allyl-N'-naphthylthiourea; N-allyl-N'-phenylthiourea; thioglycoluril (acetylenethiourea); and bis(pyridylmethyl)thiourea. [Note: thioureas generally tend to favor lower oxidation states in complexed metals.]

N—S Valence Stabilizer #6: Examples of thiocarboxamides, bis(thiocarboxamides), and poly(thiocarboxamides), (N—S bidentates, N—S tridentates, and N—S tetradentates) that meet the requirements for use as "narrow band" valence stabilizers for $Co^{+3}$ include, but are not limited to: thiocarbamide (tu); thioacetamide (taa); thiopropionamide; thiobutanamide; thiobenzamide (1-phenylthioformamide)(tba); 1-naphthylthioformamide; 1-cyclohexylthioformamide); 1-norbornylthioformamide; 1-adamantylthioformamide; N,N-dimethylthioformamide; N,N-dimethylthioacetamide; pyridine-2-thiocarboxamide (thiopicolinamide); pyrazine-2,3-dithiocarboxamide; thionicotinamide; 2-thiophenethiocarboxamide; N,N-dimethylthiobenzamide; N-ethylthiocarbamide (N-etu); tetramethylthiocarbamide (tmtu); 2-thioacetamidothiazole (tatz); and polythioacrylamides. [Note: thiocarboxamides generally tend to favor lower oxidation states in complexed metals.]

N—S Valence Stabilizer #7: Examples of imidosulfurous diamides and bis(imidosulfurous diamides) (N—S Bidentates, N—S Tridentates, and N—S Tetradentates) that meet the requirements for use as "narrow band" valence stabilizers for $Co^{+3}$ include, but are not limited to: N,N'-diphenylimidosulfurous diamide; N,N'-dibenzylimidosulfurous diamide; and phenylenebis(imidosulfurous diamide). [Note: These complexes tend to hydrolyze unless stabilized with a fluorinated anionic solubility control agent. The sulfite ($S^{+4}$) valence of the sulfur atom makes stabilization of high valence metal ions much more difficult, though still possible.]

N—S Valence Stabilizer #8: Examples of sulfurdiimines, bis(sulfurdiimines), and poly(sulfurdiimines) (N—S Bidentates, N—S Tridentates, and N—S Tetradentates) that meet the requirements for use as "narrow band" valence stabilizers for $Co^{+3}$ include, but are not limited to: N,N'-diphenylsulfurdiimine; N,N'-dibenzylsulfurdiimine; and phenylenebis(sulfurdiimine). [Note: These complexes tend to hydrolyze unless stabilized with a fluorinated anionic solubility control agent. The sulfite ($S^{+4}$) valence of the sulfur atom makes stabilization of high valence metal ions much more difficult, though still possible.]

N—S Valence Stabilizer #9: Examples of phosphonimidothioic acid, phosphonimidodithioic acid, bis(phosphonimidothioic acid); bis(phosphonimidodithioic acid), and derivatives thereof (N—S Bidentates, N—S Tetradentates) that meet the requirements for use as "narrow band" valence stabilizers for $Co^{+3}$ include, but are not limited to: phosphonimidothioic acid, phosphonimidodithioic acid; O-phenylphosphonimidothioic acid; O-benzylphosphonimidothioic acid; O-cyclohexylphosphonimidothioic acid; O-norbornylphosphonimidothioic acid; S-phenylphosphonimidodithioic acid; S-benzylphosphonimidodithioic acid; S-cyclohexylphosphonimidodithioic acid; and S-norbornylphosphonimidodithioic acid. [Note: The phosphite ($p^{+3}$) valence of the phosphorus atom makes stabilization of high valence metal ions much more difficult, though still possible.]

N—S Valence Stabilizer #10: Examples of phosphonothioic diamides, bis(phosphonothioic diamides), and poly(phosphonothioic diamides) (N—S Bidentates and N—S Tetradentates) that meet the requirements for use as "narrow band" valence stabilizers for $Co^{+3}$ include, but are not limited to: phosphonothioic diamide, phosphonothioic dihydrazide, phosphonamidothioic hydrazide, N-phenylphosphonothioic diamide, N-benzylphosphonothioic diamide, N-cyclohexylphosphonothioic diamide, and N-norbornylphosphonothioic diamide. [Note: The phosphite ($P^{+3}$) valence of the phosphorus atom makes stabilization of high valence metal ions much more difficult, though still possible.]

N—S Valence Stabilizer #1: Examples of phosphonamidothioic acid, phosphonamidimidodithioic acid, bis(phosphonamidothioic acid), bis(phosphonamidimidodithioic acid), poly(phosphonamidothioic acid), and poly(phosphonamidimidodithioic acid), and derivatives thereof (N—S Bidentates and N—S Tetradentates) that meet the requirements for use as "narrow band" valence stabilizers for $Co^{+3}$ include, but are not limited to: phosphonamidothioic acid, phosphonamidimidodithioic acid, phosphonohydrazidodithioic acid, phosphonohydrazidothioic acid, S-phenylphosphonamidimidodithioic acid, S-benzylphosphonamidimidodithioic acid, S-cyclohexylphosphonamidimidodithioic acid, and S-norbornylphosphonamidimidodithioic acid. [Note: The phosphite ($p^{+3}$) valence of the phosphorus atom makes stabilization of high valence metal ions much more difficult, though still possible.]

N—S Valence Stabilizer #12: Examples of beta-aminothiones (N-substituted 3-amino-2-propenethioaldehydes), bis(beta-aminothiones), and poly(beta-aminothiones) (N—S Bidentates and N—S Tetradentates) that meet the requirements for use as "narrow band" valence stabilizers for $Co^{+3}$ include, but are not limited to: 4-methylamino-3-penten-2-thione; 4-ethylamino-3-penten-2-thione; 4-isopropylamino-3-penten-2-thione; 4-phenylamino-3-penten-2-thione; 4-naphthylamino-3-penten-2-thione; 4-cyclohexylamino-3-penten-2-thione; 4-norbornylamino-3-penten-2-thione; 4-hydroxyamino-3-penten-2-thione; 3-methylamino-1-phenyl-2-butenethioaldehydel; 3-ethylamino-1-phenyl-2-butenethioaldehyde; 3-isopropylamino-1-phenyl-2-butenethioaldehyde; 3-phenylamino-1-phenyl-2-butenethioaldehyde; 3-naphthylamino-1-phenyl-2-butenethioaldehyde; 3-cyclohexylamino-1-phenyl-2-butenethioaldehyde; 3-norbornylamino-1-phenyl-2-butenethioaldehyde; 3-hydroxyamino-1-phenyl-2-butenethioaldehyde; 3-phenylamino-1,3-diphenyl-2-propenethioaldehyde; 3-cyclohexylamino-1,3-dicyclohexyl-2-propenethioaldehyde; and 3-norbornylamino-1,3-dinorbornyl-2-propenethioaldehyde.

N—S Valence Stabilizer #13: Examples of 3-aminothioacrylamides (3-amino-2-thiopropenamides), 3,3-diaminothioacrylamides, bis(3-aminothioacrylamides), bis(3,3-diaminothioacrylamides), poly(3-aminothioacrylamides), and poly(3,3-diaminothioacrylamides) (N—S Bidentates and N—S Tetradentates) that meet the requirements for use as "narrow band" valence stabilizers for $Co^{+3}$ include, but are not limited to: 3-methylaminothioacrylamide; 3-ethylaminothioacrylamide, 3-isopropylaminothioacrylamide, 3-phenylaminothioacrylamide; 3-naphthylaminothioacrylamide; 3-cyclohexylaminothioacrylamide; 3-norbornylaminothioacrylamide; 3-hydroxyaminothioacrylamide; N-methyl-3-methylaminothioacrylamide; N-ethyl-3-ethylaminothioacrylamide, N-isopropyl-3-isopropylaminothioacrylamide, N-phenyl-3-phenylaminothioacrylamide; N-naphthyl-3-naphthylaminothioacrylamide; N-cyclohexyl-3-cyclohexylaminothioacrylamide; N-norbornyl-3-norbornylaminothioacrylamide; 3-amino-3-methylaminothioacrylamide; 3-amino-3-ethylaminothioacrylamide, 3-amino-3-isopropylaminothioacrylamide, 3-amino-3-phenylaminothioacrylamide; 3-amino-3-naphthylaminothioacrylamide; 3-amino-3-cyclohexylaminothioacrylamide; 3-amino-3-norbornylaminothioacrylamide; and 3-amino-3-hydroxyaminothioacrylamide.

N—S Valence Stabilizer #14: Examples of 3-aminothioacrylic acids (3-amino-2-thiopropenoic acids), 3-mercapto-3-aminothioacrylic acids, bis(3-aminothioacrylic acids), bis(3-mercapto-3-aminothioacrylic acids), poly(3-aminothioacrylic acids), and poly(3-mercapto-3-aminothioacrylic acids), and derivatives thereof (N—S Bidentates and N—S Tetradentates) that meet the requirements for use as "narrow band" valence stabilizers for $Co^{+3}$ include, but are not limited to: 3-aminothioacrylic acid; 3-mercapto-3-aminothioacrylic acid; 3-methylaminothioacrylic acid; 3-ethylaminothioacrylic acid; 3-isopropylaminothioacrylic acid; 3-phenylaminothioacrylic acid; 3-naphthylaminothioacrylic acid; 3-cyclohexylaminothioacrylic acid; 3-norbornylaminothioacrylic acid; 3-hydroxyaminothioacrylic acid; methyl 3-methylaminothioacrylate; ethyl 3-ethylaminothioacrylate; isopropyl 3-isopropylaminothioacrylate; benzyl 3-phenylaminothioacrylate; naphthyl 3-naphthylaminothioacrylate; cyclohexyl 3-cyclohexylaminothioacrylate; and norbornyl 3-norbornylaminothioacrylate.

N—S Valence Stabilizer #15: Examples of N-thioacyl benzylidenimines, bis(N-thioacyl benzylidenimines), and poly (N-thioacyl benzylidenimines) (N—S Bidentates and N—S Tetradentates) that meet the requirements for use as "narrow band" valence stabilizers for $Co^{+3}$ include, but are not limited to: N-thioformyl benzylidenimine, N-thioacetyl benzylidenimine; N-thiobenzoyl benzylidenimine; and N-pentafluorothiobenzoyl benzylidenimine.

N—S Valence Stabilizer #16: Examples of thiocarbonyl oximes, bis(thiocarbonyl oximes), and poly(thiocarbonyl oximes) (N—S Bidentates, N—S Tridentates, and N—S Tetradentates) that meet the requirements for use as "narrow band" valence stabilizers for $Co^{+3}$ include, but are not limited to: butane-3-thione-2-one monoxime); and diphenylethane-2-thione-1-one monoxime.

N—S Valence Stabilizer #17: Examples of mercapto oximes, bis(mercapto oximes), and poly(mercapto oximes) (including 2-sulfurheterocyclic oximes) (N—S Bidentates, N—S Tridentates, N—S Tetradentates, and N—S Hexadentates) that meet the requirements for use as "narrow band" valence stabilizers for $Co^{+3}$ include, but are not limited to: 3-mercaptobutan-2-one oxime; 4-mercaptohexan-3-one oxime; (1,2-diphenyl-2-mercaptoethanone oxime); 1,2-di(trifluoromethyl)-2-mercaptoethanone oxime; 1,2-dicyclohexyl-2-mercaptoethanone oxime; 1,2-dinorbornyl-2-mercaptoethanone oxime; 2-mercaptobenzaldehyde oxime; 2-mercapto-1-naphthaldehyde oxime; thiophene-2-aldoxime; methyl 2-thiophenyl ketoxime; and phenyl 2-thiophenyl ketoxime.

N—S Valence Stabilizer #18: Examples of 2-nitrothiophenols (2-nitrobenzenethiols) (N—S Bidentates) that meet the requirements for use as "narrow band" valence stabilizers for $Co^{+3}$ include, but are not limited to: 2-nitrothiophenol; 2,3-dinitrothiophenol; 2,4-dinitrothiophenol; 2,5-dinitrothiophenol; 2,6-dinitrothiophenol; 1-nitro-2-naphthalenethiol; and 2-nitro-1-naphthalenethiol.

N—S Valence Stabilizer #19: Examples of 2-nitrilothiophenols (2-nitrilobenzenethiols) (N—S Bidentates) that meet the requirements for use as "narrow band" valence stabilizers for $Co^{+3}$ include, but are not limited to: 2-cyanothiophenol; 2,3-dicyanothiophenol; 2,4-dicyanothiophenol; 2,5-dicyanothiophenol; 2,6-dicyanothiophenol; 1-cyano-2-naphthalenethiol; and 2-cyano-1-naphthalenethiol.

N—S Valence Stabilizer #20: Examples of thiohydrazides, bis(thiohydrazides), and poly(thiohydrazides) (N—S Bidentates and N—S Tetradentates) that meet the requirements for use as "narrow band" valence stabilizers for $Co^{+3}$ include, but are not limited to: thioformic hydrazide; thioacetic hydrazide; thiopropionic hydrazide; thiobenzoic hydrazide; thiophthalhydrazide; thiosalicylic hydrazide; thionaphthoic hydrazides; thionorbornaneacetic hydrazide; thionicotinic hydrazide; and thioisonicotinic hydrazide. [Note: Thiohydrazides prefer complexation with lower oxidation states in metal ions.]

N—S Valence Stabilizer #21: Examples of thiosemicarbazides, bis(thiosemicarbazides), and poly(thiosemicarbazides) (N—S Bidentates, N—S Tetradentates, and N—S Hexadentates) that meet the requirements for use as "narrow band" valence stabilizers for $Co^{+3}$ include, but are not limited to: thiosemicarbazide (tsc); thiosemicarbazide diacetic acid (tsda); 1-methylthiosemicarbazide (1 mts); 1-ethylthiosemicarbazide; 1-isopropylthiosemicarbazide; 1-phenylthiosemicarbazide (1 pts)(cryogenine); 1-benzylthiosemicarbazide; 1-cyclohexylthiosemicarbazide; 1-norbornylthiosemicarbazide; 4-methylthiosemicarbazide (4mts); 4-ethylthiosemicarbazide; 4-isopropylthiosemicarbazide; 4-phenylthiosemicarbazide (4-pts); 4-benzylthiosemicarbazide; 4-cyclohexylthiosemicarbazide; 4-norbornylthiosemicarbazide; nicotinic thiosemicarbazide; isonicotinic thiosemicarbazide; and 4-phenyl-1-benzenesulfonyl-3-thiosemicarbazide (pbst). [Note: Thiosemicarbazides prefer complexation with lower oxidation states in metal ions.]

N—S Valence Stabilizer #22: Examples of five-, seven-, or nine-membered macrocyclics, macrobicyclics, and macropolycyclics (including catapinands, cryptands, cyclidenes, and sepulchrates) wherein all binding sites are composed of nitrogen (usually amine or imine groups) or sulfur (usually thiols, mercaptans, or thiocarbonyls) and are not contained in component heterocyclic rings (N—S Tridentates, N—S Tetradentates, and N—S Hexadentates) that meet the requirements for use as "narrow band" valence stabilizers for $Co^{+3}$ include, but are not limited to: triazadithiacyclodecane ([10]ane$S_2N_3$); triazadithiacycloundecane ([11]ane$S_2N_3$); triazadithiacyclododecane ([12]ane$S_2N_3$); triazadithiacyclotridecane ([13]ane$S_2N_3$); triazadithiacyclotetradecane ([14]ane$S_2N_3$); triazadithiacyclopentadecane ([15]ane$S_2N_3$); thiomorpholine; and thiazolidine.

N—S Valence Stabilizer #23: Examples of five- or seven-membered macrocyclics, macrobicyclics, and macropolycyclics (including catapinands, cryptands, cyclidenes, and sepulchrates) wherein all binding sites are composed of nitrogen or sulfur and are contained in component heterocyclic rings (N—S Bidentates, N—S Tridentates, N—S Tetradentates, or N—S Hexadentates) that meet the requirements for use as "narrow band" valence stabilizers for $Co^{+3}$ include, but are not limited to: dithiopyrantripyridines; dithiophenetripyrroles; trithiopyrantetrapyridines; and trithiophenetetrapyrroles.

N—S Valence Stabilizer #24: Examples of five-, seven-, or nine-membered macrocyclics, macrobicyclics, and macropolycyclics (including catapinands, cryptands, cyclidenes, and sepulchrates) wherein all binding sites are composed of nitrogen or sulfur and are contained in a combination of heterocyclic rings and amine, imine, thiol, mercapto, or thiocarbonyl groups (N—S Bidentates, N—S Tridentates, N—S Tetradentates, or N—S Hexadentates) that meet the requirements for use as "narrow band" valence stabilizers for $Co^{+3}$ include, but are not limited to: azathiapentaphyrins; diazadithiapentaphyrins; azathiapentaphyrins; and diazadithiapentaphyrins.

N—O Valence Stabilizer #1: Examples of imidates, diimidates, polyimidates, and derivatives of imidic acid (N—O bidentates and N—O tetradentates) that meet the requirements for use as "narrow band" valence stabilizers for $Co^{+3}$ include, but are not limited to: O-methyl formimidate; O-ethyl formimidate; O-methyl acetimidate; O-ethyl acetimidate; O-methyl benzimidate; O-ethyl benzimidate; O-methyl cyclohexylimidate; O-ethyl cyclohexylimidate; O-methyl pentafluorobenzimidate; O-ethyl pentafluorobenzimidate; O-methyl 2-pyridylimidate; O-ethyl 2-pyridylimidate; O,O'-dimethyl benzdiimidate; O,O'-dimethyl tetrafluorobenzdiimidate; 2-iminotetrahydrofuran; and 2-iminotetrahydropyran. [Note: Most imidate complexes are decomposed by water, but their stability can be enhanced through the use of fluorinated solubility control anions (e.g. $PF_6$—).]

N—O Valence Stabilizer #2: Examples ofpseudoureas, bis(pseudoureas), and poly(pseudoureas) (N—O bidentates and N—O tetradentates) that meet the requirements for use as "narrow band" valence stabilizers for $Co^{+3}$ include, but are not limited to: O-methyl pseudourea; O-ethyl pseudourea; O-isopropylpseudourea; O-benzyl pseudourea; O-cyclohexyl pseudourea; O-norbornyl pseudourea; O-pentafluorobenzyl pseudourea; N-methyl pseudourea; N-ethyl pseudourea; N-isopropyl pseudourea; N-benzyl pseudourea; N-cyclohexyl pseudourea; N-norbornyl pseudourea; and N-pentafluorobenzyl pseudourea.

N—O Valence Stabilizer #3: Examples of 2-amidinoacetates, bis(2-amidinoacetates), and poly(2-amidinoacetates) (N—O Bidentates and N—O Tetradentates) that meet the requirements for use as "narrow band" valence stabilizers for $Co^{+3}$ include, but are not limited to: N-methyl-2-amidinoacetate; O-methyl-2-amidinoacetate; N-benzyl-2-amidinoacetate; and O-benzyl-2-amidinoacetate. [Note: many 2-amidinoacetates tend to hydrolyze in water. This can be minimized through the use of fluorinated solubility control anions such as $PF_6$—.]

N—O Valence Stabilizer #4: Examples of ureas, bis(ureas), and poly(ureas), including urylene complexes (N—O bidentates and N—O tetradentates) that meet the requirements for use as "narrow band" valence stabilizers for $Co^{+3}$ include, but are not limited to: urea; methylurea; ethylurea; isopropylurea; benzylurea; cyclohexylurea; naphthylurea; biphenylurea; norbornylurea; adamantylurea; N,N'-dimethylurea; N,N'-diethylurea; N,N'-diisopropylurea; N,N'-dibenzylurea; N,N'-dicyclohexylurea; N,N'dinapthylurea; N,N'-dibiphenylurea; N,N'-dinorbornylurea; N,N'-diadamantylurea; ethyleneurea (2-imidazolidone); propyleneurea; glycoluril (acetyleneurea); and N,N'-bis(4-nitrophenyl)urea.

N—O Valence Stabilizer #5: Examples of phosphonimidic acid, bis(phosphonimidic acid), poly(phosphonimidic acid), and derivatives thereof (N—O Bidentates and N—O Tetradentates) that meet the requirements for use as "narrow band" valence stabilizers for $Co^{+3}$ include, but are not limited to: phosphonimidic acid; O-phenylphosphonimidic acid; O-benzylphosphonimidic acid; O-cyclohexylphosphonimidic acid; and O-norbornylphosphonimidic acid. [Note: The phosphite ($P^{+3}$) valence of the phosphorus atom makes stabilizization of high valence metal ions much more difficult, though still possible.]

N—O Valence Stabilizer #6: Examples of phosphonamidic acid, phosphonic diamide, bis(phosphonamidic acid), bis(phosphonic diamide), poly(phosphonamidic acid), poly(phosphonic diamide), and derivatives thereof (N—O Bidentates and N—O Tetradentates) that meet the requirements for use as "narrow band" valence stabilizers for $Co^{+3}$ include, but are not limited to: phosphonamidic acid, phosphonic diamide, phosphonamidic hydrazide, phosphonic dihydrazide, O-phenylphosphonamidic acid, O-benzylphosphonamidic acid, O-cyclohexylphosphonamidic acid, O-norbornylphosphonamidic acid, N-benzylphosphonic diamide, N-phenylphosphonic diamide, N-cyclohexylphosphonic diamide, and N-norbornylphosphonic diamide. [Note: The phosphite ($P^{+3}$) valence of the phosphorus atom makes stabilization of high valence metal ions much more difficult, though still possible.]

N—O Valence Stabilizer #7: Examples of beta-ketoamines (N-substituted 3-amino-2-propenals), bis(beta-ketoamines), and poly(beta-ketoamines) (N—O Bidentates and N—O Tetradentates) that meet the requirements for use as "narrow band" valence stabilizers for $Co^{+3}$ include, but are not limited to: 4-methylamino-3-penten-2-one; 4-ethylamino-3-penten-2-one; 4-isopropylamino-3-penten-2-one; 4-phenylamino-3-penten-2-one; 4-naphthylamino-3-penten-2-one; 4-cyclohexylamino-3-penten-2-one; 4-norbornylamino-3-penten-2-one; 4-hydroxyamino-3-penten-2-one; 3-methylamino-1-phenyl-2-butenal; 3-ethylamino-1-phenyl-2-butenal; 3-isopropylamino-1-phenyl-2-butenal; 3-phenylamino-1-phenyl-2-butenal; 3-naphthylamino-1-phenyl-2-butenal; 3-cyclohexylamino-1-phenyl-2-butenal; 3-norbornylamino-1-phenyl-2-butenal; 3-hydroxyamino-1-phenyl-2-butenal; 3-phenylamino-1,3-diphenyl-2-propenal; 3-cyclohexylamino-1,3-dicyclohexyl-2-propenal; 3-norbornylamino-1,3-dinorbornyl-2-propenal; 2,2'-pyridil; alpha-pyridoin; 4-aminoantipyrine (aap); beta-phenylaminopropiophenone; and polyaminoquinones (PAQs).

N—O Valence Stabilizer #8: Examples of 3-aminoacrylamides (3-amino-2-propenamides), 3,3-diaminoacrylamides, bis(3-aminoacrylamides), bis(3,3-diaminoacrylamides), poly(3-aminoacrylamides), and poly(3,3-diaminoacrylamides) (N—O Bidentates and N—O Tetradentates) that meet the requirements for use as "narrow band" valence stabilizers for $Co^{+3}$ include, but are not limited to: 3-methylaminoacrylamide; 3-ethylaminoacrylamide, 3-isopropylaminoacrylamide, 3-phenylaminoacrylamide; 3-naphthylaminoacrylamide; 3-cyclohexylaminoacrylamide; 3-norbornylaminoacrylamide; 3-hydroxyaminoacrylamide; N-methyl-3-methylaminoacrylamide; N-ethyl-3-ethylaminoacrylamide, N-isopropyl-3-isopropylaminoacrylamide, N-phenyl-3-phenylaminoacrylamide; N-naphthyl-3-naphthylaminoacrylamide; N-cyclohexyl-3-cyclohexylaminoacrylamide; N-norbornyl-3-norbornylaminoacrylamide;

3-amino-3-methylaminoacrylamide; 3-amino-3-ethylaminoacrylamide, 3-amino-3-isopropylaminoacrylamide, 3-amino-3-phenylaminoacrylamide; 3-amino-3-naphthylaminoacrylamide; 3-amino-3-cyclohexylaminoacrylamide; 3-amino-3-norbornylaminoacrylamide; and 3-amino-3-hydroxyaminoacrylamide.

N—O Valence Stabilizer #9: Examples of 3-aminoacrylic acids (3-amino-2-propenoic acids), 3-hydroxy-3-aminoacrylic acids, bis(3-aminoacrylic acids), bis(3-hydroxy-3-aminoacrylic acids), poly(3-aminoacrylic acids), and poly (3-hydroxy-3-aminoacrylic acids), and derivatives thereof (N—O Bidentates and N—O Tetradentates) that meet the requirements for use as "narrow band" valence stabilizers for $Co^{+3}$ include, but are not limited to: 3-aminoacrylic acid; 3-hydroxy-3-aminoacrylic acid; 3-methylaminoacrylic acid; 3-ethylaminoacrylic acid; 3-isopropylaminoacrylic acid; 3-phenylaminoacrylic acid; 3-naphthylaminoacrylic acid; 3-cyclohexylaminoacrylic acid; 3-norbornylaminoacrylicacid; 3-hydroxyaminoacrylic acid; methyl 3-methylaminoacrylate; ethyl 3-ethylaminoacrylate; isopropyl 3-isopropylaminoacrylate; benzyl 3-phenylaminoacrylate; naphthyl 3-naphthylaminoacrylate; cyclohexyl 3-cyclohexylaminoacrylate; and norbornyl 3-norbornyl aminoacrylate.

N—O Valence Stabilizer #10: Examples ofN-acyl benzylidenimines, bis(N-acyl benzylidenimines), and poly(N-acyl benzylidenimines) (N—O Bidentates and N—O Tetradentates) that meet the requirements for use as "narrow band" valence stabilizers for $Co^{+3}$ include, but are not limited to: N-formyl benzylidenimine, N-acetyl benzylidenimine; N-benzoyl benzylidenimine; and N-pentafluorobenzoyl benzylidenimine.

N—O Valence Stabilizer #11: Examples of 2-nitroanilines (N—O Bidentates) that meet the requirements for use as "narrow band" valence stabilizers for $Co^{+3}$ include, but are not limited to: 2-nitroaniline; 2,6-dintroaniline; 2-nitrophenylenediamine; 2-nitrophenylenetriamine; 2-nitro-1-aminonaphthalene; 1-nitro-2-aminonaphthalene; nitrodiaminonaphthalene; and dipicrylamine.

N—O Valence Stabilizer #12: Examples of 2-nitrilophenols (N—O Bidentates) that meet the requirements for use as "narrow band" valence stabilizers for $Co^{+3}$ include, but are not limited to: 2-cyanophenol; 2,3-dicyanophenol; 2,4-dicyanophenol; 2,5-dicyanophenol; 2,6-dicyanophenol; 1-cyano-2-naphthol; and 2-cyano-1-naphthol. Also includes acylcyanamides.

N—O Valence Stabilizer #13: Examples of amine N-oxides and N-diazine oxides (azoxy compounds) (N—O Bidentates, N—O Tridentates, and N—O Tetradentates) that meet the requirements for use as "narrow band" valence stabilizers for $Co^{+3}$ include, but are not limited to: pyridine N-oxide (pyNO or PNO); picoline N-oxide (picNO); lutidine N-oxide (lutNO or LNO); collidine N-oxide (collNO or CNO); quinoline N-oxide (QuinNO or QNO); isoquinoline N-oxide (isoQuinNO or IQNO); acridine N-oxide (AcrNO or ANO); picolinic acid N-oxide (PicANO); pyridinethiolate N-oxide (PTNO); adenine N-oxide; adenosine N-oxide; 1,10-phenanthroline mono-N-oxide (phenNO); 1,10-phenanthroline N,N-dioxide (phen2NO); bipyridyl mono-N-oxide (bipyNO); bipyridyl N,N-dioxide (bipy2NO); pyrazine mono-N-oxide (pyzNO); pyrazine N,N-dioxide (pyz2NO); pyrimidine mono-N-oxide (pymNO); pyrimidine N,N-dioxide (pym2NO); pyridazine mono-N-oxide (pdzNO); pyridazine N,N-dioxide (pdz2NO); quinoxaline mono-N-oxide (qxNO); quinoxaline N,N-dioxide (qx2NO); phenazine mono-N-oxide (phzNO); phenazine N,N-dioxide (phz2NO); 2,3-di(pyridine N-oxide)quinoxaline (dpoq); inosine N-oxide; 4,4'-bipyridine N,N-dioxide; 1-hydroxypyrazole 2-oxide; 1-hydroxyimidazole 3-oxide; 2,2'-diimidazyl 3,3'-dioxide; imidazole N-oxides (1-hydroxyimidazole-3-N-oxides); N-benzylidine aniline N-oxide; N-(naphthylidene) aniline N-oxide; N-(hydroxybenzylidene) aniline N-oxide; and 2,2'-dibenzimidazyl 3,3'-dioxide (indigo N,N-dioxide) for amine N-oxides; and azoxybenzene; phthalazine N-oxide; benzocinnoline N-oxide; and bipyrazinyl N-oxide as N-diazine oxide examples.

N—O Valence Stabilizer #14: Examples of hydrazides, bis(hydrazides), and poly(hydrazides) (N—O Bidentates and N—O Tetradentates) that meet the requirements for use as "narrow band" valence stabilizers for $Co^{+3}$ include, but are not limited to: formic hydrazide; acetic hydrazide; propionic hydrazide; benzoic hydrazide; phthalhydrazide; salicylic hydrazide; naphthoic hydrazides; norbornaneacetic hydrazide; nicotinic hydrazide; and isonicotinic hydrazide (isoniazid). [Note: Hydrazides prefer complexation with lower oxidation states in metal ions.]

N—O Valence Stabilizer #15: Examples of semicarbazides, bis(semicarbazides), and poly(semicarbazides) (N—O Bidentates, N—O Tetradentates, and N—O Hexadentates) that meet the requirements for use as "narrow band" valence stabilizers for $Co^{+3}$ include, but are not limited to: semicarbazide (sc); semicarbazide diacetic acid (sda); 1-methylsemicarbazide; 1-ethylsemicarbazide; 1-isopropylsemicarbazide; 1-phenylsemicarbazide; 1-benzylsemicarbazide; 1-cyclohexylsemicarbazide; 1-norbornylsemicarbazide; 4-methylsemicarbazide; 4-ethylsemicarbazide; 4-isopropylsemicarbazide; 4-phenylsemicarbazide; 4-benzylsemicarbazide; 4-cyclohexylsemicarbazide; 4-norbornylsemicarbazide; nicotinic semicarbazide; and isonicotinic semicarbazide. [Note: Semicarbazides prefer complexation with lower oxidation states in metal ions.]

N—O Valence Stabilizer #16: Examples of five-, seven-, or nine-membered macrocyclics, macrobicyclics, and macropolycyclics (including catapinands, cryptands, cyclidenes, and sepulchrates) wherein all binding sites are composed of nitrogen (usually amine or imine groups) or oxygen (usually hydroxy, carboxy, or carbonyl groups) and are not contained in component heterocyclic rings (N—O Tridentates, N—O Tetradentates, and N—O Hexadentates) that meet the requirements for use as "narrow band" valence stabilizers for $Co^{+3}$ include, but are not limited to: triazadioxacyclodecane ([10]ane$O_2N_3$); triazadioxacycloundecane ([11]ane$O_2N_3$); triazadioxacyclododecane ([12]ane$O_2N_3$); triazadioxacyclotridecane ([13]ane$O_2N_3$); triazadioxacyclotetradecane ([14]ane$O_2N_3$); and triazadioxacyclopentadecane ([15]ane$O_2N_3$).

N—O Valence Stabilizer #17: Examples offive- or seven-membered macrocyclics, macrobicyclics, and macropolycyclics (including catapinands, cryptands, cyclidenes, and sepulchrates) wherein all binding sites are composed of nitrogen or oxygen and are contained in component heterocyclic rings (N—O Bidentates, N—O Tridentates, N—O Tetradentates, or N—O Hexadentates) that meet the requirements for use as "narrow band" valence stabilizers for $Co^{+3}$ include, but are not limited to: dipyrantripyridines; difurantripyrroles; tripyrantetrapyridines; and trifurantetrapyrroles.

N—O Valence Stabilizer #18: Examples of five-, seven-, or nine-membered macrocyclics, macrobicyclics, and macropolycyclics (including catapinands, cryptands, cyclidenes, and sepulchrates) wherein all binding sites are composed of nitrogen or oxygen and are contained in a combination of heterocyclic rings and amine, imine, hydroxy, carboxy, or carbonyl groups (N—O Bidentates, N—O Tridentates, N—O Tetradentates, or N—O Hexadentates) that meet the requirements for use as "narrow band" valence stabilizers for $Co^{+3}$ include, but are not limited to: azaoxapentaphyrins; diazadioxapentaphyrins; azaoxapentaphyrins; and diazadioxapentaphyrins.

S—O Valence Stabilizer #1: Examples of thiobiurets (thioimidodicarbonic diamides), thioisobiurets, thiobiureas, thiotriurets, thiotriureas, bis(thiobiurets), bis(thioisobiurets), bis(thiobiureas), poly(thiobiurets), poly(thioisobiurets), and poly(thiobiureas) (S—O Bidentates, S—O Tridentates, S—O Tetradentates) that meet the requirements for use as "narrow band" valence stabilizers for $Co^{+3}$ include, but are not limited to: thiobiuret, thioisobiuret, thiobiurea, thiotriuret, thiotriurea, nitrothiobiuret, dinitrothiobiuret, aminothiobiuret, diaminothiobiuret, oxythiobiuret, dioxythiobiuret, cyanothiobiuret, methylthiobiuret, ethylthiobiuret, isopropylthiobiuret, phenylthiobiuret, benzylthiobiuret, cyclohexylthiobiuret, norbornylthiobiuret, adamantylthiobiuret, dimethylthiobiuret, diethylthiobiuret, diisopropylthiobiuret, diphenylthiobiuret, dibenzylthiobiuret, dicyclohexylthiobiuret, dinorbornylthiobiuret, diadamantylthiobiuret' and 3-formamidino thiocarbamides.

S—O Valence Stabilizer #2: Examples of acylthioureas, aroylthioureas, thioacylureas, thioaroylureas, bis(acylthioureas), bis(aroylthioureas), bis(thioacylureas), bis(thioaroylureas), poly(thioacylthioureas), poly(thioaroylthioureas), poly(thioacylureas), and poly(thioaroylureas) (S—O Bidentates, S—O Tridentates, S—O Tetradentates) that meet the requirements for use as "narrow band" valence stabilizers for $Co^{+3}$ include, but are not limited to: thioformylurea, thioacetylurea, thiobenzoylurea, thiocyclohexoylurea, pentafluorothiobenzoylurea, acetylthiourea, benzoylthiourea, and cyclohexoylthiourea.

S—O Valence Stabilizer#3: Examples ofthioimidodialdehydes, thiohydrazidodialdehydes (thioacyl hydrazides), bis(thioimidodialdehydes), bis(thiohydrazidodialdehydes), poly(thioimidodialdehydes), and poly(thiohydrazidodialdehydes) (S—O Bidentates, S—O Tridentates, S—O Tetradentates) that meet the requirements for use as "narrow band" valence stabilizers for $Co^{+3}$ include, but are not limited to: thiodiacetamide, thiodipropanamide, thiodibutanamide, thiodibenzamide, and thiodicyclohexamide.

S—O Valence Stabilizer #4: Examples ofthioimidodicarbonic acids, thiohydrazidodicarbonic acids, bis(thioimidodicarbonic acids), bis(thiohydrazidodicarbonic acids), poly(thioimidodicarbonic acids), poly(thiohydrazidodicarbonic acids) and derivatives thereof (S—O Bidentates, S—O Tridentates, S—O Tetradentates) that meet the requirements for use as "narrow band" valence stabilizers for $Co^{+3}$ include, but are not limited to: thioimidodicarbonic acid, thiohydrazidodicarbonic acid, O-phenylthioimidodicarbonic acid, O-benzylthioimidodicarbonic acid, O-cyclohexylthioimidodicarbonic acid, O-norbornylthioimidodicarbonic acid, O,O'-diphenylthioimidodicarbonic acid, O,O'-dibenzylthioimidodicarbonic acid, O,O'-dicyclohexylthioimidodicarbonic acid, O,O'-dinorbornylthioimidodicarbonic acid.

S—O Valence Stabilizer #5: Examples of 1,2-monothioketones (monothiolenes, monothio-alpha-ketonates), 1,2,3-monothioketones, 1,2,3-dithioketones, monothiotropolonates, ortho-monothioquinones, bis(1,2-monothioketones), and poly(1,2-monothioketones) (S—O Bidentates, S—O Tridentates, S—O Tetradentates) that meet the requirements for use as "narrow band" valence slabilizers for $Co^{+3}$ include, but are not limited to: monothiotropolone; 1,2-monothiobenzoquinone (o-monothioquinone); di-tert-butyl-1,2-monothiobenzoquinone; hexafluoro-1,2-monothiobenzoquinone; 1,2-monothionaphthoquinone; 9,10-monothiophenanthroquinone; monothiosquaric acid; monothiodeltic acid; monothiocroconic acid; and monothiorhodizonic acid.

S—O Valence Stabilizer #6: Examples of trithioperoxydicarbonic diamides, bis(trithioperoxydicarbonic diamides), and poly(trithioperoxydicarbonic diamides) (S—O Bidentates, S—O Tridentates, S—O Tetradentates) that meet the requirements for use as "narrow band" valence stabilizers for $Co^{+3}$ include, but are not limited to: trithioperoxydicarbonic diamide; N-phenyltrithioperoxydicarbonic diamide; N-benzyltrithioperoxydicarbonic diamide; N-cyclohexyltrithioperoxydicarbonic diamide; N-norbornyltrithioperoxydicarbonic diamide; N,N'-diphenyltrithioperoxydicarbonic diamide; N,N'-dibenzyltrithioperoxydicarbonic diamide; N,N'-dicyclohexyltrithioperoxydicarbonic diamide; and N,N'-dinorbornyltrithioperoxydicarbonic diamide.

S—O Valence Stabilizer #7: Examples of dithiodicarbonic acids, bis(dithiodicarbonic acids), poly(dithiodicarbonic acids), and derivatives thereof (S—O Bidentates, S—O Tridentates, S—O Tetradentates) that meet the requirements for use as "narrow band" valence stabilizers for $Co^{+3}$ include, but are not limited to: dithiodicarbonic acid, O-phenyldithiodicarbonic acid, O-benzyldithiodicarbonic acid, O-cyclohexyldithiodicarbonic acid, O-norbornyldithiodicarbonic acid, O,O'-diphenyldithiodicarbonic acid, O,O'-dibenzyldithiodicarbonic acid, O,O'-dicyclohexyldithiodicarbonic acid, and O,O'-dinorbornyldithiodicarbonic acid.

S—O Valence Stabilizer #8: Examples oftrithioperoxydicarbonic acids, bis(trithioperoxydicarbonic acids), poly(trithioperoxydicarbonic acids), and derivatives thereof (S—O Bidentates, S—O Tridentates, S—O Tetradentates) that meet the requirements for use as "narrow band" valence stabilizers for $Co^{+3}$ include, but are not limited to: trithioperoxydicarbonic acid, O-phenyltrithioperoxydicarbonic acid; O-benzyltrithioperoxydicarbonic acid; O-cyclohexyltrithioperoxydicarbonic acid; O-norbornyltrithioperoxydicarbonic acid; O,O'-diphenyltrithioperoxydicarbonic acid; O,O'-dibenzyltrithioperoxydicarbonic acid; O,O'-dicyclohexyltrithioperoxydicarbonic acid; and O,O'-dinorbornyltrithioperoxydicarbonic acid.

S—O Valence Stabilizer #9: Examples of monothioperoxydiphosphoramides, bis(monothioperoxydiphosphoramides), and poly(monothioperoxydiphosphoramides) (S—O Bidentates, S—O Tridentates, S—O Tetradentates) that meet the requirements for use as "narrow band" valence stabilizers for $Co^{+3}$ include, but are not limited to: monothioperoxydiphosphoramide, N-methylmonothioperoxydiphosphoramide, N-isopropylmonothioperoxydiphosphoramide, N-tert-butylmonothioperoxydiphosphoramide, N-phenylmonothioperoxydiphosphoramide, N-pentafluorophenylmonothioperoxydiphosphoramide, N-benzylmonothioperoxydiphosphoramide, N-cyclohexylmonothioperoxydiphosphoramide, N-norbornylmonothioperoxydiphosphoramide, N,N'''-dimethylmonothioperoxydiphosphoramide, N,N'''-diisopropylmonothioperoxydiphosphoramide, N,N'''-di-tert-butylmonothioperoxydiphosphoramide, N,N'''-diphenylmonothioperoxydiphosphoramide, N,N'''- dipentafluorophenylmonothioperoxydiphosphoramide, N,N'''-dibenzylmonothioperoxydiphosphoramide, N,N'''-dicyclobexylmonothioperoxydiphosphoramide, and N,N'''-dinorbornylmonothioperoxydiphosphoramide.

S—O Valence Stabilizer #10: Examples of monothioperoxydiphosphoric acids, bis(monothioperoxydiphosphoric acids), poly(monothioperoxydiphosphoric acids), and derivatives thereof (S—O Bidentates, S—O Tridentates, S—O Tetradentates) that meet the requirements for use as "narrow band" valence stabilizers for $Co^{+3}$ include, but are not limited to: monothioperoxydiphosphoric acid, methylmonothioperoxydiphosphoric acid, isopropylmonothioperoxydiphosphoric acid, tert-butylmonothioperoxydiphosphoric acid, phenylmonothioperoxydiphosphoric acid, pentafluorophenylmonothioperoxydiphosphoric acid, benzylmonothioperoxydiphosphoric acid, cyclohexylmonothioperoxydiphosphoric acid, norbornylmonothioperoxydiphosphoric acid, dimethylmonothioperoxydiphosphoric acid, diisopropylmonothioperoxydiphosphoric acid, di-tert-butylmonothioperoxydiphosphoric acid, diphenylmonothioperoxydiphosphoric acid, di-pentafluorophenylmonothioperoxydiphosphoric acid, dibenzylmonothioperoxydiphosphoric acid, dicyclohexylmonothioperoxydiphosphoric acid, and dinorbornylmonothioperoxydiphosphoric acid.

S—O Valence Stabilizer #11: Examples of monothioimidodiphosphonic acids, monothiohydrazidodiphosphonic acids, bis(monothioimidodiphosphonic acids), bis(monothiohydrazidodiphosphonic acids), poly(monothioimidodiphosphonic acids), poly(monothiohydrazidodiphosphonic acids), and derivatives thereof (S—O Bidentates, S—O Tridentates, S—O Tetradentates) that meet the requirements for use as "narrow band" valence stabilizers for $Co^{+3}$ include, but are not limited to: monothioimidodiphosphonic acid, methylmonothioimidodiphosphonic acid, isopropylmonothioimidodiphosphonic acid, tert-butylmonothioimidodiphosphonic acid, phenylmonothioimidodiphosphonic acid, pentafluorophenylmonothioimidodiphosphonic acid, benzylmonothioimidodiphosphonic acid, cyclohexylmonothioimidodiphosphonic acid, norbornylmonothioimidodiphosphonic acid, dimethylmonothioimidodiphosphonic acid, diisopropylmonothioimidodiphosphonic acid, di-tert-butylmonothioimidodiphosphonic acid, diphenylmonothioimidodiphosphonic acid, di-pentafluorophenylmonothioimidodiphosphonic acid, dibenzylmonothioimidodiphosphonic acid, dicyclohexylmonothioimidodiphosphonic acid, and dinorbornylmonothioimidodiphosphonic acid. [Note: The phosphite ($P^{+3}$) valence of the phosphorus atom makes stabilization of high valence metal ions much more difficult, though still possible.]

S—O Valence Stabilizer #12: Examples of monothioimidodiphosphonamides, monothiohydrazidodiphosphonamides, bis(monothioimidodiphosphonamides), bis(monothiohydrazidodiphosphonamides), poly(monothioimidodiphosphonamides), and poly(monothiohydrazidodiphosphonamides) (S—O Bidentates, S—O Tridentates, S—O Tetradentates) that meet the requirements for use as "narrow band" valence stabilizers for $Co^{+3}$ include, but are not limited to: monothioimidodiphosphonamide, N-methylmonothioimidodiphosphonamide, N-isopropylmonothioimidodiphosphonamide, N-tert-butylmonothioimidodiphosphonamide, N-phenylmonothioimidodiphosphonamide, N-pentafluorophenylmonothioimidodiphosphonamide, N-benzylmonothioimidodiphosphonamide, N-cyclohexylmonothioimidodiphosphonamide, N-norbornylmonothioimidodiphosphonamide, N,N'''-dimethylmonothioimidodiphosphonamide, N,N'''-diisopropylmonothioimidodiphosphonamide, N,N'''-di-tert-butylmonothioimidodiphosphonamide, N,N'''-diphenylmonothioimidodiphosphonamide, N,N'''-dipentafluorophenylmonothioimidodiphosphonamide, N,N'''-dibenzylmonothioimidodiphosphonamide, N,N'''-dicyclohexylmonothioimidodiphosphonamide, and N,N'''-dinorbornylmonothioimidodiphosphonamide. [Note: The phosphite ($P^{+3}$) valence of the phosphorus atom makes stabilization of high valence metal ions much more difficult, though still possible.]

S—O Valence Stabilizer #13: Examples of dithiodiphosphonamides, bis(dithiodiphosphonamides), and poly(dithiodiphosphonamides) (S—O Bidentates, S—O Tridentates, S—O Tetradentates) that meet the requirements for use as "narrow band" valence stabilizers for $Co^{+3}$ include, but are not limited to: dithiodiphosphonamide, N-methyldithiodiphosphonamide, N-isopropyldithiodiphosphonamide, N-tert-butyldithiodiphosphonamide, N-phenyldithiodiphosphonamide, N-pentafluorophenyldithiodiphosphonamide, N-benzyldithiodiphosphonamide, N-cyclohexyldithiodiphosphonamide, N-norbornyldithiodiphosphonamide, N,N'''-dimethyldithiodiphosphonamide, N,N'''-diisopropyldithiodiphosphonamide, N,N'''-di-tert-butyldithiodiphosphonamide, N,N'''-diphenyldithiodiphosphonamide, N,N'''-di-pentafluorophenyldithiodiphosphonamide, N,N'''-dibenzyldithiodiphosphonamide, N,N'''-dicyclohexyldithiodiphosphonamide, and N,N'''-dinorbornyldithiodiphosphonamide. [Note: The phosphite ($P^{+3}$) valence of the phosphorus atom makes stabilization of high valence metal ions much more difficult, though still possible.]

S—O Valence Stabilizer#14: Examples of dithiodiphosphonic acids, bis(dithiodiphosphonic acids), poly(dithiodiphosphonic acids), and derivatives thereof (S—O Bidentates, S—O Tridentates, S—O Tetradentates) that meet the requirements for use as "narrow band" valence stabilizers for $Co^{+3}$ include, but are not limited to: dithiodiphosphonic acid, methyldithiodiphosphonic acid, isopropyldithiodiphosphonic acid, tert-butyldithiodiphosphonic acid, phenyldithiodiphosphonic acid, pentafluorophenyldithiodiphosphonic acid, benzyldithiodiphosphonic acid, cyclohexyldithiodiphosphonic acid, norbornyldithiodiphosphonic acid, dimethyldithiodiphosphonic acid, diisopropyldiothiodiphosphonic acid, di-tert-butyldithiodiphosphonic acid, diphenyldithiodiphosphonic acid, di-pentafluorophenyldithiodiphosphonic acid, dibenzyldithiodiphosphonic acid, dicyclohexyldithiodiphosphonic acid, and dinorbornyldithiodiphosphoric acid. [Note: The phosphite ($P^{+3}$) valence of the phosphorus atom makes stabilization of high valence metal ions much more difficult, though still possible.]

S—O Valence Stabilizer #15: Examples of monothioperoxydiphosphonamides, bi s(monothioperoxydiphosphonamides), and poly(monothioperoxydiphosphonamides) (S—O Bidentates, S—O Tridentates, S—O Tetradentates) that meet the requirements for use as "narrow band" valence stabilizers for $Co^{+3}$ include, but are not limited to: monothioperoxydiphosphonamide, N-methylmonothioperoxydiphosphonamide, N-isopropylmonothioperoxydiphosphonamide, N-tert-butylmonothioperoxydiphosphonamide, N-phenylmonothioperoxydiphosphonamide, N-pentafluorophenylmonothioperoxydiphosphonamide, N-benzylmonothioperoxydiphosphonamide, N-cyclohexylmonothioperoxydiphosphonamide, N-norbornylmonothioperoxydiphosphonamide, N,N'''-dimethylmonothioperoxydiphosphonamide, N,N'''-diisopropylmonothioperoxydiphosphonamide, N,N'''-di-tert-butylmonothioperoxydiphosphonamide, N,N'''-diphenylmonothioperoxydiphosphonamide, N,N'''-di-pentafluorophenylmonothioperoxydiphosphonamide, N,N'''-dibenzylmonothioperoxydiphosphonamide, N,N'''-dicyclohexylmonothioperoxydiphosphonamide, and N,N'''-dinorbornylmonothioperoxydiphosphonamide. [Note: The phosphite ($P^{+3}$) valence of the phosphorus atom makes stabilization of high valence metal ions much more difficult, though still possible.]

S—O Valence Stabilizer #16: Examples of monothioperoxydiphosphonic acids, bis(monothioperoxydiphosphonic acids), poly(monothioperoxydiphosphonic acids), and derivatives thereof (S—O Bidentates, S—O Tridentates, S—O Tetradentates) that meet the requirements for use as "narrow band" valence stabilizers for $Co^{+3}$ include, but are not limited to: monothioperoxydiphosphonic acid, methylmonothioperoxydiphosphonic acid, isopropylmonothioperoxydiphosphonic acid, tert-butylmonothioperoxydiphosphonic acid, phenylmonothioperoxydiphosphonic acid, pentafluorophenylmonothioperoxydiphosphonic acid, benzylmonothioperoxydiphosphonic acid, cyclohexylmonothioperoxydiphosphonic acid, norbornylmonothioperoxydiphosphonic acid, dimethylmonothioperoxydiphosphonic acid, diisopropylmonothioperoxydiphosphonic acid, di-tert-butylmonothioperoxydiphosphonic acid, diphenylmonothioperoxydiphosphonic acid, di-pentafluorophenylmonothioperoxydiphosphonic acid, dibenzylmonothioperoxydiphosphonic acid, dicyclohexylmonothioperoxydiphosphonic acid, and dinorbornylmonothioperoxydiphosphonic acid. [Note: The phosphite ($P^{+3}$) valence of the phosphorus atom makes stabilization of high valence metal ions much more difficult, though still possible.]

S—O Valence Stabilizer #17: Examples of monothiophosphoric acids (phosphorothioic acids), bis(monothiophosphoric acids), poly(monothiophosphoric acids), and derivatives thereof (S—O Bidentates, S—O Tridentates, S—O Tetradentates) that meet the requirements for use as "narrow band" valence stabilizers for $Co^{+3}$ include, but are not limited to: monothiophosphoric acid, O-phenylmonothiophosphoric acid, O-benzylmonothiophosphoric acid, O-cyclohexylmonothiophosphoric acid, O-norbornylmonothiophosphoric acid, O,O-diphenylmonothiophosphoric acid, O,O-dibenzylmonothiophosphoric acid, O,O-dicyclohexylmonothiophosphoric acid, and O,O-dinorbornylmonothiophosphoric acid.

S—O Valence Stabilizer #18: Examples of phosphoro(dithioperoxoic) acids, bis[phosphoro(dithioperoxoic) acids], poly[phosphoro(dithioperoxoic) acids], and derivatives thereof (S—O Bidentates, S—O Tridentates, S—O Tetradentates) that meet the requirements for use as "narrow band" valence stabilizers for $Co^{+3}$ include, but are not limited to: phosphoro(dithioperoxoic) acid, O-phenylphosphoro(dithioperoxoic) acid, O-benzylphosphoro(dithioperoxoic) acid, O-cyclohexylphosphoro(dithioperoxoic) acid, O-norbornylphosphoro(dithioperoxoic) acid, O,O-diphenylphosphoro(dithioperoxoic) acid, O,O-dibenzylphosphoro(dithioperoxoic) acid, O,O-dicyclohexylphosphoro(dithioperoxoic) acid, and O,O-dinorbornylphosphoro(dithioperoxoic) acid.

S—O Valence Stabilizer #19: Examples of monothiophosphonic Acids (phosphonothioic acids), bis(monothiophosphonic acids), poly(monothiophosphonic acids), and derivatives thereof (S—O Bidentates, S—O Tridentates, S—O Tetradentates) that meet the requirements for use as "narrow band" valence stabilizers for $Co^{+3}$ include, but are not limited to: monothiophosphonic acid, O-phenylmonothiophosphonic acid, O-benzylmonothiophosphonic acid, O-cyclohexylmonothiophosphonic acid, O-norbornylmonothiophosphonic acid, O,P-diphenylmonothiophosphonic acid, O,P-dibenzylmonothiophosphonic acid, O,P-dicyclohexylmonothiophospbonic acid, and O,P-dinorbornylmonothiophosphonic acid. [Note: The phosphite ($P^{+3}$) valence of the phosphorus atom makes stabilization of high valence metal ions much more difficult, though still possible.]

S—O Valence Stabilizer #20: Examples of phosphono(dithioperoxoic) acids, bis[phosphono(dithioperoxoic) acids], poly[phosphono(dithioperoxoic) acids], and derivatives thereof (S—O Bidentates, S—O Tridentates, S—O Tetradentates) that meet the requirements for use as "narrow band" valence stabilizers for $Co^{+3}$ include, but are not limited to: phosphono(dithioperoxoic) acid, O-phenylphosphono(dithioperoxoic) acid, O-benzylphosphono(dithioperoxoic) acid, O-cyclohexylphosphono(dithioperoxoic) acid, O-norbornylphosphono(dithioperoxoic) acid, O,P-diphenylphosphono(dithioperoxoic) acid, O,P-dibenzylphosphono(dithioperoxoic) acid, O,P-dicyclohexylphosphono(dithioperoxoic) acid, and O,P-dinorbornylphosphono(dithioperoxoic) acid. [Note: The phosphite ($P^{+3}$) valence of the phosphorus atom makes stabilization of high valence metal ions much more difficult, though still possible.]

S—O Valence Stabilizer #21: Examples of beta-hydroxythioketones, beta-hydroxythioaldehydes, bis(beta-hydroxythioketones), bis(beta-hydroxythioaldehydes), poly(beta-hydroxythioketones), and poly(beta-hydroxythioaldehydes) (S—O Bidentates, S—O Tridentates, S—O Tetradentates) that meet the requirements for use as "narrow band" valence stabilizers for $Co^{+3}$ include, but are not limited to: 4-hydroxypentan-2-thione; 1,3-diphenyl-3-hydroxypropanethioaldehyde; 1,3-dibenzyl-3-hydroxypropanethioaldehyde; 1,3-dicyclohexyl-3-hydroxypropanethioaldehyde; 1,3-dinorbornyl-3-hydroxypropanethioaldehyde; 1,3-di(2-thienyl)-3-hydroxypropanethioaldehyde; 1,3-di(2-furyl)-3-hydroxypropanethioaldehyde; o-hydroxythioacetophenone; and beta-hydroxythiobenzophenone.

S—O Valence Stabilizer #22: Examples ofbeta-mercaptoketones, beta-mercaptoaldehydes, bis(beta-mercaptoketones), bis(beta-mercaptoaldehydes), poly(beta-mercaptoketones), and poly(beta-mercaptoaldehydes) (S—O Bidentates, S—O Tridentates, S—O Tetradentates) that meet the requirements for use as "narrow band" valence stabilizers for $Co^{+3}$ include, but are not limited to: 4-mercaptopentan-2-one; 1,3-diphenyl-3-mercaptopropanal; 1,3-dibenzyl-3-mercaptopropanal; 1,3-dicyclohexyl-3-mercaptopropanal; 1,3-dinorbornyl-3-mercaptopropanal; 1,3-di(2-thienyl)-3-mercaptopropanal; 1,3-di(2-furyl)-3-mercaptopropanal; 3-mercapto-1,5-pentanedialdehyde; o-mercaptoacetophenone; 5-mercapto-1,4-naphthoquinone; 1-mercaptoacridone; 1-mercaptoanthraquinone; 1,8-dimercaptoanthraquinone; and beta-mercaptobenzophenone.

S—O Valence Stabilizer #23: Examples of N-(aminomethylol)thioureas [N-(aminohydroxymethyl)thioureas], bis[N-(aminomethylol)thioureas], and poly[N-(aminomethylol) thioureas] (S—O Bidentates, S—O Tridentates, S—O Tetradentates) that meet the requirements for use as "narrow band" valence stabilizers for $Co^{+3}$ include, but are not limited to: N'-(aminohydroxymethyl)thiourea; N,N"-dimethyl-N'-(aminohydroxymethyl)thiourea; N,N'-diethyl-N'-(aminohydroxymethyl)thiourea; N,N"-isopropyl-N'-(aminohydroxymethyl)thiourea; N,N"-diphenyl-N'-(aminohydroxymethyl)thiourea; N,N"-dibenzyl-N'-(aminohydroxymethyl)thiourea; N,N"-dicyclohexyl-N'-(aminohydroxymethyl)thiourea; and N,N"-dinorbornyl-N'-(aminohydroxymethyl)thiourea.

S—O Valence Stabilizer #24: Examples of N-(aminomethylthiol)ureas [N-(aminomercaptomethyl)ureas], bis[N-(aminomethylthiol)ureas], and poly[N-(aminomethylthiol)ureas] (S—O Bidentates, S—O Tridentates, S—O Tetradentates) that meet the requirements for use as "narrow band" valence stabilizers for $Co^{+3}$ include, but are not limited to: N'-(aminomercaptomethyl)urea; N,N"-dimethyl-N'-(aminomercaptomethyl)urea; N,N'-diethyl-N'-(aminomercaptomethyl)urea; N,N"-isopropyl-N'-(aminomercaptomethyl)urea; N,N"-diphenyl-N'-(aminomercaptomethyl)urea; N,N"-dibenzyl-N'-(aminomercaptomethyl)urea; N,N"-dicyclohexyl-N'-(aminomercaptomethyl)urea; and N,N"-dinorbornyl-N'-(aminomercaptomethyl)urea.

S—O Valence Stabilizer #25: Examples of monothiooxamides, bis(monothiooxamides), and poly(monothiooxamides) (S—O Bidentates, S—O Tridentates, S—O Tetradentates) that meet the requirements for use as "narrow band" valence stabilizers for $Co^{+3}$ include, but are not limited to: monothiooxamide, N-methylthiooxamide; N-ethylthiooxamide; N-isopropylthiooxamide; N-phenylthiooxamide; N-benzylthiooxamide; N-cyclohexylthiooxamide; N-norbornylthiooxamide; N,N'-dimethylthiooxamide; N,N'-diethylthiooxamide; N,N'-diisopropylthiooxamide; N,N'-diphenylthiooxamide; N,N'-dibenzylthiooxamide; N,N'-dicyclohexylthiooxamide; and N,N'-dinorbornylthiooxamide.

S—O Valence Stabilizer #26: Examples of beta-mercapto carboxylic acids, bis(beta-mercapto carboxylic acids), poly (beta-mercapto carboxylic acids), and derivatives thereof (S—O Bidentates, S—O Tridentates, S—O Tetradentates) that meet the requirements for use as "narrow band" valence stabilizers for $Co^{+3}$ include, but are not limited to: methyl 3-mercaptopropanoate; methyl 3-mercaptobutanoate; ethyl 3-mercaptobutanoate; phenyl 3-mercaptobutanoate; cyclohexyl 3-mercaptobutanoate; norbornyl 3-mercaptobutanoate; methyl beta-mercaptohydrocinnamate; ethyl beta-mercaptohydrocinnamate; phenyl beta-mercaptohydrocinnamate; methyl o-mercaptobenzoate; ethyl o-mercaptobenzoate; phenyl o-mercaptobenzoate; cyclohexyl o-mercaptobenzoate; (2-benzothiazolylthio) succinic acid (mtbs); norbornyl o-mercaptobenzoate; and 3-[(benzothiazol-2-yl)thio]propionic acid.

S—O Valence Stabilizer #27: Examples of beta-mercapto thiocarboxylic acids, bis(beta-mercapto thiocarboxylic acids), poly(beta-mercapto thiocarboxylic acids), and derivatives thereof (S—O Bidentates, S—O Tridentates, S—O Tetradentates) that meet the requirements for use as "narrow band" valence stabilizers for $Co^{+3}$ include, but are not limited to: methyl 3-mercaptothiobutanoate; ethyl 3-mercaptothiobutanoate; phenyl 3-mercaptothiobutanoate; cyclohexyl 3-mercaptothiobutanoate; norbornyl 3-mercaptothiobutanoate; methyl beta-mercaptothiocinnamate; ethyl beta-mercaptothiocinnamate; phenyl beta-mercaptothiocinnamate; methyl o-mercaptothiobenzoate; ethyl o-mercaptothiobenzoate; phenyl o-mercaptothiobenzoate; cyclohexyl o-mercaptothiobenzoate; norbornyl o-mercaptothiobenzoate; and (alkylthio)oxoethyl alkyl(aryl) disulfides.

S—O Valence Stabilizer #28: Examples of beta-hydroxy thiocarboxylic acids, bis(beta-hydroxy thiocarboxylic acids), poly(beta-hydroxy thiocarboxylic acids), and derivatives thereof (S—O Bidentates, S—O Tridentates, S—O Tetradentates) that meet the requirements for use as "narrow band" valence stabilizers for $Co^{+3}$ include, but are not limited to: methyl 3-hydroxythiobutanoate; ethyl 3-hydroxythiobutanoate; phenyl 3-hydroxythiobutanoate; cyclohexyl 3-hydroxythiobutanoate; norbornyl 3-hydroxythiobutanoate; methyl beta-hydroxythiocinnamate; ethyl beta-hydroxythiocinnamate; phenyl beta-hydroxythiocinnamate; methyl o-hydroxythiobenzoate; ethyl o-hydroxythiobenzoate; phenyl o-hydroxythiobenzoate; cyclohexyl o-hydroxythiobenzoate; and norbornyl o-hydroxythiobenzoate.

S—O Valence Stabilizer #29: Examples of beta-mercapto carboxamides, bis(beta-mercapto carboxamides), poly(beta-mercapto carboxamides), and derivatives thereof (S—O Bidentates, S—O Tridentates, S—O Tetradentates) that meet the requirements for use as "narrow band" valence stabilizers for $Co^{+3}$ include, but are not limited to: N-methyl 3-mercaptobutanamide; N-ethyl 3-mercaptobutanamide; N-phenyl 3-mercaptobutanamide; N-cyclohexyl 3-mercaptobutanamide; N-norbornyl 3-mercaptobutanamide; N-methyl o-mercaptobenzamide; N-ethyl o-mercaptobenzamide; N-phenyl o-mercaptobenzamide; N-cyclohexyl o-mercaptobenzamide; and N-norbornyl o-mercaptobenzamide.

S—O Valence Stabilizer #30: Examples of S-alkylthiocarboxylic Acids, S-arylthiocarboxylic Acids, and S,S-thiobiscarboxylic Acids (S—O Bidentates and S—O Tridentates) that meet the requirements for use as "narrow band" valence stabilizers for $Co^{+3}$ include, but are not limited to: (methylthio)acetic acid; (methylthio)benzoic acid; (methylthio) nicotinic acid; (methylthio)napthoic acid; (phenylthio)acetic acid; (phenylthio)benzoic acid; (phenylthio)naphthoic acid; (norbornylthio)acetic acid; (norbornylthio)benzoic acid; (norbornylthio)napthoic acid; thiobisacetic acid; thiobisbenzoic acid; and thiobisnapthoic acid.

S—O Valence Stabilizer #31: Examples of S-alkyldisulfidocarboxylic acids, S-aryldisulfidocarboxylic acids, and S,S'-disulfidobiscarboxylic acids (S—O Bidentates and S—O Tridentates) that meet the requirements for use as "narrow band" valence stabilizers for $Co^{+3}$ include, but are not limited to: (methyldisulfido)acetic acid; (methyldisulfido)benzoic acid; (methyldisulfido)nicotinic acid; (methyldisulfido)napthoic acid; (phenyldisulfido)acetic acid; (phenyldisulfido)benzoic acid; (phenyldisulfido)naphthoic acid; (norbornyldisulfido)acetic acid; (norbornyldisulfido)benzoic acid; (norbornyldisulfido)napthoic acid; S,S'-disulfidobisacetic acid; S,S'-disulfidobisbenzoic acid; and S,S'-disulfidobisnapthoic acid.

S—O Valence Stabilizer #32: Examples ofmonothiomonocarboxylic acids, dithiodicarboxylic acids, bis(monothiomonocarboxylic acids), bis(dithiodicarboxylic acids), poly (monothiomonocarboxylic acids), poly(dithiodicarboxylic acids), and derivatives thereof (S—O Bidentates and S—O Tetradentates) that meet the requirements for use as "narrow band" valence stabilizers for $Co^{+3}$ include, but are not limited to: thioacetic acid; thiopropionic acid; thiobenzoic acid; thiophenylacetic acid; thiocyclohexanoic acid; thiofuroic acid; thionaphthoic acid; phenyl thioacetate; phenyl thiopropionate; phenyl thiobenzoate; phenyl thiocyclohexanoate; phenyl thiofuroate; phenyl thionaphthoate; dithiooxalic acid (dto); monothiooxalic acid (mtox); dithiomalonic acid; dithiosuccinic acid; diphenyl dithiooxalate; diphenyl dithiomalonate; and diphenyl dithiosuccinate.

S—O Valence Stabilizer #33: Examples of monothiocarbonates and bis(monothiocarbonates) (S—O Bidentates and S—O Tetradentates) that meet the requirements for use as "narrow band" valence stabilizers for $Co^{+3}$ include, but are not limited to: S,O-diethyldithiocarbonate; S,O-diisopropyldithiocarbonate; S,O-diphenyldithiocarbonate; S,O-dibenzyldithiocarbonate; S,O-dicyclohexyldithiocarbonate; and S,O-dinorbornyldithiocarbonate.

S—O Valence Stabilizer #34: Examples of monothiocarbazates (monothiocarbazides), bis(monothiocarbazates), and poly(monothiocarbazates) (S—O Bidentates, S—O Tridentates, and S—O Tetradentates; or possibly N—S Bidentates, N—S Tridentates, and N—S Tetradentates) that meet the requirements for use as "narrow band" valence stabilizers for $Co^{+3}$ include, but are not limited to: N,N'-dimethylmonothiocarbazate; N,N'-di(trifluoromethyl)monothiocarbazate; N,N'-diethylmonothiocarbazate; N,N'-diphenylmonothiocarbazate; N,N'-dibenzylmonothiocarbazate; N,N'-di(pentafluorophenyl)monothiocarbazate; N,N'-dicyclohexylmonothiocarbazate; and N,N'-dinorbornylmonothiocarbazate.

S—O Valence Stabilizer #35: Examples of mercapto alcohols and silylmercaptoalcohols, bis(mercapto alcohols and silylmercaptoalcohols), and poly(mercapto alcohols and silylmercaptoalcohols) (S—O Bidentates, S—O Tridentates, S—O Tetradentates) that meet the requirements for use as "narrow band" valence stabilizers for $Co^{+3}$ include, but are not limited to: 2-mercaptoethanol (mel); 3-mercaptopropanol (mpl); 2-mercaptophenol; 2-mercaptocyclohexanol; 3-mercapto-2-norborneol; 2-mercaptopyridine 1-oxide; 1,4-thioxane; thiodialkanols; 2-(trimethoxysilyl)-1-ethanethiol (tmset); 3-(trimethoxysilyl)-1-propanethiol (tmspt); o-hydroxythiophenols; o-(O-hydroxyalkyl(aryl))thiophenols; and o-(S-thioalkyl(aryl))phenols.

S—O Valence Stabilizer #36: Examples of monothiocarbimates, bis(monothiocarbimates), and poly(monothiocarbimates) (S—O Bidentates, S—O Tridentates, and S—O Tetradentates) that meet the requirements for use as "narrow band" valence stabilizers for $Co^{+3}$ include, but are not limited to: methylmonothiocarbimate; trifluoromethylmonothiocarbimate; ethylmonothiocarbimate; propylmonothiocarbimate; isopropylmonothiocarbimate; butylmonothiocarbimate; tertbutylmonothiocarbimate; cyanomonothiocarbimate; cyanamidomonothiocarbimate; azidomonothiocarbimate; phenylmonothiocarbimate; pentafluorophenylmonothiocarbimate; benzylmonothiocarbimate; naphthylmonothiocarbimate; cyclohexylmonothiocarbimate; norbornylmonothiocarbimate; and adamantylmonothiocarbimate. [Note: Carbimates tend to stabilize lower oxidation states in metal ions.]

S—O Valence Stabilizer #37: Examples of alkyl- and arylmonothioborates and bis(monothioborates) (S—O Bidentates and S—O Tetradentates) that meet the requirements for use as "narrow band" valence stabilizers for $Co^{+3}$ include, but are not limited to: O,O'-diethyl monothioborate; O,O'-diisopropyl monothioborate; O,O'-diphenyl monothioborate; O,O'-dibenzyl monothioborate; O,O'-dicyclohexyl monothioborate; and O,O'-dinorbornyl monothioborate.

S—O Valence Stabilizer #38: Examples of alkyl- and arylmonothioboronates and bis(monothioboronates) (S—O Bidentates and S—O Tetradentates) that meet the requirements for use as "narrow band" valence stabilizers for $Co^{+3}$ include, but are not limited to: diethyl monothioboronate; diisopropyl monothioboronate; diphenyl monothioboronate; dibenzyl monothioboronate; dicyclohexyl monothioboronate; and dinorbornyl monothioboronate. [Note: boronates tend to stabilize lower oxidation states in metal ions.]

S—O Valence Stabilizer #39: Examples of monothioarsonic acids (arsonothioic acids), bis(monothioarsonic acids), poly(monothioarsonic acids), and derivatives thereof(S—O Bidentates, S—O Tridentates, S—O Tetradentates) that meet the requirements for use as "narrow band" valence stabilizers for $Co^{+3}$ include, but are not limited to: monothioarsonic acid, O-phenylmonothioarsonic acid, O-benzylmonothioarsonic acid, O-cyclohexylmonothioarsonic acid, O-norbornylmonothioarsonic acid, O,O-diphenylmonothioarsonic acid, O,O-dibenzylmonothioarsonic acid, O,O-dicyclohexylmonothioarsonic acid, and O,O-dinorbornylmonothioarsonic acid.

S—O Valence Stabilizer #40: Examples of heterocyclic rings containing one or two sulfur atoms and having at least one additional oxygen atom binding site not in a ring (S—O Bidentates, S—O Tridentates, S—O Tetradentates, or S—O Hexadentates) that meet the requirements for use as "narrow band" valence stabilizers for $Co^{+3}$ include, but are not limited to: 2-thiopheneethanol (2-(2-thienyl)ethanol); 2-propionylthiophene (1-(2-thienyl)-1-propanone); N,N'-thiobisphthalimide; 1,1'-thiocarbonyldi-2-pyridone; 2-thiopheneacetic acid; 2-thiophenecarboxaldehyde; 2-thiophenecarboxamide; 2-thiophenecarboxylic acid; 2,5-thiophenedicarboxaldehyde; 2,5-thiophenedicarboxylic acid; 2-thiophenemethanol; 2-thiophenone; thiotetronic acid; alkyl(aryl) 2-thienyl ketones; dithienyl ketone; 1,3-dithiane-2-carboxylic acid; and 1,3-dithiolane-2-carboxylic acid.

S—O Valence Stabilizer #41: Examples of heterocyclic rings containing one or two oxygen atoms and having at least one additional sulfur atom binding site not in a ring (S—O Bidentates, S—O Tridentates, S—O Tetradentates, or S—O Hexadentates) that meet the requirements for use as "narrow band" valence stabilizers for $Co^{+3}$ include, but are not limited to: 2-furanethanethiol (2-(2-furyl)ethanethiol); 1-(2-furyl)-1-propanethione); 2-furanthioacetic acid; 2-furanthiocarboxaldehyde; 2-furanthiocarboxamide; 2-furanthiocarboxylic acid; 2,5-furandithiocarboxaldehyde; 2,5-furandithiocarboxylic acid; 2-furanmethanethiol; 2-furanthione; furfuryl disulfide; furfuryl mercaptan; furfuryl sulfide; and furfuryl methyl disulfide.

S—O Valence Stabilizer #42: Examples of heterocyclic rings containing one or two sulfur atoms and having at least one additional oxygen atom binding site in a separate ring (S—O Bidentates, S—O Tridentates, S—O Tetradentates, or S—O Hexadentates) that meet the requirements for use as "narrow band" valence stabilizers for $Co^{+3}$ include, but are not limited to: 2-(2-furyl)thiophene; 2,5-(2-furyl)thiophene; 2-(2-furyl)thiopyran; and 2,5-(2-furyl)thiopyran.

S—O Valence Stabilizer #43: Examples of two-, three-, four-, five-, six-, seven-, eight-, nine-, and ten-membered macrocyclics, macrobicyclics, and macropolycyclics (including catapinands, cryptands, cyclidenes, and sepulchrates) wherein all binding sites are composed of sulfur (usually thiol, mercapto, or thiocarbonyl groups) or oxygen (hydroxy, carboxy, or carbonyl groups) and are not contained in component heterocyclic rings (S—O Bidentates, S—O Tridentates, S—O Tetradentates, and S—O Hexadentates) that meet the requirements for use as "narrow band" valence stabilizers for $Co^{+3}$ include, but are not limited to: thiaoxacyclobutane ([4]aneOS); thiaoxacyclopentane ([5]aneOS); thiaoxacyclohexane ([6]aneOS); thiaoxacycloheptane ([7]aneOS); thiaoxacyclooctane ([8]aneOS); thiaoxacyclobutene ([4]eneOS); thiaoxacyclopentene ([5]eneOS); thiaoxacyclohexene ([6]eneOS); thiaoxacycloheptene ([7]eneOS); thiaoxacyclooctene ([8]eneOS); dithiaoxacyclohexane ([6]aneOS$_2$); dithiaoxacycloheptane ([7]aneOS$_2$); dithiaoxacyclooctane ([8]aneOS$_2$); dithiaoxacyclononane ([9]aneOS$_2$); dithiaoxacyclodecane ([10]aneOS$_2$); dithiaoxacycloundecane ([11]aneOS$_2$); dithiaoxacyclododecane ([12]aneOS$_2$); dithiaoxacyclohexene ([6]eneOS$_2$); dithiaoxacycloheptene ([7]eneOS$_2$); dithiaoxacyclooctene ([8]eneOS$_2$); dithiaoxacyclononene ([9]eneOS$_2$); dithiaoxacyclodecene ([10]eneOS$_2$); dithiaoxacycloundecene ([11]eneOS$_2$); dithiaoxacyclododecene ([12]eneOS$_2$); dithiadioxacyclooctane ([8]aneO$_2$S$_2$); dithiadioxacyclononane ([9]aneO$_2$S$_2$); dithiadioxacyclodecane ([10]aneO$_2$S$_2$); dithiadioxacycloundecane ([11]aneO$_2$S$_2$); dithiadioxacyclododecane ([12]aneO$_2$S$_2$); dithiadioxacyclotridecane ([13]aneO$_2$S$_2$); dithiadioxacyclotetradecane ([14]aneO$_2$S$_2$); dithiadioxacyclopentadecane ([15]aneO$_2$S$_2$); dithiadioxacyclohexadecane ([16]aneO$_2$S$_2$); dithiadioxacycloheptadecane ([17]aneO$_2$S$_2$); dithiadioxacyclooctadecane ([18]aneO$_2$S$_2$); dithiadioxacyclononadecane ([19]aneO$_2$S$_2$); dithiadioxacycloeicosane ([20]aneO$_2$S$_2$); dithiadioxacyclooctadiene ([8]dieneo$_2$S$_2$); dithiadioxacyclononadiene ([9]dieneo$_2$S$_2$); dithiadioxacyclodecadiene ([10]dieneo$_2$S$_2$); dithiadioxacycloundecadiene ([11]dieneo$_2$S$_2$); dithiadioxacyclododecadiene ([12]dieneO$_2$S$_2$); dithiadioxacyclotridecadiene ([13]dieneo$_2$S$_2$); dithiadioxacyclotetradecadiene ([14]dieneO$_2$S$_2$); dithiadioxacyclopentadecadiene ([15]dieneO$_2$S$_2$); dithiadioxacyclohexadecadiene ([16]dieneO$_2$S$_2$); dithiadioxacycloheptadecadiene ([17]dieneo$_2$S$_2$); dithiadioxacyclooctadecadiene ([18]dieneo$_2$S$_2$); dithiadioxacyclononadecadiene ([19]dieneO$_2$S$_2$); and dithiadioxacycloeicosadiene ([20]dieneO$_2$S$_2$).

S—O Valence Stabilizer #44: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of sulfur or oxygen and are contained in component heterocyclic rings (S—O Tridentates, S—O Tetradentates, or S—O Hexadentates) that meet the requirements for use as "narrow band" valence stabilizers for $Co^{+3}$ include, but are not limited to: difurandithiophenes; difurantrithiophenes; trifurantrithiophenes; and tetrafurantetrathiophenes.

S—O Valence Stabilizer #45: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of sulfur or oxygen and are contained in a combination of heterocyclic rings and thiol, mercapto, thiocarbonyl, hydroxy, carboxy, and carbonyl groups (S—O Tridentates, S—O Tetradentates, or S—O Hexadentates) that meet the requirements for use as "narrow band" valence stabilizers for $Co^{+3}$ include, but are not limited to: dithiadifurandithiophenes; tetrathiadifurandithiophenes; trithiatrifurantrithiophenes; trithiatrifurantrithiophenes; tetrathiatetrafurantetrathiophenes; and octathiatetrafurantetrathiophenes.

S—O Valence Stabilizer #46: Examples of sulfoxides that meet the requirements for use as "narrow band" valence stabilizers for $Co^{+3}$ include, but are not limited to: dimethylsulfoxide (DMSO); diethylsulfoxide; diphenylsulfoxide; and tetrahydrothiophene oxide.

S—O Valence Stabilizer #47: Examples of sulfones that meet the requirements for use as "narrow band" valence stabilizers for $Co^{+3}$ include, but are not limited to: dimethyl sulfone; diethyl sulfone; and diphenyl sulfone.

S—O Valence Stabilizer #48: Examples of sulfur dioxide ligands that meet the requirements for use as "narrow band" valence stabilizers for $Co^{+3}$ include, but are not limited to: sulfur dioxide (—$SO_2$) ligands. [Note: Sulfur dioxide is a reducing agent, and complexed metal ions therefore tend to prefer lower oxidation states.]

N—P Valence Stabilizer #1: Examples of aminoaryl phosphines and iminoaryl phosphines (N—P Bidentates, N—P Tridentates, and N—P Tetradentates) that meet the requirements for use as "narrow band" valence stabilizers for $Co^{+3}$ include, but are not limited to: tri(2-aminophenyl)phosphine; tri(2-aminophenyl)phosphine oxide; and tri(2-aminophenyl)phosphine sulfide.

N—P Valence Stabilizer #2: Examples of heterocyclic rings containing one, two, three, or four nitrogen atoms and having at least one additional phosphorus atom binding site not in a ring (N—P Bidentates, N—P Tridentates, N—P Tetradentates, or N—P Hexadentates) that meet the requirements for use as "narrow band" valence stabilizers for $Co^{+3}$ include, but are not limited to: tri(2-imidazolyl)phosphine; tri(2-pyrrolyl)phosphine; tri(2-pyridyl)phosphine; tri(2-imidazolyl)phosphine oxide; tri(2-pyrrolyl)phosphine oxide; tri(2-pyridyl)phosphine oxide; tri(2-imidazolyl)phosphine sulfide; tri(2-pyrrolyl)phosphine sulfide; and tri(2-pyridyl)phosphine sulfide.

N—P Valence Stabilizer #3: Examples of heterocyclic rings containing one, two, or three phosphorus atoms and having at least one additional nitrogen atom binding site not in a ring (N—P Bidentates, N—P Tridentates, N—P Tetradentates, or N—P Hexadentates) that meet the requirements for use as "narrow band" valence stabilizers for $Co^{+3}$ include, but are not limited to: 2-aminophosphole; 2,5-diaminophosphole; 2-(aminomethyl)phosphole; 2,5-di(aminomethyl)phosphole; 2-aminophosphorin; 2,6-diaminophosphorin; 2-(aminomethyl)phosphorin; 2,6-di(aminomethyl)phosphorin; triaminocyclotriphosphazenes; and hexaminocyclotriphosphazenes.

N—P Valence Stabilizer #4: Examples of heterocyclic rings containing one, two, three, or four nitrogen atoms and having at least one additional phosphorus atom binding site in a separate ring (N—P Bidentates, N—P Tridentates, N—P Tetradentates) that meet the requirements for use as "narrow band" valence stabilizers for $Co^{+3}$ include, but are not limited to: 2-(2-pyrrolyl)phosphole; 2,5-di(2-pyrrolyl)phosphole; 2-(2-pyridyl)phosphorin; and 2,6-(2-pyridyl)phosphorin.

N—P Valence Stabilizer #5: Examples of two-, three-, four-, five-, six-, seven-, eight-, nine-, and ten-membered macrocyclics, macrobicyclics, and macropolycyclics (including catapinands, cryptands, cyclidenes, and sepulchrates) wherein all binding sites are composed of nitrogen (usually amine or imine groups) or phosphorus and are not contained in component heterocyclic rings (N—P Bidentates, N—P Tridentates, N—P Tetradentates, and N—P Hexadentates) that meet the requirements for use as "narrow band" valence stabilizers for $Co^{+3}$ include, but are not limited to: cyclobiphosphazenes; cyclotriphosphazenes; cyclotetraphosphazenes; cyclopentaphosphazenes; cyclohexaphosphazenes; diphosphatetraazacyclooctatetraenes; diphospha-s-triazines; and phosphas-triazines.

N—P Valence Stabilizer #6: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of nitrogen or phosphorus and are contained in component heterocyclic rings (N—P Bidentates, N—P Tridentates, N—P Tetradentates, or N—P Hexadentates) that meet the requirements for use as "narrow band" valence stabilizers for $Co^{+3}$ include, but are not limited to: diphospholedipyrroles; diphosphorindipyridines; triphospholetripyrrol es; triphosphorintripyridines; tetraphospholetetrapyrroles; and tetraphosphorintetrapyridines.

N—P Valence Stabilizer #7: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of nitrogen or phosphorus and are contained in a combination of heterocyclic rings and amine, imine, and phosphine groups (N—P Bidentates, N—P Tridentates, N—P Tetradentates, or N—P Hexadentates) that meet the requirements for use as "narrow band" valence stabilizers for $Co^{+3}$ include, but are not limited to: azaphosphatetraphyrins; diazadiphosphatetraphyrins; azaphosphahexaphyrins; diazadiphosphahexaphyrins; triazatriphosphahexaphyrins; and apholate.

S—P Valence Stabilizer #1: Examples of thioaryl phosphines (S—P Bidentates, S—P Tridentates, S—P Tetradentates, and S—P Hexadentates) that meet the requirements for use as "narrow band" valence stabilizers for $Co^{+3}$ include, but are not limited to: tri(2-mercaptophenyl)phosphine; tri(2-mercaptophenyl)phosphine oxide; and tri(2-mercaptophenyl)phosphine sulfide.

S—P Valence Stabilizer #2: Examples of heterocyclic rings containing one or two sulfur atoms and having at least one additional phosphorus atom binding site not in a ring (S—P Bidentates, S—P Tridentates, S—P Tetradentates, or S—P Hexadentates) that meet the requirements for use as "narrow band" valence stabilizers for $Co^{+3}$ include, but are not limited to: tri(2-thiophene)phosphine; tri(2-thiopyran)phosphine; tri(2-thiophene)phosphine oxide; tri(2-thiopyran)phosphine oxide; tri(2-thiophene)phosphine sulfide; and tri(2-thiopyran)phosphine sulfide.

S—P Valence Stabilizer #3: Examples of heterocyclic rings containing one, two, orthree phosphorus atoms and having at least one additional sulfur atom binding site not in a ring (S—P Bidentates, S—P Tridentates, S—P Tetradentates, or S—P Hexadentates) that meet the requirements for use as "narrow band" valence stabilizers for $Co^{+3}$ include, but are not limited to: 2-mercaptophosphole; 2,5-dimercaptophosphole; 2-(mercaptomethyl)phosphole; 2,5-di(mercaptomethyl)phosphole; 2-mercaptophosphorin; 2,6-dimercaptophosphorin; 2-(mercaptomethyl)phosphorin; and 2,6-di(mercaptomethyl)phosphorin.

S—P Valence Stabilizer #4: Examples of heterocyclic rings containing one or two sulfur atoms and having at least one additional phosphorus atom binding site in a separate ring (S—P Bidentates, S—P Tridentates, S—P Tetradentates) that meet the requirements for use as "narrow band" valence stabilizers for $Co^{+3}$ include, but are not limited to: 2-(2-thienyl)phosphole; 2,5-di(2-thienyl)phosphole; 2-(2-thienyl)phosphorin; and 2,6-(2-thienyl)phosphorin.

S—P Valence Stabilizer #5: Examples of two-, three-, four-, five-, six-, seven-, eight-, nine-, and ten-membered macrocyclics, macrobicyclics, and macropolycyclics (including catapinands, cryptands, cyclidenes, and sepulchrates) wherein all binding sites are composed of sulfur (usually thiol, mercapto, or thiocarbonyl groups) or phosphorus and are not contained in component heterocyclic rings (S—P Bidentates, S—P Tridentates, S—P Tetradentates, and S—P Hexadentates) that meet the requirements for use as "narrow band" valence stabilizers for $Co^{+3}$ include, but are not limited to: phosphathiacyclobutane ([4]aneP S); phosphathiacyclopentane ([5]aneP S); phosphathiacyclohexane ([6]anePS); phosphathiacycloheptane ([7]anePS); phosphathiacyclooctane ([8]anePS); diphosphathiacyclohexane ([6]aneSP$_2$); diphosphathiacycloheptane ([7]aneSP$_2$); diphosphathiacyclooctane ([8]aneSP$_2$); diphosphathiacyclononane ([9]aneSP$_2$); diphosphathiacyclodecane ([10]aneSP$_2$); diphosphathiacycloundecane ([11]aneSP$_2$); diphosphathiacyclododecane ([12]aneSP$_2$); diphosphadithiacyclooctane ([8]aneS$_2$P$_2$); diphosphadithiacyclononane ([9]aneS$_2$P$_2$); diphosphadithiacyclodecane ([10]aneS$_2$P$_2$); diphosphadithiacycloundecane ([11]aneS$_2$P$_2$); diphosphadithiacyclododecane ([12]aneS$_2$P$_2$); diphosphadithiacyclotridecane ([13]aneS$_2$P$_2$); diphosphadithiacyclotetradecane ([14]aneS$_2$P$_2$); diphosphadithiacyclopentadecane ([15]aneS$_2$P$_2$); diphosphadithiacyclohexadecane ([16]aneS$_2$P$_2$); diphosphadithiacycloheptadecane ([17]aneS$_2$P$_2$); diphosphadithiacyclooctadecane ([18]aneS$_2$P$_2$); diphosphadithiacyclononadecane ([19]aneS$_2$P$_2$); diphosphadithiacycloeicosane ([20]aneS$_2$P$_2$).

S—P Valence Stabilizer #6: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of sulfur or phosphorus and are contained in component heterocyclic rings (S—P Bidentates, S—P Tridentates, S—P Tetradentates, or S—P Hexadentates) that meet the requirements for use as "narrow band" valence stabilizers for $Co^{+3}$ include, but are not limited to: diphospholedithiophenes; diphosphorindithiopyrans; triphospholetrithiophenes; triphosphorintrithiopyrans; tetraphospholetetrathiophenes; and tetraphosphorintetrathiopyrans.

S—P Valence Stabilizer #7: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of sulfur or phosphorus and are contained in a combination of heterocyclic rings and thiol, mercapto, thiocarbonyl, and phosphine groups (S—P Bidentates, S—P Tridentates, S—P Tetradentates, or S—P Hexadentates) that meet the requirements for use as "narrow band" valence stabilizers for $Co^{+3}$ include, but are not limited to: thiaphosphatetraphyrins; dithiadiphosphatetraphyrins; thiaphosphahexaphyrins; dithiadiphosphahexaphyrins; and trithiatriphosphahexaphyrins.

P—O Valence Stabilizer #1: Examples ofhydroxyaryl phosphines (P—O Bidentates, P—O Tridentates, P—O Tetradentates, and P—O Hexadentates) that meet the requirements for use as "narrow band" valence stabilizers for $Co^{+3}$ include, but are not limited to: tri(2-hydroxyphenyl)phosphine; tri(2-hydroxyphenyl)phosphine oxide; and tri(2-hydroxyphenyl)phosphine sulfide.

P—O Valence Stabilizer #2: Examples ofheterocyclic rings containing one or two oxygen atoms and having at least one additional phosphorus atom binding site not in a ring (P—O Bidentates, P—O Tridentates, P—O Tetradentates, or P—O Hexadentates) that meet the requirements for use as "narrow band" valence stabilizers for $Co^{+3}$ include, but are not limited to: tri(2-furan)phosphine; tri(2-pyran)phosphine; tri (2-furan)phosphine oxide; tri(2-pyran)phosphine oxide; tri (2-furan)phosphine sulfide; and tri(2-pyran)phosphine sulfide.

P—O Valence Stabilizer #3: Examples of heterocyclic rings containing one, two, or three phosphorus atoms and having at least one additional oxygen atom binding site not in a ring (P—O Bidentates, P—O Tridentates, P—O Tetradentates, or P—O Hexadentates) that meet the requirements for use as "narrow band" valence stabilizers for $Co^{+3}$ include, but are not limited to: 2-hydroxyphosphole; 2,5-dihydroxyphosphole; 2-(hydroxymethyl)phosphole; 2,5-di(hydroxymethyl) phosphole; 2-hydroxyphosphorin; 2,6-dihydroxyphosphorin; 2-(hydroxymethyl)phosphorin; and 2,6-di (hydroxymethyl)phosphorin.

P—O Valence Stabilizer #4: Examples of heterocyclic rings containing one or two oxygen atoms and having at least one additional phosphorus atom binding site in a separate ring (P—O Bidentates, P—O Tridentates, P—O Tetradentates) that meet the requirements for use as "narrow band" valence stabilizers for $Co^{+3}$ include, but are not limited to: 2-(2-furyl)phosphole; 2,5-di(2-furyl)phosphole; 2-(2-furyl)phosphorin; and 2,6-(2-furyl)phosphorin.

P—O Valence Stabilizer #5: Examples of two-, three-, four-, five-, six-, seven-, eight-, nine-, and ten-membered macrocyclics, macrobicyclics, and macropolycyclics (including catapinands, cryptands, cyclidenes, and sepulchrates) wherein all binding sites are composed of oxygen (usually hydroxy, carboxy, or carbonyl groups) or phosphorus and are not contained in component heterocyclic rings (P—O Bidentates, P—O Tridentates, P—O Tetradentates, and P—O Hex adentates) that meet the requirements for use as "narrow band" valence stabilizers for $Co^{+3}$ include, but are not limited to: phosphaoxacyclobutane ([4]anePO); phosphaoxacyclopentane ([5]anePO); phosphaoxacyclohexane ([6]anePO); phosphaoxacycloheptane ([7]anePO); phosphaoxacyclooctane ([8]anePO); diphosphaoxacyclohexane ([6] $aneOP_2$); diphosphaoxacycloheptane ([7]$aneOP_2$); diphosphaoxacyclooctane ([8]$aneOP_2$); diphosphaoxacyclononane ([9]$aneOP_2$); diphosphaoxacyclodecane ([10]$aneOP_2$); diphosphaoxacycloundecane ([11]$aneOP_2$); diphosphaoxacyclododecane ([12]$aneOP_2$); diphosphadioxacyclooctane ([8]$aneO_2P_2$); diphosphadioxacyclononane ([9]$aneO_2P_2$); diphosphadioxacyclodecane ([10]$aneO_2P_2$); diphosphadioxacycloundecane ([11]$aneO_2P_2$); diphosphadioxacyclododecane ([12]$aneO_2P_2$); diphosphadioxacyclotridecane ([13] $aneO_2P_2$); diphosphadioxacyclotetradecane ([14]$aneO_2P_2$); diphosphadioxacyclopentadecane ([15]$aneO_2P_2$); diphosphadioxacyclohexadecane ([16]$aneO_2P_2$); diphosphadioxacycloheptadecane ([17]$aneO_2P_2$); diphosphadioxacyclooctadecane ([18]$aneO_2P_2$); diphosphadioxacyclononadecane ([19]$aneO_2P_2$); diphosphadioxacycloeicosane ([20] $aneO_2P_2$); and dioxaphospholane.

P—O Valence Stabilizer #6: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of oxygen or phosphorus and are contained in component heterocyclic rings (P—O Bidentates, P—O Tridentates, P—O Tetradentates, or P—O Hexadentates) that meet the requirements for use as "narrow band" valence stabilizers for $Co^{+3}$ include, but are not limited to: diphospholedifurans; diphosphorindipyrans; triphospholetrifurans; triphosphorintripyrans; tetraphospholetetrafurans; and tetraphosphorintetrapyrans.

P—O Valence Stabilizer #7: Examples of four-, five-, six-, seven-, eight-, nine-, or ten-membered macrocyclics, macrobicyclics, and macropolycyclics (including catapinands, cryptands, cyclidenes, and sepulchrates) wherein all binding sites are composed of oxygen or phosphorus and are contained in a combination of heterocyclic rings and hydroxy, carboxy, carbonyl, and phosphine groups (P—O Bidentates, P—O Tridentates, P—O Tetradentates, or P—O Hexadentates) that meet the requirements for use as "narrow band" valence stabilizers for $Co^{+3}$ include, but are not limited to: oxaphosphatetraphyrins; dioxadiphosphatetraphyrins; oxaphosphahexaphyrins; dioxadiphosphahexaphyrins; and trioxatriphosphahexaphyrins.

As Valence Stabilizer #1: Examples ofmonoarsines (As Monodentates) that meet the requirements for use as "narrow band" valence stabilizers for $Co^{+3}$ include, but are not limited to: arsine, triphenylarsine, ticyclohexylarsine, methyldiphenylarsine, ethyldiphenylarsine, arsinonorbornane, and arsinoadamantane.

As Valence Stabilizer #2: Examples of diarsines (As Monodentates or As—As Bidentates) that meet the requirements for use as "narrow band" valence stabilizers for $Co^{+3}$ include, but are not limited to: bis(diphenylarsino)methane, bis(diphenylarsino)ethane, bis(diphenylarsino)propane, bis (diphenylarsino)butane, bis(diphenylarsino)pentane, 1,2-diarsinobenzene, cyclohexane-1,2-diarsine, 1,2-bis(phenylbutylarsino)ethane, o-phenylenebis(methylphenylarsine) and o-phenylenebis(dimethylarsine) (diars). (Note: the aryl derivatives are air-stable, whereas the alkyl derivatives are air-sensitive and therefore unsuitable for these applications.)

As Valence Stabilizer #3: Examples of triarsines (As—As Bidentates, or As—As Tridentates) that meet the requirements for use as "narrow band" valence stabilizers for $Co^{+3}$ include, but are not limited to: 1,1,5,9,9-pentaphenyl-1,5,9-triarsanonane, 3-methyl-3-(As,As-dimethyl)arsinomethyl-1,1,5,5-tetraphenyl-1,5-diarsapentane, As,As-[o-(As-dimethyl)arsinodiphenyl]-(As-phenyl)arsine, As,As-[o-(As-diphenyl)arsinodiphenyl]-(As-phenyl)arsine, hexahydro-2,4,6-trimethyl-1,3,5-triarsinazine. (Note: the aryl derivatives are air-stable, whereas the alkyl derivatives are air-sensitive and therefore unsuitable for these applications.)

As Valence Stabilizer #4: Examples oftetraarsines (As—As Bidentates, As—As Tridentates, or As—As Tetradentates) that meet the requirements for use as "narrow band" valence stabilizers for $Co^{+3}$ include, but are not limited to: 3,3-(As-diphenyl)arsinomethyl-1,1,5,5-tetraphenyl-1,5-diarsapentane. (Note: the aryl derivatives are air-stable, whereas the alkyl derivatives are air-sensitive and therefore unsuitable for these applications.)

As Valence Stabilizer #5: Examples of pentaarsines (As—As Bidentates, As—As Tridentates, or As—As Tetradentates) that meet the requirements for use as "narrow band" valence stabilizers for $Co^{+3}$ include, but are not limited to: 4-[2-(As-diphenyl)arsinoethyl]-1,1,7,10,10-pentaphenyl-1, 4,7,10-tetraarsadecane. (Note: the aryl derivatives are air-stable, whereas the alkyl derivatives are air-sensitive and therefore unsuitable for these applications.)

As Valence Stabilizer #6: Examples of hexaarsines (As—As Bidentates, As—As Tridentates, As—As Tetradentates, or As—As Hexadentates) that meet the requirements for use as "narrow band" valence stabilizers for $Co^{+3}$ include, but are not limited to: o-phenylenebis[di-3-(As-diphenyl)arsinopropylarsine]. (Note: the aryl derivatives are air-stable, whereas the alkyl derivatives are air-sensitive and therefore unsuitable for these applications.)

As Valence Stabilizer #7: Examples of 5-membered heterocyclic rings containing one arsenic atom (As Monodentates) that meet the requirements for use as "narrow band" valence stabilizers for $Co^{+3}$ include, but are not limited to: arsole, azarsole, diazarsole, benzarsole, benzazarsole, dibenzarsole, naphtharsole, naphthazarsole.

As Valence Stabilizer #8: Examples of 6-membered heterocyclic rings containing one arsenic atom (As Monodentates) that meet the requirements for use as "narrow band" valence stabilizers for $Co^{+3}$ include, but are not limited to: arsenin, azarsenin, diazarsenin, benzarsenin, benzazarsenin, dibenzarsenin, naphtharsenin, and naphthazarsenin.

As Valence Stabilizer #9: Examples of 5-membered heterocyclic rings containing one arsenic atom and having at least one additional arsenic atom binding site not contained in a ring (As Monodentates, As—As Bidentates, As—As Tridentates, As—As Tetradentates, or As—As Hexadentates) that meet the requirements for use as "narrow band" valence stabilizers for $Co^{+3}$ include, but are not limited to: 2-(As-phenylarsino)arsole; 2,5-(As-phenylarsino)arsole; 2-(As-phenylarsino)benzarsole; 7-(As-phenylarsino)benzarsole; and 1,8-(As-phenylarsino)dibenzarsole.

As Valence Stabilizer #10: Examples of 6-membered heterocyclic rings containing one arsenic atom and having at least one additional arsenic atom binding site not contained in a ring (As Monodentates, As—As Bidentates, As—As Tridentates, As—As Tetradentates, or As—As Hexadentates) that meet the requirements for use as "narrow band" valence stabilizers for $Co^{+3}$ include, but are not limited to: 2-(As-phenylarsino)arsenin; 2,5-(As-phenylarsino)arsenin; 2-(As-phenylarsino)benzarsenin; 7-(As-phenylarsino)benzarsenin; and 1,9-(As-phenylarsino)dibenzarsenin.

As Valence Stabilizer #11: Examples of 5-membered heterocyclic rings containing one arsenic atom and having at least one additional arsenic atom binding site contained in a ring (As Monodentates, As—As Bidentates, As—As Tridentates, As—As Tetradentates) that meet the requirements for use as "narrow band" valence stabilizers for $Co^{+3}$ include, but are not limited to: 2,2'-biarsole; 2,2',2"-triarsole; and 2,2'-bibenzarsole.

As Valence Stabilizer #12: Examples of 6-membered heterocyclic rings containing one arsenic atom and having at least one additional arsenic atom binding site contained in a ring (As Monodentates, As—As Bidentates, As—As Tridentates, As—As Tetradentates) that meet the requirements for use as "narrow band" valence stabilizers for $Co^{+3}$ include, but are not limited to: 2,2'-biarsenin; 2,2',2"-triarsenin; 2,2',2",2'"-tetraarsenin; 2,2'-bibenzarsenin; and 8,8'-bibenzarsenin.

As Valence Stabilizer #13a: Examples of two-membered macrocyclics, macrobicyclics, and macropolycyclics (including catapinands, cryptands, cyclidenes, and sepulchrates) wherein both binding sites are composed of arsenic and are not contained in component heterocyclic rings (As—As Bidentates) that meet the requirements for use as "narrow band" valence stabilizers for $Co^{+3}$ include, but are not limited to: As,As-diphenyldiarsacyclobutane ([4]aneAs2); As,As-diphenyldiarsacyclopentane ([5]aneAs$_2$); As,As-diphenyldiarsacyclohexane ([6]aneAs2); As,As-diphenyldiarsacycloheptane ([7]aneAs$_2$); As,As-diphenyldiarsacyclooctane ([8]aneAs2); As,As-diphenyldiarsacyclobutene ([4]eneAs$_2$); As,As-diphenyldiarsacyclopentene ([5]eneAs2); As,As-diphenyldiarsacyclohexene ([6]eneAs$_2$); As,As-diphenyldiarsacycloheptene ([7]eneAs2); and As,As-diphenyldiarsacyclooctene ([8]eneAs$_2$).

As Valence Stabilizer #13b: Examples of three-membered macrocyclics, macrobicyclics, and macropolycyclics (including catapinands, cryptands, cyclidenes, and sepulchrates) wherein all binding sites are composed of arsenic and are not contained in component heterocyclic rings (As—As Tridentates) that meet the requirements for use as "narrow band" valence stabilizers for $Co^{+3}$ include, but are not limited to: As,As,As-triphenyltriarsacyclohexane ([6]aneAs$_3$); As,As,As-triphenyltriarsacycloheptane ([7]aneAs$_3$); As,As,As-triphenyltriarsacyclooctane ([8]aneAs$_3$); As,As,As-triphenyltriarsacyclononane ([9]aneAs$_3$); As,As,As-triphenyltriarsacyclodecane ([10]aneAs$_3$); As,As,As-triphenyltriarsacycloundecane ([11]aneAs$_3$); As,As,As-triphenyltriarsacyclododecane ([12]aneAs$_3$); As,As,As-triphenyltriarsacyclohexatriene ([6]trieneAs$_3$); As,As,As-triphenyltriarsacycloheptatriene ([7]trieneAs$_3$); As,As,As-triphenyltriarsacyclooctatriene ([8]trieneAs$_3$); As,As,As-triphenyltriarsacyclononatriene ([9]trieneAs$_3$); As,As,As-triphenyltriarsacyclodecatriene ([10]trieneAs$_3$); As,As,As-triphenyltriarsacycloundecatriene ([11]trieneAs$_3$); and As,As,As-triphenyltriarsacyclododecatriene ([12]trieneAs$_3$).

As Valence Stabilizer #13c: Examples of four-membered macrocyclics, macrobicyclics, and macropolycyclics (including catapinands, cryptands, cyclidenes, and sepulchrates) wherein all binding sites are composed of arsenic and are not contained in component heterocyclic rings (As—As Tetradentates) that meet the requirements for use as "narrow band" valence stabilizers for $Co^{+3}$ include, but are not limited to: As,As,As,As-tetraphenyltetraarsacyclooctane ([8]aneAs$_4$); As,As,As,As-tetraphenyltetraarsacyclononane ([9]aneAs$_4$); As,As,As,As-tetraphenyltetraarsacyclodecane ([10]aneAs$_4$); As,As,As,As-tetraphenyltetraarsacycloundecane ([11]aneAs$_4$); As,As,As,As-tetraphenyltetraarsacyclododecane ([12]aneAs$_4$); As,As,As,As-tetraphenyltetraarsacyclotridecane ([13]aneAs$_4$); As,As,As,As-tetraphenyltetraarsacyclotetradecane ([14]aneAs$_4$); As,As,As,As-tetraphenyltetraarsacyclopentadecane ([15]aneAs$_4$); As,As,As,As-tetraphenyltetraarsacyclohexadecane ([16]aneAs$_4$); As,As,As,As,As-tetraphenyltetraarsacycloheptadecane ([17]aneAs$_4$); As,As,As,As-tetraphenyltetraarsacyclooctadecane ([18]aneAs$_4$); As,As,As,As-tetraphenyltetraarsacyclononadecane ([19]aneAs$_4$); and As,As,As,As-tetraphenyltetraarsacycloeicosane ([20]aneAs$_4$).

As Valence Stabilizer #13d: Examples of six-membered macrocyclics, macrobicyclics, and macropolycyclics (including catapinands, cryptands, cyclidenes, and sepulchrates) wherein all binding sites are composed of arsenic and are not contained in component heterocyclic rings (As—As Tridentates, As—As Tetradentates, or As—As Hexadentates) that meet the requirements for use as "narrow band"

valence stabilizers for $Co^{+3}$ include, but are not limited to: As,As,As,As,As,As-hexaphenylhexaarsacyclododecane ([12]aneAs$_6$); As—As,As,As,As,As-hexaphenylhexaarsacyclotridecane ([13]aneAs$_6$); As,As,As,As,As,As-hexaphenylhexaarsacyclotetradecane ([14]aneAs$_6$); As,As,As,As,As,As-hexaphenylhexaarsacyclopentadecane ([15]aneAs$_6$); As,As,As,As,As,As-hexaphenylhexaarsacyclohexadecane ([16]aneAs$_6$); As,As,As,As,As,As-hexaphenylhexaarsacycloheptadecane ([17]aneAs$_6$); As,As,As,As,As,As-hexaphenylhexaarsacyclooctadecane ([18]aneAs$_6$); As,As,As,As,As,As-hexaphenylhexaarsacyclononadecane ([19]aneAs$_6$); As,As,As,As,As,As-hexaphenylhexaarsacycloeicosane ([20]aneAs$_6$); As,As,As,As,As,As-hexaphenylhexaarsacycloheneicosane ([21]aneAs$_6$); As,As,As,As,As,As-hexaphenylhexaarsacyclodocosane ([22]aneAs$_6$); As,As,As,As,As,As,As-hexaphenylhexaarsacyclotricosane ([23]aneAs$_6$); and As,As,As,As,As,As-hexaphenylhexaarsacyclotetracosane ([24]aneAs$_6$).

As Valence Stabilizer #14a: Examples of four-membered macrocyclics, macrobicyclics, and macropolycyclics (including catapinands, cryptands, cyclidenes, and sepulchrates) wherein all four binding sites are composed of arsenic and are contained in component 5-membered heterocyclic rings (As—As Tetradentates) that meet the requirements for use as "narrow band" valence stabilizers for $Co^{+3}$ include, but are not limited to: tetraarsoles.

As Valence Stabilizer #14b: Examples of six-membered macrocyclics, macrobicyclics, and macropolycyclics (including catapinands, cryptands, cyclidenes, and sepulchrates) wherein all six binding sites are composed of arsenic and are contained in component 5-membered heterocyclic rings (As—As Tetradentates and As—As Hexadentates) that meet the requirements for use as "narrow band" valence stabilizers for $Co^{+3}$ include, but are not limited to: hexaarsoles.

As Valence Stabilizer #15a: Examples of four-membered macrocyclics, macrobicyclics, and macropolycyclics (including catapinands, cryptands, cyclidenes, and sepulchrates) wherein all four binding sites are composed of arsenic and are contained in a combination of 5-membered heterocyclic rings and arsine groups (As—As Tridentates, As—As Tetradentates) that meet the requirements for use as "narrow band" valence stabilizers for $Co^{+3}$ include, but are not limited to: diarsatetraarsoles; and tetraarsatetraarsoles.

As Valence Stabilizer #15b: Examples of six-membered macrocyclics, macrobicyclics, and macropolycyclics (including catapinands, cryptands, cyclidenes, and sepulchrates) wherein all six binding sites are composed of arsenic and are contained in a combination of 5-membered heterocyclic rings and phosphine groups (As—As Tridentates, As—As Tetradentates, and As—As Hexadentates) that meet the requirements for use as "narrow band" valence stabilizers for $Co^{+3}$ include, but are not limited to: diarsahexaarsoles; and triarsahexaarsoles.

As Valence Stabilizer #16a: Examples of four-membered macrocyclics, macrobicyclics, and macropolycyclics (including catapinands, cryptands, cyclidenes, and sepulchrates) wherein all four binding sites are composed of arsenic and are contained in component 6-membered heterocyclic rings (As—As Tetradentates) that meet the requirements for use as "narrow band" valence stabilizers for $Co^{+3}$ include, but are not limited to: cyclotetraarsenins.

As Valence Stabilizer #16b: Examples of six-membered macrocyclics, macrobicyclics, and macropolycyclics (including catapinands, cryptands, cyclidenes, and sepulchrates) wherein all six binding sites are composed of arsenic and are contained in component 6-membered heterocyclic rings (As—As Tridentates, As—As Tetradentates, and As—As Hexadentates) that meet the requirements for use as "narrow band" valence stabilizers for $Co^{+3}$ include, but are not limited to: cyclohexaarsenins.

As Valence Stabilizer #17a: Examples of four-membered macrocyclics, macrobicyclics, and macropolycyclics (including catapinands, cryptands, cyclidenes, and sepulchrates) wherein all four binding sites are composed of arsenic and are contained in a combination of 6-membered heterocyclic rings and arsine groups (As—As Tridentates, As—As Tetradentates, or As—As Hexadentates) that meet the requirements for use as "narrow band" valence stabilizers for $Co^{+3}$ include, but are not limited to: diarsacyclotetraarsenins; and tetraarsacyclotetraarsenins.

As Valence Stabilizer #17b: Examples of six-membered macrocyclics, macrobicyclics, and macropolycyclics (including catapinands, cryptands, cyclidenes, and sepulchrates) wherein all six binding sites are composed of arsenic and are contained in a combination of 6-membered heterocyclic rings and arsine groups (As—As Tridentates, As—As Tetradentates, or As—As Hexadentates) that meet the requirements for use as "narrow band" valence stabilizers for $Co^{+3}$ include, but are not limited to: diarsacyclohexaarsenins; and triarsacyclohexaarsenins.

Se Valence Stabilizer #1: Examples of monoselenoethers (Se Monodentates) that meet the requirements for use as "narrow band" valence stabilizers for $Co^{+3}$ include, but are not limited to: hydrogen selenide, dimethyl selenide, diethyl selenide, dioctyl selenide, diphenyl selenide, dicyclohexyl selenide, tetramethylene selenide, trimethylene selenide, dimethylene selenide, and selenobicycloheptane.

Se Valence Stabilizer #2: Examples of diselenoethers (Se Bidentates) that meet the requirements for use as "narrow band" valence stabilizers for $Co^{+3}$ include, but are not limited to: 2,5-dimethyl-3,6-diselenaoctane; 2,5-diselenahexane; 2,6-diselenaheptane; 3,7-diselenanonane; 3,6-diselenaoctane; 3-butenyl butyl selenoether (bbs); 4-pentenyl butyl selenoether (pbs); 3-butenyl phenyl selenoether (bps); and 4-pentenyl phenyl selenoether (pps).

Se Valence Stabilizer #3: Examples of triselenoethers (Se Bidentates or Se Tridentates) that meet the requirements for use as "narrow band" valence stabilizers for $Co^{+3}$ include, but are not limited to: 1,3,5-triselenane; 2,5,8-triselenanonane; 3,6,9-triselenaundecane; and 2,6,10-triselenaundecane.

Se Valence Stabilizer #4: Examples of tetraselenoethers (Se Bidentates, Se Tridentates, or Se Tetradentates) that meet the requirements for use as "narrow band" valence stabilizers for $Co^{+3}$ include, but are not limited to: 2,6,10,14-tetraselenapentadecane and 2,5,8,11-tetraselenadodecane.

Se Valence Stabilizer #5a: Examples of 5-membered heterocyclic rings containing one selenium atom (Se Monodentates) that meet the requirements for use as "narrow band" valence stabilizers for $Co^{+3}$ include, but are not limited to: dihydroselenophene, selenophene, selenazole, selenapyrroline, selenaphospholene, selenaphosphole, oxaselenole, selenadiazole, selenatriazole, benzodihydroselenophene, benzoselenophene, benzoselenazole, benzoselenaphosphole, dibenzoselenophene, and naphthoselenophene.

Se Valence Stabilizer #5b: Examples of 5-membered heterocyclic rings containing two selenium atoms (Se Monodentates or Se Bidentates) that meet the requirements for use as "narrow band" valence stabilizers for $Co^{+3}$ include, but are not limited to: diselenole, benzodiselenole, and naphthodiselenole.

Se Valence Stabilizer #6a: Examples of 6-membered heterocyclic rings containing one selenium atom (Se Monodentates) that meet the requirements for use as "narrow band" valence stabilizers for $Co^{+3}$ include, but are not limited to: dihydroselenopyran, selenopyran, selenazine, selenadiazine, selenaphosphorin, selenadiphosphorin, oxaselenin, benzoselenopyran, dibenzoselenopyran, and naphthoselenopyran.

Se Valence Stabilizer #6b: Examples of 6-membered heterocyclic rings containing two selenium atoms (Se Monodentates or Se Bidentates)that meet the requirements for use as "narrow band" valence stabilizers for $Co^{+3}$ include, but are not limited to: dihydrodiselenin, diselenin, benzodiselenin, dibenzodiselenin, and naphthodiselenin.

Se Valence Stabilizer #7: Examples of 5-membered heterocyclic rings containing one selenium atom and having at least one additional selenium atom binding site not contained in a ring (Se Monodentates, Se—Se Bidentates, Se—Se Tridentates, Se—Se Tetradentates, or Se—Se Hexadentates) that meet the requirements for use as "narrow band" valence stabilizers for $Co^{+3}$ include, but are not limited to: 2,5-diseleno-2,5-dihydroselenophene; 2,5-bis(selenomethyl)-2,5-dihydroselenophene; 2,5-bis(2-selenophenyl)-2,5-dihydroselenophene; 2,5-diseleno(selenophene); 2,5-bis(selenomethyl)selenophene; 2,5-bis(2-selenophenyl) selenophene; 2,5-diseleno(selenazole); 2,5-bis(selenomethyl)selenazole; 2,5-bis(2-selenophenyl)selenazole; and 2,5-diseleno-1,3,4-selenadiazole [bismuthselenol].

Se Valence Stabilizer #8: Examples of 6-membered heterocyclic rings containing one selenium atom and having at least one additional selenium atom binding site not contained in a ring (Se Monodentates, Se—Se Bidentates, Se—Se Tridentates, Se—Se Tetradentates, or Se—Se Hexadentates) that meet the requirements for use as "narrow band" valence stabilizers for $Co^{+3}$ include, but are not limited to: 2,6-diseleno-2,5-dihydroselenopyran; 2,6-bis(selenomethyl)-2,5-dihydroselenopyran; 2,6-bis(2-selenophenyl)-2,5-dihydroselenopyran; 2,6-diseleno(selenopyran); 2,6-bis(selenomethyl)selenopyran; 2,6-bis(2-selenophenyl) selenopyran; 2,6-diseleno(selenazine); 2,6-bis(selenomethyl)selenazine; 2,6-bis(2-selenophenyl)selenazine; 2,6-diseleno-1,3,5-selenadiazine; 2-seleno-1-benzoselenopyran; 8-seleno-1-benzoselenopyran; and 1,9-diselenodibenzoselenopyran.

Se Valence Stabilizer #9: Examples of 5-membered heterocyclic rings containing one selenium atom and having at least one additional selenium atom binding site contained in a ring (Se Monodentates, Se—Se Bidentates, Se—Se Tridentates, Se—Se Tetradentates) that meet the requirements for use as "narrow band" valence stabilizers for $Co^{+3}$ include, but are not limited to: 2,2'-bi-2,5-dihydroselenophene; 2,2',2"-tri-2,5-dihydroselenophene; 2,2'-biselenophene; 2,2',2"-triselenophene; 2,2'-biselenazole; 5,5'-biselenazole; 2,2'-bi-1,3,4-selenadiazole; 2,2'-biselenanaphthene; 2,2'-bibenzoselenazole; and 1,1'-bis (dibenzoselenophene).

Se Valence Stabilizer #10: Examples of 6-membered heterocyclic rings containing one selenium atom and having at least one additional selenium atom binding site contained in a ring (Se Monodentates, Se—Se Bidentates, Se—Se Tridentates, Se—Se Tetradentates) that meet the requirements for use as "narrow band" valence stabilizers for $Co^{+3}$ include, but are not limited to: 2,2'-bi-2,5-dihydroselenopyran; 2,2',2"-tri-2,5-dihydroselenopyran; 2,2'-biselenopyran; 2,2',2"-triselenopyran; 2,2'-bi-1,4-selenazine; 2,2'-bi-1,3,5-selenadiazine; 2,2'-bi-1-benzoselenopyran; and 1,1'-bis (dibenzoselenopyran).

Se Valence Stabilizer #11a: Examples of two-membered macrocyclics, macrobicyclics, and macropolycyclics (including catapinands, cryptands, cyclidenes, and sepulchrates) wherein both binding sites are composed of selenium (usually selenol or selenoether groups) and are not contained in component heterocyclic rings (Se—Se Bidentates) that meet the requirements for use as "narrow band" valence stabilizers for $Co^{+3}$ include, but are not limited to: diselenacyclobutane ([4]ane$Se_2$); diselenacyclopentane ([5]ane$Se_2$); diselenacyclohexane ([6]ane$Se_2$); diselenacycloheptane ([7]ane$Se_2$); diselenacyclooctane ([8]ane$Se_2$); diselenacyclobutene ([4]ene$Se_2$); diselenacyclopentene ([5]ene$Se_2$); diselenacyclohexene ([6]ene$Se_2$); diselenacycloheptene ([7]ene$Se_2$); diselenacyclooctene ([8]ene$Se_2$); diselenacyclobutadiene ([4]diene$Se_2$); diselenacyclopentadiene ([5]diene$Se_2$); diselenacyclohexadiene ([6]diene$Se_2$); diselenacycloheptadiene ([7]diene$Se_2$); and diselenacyclooctadiene ([8]diene$Se_2$).

Se Valence Stabilizer #11b: Examples of three-membered macrocyclics, macrobicyclics, and macropolycyclics (including catapinands, cryptands, cyclidenes, and sepulchrates) wherein all binding sites are composed of selenium (usually selenol or selenoether groups) and are not contained in component heterocyclic rings (Se—Se Tridentates) that meet the requirements for use as "narrow band" valence stabilizers for $Co^{+3}$ include, but are not limited to: triselenacyclohexane ([6]ane$Se_3$); triselenacycloheptane ([7]ane$Se_3$); triselenacyclooctane ([8]ane$Se_3$); triselenacyclononane ([9]ane$Se_3$); triselenacyclodecane ([10]ane$Se_3$); triselenacycloundecane ([11]ane$Se_3$); triselenacyclododecane ([12]ane$Se_3$); triselenacyclohexene ([6]ene$Se_3$); triselenacycloheptene ([7]ene$Se_3$); triselenacyclooctene ([8]ene$Se_3$); triselenacyclononene ([9]ene$Se_3$); triselenacyclodecene ([10]ene$Se_3$); triselenacycloundecene ([11]ene$Se_3$); triselenacyclododecene ([12]ene$Se_3$); triselenacyclohexatriene ([6]triene$Se_3$); triselenacycloheptatriene ([7]triene$Se_3$); triselenacyclooctatriene ([8]triene$Se_3$); triselenacyclononatriene ([9]triene$Se_3$); triselenacyclodecatriene ([10]triene$Se_3$); triselenacycloundecatriene ([11]triene$Se_3$); and triselenacyclododecatriene ([12]triene$Se_3$).

Se Valence Stabilizer #11c: Examples of four-membered macrocyclics, macrobicyclics, and macropolycyclics (including catapinands, cryptands, cyclidenes, and sepulchrates) wherein all binding sites are composed of selenium (usually selenol or selenoether groups) and are not contained in component heterocyclic rings (Se—Se Tetradentates) that meet the requirements for use as "narrow band" valence stabilizers for $Co^{+3}$ include, but are not limited to: tetraselenacyclooctane ([8]ane$Se_4$); tetraselenacyclononane ([9]ane$Se_4$); tetraselenacyclodecane ([11]ane$Se_4$); tetraselenacycloundecane ([11]ane$Se_4$); tetraselenacyclododecane ([12]ane$Se_4$); tetraselenacyclotridecane ([13]ane$Se_4$); tetraselenacyclotetradecane ([14]ane$Se_4$); tetraselenacyclopentadecane ([15]ane$Se_4$); tetraselenacyclohexadecane ([16]ane$Se_4$); tetraselenacycloheptadecane ([17]ane$Se_4$); tetraselenacyclooctadecane ([18]ane$Se_4$); tetraselenacyclononadecane ([19]aneSe$_4$); tetraselenacycloeicosane ([20]aneSe$_4$); tetraselenacyclooctadiene ([8]dieneSe$_4$); tetraselenacyclononadiene ([9]dieneSe$_4$); tetraselenacyclodecadiene ([10]dieneSe$_4$); tetraselenacycloundecadiene ([11]dieneSe$_4$); tetraselenacyclododecadiene ([12]dieneSe$_4$); tetraselenacyclotridecadiene ([13]dieneSe$_4$); tetraselenacyclotetradecadiene ([14]dieneSe$_4$); tetraselenacyclopentadecadiene ([15]dieneSe$_4$); tetraselenacyclohexadecadiene ([16]dieneSe$_4$); tetraselenacycloheptadecadiene ([17]dieneSe$_4$); tetraselenacyclooctadecadiene ([18]dieneSe$_4$); tetraselenacyclononadecadiene ([19]dieneSe$_4$); tetraselenacycloeicosadiene ([20]dieneSe$_4$); tetraselenacyclooctatetradiene ([8]tetradieneSe$_4$); tetraselenacyclononatetradiene ([9]tetradieneSe$_4$); tetraselenacyclodecatetradiene ([10]tetradieneSe$_4$); and tetraselenacycloundecatetradiene ([11]tetradieneSe$_4$).

Se Valence Stabilizer #11d: Examples of six-membered macrocyclics, macrobicyclics, and macropolycyclics (including catapinands, cryptands, cyclidenes, and sepulchrates) wherein all binding sites are composed of selenium (usually selenol or selenoether groups) and are not contained in component heterocyclic rings (Se—Se Tridentates, Se—Se Tetradentates, or Se—Se Hexadentates) that meet the requirements for use as "narrow band" valence stabilizers for $Co^{+3}$ include, but are not limited to: hexaselenacyclododecane ([12]aneSe$_6$); hexaselenacyclotridecane ([13]aneSe$_6$); hexaselenacyclotetradecane ([14]aneSe$_6$); hexaselenacyclopentadecane ([15]aneSe$_6$); hexaselenacyclohexadecane ([16]aneSe$_6$); hexaselenacycloheptadecane ([17]aneSe$_6$); hexaselenacyclooctadecane ([18]aneSe$_6$); hexaselenacyclononadecane ([19]aneSe$_6$); hexaselenacycloeicosane ([20]aneSe$_6$); hexaselenacycloheneicosane ([21]aneSe$_6$); hexaselenacyclodocosane ([22]aneSe$_6$); hexaselenacyclotricosane ([23]aneSe$_6$); hexaselenacyclotetracosane ([24]aneSe$_6$); hexaselenacyclododecatriene ([12]trieneSe$_6$); hexaselenacyclotridecatriene ([13]trieneSe$_6$); hexaselenacyclotetradecatriene ([14]trieneSe$_6$); hexaselenacyclopentadecatriene ([15]trieneSe$_6$); hexaselenacyclohexadecatriene ([16]trieneSe$_6$); hexaselenacycloheptadecatriene ([17]trieneSe$_6$); and hexaselenacyclooctadecatriene ([18]trieneSe$_6$).

Se Valence Stabilizer #12a: Examples of four-membered macrocyclics, macrobicyclics, and macropolycyclics (including catapinands, cryptands, cyclidenes, and sepulchrates) wherein all four binding sites are composed of selenium and are contained in component 5-membered heterocyclic rings (Se—Se Tetradentates) that meet the requirements for use as "narrow band" valence stabilizers for $Co^{+3}$ include, but are not limited to: tetraselenophenes; tetraselenaphospholes; tetraoxaselenoles; and tetradiselenoles.

Se Valence Stabilizer #12b: Examples of six-membered macrocyclics, macrobicyclics, and macropolycyclics (including catapinands, cryptands, cyclidenes, and sepulchrates) wherein all six binding sites are composed of selenium and are contained in component 5-membered heterocyclic rings (Se—Se Tridentates or Se—Se Tetradentates) that meet the requirements for use as "narrow band" valence stabilizers for $Co^{+3}$ include, but are not limited to: hexaselenophenes; hexaselenaphospholes; hexaoxaselenoles; and hexadiselenoles.

Se Valence Stabilizer #13a: Examples of four-membered macrocyclics, macrobicyclics, and macropolycyclics (including catapinands, cryptands, cyclidenes, and sepulchrates) wherein all four binding sites are composed of selenium and are contained in a combination of 5-membered heterocyclic rings and selenol and selenoether groups (Se—Se Tetradentates) that meet the requirements for use as "narrow band" valence stabilizers for $Co^{+3}$ include, but are not limited to: di selenatetraselenophenes; tetraselenatetraselenophenes; diselenatetradiselenoles; and tetraselenatetradiselenoles.

Se Valence Stabilizer #13b: Examples of six-membered macrocyclics, macrobicyclics, and macropolycyclics (including catapinands, cryptands, cyclidenes, and sepulchrates) wherein all six binding sites are composed of selenium and are contained in a combination of 5-membered heterocyclic rings and selenol or selenoether groups (Se—Se Tridentates or Se—Se Hexadentates) that meet the requirements for use as "narrow band" valence stabilizers for $Co^{+3}$ include, but are not limited to: diselenahexaselenophenes; and triselenahexaselenophenes.

Se Valence Stabilizer #14a: Examples of four-membered macrocyclics, macrobicyclics, and macropolycyclics (including catapinands, cryptands, cyclidenes, and sepulchrates) wherein all four binding sites are composed of selenium and are contained in component 6-membered heterocyclic rings (Se—Se Tetradentates) that meet the requirements for use as "narrow band" valence stabilizers for $Co^{+3}$ include, but are not limited to: tetraselenopyrans; tetraselenaphosphorins; tetraselenadiphosphorins; tetraoxaselenins; and tetradiselenins.

Se Valence Stabilizer #14b: Examples of six-membered macrocyclics, macrobicyclics, and macropolycyclics (including catapinands, cryptands, cyclidenes, and sepulchrates) wherein all six binding sites are composed of selenium and are contained in component 6-membered heterocyclic rings (Se—Se Tridentates or Se—Se Hexadentates) that meet the requirements for use as "narrow band" valence stabilizers for $Co^{+3}$ include, but are not limited to: hexaselenopyrans; hexaselenaphosphorins; hexaselenadiphosphorins; hexaoxaselenins; and hexadiselenins.

Se Valence Stabilizer #15a: Examples of four-membered macrocyclics, macrobicyclics, and macropolycyclics (including catapinands, cryptands, cyclidenes, and sepulchrates) wherein all four binding sites are composed of selenium and are contained in a combination of 6-membered heterocyclic rings and selenol or selenoether groups (Se—Se Tetradentates) that meet the requirements for use as "narrow band" valence stabilizers for $Co^{+3}$ include, but are not limited to: diselenatetraselenopyrans; tetraselenatetraselenopyrans; diselenatetraselenaphosphorins; tetraselenatetraselenaphosphorins; diselenatetraoxaselenins; tetraselenatetraoxaselenins; diselenatetradiselenins; and tetraselenatetradiselenins.

Se Valence Stabilizer #15b: Examples of six-membered macrocyclics, macrobicyclics, and macropolycyclics (including catapinands, cryptands, cyclidenes, and sepulchrates) wherein all six binding sites are composed of selenium and are contained in a combination of 6-membered heterocyclic rings and selenol or selenoether groups (Se—Se Tridentates, Se—Se Tetradentates, or Se—Se Hexadentates) that meet the requirements for use as "narrow band" valence stabilizers for $Co^{+3}$ include, but are not limited to: diselenahexaselenopyrans; triselenahexaselenopyrans; diselenahexaselenaphosphorins; triselenahexaselenaphosphorins; diselenahexaoxaselenins; triselenahexaoxaselenins; diselenahexadiselenins; and triselenahexadiselenins.

Se Valence Stabilizer #16: Examples of 1,3-diselenoketones (diseleno-beta-ketonates), 1,3,5-triselenoketones, bis(1,3-diselenoketones), and poly(1,3-diselenoketones) (Se—Se Bidentates, Se—Se Tridentates, Se—Se Tetradentates) that meet the requirements for use as "narrow band" valence si abilizers for $Co^{+3}$ include, but are not limited to: hexafluoropentanediselenone; 1,3-diphenyl-1,3-propanediselenone; selenobenzoylselenopinacolone; diselenocyclohexoylmethane; diphenylpentanetriselenoate; tetramethylnonanetriselenoate; hexafluoroheptanetriselenoate; trifluoroheptanetriselenoate; 1-(2-thienyl)-1,3-butanediselenone, 1-(2-naphthyl)-1,3-butanediselenone, and trifluoroselenoacetylselenocamphor.

Se Valence Stabilizer #17: Examples of 1,1-diselenolates, bis(1,1-diselenolates), and poly(1,1-diselenolates) (Se—Se Bidentates and Se—Se Tetradentates) that meet the requirements for use as "narrow band" valence stabilizers for $Co^{+3}$ include, but are not limited to: 1,1-dicyano-2,2-ethylene diselenolate; 1,1-dicarboalkoxy-2,2-ethylene diselenolate; 1,1-di(trifluoromethyl)-2,2-ethylene diselenolate; 1,1-di(pentafluorophenyl)-2,2-ethylene diselenolate; 1-pentamethylene-2,2-ethylene diselenolate; and 1-nitroethylene diselenolate.

Se Valence Stabilizer #18: Examples of diselenocarbamates, bis(diselenocarbamates), and poly(diselenocarbamates) (including N-hydroxydiselenocarbamates and N-mercaptodiselenocarbamates) (Se—Se Bidentates, Se—Se Tridentates, and Se—Se Tetradentates) that meet the requirements for use as "narrow band" valence stabilizers for $Co^{+3}$ include, but are not limited to: dimethyldiselenocarbamate; di(trifluorodimethyl)diselenocarbamate; diethyldiselenocarbamate; dipropyldiselenocarbamate; diisopropyldiselenocarbamate; dibutyldiselenocarbamate; ditertbutyldiselenocarbamate; dicyanamidodiselenocarbamate; azidoselenoformates; diphenyldiselenocarbamate; di(pentafluorophenyl)diselenocarbamate; dibenzyldiselenocarbamate; dinaphthyldiselenocarbamate; dicyclohexyldiselenocarbamate; dinorbornyldiselenocarbamate; diadamantyldiselenocarbamate; pyrrolidinodiselenocarbamate; piperidinodiselenocarbamate; morpholinodiselenocarbamate; thiamorpholinodiselenocarbamate; 3-pyrrolinodiselenocarbamate; pyrrolodiselenocarbamate; oxazolodiselenocarbamate; isoxazolodiselenocarbamate; thiazolodiselenocarbamate; isothiazolodiselenocarbamate; indolodiselenocarbamate; carbazolodiselenocarbamate; pyrazolinodiselenocarbamate; imidazolinodiselenocarbamate; pyrazolodiselenocarbamate; imidazolodiselenocarbamate; indazolodiselenocarbamate; and triazolodiselenocarbamate.

Se Valence Stabilizer #19: Examples of triselenophosphoric acids (phosphorotriselenoic acids), bis(triselenophosphoric acids), poly(triselenophosphoric acids), and derivatives thereof (Se—Se Bidentates, Se—Se Tridentates, Se—Se Tetradentates) that meet the requirements for use as "narrow band" valence stabilizers for $Co^{+3}$ include, but are not limited to: triselenophosphoric acid, O-phenyltriselenophosphoric acid, O-benzyltriselenophosphoric acid, O-cyclohexyltriselenophosphoric acid, O-norbornyltriselenophosphoric acid, O,Se-diphenyltriselenophosphoric acid, O,Se-dibenzyltriselenophosphoric acid, O,Se-dicyclohexyltriselenophosphoric acid, and O,Se-dinorbornyltriselenophosphoric acid.

Se Valence Stabilizer #20: Examples of diselenophosphoric acids (phosphorodiselenoic acids), bis(diselenophosphoric acids), poly(diselenophosphoric acids), and derivatives thereof (Se—Se Bidentates, Se—Se Tridentates, Se—Se Tetradentates) that meet the requirements for use as "narrow band" valence stabilizers for $Co^{+3}$ include, but are not limited to: diselenophosphoric acid, O-phenyldiselenophosphoric acid, O-benzyldiselenophosphoric acid, O-cyclohexyldiselenophosphoric acid, O-norbornyldiselenophosphoric acid, O,O-diphenyldiselenophosphoric acid, O,O-dibenzyldiselenophosphoric acid, O,O-dicyclohexyldiselenophosphoric acid, and O,O-dinorbornyldiselenophosphoric acid.

Se Valence Stabilizer #21: Examples of tetraselenophosphoric acids (phosphorotetraselenoic acids), bis(tetraselenophosphoric acids), poly(tetraselenophosphoric acids), and derivatives thereof (Se—Se Bidentates, Se—Se Tridentates, Se—Se Tetradentates) that meet the requirements for use as "narrow band" valence stabilizers for $Co^{+3}$ include, but are not limited to: tetraselenophosphoric acid, Se-phenyltetraselenophosphoric acid, Se-benzyltetraselenophosphoric acid, Se-cyclohexyltetraselenophosphoric acid, Se-norbornyltetraselenophosphoric acid, Se,Se-diphenyltetraselenophosphoric acid, Se,Se-dibenzyltetraselenophosphoric acid, Se,Se-dicyclohexyltetraselenophosphoric acid, and Se,Se-dinorbornyltetraselenophosphoric acid.

Se Valence Stabilizer #22: Examples of diselenocarbonates, triselenocarbonates, bis(diselenocarbonates), and bis(triselenocarbonates), (Se—Se Bidentates and S—S Tetradentates) that meet the requirements for use as "narrow band" valence stabilizers for $Co^{+3}$ include, but are not limited to: Se,Se-diethyldiselenocarbonate; Se,Se-diisopropyldiselenocarbonate; Se,Se-diphenyldisel enocarbonate; Se,Se-dibenzyldi sel enocarbonate; Se,Se-dicyclohexyldiselenocarbonate; Se,Se-dinorbornyldiselenocarbonate; diethyltriselenocarbonate; diisopropyltriselenocarbonate; diphenyltriselenocarbonate; dibenzyltriselenocarbonate; dicyclohexyltriselenocarbonate; and dinorbornyltriselenocarbonate.

Se Valence Stabilizer #23: Examples of selenocyanate ligands (Se monodentates) that meet the requirements for use as "narrow band" valence stabilizers for $Co^{+3}$ include, but are not limited to: selenocyanate (—SeCN).

Se Valence Stabilizer #24: Examples of selenolates (Se monodentates) that meet the requirements for use as "narrow band" valence stabilizers for $Co^{+3}$ include, but are not limited to: selenophenol; and naphthaleneselenol.

MiscellaneousValence Stabilizer#1: Examples of diene,bicyclicand tricyclichydrocarbon ligands that meet the requirements for use as "narrow band" valence stabilizers for $Co^{+3}$ include, but are not limited to: cyclopentadiene; azulene; carotene; norbornane; and adamantane.

Miscellaneous Valence Stabilizer #2: Examples of cyanide and related ligands that meet the requirements for use as "narrow band" valence stabilizers for $Co^{+3}$ include, but are not limited to: cyanide (—CN); and fulminate (—CNO).

Miscellaneous Valence Stabilizer #3: Examples of carbonyl ligands that meet the requirements for use as "narrow band" valence stabilizers for $Co^{+3}$ include, but are not limited to: carbonyl (—CO); and carbon dioxide ($CO_2$) ligands.

Miscellaneous Valence Stabilizer #4: Examples of halogens that meet the requirements for use as "narrow band" valence stabilizers for $Co^{+3}$ include, but are not limited to: fluorine; chlorine; bromine; and iodine.

Miscellaneous Valence Stabilizer #5: Examples of hydroxo and oxo functionalities that meet the requirements for use as "narrow band" valence stabilizers for $Co^{+3}$ include, but are not limited to: water ($H_2O$); dioxygen ($O_2$); oxide ($O^{2-}$); hydroxide ($OH^-$); peroxo groups ($O_2^{2-}$); and superoxo groups ($O_2^-$).

As discussed above, the properties of a particular $Co^{+3}$-containing complex can be altered by changing the substituent groups on these general classes of valence stabilizers. This can influence the effectiveness of corrosion inhibition normally achieved using that specific complex.

4e) Mixed Inorganic/Organic Valence Stabilizers

Mixing inorganic and organic valence stabilizers in a conversion coating solution will often result in a coating with poor corrosion inhibiting properties because of cross interference. Inorganic and organic stabilizers interact with $Co^{+3}$ in different ways. For example, inorganic valence stabilizers will perform their function by forming a shell of octahedrally or tetrahedrally coordinated anionic species around a captured $Co^{+3}$ ion. Therefore, the net charge of these inorganic $Co^{+3}$-stabilizer complexes is always negative. Organic species stabilize by the formation of a "soft bond" between the bonding atom in the stabilizer (e.g., nitrogen or sulfur) and the $Co^{+3}$ ion. The net charge of these complexes is usually positive. If these two very different types of stabilization ligands are combined, then the magnitude of the charge on the stabilized complex can be reduced significantly. The performance of organic or inorganic stabilized corrosion inhibitor complexes has been found to be directly related to the ability of the complex to form and sustain a thick electrostatic barrier layer. Additionally, a mixed stabilizer can have a poorly developed electrostatic field and a non-optimal packing around the $Co^{+3}$ ion, resulting in a complex with less resistance to aqueous attack. Mixed organic/inorganic stabilized $Co^{+3}$ coatings will generally perform more poorly than coatings that have exclusively organic or inorganic valence stabilizers for this reason.

4f) Valence Stabilizers for Tetravalent Cobalt

The $Co^{+4}$ ion forms very few stable complexes with organic compounds, and no currently known inorganically stabilized complexes. $Co^{+4}$ may be used in broader applications in the future with compounds not currently identified. Examples of typical organic ligands for $Co^{+4}$ include dithiocarbamates, dithiolenes, dithiols, dithioketones, norbornyls, biguamides, azo oximes (including hydrazone oximes), some Schiff Bases, and some azo compounds.

5) Additional Solubility Control Agents

One of the roles of the valence stabilizer is to allow for the formation of a trivalent cobalt complex that has a specific solubility range. The anions or cations present in the coating solution maybe sufficient to form a Co 3-containing compound within the conversion coating that exhibits the desired solubility characteristics. However, additional solubility control may be desirable to optimize the performance of the trivalent cobalt-valence stabilizer complex. The use of an additional solubility control agent is optional, not required.

Both the organic and inorganic valence stabilizers described above may need some kind of additional solubility control that can be in the form of either inorganic or organic compounds. The key to selecting solubility control agents is to match the cationic or anionic modifiers with individual $Co^{+3}$-valence stabilizer combinations. Some cations or anions may work to optimize one $Co^{+3}$-valence stabilizer complex, but this does not necessarily mean they will optimize the solubility of a different complex.

The initial formation of a conversion coating may produce $Co^{43}$ compounds with solubilities greater than optimal. A post-deposition treatment can be applied to the coating as a remedial treatment or as a desired process step. Additional solubility control agents applied to a work piece can enhance the $Co^{+3}$ content of the coating by forming more insoluble compounds in place. Application of a second solution after the conversion coating process has been found to result in enhanced solubility control of $Co^{+3}$ in the conversion coating.

Additional solubility control agents are typically applied as a second solution. Otherwise, these cations or anions would begin to precipitate cobalt-containing compounds in the conversion coating solution, depleting it of cobalt prior to treating the work piece. In general, fine tuning of solubilityby cationic species is typical for $Co^{+3}$-stabilizer combinations when an inorganic valence stabilizer is used, and by anionic species when an organic valence stabilizer is used.

The need for an additional solubility control agent may be illustrated for the situation where molybdate is used as a valence stabilizer for a $Co^{+3}$ conversion coating. Cationic species are necessary to deposit a $Co^{+3}$/molybdate complex within the coating (the net charge on a $Co^{+3}$/heteropolymolybdate anion may either be −3 or −6). The cationic species needed to balance the charge and form a compound is usually supplied from cations already present in the conversion coating solution and/or by cations being pulled into the solution from the work piece. However, if the $Co^{+3}$/molybdate complex composed of the available cations has a much greater solubility than desired, then additional solubility control agents will be required. The differences in effectiveness of conversion coatings on various alloy compositions is likely a reflection of the influence that the composition of the alloy itselfhas on the solubility of the deposited conversion coating. Similarly, anions present in a conversion coating solution or source material will be incorporated in a $Co^{+3}$ compound that requires a negative charge balance. This is frequently observed with $Co^{+3}$/organic valence stabilizer combinations.

Additional solubility control can be achieved through the use ofnon-toxic inorganic cations which include, but are not limited to: $H^+$, $Li^+$, $Na^+$, $K^+$, $Rb^+$, $Cs^+$, $NH_4^+$, $Mg^{+2}$, $Ca^{+2}$, $Sr^{+2}$, $Y^{+3}$, $La^{+3}$, $Ce^{+3}$, $Ce^{+4}$, $Nd^{+3}$, $Pr^{+3}$, $Sc^{+3}$, $Sm^{+3}$, $Eu^{+3}$, $Eu^{+2}$, $Gd^{+3}$, $Tb^{+3}$, $Dy^{+3}$, $Ho^{+3}$, $Er^{+3}$, $Tm^{+3}$, $Yb^{+3}$, $Lu^{+3}$, $Ti^{+4}$, $Zr^{+4}$, $Ti^{+3}$, $Hf^{+4}$, $Nb^{+4}$, $Ta^{+4}$, $Nb^{+4}$, $Ta^{+4}$, $Mo^{+6}$, $W^{+6}$, $Mo^{+5}$, $W^{+5}$, $Mo^{+4}$, $W^{+4}$, $Mn^{+2}$, $Mn^{+3}$, $Mn^{+4}$ $Fe^{+2}$, $Fe^{+3}$, $Co^{+2}$, $Co^{+3}$, $Ru^{+2}$, $Ru^{+3}$, $Ru^{+4}$, $Rh^{+4}$, $Ir^{+3}$, $Rh^{+2}$, $Ir^{+2}$, $Pd^{+4}$, $Pt^{+4}$, $Pd^{+2}$, $Pt^{+2}$, $Cu^+$, $Cu^{+2}$, $Cu^{+3}$, $Ag^+$, $Ag^{+2}$, $Ag^{+3}$, $Au^+$, $Au^{+2}$, $Au^{+3}$, $Zn^{+2}$, $Al^{+3}$, $Ga^{+3}$, $Ga^+$, $In^{+3}$, $In^+$, $Ge^{+4}$, $Ge^{+2}$, $Sn^{+2}$, $Sn^{+4}$, $Sb^{+3}$, $Sb^{+5}$, $Bi^{+3}$, and $Bi^{+5}$. Any water-soluble compound that contains these cations can be used for this purpose. Nitrates, chlorides, bromides, and perchlorates of these cations offer inexpensive water-soluble precursors, although many other water-soluble precursors exist.

Cationic solubility control may also be achieved through the use ofnontoxic organic cations that include, but are not limited to: quaternary ammonium compounds ($NR_4$+, where R can be any combination of alkyl, aromatic, or acyclic organic substituents, such as the methyltriethylammonium ion); organics that contain at least one N+site (such as pyridinium or thiazolium cations); organics that contain at least one phosphonium site ($P^+$, such as the benzyltriphenylphosphonium ion); organics that contain at least one stibonium site ($Sb^+$, such as the tetraphenylstibonium ion); organics that contain at least one oxonium site ($O^+$, such as pyrylium cations); organics that contain at least one sulfonium site ($S^+$, such as the triphenylsulfonium ion); and organics that contain at least one iodonium site ($I^+$, such as the diphenyliodonium ion).

The quaternary ammonium compounds, organics containing at least one $N^+$ site, and organics containing at least one oxonium site are the most important of these classifications because of the very large number of stable cations that are available. Water-soluble precursors for these organic cations are desirable in order to maximize the amount of material available in the appropriate conversion coating solution. Fluorides, chlorides, and bromides offer the most water-soluble precursors for these organic cations, although lower molecular weight nitrates and perchlorates of these cations (e.g., tetramethylammonium) are also acceptable water-soluble precursors. Larger molecular weight nitrates and perchlorates are not generally acceptable as precursors because of their low water solubility.

Although it is less desirable, toxic inorganic or organic cations can be used as additional solubility control agents. Examples oftoxic inorganic cations that can be used include, but are not limited to: $Be^{+2}$, $Ba^{+2}$, $V^{+5}$, $V^{+4}$, $V^{+3}$, $Cr^{+3}$, $Ni^{+2}$, $Ni^{+4}$, $Os^{+4}$, $Cd^{+2}$, $Hg^{+1}$, $Hg^{+2}$, $Tl^{+}$, $Tl^{+3}$, $As^{+3}$, $As^{+5}$ $Pb^{+2}$, and $Pb^{+4}$. Examples of toxic organic cations include, but are not limited to: organic compounds that contain at least one arsonium site ($As^+$, an example being the tetraphenylarsonium ion) and organic compounds that contain at least one selenonium site (Se, an example being the triphenylselenonium ion). Use of these materials for additional solubility control may be desirable in some specific instances where the toxicity of the coating baths is of limited importance to the operator. Water-soluble precursors for these toxic cations are desirable in order to maximize the amount of available cation for solubility control. In general, the nitrates, fluorides, chlorides, bromides, and perchlorates of these cations offer the highest water solubility.

Additional solubility control can also be achieved through the use of nontoxic inorganic anions, especially for $Co^{+3}$/organic valence stabilizer combinations. Water-soluble precursors for these inorganic anions are desirable in order to maximize the amount of material available in the appropriate conversion coating solution. These include, but are not limited to: fluorotitanates, chlorotitanates, fluorozirconates, chlorozirconates, fluoroniobates, chloroniobates, fluorotantalates, chlorotantalates, molybdates, tungstates, permanganates, fluoromanganates, chloromanganates, fluoroferrates, chloroferrates, fluorocobaltates, chlorocobaltates, fluorozincates, chlorozincates, borates, fluoroborates, fluoroaluminates, chloroaluminates, carbonates, silicates, fluorosilicates, fluorostannates, nitrates, nitrites, azides, phosphates, phosphites, phosphonates, phosphinites, thiophosphates, thiophosphites, thiophosphonates, thiophosphinites, fluorophosphates, fluoroantimonates, chloroantimonates, sulfates, sulfites, sulfonates, thiosulfates, dithionites, dithionates, fluorosulfates, tellurates, fluorides, chlorides, chlorates, perchlorates, bromides, bromates, iodides, iodates, periodates, and heteropolyanions (e.g., heteropolymolybdates, silicomolybdates).

Additional solubility control can also be achieved through the use of an almost unlimited number of non-toxic organic anions (e.g., organics with different carboxylates or acid groups). Examples include, but are not limited to: ferricyanides; ferrocyanides; cyanocobaltates; cyanocuprates; cyanomanganates; cyanates; cyanatoferrates; cyanatocobaltates; cyanatocuprates; cyanatomanganates; thiocyanates; thiocyanatoferrates; thiocyanatocobaltates; thiocyanatocuprates; thiocyanatomanganates; cyanamides; cyanamidoferrates; cyanamidocobaltates; cyanamidocuprates; cyanamidomanganates; nitritoferrates; nitritocobaltates; azides; (thio)carboxylates, di(thio)carboxylates, tri(thio)carboxylates, or tetra(thio)carboxylates [useful representatives including, but not limited to, acetic acid, benzoic acid, succinic acid, fumaric acid, salicylic acid, lactic acid, tartaric acid, antimonyl tartrates, cinnamic acid, adipic acid, phthalic acid, terephthalic acid, citric acid, ascorbic acid, malic acid, malonic acid, oxalic acid, stearic acid, gallic acid, naphthenic acid, camphoric acid, nitrosalicylic acid, aminosalicylic acid, acetylsalicylic acid, sulfosalicylic acid, nitrobenzoic acid, perfluoro$C_{2-6}$carboxylic acids, trinitrobenzoic acid, chlorobenzoic acid, anisic acid, iodobenzoic acid, anthranilic acid, mandelic acid, toluic acid, nicotinic acid, isonicotinic acid, pyrazolecarboxylic acid, picrolonic acid, quinaldic acid, diphenic acid, benzoquinaldic acid, quinolinecarboxylic acid, isoquinolinecarboxylic acid, triazinecarboxylic acid, (thio)carbonic acids, (thio)carbamic acids, trimethylhexylic acid, tetrafluorophthalic acid, ethylenediaminetetraacetic acid, toluoylpropionic acid, lactobionic acid, octylthiopropionate, lipoic acid, methylbenzoylpropionic acid, anthracenesuccinic acid, benzothiazolecarboxylic acid, phenylacetic acid, glycolic acid, thioglycolic acid, benzothiazolylthiosuccinic acid, benzothiazolylthiopropionic acid, phenylanthranilic acid, furancarboxylic acid, nitrofuroic acid, phosphonobutanetricarboxylic acid, benzothiazolylthiosuccinic acid, N-phosphonomethylglycine, cresoxyacetic acid, aminobutyric acid, alanine, asparagine, cysteine, glutamine, glycine, leucine, methionine, phenylalanine, proline, serine, threonine, tryptophan, tyrosine, valine, glutamic acid, aspartic acid, arginine, histidine, lysine, trihydroxyglutaric acid, phenoxyacetic acid, hydroxynaphthoic acid, phenylbutyric acid, hydroxyphosphonoacetic acid, tropic acid, aminophenylpropionic acid, dihydrocinnainic acid, hydroxycinnamic acid, cinchomeronic acid, aurintricarboxylic acid, benzotriazolecarboxylic acid, hydroxyphosphonoacetic acid, cyanuric acid, barbituric acid, violuric acid, diphenylvioluric acid, dilituric acid, thiobarbituric acid, cresotic acid, trimethylhexylic acid, nitrilotriacetic acid, N,N'-terephthaloylbis(aminocaproic acid), ethyleneglycolbis(aminoethylether)tetraacetic acid, diethylenetriaminepentaacetic acid, 2-phosphonobutanetricarboxylic acid, N,N'-bis(2-hydroxysuccinyl)ethylenediamine, nicotinic acid, naptalam, nitrobenzoic acid, nonylphenoxyacetic acid, and olsalazine]; (thio)pbenolates, di(thio)phenolates, tri(thio)phenolates, or tetra(thio)phenolates [useful representatives including, but not limited to, pyrocatechol, resorcinol, picric acid, styphnic acid, pyrogallol, purpurin, purpurogallin, benzopurpurin, gallein, thiophenol, rhodizonic acid, kojic acid, chromotropic acid, carminic acid, fluorescein, tannic acid, and humic acid]; (thio)phosphonates, di(thio)phosphonates, or tri(thio)phosphonates [useful representatives including, but not limited to, diethylphosphonic acid, diphenylphosphonic acid, nitrophenylphosphonic acid, perfluoro$C_{2-16}$phosphonic acids, benzenephosphonic acid, phytic acid, hydroxyethylidenebisphosphonic acid, nitrilotrimethylenephosphonic acid, aminomethylenephosphonic acid, etidronic acid, ethylphosphonic acid, chloroethylphosphonic acid, ethylenediaminotetramethylenephosphonic acid, laurylhydroxydiphosphonic acid, methylaminodimethylenephosphonic acid, alkyl(aryl)diphosphonic acids, N-cetylaminoethanediphosphonic acid, carboxyhydroxymethylphosphonic acid (hpa), oxyethylidenediphosphonic acid, polycaproamidophosphonates, phenylethanetriphosphonic acid, oxidronic acid, and pamidronic acid]; (thio)phosphonamides, di(thio)phosphonamides, or tri(thio)phosphonamides [useful representatives including, but not limited to, phosphoramidic acid, phosphordiamidic acid (diamidophosphonic acid), and phosphoramidothioic acid]; amino(thio)phosphonates, diamino (thio)phosphonates, or triamino(thio)phosphonates; imino (thio)phosphonates or diimino(thio)phosphonates; (thio) sulfonates, di(thio)sulfonates, or tri(thio)sulfonates [useful representatives including, but not limited to, methanesulfonic acid, benzenesulfonic acid, aminobenzenesulfonic acid (sulfanilic acid), nitrobenzenesulfonic acid, phenylsulfonic acid, naphthalenesulfonic acid, nitronaphthalenesulfonic acid, oxinesulfonic acid, alizarinsulfonic acid, benzidinesulfonic acid, flavianic acid, camphorsulfonic acid, diiodophenolsulfonic acid (sozoiodol), 8-hydroxyquinoline-5-sulfonic acid, 7-nitro-8-hydroxyquinoline-5-sulfonic acid, benzotriazolesulfonic acid, bis(trifluoromethyl)benzenesulfonic acid, diiododihydroxybenzophenonesulfonic acid, p-amino-p'-ethoxydiphenylamine-o-sulfonic acid, 1-amino-2-naphthol-4-sulfonic acid, 1,2-diaminoanthraquinone-3-sulfonic acid, 1,5-dinitro-2-naphthol-7-sulfonic acid, perfluoro$C_{2-16}$sulfonic acids, benzenedisulfonic acid, phenyldisulfonic acid, naphthalenedisulfonic acid, 3,6-naphtholdisulfonic acid, indigodisulfonic acid, benzidinedisulfonic acid, carboxyiodobenzenesulfonic acids, N-benzeneaminomethanesulfonic acid (ams), amido-G-acid, amido-R-acid, naphthalene(di)sulfonic acid (Armstrong's acid), amsonic acid, Badische acid, camphorsulfonic acid, chrysophenine, Cassella's acid, chromotropic acid, Cleve's acid, croceic acid, anthracenesulfonic acid, hydroxyquinolinesulfonic acid, hydrazinobenzenesulfonic acid, indigo carmine, indoxyl, isatinsulfonic acid, indican, lignosulfonic acid, metanil yellow, metanilic acid, naphthoquinonesulfonic acid, Nuclear Fast Red, naphthol(di)sulfonic acid, naphthylamine(di)sulfonic acid, Orange I, orthanilic acid, phenol(di)sulfonic acid, methylenedinaphthalenesulfonic acid, methyl orange, and piperazinediethanesulfonic acid (pipes)]; (thio)sulfonamides, di(thio)sulfonamides, or tri(thio)sulfonamides; amino(thio)sulfonates, diamino(thio)sulfonates, or triamino (thio)sulfonates; imino(thio)sulfonates (including sulfamates) or diimino(thio)sulfonates (including disulfamates) [useful representatives including, but not limited to, methylsulfamic acid and phenylsulfamic acid]; (thio)borates, di(thio)borates, or (thio)boronates [useful representatives including, but not limited to, phenylboric acid and borotartaric acid]; organic silicates; and stibonates [useful representatives including, but not limited to, antimonyl tartrate and benzenestibonic acid]. Water-soluble precursors for these organic anions are desirable to maximize the amount available in the appropriate conversion coating solution.

Finally, toxic inorganic or organic anions can be used as additional solubility control agents, although this is less desirable. Examples oftoxic inorganic anions include, but are not limited to: arsenates, arsenites, fluoroarsenates, chloroarsenates, selenates, selenites, fluorothallates, chlorothallates, iodomercury anions (e.g., Nessler's reagent), thiocyanatomercury anions (e.g., Behren's reagent), chloromercurates, bromomercurates, osmates, fluoronickelates, chromates, Reinecke's salt, and vanadates. Examples of toxic organic anions include cyanides; cyanochromates; cyanonickelates; cyanatochromates; cyanatonickelates; thiocyanatochromates; thiocyanatonickelates; cyanamidochromates; cyanamidonickelates; nitritonickelates; arsonates, diarsonates, or triarsonates [useful representatives including, but not limited to, propylarsonic acid, phenylarsonic acid, hydroxyphenylarsonic acid, benzenearsonic acid, methylbenzenearsonic acid, hydroxybenzenearsonic acid, and nitrobenzenearsonic acid]; organic selenates, diselenates, or triselenates. These materials may be necessary in some specific instances for additional solubility control where coating bath toxicity is of limited importance. Water-soluble precursors for these anions are desirable in order to maximize the amount of available anion to interact with the $Co^{+3}$ complex. The alkali or ammonium species of these anions typically offer the greatest water solubility.

6) Agents to Increase Color-Fastness of Coating

Conversion coatings will frequently be colored to improve the aesthetic nature of the work piece, as well as to aid in the identification of coated versus uncoated areas. Long-term exposure to high energy wavelengths (i.e., the ultraviolet wavelengths of sunlight) may fade or dim the color of the coated work piece. The conversion coating solution may include agents that improve the color-fastness of the coating. Typically, these are termed "UV blockers" in the paint and coatings literature. Active UV blockers are typically dark in color and function by absorbing nearly all of the light energy. Passive UV blockers are light in color and function by reflecting back nearly all of the light energy. Examples of active UV blockers include carbon black, graphite and phthalocyanines. Examples of passive UV blockers include titanium oxide, tin oxide, silicon oxide, silicates, or aluminosilicates.

B. Solution Composition and Preparation

Additional important process considerations include chemical concentrations, pH of the coating solution, redox potential of the coating solution, application temperature, and contact time.

1) Solvents

Water is a typical solvent for these conversion coating solutions due to its availability and low cost. Other solvents or combinations of water with other solvents (such as alcohols, ketones, etc.) may also be used if desired. However, these processes will be more costly than those using water exclusively.

2) Cobalt Concentration

The maximum concentration of the cobalt source depends upon the solubility of the specific cobalt source used. Any concentration exceeding this precursor solubility will result in undissolved solid material that will not be incorporated into the conversion coating and may even act as flaws in the coating. The ambient temperature processes outlined here produce $Co^{+3}$ conversion coatings with exceptional corrosion inhibiting character. Therefore, the solubility of the cobalt sources in water at or near ambient temperature (25° C.) should be the maximum amount of the cobalt source that is added. Since the solubility of virtually all materials in water increases with temperature, more cobalt can be added to the conversion coating solution if the temperature of the bath is increased from ambient. Although higher temperatures lead to higher allowable concentrations of cobalt precursors, this is unnecessary and adds to the cost of the process.

Acidic pHs will typically increase the solubility of many inorganic materials, thereby increasing the concentration of cobalt available in solution. A general estimate of the maximum concentration of cobalt in the conversion coating solution at ambient conditions can be determined from the solubilities of some of the more desirable cobalt sources as listed in Table 3.

TABLE 3

Solubilities of Some Cobalt Sources under Ambient Conditions [Maximum Concentration of Cobalt in Solution] (at or near 25° C. and at or near pH 7)

| Cobalt Source | Solubility in Water (mole/L) |
|---|---|
| Cobalt (II) nitrate | $5.1 \times 10^{0}$ |
| Cobalt (II) sulfate | $2.3 \times 10^{0}$ |
| Cobalt (II) perchlorate | $7.08 \times 10^{0}$ |
| Cobalt (II) chloride | $3.46 \times 10^{0}$ |
| Cobalt (II) fluoride | $1.55 \times 10^{-1}$ |
| Cobalt (II) bromide | $3.05 \times 10^{0}$ |
| Cobalt (II) iodide | $1.08 \times 10^{1}$ |
| Cobalt (II) bromate | $1.08 \times 10^{0}$ |
| Cobalt (II) chlorate | $1.67 \times 10^{1}$ |
| Cobalt (II) hexafluorosilicate | $3.8 \times 10^{0}$ |
| Cobalt (II) formate | $2.7 \times 10^{-1}$ |
| Cobalt (II) acetate | $\sim 10^{0}$ |
| Cobalt (II) propionate | $1.3 \times 10^{0}$ |
| Cobalt (II) butyrate | $\sim 10^{0}$ |
| Cobalt (II) benzoate | $\sim 10^{0}$ |
| Hexaammine cobalt (III) chloride | $2.2 \times 10^{-1}$ |
| Hexaammine cobalt (III) nitrate | $4.9 \times 10^{-2}$ |
| Pentaammine cobalt (III) chloride | $9.3 \times 10^{-1}$ |

The depletion of cobalt from the coating solution below an acceptable level is a function of the amount of metal surface area being coated prior to regeneration of the solution. A coating applied to a very large surface area may deplete the solution to the point that subsequent solution applications no longer form effective coatings. Less cobalt will be removed from the conversion coating solution when treating a smaller surface area of metal, so more work pieces can be coated from the same solution.

The corrosion-inhibiting cobalt compounds formed on the surface of the metal exhibit solubilities ranging from approximately $5\times10^{-2}$ to $5\times10^{-5}$ moles/liter of cobalt in water. Coating solutions with cobalt concentrations much less than these concentrations may: 1) withdraw cobalt from the formed coating in order to attempt to reach an equilibrium, or 2) may produce an incomplete, poorly formed oxide film. Intentionally exhausted (depleted) conversion coating solutions have been observed to degrade a coated surface and return cobalt to the coating solution. The lowest concentration of cobalt in the precursor conversion coating bath from which some resultant corrosion inhibition will be exhibited is probably in the range of $1\times10^{-3}$ to $1\times10^{-4}$ moles/liter of cobalt. We used cobalt concentrations of approximately $1\times10^{-1}$ mole/liter of cobalt with excellent results.

3) Oxidizer Concentration

The concentration of the oxidizer source can range up to the maximum solubility of the specific oxidizer source used. Any concentration exceeding this solubility will result in undissolved solid material that will not be available to raise the redox potential of the conversion coating solution. This process is designed to operate at ambient temperatures, so the maximum concentration of oxidizer source should be restricted to its maximum solubility in water at or near ambient temperature (25° C.). As discussed above, more oxidizer can be added to the conversion coating solution ifthe temperature of the bath is increased from ambient. Higher temperatures may lead to higher allowable concentrations of oxidizer precursors, but this is unnecessary and undesirable in light of process economics. Table 4 shows the solubilities in water of some of the more desirable oxidizer sources.

TABLE 4

Solubilities of Some Oxidizer Sources under Ambient Conditions (At or near 25° C. and at or near pH 7)

| | Oxidizer Source | Example Precursor | Solubility in Water (mole/L) |
|---|---|---|---|
| A) | Peroxides and Superoxides | Hydrogen peroxide | 60 wt. % |
| | | Lithium peroxide | $\sim 1 \times 10^{0}$ |
| | | Sodium peroxide | $\sim 1 \times 10^{0}$ |
| | | Potassium superoxide | $\sim 1 \times 10^{0}$ |
| B) | Persulfates | Ammonium persulfate | $2.6 \times 10^{0}$ |
| | | Lithium persulfate | $\sim 3 \times 10^{0}$ |
| | | Sodium persulfate | $3.1 \times 10^{0}$ |
| | | Potassium persulfate | $2.0 \times 10^{-1}$ |
| | | Magnesium persulfate | $\sim 1 \times 10^{1}$ |
| | | Calcium persulfate | $\sim 1 \times 10^{1}$ |
| | | Strontium persulfate | $\sim 5 \times 10^{0}$ |
| | | Barium persulfate | $1.3 \times 10^{0}$ |
| C) | Perborates | Ammonium perborate | $1.8 \times 10^{-1}$ |
| | | Lithium perborate | $\sim 1 \times 10^{-1}$ |
| | | Sodium perborate | $1.7 \times 10^{-1}$ |
| | | Potassium perborate | $1.1 \times 10^{-1}$ |
| D) | Peroxybenzoates | Monoperoxyphthalic acid | $\sim 1 \times 10^{-1}$ |
| | | Magnesium monoperoxyphthalate | $\sim 1 \times 10^{-1}$ |
| | | Chloroperoxybenzoic acid | $\sim 1 \times 10^{-1}$ |
| E) | Chlorites | Lithium chlorite | $\sim 5 \times 10^{0}$ |
| | | Sodium chlorite | $4.3 \times 10^{0}$ |
| | | Calcium chlorite | $\sim 1 \times 10^{0}$ |
| | | Strontium chlorite | $\sim 5 \times 10^{-1}$ |
| | | Barium chlorite | $\sim 1 \times 10^{-1}$ |
| F) | Bromates | Ammonium bromate | $\sim 1 \times 10^{1}$ |
| | | Lithium bromate | $4.85 \times 10^{0}$ |
| | | Sodium bromate | $1.82 \times 10^{0}$ |
| | | Potassium bromate | $8.0 \times 10^{-1}$ |
| | | Rubidium bromate | $1.4 \times 10^{-1}$ |
| | | Cesium bromate | $1.4 \times 10^{-1}$ |
| | | Magnesium bromate | $1.0 \times 10^{0}$ |
| | | Calcium bromate | $\sim 1 \times 10^{0}$ |
| | | Strontium bromate | $9.1 \times 10^{-1}$ |
| | | Zinc bromate | $\sim 1 \times 10^{0}$ |
| | | Ferric bromate | $\sim 1 \times 10^{0}$ |
| G) | Hypochlorites | Lithium hypochlorite | $\sim 1 \times 10^{1}$ |
| | | Sodium hypochlorite | $\sim 1 \times 10^{1}$ |
| | | Magnesium hypochlorite | $\sim 1 \times 10^{1}$ |
| | | Calcium hypochlorite | $\sim 1 \times 10^{1}$ |
| | | Strontium hypochlorite | $\sim 5 \times 10^{0}$ |
| | | Barium hypochlorite | $\sim 5 \times 10^{0}$ |
| H) | Periodates | Periodic acid | $4.96 \times 10^{1}$ |
| | | Ammonium periodate | $1.3 \times 10^{-1}$ |
| | | Lithium periodate | $\sim 1 \times 10^{0}$ |
| | | Sodium periodate | $6.7 \times 10^{-1}$ |
| | | Potassium periodate | $2.9 \times 10^{-2}$ |
| | | Rubidium periodate | $2.4 \times 10^{-2}$ |
| | | Cesium periodate | $6.6 \times 10^{-2}$ |
| | | Magnesium periodate | $\sim 1 \times 10^{-2}$ |
| I) | Permanganates | Ammonium permanganate | $5.77 \times 10^{-1}$ |
| | | Lithium permanganate | $3.97 \times 10^{0}$ |
| | | Sodium permanganate | $\sim 1 \times 10^{0}$ |
| | | Potassium permanganate | $4.04 \times 10^{-1}$ |
| | | Magnesium permanganate | $\sim 1 \times 10^{1}$ |
| | | Calcium permanganate | $9.18 \times 10^{0}$ |
| | | Strontium permanganate | $7.67 \times 10^{0}$ |
| | | Barium permanganate | $2.01 \times 10^{0}$ |
| | | Zinc permanganate | $8.10 \times 10^{-1}$ |
| | | Ferric permanganate | $\sim 1 \times 10^{0}$ |
| J) | Chlorates | Lithium chlorate | $5.5 \times 10^{1}$ |
| | | Sodium chlorate | $7.5 \times 10^{0}$ |
| | | Potassium chlorate | $5.8 \times 10^{-1}$ |
| | | Rubidium chlorate | $3.0 \times 10^{-1}$ |
| | | Cesium chlorate | $2.9 \times 10^{-1}$ |
| | | Magnesium chlorate | $4.3 \times 10^{0}$ |
| | | Calcium chlorate | $7.4 \times 10^{0}$ |
| | | Strontium chlorate | $6.9 \times 10^{0}$ |
| | | Zinc chlorate | $8.6 \times 10^{0}$ |
| | | Barium chlorate | $8.5 \times 10^{-1}$ |

TABLE 4-continued

Solubilities of Some Oxidizer Sources under Ambient Conditions (At or near 25° C. and at or near pH 7)

| | Oxidizer Source | Example Precursor | Solubility in Water (mole/L) |
|---|---|---|---|
| K) | Perchlorates | Perchloric acid | 75 wt. % |
| | | Ammonium perchlorate | $1.3 \times 10^{0}$ |
| | | Lithium perchlorate | $5.6 \times 10^{0}$ |
| | | Sodium perchlorate | $1.5 \times 10^{1}$ |
| | | Potassium perchlorate | $3.6 \times 10^{-1}$ |
| | | Rubidium perchlorate | $2.2 \times 10^{-1}$ |
| | | Cesium perchlorate | $8.6 \times 10^{-2}$ |
| | | Magnesium perchlorate | $4.4 \times 10^{0}$ |
| | | Calcium perchlorate | $7.9 \times 10^{0}$ |
| | | Strontium perchlorate | $1.1 \times 10^{1}$ |
| | | Zinc perchlorate | $\sim 1 \times 10^{0}$ |
| | | Barium perchlorate | $5.1 \times 10^{0}$ |
| | | Aluminum perchlorate | $\sim 1 \times 10^{0}$ |
| | | Ferric perchlorate | $\sim 1 \times 10^{0}$ |
| | | Tetramethylammonium perchlorate | $\sim 1 \times 10^{0}$ |
| | | Tetraethylammonium perchlorate | $\sim 5 \times 10^{-1}$ |
| | | Tetrapropylammonium perchlorate | $\sim 1 \times 10^{-1}$ |
| L) | Nitrates | Nitric acid | 75 wt. % |
| | | Ammonium nitrate | $2.5 \times 10^{1}$ |
| | | Lithium nitrate | $1.3 \times 10^{1}$ |
| | | Sodium nitrate | $1.1 \times 10^{1}$ |
| | | Potassium nitrate | $7.4 \times 10^{0}$ |
| | | Rubidium nitrate | $3.0 \times 10^{0}$ |
| | | Cesium nitrate | $2.1 \times 10^{0}$ |
| | | Magnesium nitrate | $4.9 \times 10^{0}$ |
| | | Calcium nitrate | $2.1 \times 10^{1}$ |
| | | Strontium nitrate | $3.4 \times 10^{0}$ |
| | | Zinc nitrate | $6.2 \times 10^{0}$ |
| | | Barium nitrate | $3.3 \times 10^{-1}$ |
| | | Aluminum nitrate | $1.7 \times 10^{0}$ |
| | | Ferric nitrate | $5.7 \times 10^{0}$ |
| | | Tetramethylammonium nitrate | $\sim 1 \times 10^{1}$ |
| | | Tetraethylammonium nitrate | $\sim 5 \times 10^{0}$ |
| | | Tetrapropylammonium nitrate | $\sim 1 \times 10^{0}$ |
| | | Tetrabutylammonium nitrate | $\sim 5 \times 10^{-1}$ |

TABLE 4-continued

Solubilities of Some Oxidizer Sources under Ambient Conditions (At or near 25° C. and at or near pH 7)

| | Oxidizer Source | Example Precursor | Solubility in Water (mole/L) |
|---|---|---|---|
| M) | Nitrites | Lithium nitrite | $2.8 \times 10^{1}$ |
| | | Sodium nitrite | $1.3 \times 10^{1}$ |
| | | Potassium nitrite | $3.5 \times 10^{1}$ |
| | | Magnesium nitrite | $\sim 1 \times 10^{0}$ |
| | | Calcium nitrite | $3.9 \times 10^{0}$ |
| | | Strontium nitrite | $3.8 \times 10^{0}$ |
| | | Zinc nitrite | $\sim 1 \times 10^{0}$ |
| | | Barium nitrite | $2.9 \times 10^{0}$ |
| N) | Vanadates | Vandium pentoxide | $4.4 \times 10^{-2}$ |
| | | Ammonium vanadate | $4.4 \times 10^{-2}$ |
| | | Lithium vanadate | $\sim 1 \times 10^{0}$ |
| | | Sodium vanadate | $1.7 \times 10^{0}$ |
| | | Potassium vanadate | $\sim 1 \times 10^{0}$ |
| | | Magnesium vanadate | $\sim 1 \times 10^{0}$ |
| | | Calcium vanadate | $\sim 5 \times 10^{-1}$ |
| O) | Iodates | Iodic acid | $1.76 \times 10^{1}$ |
| | | Iodine pentoxide | $5.6 \times 10^{0}$ |
| | | Ammonium iodate | $1 \times 10^{-1}$ |
| | | Lithium iodate | $4.4 \times 10^{0}$ |
| | | Sodium iodate | $4.5 \times 10^{-1}$ |
| | | Potassium iodate | $2.2 \times 10^{-1}$ |
| | | Magnesium iodate | $2.3 \times 10^{-1}$ |

Low oxidizer concentrations may not oxidize a sufficient quantity of cobalt from the divalent state to the trivalent state. This would result in reduced corrosion inhibiting performance. The net redox potential of the coating solution is also a function of the surface area of the metal that has been coated. The redox potential decreases over time (e.g., several days), so these solutions require additions of oxidizer to maintain the redox potential.

4) Preparative Agent Concentration

The concentration of the preparative agent is desirable for the conversion coating process. Cratering of the coated metal surface has been found when the solution concentration of the preparative agent exceeds (or even approaches) the solubility of the precursor material. This cratering results in coatings with reduced corrosion resistance Solubility values for many fluorides (a typical preparative agent) are given in Table 5. The added concentrations should not exceed (or come close to) these values. Of course, variations in the solution temperature and pH will change the solubilities of each of these preparative agents, but the values given below can be used as general approximations.

TABLE 5

Solubilities of Fluoride Preparative Agents under Ambient Conditions [Maximum Allowable Concentrations in Solution] (At or near 25° C. and at near pH 7)

| Fluoride Source | Example Precursor | Solubility in Water (mole/L) |
|---|---|---|
| A) Simple Fluorides | Hydrofluoric acid | 75 wt. % |
| | Ammonium fluoride | $2.7 \times 10^{1}$ |
| | Lithium fluoride | $1.04 \times 10^{-1}$ |
| | Sodium fluoride | $1.01 \times 10^{0}$ |
| | Potassium fluoride | $1.59 \times 10^{1}$ |
| | Potassium bifluoride | $5.25 \times 10^{0}$ |
| | Rubidium fluoride | $1.25 \times 10^{1}$ |
| | Cesium fluoride | $2.42 \times 10^{1}$ |
| | Copper (II) fluoride | $4.62 \times 10^{-1}$ |
| | Silver (I) fluoride | $1.43 \times 10^{1}$ |
| | Zinc fluoride | $1.57 \times 10^{-1}$ |

TABLE 5-continued

Solubilities of Fluoride Preparative Agents under Ambient Conditions
[Maximum Allowable Concentrations in Solution]
(At or near 25° C. and at near pH 7)

| Fluoride Source | Example Precursor | Solubility in Water (mole/L) |
|---|---|---|
| | Aluminum fluoride | $6.6 \times 10^{-2}$ |
| | Titanium fluoride | $\sim 1 \times 10^{0}$ |
| | Zirconium fluoride | $8.3 \times 10^{-2}$ |
| | Germanium fluoride hydrate | $\sim 1 \times 10^{-1}$ |
| | Tin (II) fluoride | $\sim 1 \times 10^{-1}$ |
| | Tin (IV) fluoride | $\sim 1 \times 10^{0}$ |
| | Vanadium fluoride | $\sim 1 \times 10^{-1}$ |
| | Niobium fluoride | $\sim 1 \times 10^{0}$ |
| | Tantalum fluoride | $\sim 1 \times 10^{-1}$ |
| | Antimony (III) fluoride | $3.15 \times 10^{-1}$ |
| | Antimony (V) fluoride | $\sim 1 \times 10^{1}$ |
| | Manganese (II) fluoride | $7.1 \times 10^{-2}$ |
| | Cobalt (II) fluoride | $1.55 \times 10^{-1}$ |
| B) Hexafluorozirconates | Ammonium hexafluorozirconate | $\sim 1 \times 10^{-1}$ |
| | Lithium hexafluorozirconate | $\sim 8 \times 10^{-2}$ |
| | Sodium hexafluorozirconate | $\sim 6 \times 10^{-2}$ |
| | Potassium hexafluorozirconate | $8.12 \times 10^{-2}$ |
| | Rubidium hexafluorozirconate | $8.48 \times 10^{-2}$ |
| | Cesium hexafluorozirconate | $1.12 \times 10^{-1}$ |
| C) Hexafluorotitanates | Ammonium hexafluorotitanate | $\sim 1 \times 10^{-1}$ |
| | Lithium hexafluorotitanate | $\sim 5 \times 10^{-2}$ |
| | Sodium hexafluorotitanate | $\sim 1 \times 10^{-2}$ |
| | Potassium hexafluorotitanate | $6.0 \times 10^{-2}$ |
| | Rubidium hexafluorotitanate | $2.5 \times 10^{-2}$ |
| | Cesium hexafluorotitanate | $5.5 \times 10^{-2}$ |
| D) Hexafluorosilicates | Ammonium hexafluorosilicate | $1.04 \times 10^{0}$ |
| | Lithium hexafluorosilicate | $3.8 \times 10^{0}$ |
| | Sodium hexafluorosilicate | $3.5 \times 10^{-2}$ |
| | Potassium hexafluorosilicate | $5.5 \times 10^{-3}$ |
| | Rubidium hexafluorosilicate | $6.9 \times 10^{-3}$ |
| | Cesium hexafluorosilicate | $2.3 \times 10^{-2}$ |
| | Silver (I) hexafluorosilicate | $\sim 1 \times 10^{-0}$ |
| | Magnesium hexafluorosilicate | $3.9 \times 10^{0}$ |
| | Calcium hexafluorosilicate | $\sim 1 \times 10^{-1}$ |
| | Strontium hexafluorosilicate | $1.2 \times 10^{-1}$ |
| | Zinc hexafluorosilicate | $\sim 1 \times 10^{0}$ |
| | Copper (II) hexafluorosilicate | $7.4 \times 10^{0}$ |
| | Cobalt (II) hexafluorosilicate | $3.82 \times 10^{0}$ |
| | Manganese (II) hexaluorosilicate | $4.59 \times 10^{0}$ |
| | Iron (II) hexafluorosilicate | $4.19 \times 10^{0}$ |
| | Iron (III) hexafluorosilicate | $4.19 \times 10^{0}$ |
| E) Hexafluoroaluminates | Ammonium hexafluoroaluminate | $5.3 \times 10^{-2}$ |
| | Lithium hexafluoroaluminate | $6.6 \times 10^{-3}$ |
| | Sodium hexafluoroaluminate | $2.9 \times 10^{-3}$ |
| | Potassium hexafluoroaluminate | $6.1 \times 10^{-3}$ |
| F) Tetrafluoroborates | Ammonium tetrafluoroborate | $2.4 \times 10^{0}$ |
| | Lithium tetrafluoroborate | $\sim 1 \times 10^{0}$ |
| | Sodium tetrafluoroborate | $9.8 \times 10^{0}$ |
| | Potassium tetrafluoroborate | $3.5 \times 10^{-2}$ |
| G) Hexafluorogermanates | Ammonium hexafluorogermanates | $\sim 1 \times 10^{-1}$ |
| | Potassium hexafluorogermanates | $2.0 \times 10^{-2}$ |
| | Rubidium hexafluorogermanates | $\sim 1 \times 10^{-2}$ |
| | Cesium hexafluorogermanates | $\sim 1 \times 10^{-2}$ |
| H) Hexafluorostannates | Ammonium hexafluorostannate | $\sim 1 \times 10^{-1}$ |
| | Lithium hexafluorostannate | $\sim 1 \times 10^{-2}$ |
| | Sodium hexafluorostannate | $\sim 1 \times 10^{-2}$ |
| | Potassium hexafluorostannate | $1.28 \times 10^{-1}$ |
| | Rubidium hexafluorostannate | $6.2 \times 10^{-2}$ |
| | Cesium hexafluorostannate | $7.9 \times 10^{-2}$ |
| I) Hexafluorohafnates | Ammonium hexafluorohafnate | $\sim 1 \times 10^{0}$ |
| | Lithium hexafluorohafnate | $\sim 1 \times 10^{-1}$ |
| | Sodium hexafluorohafnate | $\sim 7 \times 10^{-2}$ |
| | Potassium hexafluorohafnate | $1.3 \times 10^{-1}$ |
| | Rubidium hexafluorohafnate | $1.9 \times 10^{-1}$ |
| | Cesium hexafluorohafnate | $1.7 \times 10^{-1}$ |
| J) Hexafluorogallates | Ammonium fluorogallate | $\sim 1 \times 10^{-2}$ |
| | Alkali/Alkaline fluorogallates | $\sim 1 \times 10^{-2}$ |
| | Silver (I) fluorogallate | $\sim 1 \times 10^{0}$ |
| | Copper (II) fluorogallate | $\sim 1 \times 10^{-2}$ |

TABLE 5-continued

Solubilities of Fluoride Preparative Agents under Ambient Conditions
[Maximum Allowable Concentrations in Solution]
(At or near 25° C. and at near pH 7)

| Fluoride Source | Example Precursor | Solubility in Water (mole/L) |
|---|---|---|
| | Zinc fluorogallate | $\sim 1 \times 10^{-1}$ |
| | Manganese (II), iron (II), and cobalt (II) fluorogallates | $\sim 1 \times 10^{-2}$ |
| K) Hexafluorophosphates | Ammonium hexafluorophosphate | $\sim 1 \times 10^{0}$ |
| | Lithium hexafluorophosphate | $\sim 2 \times 10^{0}$ |
| | Sodium hexafluorophosphate | $5.6 \times 10^{0}$ |
| | Potassium hexafluorophosphate | $5.1 \times 10^{-1}$ |
| | Rubidium hexafluorophosphate | $\sim 1 \times 10^{-1}$ |
| | Cesium hexafluorophosphate | $\sim 1 \times 10^{-1}$ |
| L) Hexafluoroantimonates | Ammonium hexafluoroantimonate | $4.7 \times 10^{0}$ |
| | Lithium hexafluoroantimonate | $\sim 1 \times 10^{0}$ |
| | Sodium hexafluoroantimonate | $4.97 \times 10^{0}$ |
| | Potassium hexafluoroantimonate | $3.7 \times 10^{0}$ |
| | Rubidium hexafluoroantimonate | $1.6 \times 10^{0}$ |
| | Cesium hexafluoroantimonate | $\sim 5 \times 10^{0}$ |
| M) Heptafluoroniobates | Lithium heptafluoroniobate | $\sim 5 \times 10^{-1}$ |
| | Sodium heptafluoroniobate | $\sim 5 \times 10^{-2}$ |
| | Potassium heptafluoroniobate | $2.6 \times 10^{-1}$ |
| | Rubidium heptafluoroniobate | $\sim 1 \times 10^{-1}$ |
| | Cesium heptafluoroniobate | $\sim 3 \times 10^{-1}$ |
| N) Heptafluorotantalates | Lithium heptafluorotantalate | $\sim 5 \times 10^{-1}$ |
| | Sodium heptafluorotantalate | $\sim 5 \times 10^{-2}$ |
| | Potassium heptafluorotantalate | $\sim 3 \times 10^{-1}$ |
| | Rubidium heptafluorotantalate | $\sim 1 \times 10^{-1}$ |
| | Cesium heptafluorotantalate | $\sim 3 \times 10^{-1}$ |

The concentration of preparative agent must be sufficient to treat the selected surface because the preparative agent initiates the entire coating process. Low fluoride ion concentrations result in thin coatings that do not exhibit an acceptable degree of corrosion inhibition. The substrate metal remains smooth and bright, and no visible coating action takes place at very low fluoride ion concentrations. These effects were found to begin when the ratio of fluoride ions to cobalt ions in the coating solution falls below a ratio of 0.05. Therefore, the minimum recommended fluoride-to-cobalt ratio is 0.05.

5) Valence Stabilizer Concentration

The concentration of the valence stabilizer can be any concentration up to the maximum solubility of the specific valence stabilizer source used. Any concentration exceeding this solubility will result in undissolved solid material that will not be available for stabilizing the desired trivalent cobalt ions. Since this process was developed to operate at ambient temperature, the concentration of valence stabilizer source should be restricted to its maximum solubility in water at or near ambient temperature (25° C.). Higher temperatures may allow more valence stabilizer to be added to the conversion coating solution, but this is unnecessary and adds additional cost to the process. Table 6 shows the aqueous solubilities of some of the more desirable sources for wide band (typical) inorganic valence stabilizers, and Table 7 shows the aqueous solubilities of some sources for narrow band (less typical) inorganic valence stabilizers.

TABLE 6

Solubilities of Wide Band Inorganic Valence Stabilizer Precursors under Ambient Conditions
[Maximum Allowable Concentrations in Solution]
(At or near 25° C. and at or near pH 7)

| Inorganic Valence Stabilizer | Example Precursors | Solubility in Water (mole/L) |
|---|---|---|
| Molybdates | Molybdenum trioxide | $7.4 \times 10^{-3}$ |
| | Molybdic acid | $7.4 \times 10^{-3}$ |
| | Ammonium molybdate | $\sim 5 \times 10^{0}$ |
| | Lithium molybdate | $\sim 1 \times 10^{1}$ |
| | Sodium molybdate | $2.15 \times 10^{2}$ |
| | Potassium molybdate | $7.75 \times 10^{2}$ |
| | Rubidium molybdate | $6.4 \times 10^{0}$ |
| | Cesium molybdate | $4.8 \times 10^{0}$ |
| | Magnesium molybdate | $7.4 \times 10^{-1}$ |
| Tungstates | Tungstic acid | $8.0 \times 10^{-1}$ |
| | Ammonium tungstate | $\sim 1 \times 10^{2}$ |
| | Lithium tungstate | $5.8 \times 10^{1}$ |
| | Sodium tungstate | $2.49 \times 10^{2}$ |
| | Potassium tungstate | $1.42 \times 10^{2}$ |
| | Rubidium tungstate | $\sim 5 \times 10^{1}$ |
| | Cesium tungstate | $\sim 5 \times 10^{0}$ |
| | Magnesium tungstate hydrate | $7.2 \times 10^{-1}$ |
| Vanadates | Vanadium pentoxide | $4.4 \times 10^{-2}$ |
| | Ammonium vanadate | $4.4 \times 10^{-2}$ |
| | Lithium vanadate | $\sim 1 \times 10^{0}$ |
| | Sodium vanadate | $1.7 \times 10^{0}$ |
| | Potassium vanadate | $\sim 1 \times 10^{0}$ |

TABLE 6-continued

Solubilities of Wide Band Inorganic Valence Stabilizer Precursors under Ambient Conditions [Maximum Allowable Concentrations in Solution] (At or near 25° C. and at or near pH 7)

| Inorganic Valence Stabilizer | Example Precursors | Solubility in Water (mole/L) |
|---|---|---|
| | Rubidium vanadate | ~5 × $10^{-1}$ |
| | Cesium vanadate | ~5 × $10^{-1}$ |
| | Magnesium vanadate | ~1 × $10^{0}$ |
| | Calcium vanadate | ~5 × $10^{-1}$ |
| Niobates | Ammonium niobate | ~1 × $10^{-1}$ |
| | Lithium niobate | ~1 × $10^{-1}$ |
| | Sodium niobate | 5.9 × $10^{-2}$ |
| | Potassium niobate | ~5 × $10^{-2}$ |
| | Magnesium hexaniobate | 8.8 × $10^{-2}$ |
| | Calcium hexaniobate | 4.7 × $10^{-2}$ |
| Tantalates | Ammonium tantalate | ~1 × $10^{-2}$ |
| | Lithium tantalate | ~1 × $10^{-2}$ |
| | Sodium tantalate | 5.5 × $10^{-3}$ |
| | Potassium tantalate | ~5 × $10^{-3}$ |
| Tellurates | Telluric acid | ~5 × $10^{-1}$ |
| | Ammonium tellurate | ~5 × $10^{-1}$ |
| | Lithium tellurate | ~1 × $10^{0}$ |
| | Sodium tellurate | 2.8 × $10^{-2}$ |
| | Potassium tellurate | ~1 × $10^{-2}$ |
| | Rubidium tellurate | ~1 × $10^{-2}$ |
| | Cesium tellurate | ~1 × $10^{-2}$ |
| Periodates | Periodic acid | 4.96 × $10^{1}$ |
| | Ammonium periodate | 1.3 × $10^{-1}$ |
| | Lithium periodate | ~5 × $10^{1}$ |
| | Sodium periodate | 6.7 × $10^{-1}$ |
| | Potassium periodate | 2.9 × $10^{-2}$ |
| | Rubidium periodate | 2.4 × $10^{-2}$ |
| | Cesium periodate | 6.6 × $10^{-2}$ |
| | Magnesium periodate | ~5 × $10^{0}$ |
| Antimonates | Ammonium antimonate | ~1 × $10^{0}$ |
| | Lithium antimonate | ~1 × $10^{0}$ |
| | Sodium antimonate | 1.2 × $10^{-3}$ |
| | Potassium antimonate | 1.04 × $10^{-1}$ |
| | Rubidium antimonate | ~1 × $10^{-1}$ |
| | Cesium antimonate | ~5 × $10^{-2}$ |
| Stannates | Ammonium stannate | ~5 × $10^{0}$ |
| | Lithium stannate | ~5 × $10^{0}$ |
| | Sodium stannate | 2.3 × $10^{0}$ |
| | Potassium stannate | 3.7 × $10^{0}$ |
| | Rubidium stannate | ~5 × $10^{0}$ |
| | Cesium stannate | ~1 × $10^{0}$ |
| Iodates | Iodic acid | 1.76 × $10^{1}$ |
| | Iodine pentoxide | 5.6 × $10^{0}$ |
| | Ammonium iodate | 1 × $10^{-1}$ |
| | Lithium iodate | 4.4 × $10^{0}$ |
| | Sodium iodate | 4.5 × $10^{-1}$ |
| | Potassium iodate | 2.2 × $10^{-1}$ |
| | Rubidium iodate | 8.1 × $10^{-2}$ |
| | Cesium iodate | 8.4 × $10^{-2}$ |
| | Magnesium iodate | 2.29 × $10^{-1}$ |
| Carbonates | Ammonium carbonate | 8.8 × $10^{0}$ |
| | Ammonium bicarbonate | 1.5 × $10^{0}$ |
| | Lithium carbonate | 2.1 × $10^{-1}$ |
| | Lithium bicarbonate | 8.1 × $10^{-1}$ |
| | Sodium carbonate | 7.5 × $10^{-1}$ |
| | Sodium bicarbonate | 8.2 × $10^{-1}$ |
| | Potassium carbonate | 8.1 × $10^{0}$ |
| | Potassium bicarbonate | 3.9 × $10^{0}$ |
| | Rubidium carbonate | 1.95 × $10^{1}$ |
| | Rubidium bicarbonate | 3.7 × $10^{0}$ |
| | Cesium carbonate | 8.0 × $10^{0}$ |
| | Cesium bicarbonate | 1.08 × $10^{1}$ |

TABLE 7

Solubilities of Narrow Band Inorganic Valence Stabilizer Precursors under Ambient Conditions (Maximum concentration in solution at or near 25° C. and pH 7)

| Narrow Band Inorganic Valence Stabilizer | Example Precursors | Solubility in Water (mole/L) |
|---|---|---|
| A) Germanates | Germanium dioxide hydrate | 4.3 × $10^{-2}$ |
| | Ammonium germanate | ~1 × $10^{0}$ |
| | Lithium germanate | 6.3 × $10^{-2}$ |
| | Sodium germanate | 1.55 × $10^{0}$ |
| | Potassium germanate | ~1 × $10^{0}$ |
| | Rubidium germanate | ~5 × $10^{-1}$ |
| | Cesium germanate | ~5 × $10^{-2}$ |
| B) Titanates | Titanium hydroxide | 1.36 × $10^{-4}$ |
| C) Zirconates | Zirconium hydroxide | 1.26 × $10^{-3}$ |
| D) Hafnates | Hafnium hydroxide | 3.7 × $10^{-3}$ |
| E) Bismuthates | Bismuth nitrate | 2.7 × $10^{-2}$ |
| | Bismuthyl perchlorate | ~1 × $10^{-1}$ |
| F) Arsenates | Arsenic pentoxide | 6.5 × $10^{0}$ |
| | Ammonium arsenate | 2.1 × $10^{0}$ |
| | Sodium arsenate | 9.2 × $10^{-1}$ |
| | Potassium arsenate | 7.4 × $10^{-1}$ |
| G) Silicates | Sodium silicate | ~1 × $10^{0}$ |
| | Potassium silicate | ~1 × $10^{0}$ |
| H) Borates | Boric acid | 1 × $10^{0}$ |
| | Ammonium borate | 2.8 × $10^{-1}$ |
| | Lithium borate | 5.2 × $10^{-1}$ |
| | Sodium borate | 3.9 × $10^{0}$ |
| | Potassium borate | 8.7 × $10^{0}$ |
| I) Aluminates | Sodium aluminate | ~1 × $10^{0}$ |
| | Potassium aluminate | ~1 × $10^{0}$ |
| J) Phosphates | Phosphoric acid | 5.6 × $10^{1}$ |
| | Ammonium phosphate | 1.3 × $10^{0}$ |
| | Lithium phosphate | 3.4 × $10^{-3}$ |
| | Sodium phosphate | 2.6 × $10^{-1}$ |
| | Potassium phosphate | 4.2 × $10^{0}$ |
| | Pyrophosphoric acid | 4.0 × $10^{1}$ |
| | Sodium pyrophosphate | 1.2 × $10^{-1}$ |

The number of complexing octahedra or tetrahedra around the central $Co^{+3}$ ion varies from species to species (e.g., molybdates vs. tungstates). Varying the concentration of the complexing agent while keeping the $Co^{+3}$ concentration constant resulted in clear differences in corrosion protection. The degree of corrosion protection was found to fall off dramatically below a valence stabilizer-to-cobalt ratio of about 0.01. Therefore, the minimum recommended valence stabilizer-to-cobalt ratio is 0.010, with ratios higher than 0.015 being typical.

The maximum concentration of organic valence stabilizers is dependent upon the precursor solubility. Because of the very large number of potential organic valence stabilizers, precursor solubilities are not shown. The minimum concentration of valence stabilizer is dependent upon the specific $Co^{+3}$-valence stabilizer complex being formed within the conversion coating. The solubility and maximum solution concentration of these materials also increases with temperature, but this increased temperature is unnecessary to produce an effective coating.

6) Solubility Control Agent Concentration

The concentration of the optional solubility control agent can be any concentration up to its maximum solubility under ambient conditions. Exceeding the solubility will result in undissolved solid material that will not be available for adjusting the solubility of the cobalt-stabilizer complex. The solubilities of potential solubility control agents are not shown because of the large number of cationic or anionic species which can be used. Standard values for the solubilities of these materials in water can be used as the maximum allowable concentrations in the prepared solutions.

7) Coating Solution pH

The conversion coating solution should have an acidic or neutral pH so that a rise in pH caused by oxide and metal dissolution from the work surface will result in a rise in local pH and the precipitation of the desired conversion coating materials. Solution pH must not be so low that the pH rise during the conversion coating process is insufficient to result in coating precipitation. Very low pH values in the conversion coating solutions may also lead to excessive substrate metal loss and possible hydrogen embrittlement of the work piece.

The maximum practical pH of the conversion coating solution is about 7 and the lowest practical pH is 0 for trivalent (or tetravalent) cobalt coating application. Optimally, however, the pH should not be higher than 6 or less than 1 or 2. The pH of the trivalent cobalt conversion coating solutions should be checked periodically to confirm that it falls within operational parameters. Separate solutions that contain either valence stabilizers or optional solubility control agents generally do not require careful pH control.

8) Redox Potential of the Coating Solution

The necessary redox potential of the conversion coating solution is a function of both the solution pH and the cobalt concentration. Approximate values for the necessary redox potential of the solution can be derived from the Pourbaix stability diagram for cobalt. These values are shown in Table 8. Trivalent cobalt may be produced in solution at slightly lower redox values than those in Table 8 if the cobalt is already complexed with suitable valence stabilizers. In rare instances, some tetravalent cobalt may also be formed in the coating, provided that the redox potential is sufficiently high, and that the optimum valence stabilizer for $Co^{+4}$ is used.

TABLE 8

Approximate Required Redox Potential as a Function of Conversion Coating Solution pH

| pH | Minimum Required Redox Potential (V) |
|---|---|
| 0 | 1.6 |
| 1 | 1.5 |
| 2 | 1.4 |
| 3 | 1.2 |
| 4 | 1.0 |
| 5 | 0.9 |
| 6 | 0.7 |
| 7 | 0.6 |

These redox potentials can be achieved through chemical (or electrochemical) means. The redox potential of the conversion coating solution will slowly drop over a period of several days. It should be brought back up to those values shown in Table 8 when this happens. Periodic evaluation pf the redox potential of these solutions can be performed using ASTM D-1498 (Oxidation-Reduction Potential of water) or comparable test procedures. Post-treatment solutions that contain valence stabilizers or optional additional solubility control agents generally do not require control of the redox potential. 9) Application Temperature The recommended application temperature range of the conversion coating solution is between 5 and 40° C., with temperatures at or near ambient (20 to 25° C.) being typical. Application temperatures that are cooler than the typical range will result in a much slower coating deposition rate and may result in incomplete film formation. Temperatures higher than ambient can be used, but this is unnecessary and can increase the cost and application difficulty associated with the process. A temperature range of between about 5 and about 100° C. therefore constitutes the maximum allowable range for the application of these processes.

10) Contact Time, Coating Thickness

The contact time for the solutions should be sufficient to allow the formation of a uniform conversion coating of sufficient thickness to be effective as both a barrier film and a reservoir of $Co^{+3}$ corrosion inhibitor. An average time of about 5 minutes has been found effective. A minimum solution contact time has been found to be about 1 minute under ambient conditions. Contact times will vary with parameters including solution concentrations, temperature, pH, and alloy composition. The barrier oxide film needs to develop long enough to provide a suitable base for mechanical adhesion of a later paint layer. Incomplete coating deposition will result in coatings with reduced mechanical adhesion. A satisfactory conversion coating has a combination of coating thickness and coating morphology that provides for good adherence of the conversion coating as well as to subsequently applied paints and coatings. The "state-of-the-art" chromium conversion coatings exhibit a coating thickness of approximately 200 nanometers, as well as a "mud-crack" or "honeycomb" morphology. Thinner coatings may be acceptable, but their morphology must be enhanced to achieve comparable paint adhesion. The minimum thickness of a trivalent cobalt coating will vary with substrate composition. A lower limit will be approximately 25 nanometers to form a pin-hole free uniform coating that will promote paint adhesion. Conversely, very thick conversion coatings can result in low mechanical adhesion due to fracture through the grown films. The maximum thickness for a satisfactory trivalent coblt conversion coating is approximately 10,000 nanometers.

C) General Application Process

The general process flow diagram for the application of the optimized trivalent cobalt conversion coatings is as follows:

1) Precleaning (if required)
2) Masking (if required)
3) Alkaline cleaning/rinsing (if required)
4) Deoxidizing/rinsing (if required)
5) Formation of optimized trivalent cobalt conversion coating
6) Rinsing
7) Post-coating treatment
8) Rinsing
9) Drying (if required).

Each of these processing steps are discussed briefly as follows:

1) Precleaning (if required)

Oils or greases on the part to be coated are removed using an appropriate technique, such as vapor degreasing.

2) Masking (if required)

Any areas that are not to be conversion coated with the cobalt conversion coatings are masked off using appropriate maskants. Any system component which may be adversely affected by the cobalt conversion coating process should also be masked off.

3) Alkaline Cleaning/Rinsing or Other Cleaning Process (if required)

Alkaline cleaning is suggested to remove traces of oils or hydrocarbon contaminants on the metal surface. These alkaline cleaning solutions frequently require elevated temperatures for application. The metal piece should be rinsed thoroughly following alkaline cleaning.

4) Deoxidizing/Rinsing (if required)

Deoxidizing should be performed using appropriate deoxidizing solutions in accordance with performance specifications in order to remove the natural oxide film on the surface of the metal piece. Following deoxidizing, the metal piece is thoroughly rinsed while reducing as much as possible the drag-out from the deoxidizing bath.

5) Formation of Cobalt Conversion Coating

The conversion coating solution (as described above) is applied through immersion, spray application, fogging, or manual application.

6) Rinsing

Standard rinse procedures are used.

7) Post-Coating Treatment

Solution formulations can be developed where a valence stabilizer is not included in the initial conversion coating solution or additional solubility control agents are needed to modify compounds formed during coating deposition. A second solution application (eitherby immersion, spray application, fogging, or manual application) may be necessary. This second solution would contain the cobalt valence stabilizer or solubility control agent.

Post coating treatments to the formed conversion coating can also include treatments to change the color of the formed coating through the action of dyes or bleaching agents. For example, thick hexavalent chromium conversion coatings on zinc are often dyed black from the original olive-drab color as-formed on the galvanized work piece. Likewise, bleaching agents are applied to hexavalent chromium conversion coatings on zinc to obtain a clear or iridescent effect. The application of dyes or bleaching agents to conversion coatings based on trivalent (or tetravalent) cobalt will change the color of these coatings also.

8) Rinsing

Standard rinse procedures are used.

9) Drying (if required)

Standard drying methods may be used. The "state-of-the-art" hexavalent chromium coatings require a 24-hour "aging" period prior to paint application. Comparable "aging" is optional but typical for cobalt conversion coatings.

EXAMPLES

The following examples of the method of forming valence stabilized CoIII conversion coatings demonstrate a variety of conversion coating solution formulas that can be used as direct replacements for toxic hexavalent chromium-based conversion coating solutions. However, these examples are not intended to represent refined final commercial compositions. The examples are intended to demonstrate the range and robustness of the art of CoIII valence stabilization as described in the specification.

We present first the conditions by which many of our examples were formed, the conditions under which their corrosion resistance was tested, and the color exhibited by many of the example trivalent cobalt conversion coatings. We then present some comparative examples of prior art that were examined during the development program associated with this patent. Finally, some examples using either inorganic or organic valence stabilizers with $Co^{+3}$ are discussed.

1. Stock Solution and Sample Preparation

The test examples explored here (with the exception of the comparative examples) were all prepared in the same manner to avoid preparation and compositional complications during analysis of stabilizer or preparation agent performance. Cobalt nitrate [$Co(NO_3)_2 6H_2O$] was the compound used for the water-soluble cobalt source (although many others could be used). Potassium persulfate was used as the water-soluble peroxide source to oxidize the CoII to CoIII. The quantity of oxidizer was sufficient for a 1:1 ratio of released peroxide ion to CoII ion. The same quantity of potassium hexafluorozirconate preparative agent was used as is in the CrVI baseline solution.

The following were held constant for all of the conversion coating solution formulations:

| | |
|---|---|
| Cobalt nitrate | 41.9 grams - yielding 0.1440 M CoII |
| Potassium persulfate | 38.9 grams - yielding 0.1440 M peroxide |
| Potassium hexafluorozirconate | 1.70 grams |

The reagents were added to one liter of deionized water at room temperature and allowed to dissolve while monitoring solution temperature and pH. Degreased and deoxidized plates of bare 2024-T3 and 7075-T6 aluminum alloys were conversion coated with a specific treatment. Multiple samples of specific compositions were prepared and tested. Exposure results reflect the average combined performance of the specimens rather than a best performance. Ease of use, uniform application methodology, and predictable corrosion inhibiting performance are emphasized by using multiple samples. The usefulness of these conversion-coating methods depends on the ability to obtain a constant level of corrosion inhibition. Samples treated with Alodine 1200™ were prepared identically to those used to test CoII composition variations for purposes of comparison.

Conversion coating performance would be, ideally, independent of the substrate composition. This is not necessarily seen when bare 2024-T3 and 7075-T6 aluminum alloys are tested side-by-side, with either CrVI or CoIII conversion coatings. Substrate composition can influence the effectiveness of a particular conversion coat, but the limited selection of chromate compound solubilities has restricted the general development of application-specific CrVI conversion coatings. The technology presented here will allow the development of both effective wide-spectrum coating systems for general application and tailored coating system solutions for specific needs, all based on trivalent (or tetravalent) cobalt.

2. Corrosion Testing

Conversion coat formulations were evaluated by static salt fog (ASTM B-117) and cyclic Prohesion™ (ASTM G-85.5) accelerated corrosion tests. ASTM B-117 is a traditional corrosion proof test, but it has little relation to a real working environment. This accelerated corrosion test exposes samples to a constant salt-water fog and is a de facto test of solubility for corrosion inhibitors. B-117 does not necessarily test the ability of a corrosion inhibitor to actually inhibit corrosion. This is particularly true of inhibitors and complexes that have not been fully optimized with respect to solubility. ASTM G-85.5 (Prohesion™) is a cyclic corrosion test that more closely resembles real working environments. This accelerated corrosion test exposes samples to a cycle of fog of dilute salt and ammonium sulfate at room temperature followed by forced-air drying at an elevated temperature. This is a true test of the ability of a compound to inhibit corrosion. Results of these tests may be combined to gain insight into how a particular coating or compound will perform relative to a standard, as well as helping to identify strengths and weaknesses in the performance of a particular material.

3. Color

Coating deposition may be identified by a change in surface texture or color. Commercial CrVI conversion coating systems are known to provide a golden, yellowish (for current systems), or greenish (for older systems) tint to the metal surface after treatment. The usefulness of color in these coatings is as a visual aid during application and as a place marker after application. The methods of forming conversion coatings described here are capable of producing colored or uncolored corrosion inhibiting coatings.

4. Comparative Example 1

Alodine 1200™ is a commercial CrVI-ferricyanide based conversion coating used extensively to provide corrosion protection to metal surfaces. This material was used as a performance baseline for the effectiveness of CoIII compositions developed using the methodology described in this specification. Table 9 presents the accelerated corrosion testing results for bare 2024-T3 and 7075-T6 aluminum alloy test panels treated with Alodine 1200™ to form corrosion inhibiting conversion coatings.

TABLE 9

Alodine 1200 ™ Test Results for Accelerated Corrosion

| Alloy | B-117 Hours | B-117 Rating | G-85.5 Hours | G-85.5 Rating |
|---|---|---|---|---|
| 2024-T3 | 98 | 98% | 168 | 85% |
| 7075-T6 | 98 | 100% | 168 | 90% |

The Alodine 1200™ treated samples performed well during their period of exposure as is expected from the current state-of-the-art. The influence of alloy composition on the performance of the conversion coating became clear over the period of exposure testing.

5. Comparative Example 2

Conversion coating processes based on cobalt have been reported in the prior art that make use of additives identified as 'stabilizers' or 'bath stabilizers'. 'Bath stabilizers' treat and extend the service life of the coating solution by reducing the formation and precipitation of CoIII-containing solids during coating deposition. Carboxylates, amines, or nitrito complexes are added to the bath to retain trivalent cobalt (Colil) ion in solution and maintain stable solution concentrations during the coating process.

Coating solutions were prepared following the procedure described in U.S. Pat. No. 5,551,994 and PCT International Application No. WO 96/29,448, with one exception. Bath stabilizers such as an amine, triethanolamine, or carboxylate were used in the coating solution. Sample plates treated with the bath-stabilized solution were treated with a vanadate/tungstate rinse to seal the coating per the prior art. The process described in the patents requires elevated solution temperatures to produce the described coatings; however, in this experiment the solutions were not heated. In this way, the performance of those coatings may be compared to coatings prepared by the methods outlined in the present invention, which were all produced at room temperature. The coated samples were exposed to ASTM B-117 and G-85 accelerated corrosion test environments. The specimens failed to inhibit corrosion during accelerated corrosion testing.

A variation of this process was also examined where an inorganic stabilizer with proven effectiveness (tellurate) at room temperature application was combined with triethanolamine. The surfaces of these samples exhibited severe corrosion in both testing environments, although the 7075-T6 samples in ASTM G-85 still exhibited some uncorroded areas. A comparison of tellurate stabilized conversion coatings with and without a water-soluble amine bath stabilizer demonstrates that the presence of the amine actually accelerated the effects of corrosion. This modification resulted in a very effective corrosion inhibitor being turned into one that provided only marginal protection.

Detailed analysis of the prior art process determined that heating the coating solutions was a method of producing an oxide barrier coating. However, the oxides that form from high temperature solution in this prior art will be starved of available CoIII. CoIII-vanadate/tungstate complexes formed during the sealing treatment are slightly soluble and would serve to enhance the corrosion resistance of a coating, had one been deposited.

Bath stabilizers produce conversion coatings with less inherent corrosion protection than if no 'bath stabilizers' were used. The effectiveness of the vanadate/tungstate sealing step is also reduced because the bath stabilizers also increase the solubility of CoIII-vanadate/tungstate complexes. The sealing step used in this art is not an efficient method to incorporate sparingly soluble CoIII compounds into a coating.

6. Comparative Example 3

Polymers or other film-formers have been used in prior art conversion coating solutions. Film-formers may enhance short-term corrosion resistance by functioning as a barrier layer. CoIII-based conversion coating solutions of proven effectiveness were prepared with film forming additives. A periodate 2× valence stabilized Colli conversion coating solution was mixed with a polyvinyl butyral resin with an acid diluent and applied to test specimens. The CoIII-periodate valence stabilizer system yields a good conversion coating. Likewise, a molybdate-cobalt conversion coating was mixed with a non-inhibitive film former (Zip-Chem Co.) and applied to test specimens. The deposited periodate/polyvinyl butyral resin film had a low viscosity and didn't set up as a film for two days after solution application. Table 10 shows the results of accelerated corrosion testing on this barrier film system.

TABLE 10

Exposure Results for Barrier Film CoIII Formulations

| Stabilizer | 2024-T3 B-117 135 hrs. | 7075-76 B-117 135 hrs. | 2024-T3 G-85 135 hrs. | 7075-T6 G-85 135 hrs. |
|---|---|---|---|---|
| Periodate 2x in polyvinyl butyral resin | 12% | 12% | 55% | 20% |

TABLE 10-continued

Exposure Results for Barrier Film CoIII Formulations

| Stabilizer | 2024-T3 B-117 135 hrs. | 7075-76 B-117 135 hrs. | 2024-T3 G-85 135 hrs. | 7075-T6 G-85 135 hrs. |
|---|---|---|---|---|
| Periodate 2x in polyvinyl butyral resin | 12% | 12% | 55% | 20% |

The molybdate-cobalt conversion coating that was mixed with a non-inhibitive film former never set and remained liquid 2 weeks after application.

Detailed analysis of the prior art process determined that the film formers interfere with substrate oxidation during the conversion coating process. Thin, incompletely anodized surfaces are formed that restrict the incorporation of a reservoir for active corrosion inhibitor. A comparison of these results with periodate compositions with no polymer indicates that the compositions with no polymer exhibit much greater corrosion resistance.

7. Example 1

CoIII Solubility Range

Three factors influence the effectiveness of CoIII complexes as active corrosion inhibitors. These factors are the solubility, valence stabilization, and polar character of the formed complex. Valence stabilization is an absolute requirement for the formation of useful inhibitors. The complex will simply not be able to oxidize surface flaws if the valence is not stabilized. The polar character of the complex is an important but not an essential feature of a corrosion-inhibiting complex.

Complexes lacking significant electrostatic double layer formation are still able to provide some amount of active inhibition. CoIII complex availability is second only to valence stabilization in a conversion coating's ability to provide effective inhibition. The solubility of solid CoIII complexes controls both how much and how fast corrosion inhibitor is supplied to a corroding surface. Solubility ranges for inhibitors have been referred to as insoluble, sparingly soluble, and very soluble. Sparingly soluble compounds are known to offer the widest range of useful oxidizer in solution.

A test to identify the range of CoIII availability in solution needed to inhibit corrosion was performed by preparing a series of simple complexes with valence stabilization and polar character held constant. Conversion coating solutions containing CoIII as the oxidizing component were prepared where the CoIII ion was valence stabilized in solution with ammonia. Six ammonia molecules are known to pack around soluble CoIII forming a hexaamine-cobalt ($Co(NH_3)_6^{+3}$) complex. The anionic species chloride, bromide, sulfate, phosphate, carbonate, and hydroxide were used to precipitate $Co(NH_3)_6^{+3}$ complexes of varying solubility. Coating solutions containing potassium hexafluorozirconate as a surface preparative agent were applied to cleaned 2024-T3 aluminum samples. The coated samples were exposed to 135 hours of ASTM B-117 and 135 hours of G-85 accelerated corrosion test environments.

A clear progression of corrosion resistance was observed. $Co(OH)_3$ was precipitated when the hexaamine-cobalt complex was reacted with hydroxide. The samples containing extremely insoluble $Co(OH)_3$ exhibited little or no corrosion resistance. Samples that contained the more soluble chloride and bromide species performed well in the early stages of the test, but failed to inhibit corrosion part way into the corrosion test. CoIII was likely incorporated into the coating as the expected (soluble) $Co(NH_3)_6Cl_3$ and $Co(NH_3)_6Br_3$ compounds. The slightly less soluble $[Co(NH_3)_6]_2[ZrF_6]_3$ may have also precipitated and helped provide a slight reservoir of CoIII. Solubilities as high as about $5\times10^{-1}$ moles/liter of CoIII exhibited corrosion resistance during the early portion of accelerated corrosion testing, but failed later in the test. The higher solubility complexes would have promoted rapid CoIII depletion as the test progressed.

Intermediate solubility complexes of sulfate, carbonate, and phosphate exhibited corrosion resistance greater than chloride or bromide stabilized complexes and performed the best of this series of stabilizer anions. These exhibited greater corrosion resistance than samples containing chloride or bromide. This data allowed an approximate range of $5\times10^{-2}$ to $5\times10^{-5}$ moles/liter of CoIII to be established as a typical solubility range for solid CoIII complexes in conversion coatings. Generally, CoIII complex solubility ranges as high as $5\times10^{-1}$ to as low as $1\times10^{-5}$ moles per liter of CoIII, at standard temperature and pressure, may offer some corrosion protection under certain conditions. An approximate solubility range of $5\times10^{-2}$ to $5\times10^{-5}$ moles/liter of CoIII in solution is a very desirable solubility range for CoIII in conversion coatings.

None of these ammonia stabilized samples exhibited corrosion resistance approaching that exhibited by CrVI-based conversion coat samples. This is because inadequate electrostatic dipoles are established in the hexaamine-CoIII complex. Further optimization would need to be provided through the engineering of dipoles within the "sparingly soluble" CoIII-stabilizer combinations.

It should be noted that we also performed similar tests using deposited CrVI compounds of varying solubility. As with the CoIII coatings, a clear progression of performance based on solubility was observed.

8. Example 2

Inorganic Stabilizers

Inorganic valence stabilizers were used to test and verify the method of forming effective CoIII-based conversion coatings. A series of simple inorganic valence stabilized CoIII complexes were prepared and applied to precleaned bare 2024-T3 and 7075-T6 aluminum alloy samples. Immersion times were 5 minutes for each piece in each formulation. The coated samples were exposed to ASTM B-117 and G-85 accelerated corrosion test environments. Table 11 shows the type and concentration of each stabilizer that was used in combination with CoIII. The concentration of each stabilizer was either the same as that of ferricyanide in the hexavalent chromium formulations on a molar basis, or, in the case of some of the inorganics, twice that amount. This was done to ensure sufficient source material to form heteropolymetallates for CoIII stabilization.

TABLE 11

Formulations and Test Results for Initial CoIII Stabilizers

| Stabilizer | Stabilizer Conc. | 2024-T3 B-117 65 hrs. | 7075-76 B-117 65 hrs. | 2024-T3 G-85 70 hrs. | 7075-T6 G-85 70 hrs. |
|---|---|---|---|---|---|
| Periodate (Periodic acid) | 0.0050 M (1.16 g) | Pass | Pass | Pass | Pass |
| Tellurate (Telluric acid) | 0.0050 M (1.16 g) | Pass | Pass | Pass | Pass |
| Tellurate 2× (Telluric acid) | 0.0100 M (2.32 g) | Pass | Pass | Pass | Pass |
| Carbonate (Ammonium bicarbonate) | 0.0050 M (0.40 g) | Fail | Fail | Pass | Pass |

Pass = 25% or more of all 3 panel surfaces uncorroded
Fail = Less than 25% of all 3 panel surfaces uncorroded.

A small quantity of the persulfate (1 to 2 grams, depending on the formulation) and some stabilization agents would not dissolve for all of these formulations. The saturation limit had been achieved at the coating temperature (25° C.). Three 2024-T3 and three 7075-T6 samples of each formulation were loaded for ASTM B-117 salt fog exposure and ASTM G-85 Prohesion exposure. The panels were exposed for 65 hours in the ASTM B-117 Salt fog test and 70 hours in the ASTM G-85 Prohesion test—a sufficient time period to begin to see the corrosion resistance of each coating for each alloy.

The periodate and tellurate-stabilized coatings performed well. Some corrosion product formed on this series of samples but large bare uncorroded areas were on all sixteen sample coupons. The periodate sample exhibited corrosion protection comparable to the Alodine 1200™ treated specimens in both ASTM B-117 and ASTM G-85 environments. The concentration of the tellurate valence stabilizer was doubled to determine the effect that valence stabilizer concentration would have upon the coating. The stabilizer concentration appeared to improve the performance of this system somewhat. Other inorganic stabilization agents also were effective to various degrees. The carbonate-stabilized coatings demonstrated the influence of solubility on the performance of the coating during salt fog exposure. This stabilizer is a candidate for further examination to tailor the solubility of the complex with additional solubility control agents.

A second group of inorganically stabilized trivalent cobalt compositions was tested to evaluate the effect of the concentration of the valence stabilizer. The stabilizer concentration in this set was either the same, twice, or three times the molar amount of ferricyanide in hexavalent chromium formulations. Compositional characteristics of these solutions in terms of the source and concentration of cobalt, oxidizer, and preparative agent were identical to the previous sample set, although only one sample of each was tested. Table 12 shows the type, concentration, and effectiveness of each stabilizer that was used for CoIII in this example.

TABLE 12

Formulations and Test Results for Inorganic CoIII Stabilizers

| Stabilizer | Stabilizer Conc. | 2024-T3 B-117 78 hrs | 7075-T6 B-117 78 hrs | 2024-T3 G-85 78 hrs | 7075-T6 G-85 78 hrs |
|---|---|---|---|---|---|
| Periodate 2× (Periodic acid) | 0.0050 M (1.14 g) | <10% | 75% | 95% | 95% |
| Periodate 1× (Periodic acid) | 0.0025 M (0.57 g) | 65% | 75% | 95% | 95% |
| Periodate 3× (Periodic acid) | 0.0075 M (1.71 g) | 40% | 75% | 90% | 85% |
| Tellurate 2× (Telluric acid) | 0.0050 M (1.16 g) | <10% | 60% | 90% | 85% |
| Tellurate 1× (Telluric acid) | 0.0025 M (0.58 g) | <10% | 50% | 90% | 90% |
| Tellurate 3× (Telluric acid) | 0.0075 M (1.74 g) | <10% | 25% | 80% | 70% |
| Molybdate 2× (Potassium molybdate) | 0.0050 M (1.20 g) | <10% | 40% | 95% | 85% |
| Molybdate 1× (Potassium molybdate) | 0.0025 M (0.60 g) | 40% | 25% | 95% | 95% |
| Molybdate 3× (Potassium molybdate) | 0.0075 M (1.80 g) | 40% | 25% | 98% | 75% |
| Stannate 2× (Sodium stannate) | 0.0050 M (0.67 g) | 90% | 80% | 95% | 80% |

The rating numbers correspond to chrome baselines exposed to the same conditions (given a ranking of 100%).

This set of samples demonstrates the robust character of the method of preparing CoIII-based conversion coatings described in this specification. Precursor concentration does influence the corrosion resistance of coatings made with these stabilizers. Several of these formulations are of commercial quality with no additional development or refinement necessary. The worst of the chemical systems listed in Table 10 work better than current commercial alternatives for CrVI-based conversion coatings. The stannate and periodate 1× stabilized compositions could be used immediately as direct equivalent replacements for Alodine 1200™.

9. Example 3

Organic Valence Stabilizers

Organic valence stabilizers were used to verify the robustness of the method of forming effective CoIII-based conversion coatings. Organic compounds provide an almost unlimited number of possibilities for stabilizer compositions. Picolinate is an organic compound that demonstrated its ability to valence stabilize CoIII. A conversion coating solution containing 0.0025 M (0.31 g) picolinic acid was prepared as described above. This concentration was the same as that of ferricyanide in the hexavalent chromium formulations on a molar basis. This solution was applied to precleaned bare 2024-T3 and 7075-T6 aluminum alloy samples. Immersion times were 5 minutes for each piece in each formulation. The coated samples were exposed to ASTM B-117 and G-85 accelerated corrosion test environments. Table 13 shows the results of the initial corrosion testing of picolinate stabilized CoIII conversion coating.

TABLE 13

Test Results for Initial Organic CoIII Stabilizer

| Alloy | 65 hrs. B-117 | 70 hrs. G-85 |
|---|---|---|
| 2024-T3 | Fail | Pass |
| 7075-T6 | Pass | Pass |

Pass = 25% or more of all 3 panel surfaces uncorroded
Fail = Less than 25% of all 3 panel surfaces uncorroded The encouraging results with picolinic acid and other organic compounds suggested the value of examining additional organic stabilizers. The concentration of the organic stabilizers were varied similar to inorganic valence stabilizers shown in the earlier example. Conversion coating solutions were prepared as described above. These solutions were applied to precleaned bare 2024-T3 and 7075-T6 aluminum alloy samples. Immersion times were 5 minutes for each piece in each formulation. The coated samples were exposed to ASTM B-117 and G-85 accelerated corrosion test environments. Table 14 shows the type and concentration of each organic stabilizer that was used for CoIII.

TABLE 14

Formulations and Test Results for Organic CoIII Stabilizers

| Stabilizer Group 1 | Stabilizer Conc. | 2024-T3 B-117 78 hrs | 7075-T6 B-117 78 hrs | 2024-T3 G-85 78 hrs | 7075-T6 G-85 78 hrs |
|---|---|---|---|---|---|
| Ferricyanide 1× (Potassium ferricyanide) | 0.0025 M (0.83 g) | 25% | 25% | 90% | 75% |
| Picolinate 1× (Picolinic acid) | 0.0025 M (0.31 g) | 30% | 35% | 70% | 70% |
| Nicotinate 1× (Nicotinic acid) | 0.0025 M (0.31 g) | <10% | 25% | 70% | 70% |
| Isonicotinate 1× (Isonicotinic acid) | 0.0025 M (0.31 g) | <10% | 60% | 70% | 70% |
| Pyrazinecarboxylate 1× (2-Pyrazine-carboxylic acid) | 0.0025 M (0.31 g) | 25% | 30% | 70% | 70% |
| **Stabilizer Group 2** | **Stabilizer Conc.** | **135 hrs** | **135 hrs** | **135 hrs** | **135 hrs** |
| Flavazin 2× | 0.0050 M (0.95 g) | 18% | 12% | 95% | 90% |
| Tartrazine 2× | 0.0050 M (1.34 g) | 60% | 67% | 92% | 91% |
| Metanil 2× | 0.0050 M (0.94 g) | <10% % | <10% | 90% | 90% |
| Naphthol Yellow 2× | 0.0050 M (0.26 g) | 50% | 20% | 95% | 95% |
| Phthalocyanine 1× | 0.0025 M (0.64 g) | 10% | 45% | 80% | 70% |

The rating numbers correspond to chrome baselines exposed to the same conditions (given a ranking of 100%).

Organic ligands with various bonding configurations were examined in Group 1 of the above table. Picolinic, nicotinic, isonicotinic, and pyrazinecarboxylic acids are all isomers of one another with identical molecular weights. They were used to determine if the geometry of the organic ligand was important. The results of this study demonstrate the importance of the binding site geometry. The valence stabilizers in Group 2 of the above table were examined to identify trends in stabilizer performance with the size of the organic stabilizer. Several of the large organic valence stabilizers approached and passed the level of protection provided by Alodine 1200™ in ASTM G-85 accelerated corrosion testing. A naphthol yellow stabilized CoIII conversion coating performed better than Alodine 1200™ in ASTM G-85. The results for salt fog indicate that solubility control is important in tailoring the long-term performance of these compounds. Phthalocyanine, Flavazin, and Tartrazine were very effective in ASTM G-85 and worked very well for a limited time in B-117. This result indicates that these materials are effective in inhibiting corrosion but may need additional solubility control to reach their full potential.

While certain representative embodiments and details have been shown for purposes of illustrating the invention, it will be apparent to those skilled in the art that various changes in the compositions and methods disclosed herein may be made without departing from the scope of the invention, which is defined in the appended claims.

What is claimed is:

1. A solid corrosion-inhibiting conversion coating formed on a substrate metal, the conversion coating comprising cobalt, wherein the cobalt is trivalent cobalt, or tetravalent cobalt, or combinations thereof, and a valence stabilizer combined to form a cobalt/valence stabilizer complex within the solid corrosion-inhibiting conversion coating, and wherein the cobalt/valence stabilizer complex has a solubility in water of between about $5\times10^{-1}$ and about $1\times10^{-5}$ moles per liter of cobalt at about 25° C. and about 760 Torr, and wherein the valence stabilizer is selected from an organic valence stabilizer and an inorganic valence stabilizer, with the proviso that the inorganic valence stabilizer is not a vanadate or a tungstate, and the organic valence stabilizer is not a carboxylate.

2. The conversion coating of claim 1 wherein the solubility of the cobalt/valence stabilizer complex in water is between about $5\times10^{-2}$ and about $5\times10^{-5}$ moles per liter of cobalt at about 25° C. and about 760 Torr.

3. The conversion coating of claim 1 wherein there is an electrostatic barrier layer around the cobalt/valence stabilizer complex in aqueous solution.

4. The conversion coating of claim 1 wherein the cobalt/valence stabilizer complex acts as an ion exchange agent towards corrosive ions.

5. The conversion coating of claim 1 wherein the conversion coating is between about 25 and about 10,000 nanometers thick.

6. The conversion coating of claim 5 wherein the conversion coating is between about 100 and about 500 nanometers thick.

7. The conversion coating of claim 1 wherein the conversion coating has a morphology which enhances adhesion of a coating applied over the conversion coating.

8. The conversion coating of claim 1 wherein the valence stabilizer is the inorganic valence stabilizer selected from molybdates, niobates, tantalates, tellurates, periodates, iodates, carbonates, antimonates, stannates, titanates, zirconates, hafnates, bismuthates, germanates, arsenates, phosphates, borates, aluminates, and silicates, and combinations thereof.

9. The conversion coating of claim 8 wherein the valence stabilizer is the inorganic valence stabilizer selected from molybdates, niobates, tantalates, tellurates, periodates, iodates, carbonates, antimonates, and stannates, and combinations thereof.

10. The conversion coating of claim 8 wherein the cobalt/valence stabilizer complex has a central cavity containing a cobalt ion and an additional ion.

11. The conversion coating of claim 10 wherein the additional ion is $B^{+3}$, $Al^{+3}$, $Si^{+4}$, $P^{+5}$, $Ti^{+4}$, $V^{+5}$, $V^{+4}$, $Cr^{+6}$, $Cr^{+3}$, $Mn^{+4}$, $Mn^{+3}$, $Mn^{+2}$, $Fe^{+3}$, $Fe^{+2}$, $Co^{+2}$, $Ni^{+2}$, $Ni^{+3}$, $Ni^{+4}$, $Cu^{+2}$, $Ga^{+3}$, $Ge^{+4}$, $As^{+5}$, $As^{+3}$, $Zr^{+4}$, or $Ce^{+4}$.

12. The conversion coating of claim 1 wherein the valence stabilizer is the organic valence stabilizer selected from monoamines; diamines; triamines; tetraamines; pentamines; hexamines; five- or six-membered heterocyclic rings containing one to four nitrogen atoms optionally having additional nitrogen, sulfur, or oxygen binding sites; five- or six-membered heterocyclic rings containing one or two sulfur atoms and having additional nitrogen binding sites; five- or six-membered heterocyclic rings containing one or two oxygen atoms and having additional nitrogen binding sites; (two-, three-, four-, six-, eight-, or ten-)membered nitrogen, nitrogen-sulfur, or nitrogen-oxygen macrocyclics; macrocyclic oligothioketones or dithiolenes; diazenes; thio-, amido-, or imido-derivatives of hypophosphoric, phosphoric, or diphosphoric acids and salts; azo compounds, triazenes, formazans, azines, hydrazones, or Schiff Bases containing at least two azo, imine, or azine groups; azo compounds, triazenes, formazans, azines, hydrazones, or Schiff Bases with ortho-(for aryl) or alpha- or beta-(for alkyl) substitution; oximes; amidines and imido compounds; dithio ligands; amides; N-(thio)acyl 7-aminobenzylidenimines; (thio) semicarbazones; (thio)acyl hydrazones; (thio) carbazones; silylaminoalcohols; thioalkyl amines and imines; hydroxyalkyl imines; (thio)aryl amines and imines; guanylureas; guanidinoureas; 2-nitrosophenols; 2-nitrophenols; N-nitrosohydroxylamines; 1,3-monothioketones; monothiomalonamides; 2-thioacylacetamides; 2-acylthioacetamides; monothioethers; dithioethers; trithioethers; tetrathioethers; pentathioethers; hexathioethers; disulfides; monophosphines; diphosphines; triphosphines; tetraphosphines; pentaphosphines; hexaphosphines; five- or six-membered heterocyclic rings containing one or two sulfur atoms optionally having additional sulfur, oxygen, or phosphorus binding sites; five- or six-membered heterocyclic rings containing one to three phosphorus atoms optionally having additional phosphorus, nitrogen, oxygen, or sulfur binding sites; five- or six-membered heterocyclic rings containing one to four nitrogen atoms and having additional phosphorus binding sites; five- or six-membered heterocyclic rings containing one or two oxygen atoms and having additional sulfur or phosphorus binding sites; (five-, seven-, or nine-)membered nitrogen, nitrogen-sulfur, or nitrogen-oxygen macrocyclics; (two- to ten-)membered sulfur, sulfur-oxygen, or sulfur-phosphorus macrocyclics, not including oligothioketones or dithiolenes; (two- to ten-) membered phosphorus, nitrogen-phosphorus, or oxygen-phosphorus macrocyclics; thio-, amido-, or imido-derivative of phosphonic and diphosphonic acids and salts; thio-, amido-, or imido-derivatives of phosphonic and diphosphonic acids and salts containing no sulfur binding sites; amido-, or imido-derivatives of hypophosphoric, phosphoric, or diphosphoric acids and salts containing no sulfur binding sites; dithioperoxydiphosphoramides; dithioperoxydiphosphoric acids and salts; monothioperoxydiphosphoramides; monothioperoxydiphosphoric acids and salts; monothiophosphoric acids;azo compounds, triazenes, formazans, azines, or Schiff Bases; silylamines; silazanes; guanidines and diguanidines; pyridinaldimines; hydrazones; hydramides; nitriles; thioureas and thioamides; ureas and biurets; monothio ligands; diketone ligands; dithioacyl disulfides; 1,2-dithiolates; rhodanines; dithiocarbimates; (thio)xanthates; phosphinodithioformates; (thio)borates and (thio)boronates; (thio)arsonic acids and salts; (thio)antimonic acids and salts; phosphine and arsine sulfides or oxides; beta-hydroxyketones and aldehydes; carbazates; imidosulfurous diamides; sulfurdiimines; thiocarbonyl and mercapto oximes; 2-nitrothiophenols; 2-nitrilo (thio)phenols; acylcyanamides; beta-ketoamines; 3-aminoacrylamides and 3,3-diaminoacrylamides; 2-nitroanilines; amine and diazine N-oxides; hydrazides and semicarbazides; (amino- or imino-)aryl phosphines; (thio- or hydroxy-)aryl phosphines; arsines; five- or six-membered heterocyclic rings containing one arsenic atom optionally having additional arsenic binding sites; (two- to six-)membered arsenic macrocyclics; selenoethers; five- or six-membered heterocyclic rings containing one or two selenium atoms optionally having additional selenium binding sites; (two- to six-)membered selenium macrocyclics; 1,3-diselenoketones; 1,1-diselenolates; selenophosphoric acids and salts; cyanide, isocyanide, and cyanamide ligands; nitrosyl and nitrite ligands; azide ligands; thiolates and selenolates; (thio)cyanate ligands; diene or bicyclic or tricyclic hydrocarbon ligands; and carbonyl, halogen, or hydroxo ligands; and combinations thereof.

13. The conversion coating of claim 12 wherein the organic valence stabilizer is selected from monoamines; diamines; triamines; tetraamines; pentamines; hexamines; five- or six-membered heterocyclic rings containing one to four nitrogen atoms optionally having additional nitrogen, sulfur, or oxygen binding sites; five- or six-membered heterocyclic rings containing one or two sulfur atoms and having additional nitrogen binding sites; five- or six-membered heterocyclic rings containing one or two oxygen atoms and having additional nitrogen binding sites; (two-, three-, four-, six-, eight-, or ten-)membered nitrogen, nitrogen-sulfur, or nitrogen-oxygen macrocyclics; macrocyclic oligothioketones or dithiolenes; diazenes; thio-, amido-, or imido-derivatives of hypophosphoric, phosphoric, or diphosphoric acids and salts; azo compounds, triazenes, formazans, azines, hydrazones, or Schiff Bases containing at least two azo, imine, or azine groups; azo compounds, triazenes, formazans, azines, hydrazones, or Schiff Bases with ortho-(for aryl) or alpha- or beta-(for alkyl) substitution; oximes; amidines and imido compounds; dithio ligands; amides; N-(thio)acyl 7-aminobenzylidenimines; (thio) semicarbazones; (thio)acyl hydrazones; (thio)carbazones; silylaminoalcohols; thioalkyl amines and imines; hydroxyalkyl imines; (thio)aryl amines and imines; guanylureas; guanidinoureas; 2-nitrosophenols; 2-nitrophenols; N-nitrosohydroxylamines; 1,3-monothioketones; monothiomalonamides; 2-thioacylacetamides; 2-acylthioacetamides; dithiodicarbonic diamides; and and combinations thereof.

14. The conversion coating of claim 12 wherein the organic valence stabilizer is the diazene selected from diazeneformimidamides; diazeneformamides; diazeneformothioamides; diazeneacetimidamides; diazeneacetothioamides; diazeneformimidic acids and salts; diazeneacetimidic acids and salts; diazeneformaldehydes; diazeneformothioaldehydes; diazeneacetaldehydes; diazeneacetothioaldehydes; diazenediformamides; diazenediformothioamides; diazenediacetamides; diazenediacetothioamides; imidoyldiazenes; diazenediformimidamides; diazenediacetimidamides; diazenediformimidic acids and salts; diazenediacetimidic acids and salts; diazenediformaldehydes; diazenediformothioaldehydes; diazenediacetaldehydes; diazenediacetothioaldehydes; and diimidoyldiazenes; and combinations thereof.

15. The conversion coating of claim 12 wherein the organic valence stabilizer is the thio-, amido-, or imido-derivative of hypophosphoric, phosphoric, or diphosphoric acids and salts selected from phosphoramidimidic triamides; phosphoramidimidic acids and salts; phosphorodiamidimidic acids and salts; (di- or mono-)thiohypophosphoric acids and salts; (di- or mono-)thiohypophosphoramides; phosphoramidic acids and salts; phosphorimidic acids and salts; (di- or mono-)thioimidodiphosphoric acids and salts; (di- or mono-) thiohydrazidodiphosphoric acids and salts; (di- or mono-)thioimidodiphosphoramides; (di- or mono-)thiohydrazidodiphosphoramides; phosphoric triamides; (di- or mono-) thiodiphosphoramides; (di- or mono-)thiodiphosphoric acids and salts; (tetra-, tri-, di-) thiophosphoric acids and salts; and combinations thereof.

16. The conversion coating of claim 12 wherein the organic valence stabilizer is azo compounds, triazenes, formazans, azines, hydrazones, or Schiff Bases with ortho-(for aryl) or alpha- or beta-(for alkyl) substitution wherein the substituent is selected from amino; imino; oximo; diazeno; hydrazido; thiol; mercapto; thiocarbonyl; hydroxy; and carbonyl substituents; and combinations thereof.

17. The conversion coating of claim 12 wherein the organic valence stabilizer is the oxime selected from monooximes; dioximes; carbonyl oximes; imine oximes; hydroxy oximes; amino oximes; amido oximes; hydrazone oximes; and azo oximes; and combinations thereof.

18. The conversion coating of claim 12 wherein the organic valence stabilizer is the amidine and imido compound selected from amidines; diamidines; biguanides; biguanidines; diamidinomethanes; imidoylguanidines; amidinoguanidines; diformamidine oxides, sulfides, and disulfides; imidodicarbonimidic acids and salts; diimidodicarbonimidic acids and salts; thioimidodicarbonimidic acids and salts; thiodiimidodicarbonimidic acids and salts; diimidoylimines; diimidoylhydrazides; imidosulfamides; diimidosulfamides; N-hydroxy(or N,N'-dihydroxy)amidines; and diimidosulfuric acids and salts; and combinations thereof.

19. The conversion coating of claim 12 wherein the organic valence stabilizer is the dithio ligand selected from dithioimidodialdehydes; dithiohydrazidodialdehydes; 1,3-dithioketones; 1,2-dithioketones; dithiomalonamides; 2-thioacylthioacetamides; dithioacyl sulfides; beta-mercaptothioketones and aldehydes; N-(aminomethylthiol)thioureas; dithiooxamides; 1,1-dithiolates ;and dithiocarbazates; and combinations thereof.

20. The conversion coating of claim 12 wherein the organic valence stabilizer is the amide selected from monoamides; lactams; amidinoamides; guanidinoamides; imidoylamides; polyamides; and polylactams; and combinations thereof.

21. The conversion coating of claim 12 wherein the organic valence stabilizer is the thio-, amido-, or imido-derivative of phosphonic and diphosphonic acids and salts selected from phosphonitrile amides; phosphonimidic diamides; phosphonamidimidic acids and salts; dithioimidodiphosphonic acids and salts; dithiohydrazidodiphosphonic acids and salts; dithioimidodiphosphonamides; dithiohydrazidodiphosphonamides; dithiodiphosphonamides; dithiodiphosphonic acids and salts; dithioperoxydiphosphonamides; dithioperoxydiphosphonic acids and salts; (di- and tri-) thiophosphonic acids and salts; monothioimidodiphosphonic acids and salts; monothiohydrazidodiphosphonic acids and salts; monothioimidodiphosphonamides; monothiohydrazidodiphosphonamides; monothiodiphosphonamides; monothiodiphosphonic acids and salts; monothioperoxydiphosphonamides; monothioperoxydiphosphonic acids and salts; monothiophosphonic acids and salts; and combinations thereof.

22. The conversion coating of claim 12 wherein the organic valence stabilizer is the amido-, or imido-derivative of hypophosphoric, phosphoric, or diphosphoric acids and salts containing no sulfur binding sites selected from hypophosphoric acids and salts; hypophosphoramides; imidodiphosphoric acids and salts; hydrazidodiphosphoric acids and salts; imidodiphosphoramides; hydrazidodiphosphoramides; and diphosphoramides; and combinations thereof.

23. The conversion coating of claim 12 wherein the organic valence stabilizer is the amido-, or imido-derivative of phosphonic or diphosphonic acids and salts containing no sulfur binding sites selected from imidodiphosphonic acids and salts; hydrazidodiphosphonic acids and salts; imidodiphosphonamides; hydrazidodiphosphonamides; diphosphonamides; phosphonimidic acids and salts; phosphonamidic acids and salts; and phosphonic diamides; and combinations thereof.

24. The conversion coating of claim 12 wherein the organic valence stabilizer is the thiourea and thioamide selected from thioureas; thiocarboxamides; thioacylthioureas, acylthioureas, and thioacylureas; thioaroylthioureas, aroylthioureas, and thioaroylureas; thioimidates; thioguanylureas; guanidinothioureas; amidinothioamides; guanidinothioamides; imidoylthioamides; 3-aminothioacrylamides; thiohydrazides; thiosemicarbazides; (mono- and di-) thiobiurets; (mono- and di-)thioisobiurets; (mono- and di-)thiobiureas; N-(aminomethylol) thioureas; N-(aminomethylthiol) ureas; and beta-mercaptocarboxamides; and combinations thereof.

25. The conversion coating of claim 12 wherein the organic valence stabilizer is the urea and biuret selected from ureas; pseudoureas; biurets; isobiurets; biureas; acylureas; aroylureas; and N-(aminomethylol)ureas; and combinations thereof.

26. The conversion coating of claim 12 wherein the organic valence stabilizer is the monothio ligand selected from beta-aminothiones; N-thioacyl benzylidenimines; thioimidodialdehydes; thiohydrazidodialdehydes; 1,2-monothioketones; trithioperoxydicarbonic diamides; dithioperoxydicarbonic diamides; beta-hydroxythioketones; beta-hydroxythioaldehydes; beta-mercaptoketones; beta-mercaptoaldehydes; monothiooxamides; monothiocarbazates; monothiocarbimates; mercaptoalcohols; and silylmercaptoalcohols; and combinations thereof.

27. The conversion coating of claim 12 wherein the organic valence stabilizer is the diketone ligand selected from imidodialdehydes; hydrazidodialdehydes; imidodisulfamic acids and salts; imidodisulfuric acids and salts; 1,3-diketones; 1,2-diketones; malonamides; 2-acylacetamides; monothiodicarbonic diamides; oxamides; and combinations thereof.

28. The conversion coating of claim 12 wherein the organic valence stabilizer is the phosphine and arsine sulfide or oxide selected from phosphine P-sulfides; aminophosphine sulfides; arsine As-sulfides; aminoarsine sulfides; phosphine P-oxides; aminophosphine oxides; arsine As-oxides; and aminoarsine oxides; and combinations thereof.

29. The conversion coating of claim 12 wherein the solubility in water of the cobalt/valence stabilizer complex is adjusted by the addition of a substituent group on the organic valence stabilizer.

30. The conversion coating of claim 29 wherein the solubility in water is increased by the addition of the substituent group selected from sulfonate groups ($—SO_3^-$), hydroxyl groups (—OH), ester groups ($—C_3—$), carbonyl groups (═C═O), amine groups ($—NH_2$), nitrosamine groups (═N—N═O), carbonylnitrene groups (—CO—N), sulfoxide groups (═S═O), sulfone groups ($═S[═O]_2X$), sulfinyl groups (—N═S═O), sulfodiimines ($═S[NH]_2$), sulfonyl halide groups ($—S[═O]_2X$), sulfonamide groups ($—S[═O]_2NH_2$), monohalosulfonamide groups ($—S[═O]_2NHX$), dihalosulfonamide groups ($—S[O]_2MX_2$), halosulfonate groups ($—S[═O]_2OX$), halosulfonate amide groups ($═N—S[═O]_2X$), aminosulfonate groups ($═N—S[═O]_2OH$), iminosulfonate groups ($—N[SO_3^-]_{1-2}$), phosphonate groups ($—PO_3^{-2}$), phosphonamide groups ($—PO_2NH_2^-$), phosphondiamide groups ($—PO[NH_2]_2$), aminophosphonate groups ($═N—PO_3^{-2}$), and iminophosphonate groups ($—N[PO_3^2]_{1-2}$), and combinations thereof.

31. The conversion coating of claim 29 wherein the solubility in water is decreased by the addition of the substituent group selected from nitro groups ($—NO_2$), perfluoroalkyl groups ($—C_xF_{2x+1}$), perchloroalkyl groups ($—C_xCl_{2x+1}$), nitramine groups ($═N—NO_2$), thioketone groups (═C═S), sulfenyl halide groups (—S—X), and sulfur dihaloimide groups ($—N═SX_2$), and combinations thereof.

32. The conversion coating of claim 12 wherein an electrostatic barrier layer of the cobalt/valence stabilizer complex is adjusted by the addition of a substituent group on the organic valence stabilizer.

33. The conversion coating of claim 32 wherein the electrostatic barrier layer is increased by the addition of the substituent group selected from ketones (═C═O), thioketones (═C═S), amides ($—C[═O]—NR_2$), thioamides ($—C[═S]—NR_2$), nitriles or cyano groups, (—CN), isocyanides (—NC), nitroso groups (—N═O), thionitroso groups (—N═S), nitro groups ($—NO_2$), azido groups ($—N_3$), cyanamide or cyanonitrene groups (═N—CN), cyanate groups (—O—CN), isocyanate groups (—N═C═O), thiocyanate groups (—S—CN), isothiocyanate groups (—N═C═S), nitrosamine groups (═N—N═O), thionitrosamine groups (═N—N═S), nitramine groups ($═N—NO_2$), thionitramine groups ($═N—NS_2$), carbonylnitrene groups (—CO—N), thiocarbonylnitrene groups (—CS—N), sulfenyl halides (—S—X), sulfoxides (═S═O), sulfones ($═S[═O]_2$), sulfinyl groups (—N═S═O), thiosulfinyl groups (—N═S═S), sulfenyl thiocyanato groups (—S—S—CN), sulfenyl cyanato groups (—S—O—CN), sulfodiimine groups ($═S[═NH]_2$), sulfur dihaloimido groups ($—N═SX_2$), sulfur oxide dihaloimido groups ($—N═S[═O]X_2$), aminosulfur oxide trihalide groups ($═N—S[═O]X_3$), sulfonyl azide groups ($—S[═O]_2N_3$), sulfonyl thiocyanate groups ($—S[═O]_2SCN$), sulfonyl cyanate groups ($—S[═O]_2OCN$), sulfonyl cyanide groups ($—S[═O]_2CN$), halosulfonate groups ($—S[═O]_2OX$), phosphonyl thiocyanate groups ($—P[═O]OHSCN$), phosphonyl cyanate groups ($—P[═O]OHOCN$), and phosphonyl cyanide groups ($—P[═O]OHCN$), and combinations thereof.

34. The conversion coating of claim 1 further comprising a solubility control agent.

35. The conversion coating of claim 34 wherein the solubility control agent is selected from a cationic solubility control agent and an anionic solubility control agent.

36. The conversion coating of claim 35 wherein the solubility control agent is the cationic solubility control agent selected from $H^+$, $Li^+$, $Na^+$, $K^+$, $Rb^+$, $Cs^+$, $NH_4^+$, $Mg^{+2}$, $Ca^{+2}$, $Sr^{+2}$, $Be^{+2}$, $Ba^+$, $Y^{+3}$, $La^3$, $Ce^{+3}$, $Ce^{+4}$, $Nd^{+3}$, $Pr^{+3}$, $Sc^{+3}$, $Sm^{+3}$, $Eu^{+3}$, $Eu^{+2}$, $Gd^{+3}$, $Tb^{+3}$, $Dy^{+3}$, $Ho^{+3}$, $Er^{+3}$, $Tm^{+3}$, $Yb^{+3}$, $Lu^{+3}$, $Ti^{+4}$, $Zr^{+4}$, $Ti^{+3}$, $Hf^4$, $Nb^{+4}$, $Ta^{+4}$, $Nb^{+4}$, $Ta^{+4}$, $V^{+5}$, $V^{+4}$, $V^{+3}$, $Mo^{+6}$, $W^{+6}$, $Mo^{+5}$, $W^{+5}$, $Mo^{+4}$, $W^{+4}$, $Cr^{+3}$, $Mn^{+2}$, $Mn^{+3}$, $Mn^{+4}$, $Fe^{+2}$, $Fe^{+3}$, $Co^{+2}$, $Co^{+3}$, $Ni^{+2}$, $Ni^{+3}$, $Ni^{+4}$, $Ru^{+2}$, $Ru^{+3}$, $Ru^{+4}$, $Rh^{+3}$, $Ir^{+3}$, $Rh^{+2}$, $Ir^{+2}$, $Pd^{+4}$, $Pt^{+4}$, $Pd^{+2}$, $Pt^{+2}$, $Os^{+4}$, $Cu^+$, $Cu^{+2}$, $Cu^{+3}$, $Ag^+$, $Ag^{+2}$, $Ag^{+3}$, $Au^+$, $Au^{+2}$, $Au^3$, $Zn^{+2}$, $Cd^{+2}$, $Hg^+$, $Hg^{+2}$, $Al^{+3}$, $Ga^{+3}$, $Ga^+$, $In^{+3}$, $In^+$, $Tl^{+3}$, $Tl^+$, $Ge^{+4}$, $Ge^{+2}$, $Sn^{+4}$, $Sn^{+2}$, $Pb^{+4}$, $Pb^{+2}$, $Sb^{+3}$, $Sb^{+5}$, $As^{+3}$, $As^{+5}$, $Bi^{+3}$, $Bi^{+5}$, organic compounds containing at least one $N^+$ site, organic compounds containing at least one phosphonium site, organic compounds containing at least one arsonium site, organic compounds containing at least one stibonium site, organic compounds containing at least one oxonium site, organic compounds containing at least one sulfonium site, organic compounds containing at least one selenonium site, organic compounds containing at least one iodonium site, and quaternary ammonium compounds having a formula $NR_4^+$, where R is an alkyl, aromatic, or acyclic organic constituent, and combinations thereof.

37. The conversion coating of claim 36 wherein the cationic solubility control agent is selected from $H^+$, $Li^+$, $Na^+$, $K^+$, $Rb^+$, $Cs^+$, $NH_4^+$, $Mg^{+2}$, $Ca^{+2}$, $Sr^{+2}$, $Y^{+3}$, $La^{+3}$, $Ce^{+3}$, $Ce^{+4}$, $Nd^{+3}$, $Pr^+$, $Sc^{+3}$, $Sm^{+3}$, $Eu^{+3}$, $Eu^{+2}$, $Gd^{+3}$, $Tb^{+3}$, $Dy^{+3}$, $Ho^{+3}$, $Er^{+3}$, $Tm^{+3}$, $Yb^{+3}$, $Lu^{+3}$, $Ti^{+4}$, $Zr^{+4}$, $Ti^{+3}$, $Hf^{+4}$, $Nb^{+5}$, $Ta^{+5}$, $Nb^{+4}$, $Ta^{+4}$, $Mo^{+6}$, $W^{+6}$, $Mo^{+5}$, $W^{+5}$, $Mo^{+4}$, $W^{+4}$, $Mn^{+2}$, $Mn^{+3}$, $Mn^{+4}$, $Fe^2$, $Fe^{+3}$, $Co^{+2}$, $Co^{+3}$, $Ru^{+2}$, $Ru^{+3}$, $Ru^{+4}$, $Rh^{+3}$, $Ir^{+3}$, $Rh^{+2}$, $Ir^{+2}$, $Pd^{+4}$, $Pt^{+4}$, $Pd^{+2}$, $Pt^{+2}$, $Cu^+$, $Cu^{+2}$, $Cu^{+3}$, $Ag^+$, $Ag^{+2}$, $Ag^{+3}$, $Au^+$, $Au^{+2}$, $Au^{+3}$, $Zn^{+2}$, $Al^{+3}$, $Ga^{+3}$, $Ga^+$, $In^{+3}$, $In^+$, $Ge^{+4}$, $Ge^{+2}$, $Sn^{+4}$, $Sn^{+2}$, $Sb^{+3}$, $Sb^{+5}$, $Bi^{+3}$, $Bi^{+5}$, organic compounds containing at least one $N^+$ site, organic compounds containing at least one phosphonium site, organic compounds containing at least one stibonium site, organic compounds containing at least one oxonium site, organic compounds containing at least one sulfonium site, organic compounds containing at least one iodonium site, and quaternary ammonium compounds having a formula $NR_4^+$, where R is an alkyl, aromatic, or acyclic organic constituent, and combinations thereof.

38. The conversion coating of claim 35 wherein the solubility control agent is the anionic solubility control agent selected from fluorotitanates; chlorotitanates; fluorozirconates; chlorozirconates; fluoroniobates; chloroniobates; fluorotantalates; chlorotantalates; molybdates; tungstates; permanganates; fluoromanganates; chloromanganates; fluoroferrates; chloroferrates; fluorocobaltates; chlorocobaltates; fluorozincates; chlorozincates; borates; fluoroborates; fluoroaluminates; chloroaluminates; carbonates; silicates; fluorosilicates; fluorostannates; nitrates; nitrites; azides; cyanamides; phosphates; phosphites; phosphonates; phosphinites; thiophosphates; thiophosphites; thiophosphonates; thiophosphinites; fluorophosphates; fluoroantimonates; chloroantimonates; sulfates; sulfites; sulfonates; thiosulfates; dithionites; dithionates; fluorosulfates; tellurates; fluorides; chlorides; chlorates; perchlorates; bromides; bromates; iodides; iodates; periodates; heteropolyanions; ferricyanides; ferrocyanides; cyanocobaltates; cyanocuprates; cyanomanganates; cyanates; cyanatofenates; cyanatocobaltates; cyanatocuprates; cyanatomanganates; thiocyanates; thiocyanatoferrates; thiocyanatocobaltates; thiocyanatocuprates; thiocyanatomanganates; cyanamides; cyanamidoferrates; cyanamidocobaltates; cyanamidocuprates; cyanamidomanganates; nitritofenates; nitritocobaltates; azides; (thio)carboxylates; di(thio)carboxylates; tri (thio)carboxylates; tetra(thio)carboxylates; (thio) phenolates; di(thio)phenolates; tri(thio)phenolates; tetra (thio)phenolates; (thio)phosphonates; di(thio)phosphonates; tri(thio)phosphonates; (thio)phosphonamides; di(thio)phosphonamides; tri(thio)phosphonamides; amino(thio)phosphonates; diamino(thio)phosphonates; triamino(thio)phosphonates; imino(thio)phosphonates; diimino(thio) phosphonates; (thio)sulfonates; di(thio)sulfonates; tri(thio) sulfonates; (thio) sulfonamides; di(thio) sulfonamides; tri (thio)sulfonamides; amino(thio) sulfonates; diamino(thio) sulfonates; triamino(thio)sulfonates; imino(thio)sulfonates; diimino(thio) sulfonates; (thio)borates; di(thio)borates; (thio)boronates; organic silicates; stibonates; cyanides; cyanochromates; cyanonickelates; cyanatochromates; cyanatonickelates; thiocyanatochromates; thiocyanatonickelates; cyanamidochromates; cyanamidonickelates; nitritonickelates; arsonates; diarsonates; triarsonates; organic selenates; diselenates; triselenates; arsenates; arsenites; fluoroarsenates; chloroarsenates; selenates; selenites; fluorothallates; chlorothallates; iodomercury anions; chloromercurates; bromomercurates; osmates; fluoronickelates; chromates; Reinecke's salt; and vanadates; and combinations thereof.

39. The conversion coating of claim 38 wherein the anionic solubility control agent is selected from fluorotitanates; chlorotitanates; fluorozirconates; chlorozirconates; fluoroniobates; chloroniobates; fluorotantalates; chlorotantalates; molybdates; tungstates; permanganates; fluoromanganates; chloromanganates; fluoroferrates; chloroferrates; fluorocobaltates; chlorocobaltates; fluorozincates; chlorozincates; borates; fluoroborates; fluoroaluminates; chloroaluminates; carbonates; silicates; fluorosilicates; fluorostannates; nitrates; nitrites; azides; cyanamides; phosphates; phosphites; phosphonates; phosphinites; thiophosphates; thiophosphites; thiophosphonates; thiophosphinites; fluorophosphates; fluoroantimonates; chloroantimonates; sulfates; sulfites; sulfonates; thiosulfates; dithionites; dithionates; fluorosulfates; tellurates; fluorides; chlorides; chlorates; perchlorates; bromides; bromates; iodides; iodates; periodates; heteropolyanions; ferricyanides; ferrocyanides; cyanocobaltates; cyanocuprates; cyanomanganates; cyanates; cyanatofenates; cyanatocobaltates; cyanatocuprates; cyanatomanganates; thiocyanates; thiocyanatoferrates; thiocyanatocobaltates; thiocyanatocuprates; thiocyanatomanganates; cyanamides; cyanamidoferrates; cyanamidocobaltates; cyanamidocuprates; cyanamidomanganates; nitritofenates; nitritocobaltates; azides; (thio)carboxylates; di(thio)carboxylates; tri(thio)carboxylates; tetra(thio)carboxylates; (thio)phenolates; di(thio)phenolates; tri(thio)phenolates; tetra(thio)phenolates; (thio)phosphonates; di(thio) phosphonates; tri(thio)phosphonates; (thio) phosphonamides; di(thio)phosphonamides; tri(thio) phosphonamides; amino(thio)phosphonates; diamino(thio) phosphonates; triamino(thio)phosphonates; imino(thio) phosphonates; diimino(thio)phosphonates; (thio)sulfonates; di(thio)sulfonates; tri(thio)sulfonates; (thio)sulfonamides; di(thio)sulfonamides; tri(thio)sulfonamides; amino(thio)sulfonates; diamino(thio) sulfonates; triamino(thio)sulfonates; imino(thio)sulfonates; diimino(thio)sulfonates; (thio)borates; di(thio)borates; (thio)boronates; organic silicates; and stibonates; and combinations thereof.

40. The conversion coating of claim 1 wherein the conversion coating is colored.

41. The conversion coating of claim 40 further comprising an agent which improves color-fastness of the conversion coating.

42. The conversion coating of claim 41 wherein the agent which improves color-fastness is selected from an active UV blocker, a passive UV blocker, and a brightener.

43. The conversion coating of claim 42 wherein the agent which improves color-fastness is the active UV blocker selected from carbon black, graphite, and phthalocyanines.

44. The conversion coating of claim 42 wherein the agent which improves color-fastness is the passive UV blocker selected from titanium oxide, tin oxide, lead oxide, silicon oxide, silicates, and aluminosilicates, and combinations thereof.

45. The conversion coating of claim 42 wherein the agent which improves color-fastness is the brightener selected from sulfonic acids, sulfonates, sulfonamides, sulfonimides, sulfinic acids, sulfones, cyanides, and nonionic surfactants.

46. A corrosion-inhibiting conversion coating bath consisting essentially of a solvent, a precursor cobalt source, and a valence stabilizer combined to form a cobalt/valence stabilizer complex, optionally an oxidizer, optionally preparative agent, and optionally a solubility control agent, and wherein the valence stabilizer is selected from an organic valence stabilizer and an inorganic valence stabilizer, with the proviso that the inorganic valence stabilizer is not a vanadate or a tungstate, and the organic valence stabilizer is not a carboxylate.

47. The conversion coating bath of claim 46 wherein the solvent is water.

48. The conversion coating bath of claim 46 wherein the conversion coating bath includes the oxidizer selected from a dissolved solid, a liquid, and a gas.

49. The conversion coating bath of claim 48 wherein the oxidizer is selected from peroxides, superoxides, persulfates, perborates, pemitrates, perphosphates, percarbonates, persilicates, peraluminates, pertitanates, perzirconates, permolybdates, pertungstates, pervanadates, organic peroxyacid derivatives, ozone, hypochlorites, chlorates, perchlorates, nitrates, nitrites, vanadates, iodates, hypobromites, chlorites, bromates, permanganates, periodates, dissolved oxygen, dissolved chlorine, and dissolved fluorine, and combinations thereof.

50. The conversion coating bath of claim 46 wherein the cobalt source is selected from cobalt contained within a treated substrate, cobalt nitrate, cobalt sulfate, cobalt perchlorate, cobalt chloride, cobalt fluoride, cobalt bromide, cobalt iodide, cobalt bromate, cobalt chlorate, cobalt fluosilicate, cobalt fluotitanate, cobalt fluozirconate, cobalt fluoborate, cobalt fluoaluminate, cobalt formate, cobalt acetate, cobalt propionate, cobalt butyrate, cobalt benzoate, cobalt glycolate, cobalt lactate, cobalt tartronate, cobalt malate, cobalt tartrate, cobalt citrate, cobalt benzenesulfonate, cobalt thiocyanate, cobalt acetylacetonate, ammonium cobalt sulfate, ammonium cobalt nitrate, ammonium cobalt chloride, ammonium cobalt bromide, hexaamminecobalt chloride, hexaamminecobalt bromide, hexaamminecobalt nitrate, pentaamminecobalt chloride, pentaamminecobalt bromide, pentaamminecobalt nitrate, lithium cobaltinitrite, sodium cobaltinitrite, tris(ethylenediamine)cobalt chloride, tris(ethylenediamine)cobalt nitrate, bipyridine complexes of trivalent cobalt, phenanthroline complexes of trivalent cobalt, and cobalticarbonates, and combinations thereof.

51. The conversion coating bath of claim 46 wherein the conversion coating bath includes the preparative agent selected from fluorides, chlorides, bromides, and hydroxides, and combinations thereof.

52. The conversion coating bath of claim 51 wherein the preparative agent is a fluoride.

53. The conversion coating bath of claim 52 wherein the fluoride is selected from fluorozirconates, fluorotitanates, fluorosilicates, fluoroaluminates, fluoroborates, fluorogallates, fluoroindates, fluorogermanates, fluorostannates, fluorophosphates, fluoroarsenates, fluoroantimonates, fluorobismuthates, fluorosulfates, fluoroselenates, fluorotellurates, fluorocuprates, fluoroargentates, fluorozincates, fluorohafnates, fluorovanadates, fluoroniobates, fluorotantalates, fluoromolybdates, fluorotungstates, fluoroyttrates, fluorolanthanates, fluorocerates, fluoromanganates, fluoroferrates, fluoronickelates, fluorocobaltates, potassium fluoride, potassium hydrogen fluoride, sodium fluoride, sodium hydrogen fluoride, lithium fluoride, lithium hydrogen fluoride, ammonium fluoride, ammonium hydrogen fluoride, hydrofluoric acid, dissolved fluorine, and organic fluorides, and combinations thereof.

54. The conversion coating bath of claim 46 wherein the conversion coating bath includes the solubility control agent selected from a cationic solubility control agent and an anionic solubility control agent.

55. The conversion coating bath of claim 54 wherein the solubility control agent is the cationic solubility control agent selected from $H^+$, $Li^+$, $Na^+$, $K^+$, $Rb^+$, $Cs^+$, $NH_4^+$, $Mg^{+2}$, $Ca^{+2}$, $Sr^{+2}$, $Y^{+3}$, $La^{+3}$, $Ce^{+3}$, $Ce^{+4}$, $Nd^{+3}$, $P^{+3}$, $Sc^{+3}$, $Sm^{+3}$, $Eu^{+3}$, $Eu^{+2}$, $Gd^+$, $Tb^{+3}$, $Dy^{+3}$, $Ho^{+3}$, $Er^{+3}$, $Tm^{+3}$, $Yb^{+3}$, $Lu^{+3}$, $Ti^{+4}$, $Zr^{+4}$, $Ti^{+3}$, $Hf^4$, $Nb^{+5}$, $Ta^{+5}$, $Nb^{+4}$, $Ta^{+4}$, $Mo^{+6}$, $W^{+6}$, $Mo^{+5}$, $W^{+5}$, $Mo^{+4}$, $W^{+4}$, $Mn^{+2}$, $Mn^{+3}$, $Mn^{+4}$, $Fe^{+2}$, $Fe^{+3}$, $Co^{+2}$, $Co^{+3}$, $Ru^{+2}$, $Ru^{+3}$, $Ru^{+4}$, $Rh^{+3}$, $Ir^3$, $Rh^{+2}$, $Ir^{+2}$, $Pd^{+4}$, $Pt^{+4}$, $Pd^{+2}$, $Pt^{+2}$, $Cu^+$, $Cu^{+2}$, $Cu^{+3}$, $Ag^+$, $Ag^{+2}$, $Ag^{+3}$, $Au^+$, $Au^{+2}$ $Au^{+3}$, $Zn^{+2}$, $Al^{+3}$, $Ga^{+3}$, $Ga^+$, $In^{+3}$, $In^+$, $Ge^{+4}$, $Ge^{+2}$, $Sn^{+4}$, $Sn^{+2}$, $Sb^{+3}$, $Sb^{+5}$, $Bi^{+3}$, $Bi^{+5}$, organic compounds containing at least one $N^+$ site, organic compounds containing at least one phosphonium site, organic compounds containing at least one arsonium site, organic compounds containing at least one stibonium site, organic compounds containing at least one oxonium site, organic compounds containing at least one sulfonium site, organic compounds containing at least one selenonium site, organic compounds containing at least one iodonium site, and quaternary ammonium compounds having a formula $NR_4^+$, where R is an alkyl, aromatic, or acyclic organic constituent, and combinations thereof.

56. The conversion coating bath of claim 55 wherein the cationic solubility control agent is selected from $H^+$, $Li^+$, $Na^+$, $K^+$, $Rb^+$, $Cs^+$, $NH_4^+$, $Mg^{+2}$, $Ca^{+2}$, $Sr^{+2}$, $Y^{+3}$, $La^{+3}$, $Ce^{+3}$, $Ce^{+4}$, $Nd^{+3}$, $P^{+3}$, $Sc^{+3}$, $Sm^{+3}$, $Eu^{+3}$, $Eu^{+2}$, $Gd^+$, $Tb^{+3}$, $Dy^{+3}$, $Ho^{+3}$, $Er^{+3}$, $Tm^{+3}$, $Yb^{+3}$, $Lu^{+3}$, $Ti^{+4}$, $Zr^{+4}$, $Ti^{+3}$, $Hf^4$, $Nb^{+5}$, $Ta^{+5}$, $Nb^{+4}$, $Ta^{+4}$, $Mo^{+6}$, $W^{+6}$, $Mo^{+5}$, $W^{+5}$, $Mo^{+4}$, $W^{+4}$, $Mn^{+2}$, $Mn^{+3}$, $Mn^{+4}$, $Fe^{+2}$, $Fe^{+3}$, $Co^{+2}$, $Co^{+3}$, $Ru^{+2}$, $Ru^{+3}$, $Ru^{+4}$, $Rh^{+3}$, $Ir^3$, $Rh^{+2}$, $Ir^{+2}$, $Pd^{+4}$, $Pt^{+4}$, $Pd^{+2}$, $Pt^{+2}$, $Cu^+$, $Cu^{+2}$, $Cu^{+3}$, $Ag^+$, $Ag^{+2}$, $Ag^{+3}$, $Au^+$, $Au^{+2}$ $Au^{+3}$, $Zn^{+2}$, $Al^{+3}$, $Ga^{+3}$, $Ga^+$, $In^{+3}$, $In^+$, $Ge^{+4}$, $Ge^{+2}$, $Sn^{+4}$, $Sn^{+2}$, $Sb^{+3}$, $Sb^{+5}$, $Bi^{+3}$, $Bi^{+5}$, organic compounds containing at least one $N^+$ site, organic compounds containing at least one phosphonium site, organic compounds containing at least one stibonium site, organic compounds containing at least one oxonium site, organic compounds containing at least one sulfonium site, organic compounds containing at least one iodonium site, and quaternary ammonium compounds having a formula $NR_4^+$, where R is an alkyl, aromatic, or acyclic organic constituent, and combinations thereof.

57. The conversion coating bath of claim 54 wherein the solubility control agent is the anionic solubility control agent selected from fluorotitanates; chlorotitanates; fluorozirconates; chlorozirconates; fluoroniobates; chloroniobates; fluorotantalates; chlorotantalates; molybdates; tungstates; permanganates; fluoromanganates; chloromanganates; fluoroferrates; chloroferrates; fluorocobaltates; chlorocobaltates; fluorozincates; chlorozincates; borates; fluoroborates; fluoroaluminates; chloroaluminates; carbonates; silicates; fluorosilicates; fluorostannates; nitrates; nitrites; azides; cyanamides; phosphates; phosphites; phosphonates; phosphinites; thiophosphates; thiophosphites; thiophosphonates; thiophosphinites; fluorophosphates; fluoroantimonates; chloroantimonates; sulfates; sulfites; sulfonates; thiosulfates; dithionites; dithionates; fluorosulfates; tellurates; fluorides; chlorides; chlorates; perchlorates; bromides; bromates; iodides; iodates; periodates; heteropolyanions; fenicyanides; fenocyanides; cyanocobaltates; cyanocuprates; cyanomanganates; cyanates; cyanatoferrates; cyanatocobaltates; cyanatocuprates; cyanatomanganates; thiocyanates; thiocyanatoferrates; thiocyanatocobaltates; thiocyanatocuprates; thiocyanatomanganates; cyanamides; cyanamidofenates; cyanamidocobaltates; cyanamidocuprates; cyanamidomanganates; nitritofenates; nitritocobaltates; azides; (thio)carboxylates; di(thio)carboxylates; tri (thio)carboxylates; tetra(thio)carboxylates ; (thio) phenolates; di(thio)phenolates; tri(thio)phenolates; tetra (thio)phenolates; (thio)phosphonates; di(thio)phosphonates; tri(thio)phosphonates; (thio)phosphonamides; di(thio)phosphonamides; tri(thio)phosphonamides; amino(thio)phosphonates; diamino(thio)phosphonates; triamino(thio)phosphonates; imino(thio)phosphonates; diimino(thio) phosphonates; (thio)sulfonates; di(thio)sulfonates; tri(thio) sulfonates; (thio)sulfonamides; di(thio)sulfonamides; tri (thio)sulfonamides; amino(thio)sulfonates; diamino(thio) sulfonates; triamino(thio)sulfonates; imino(thio)sulfonates; diimino(thio)sulfonates; (thio)borates; di(thio)borates; (thio)boronates; organic silicates; stibonates; cyanides; cyanochromates; cyanonickelates; cyanatochromates; cyanatonickelates; thiocyanatochromates; thiocyanatonickelates; cyanamidochromates; cyanamidonickelates; nitritonickelates; arsonates; diarsonates; triarsonates; organic selenates; diselenates; triselenates; arsenates; arsenites; fluoroarsenates; chioroarsenates; selenates; selenites; fluorothallates; chiorothallates; iodomercury anions; chioromercurates; bromomercurates; osmates; fluoronickelates; chromates; Reinecke's salt; and vanadates; and combinations thereof.

58. The conversion coating bath of claim 57 wherein the anionic solubility control agent is selected from fluorotitanates; chlorotitanates; fluorozirconates; chlorozirconates; fluoroniobates; chloroniobates; fluorotantalates; chlorotantalates; molybdates; tungstates; permanganates; fluoromanganates; chloromanganates; fluoroferrates; chloroferrates; fluorocobaltates; chlorocobaltates; fluorozincates; chlorozincates; borates; fluoroborates; fluoroaluminates; chloroaluminates; carbonates; silicates; fluorosilicates; fluorostannates; nitrates; nitrites; azides; cyanamides; phosphates; phosphites; phosphonates; phosphinites; thiophosphates; thiophosphites; thiophosphonates; thiophosphinites; fluorophosphates; fluoroantimonates; chloroantimonates; sulfates; sulfites; sulfonates; thiosulfates; dithionites; dithionates; fluorosulfates; tellurates; fluorides; chlorides; chlorates; perchlorates; bromides; bromates; iodides; iodates; periodates; heteropolyanions; ferricyanides; ferrocyanides; cyanocobaltates; cyanocuprates; cyanomanganates; cyanates; cyanatofenates; cyanatocobaltates; cyanatocuprates; cyanatomanganates; thiocyanates; thiocyanatoferrates; thiocyanatocobaltates; thiocyanatocuprates; thiocyanatomanganates; cyanamides; cyanamidoferrates; cyanamidocobaltates; cyanamidocuprates; cyanamidomanganates; nitritofenates; nitritocobaltates; azides; (thio)carboxylates; di(thio)carboxylates; tri(thio)carboxylates; tetra(thio)carboxylates; (thio)phenolates; di(thio)phenolates; tri(thio)phenolates; tetra(thio)phenolates; (thio)phosphonates; di(thio) phosphonates; tri(thio)phosphonates; (thio) phosphonamides; di(thio)phosphonamides; tri(thio) phosphonamides; amino(thio)phosphonates; diamino(thio) phosphonates; triamino(thio)phosphonates; imino(thio) phosphonates; diimino(thio)phosphonates; (thio)sulfonates; di(thio)sulfonates; tri(thio)sulfonates; (thio)sulfonamides; di(thio)sulfonamides; tri(thio)sulfonamides; amino(thio)sulfonates; diamino(thio)sulfonates; triamino(thio)sulfonates; imino(thio)sulfonates; diimino(thio)sulfonates; (thio)borates; di(thio)borates; (thio)boronates; organic silicates; and stibonates; and combinations thereof.

59. The conversion coating bath of claim 46 wherein the conversion coating bath has a concentration of cobalt of between about $1\times10^{-4}$ moles/liter cobalt and a concentration which is a maximum solubility of the cobalt source in the solvent at a temperature of the conversion coating bath.

60. The conversion coating bath of claim 48 wherein the conversion coating bath has a concentration of oxidizer of between a minimum concentration wherein a majority of the cobalt is oxidized to a trivalent or tetravalent oxidation state and a maximum solubility of the oxidizer in the solvent at a temperature of the conversion coating bath.

61. The conversion coating bath of claim 51 wherein the conversion coating bath has a concentration of preparative agent between a minimum concentration wherein there is a fluoride-to-cobalt ratio of 0.05 and a maximum concentration which is a maximum solubility of the preparative agent in the solvent at a temperature of the conversion coating bath.

62. The conversion coating bath of claim 46 wherein the conversion coating bath has a concentration of valence stabilizer between a minimum concentration wherein there is a valence stabilizer-to-cobalt ratio of 0.010 and a maximum concentration which is a maximum solubility of the valence stabilizer in the solvent at a temperature of the conversion coating bath.

63. The conversion coating bath of claim 46 wherein the conversion coating bath has a pH of between about 0 and about 7.

64. The conversion coating bath of claim 63 wherein the conversion coating bath has a pH of between about 1 and about 6.

65. The conversion coating bath of claim 46 wherein the conversion coating bath has a temperature of between about 50° C. and about 100° C.

66. The conversion coating bath of claim 65 wherein the conversion coating bath has a temperature of between about 50° C. and about 400° C.

67. A solid conosion-inhibiting conversion coating formed on a substrate metal, the conversion coating comprising cobalt, wherein the cobalt is trivalent cobalt, or tetravalent cobalt, or combinations thereof, and a valence stabilizer combined to form a cobalt/valence stabilizer complex within the solid, conosion-inhibiting conversion coating, wherein the cobalt/valence stabilizer complex is sparingly soluble in water at about 25° C. and about 760 Torr, and wherein the valence stabilizer is selected from an organic valence stabilizer and an inorganic valence stabilizer, with the proviso that the inorganic valence stabilizer is not a vanadate or a tungstate, and the organic valence stabilizer is not a carboxylate.

68. A conosion-inhibiting conversion coating bath comprising a solvent, a precursor cobalt source, and a valence stabilizer combined to form a cobalt/valence stabilizer complex, optionally an oxidizer, optionally preparative agent, and optionally a solubility control agent, wherein the cobalt/valence stabilizer complex is sparingly soluble in water at about 25° C. and about 760 Torr, and wherein the valence stabilizer is selected from an organic valence stabilizer and an inorganic valence stabilizer, with the proviso that the inorganic valence stabilizer is not a vanadate or a tungstate, and the organic valance stabilizer is not a carboxylate.

69. A conosion-inhibiting conversion coating comprising cobalt, wherein the cobalt is trivalent cobalt, or tetravalent cobalt, or combinations thereof, and a valence stabilizer combined to form a cobalt/valence stabilizer complex wherein the cobalt/valence stabilizer complex has a central cavity containing a cobalt ion and an additional ion wherein the additional ion is $B^{+3}$, $Al^{+3}$, $Si^{+4}$, $P^{+5}$, $Ti^{+4}$, $V^{+5}$, $V^{+4}$, $Cr^{+6}$, $Cr^{+3}$, $Mn^{+4}$, $Mn^{+3}$, $Mn^{+2}$, $Fe^{+3}$, $Fe^{+2}$, $Co^{+2}$, $Ni^{+2}$, $Ni^{+3}$, $Ni^{+4}$, $Cu^{+2}$, $Cu^{+3}$, $Zn^{+2}$, $Ga^{+3}$, $Ge^{+4}$, $As^{+5}$, $As^{+3}$, $Zr^{+4}$, or $Ce^{+4}$.

70. A conosion-inhibiting conversion coating comprising cobalt, wherein the cobalt is trivalent cobalt, or tetravalent cobalt, or combinations thereof, and a valence stabilizer combined to form a cobalt/valence stabilizer complex wherein the valence stabilizer is an organic valence stabilizer selected from monoamines; diamines; triamines; tetraamines; pentamines; hexamines; five- or six-membered heterocyclic rings containing one to four nitrogen atoms optionally having additional nitrogen, sulfur, or oxygen binding sites; five- or six-membered heterocyclic rings containing one or two sulfur atoms and having additional nitrogen binding sites; five- or six-membered heterocyclic rings containing one or two oxygen atoms and having additional nitrogen binding sites; (two-, three-, four-, six-, eight-, or ten-)membered nitrogen, nitrogen-sulfur, or nitrogen-oxygen macrocyclics; macrocyclic oligothioketones or dithiolenes; diazenes; thio-, amido-, or imido-derivatives of hypophosphoric, phosphoric, or diphosphoric acids and salts; azo compounds, triazenes, formazans, azines, hydrazones, or Schiff Bases containing at least two azo, imine, or azine groups; azo compounds, triazenes, formazans, azines, hydrazones, or Schiff Bases with ortho-(for aryl) or alpha- or beta-(for alkyl) substitution; oximes; amidines and imido compounds; dithio ligands; amides; amino acids; N-(thio) acyl 7-aminobenzylidenimines; (thio)hydroxamates; alpha- or ortho-aminothio(di)carboxylic acids and salts; (thio)semicarbazones; (thio)acyl hydrazones; (thio)carbazones; silylaminoalcohols; thioalkyl amines and imines; hydroxyalkyl imines; (thio)aryl amines and imines; guanylureas; guanidinoureas; 2-nitrosophenols; 2-nitrophenols; N-nitrosohydroxylamines; 1,3-monothioketones; monothiomalonamides; 2-thioacylacetamides; 2-acylthioacetamides; dithiodicarbonic diamides; trithiodicarboxylic acids and salts; monothiocarbamates; monothioethers; dithioethers; trithioethers; tetrathioethers; pentathioethers; hexathioethers; disulfides; monophosphines; diphosphines; triphosphines; tetraphosphines; pentaphosphines; hexaphosphines; five- or six-membered heterocyclic rings containing one or two sulfur atoms optionally having additional sulfur, oxygen, or phosphorus binding sites; five- or six-membered heterocyclic rings containing one to three phosphorus atoms optionally having additional phosphorus, nitrogen, oxygen, or sulfur binding sites; five- or six-membered heterocyclic rings containing one to four nitrogen atoms and having additional phosphorus binding sites; five- or six-membered heterocyclic rings containing one or two oxygen atoms and having additional sulfur or phosphorus binding sites; (five-, seven-, or nine-)membered nitrogen, nitrogen-sulfur, or nitrogen-oxygen macrocyclics; (two- to ten-)membered sulfur, sulfur-oxygen, or sulfur-phosphorus macrocyclics, not including oligothioketones or dithiolenes; (two- to ten-) membered phosphorus, nitrogen-phosphorus, or oxygen-phosphorus macrocyclics; thio-, amido-, or imido-derivatives of phosphonic and diphosphonic acids and salts containing no sulfur binding sites; amido-, or imido-derivatives of hypophosphoric, phosphoric, or diphosphoric acids and salts containing no sulfur binding sites; dithioperoxydiphosphoramides; dithioperoxydiphosphoric acids and salts; monothioperoxydiphosphoramides; monothioperoxydiphosphoric acids and salts; monothiophosphoric acids; phosphoro(dithioperoxoic) acids and salts; azo compounds, triazenes, formazans, azines, or Schiff Bases; silylamines; silazanes; guanidines and diguanidines; pyridinaldimines; hydrazones; hydramides; nitriles; thioureas and thioamides; ureas and biurets; monothio ligands; diketone ligands; dithioacyl disulfides; tetrathioperoxydicarbonic diamides; (hexa-, penta-, or tetra-) thioperoxydicarbonic acids and salts; 1,2-dithiolates; rhodanines; dithiocarbimates; (thio) xanthates; S-(alkyl- or aryl-thio)thiocarboxylic acids and salts; phosphinodithioformates; (thio)borates and (thio)boronates; (thio)arsonic acids and salts; (thio)antimonic acids and salts; phosphine and arsine sulfides or oxides; beta-hydroxyketones and aldehydes; squaric acids and salts; carbamates and carbimates; carbazates; imidosulfurous diamides; sulfurdiimines; thiocarbonyl and mercapto oximes; 2-nitrothiophenols; 2-nitrilo(thio)phenols; acylcyanamides; imidates; 2-amidinoacetates; beta-ketoamines; 3-aminoacrylamides and 3,3-diaminoacrylamides; 3-aminoacrylic acids and salts and 3-hydroxy-3-aminoacrylic acids and salts; 2-nitroanilines; amine and diazine N-oxides; hydrazides and semicarbazides; (amino- or imino-)aryl phosphines; (thio- or hydroxy-)aryl phosphines; arsines; five- or six-membered heterocyclic rings containing one arsenic atom optionally having additional arsenic binding sites;(two- to six-)membered arsenic macrocyclics; selenoethers; five- or six-membered heterocyclic rings containing one or two selenium atoms optionally having additional selenium binding sites; (two- to six-)membered selenium macrocyclics; 1,3-diselenoketones; 1,1-diselenolates; diselenocarbamates; selenophosphoric acids and salts; selenocarbonates; cyanide, isocyanide, and cyanamide ligands; nitrosyl and nitrite ligands; azide ligands; thiolates and selenolates; (thio)cyanate ligands; diene or bicyclic or tricyclic hydrocarbon ligands; and carbonyl, halogen, or hydroxo ligands; and combinations thereof; and wherein the solubility in water of the cobalt/valence stabilizer complex is decreased by the addition of a substituent group on the organic valence stabilizer, the substituent group selected from nitro groups (—$NO_2$), peffluoroalkyl groups (—$C_xF_{2x+1}$), perchloroalkyl groups (—$C_xCl_{2x+1}$), nitramine groups (═N—$NO_2$), thioketone groups (═C═S), sulfenyl halide groups (—S—X), and sulfur dihaloimide groups (—N═$SX_2$), and combinations thereof.

71. A conosion-inhibiting conversion coating comprising cobalt, wherein the cobalt is trivalent cobalt, or tetravalent cobalt, or combinations thereof, and a valence stabilizer combined to form a cobalt/valence stabilizer complex wherein the valence stabilizer is an organic valence stabilizer selected from monoamines; diamines; triamines; tetraamines; pentamines; hexamines; five- or six-membered heterocyclic rings containing one to four nitrogen atoms optionally having additional nitrogen, sulfur, or oxygen binding sites; five- or six-membered heterocyclic rings containing one or two sulfur atoms and having additional nitrogen binding sites; five- or six-membered heterocyclic rings containing one or two oxygen atoms and having additional nitrogen binding sites; (two-, three-, four-, six-, eight-, or ten-)membered nitrogen, nitrogen-sulfur, or nitrogen-oxygen macrocyclics; macrocyclic oligothioketones or dithiolenes; diazenes; thio-, amido-, or imido-derivatives of hypophosphoric, phosphoric, or diphosphoric acids and salts; azo compounds, triazenes, formazans, azines, hydrazones, or Schiff Bases containing at least two azo, imine, or azine groups; azo compounds, triazenes, formazans, azines, hydrazones, or Schiff Bases with ortho-(for aryl) or alpha- or beta-(for alkyl) substitution; oximes; amidines and imido compounds; dithio ligands; amides; amino acids; N-(thio) acyl 7-aminobenzylidenimines; (thio)hydroxamates; alpha- or ortho-aminothio(di)carboxylic acids and salts; (thio)semicarbazones; (thio)acyl hydrazones; (thio)carbazones; silylaminoalcohols; thioalkyl amines and imines; hydroxyalkyl imines; (thio)aryl amines and imines; guanylureas; guanidinoureas; 2-nitrosophenols; 2-nitrophenols; N-nitrosohydroxylamines; 1,3-monothioketones; monothiomalonamides; 2-thioacylacetamides; 2-acylthioacetamides; dithiodicarbonic diamides; trithiodicarboxylic acids and salts; monothiocarbamates; monothioethers; dithioethers; trithioethers; tetrathioethers; pentathioethers; hexathioethers; disulfides; monophosphines; diphosphines; triphosphines; tetraphosphines; pentaphosphines; hexaphosphines; five- or six-membered heterocyclic rings containing one or two sulfur atoms optionally having additional sulfur, oxygen, or phosphorus binding sites; five- or six-membered heterocyclic rings containing one to three phosphorus atoms optionally having additional phosphorus, nitrogen, oxygen, or sulfur binding sites; five- or six-membered heterocyclic rings containing one to four nitrogen atoms and having additional phosphorus binding sites; five- or six-membered heterocyclic rings containing one or two oxygen atoms and having additional sulfur or phosphorus binding sites; (five-, seven-, or nine-)membered nitrogen, nitrogen-sulfur, or nitrogen-oxygen macrocyclics; (two- to ten-)membered sulfur, sulfur-oxygen, or sulfur-phosphorus macrocyclics, not including oligothioketones or dithiolenes; (two- to ten-) membered phosphorus, nitrogen-phosphorus, or oxygen-phosphorus macrocyclics; thio-, amido-, or imido-derivatives of phosphonic and diphosphonic acids and salts containing no sulfur binding sites; amido-, or imido-derivatives of hypophosphoric, phosphoric, or diphosphoric acids and salts containing no sulfur binding sites; dithioperoxydiphosphoramides; dithioperoxydiphosphoric acids and salts; monothioperoxydiphosphoramides; monothioperoxydiphosphoric acids and salts; monothiophosphoric acids; phosphoro(dithioperoxoic) acids and salts; azo compounds, triazenes, formazans, azines, or Schiff Bases; silylamines; silazanes; guanidines and diguanidines; pyridinaldimines; hydrazones; hydramides; nitriles; thioureas and thioamides; ureas and biurets; monothio ligands; diketone ligands; dithioacyl disulfides; tetrathioperoxydicarbonic diamides; (hexa-, penta-, or tetra-) thioperoxydicarbonic acids and salts; 1,2-dithiolates; rhodanines; dithiocarbimates; (thio) xanthates; S-(alkyl- or aryl-thio)thiocarboxylic acids and salts; phosphinodithioformates; (thio)borates and (thio)boronates; (thio)arsonic acids and salts; (thio)antimonic acids and salts; phosphine and arsine sulfides or oxides; beta-hydroxyketones and aldehydes; squaric acids and salts; carbamates and carbimates; carbazates; imidosulfurous diamides; sulfurdiimines; thiocarbonyl and mercapto oximes; 2-nitrothiophenols; 2-nitrilo(thio)phenols; acylcyanamides; imidates; 2-amidinoacetates; beta-ketoamines; 3-aminoacrylamides and 3,3-diaminoacrylamides; 3-aminoacrylic acids and salts and 3-hydroxy-3-aminoacrylic acids and salts; 2-nitroanilines; amine and diazine N-oxides; hydrazides and semicarbazides; (amino- or imino-)aryl phosphines; (thio- or hydroxy-)aryl phosphines; arsines; five- or six-membered heterocyclic rings containing one arsenic atom optionally having additional arsenic binding sites;(two- to six-)membered arsenic macrocyclics; selenoethers; five- or six-membered heterocyclic rings containing one or two selenium atoms optionally having additional selenium binding sites; (two- to six-)membered selenium macrocyclics; 1,3-diselenoketones; 1,1-diselenolates; diselenocarbamates; selenophosphoric acids and salts; selenocarbonates; cyanide, isocyanide, and cyanamide ligands; nitrosyl and nitrite ligands; azide ligands; thiolates and selenolates; (thio)cyanate ligands; diene or bicyclic or tricyclic hydrocarbon ligands; and carbonyl, halogen, or hydroxo ligands; and combinations thereof; and wherein an electrostatic barrier layer of the cobalt/valence stabilizer complex is increased by the addition of a substituent group on the organic valence stabilizer, the substituent group selected from ketones (═C═O), thioketones (═C═S), amides (—C[═O]—$NR_2$), thioamides (—C[═S]—$NR_2$), nitriles or cyano groups, (—CN), isocyanides (—NC), nitroso groups (—N═O), thionitroso groups (—N═S), nitro groups (—$NO_2$), azido groups (—$N_3$), cyanamide or cyanonitrene groups (═N—CN), cyanate groups (—O—CN), isocyanate groups (—N═C═O), thiocyanate groups (—S—CN), isothiocyanate groups (—N═C═S), nitrosamine groups (═N—N═O), thionitrosamine groups (═N—N═S), nitramine groups (═N—$NO_2$), thionitramine groups (═N—$NS_2$), carbonylnitrene groups (—CO—N), thiocarbonylnitrene groups (—CS—N), sulfenyl halides (—S—X), sulfoxides (═S═O), sulfones (═S[═O]$_2$), sulfinyl groups (—N═S═O), thiosulfinyl groups (—N═S═S), sulfenyl thiocyanato groups (—S—S—CN), sulfenyl cyanato groups (—S—O—CN), sulfodjimine groups (═S[═NH]$_2$), sulfur dihaloimido groups (—N═$SX_2$), sulfur oxide dihaloimido groups (—N═S[═O]$X_2$), aminosulfur oxide trihalide groups (═N—S[═O]$X_3$), sulfonyl azide groups (—S[═O]$_2N_3$), sulfonyl thiocyanate groups (—S[═O]$_2$SCN), sulfonyl cyanate groups (—S[═O]$_2$OCN), sulfonyl cyanide groups (—S[═O]$_2$CN), halosulfonate groups (—S[═O]$_2$OX), phosphonyl thiocyanate groups (—P[═O]OHSCN), phosphonyl cyanate groups (—P[═O]OHOCN), and phosphonyl cyanide groups (—P[═O]OHCN), and combinations thereof.

* * * * *